US007270628B2

(12) United States Patent
Campanaro et al.

(10) Patent No.: US 7,270,628 B2
(45) **Date of Patent: *Sep. 18, 2007**

(54) METHOD OF USING A COLLAPSIBLE EXERCISE DEVICE

(75) Inventors: Thomas J. Campanaro, Rancho Santa Fe, CA (US); Joy L. Campanaro, Rancho Santa Fe, CA (US); Larry Westfall, San Diego, CA (US); Dale Mc Murray, San Diego, CA (US)

(73) Assignee: Engineering Fitness International Corp., San Diego, CA (US)

( * ) Notice: Subject to any disclaimer, the term of this patent is extended or adjusted under 35 U.S.C. 154(b) by 620 days.

This patent is subject to a terminal disclaimer.

(21) Appl. No.: 10/785,541

(22) Filed: Feb. 24, 2004

(65) Prior Publication Data

US 2004/0248713 A1 Dec. 9, 2004

Related U.S. Application Data

(63) Continuation-in-part of application No. 10/376,044, filed on Feb. 26, 2003, now Pat. No. 6,921,355.

(60) Provisional application No. 60/482,199, filed on Jun. 23, 2003, provisional application No. 60/469,283, filed on May 9, 2003.

(51) Int. Cl.
*A63B 21/068* (2006.01)

(52) U.S. Cl. ..... 482/95; 482/103; 482/135; 482/138; 482/140; 482/141; 482/145

(58) Field of Classification Search ..... 482/96, 482/135, 138, 140–142, 145, 908
See application file for complete search history.

(56) References Cited

U.S. PATENT DOCUMENTS

| | | | | |
|---|---|---|---|---|
| 3,711,812 | A | 1/1973 | Cherry | |
| 3,870,297 | A | 3/1975 | Elder | |
| 3,892,404 | A * | 7/1975 | Martucci | 482/96 |
| 4,004,801 | A | 1/1977 | Campanaro et al. | |
| 4,383,684 | A * | 5/1983 | Schliep | 482/96 |
| 4,672,697 | A | 6/1987 | Schurch | |
| 4,863,161 | A | 9/1989 | Telle | |
| 4,911,438 | A * | 3/1990 | Van Straaten | 482/96 |
| 5,066,005 | A * | 11/1991 | Luecke | 482/96 |
| 5,169,363 | A | 12/1992 | Campanaro et al. | |
| 5,308,296 | A | 5/1994 | Eckstein | |
| 5,620,403 | A * | 4/1997 | Lundin | 482/96 |

(Continued)

*Primary Examiner*—Cary E. O'Connor
*Assistant Examiner*—Victor K. Hwang
(74) *Attorney, Agent, or Firm*—Stephen C. Beuerle; Procopio Cory Hargreaves & Savitch LLP

(57) ABSTRACT

An aspect of the invention involves a method of using a collapsible exercise device including providing a collapsible exercise device; positioning a first end of an adjustable incline at a desired height with respect to a vertical support member so that the adjustable incline is at a desired inclination; moving first and second combination pulley-support and pull-up bars to a desired position; moving first and second pulleys connected to the first and second combination pulley-support and pull-up bars to a desired location; and moving a support platform along the adjustable incline through cable movement through the first and second pulleys on the combination pulley-support and pull-up bars.

17 Claims, 21 Drawing Sheets

U.S. PATENT DOCUMENTS 5,645,509 A 7/1997 Brewer et al.
5,785,631 A 7/1998 Heidecke
D405,132 S 2/1999 Westfall et al.
5,906,564 A * 5/1999 Jacobsen ..... 482/96
5,910,070 A 6/1999 Henry et al.
5,938,571 A * 8/1999 Stevens ..... 482/96
5,967,955 A 10/1999 Westfall et al.
6,042,508 A 3/2000 Clem et al.
6,117,049 A 9/2000 Lowe
6,390,951 B1 5/2002 Daniel
6,409,631 B1 6/2002 Alessandri
6,500,097 B1 12/2002 Hall
6,632,161 B1 10/2003 Nir
6,634,996 B2 * 10/2003 Jacobsen ..... 482/96
6,692,412 B2 * 2/2004 Chen et al. ..... 482/96
6,740,009 B1 5/2004 Hall
6,767,314 B2 * 7/2004 Thompson ..... 482/96
6,786,847 B1 9/2004 Morgan et al.
6,921,355 B2 * 7/2005 Campanaro et al. ..... 482/95
7,104,937 B2 * 9/2006 Arbuckle et al. ..... 482/142
7,125,369 B2 * 10/2006 Endelman ..... 482/142
7,204,790 B2 * 4/2007 Sleamaker ..... 482/96
2003/0139264 A1 7/2003 Kuo
2003/0199363 A1 10/2003 Chen
2005/0026750 A1 2/2005 Oglesby et al.
2005/0159278 A1 * 7/2005 McVay et al. ..... 482/142

* cited by examiner 110
830
940
700
230
120
260
100
1000
320
240
410
385
390
450
620
240

501
504
503
502
505
415
420
430
380
450
440
501
D
360
370

110
830
940
100
B
700
1000
320
230
260
120
620
240

700
750
740
710
730
760
720
780
770
820
790
800
810

EXERCISE RESISTANCE CHART

| BODYWEIGHT | LEVEL | 1 | 2 | 3 | 4 | 5 | 6 | 7 | 8 |
|---|---|---|---|---|---|---|---|---|---|
| | Slope in Degrees | 4.5° | 7.5° | 10.5° | 13.5° | 16.5° | 20° | 24° | 27° |
| | % | 10 | 16 | 23 | 29 | 35 | 42 | 50 | 56 |
| 100 | weight | 10 | 16 | 23 | 29 | 35 | 42 | 50 | 56 |
| | % | 10 | 16 | 22 | 29 | 35 | 42 | 50 | 55 |
| 110 | weight | 11 | 18 | 24 | 31 | 38 | 46 | 55 | 61 |
| | % | 10 | 16 | 22 | 28 | 34 | 41 | 49 | 55 |
| 120 | weight | 12 | 19 | 26 | 34 | 41 | 49 | 59 | 65 |
| | % | 9 | 16 | 22 | 28 | 34 | 41 | 48 | 54 |
| 130 | weight | 12 | 20 | 28 | 36 | 44 | 53 | 63 | 70 |
| | % | 9 | 15 | 21 | 27 | 33 | 40 | 48 | 53 |
| 140 | weight | 13 | 21 | 30 | 38 | 47 | 56 | 67 | 74 |
| | % | 9 | 15 | 21 | 27 | 33 | 40 | 47 | 53 |
| 150 | weight | 14 | 23 | 32 | 41 | 49 | 60 | 71 | 79 |
| | % | 9 | 15 | 21 | 27 | 33 | 39 | 47 | 52 |
| 160 | weight | 14 | 24 | 34 | 43 | 52 | 63 | 75 | 84 |
| | % | 9 | 15 | 21 | 27 | 32 | 39 | 46 | 52 |
| 170 | weight | 15 | 25 | 35 | 45 | 55 | 66 | 79 | 88 |
| | % | 9 | 15 | 21 | 26 | 32 | 39 | 46 | 51 |
| 180 | weight | 16 | 27 | 37 | 48 | 58 | 70 | 83 | 93 |
| | % | 9 | 15 | 21 | 26 | 32 | 39 | 46 | 51 |
| 190 | weight | 17 | 28 | 39 | 50 | 61 | 73 | 87 | 97 |
| | % | 9 | 15 | 20 | 26 | 32 | 38 | 46 | 51 |
| 200 | weight | 18 | 29 | 41 | 52 | 64 | 77 | 91 | 102 |
| | % | 9 | 15 | 20 | 26 | 32 | 38 | 45 | 51 |
| 210 | weight | 18 | 30 | 43 | 55 | 66 | 80 | 95 | 106 |
| | % | 9 | 15 | 20 | 26 | 32 | 38 | 45 | 50 |
| 220 | weight | 19 | 32 | 45 | 57 | 69 | 83 | 99 | 110 |
| | % | 9 | 14 | 20 | 26 | 31 | 38 | 45 | 50 |
| 230 | weight | 20 | 33 | 46 | 59 | 72 | 87 | 103 | 115 |
| | % | 9 | 14 | 20 | 26 | 32 | 38 | 45 | 50 |
| 240 | weight | 21 | 35 | 48 | 62 | 75 | 90 | 107 | 120 |
| | % | 9 | 14 | 20 | 26 | 31 | 38 | 45 | 50 |
| 250 | weight | 22 | 36 | 50 | 64 | 78 | 94 | 111 | 124 |
| | % | 9 | 14 | 20 | 26 | 31 | 37 | 44 | 50 |
| 260 | weight | 22 | 37 | 52 | 66 | 81 | 97 | 116 | 129 |
| | % | 9 | 14 | 20 | 25 | 31 | 37 | 44 | 49 |
| 270 | weight | 23 | 38 | 54 | 69 | 84 | 100 | 120 | 133 |
| | % | 9 | 14 | 20 | 25 | 31 | 37 | 44 | 49 |
| 280 | weight | 24 | 40 | 55 | 71 | 86 | 104 | 124 | 138 |
| | % | 9 | 14 | 20 | 25 | 31 | 37 | 44 | 49 |
| 290 | weight | 25 | 41 | 57 | 73 | 89 | 107 | 128 | 143 |
| | % | 9 | 14 | 20 | 25 | 31 | 37 | 44 | 49 |
| 300 | weight | 27 | 42 | 59 | 76 | 92 | 111 | 132 | 147 |

FIG. 18

| | BEGINNER | INTERMEDIATE | ADVANCED |
|---|---|---|---|
| Selection | Single joint & multiple joint | Single joint & multiple joint emphasis on MJ | Single joint & multiple joint |
| Order | Large to small muscle groups | Multiple joint to single joint | High intensity to low intensity |
| Loading | 60–70% of 1 Rep max. | 70–80% of 1 rep max. | 70%–100% of 1 rep max. 70–85% periodized |
| Volume | 1–3 Sets, 8–12 Reps | Multiple sets 6–12 reps | Multiple sets, 1–12 reps with emphasis on 6-12 reps periodized |
| Rest Interval | 2–3 mins. for core 1–2 mins. for others | 2–3 mins. for core 1–2 mins. for others | 2–3 mins. for core 1–2 mins. for others |
| Velocity | Slow to moderate | Moderate | Intentionally slow to fast |
| Frequency | 2–3 x / week | 2–4 x / week | 4–6 x / week |

FIG. 19

| | BEGINNER | INTERMEDIATE | ADVANCED |
|---|---|---|---|
| Selection | Single joint & multiple joint | Single joint & multiple joint with emphasis on MJ | Single joint & multiple joint |
| Order | Large to small muscle groups | Multiple joint to single joint | High intensity to low intensity |
| Loading | 60–70% of 1 Rep max. | 70–80% of 1 rep max. | 70%–100% of 1 rep max. 70–85% periodized |
| Volume | 1–3 Sets, 8–12 Reps | Multiple sets 6–12 reps | Multiple sets, 1–12 reps with emphasis on 6-12 reps periodized |
| Rest Interval | 1–2 mins. | 1–2 mins. | 2–3 mins. for heavy sets. 1–2 mins. for light to moderate |
| Velocity | Slow to moderate | Slow to moderate | Slow, moderate, fast |
| Frequency | 2–3 x / week | 2–4 x / week | 4–6 x / week |

FIG. 20

| | BEGINNER | INTERMEDIATE | ADVANCED |
|---|---|---|---|
| Selection | Primarily multiple joint | Primarily multiple joint | Primarily multiple joint |
| Order | Large to small muscle groups | Most complex to least complex | High intensity to low intensity |
| Loading | >80% 1 RM-strength<br>30–60% 1RM endurance | >80% 1 RM-strength<br>30–60% 1RM endurance | >80% 1 RM-strength<br>30–60% 1RM endurance |
| Volume | Train for Strength | 1–3 sets, 3–6 reps | 1–3 sets, 3–6 reps |
| Rest Interval | 2–3 mins. for core | 2–3 mins. for core<br>1–2 mins. for others | 2–3 mins. for core<br>1–2 mins. for others |
| Velocity | Moderate | Fast | Fast |
| Frequency | 2–3 x / week | 2–4 x / week | 4–6 x / week |

FIG. 21

| | BEGINNER | INTERMEDIATE | ADVANCED |
|---|---|---|---|
| Selection | Single joint & multiple joint | Single joint & multiple joint | Single joint & multiple joint |
| Order | Variety in sequencing | Variety in sequencing | Variety in sequencing |
| Loading | 50–70% of 1 Rep max. | 50–70% of 1 Rep max. | 30–80% of 1 Rep max. |
| Volume | 1–3 Sets, 10–15 Reps | Multiple sets 10–15 reps or more | Multiple sets, 10–25 reps or more |
| Rest Interval | 1–2 mins. for high rep sets | 1–2 mins. for high rep sets | <1 min. for 10-15 reps |
| Velocity | Slow to moderate repetitions | Moderate to high repetitions | Moderate to high repetitions |
| Frequency | 2–3 x / week | 2–4 x / week | 4–6 x / week |

FIG. 22

METHOD OF USING A COLLAPSIBLE EXERCISE DEVICE

CROSS-REFERENCE TO RELATED APPLICATIONS

This application is a continuation-in-part application of U.S. application Ser. No. 10/376,044, filed Feb. 26, 2003, now U.S. Pat. No. 6,921,355, and claims the benefit of prior provisional application 60/469,283 filed on May 9, 2003 and prior provisional application 60/482,199 filed on Jun. 23, 2003.

FIELD OF THE INVENTION

The present invention relates, in general, to an exercise device and a method of using the same. More particularly, the present invention relates to an exercise device and method wherein the exerciser exerts muscle force against an adjustable portion of the exerciser's own body weight, and other methods described herein.

BACKGROUND OF THE INVENTION

Home exercise is becoming increasingly more popular. Home exercise offers the health benefits of regular exercise while recognizing that many people have difficulty in finding sufficient time in their schedule for a full workout at a health club or gymnasium. An exerciser may exercise at home whenever the exerciser's schedule permits. This flexibility in scheduling often allows for a more consistent and thus healthful exercise regime.

Home exercise, however, has its drawbacks. In particular, in order to exercise all or most of the muscle groups, multiple pieces of home exercise equipment may be required. Furthermore, these multiple pieces of equipment may require permanent installation in the exerciser's home.

Permanent or not, many popular pieces of home exercise equipment occupy a great deal of space. This makes the use of this equipment impractical in homes or apartments which do not have the required extra space. Furthermore, non-permanent pieces of equipment are often difficult to disassemble and may require much storage space even when disassembled. A user must then often choose between an exercise device providing a complete exercise regime and a device which fits the exerciser's home space.

There is, thus, a need for exercise equipment which may be easily stored when not in use, does not occupy a great deal of space when in use and provides for exercising all or most of the muscle groups.

Exercise devices are known in which a user, positioned on a support platform, propels that support platform up an inclined ramp. One way by which the platform may be propelled is by pulling a cable connected to the support platform through a variety of pulleys positioned on the exercise device. By changing positions on the platform and by changing the method by which the platform is propelled, a user can exercise multiple muscle groups.

While early versions of these devices did not allow for easy storage, later designs were proposed that allowed for some type of disassembly in the design. Even the later designs do not, however, provide complete foldability of the exercise unit. The designs include some separate elements which must be disengaged to allow for foldability of the device. Thus, these designs cannot be folded and stored as a unit. Moreover, the designs are not easily converted from the folded stored state to an unfolded state for use.

Another problem with early versions of these devices is that they did not allow for a wide variety of different types of muscle exercises, especially multiple muscle exercises for each specific muscle group.

In view of the foregoing, there is a need for an inclined ramp exercise device which is easily foldable to a size which allows for easy storage, is easily unfolded into a useable state, and which allows for exercising multiple muscle groups and multiple exercises for each muscle group.

There is also a need for multiple exercises, sequences of exercises, instruction, and education related to an inclined ramp exercise device.

In the inclined ramp exercise device, a user can make the workout more difficult by increasing the angle and height of the inclined ramp on which the platform is propelled. In the past, this was manually performed by the user by lifting one end of an inclined ramp and setting the inclined ramp at a desired height and angle of inclination for the desired level of difficulty. A user may have to lift and reset the inclined ramp multiple times, depending on which exercises the user is performing and the desired resistance level. This can be tiring and cumbersome.

Thus, a need also exist for an inclined ramp exercise device and a method where the exercise device includes an automatic lift mechanism for automatically setting the height and angle of the inclined ramp.

SUMMARY OF THE INVENTION

Accordingly, an aspect of the invention involves a method of using a collapsible exercise device. The method includes providing a collapsible exercise device including a vertical support member, an adjustable incline having a first end and a second end, the first end of the adjustable incline pivotally coupled to, adjustably supported by, and vertically movable with respect to, the vertical support member for adjusting the incline of the adjustable incline, a user support platform movably attached to the adjustable incline, first and second combination pulley-support and pull-up bars each pivotally connected to the first end of the adjustable incline for movement between at least a substantially vertical position and a substantially non-vertical position, first and second pulleys movably connected to the first and second combination pulley-support and pull-up bars for movement of the pulleys to a desired location, and one or more cables extendable through first and second pulleys and connected to the user support platform for movement of the support platform along the adjustable incline through cable movement, wherein the exercise device is foldable such that the vertical support member and the adjustable incline are substantially parallel to each other when collapsed; positioning the first end of the adjustable incline at a desired height with respect to the vertical support member so that the adjustable incline is at a desired inclination; moving the first and second combination pulley-support and pull-up bars to a desired position; moving the first and second pulleys connected to the first and second combination pulley-support and pull-up bars to a desired location; and moving the support platform along the adjustable incline through cable movement through the first and second pulleys on the combination pulley-support and pull-up bars.

Further implementations of the aspect of the invention described immediately above include one or more of the following. The first and second combination pulley-support and pull-up bars each have a trapezoidal configuration. The first and second pulleys each include a collar slidably attached to the combination pulley-support and pull-up bar and a pull pin carried by the collar for locking the pulley in position on the combination pulley-support and pull-up bar. A folding squat platform is pivotally and removably connected to the second end of the adjustable incline. A squat stand is telescopingly and removably engaged with the folding squat platform. A push-up bar is removably connected to the second end of the adjustable incline. A padded foot support is removably connected to the second end of the adjustable incline. A dip bar assembly is connected to the adjustable incline, and the dip bar assembly includes a pair of dip bars movable between at least a retracted, out-of-the way position, and a non-retracted, ready-for-use position. A foot support assembly is pivotally connected to the adjustable incline, and the foot support assembly is pivotable between at least a retracted, out-of-the way position, and a non-retracted, ready-for-use position. The one or more cables include a single cable with opposite ends, and handles each connected to the opposite ends of the single cable. The vertical support member includes a vertical support tower including a tower level track therein, the tower level tracks including multiple vertically spaced hooks, and the first end of the adjustable incline is pivotally connected to, and adjustably supported by the hooks of the tower level track. The vertical support member includes an automatic lift mechanism including a driving mechanism, upper and lower pulley assemblies, at least one of which is driven by the driving mechanism, and opposite vertical chains carried by the pulley, the adjustable incline is coupled to the opposite vertical chains, and positioning the first end of the adjustable incline at a desired height includes moving the first end of the adjustable incline up and down with the automatic lift mechanism. The collapsible exercise device is used for personal training. The collapsible exercise device is used for group training. The collapsible exercise device is used for Pilates training. The collapsible exercise device is used for rehabilitation. Positioning the first end of the adjustable incline at a desired height includes positioning the first end of the adjustable incline at a desired height level in accordance with a resistance chart indicating the effective weight for various height levels and bodyweights.

BRIEF DESCRIPTION OF THE DRAWINGS

The accompanying drawings, which are incorporated in and constitute a part of the specification, illustrate embodiments of the invention and, together with the description, serve to explain the objects, advantages, and principles of the invention. In the drawings.

FIG. 18 is an exemplary resistance chart for the exercise device illustrated in FIGS. 1-17.

FIG. 19 is an exemplary strength chart with guidelines for the gradual improvement of strength using the exercise device.

FIG. 20 is an exemplary hypertrophy chart with guidelines for the gradual improvement of hypertrophy using the exercise device.

FIG. 21 is an exemplary power chart with guidelines for the gradual improvement of power using the exercise device.

FIG. 22 is an exemplary endurance chart with guidelines for the gradual improvement of endurance using the exercise device.

DETAILED DESCRIPTION OF PREFERRED EMBODIMENTS

Figure 1:
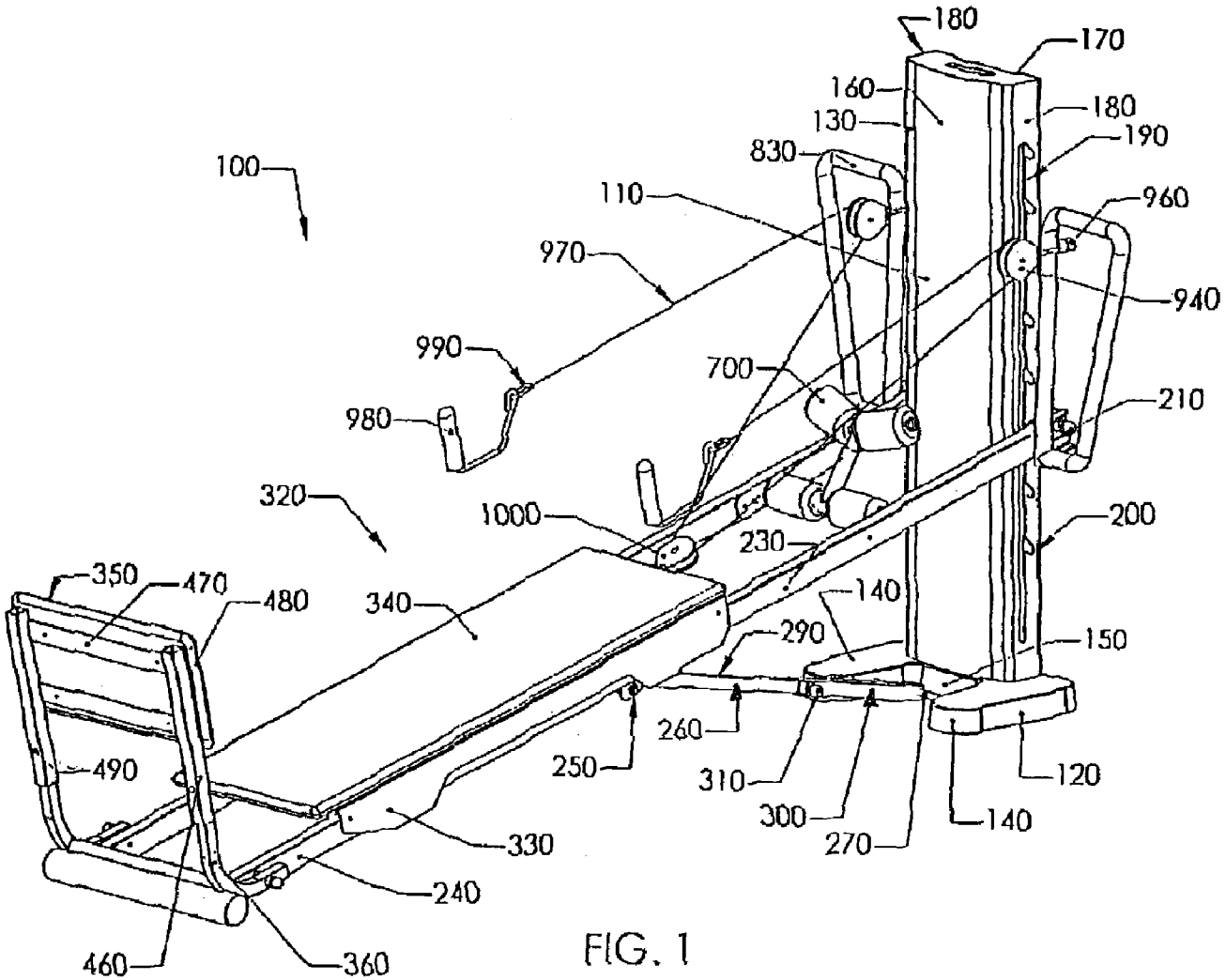
FIG. 1 is a perspective view of an embodiment of an exercise device.
Figure 2:
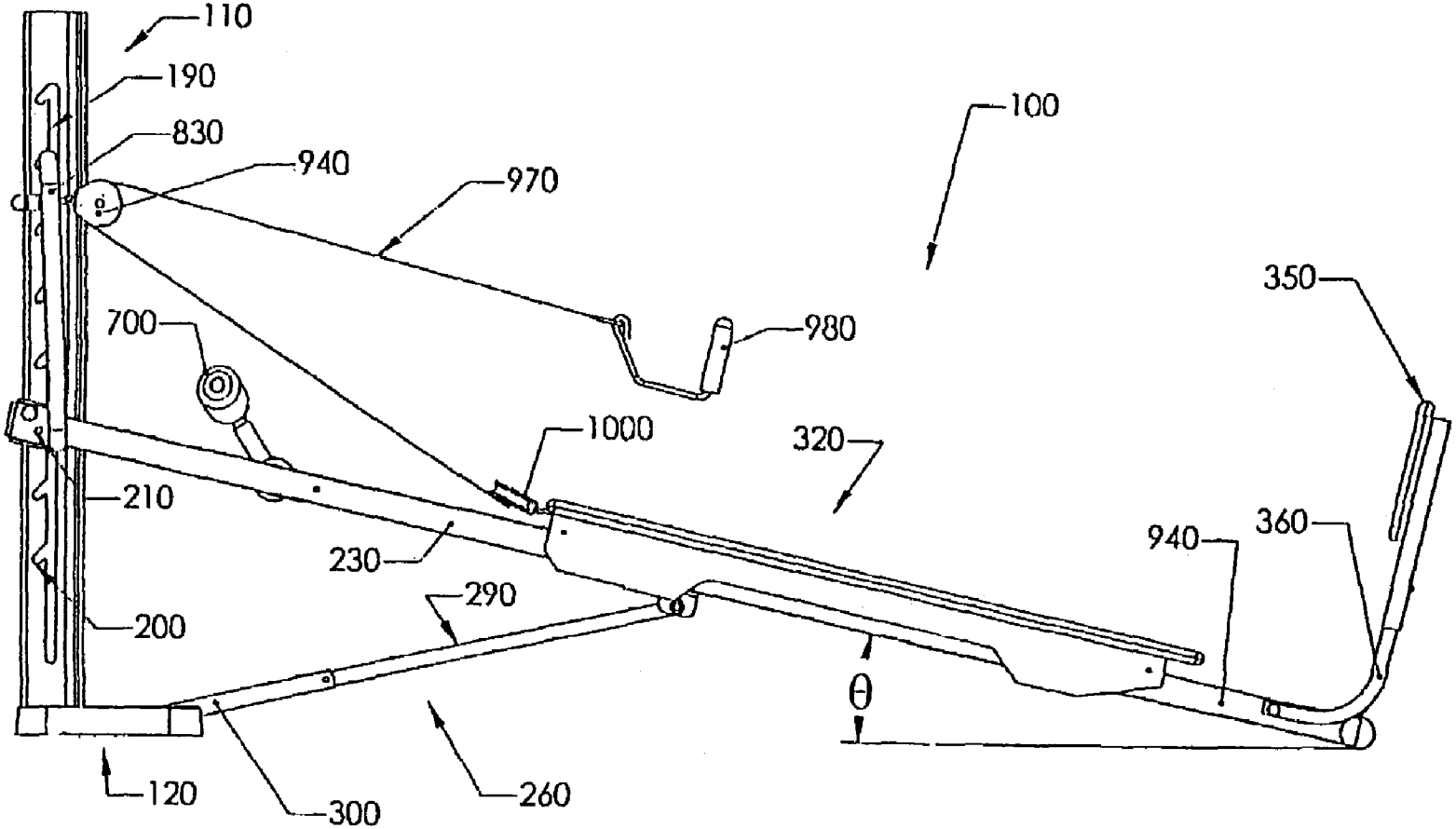
FIG. 2 is a left side elevational view of the exercise device shown in FIG. 1.
Figure 3:
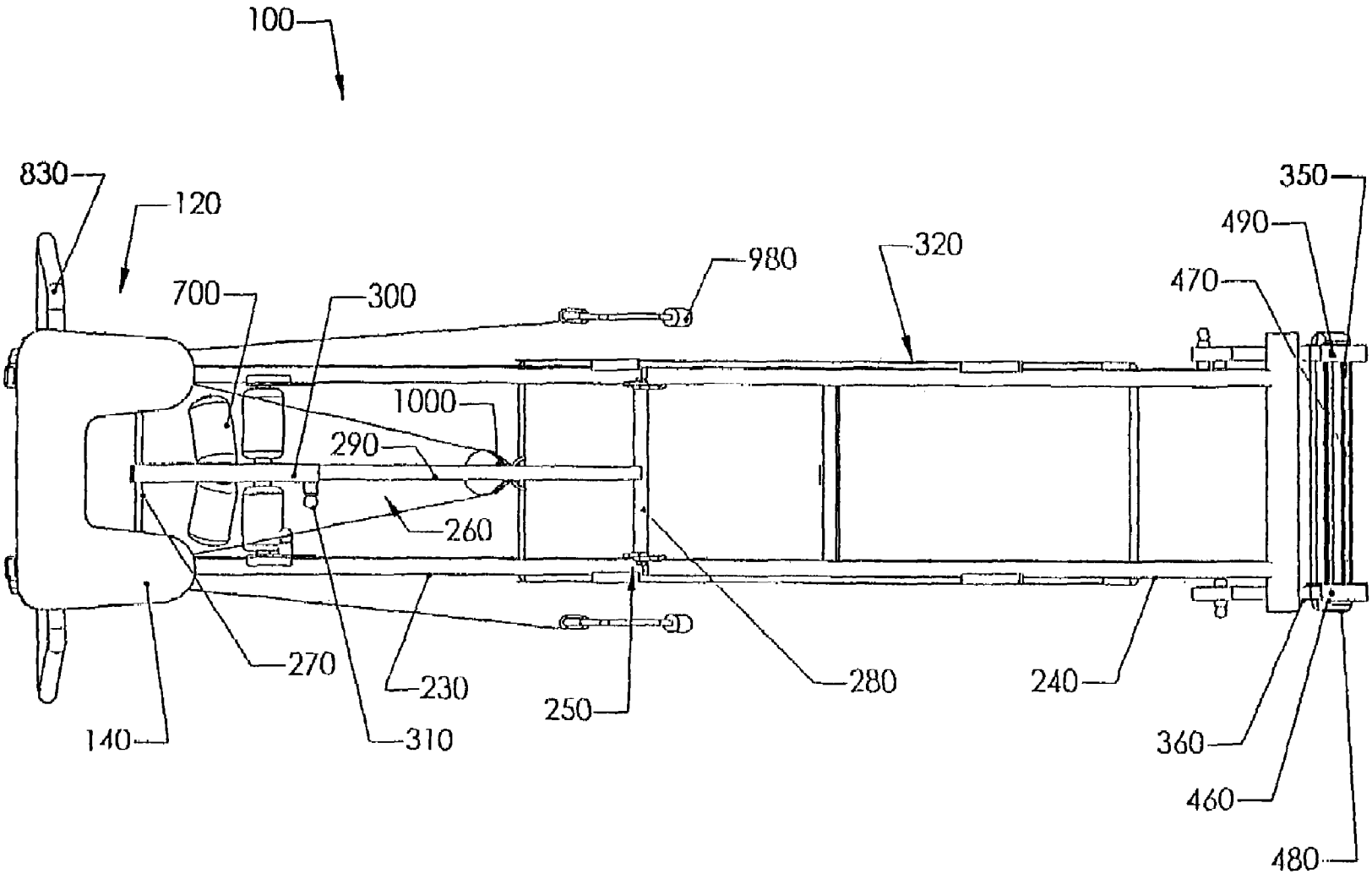
FIG. 3 is a bottom plan view of the exercise device shown in FIG. 1.

With reference to FIGS. 1-3, a collapsible exercise device 100 constructed in accordance with an embodiment of the invention will now be described. The collapsible exercise device 100 is shown in an unfolded state. The collapsible exercise device 100 includes a vertical support member or tower 110 having a base 120 and a tower housing 130. The base 120 includes a pair of opposite foot-shaped base members 140 joined by an intermediate base section 150. The tower housing 130 extends from the intermediate base section 150 of the base 120. The tower housing 130 includes a front vertical face 160, a rear vertical face 170, and opposite symmetric sides 180. The sides 180 include tower level tracks 190 with multiple tower level hooks 200 evenly vertically spaced along the tracks 190.

Slide bars 210 extend inwardly from proximal ends 220 of a pair of upper rails 230. The inwardly extending slide bars 210 may be slid up or down in the tower level tracks 190 and set in corresponding tower level hooks 200 to a desired height. The slide bars 210 may be removable from the upper rails 230. A pair of lower rails 240 are pivotally connected to the upper rails 230 at rail pivot points 250. A strut 260 is pivotally connected to the base 120 through a lower pivot bar 270 at the base members 140 and is also pivotally connected to the rail pivot points 250 through an upper pivot bar 280. The strut 260 includes an upper strut post 290 matingly received within a lower strut post 300. The strut posts 290 may be locked with respect to each other with a spring-loaded pull pin 310 and lateral holes in the upper strut post 290.

In an alternate embodiment, one end of the strut 260 may be pivotally connected to the upper pivot bar 280, while the other end includes a support platform that rests on a floor.

A user support platform 320 is slidably attached to the rails 230, 240 through support frame or glideboard 330 and rollers (not shown) on the support frame 330. A main support pad 340 is attached to and supported by the support frame 330. A bumper (not shown) may be positioned on the lower rails 240 to prevent the user support platform 320 from rolling all the way down the lower rails 240.

Figures 4A, 4B:
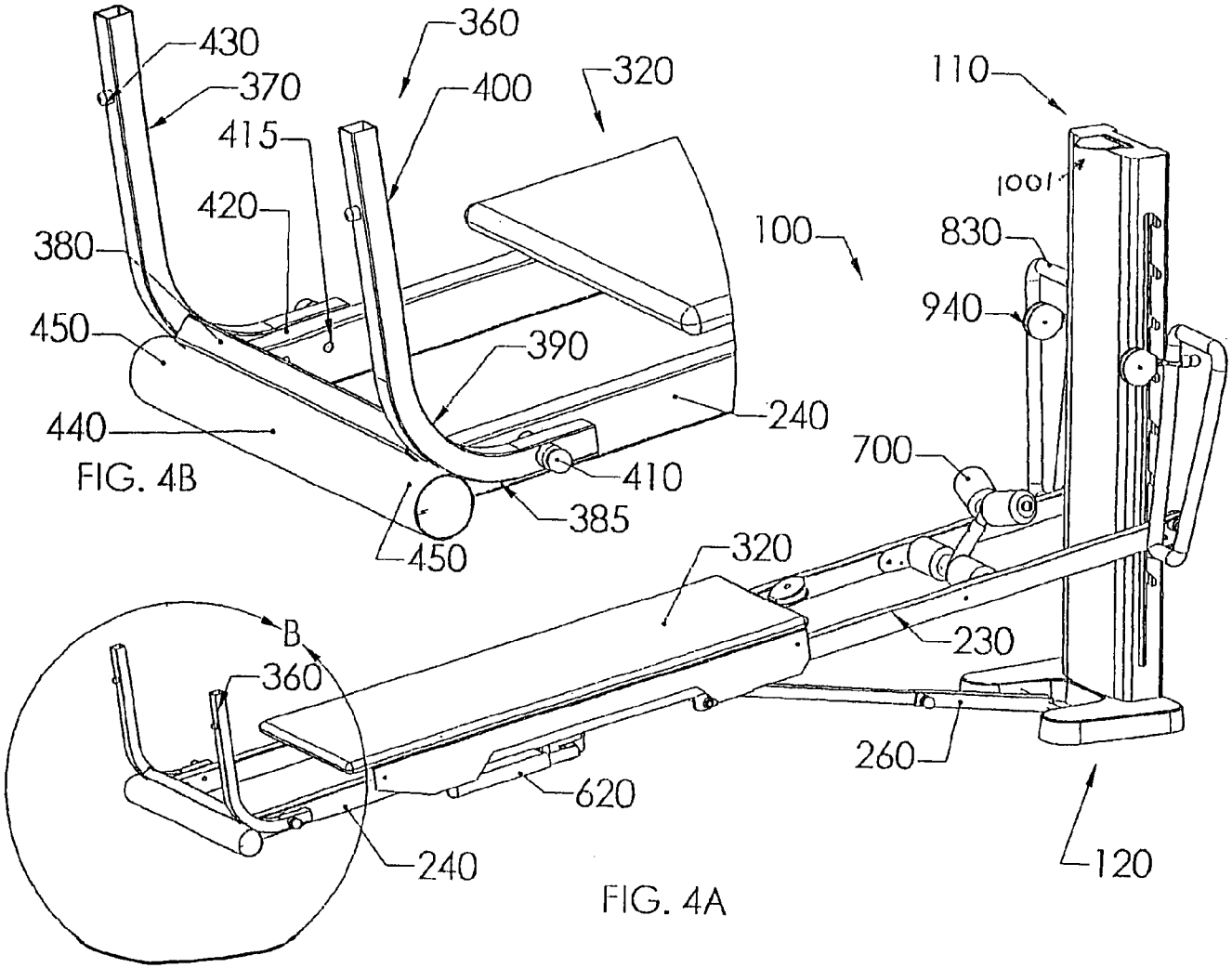
FIG. 4A is a perspective view of the device shown in FIG. 1 with a telescoping squat stand removed from a folding squat platform and the folding squat stand shown in an unfolded state.
FIG. 4B is an enlarged perspective view of the area B of FIG. 4A and details the telescoping squat stand removed from a folding squat platform.

With reference to FIGS. 1, 2, and 4A-5B, a telescoping squat stand 350 and folding squat platform 360 constructed in accordance with an embodiment of the invention will be described. In FIGS. 4A and 4B, the folding squat platform 360 is shown in an unfolded state with the telescoping squat stand 350 removed from the folding squat platform 360. The folding squat platform 360 includes opposite parallel rails 370 joined by perpendicularly extending cross rail 380. Each rail 370 has a generally square cross-section and includes a short, straight pivot portion 385, a curved portion 390, and an elongated distal portion 400. The pivot portion 385 carries a spring-loaded pull pin 410 for locking the folding squat platform 360 within pin holes 415 near a distal end 420 of the lower rails 240. A spring-loaded depressible pin 430 is carried in the elongated distal portion 400 for locking the folding squat platform 360 in place along the folding squat platform 360.

In the unfolded state shown in FIGS. 4A and 4B, the curved portion 390 of the rails 370 and the cross rail 380 are supported by a cross member 440. The cross member 440 has a generally cylindrical configuration and extends perpendicularly between the distal ends 420 of the lower rails, joining the lower rails 240. Ends 450 of the cross member 440 extend laterally beyond the distal ends 420 and may carry rollers or wheels for rolling this part of the exercise device 100 along the floor.

Figures 5A, 5B:
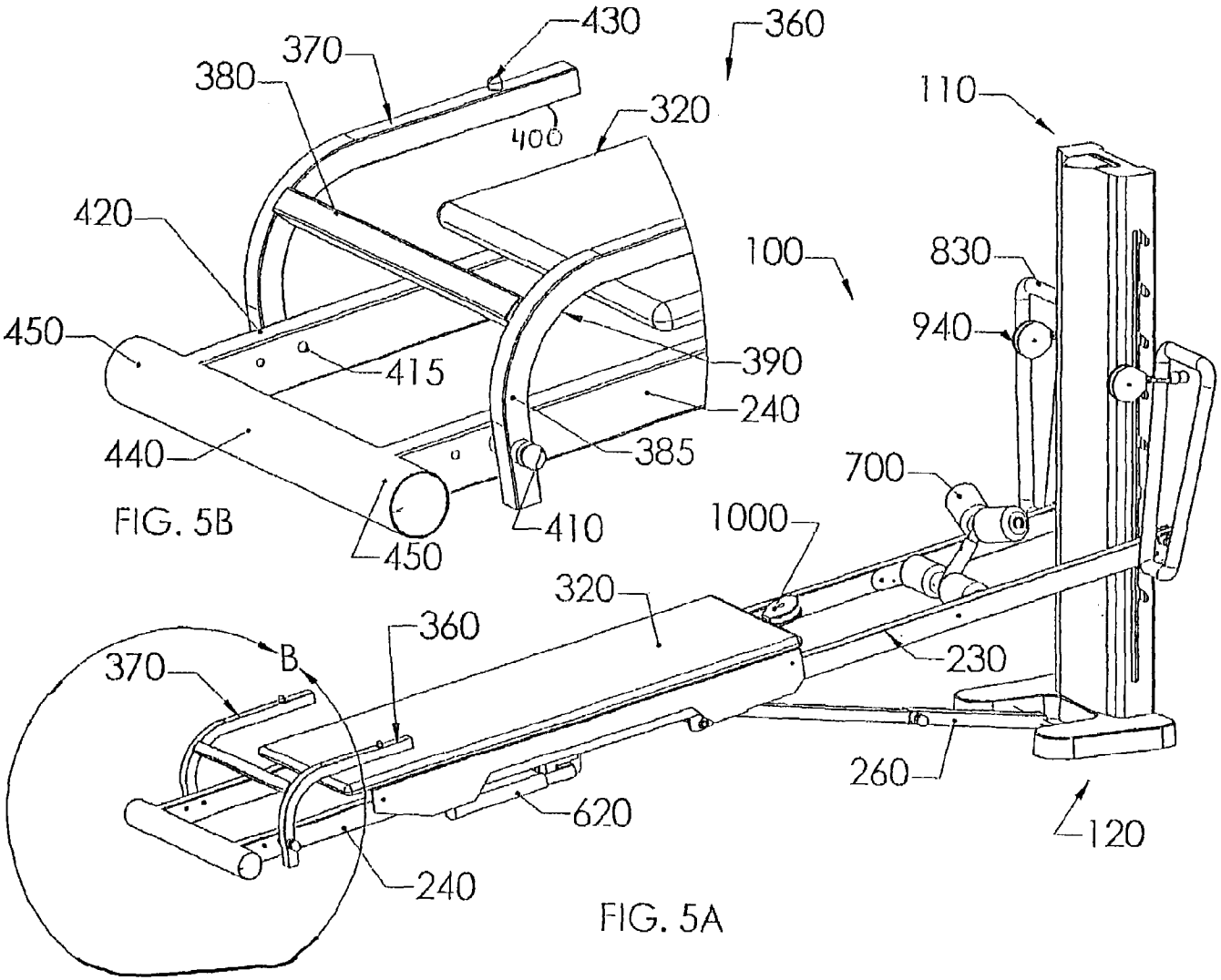
FIG. 5A is a perspective view of the device shown in FIG. 1 with a telescoping squat stand removed from a folding squat platform and the folding squat stand shown in a folded state.
FIG. 5B is an enlarged perspective view of the area B of FIG. 5A and details the folding squat platform shown in a folded state.

The folding squat platform 360 may be pivoted or folded up to the compact position shown in FIGS. 5A and 5B, where the elongated distal portion 400 of the folding squat platform 260 is generally parallel with the lower rails 240. The telescoping squat stand 350 includes opposite straight parallel rails 460, perpendicularly extending supports 470, and a squat platform 480 supported by and connected to the rails 460 and supports 470. The rails 460 include a generally square cross-sectional, hollow configuration and telescope onto (matingly receive) the elongated distal portions 400 of the rails 370. When attaching the squat stand 350 to the rails 370, the pins 430 may be depressed slightly to allow the rails 460 to slide completely onto the rails 370. Each rail 460 may include one or more pin holes 490 that the spring-loaded pin 430 snap locks into when the hole 490 is over the pin 430. The telescoping squat stand 350 may be removed by pressing down on the pins 430 and sliding the rails 460 of the squat stand 350 off of the rails 370 of the folding squat platform 360. The folding squat platform 360 (or the folding squat platform 260 and connected squat stand 350) may be removed from the distal ends of the lower rails 240 by pulling the pull pins 410 out of the pin holes 415 and removing the folding squat platform 360 from the lower rails 240.

Figures 5C, 5D:
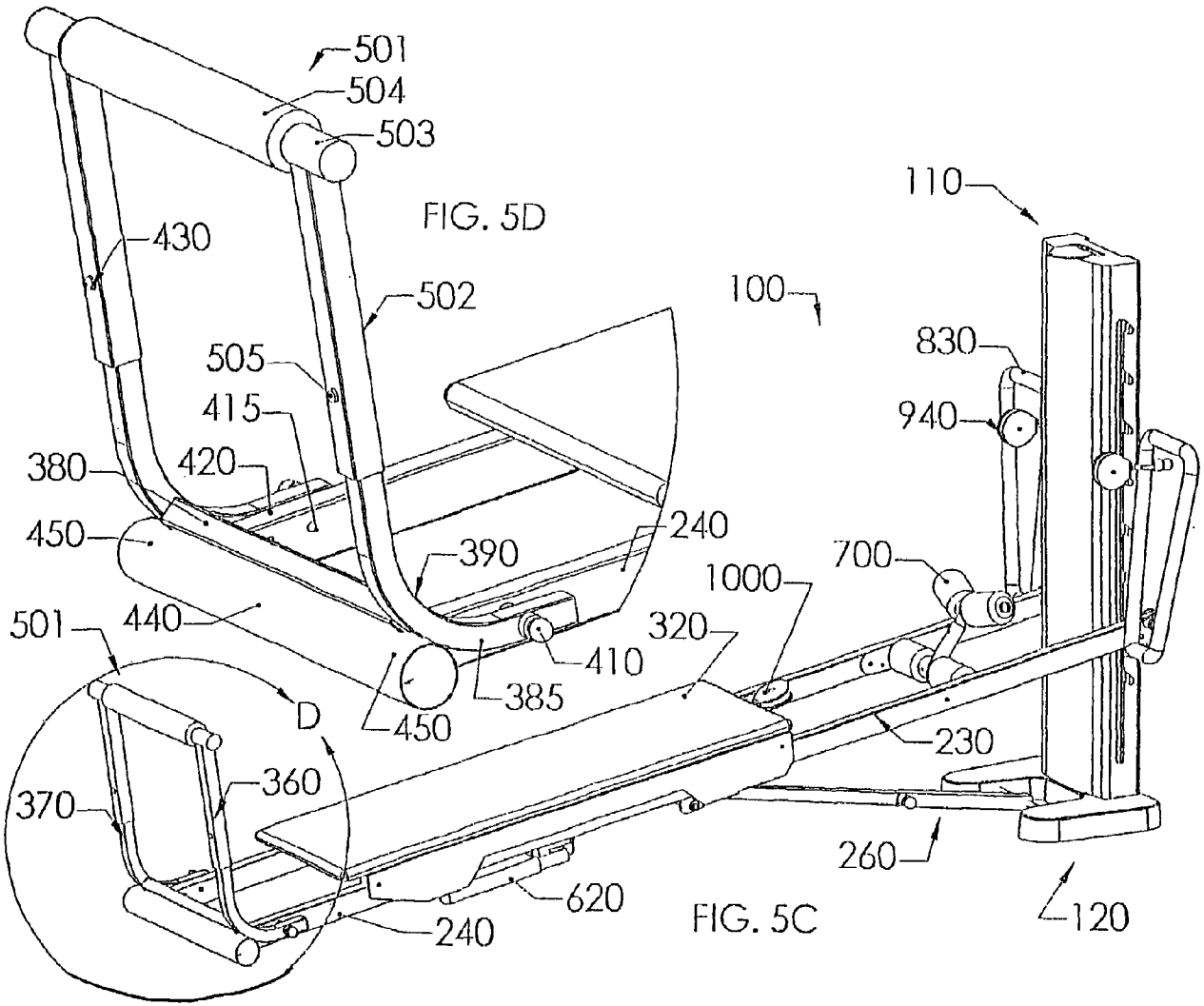
FIG. 5C is a perspective view of the device shown in FIG. 1 with a telescoping squat stand removed from the folding squat platform and an embodiment of a toe bar accessory attached to the folding squat stand.
FIG. 5D is an enlarged perspective view of the area D of FIG. 5C and details the toe bar accessory and the folding squat stand in an unfolded state.

FIGS. 5C and 5D illustrate an embodiment of a telescoping toe bar accessory 501 that attaches to the folding platform 360 in the same manner as the telescoping squat stand 350. The toe bar accessory 501 includes opposite straight parallel rails 502, perpendicularly extending toe bar 503, and a cylindrical toe pad or cushion 504 that surrounds a central portion of the toe bar 503. The rails 502 include a generally square cross-sectional, hollow configuration and telescope onto (matingly receive) the elongated distal portions 400 of the rails 370. When attaching the toe bar accessory 501 to the rails 370, the pins 430 may be depressed slightly to allow the rails 502 to slide completely onto the rails 370. Each rail 502 may include one or more pin holes 505 that the spring-loaded pin 430 snap locks into when the hole 505 is over the pin 430. The telescoping toe bar accessory 501 may be removed by pressing down on the pins 430 and sliding the rails 502 of the toe bar accessory 501 off of the rails 370 of the folding platform 360. The folding platform 360 (or the folding platform 360 and connected toe bar accessory 501) may be removed from the distal ends of the lower rails 240 by pulling the pull pins 410 out of the pin holes 415 and removing the folding platform 360 from the lower rails 240.

Figures 6A, 6B:
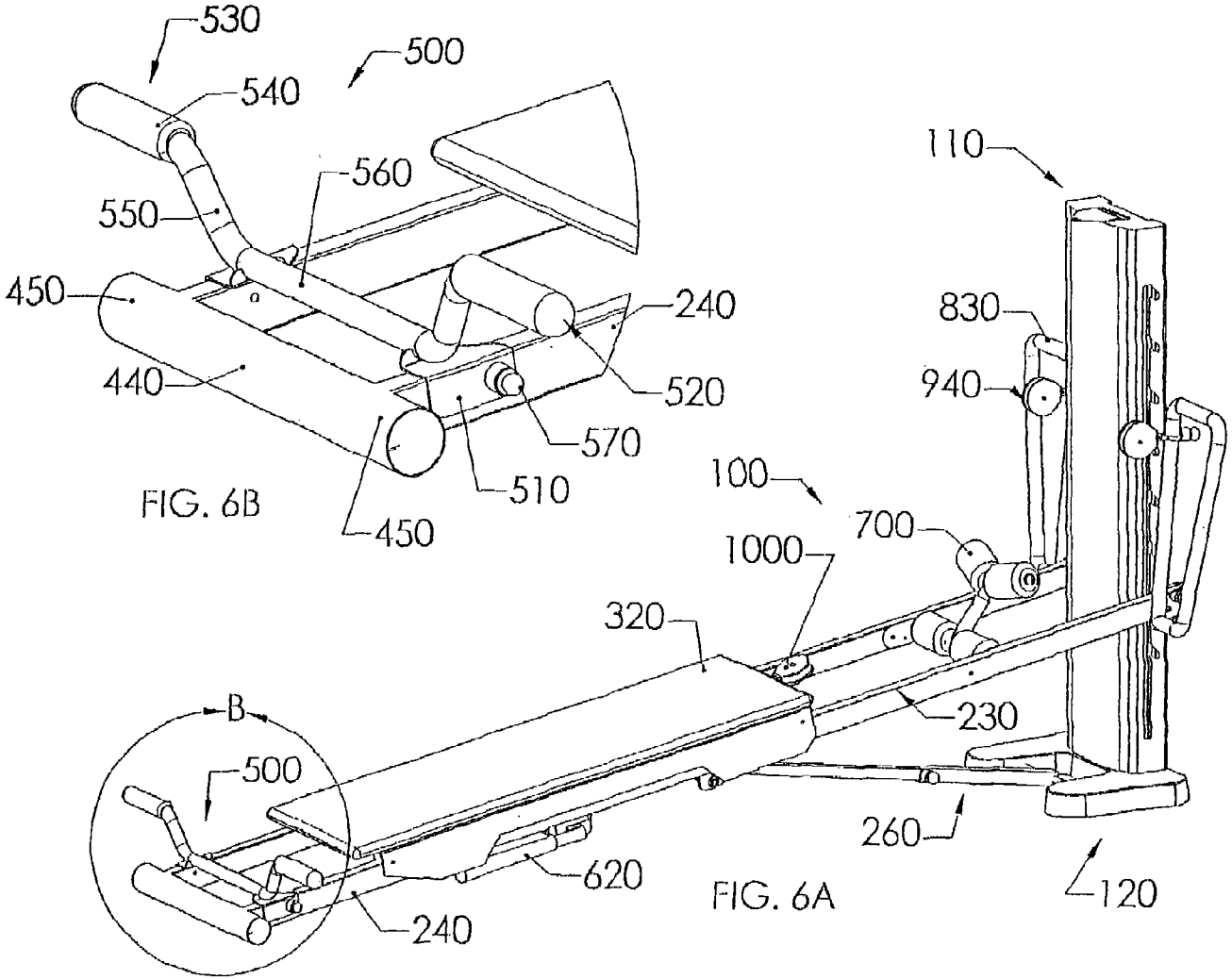
FIG. 6A is a perspective view of the device shown in FIG. 1 with the telescoping squat stand and folding squat platform replaced with a push-up bar accessory.
FIG. 6B is an enlarged perspective view of the area B of FIG. 6A and details the push-up bar accessory.

With reference to FIG. 6A, an embodiment of a push-up bar accessory 500 that may be easily attached to and removed from the distal ends 420 of the lower rails 240 will now be described. The push-up bar accessory 500 includes a pair of opposite coupling brackets 510 for connecting the push-up bar accessory 500 to the distal ends 420 of the lower rails 240. A push-up bar 520 includes handles 530 with grips 540, upwardly angled portions 550, and intermediate portion 560. The push-up bar 520 is connected to the brackets 510 near where the intermediate portion 560 joins the angled portions 550. The brackets 510 carry spring-loaded pull pins 570 for attaching the push-up bar accessory 500 to and removing it from pin holes 415 at the distal ends 420 of the lower rails 240.

Figures 7A, 7B:
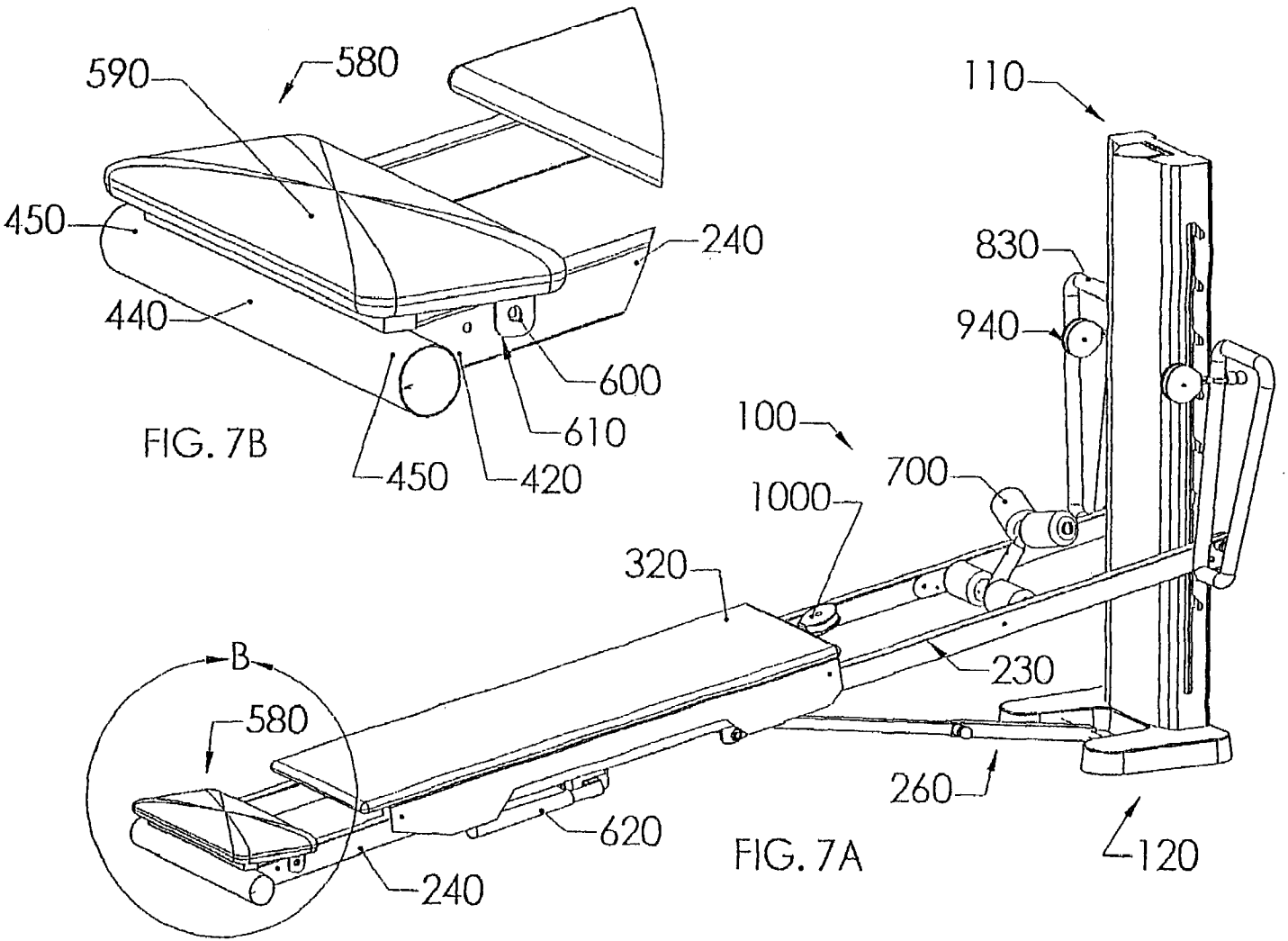
FIG. 7A is a perspective view of the device shown in FIG. 1 with the telescoping squat stand and folding squat platform replaced with a padded foot support accessory.
FIG. 7B is an enlarged perspective view of the area B of FIG. 7A and details the padded foot support accessory.
Figures 8A, 8B:
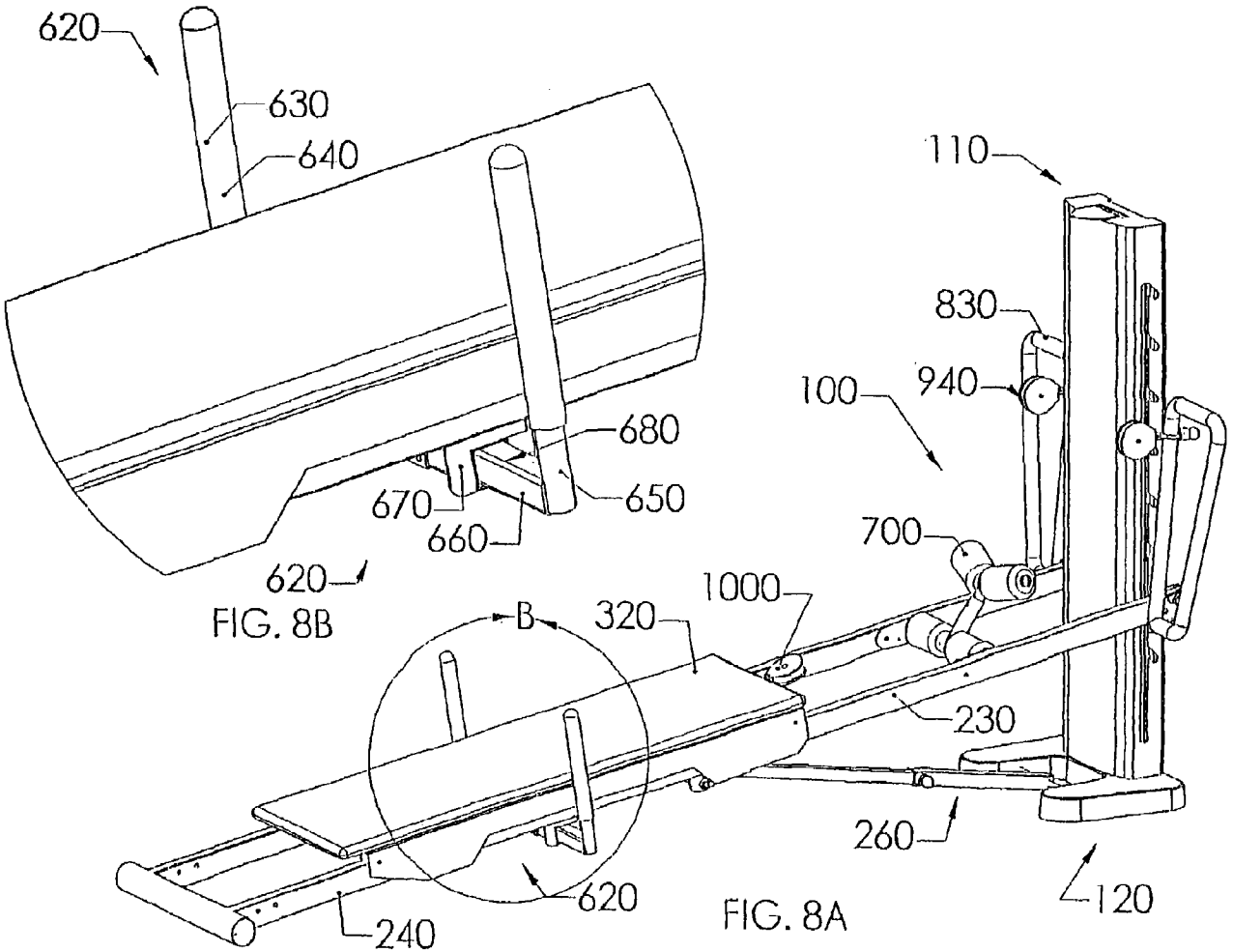
FIG. 8A is a perspective view of the device shown in FIG. 1 without the telescoping squat stand and folding squat platform and shows a dip bar accessory in an unretracted state.
FIG. 8B is an enlarged perspective view of the area B of FIG. 8A and details the dip bar accessory.
Figures 9A, 9B:
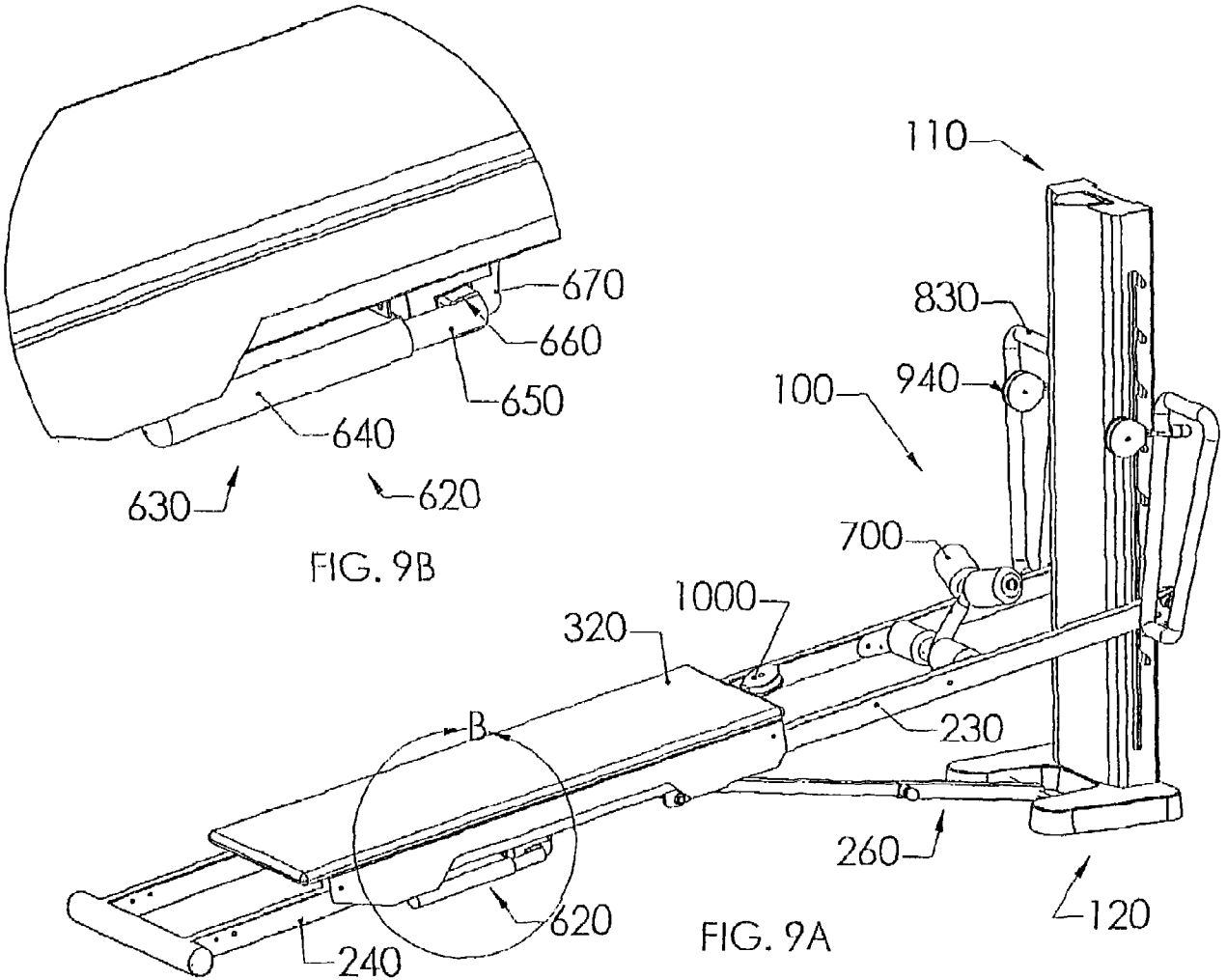
FIG. 9A is a perspective view of the device similar to FIG. 9A and shows the dip bar accessory in a retracted state.
FIG. 9B is an enlarged perspective view of the area B of FIG. 9A and details the dip bar accessory in a retracted state.
Figures 10A, 10B:
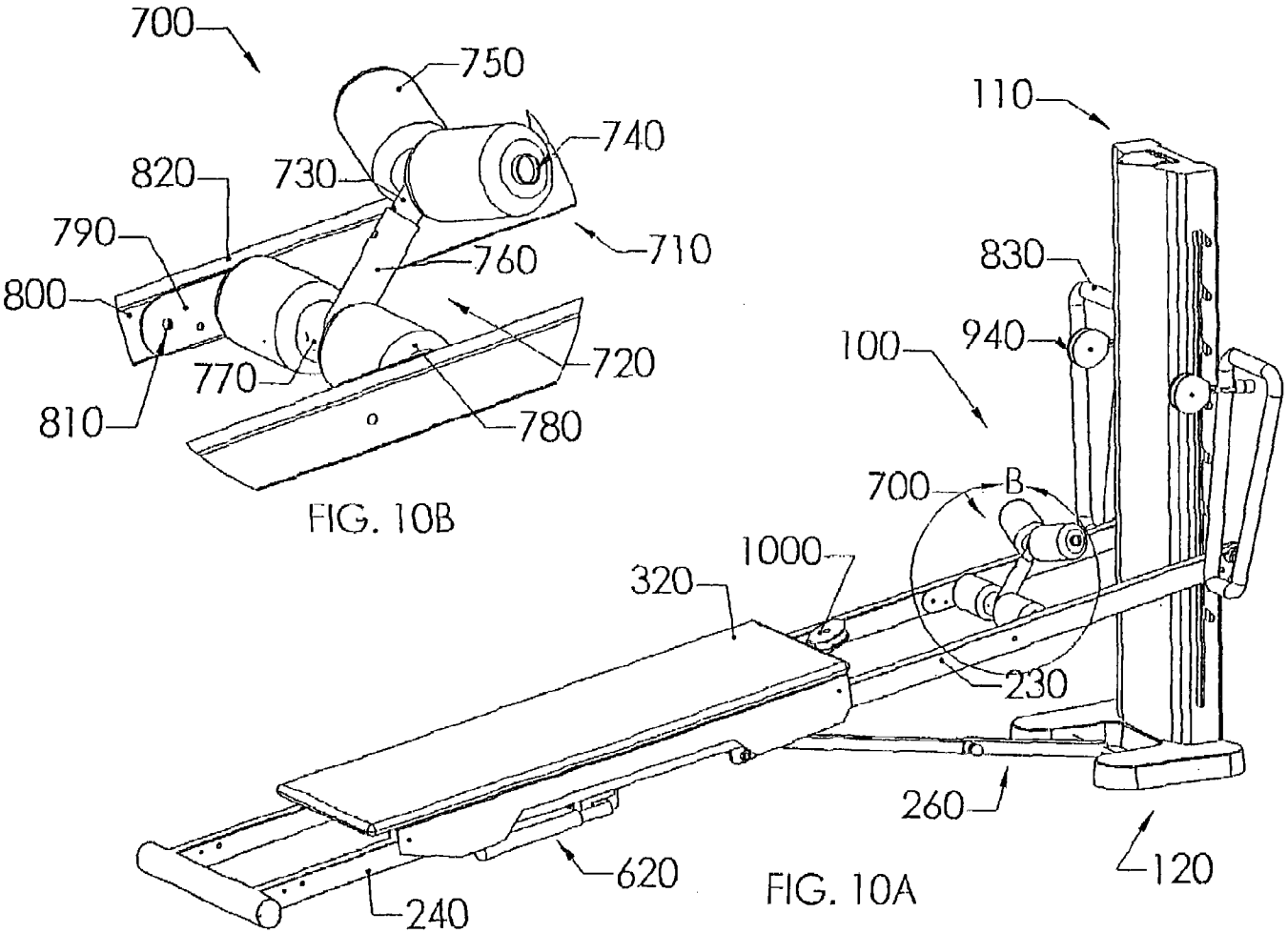
FIG. 10A is a perspective view of the device shown in FIG. 1 and shows a folding foot platform in an unfolded state.
FIG. 10B is an enlarged perspective view of the area B of FIG. 10A and details the foot platform.
Figures 11A, 11B:
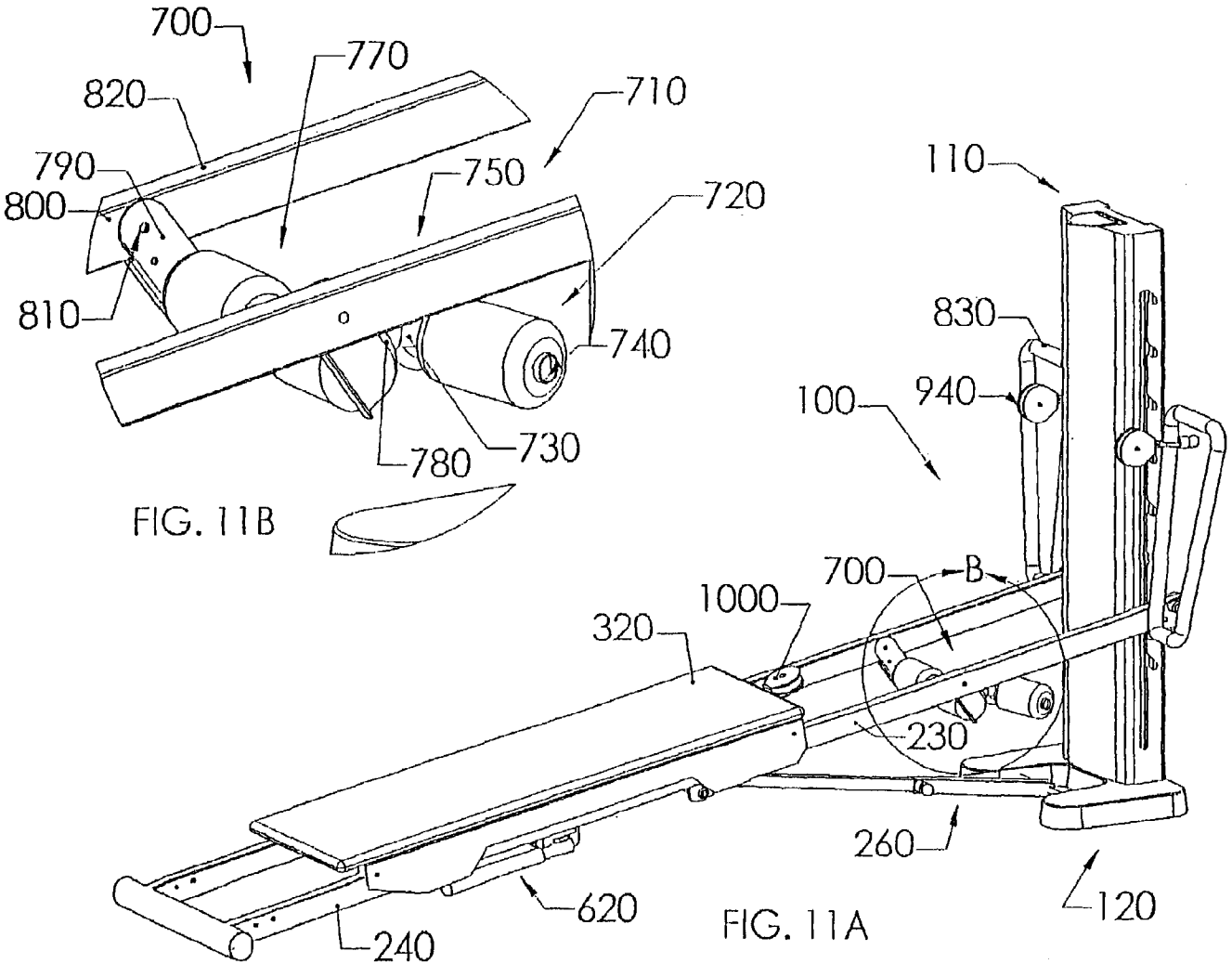
FIG. 11A is a perspective view of the device similar to FIG. 10A and shows the folding foot platform in a folded state.
FIG. 11B is an enlarged perspective view of the area B of FIG. 11A and details the folding foot platform in a folded state.

With reference to FIGS. 7A and 7B, an embodiment of a padded foot support accessory 580 that may be easily attached to and removed from the distal ends 420 of the lower rails 240 will now be described. The padded foot support accessory 580 includes a foot pad 590 supported by and connected to opposite brackets 600 for connecting the padded foot support accessory 580 to the distal ends 420 of the lower rails 240. The brackets 600 carry spring-loaded pull pins 610 for attaching the padded foot support accessory 580 to and removing it from pin holes 415 at the distal ends 420 of the lower rails 240. In the position shown, the padded foot support accessory 580 is supported by the brackets 600 on the lower rails 240 and the cross member 440.

With reference to FIGS. 8A-9B, an embodiment of a dip bar accessory 620 that may be used with the exercise device 100 will now be described. The dip bar accessory 620 includes handles 630 with grips 640 attached at ends 650 to perpendicularly extending cross rails 660. The handles 630 may have a generally cylindrical, tubular configuration and the cross rails 660 may have a generally square cross-sectional, hollow configuration. The cross rails 660 slide laterally in and out within brackets 670 mounted to the lower rails 240. The brackets 670 have rectilinear cut outs 680 that the cross rails 660 slide within. A locking mechanism (not shown) of the brackets 670 (or as one or more separate members) allow the handles 630 to be moved laterally outward and rotated 90 degrees upward to the unretracted state shown in FIGS. 8A and 8B, and moved laterally inward and rotated 90 degrees downward to the retracted state shown in FIGS. 9A and 9B. In the unretracted, active state shown in FIGS. 8A and 8B, the cross rails 660 are low enough and the handles 630 are disposed laterally outward far enough so as to avoid contact with the support frame 330 of the user support platform 320 when the platform 320 is in motion. In the retracted state shown in FIGS. 9A and 9B, the handles 630 are disposed beneath and parallel to the lower rails 240. In this position, the handles 630 are also are disposed laterally inward far enough so as to avoid contact with the support frame 330 of the user support platform 320 when the platform 320 is in motion.

With reference to FIGS. 10A-11B, an embodiment of a folding foot platform 700 that may positioned in an unretracted or unfolded state (FIGS. 10A, 10B) and a retracted or folded state (FIGS. 11A, 11B) will now be described. The folding foot platform 700 includes a generally Y-shaped member 710 telescoped within an upside-down generally T-shaped member 720. The generally Y-shaped member includes a cylindrical main insertion tube 730 and upwardly angled foot retaining tubes 740. Cylindrical toe cushions 750 cover the upwardly angled foot retaining tubes 740. The upside-down generally T-shaped member 720 includes a main receiving tube 760 and outwardly perpendicularly extending cylindrical heel support tubes 770. Cylindrical heel cushions 780 cover the heel support tubes 770. The main insertion tube 730 is slidably received within the main receiving tube 760 and may be locked relative thereto with a pull pin within holes in the tubes 730, 760. Outer lateral ends of the heel support tubes 770 are fixedly connected to pivoting brackets 790. The pivoting brackets 790 are pivotally connected to inner sides 800 of the upper rails 230 through pivot pins 810. In the unretracted state shown in FIGS. 10A, 10B, a user may position his or her feet into the folding foot platform 700 by putting toes underneath the toe cushions 750 and heels on the heel cushions 780. The brackets 790, and, hence, the folding foot platform 700, are prevented from pivoting farther upward than the state shown in FIGS. 10A and 10B by respective lower flanges on the brackets 790 that engage the lower surfaces of the upper rails 230. When not in use, the folding foot platform 700 may be pivoted or folded to an out-of-the-way, retracted or folded state shown in FIGS. 11A, 11B.

Figures 12A, 12B:
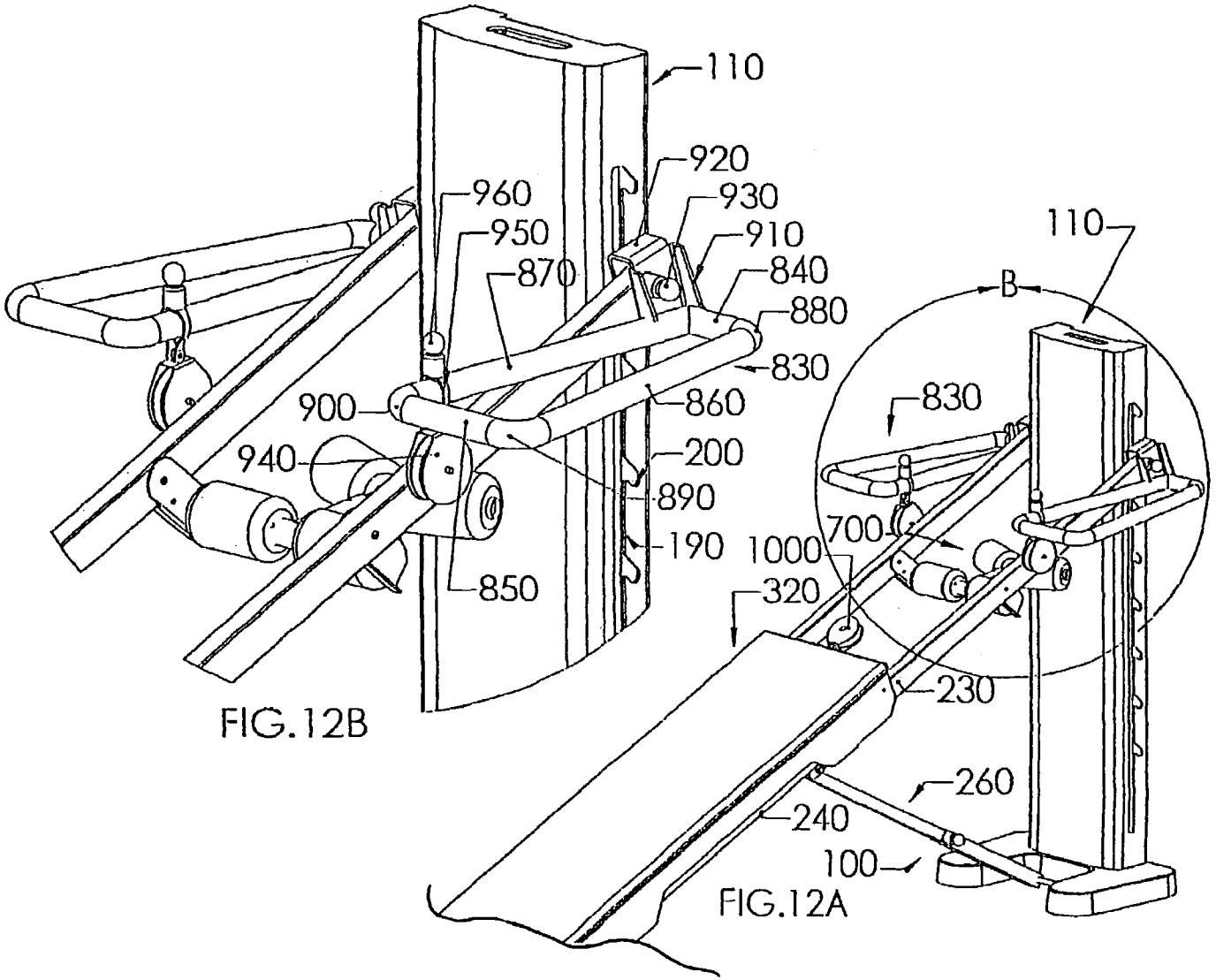
FIG. 12A is a perspective view of the device shown in FIG. 1 and shows folding, combination pulley-support and pull-up bars in a folded down or pull-up state.
FIG. 12B is an enlarged perspective view of the area B of FIG. 12A and details the folding, combination pulley-support and pull-up bars in a folded down or pull-up state.

With reference to FIGS. 1, 12A, and 12B, an embodiment of folding, combination pulley-support and pull-up bars 830 will now be described. In the embodiment shown, each bar 830 has a trapezoidal configuration and includes the following main sections: a short, straight, proximal tubular section 840, a straight, distal tubular section or pull-up handle 850 parallel to and longer than the proximal tubular section 840, an elongated, straight, angled, outer tubular section 860, and an elongated, straight, inner tubular section 870 perpendicular to the proximal tubular section 840 and the distal tubular section 850. An outer end of the proximal tubular section 840 is connected to a proximal end of the outer tubular section 860 by a tubular proximal outer elbow 880. An outer end of the distal tubular section 850 is connected to a distal end of the outer tubular section 860 by a tubular distal outer elbow 890. An inner end of the distal tubular section 850 is connected to a distal end of the inner tubular section 870 by a tubular distal inner elbow 900. An inner end of the proximal tubular section 840 is connected to a proximal end of the inner tubular section 870 by a pivoting bracket 910. The pivoting bracket 910 is pivotally connected to an attachment bracket 920, which is attached to the proximal end 220 of the upper rails 230. The pivoting bracket 910 carries a spring-loaded pull pin 930. The attachment bracket 920 may include a vertical pin hole, a horizontal pin hole, and a collapsing pin hole.

For normal use, the bars 830 may be moved to the position shown in FIG. 1 and locked into place using the pull pin 930 and the vertical pin hole on the attachment bracket 920. For performing chin ups, the bars 830 may be moved to the position shown in FIGS. 12A, 12B and locked into place using the pull pin 930 and the horizontal pin hole on the attachment bracket 920. For collapsing the exercise device 100, the bars 830 may be moved to the position shown in FIG. 13, where the bars 830 are parallel to the upper rails 230 and locked into place using the pull pin 930 and the collapsing pin hole on the attachment bracket 920.

Pulleys 940 are slidably attached to the bars 830. Each pulley 940 includes a collar 950 and a spring-loaded pull pin 960. An exerciser may move each pulley 940 to a desired position on the bar 830 by pulling on the pull pin 960, sliding the pulley 940 via the collar 950 to a desired position on the bar 830, and releasing the pull pin 960 to lock the pulley 940 in place on the bar 830. It should be noted, the pulley 940 may be slid onto sections or elbows other than the inner tubular section 870.

A connector extends through the pulleys 940 and connects to the user support platform 320. The connector may be of any suitable well-known type, but shown by way of example 1 is a cable 970. The cable 970 includes handles 980 (connected via links 990) at each end and extends through the pulleys 940 positioned on the combination pulley-support and pull-up bars 830 and loops through a third pulley 1000 attached to the user support platform 320. The third pulley 1000 is positioned along the lateral centerline of the user support platform 320. This position allows for unilateral (i.e. one arm), bilateral (i.e., two arm) and static equilibrium (i.e. holding the user support platform 320 suspended by keeping a constant force on each handle 980) use.

The cable 970 and the handles 980 may hang from attachment member 1001 (FIG. 4A) when not in use for storage purposes. The attachment member 1001 may also be used for connecting a separate pulley and leg ankle cuff.

The cable 970 should preferably be of sufficient length to extend through the pulleys 940 and allow the exerciser to grasp one or both of the handles 980 while the exerciser is on the user support platform 320 and the user support platform 320 is at rest.

In an alternate embodiment, the connector may be two separate cables extending through the pulleys 940 with each cable fixedly attached to the user support platform 320.

Figure 13:
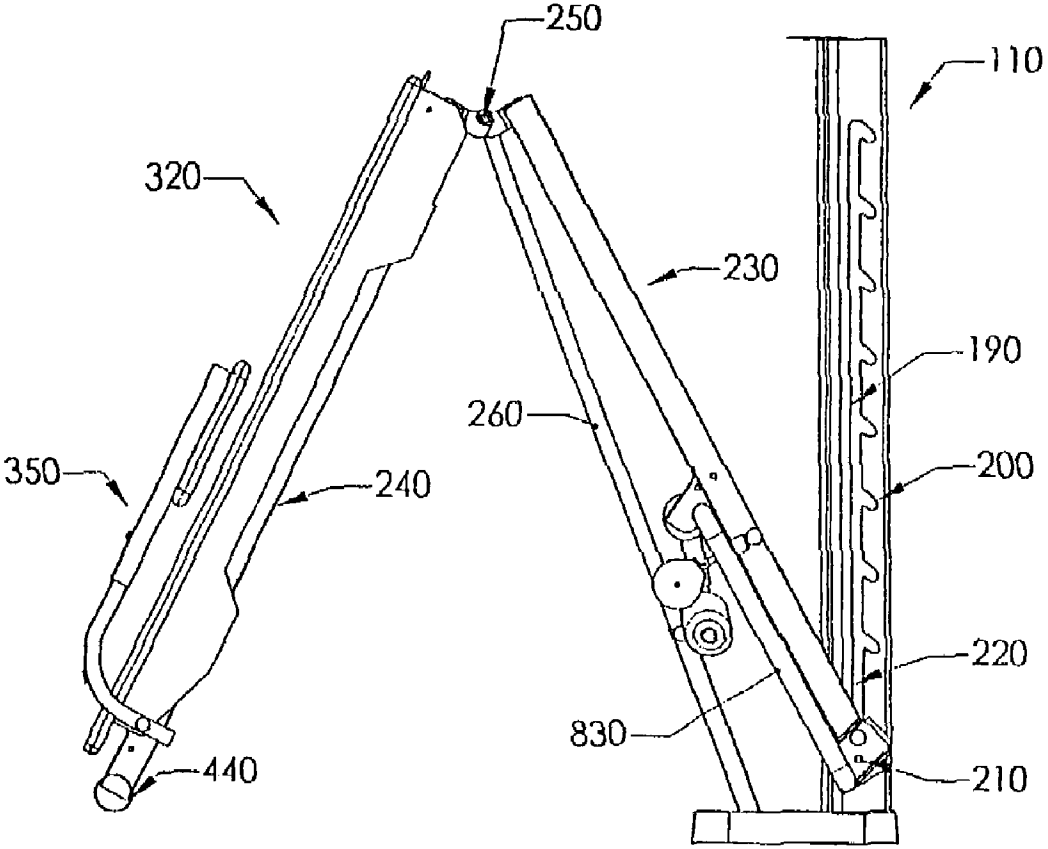
FIG. 13 is a right side elevational view of the exercise device shown in FIG. 1 in a semi-folded state.
Figure 14:
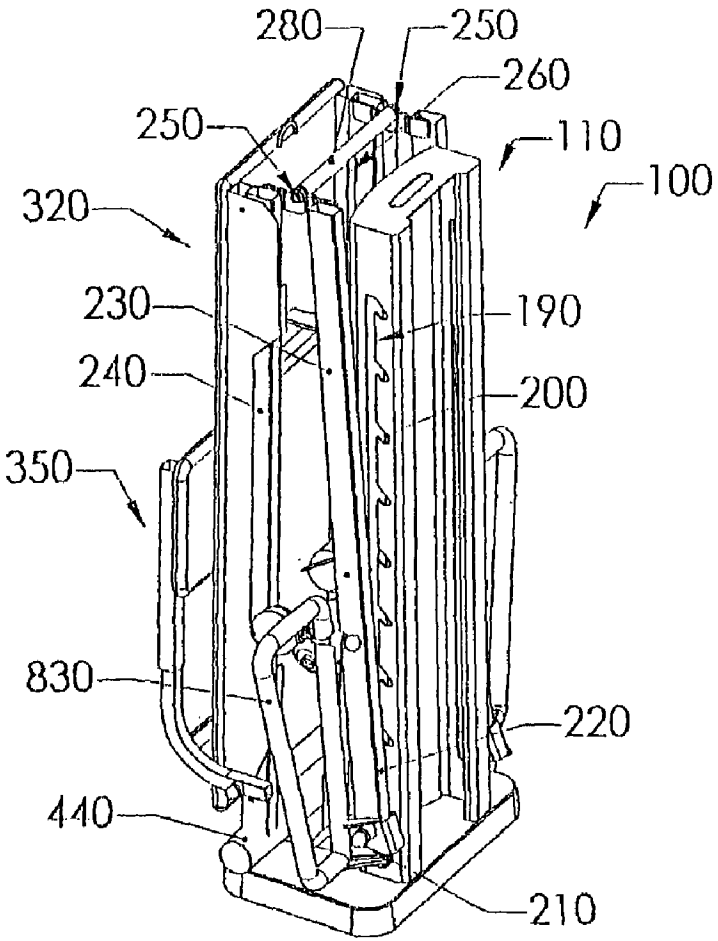
FIG. 14 is a rear perspective view of the exercise device shown in FIG. 1 in a folded state.

With reference to FIGS. 13 and 14, the collapsible or foldable nature of the exercise device 100 will now be described. FIG. 13 shows the collapsible exercise device 100 in a semi-folded state. The slide bars 210 at the proximal ends 220 of the upper rails 230 are lowered to the bottom of the tower level tracks 190 of the vertical support tower 110, and the squat stand 350 is folded over onto the user support platform 320. The rail pivot points 250 and the upper pivot bar 280 are then drawn up away from the floor while rollers on the cross member 440 roll along the floor. The exercise device 100 continues to be folded until the vertical support tower 110, the strut 260, the upper rails 230, the lower rails 240, the user support platform 320, the squat stand 350, and the combination pulley-support and pull-up bars 830 are substantially parallel as shown in FIG. 14. It should be noted that in this position, the user support platform 320 may be rolled up the lower rails 240 and off of the collapsed exercise device 100. To unfold the exercise device 100, the rollers on the cross member 440 at distal ends 420 of the lower rails 240 are rolled along the floor away from the vertical support tower 110. Once the upper rails 230 and the lower rails 240 are extended along the floor 52, the slide bars 210 at the proximal ends 220 of the upper rails 230 are raised via the proximal ends 220 of the upper rails 230 just above a desired height and lowered into tower level hooks 200 at the desired height. The squat stand 350 may then be folded to the position shown in FIG. 1.

In use, the exerciser positions himself or herself on the user support platform 320 and grasps one or both of the handles 980. The exerciser then draws one or both of the handles 980 toward the exerciser and by doing so transports the user support platform 320 up along the lower rails 240 and upper rails 230.

By varying the height of the proximal ends 220 of the upper rails 230 on the tower level hooks 200 of the vertical support tower 10, the angle θ (shown in FIG. 2) may be adjusted. The adjustment of this angle θ alters the percentage of the exerciser's weight which the exerciser's muscles are moving. This allows for adjustment of the intensity of the exerciser's workout. Weight bars (not shown) may be added to the user support platform 320 so that weight plates (not shown) may be positioned on the weight bars, thus adding to the weight propelled by the exerciser's muscles.

The exerciser may vary the position of the pulleys 940 on the combination pulley-support and pull-up bars 830 in the manner described above. For example, the pulleys 940 may be raised or lowered on the inner tubular sections 870 so that the handles 980 and pulling motion are at a more comfortable orientation or to work different muscle groups. The pulleys 940 may be moved to the outer tubular sections 860 (or other sections) for a wider grip and motion of the handles 980 or to work different muscle groups.

An exerciser may also vary the resistance while working upper body muscles by positioning him or herself on the user support platform 320 with the exerciser's feet on the squat stand 350 or floor. The legs and lower body then provide assistance in moving the user support platform 320, lessening the load on the upper body muscles. The exerciser may also use the squat stand 350 to perform the squat exercise for the lower body muscles.

In an alternate embodiment, an exerciser may lie on the user support platform 320 with the exerciser's feet positioned in the foot platform 700 as described above. By bending the exerciser's legs, the exerciser draws the user support platform 320 up along the rails 230, 240. The exercise may also perform sit ups on the user support platform 320 by securing his or her legs in the foot platform 700. In this embodiment, the squat stand 350 and folding platform 260 may be replaced with the padded foot support accessory 580 to support the feet.

In a further embodiment, the squat stand 350 and folding platform 260 may be replaced with the push-up bar accessory 500. The exerciser performs push ups using the push-up bar accessory 500 with his or her feet on the floor, and the chest over the distal part of the lower rails 240. The exerciser may also lie on the user support platform 320 and use the push-up bar accessory 500 to perform a military press or similar exercise.

In another embodiment, the exerciser may lie on the user support platform 320, grip the handles 630 of the dip bar accessory 620 (FIGS. 8A, 8B), and perform dips, exercising the arms and chest.

Furthermore, an exerciser may lower the combination pulley-support and pull-up bars 830 to the position shown in FIGS. 12A, 12B as described above, position himself or herself on the user support platform 320, and grasp the handles 850. By drawing the exerciser toward the handles 850, the exerciser is exercising additional muscle groups.

Figure 15:
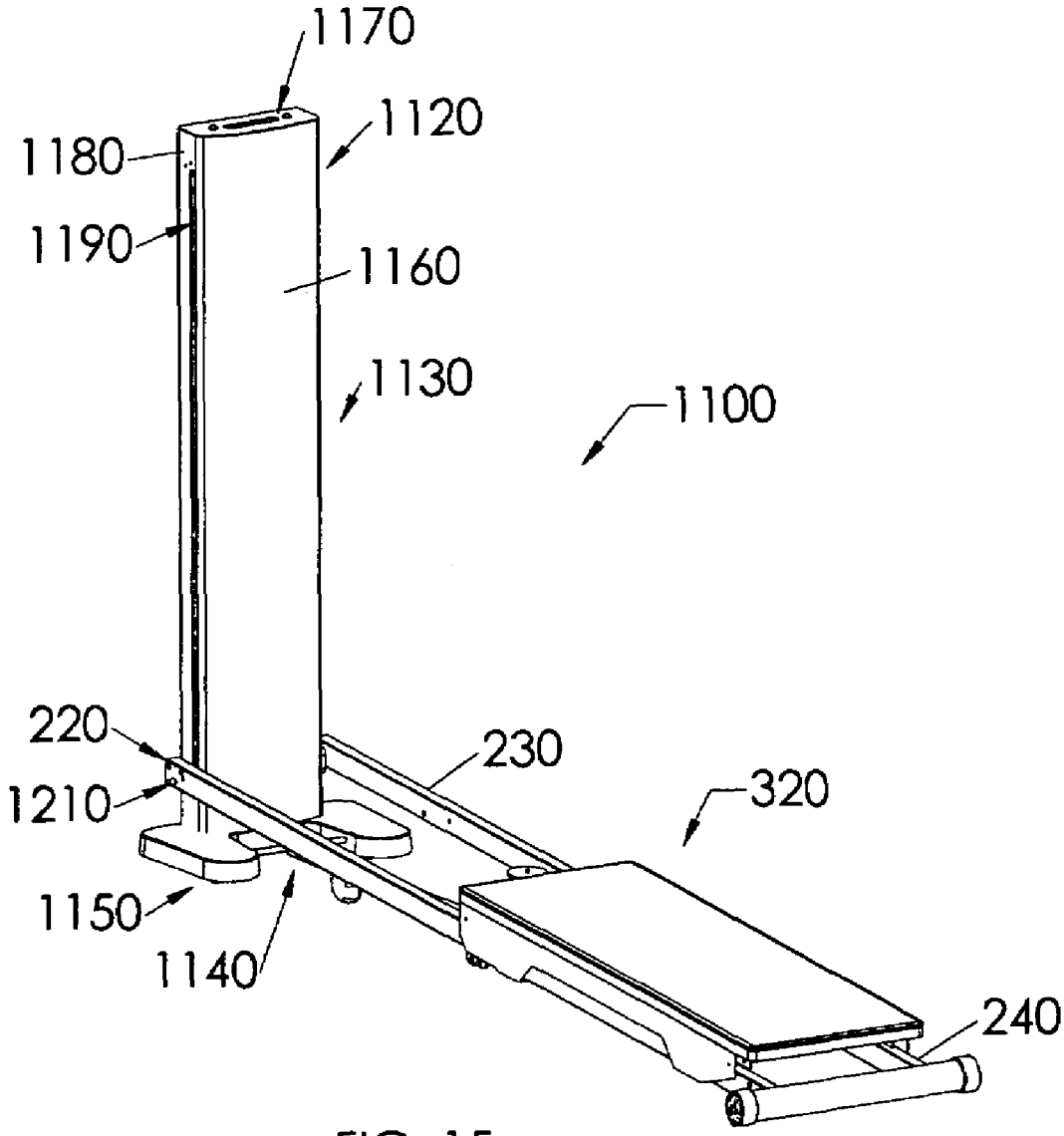
FIG. 15 is a perspective view of an embodiment of exercise device similar to the embodiments of the exercise devices shown in FIGS. 1-14, except components of the exercise devices shown in FIGS. 1-14 are removed and the exercise device of FIG. 15 includes an automatic lift mechanism for automatically setting the height and angle of the rails and user support platform.
Figure 16:
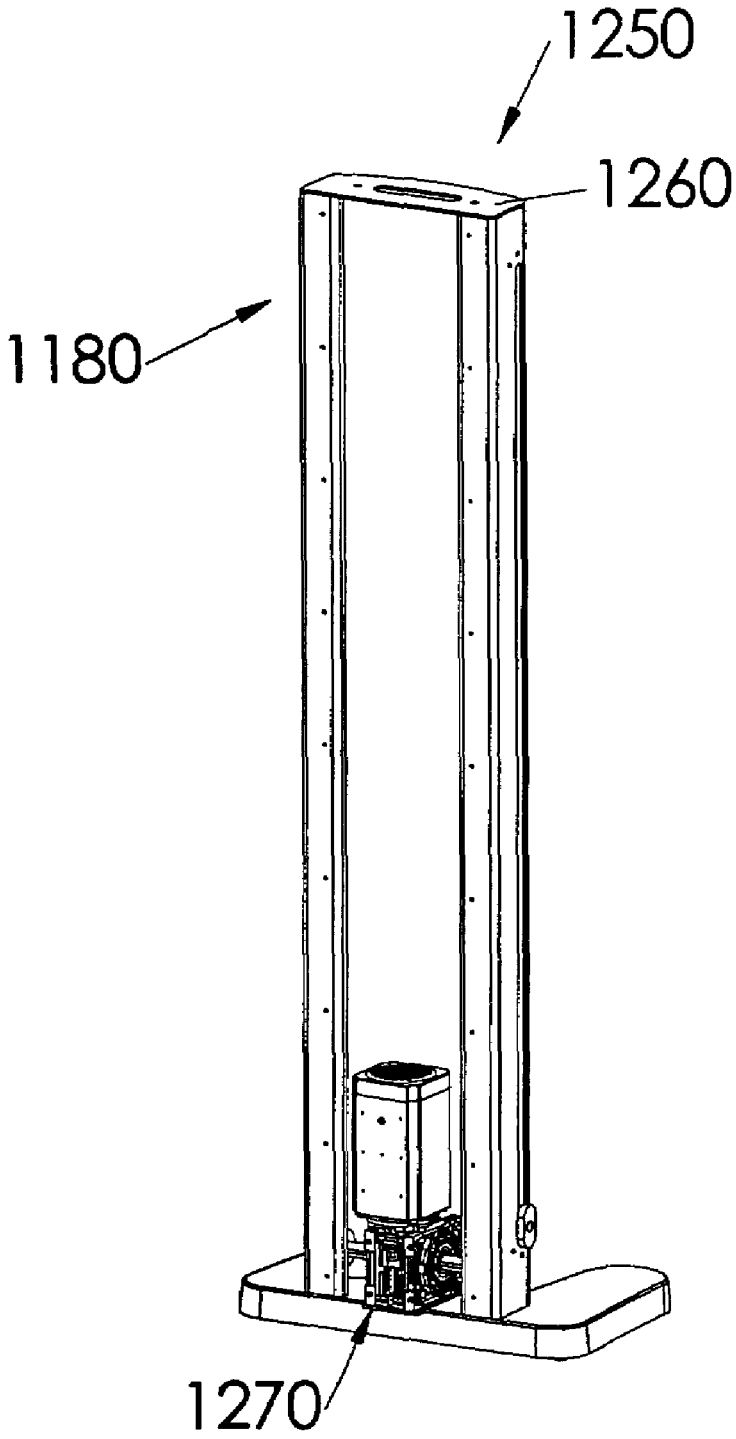
FIG. 16 is a perspective view of an embodiment of the internal construction of the tower illustrated in the exercise device of FIG. 15.
Figure 17:
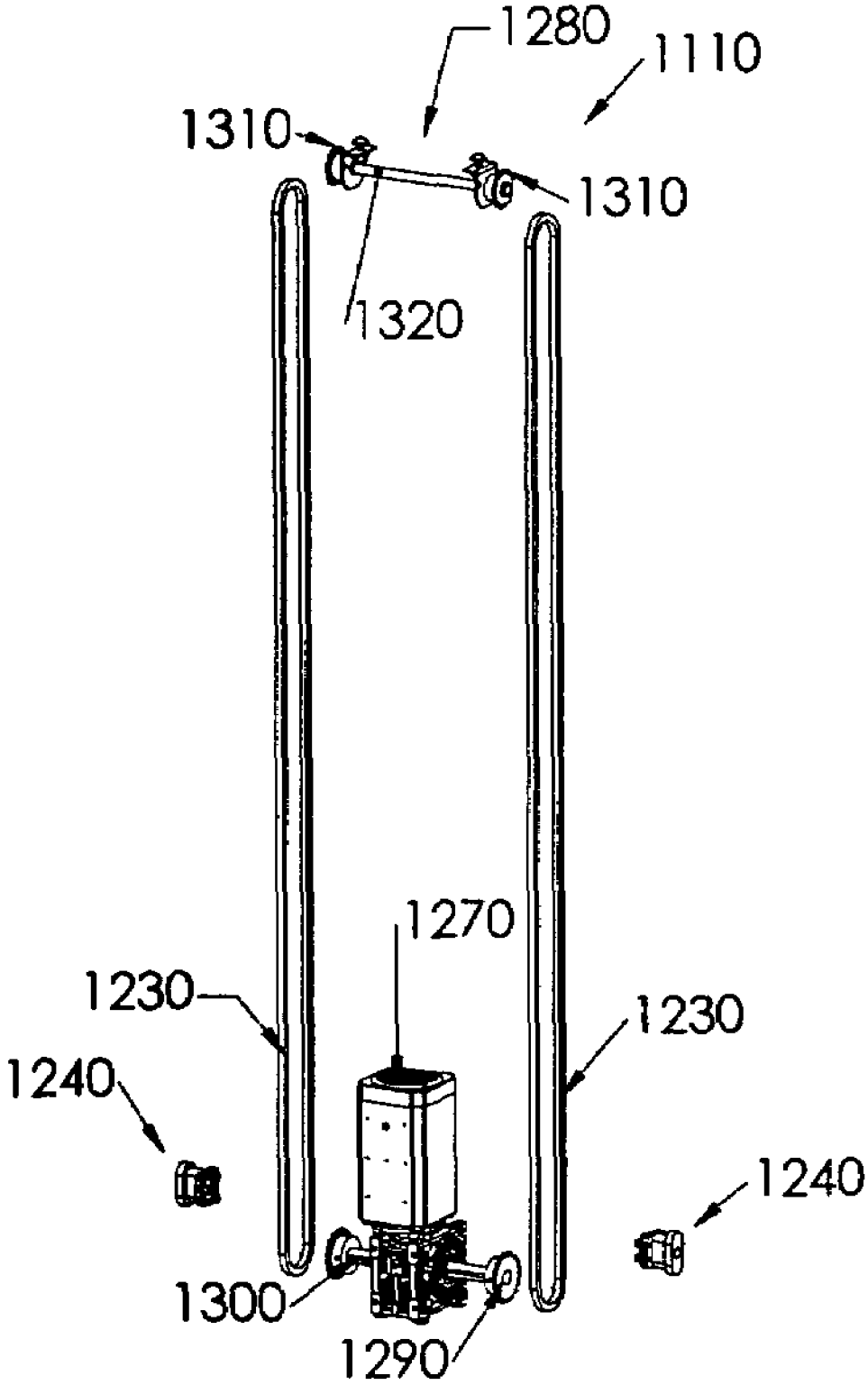
FIG. 17 is a perspective view of an embodiment of an automatic lift mechanism of the exercise device of FIG. 15.

With reference to FIGS. 15-17, an alternative embodiment of an exercise device 1100 will now be described. The exercise device 1100 is similar to the exercise devices shown and described above with respect to FIGS. 1-14, except the exercise device 1100 includes an automatic lift mechanism 1110 (FIG. 17) to set the height and angle of the rails 230, 240 and user support platform 320. This eliminates the need for a user to manually set the height and angle of the rails 230, 240 and user support platform 320 by lifting or lowering the rails 230, 240 and user support platform 320, sliding the inwardly extending slide bars 210 up or down in the tower level tracks 190, and setting the bars 210 in corresponding tower level hooks 200 as described above with respect to FIGS. 1 and 2.

The exercise device 1100 includes a tower 1120 with a tower housing 1130 extending from an intermediate base section 1140 of a base 1150. The tower housing 1130 includes a front vertical face 1160, a rear vertical face 1170, and opposite symmetric sides 1180. The sides 1180 include elongated vertical tracks 1190. Slide bars 1210 extend inwardly from proximal ends 220 of the upper rails 230. The inwardly extending slide bars 1210 are coupled to chains 1230 (FIG. 17) of the automatic lift mechanism 1110 through couplers 1240.

With reference to FIG. 16, an inner frame assembly 1250 of the tower 1120 is shown. The inner frame assembly 1250 includes the sides 1180 extending from the base 1150 and a horizontal cross support 1260 spanning the distance between the sides 1180 at a top of the frame assembly 1250. Near a bottom of the frame assembly, between the sides 1180, a driving mechanism 1270 (e.g. motor with attached power cord) of the automatic lift mechanism 1110 is disposed.

With reference to FIG. 17, the automatic lift mechanism 1110 of the exercise device 1110 will be described in more detail. The automatic lift mechanism 1110 includes the opposite chains 1230, an upper pulley assembly 1280, and the driving mechanism 1270, which includes lower pulleys 1290 and shafts 1300. The upper pulley assembly 1280 includes opposite pulleys 1310 and shaft 1320. In use, after the driving mechanism 1270 is plugged into a wall outlet, the automatic lift mechanism 1110 is actuated to raise or lower the height and angle of the rails 230, 240 and user support platform 320. This may be accomplished with a three-way toggle switch that may be set to an up or raise position for causing the driving mechanism 1270 to rotate in one direction to increase the height and angle of the rails 230, 240 and user support platform 320, may be set to an down or lower position for causing the driving mechanism 1270 to rotate in an opposite direction to decrease the height and angle of the rails 230, 240 and user support platform 320, and may be set to a third neutral position where the driving mechanism 1270 is off and the height and angle of the rails 230, 240 and user support platform 320 is locked in place. Varying the height and angle of the rails 230, 240 and user support platform 320 varies the portion of the exerciser's own body weight that the user exerts muscle force against during use of the exercise device 1100. The automatic lift mechanism 1110 eliminates the need for a user to manually set the height and angle of the rails 230, 240 and user support platform 320 by lifting or lowering the rails 230, 240 and user support platform 320, sliding the inwardly extending slide bars 210 up or down in the tower level tracks 190, and setting the bars 210 in corresponding tower level hooks 200 as described above with respect to FIGS. 1 and 2.

Installation and use of the exercise device 100 and some of the components for the exercise device 100 will now be described.

Installing the Folding Squat Platform and Telescoping Squat Stand

Align bottom of folding squat platform with lower rails just above base. Using the two holes ½" from the top of the rails, slide the fixed pin into the hole in the outside left rail. Pull the retractable pin on the right side and move the pin over the hole. Release the pin. Move the folding squat platform until the pin engages completely. Align the telescoping squat stand over the folding squat platform tubes until the squat stand pins contact the top of the folding squat platform tubes. Pull the retractable pins and adjust the squat stand to the desired height, then release the pins and raise or lower the squat stand until both pins engage in one of the three adjustment holes in the folding squat platform tubes.

Adjusting the Pulley Locator Brackets

Pulley locator brackets are designed to adjust easily. Simply pull back on the adjustable pin, move the pulley locator bracket to the desired position on the lateral adjustable training (LAT) bars, and allow the pin to engage the slotted hole.

Using the Adjustable Foot Holder

Prior to use, the adjustable foot holder must be rotated to the upright position. Raise the foot holder until the bracket makes contact with the rail snap button. Depress snap button and hold while raising bracket. Continue raising bracket until snap button engages. To begin using the adjustable foot holder, sit on the glideboard 330. Push in the center post snap button and raise the upper foot pad assembly. Place heels past the pads of the lower foot pad assembly. Lower the upper foot pad assembly once feet are in position. Push in the right rail snap button to lower the adjustable foot holder.

Adjusting the Lat Bars

To adjust the LAT bars, pull the pins on the retractable LAT bar to disengage from the rail and lower or raise LAT bars to the desired position. Ensure that the pins engage. Two LAT bar adjustments can be made to accommodate three positions. Normal use: parallel to the tower Pull-Up Position: small angle from the rail Fold up Position: parallel to the bottom of the rail Raising and Lowering the Rail Angle To raise or lower the rail angle, stand alongside the upper rail, facing the tower. Hold the tower with one hand while raising or lowering the upper rail with the other hand. Hint: Push backward slightly on the tower when moving the rails up or down, then pull forward when the desired height is reached and allow the tower crossbar to slip into the desired tower level hook. Any time you wish to have the glideboard 330 free from the pulley cable assembly, simply unfasten the snap hook from the "D" ring, releasing the center cable pulley. Store the center cable pulley in the tower handle as shown. Important: Remember to use ergonomically correct lifting procedures. Maintain spine in a neutral position, knees bent. Normal Pull-up Fold-up To Fold the Exercise Device 100

Drop the adjustable foot holder to the down position. To do so, push in the snap button on the inside of the right rail and gently lower the assembly. There is no need to remove the telescoping squat stand and folding squat platform when you move or store the exercise device 100. To fold the folding squat platform, pull the left side retractable pin while pushing the platform gently forward until the retractable pin locks in place in the folded position. Next, adjust the pulley cable pins to the third position on the LAT bars. Ensure that the center pulley is attached to the glideboard 330 "D" ring. Lower the LAT bars to the fold position parallel to the rails. Lower the rails to the bottom position. Push the tower back while you pull the retractable pin on the support strut. When the pin disengages, pull the tower to an upright position. Grab either side of the padded crossbar located in the center of the rails, and pull the rails toward the tower. This will bring the base of the rail to rest on the base of the tower. During this movement, the support strut pin should engage into the folded position. Connect the retainer strap to the glideboard 330 "D" ring to secure exercise device 100 in the upright position. To avoid cable breakage, ensure that cables remain free from contact with hinges, the floor, or wheels. Important: Keep hands, fingers, hair, etc. away from all moving parts. Avoid touching hinges. To move the exercise device 100, stand behind the tower, grasp the tower handle, lean the tower back toward you and roll the exercise device 100 as you would roll a hand truck.

To Unfold the Exercise Device 100 and Return to Use

Pull the Rail Assembly toward the tower. Remove the retainer strap from the glideboard 330 "D" ring. Disengage the retractable support strut knob. Push the lower rails off and away from the base of the tower. Grasp either side of the padded center rail crossbar and allow the rails to unfold slowly away from the tower until the rails are fully extended. Lift the rails to the desired tower level, ensuring that the support strut knob engages. Adjust LAT bars to desired position. To raise the folding squat platform, disengage the retractable pin on the left side and raise the platform until the pin engages in the upright position.

Resistance Chart for Exercise Device 100

The resistance required at each level, taking into consideration the weight of the participant, can be found on the Resistance Chart illustrated in FIG. 18. The Resistance Chart is customized to indicate the exercise load required at each level of exercise device 100. NOTE: This required force is simply the exercise load or amount of external work accomplished to move the glideboard 330 at a specific angle. It does not take into consideration the relative intensity of load when using the pulleys, i.e. knowing how many pounds went up and down the ramp, not how hard it was to pull the weight up and down. The exercise device 100 uses a variable-angle incline plane to create exercise resistance by modifying the user's body weight—the steeper the angle, the more resistance. Simply multiply the user's body weight by the appropriate percentage indicated in the chart. The result of this calculation is the resistance (force) in pounds required to move the glideboard 330. When figuring exercises that incorporate the pulley cables, use 50% of the charted numbers. NOTE: The weight of the glideboard 330 is factored into the resistance chart. Therefore, bodyweight and the level of resistance are the only variables required.

In the following paragraphs, a number of programs for the exercise device 100 will now be described. These programs involve a number of additional aspects of the invention. In the description of some of the programs, a brand name followed by ™ is used to identify the particular program. Some of the additional aspects of the invention described in the following paragraphs include, but not by way of limitation, one or more methods of teaching or instructing, one or more methods of teaching or instructing with respect to an embodiment of the exercise device, one or more methods of using an embodiment of the exercise device, one or more methods of using one or more features of an embodiment of the exercise device, one or more methods of exercising, training, or rehabilitating, and an embodiment of the exercise device. Although the methods in the following paragraphs may be described in a specific order and may be described as including steps performed in a specific order, in one or more alternative embodiments or aspects, one or more of the methods may be performed in a different order than that described and/or one or more steps of one or more of the methods may be performed in a different order than that described. Further, one or more of the methods and/or one or more of the steps may include fewer methods/steps, additional methods/steps, and/or some of the methods/steps combined with different methods/steps.

Personal Training

The Personal Training information set forth in this section is intended as a tool for personal fitness trainers to improve the efficiency of the training sessions. The exercise device 100 utilizes angular resistance training and numerous exercises are provided using body weight to supply resistance. The exercise device 100 accommodates functional, synergistic movement patterns as well as isolated joint articulations. Trainers utilize the exercise device 100 for improvements in strength, hypertrophy, flexibility, balance, power and endurance. The exercise device 100 challenges any individual fitness level using pulleys, an adjustable incline, levers and sound biomechanical principles to enhance every training session.

RESISTANCE TRAINING: Resistance training is the term most often used to describe exercise programming to improve the performance of the muscular system. Its objectives can range from muscle hypertrophy and weight loss to physical rehabilitation and athletic performance. The type of resistance can be produced by various modes; the most popular is the use of a set mass against gravity, i.e. free weights or one's own body. Although the primary outcome of resistance training may be improved muscular strength and endurance, additional health benefits include decreased loss of bone mineral density, lower blood pressure, reduced body fat and decreased chance of developing lower back problems. Several different types of resistance training can be used to alter the state of the musculoskeletal system, such as static (isometric) training and dynamic (isotonic and isokinetic) training. Muscular contractions are primarily isometric or isotonic in normal daily function. Isometric-Static muscular contraction where no change in muscle length occurs. This type of training is useful for maintaining the position of an object such as holding a grocery bag stationary for a length of time. Static training on the exercise device 100 would entail holding an overloaded position for an extended period. Isotonic-Dynamic muscular contraction where concentric (shortening) and eccentric (lengthening) contractions occur against a constant resistance. Although the extrinsic force is the same, the tension produced by the muscle fluctuates throughout the full range of motion, depending on the intrinsic properties such as origin, insertion of a muscle, lever length and other biomechanical variables. When performing dynamic exercises on the exercise device 100, the contractions are primarily isotonic. Isokinetic-Dynamic muscular contraction at a constant velocity throughout the full range of motion. Special equipment exists to accommodate the variable forces produced by the muscles throughout the range of motion. In theory, this type of training is useful to produce maximum strength throughout the entire range of the specified muscle.

When designing a resistance training program, the trainer should consider the following fundamentals in order to achieve maximum benefits. The SAID (Specific Adaptation to Imposed Demands) principle is the foundation of improving health and fitness; it states that all training adaptations are specific to the applied stimulus. The body modifies its tissues constantly to adapt to imposed physiological stresses. Functional exercises are based upon modifications that result from the SAID principle. For example, a coach will not only have athletes perform their sport but will also break the sport down into fundamental components. Sprinting, jumping, rotating and turning are fundamental components of basketball. Therefore, the coach will challenge the athletes with jumping drills, sprinting drills and other specific movements that mimic the sport. The coach can identify individual weaknesses in the athlete and work to improve these aspects with the SAID principle. Overload Physiological adaptation occurs (under normal circumstance) when the training stimulus is greater than what the client is accustomed to. The amount of overload is dependent upon the current level of fitness. Overload is achieved during resistance training by increasing the resistance, repetitions and sets or by decreasing the tempo or rest periods between exercises. Progression The structural and functional adaptations that take place as a result of resistance training will only respond if continually called upon to exert a greater magnitude of force (2). Progressive overload can be established by increasing or altering any of the variables associated with resistance training (i.e., load, frequency, volume, etc.). Once adaptation occurs, less muscle mass is recruited with the same resistance. Therefore, progressive training is essential for improved performance. Periodization breaks the training program into specific time periods throughout the year. The training variables are altered throughout the cycle to maximize performance during competition.

MOVEMENT PATTERNS: Many of the movements performed during training are attempts at mimicking the natural movement of a given task in order to improve performance. The ability to accurately analyze human movement will enable the trainer to duplicate the actual training movement designed to improve a specific function. To do this, the trainer needs to consider the forces required to perform the movement pattern. Functional movements incorporate all extrinsic and intrinsic forces applied to the human body as they relate to daily life. Common forces applied to movement are gravity, ground reaction force, friction and soft tissue forces. Combinations of the above forces produce functional, synergistic movement patterns in three planes of motion.

The primary planes of motion used to describe human movements in three dimensions of space are: 1) Sagittal-Sectional plane dividing the body into left and right portions. Example movement—torso flexion; 2) Frontal—Sectional plane dividing the body into anterior and posterior portions. Example movement—shoulder abduction; 3) Transverse—Sectional plane dividing the body into superior and inferior portions. Example movement—cervical rotation.

Tri-plane motions are movements combining all three planes of motion, simultaneously. These movements mimic everyday activities, working primary and stabilizing muscles synergistically. The exercise device 100 utilizes the natural forces of gravity using variable angular resistance (VAR). VAR provides partial weight bearing resistance while maintaining functional movement patterns. The adjustable pulley/cable system of the exercise device 100 enables trainers to duplicate a wide variety of functional movements patterns. The line of pull, intensity and balance requirements can easily be altered by the trainer to meet the needs of each individual client.

Personal trainers must continually develop, execute and assess exercise design to achieve specific objectives. In doing so, certain principles must be identified and applied. The 3 Ms, listed below, may assist in better exercise execution. 1) MUSCLE: Action—Identify the action of the muscle/muscle group to be challenged. ROM—Identify the range of motion of the muscle/muscle group involved. 2) MOVEMENT: Line of Pull—Defined by the muscle position and action. Trainer identifies the line of pull best suited for the exercise. Pulley Placement—Adjust pulley placement to fine tune the line of pull. Joint participation—Multi-joint or single-joint exercise. 3) MAGNITUDE: Load—Determine proper load (intensity) for exercise by experimenting with levels in comparison to repetitions desired. Volume—The number of repetitions and sets prescribed. Rest periods—If same muscle group is recruited consecutively, determine recommended rest interval for repetition zone. Frequency—Days per week exercise is to be performed.

MUSCULAR ADAPTATIONS OF RESISTANCE TRAINING: Muscular strength, endurance, hypertrophy and power are all muscular adaptations of resistance training.

STRENGTH: Strength may be referred to as the ability to generate force at a given speed of movement. Continued improvements in muscular strength require a progressive resistance-training program. The types of strength (isometric, isotonic and isokinetic) require specificity of training if an improvement is desired. Recommended are both eccentric and concentric muscle actions utilizing multi-joint (MJ) and single-joint (SJ) exercises. A 2-10% increase in load is recommended if the user can complete >2 repetitions above the recommended volume (dependent on muscle group). Increases in load are facilitated by adjusting the incline or adding external weights to the exercise device 100. FIG. 19 is a table of recommended training guidelines for improving strength. KEY POINTS (INTERMEDIATE): Single and multiple joint exercises-emphasis on multiple joint. Multiple joint prior to single joint. Multiple sets of six to twelve repetitions, two to four days per week. Two to three minute rest periods for core, one to two minutes for others. Strength/hypertrophy training on the exercise device 100 is efficient, safe and challenging. The exercise device 100 reduces the joint compression that occurs with heavy free weight training. Also, the cable pulley system reduces the momentum of the resistance, thus decreasing the risk of injury. Many exercises on the exercise device 100 require stabilization throughout the movement which subsequently reduces the amount of resistance needed for an exercise. For example, the body is fully supported during a traditional bench press with freeweights. The exercise device 100 requires the user to remain in an upright position throughout the movement. This type of training can result in additional stabilization benefits. The exercise device 100 requires stabilization for nearly all of the exercises.

HYPERTROPHY: Properly designed progressive resistance training programs can result in hypertrophy, or increased muscle size and shape. The mechanisms for this response are associated with muscle damage and remodeling of the muscle proteins. The selection of exercises, muscle action, load, volume, rest periods and frequency all affect the hypertrophy response. It is recommended that load, volume and frequency begin and progress dependent upon the person's fitness level (see chart of FIG. 20). Both eccentric and concentric muscle contractions should be included with the velocity of each repetition, ranging from slow to fast. The program should progress as specified to produce greater hypertrophy. KEY POINTS (INTERMEDIATE): Single and multiple joint exercises. Multiple joint prior to single joint. Multiple sets of six to twelve repetitions, two to four days per week. One to two minute rest periods.

POWER: Power is produced when the same amount of work is completed in a shorter period of time, or when a greater amount of work is performed during the same period of time. Muscular power plays a vital role in sports and activities of daily living (ADLs). Plyometric training is an excellent example of power training. Plyometric refers to exercises that enable a muscle to reach maximal force production in as short a time as possible. Predominantly multiple-joint movements using similar volume guidelines used for strength are recommended. Increases in power should parallel the specific goals of the client. For example, a volleyball player may be interested in increasing his or her vertical jump height. Therefore, explosive plyometric exercises would be ideal training for improvement (specificity). Primarily multiple-joint exercises with rest periods and frequency similar to muscle strength training are recommended. KEY POINTS (INTERMEDIATE): Primarily multiple joint exercises. Most complex movement patterns to least complex. Multiple sets of three to six repetitions, two to four times a week. Fast explosive movements. SAMPLE POWER RELATED EXERCISES ON EXERCISE DEVICE 100: Plyometric Squat; Plyometric Skiing; Plyometric Split Squat; Plyometric Sprint Start. Plyometric training on the exercise device 100 is an excellent way in to increase muscular power. The variable incline resistance provides trainers with an environment to safely include plyometric exercises in the programming. This allows clients of all ages to participate in plyometric training.

ENDURANCE: Muscular endurance, or the ability of a muscle to produce a maximum number of repetitions with a specific training load, is enhanced by long duration sets and shorter recovery time between sets. It is recommended that recommends that both single and multiple sets be included, targeting specific muscle groups and using variety in sequencing. Light loads and increased repetitions are recommended, as well as shorter rest periods between sets. Frequency should be the same as hypertrophy training, but with intentionally slow velocity and moderate repetitions for enhanced endurance results. KEY POINTS (INTERMEDIATE): Single and multiple joint exercises. Variety in sequencing. Multiple Sets of ten to fifteen (or more), two to four times per week. One to two minute rest periods. Circuit training on the exercise device 100 is an ideal way to increase muscular endurance. Trainers can develop specific circuits to increase performance in sport, activities of daily living or just fun. With numerous exercises to choose from, the amount of circuits that can be assembled is nearly endless.

Exercise Programming:

BALANCE: Balance is another important component of physical fitness. Balance can be learned, challenged and improved. Programs designed to improve balance should aim to improve kinesthetic awareness and develop neuromuscular adaptations to maintain functional-equilibrium during movement. Functional-equilibrium refers to the body's natural ability to maintain dynamic stability during movement. For example, when performing a chest press on the exercise device 100, the client is cued to maintain an upright posture throughout the movement pattern. This is opposed to a standard chest press in that the posterior support is provided by a fixed platform (bench). Balance training will not only assist in injury prevention, but can improve performance and confidence in sport and every day life. Kinesthetic awareness is the ability to recognize where all of a person's body parts are in a three dimensional space. A female gymnast must have excellent kinesthetic awareness to move, jump and land on the balance beam. The glideboard 330 on the exercise device 100 can serve as an unstable platform during exercises, thus creating an unstable environment in which to train. For example, a kneeling torso rotation creates more instability than a seated torso rotation. Trainers can progress many exercises simply by creating more instability. This type of training improves muscle reflex activation in order to maintain stability throughout a movement. The following is an exemplary balance routine (the individual exercises are described in more detail further below): 1. Incline Lunge, 2. Reverse Lunge, 3. Lateral Lunge, 4. Kneeling Torso Rotation (L & R), 5. Kneeling Upright Row, 6. Prone Jack Knife, 7. Single Leg Prone Jack Knife, 8. Horizontal Shoulder Abduction, 9. Kneeling Torso Rotation with Angle Variations, 10. Static, Chest Press, 11. Incline Push-ups, 12. Bridge Squat, 13. Squatting—Skiing, 14. Cool Down Routine.

STRENGTH AND ENDURANCE (TOTAL BODY): This sample routine is progressive, safe, and time effective. The program consists of exercises that challenge all of the major muscle groups. This program increases strength, endurance, flexibility and improves body composition regardless of a client's fitness level. The sequencing reduces transitions, moves from large to small muscle groups and provides clients additional benefits such as balance, kinesthetic awareness and improved functional performance. The following is an exemplary strength and endurance routine (the individual exercises are described in more detail further below): 1. Bilateral Squat, 2. Unilateral Squat, 3. Bridge Squat, 4. Lat Pull Down, 5. Arm Pullover, 6. Pullover Crunch, 7. Triceps Press Down, 8. Chest Press, 9. Seated Row, 10. Unilateral Row, 11. Seated Torso Rotation (L), 12. Seated Biceps Curl, 13. Hip Abduction, 14. Seated Torso Rotation (R), 15. Hamstring Curl, 16. Bent Leg Incline Crunch, 17. Pull Up, 18. Cool Down Routine.

CARDIO-RESISTANCE WITH OPTIONAL EQUIPMENT: Cardio-resistance training is simply a cardiovascular and strength building routine done in a circuit fashion combining resistance training exercises with bouts of cardiovascular exercises to maintain an exercising heart rate throughout the routine. The following is a sample cardio-resistance training circuit with space allotted to utilize other cardiovascular training equipment (i.e., jump rope, treadmill, exercise bike etc.) The following is an exemplary cardio-resistance routine (the individual exercises are described in more detail further below): 1. Bilateral Squat, 2. Unilateral Squat, 3. Bilateral Heel Raise, 4. Unilateral Heel Raise, 5. Toe Out Squat, 6. Plyometric Skiing (2-3 minutes), 7. Seated Row, 8. Biceps Curl, 9. Reverse Fly, 10. Seated Shoulder Extension, 11. Cardio (3 minutes), 12. Hamstring Curl, 13. Bent Leg Incline Crunch, 14. Pull Up, 15. Chin Up, 16. Cardio (3 minutes), 17. Chest Press, 18. Static Chest Press, 19, Torso Rotation, 20. Horizontal Shoulder Abduction (L&R), 21. Cardio (3 minutes), 22. Pullover Crunch, 23. Triceps Press Down, 24. Cross Body Crunch, 25. Cool Down Routine.

A number of exemplary Personal Training exercises using the exercise device 100 will be described in turn below.

Chest Press—Pectoral Group, Triceps, Deltoids (Anterior):

STARTING POSITION: Grasp handles and pull the glideboard 330 halfway up the rails. Straddle the rails and sit toward the top edge of the glideboard 330, facing away from the tower. Place legs in a comfortable position. Bring hands to the side of the torso, at chest level. Cables should be inside forearm. EXERCISE DESCRIPTION: From an upright seated position, bring the glideboard 330 up the rails by pressing the handles straight out to chest level until arms are fully extended. Lower the glideboard 330 by returning the arms back to the starting position. PULLEY PIN PLACEMENT: Adjust to ensure correct force angle. Recommended—2, 3 TEACHING TIPS: Bring the handles together at the top of the movement to maximize contraction of the pectoral muscles. Pause momentarily with arms fully extended. Maintain upright posture (neutral spine).

SAFETY ASPECTS: Avoid upper body movement in the sagittal plane. Care should be taken to avoid hyperextension during horizontal abduction of the shoulder. Do not bounce at the bottom range of the exercise. Move the arms in a slow and controlled motion. Avoid excessive shoulder protraction and retraction during the movement. VARIATIONS: Static Equilibrium—From the starting position, bring the glideboard 330 up the rails by pushing one handle straight out at chest level until the arm is fully extended. Without moving the glideboard 330, move both arms in opposite directions simultaneously.

Unilateral—From the starting position, push one handle out to chest level while the opposite arm remains static. Return with control to the starting position. Repeat with alternating arm.

Incline Chest Press—Pectoral Group, Triceps, Deltoids (Anterior)

STARTING POSITION: Grasp handles and pull the glideboard 330 halfway up the rails. Straddle the rails and sit toward the top edge of the glideboard 330, facing away from the tower. Place legs in a comfortable position. Bring hands to the side of the torso, at chest level. Cables should be inside forearm. EXERCISE DESCRIPTION: From an upright seated position, bring the glideboard 330 up the rails by pressing the handles straight out to eye level until arms are fully extended. Lower the glideboard 330 by returning the arms back to the starting position. PULLEY PIN PLACEMENT: Adjust to ensure correct force angle. Recommended—1, 2. TEACHING TIPS: Bring the handles together at the top of the movement to maximize contraction of the pectoral muscles. Pause momentarily with arms fully extended. Maintain upright posture (neutral spine).

SAFETY ASPECTS: Avoid upper body movement in the sagittal plane. Care should be taken to avoid hyperextension during horizontal abduction of the shoulder. Do not bounce at the bottom range of the exercise. Move the arms in a slow and controlled motion. Avoid excessive shoulder protraction and retraction during the movement.

VARIATIONS: Static Equilibrium—From the starting position, bring the glideboard 330 up the rails by pushing one handle straight out at eye level until the arm is fully extended. Without moving the glideboard 330, move both arms in opposite directions simultaneously. Unilateral—From the starting position, push one handle out at eye level while the opposite arm remains static. Return with control to the starting position. Repeat with alternating arm.

Decline Chest Press—Pectoral Group, Triceps, Deltoids (Anterior)

STARTING POSITION: Grasp handles and pull the glideboard 330 halfway up the rails. Straddle the rails and sit toward the top edge of the glideboard 330, facing away from the tower. Place legs in a comfortable position. Bring hands to the side of the torso, at chest level. Cables should be inside forearm. EXERCISE DESCRIPTION: From an upright, seated position, bring the glideboard 330 up the rails by pressing the handles down to abdomen level until arms are fully extended. Lower the glideboard 330 by returning the arms back to the starting position. PULLEY PIN PLACEMENT: Adjust to ensure correct force angle. Recommended—2, 3. TEACHING TIPS: Bring the handles together at the top of the movement to maximize contraction of the pectoral muscles. Pause momentarily with arms fully extended. Maintain upright posture (neutral spine).

SAFETY ASPECTS: Avoid upper body movement in the sagittal plane. Care should be taken to avoid hyperextension during horizontal abduction of the shoulder. Do not bounce at the bottom range of the exercise. Move the arms in a slow and controlled motion. Avoid excessive shoulder protraction and retraction during the movement.

VARIATIONS: Static Equilibrium—From the starting position, bring the glideboard 330 up the rails by pressing one arm down to abdomen level until the arm is fully extended. Without moving the glideboard 330, move both arms in opposite directions simultaneously.

Unilateral—From the starting position, push one handle out to abdomen level while the opposite arm remains static. Return with control to the starting position. Repeat with alternating arm.

Chest Fly—Pectoral Group

STARTING POSITION: Grasp handles and pull the glideboard 330 halfway up the rails. Straddle the rails and sit toward the top edge of the glideboard 330, facing away from the tower. Place legs in a comfortable position. Stretch arms out to the sides of the torso, with palms facing forward and a slight bend at the elbow. Cables should be outside the forearms. EXERCISE DESCRIPTION: From an upright, seated position, bring the glideboard 330 up the rails by pulling the handles together in front of the chest. Lower the glideboard 330 by returning the arms back to the starting position. PULLEY PIN PLACEMENT: Adjust to ensure correct force angle. Recommended—4, 5. TEACHING TIPS: Bring the handles together at the top of the movement to maximize contraction of the pectoral muscles. Pause momentarily with hands together. Maintain upright posture (neutral spine). Keep elbows slightly bent throughout exercise. SAFETY ASPECTS: Do not flex at the elbow during the fly movement, as this will take emphasis off the pectoral muscles. Avoid upper body movement in the sagittal plane. Care should be taken to avoid hyperextension during horizontal abduction of the shoulder. Avoid excessive shoulder protraction and retraction during the movement.

Incline Chest Fly—Pectoral Group, Deltoids

STARTING POSITION: Grasp handles and pull the glideboard 330 halfway up the rails. Straddle the rails and sit toward the top edge of the glideboard 330, facing away from the tower. Place legs in a comfortable position. Stretch arms out to the sides of the torso, with palms facing forward and a slight bend at the elbow. Cables should be outside the forearms. EXERCISE DESCRIPTION: From an upright, seated position, bring the glideboard 330 up the rails by pulling the handles together at eye level. Lower the glideboard 330 by returning the arms back to the starting position. PULLEY PIN PLACEMENT: Adjust to ensure correct force angle. Recommended—4, 6. TEACHING TIPS: Bring the handles together at the top of the movement to maximize contraction of the pectoral muscles. Pause momentarily with hands together. Maintain upright posture (neutral spine). Keep elbows slightly bent throughout exercise. SAFETY ASPECTS: Do not flex at the elbow during the fly movement, as this will take emphasis off the pectoral muscles. Avoid upper body movement in the sagittal plane. Care should be taken to avoid hyperextension during horizontal abduction of the shoulder. Avoid excessive shoulder protraction and retraction during the movement.

Decline Chest Fly—Pectoral Group

STARTING POSITION: Grasp handles and pull the glideboard 330 halfway up the rails. Straddle the rails and sit toward the top edge of the glideboard 330, facing away from the tower. Place legs in a comfortable position. Stretch arms out to the sides of the torso, with palms facing forward. Cables should be outside the forearms. EXERCISE DESCRIPTION: From an upright, seated position, pull the glideboard 330 up the rails by bringing the handles together at abdomen level. Lower the glideboard 330 by returning the arms back to the starting position. PULLEY PIN PLACEMENT: Adjust to ensure correct force angle. Recommended—4, 5. TEACHING TIPS: Bring the handles together at the top of the movement to maximize contraction of the pectoral muscles. Pause momentarily with hands together. Maintain upright posture (neutral spine). Keep elbows slightly bent throughout exercise. SAFETY ASPECTS: Do not flex at the elbow during the fly movement, as this will take emphasis off the pectoral muscles. Avoid upper body movement in the sagittal plane. Care should be taken to avoid hyperextension during horizontal abduction of the shoulder. Avoid excessive shoulder protraction and retraction during the movement.

Single Arm Chest Fly—Pectoral Group

STARTING POSITION: Stand to the side of exercise device 100 with back facing the rails. Grasp the closest handle and pull the glideboard 330 halfway up. Sit toward the top edge of the glideboard 330 facing sideways with both legs extended straight out. Feet should not touch the ground. Extend active arm toward the pulley at shoulder level. EXERCISE DESCRIPTION: With a slight bend at the elbow, palm facing in, slowly pull the arm in an arc motion to the front mid-line of the torso. Slowly lower the glideboard 330 by bringing the handle back across the torso to the original starting position. PULLEY PIN PLACEMENT: Adjust to ensure correct force angle. Recommended—3, 4. TEACHING TIPS: Contract the abdominal muscles to keep back straight and body stable on the glideboard 330. Place inactive hand on hip or on the side of the glideboard 330 to stabilize. Maintain upright posture (neutral spine). Keep elbow slightly bent throughout exercise. SAFETY ASPECTS: Do not bend the elbow joint to facilitate the movement. Avoid torso movement in the frontal plane. Avoid excessive shoulder elevation and protraction during exercise. VARIATIONS: Kneeling—Stand to the side of the rails and grasp the handle on the opposite side of the exercise device 100. Pull the glideboard 330 halfway up the rails. Place active hand, knuckles down, on the glideboard 330 to stabilize movement. Kneel on the top portion of the glideboard 330 facing sideways. Use caution when kneeling on exercise device 100. With a slight bend at the elbow, palm facing in, slowly pull the arm in an arc motion to the front mid-line of the torso. Slowly lower the glideboard 330 by bringing the handle back across the body to the original starting position and repeat.

Incline Single Arm Chest Fly—Pectoral Group, Deltoids

STARTING POSITION: Stand to the side of exercise device 100 with back facing the rails. Grasp the closest handle and pull the glideboard 330 halfway up. Sit toward the top edge of the glideboard 330 facing sideways with both feet extended straight out. Feet should not touch the ground. Extend active arm toward the pulley at abdomen level. EXERCISE DESCRIPTION: With a slight bend at the elbow, palm facing in, slowly pull the arm in an arc motion across the front mid-line of the body to eye level. Slowly lower the glideboard 330 by bringing the handle back across the body to the original starting position. PULLEY PIN PLACEMENT: Adjust to ensure correct force angle. Recommended—1, 6. TEACHING TIPS: Contract the abdominal muscles to keep back straight and body stable on the glideboard 330. Place inactive hand on hip or on the side of the glideboard 330 to stabilize. Maintain upright posture (neutral spine). Keep elbow slightly bent throughout exercise. SAFETY ASPECTS: Do not bend the elbow joint to facilitate the movement. Avoid torso movement in the frontal plane. Avoid excessive shoulder elevation and protraction during exercise. VARIATIONS: Kneeling—Stand to the side of the rails and grasp the handle on the opposite side of the exercise device 100. Pull the glideboard 330 halfway up the rails. Place active hand on the glideboard 330 to stabilize movement. Kneel on the top portion of the glideboard 330 facing sideways. Use caution when mounting exercise device 100. With a slight bend at the elbow, palm facing in, slowly pull the arm in an arc motion across the front mid-line of the body to eye level. Slowly lower the glideboard 330 by bringing the handle back across the body to the original starting position and repeat.

Decline Single Arm Chest Fly—Pectoral Group

STARTING POSITION: Stand to the side of the exercise device 100 with back facing the rails. Grasp the closest handle and pull the glideboard 330 halfway up. Sit toward the top edge of the glideboard 330 facing sideways with both feet extended straight out. Feet should not touch the ground. Extend active arm toward the pulley at shoulder level. EXERCISE DESCRIPTION: With a slight bend at the elbow, palm facing in, slowly pull the arm in an arc motion across the front mid-line of the body to abdomen level. Slowly lower the glideboard 330 by bringing the handle back across the body to the original starting position. PULLEY PIN PLACEMENT: Adjust to ensure correct force angle. Recommended—3. TEACHING TIPS: Contract the abdominal muscles to keep back straight and body stable on the glideboard 330. Place inactive hand on hip or on the side of the glideboard 330 to stabilize. Maintain upright posture (neutral spine). Keep elbow slightly bent throughout exercise. SAFETY ASPECTS: Do not bend the elbow joint to facilitate the movement. Avoid torso movement in the frontal plane. Avoid excessive shoulder elevation and protraction during exercise. VARIATIONS: Kneeling—Stand to the side of the rails and grasp the handle on the opposite side of the exercise device 100. Pull the glideboard 330 halfway up the rails. Place active hand on the glideboard 330 to stabilize movement. Kneel on the top portion of the glideboard 330 facing sideways. Use caution when mounting exercise device 100. With a slight bend at the elbow, palm facing in, slowly pull the arm in an arc motion across the front mid-line of the body to abdomen level. Slowly lower the glideboard 330 by bringing the handle back across the body to the original starting position and repeat.

Incline Push Up—Triceps, Pectoral Group, Deltoids

STARTING POSITION: Disconnect the pulley from the glideboard 330 and remove the telescoping squat stand. With the glideboard 330 at bottom of rails, face the tower and place both feet on or behind the lower base. Place both hands halfway up the glideboard 330 toward the sides. Push glideboard 330 up the rails until body is straight and arms are perpendicular to the rails. EXERCISE DESCRIPTION: Perform push-up by bending elbows to lower chest near glideboard 330, then push up until arms are straight. Glideboard 330 should not move during exercise. PULLEY PIN PLACEMENT: None. TEACHING TIPS: Exercise increases in difficulty as incline is lowered. Beginners should start at the highest incline. Keep back, legs and shoulders aligned throughout the exercise. Maintain stationary glideboard 330 throughout the exercise. SAFETY ASPECTS: Avoid hyper-extending the cervical spine. Keep the head in line with spine throughout the exercise. Avoid excessive shoulder protraction and retraction during the movement.

Decline Push Up—Pectoral Group, Triceps, Deltoids

STARTING POSITION: Disconnect the pulley from the glideboard 330 and remove the telescoping squat stand. Stand at the bottom of the rails, facing away from the tower. Bend knees and place both hands on floor near the outside portion of the lower base. Position both feet in the center of the glideboard 330. Push glideboard 330 up the rails until legs are straight and shoulders are directly above hands. EXERCISE DESCRIPTION: Perform push-up by bending elbows to lower chest near the floor, then push up until arms are straight. Glideboard 330 should not move during exercise. PULLEY PIN PLACEMENT: None. TEACHING TIPS: As the incline is increased, the emphasis changes to the shoulder muscles. Keep back, legs and shoulders aligned during the pushup exercise. Maintain shoulders directly over hands during movement. SAFETY ASPECTS: Avoid hyper-extending the cervical spine. Keep the head in line with spine throughout the exercise. Avoid excessive shoulder protraction and retraction during the movement. VARIATIONS: Wide hand placement—Increase the distance between the hands to change the emphasis to the pectoral muscles.

Cable Abdominal Crunch—Abdominals, Obliques

STARTING POSITION: Grasp handles and pull the glideboard 330 halfway up the rails. Straddle the glideboard 330 and sit at the bottom edge. Lie back, ensuring the head is fully supported. Bend knees and rest the feet on the bottom edge of the glideboard 330. EXERCISE DESCRIPTION: With handles held in toward the shoulders, slowly raise the head and shoulders off the glideboard 330 toward the knees by contracting the abdominal muscles. Pause at the top of the movement before returning to starting position. PULLEY PIN PLACEMENT: Adjust to ensure correct force angle. Recommended—2 TEACHING TIPS: Keep tension on the abdominals throughout the entire movement. Minimize cervical flexion during movement. Keep handles close to shoulders throughout the exercise. Maintain neutral wrists. SAFETY ASPECTS: Do not use momentum to raise the shoulder blades off the glideboard 330. Avoid bouncing at the bottom of the exercise.

Pullover Crunch—Latissimus Dorsi, Abdominals, Obliques, Teres Major, Triceps (Long Head), Pectoral Group STARTING POSITION: Grasp handles and pull the glideboard 330 halfway up the rails. Straddle the glideboard 330 and sit at the bottom edge. Lie back, ensuring the head is fully supported. Bend knees and rest the feet on the bottom edge of the glideboard 330. Extend both arms over head toward the tower. EXERCISE DESCRIPTION: In an arc motion, bring the handles over the chest toward the outer thighs. Simultaneously raise the head and shoulders off the glideboard 330 by contracting the abdominal muscles. Pause at the top of the movement before returning to starting position. PULLEY PIN PLACEMENT Adjust to ensure correct force angle. Recommended—2, 3. TEACHING TIPS: If the glideboard 330 "bottoms out" with arms extended overhead, slide body down. Minimize cervical flexion during movement by maintaining neutral spine. Maintain neutral wrists. Keep elbows slightly bent throughout exercise. SAFETY ASPECTS Do not allow arms to do all the work during this exercise. Movement should emanate from the back, shoulder and abdominal muscles. Avoid elevating the ribs by contracting the abdominal muscles throughout the movement. Avoid excessive shoulder protraction and elevation during the movement. VARIATIONS: Pullover crunch with legs elevated—Extend and lift the legs throughout the entire pullover crunch exercise. If strain is felt in the lower back, bend knees and hips to 90°.

Cross Body Pullover Crunch—Latissimus Dorsi, Abdominals, Obliques, Pectoral Group, Teres Major, Triceps (Long Head)

STARTING POSITION: Grasp handles and pull the glideboard 330 halfway up the rails. Straddle the glideboard 330 and sit at the bottom edge. Lie back, ensuring the head is fully supported. Bend knees and rest the feet on the bottom edge of the glideboard 330. Extend both arms over head toward the tower. EXERCISE DESCRIPTION: In an arc motion, bring one handle across the torso toward the opposite thigh. Simultaneously raise the head and shoulders off the glideboard 330 by contracting the abdominal muscles. Pause at the top of the movement before returning to starting position. Alternate arms during the exercise. PULLEY PIN PLACEMENT: Adjust to ensure proper force angle, Recommended—2, 4. TEACHING TIPS: Focus on the abdominal muscles when reaching toward the opposite thigh. The twisting motion will activate the oblique muscles. Minimize cervical flexion during movement. Maintain neutral wrists. Keep elbows slightly bent throughout exercise. SAFETY ASPECTS: Do not allow arms to do all the work during this exercise. Movement should emanate from the back, shoulder and abdominal muscles. Avoid elevating the ribs by contracting the abdominal muscles throughout the movement. Avoid excessive shoulder protraction and elevation during the movement.

Lying Leg Lift—Iliopsoas Group, Tensor Fascia Latae, Abdominals, Obliques

STARTING POSITION: Lower the LAT bars into the pull-up position. Disconnect the pulley from the glideboard 330. Push the glideboard 330 halfway up the rails, straddle the glideboard 330 and sit at the bottom edge. Lie back, ensuring head is fully supported. Grasp LAT bars. Bend hips and knees to 90° so thighs are perpendicular to glideboard 330. EXERCISE DESCRIPTION: With feet together, arms overhead and legs bent, contract the hip flexors and abdominal muscles toward the chest to lift the pelvis off the glideboard 330. Slowly return to starting position and repeat. PULLEY PIN PLACEMENT: None. TEACHING TIPS: Lower legs slowly to keep tension on the abdominals through the entire movement. Maintain neutral wrists. Keep elbows slightly bent throughout exercise. SAFETY ASPECTS: Do not use momentum to raise the pelvis off the glideboard 330. Doing so will reduce the activation of the abdominal muscles. Avoid elevating the ribs by contracting the abdominal muscles throughout the movement. Avoid excessive shoulder protraction and elevation during the movement. ACCESSORIES: LAT bars. VARIATIONS: Straight Leg—Fully extend the legs throughout entire movement pattern. This exercise increases the load on the abdominal and hip muscles during the beginning phase of the movement. Perform the exercise in the same manner as the Lying Leg Lift with legs fully extended. Torso Rotation—From starting position, slowly rotate torso to the right until a mild stretch is felt in the obliques. Repeat to the opposite side while maintaining upper body position.

Prone Jack Knife—Abdominals, Tensor Fascia Latae, Gluteal Group, Iliopsoas

STARTING POSITION: Disconnect the pulley from the glideboard 330. Remove the telescoping squat stand. Install the Press Bar on the bottom of the rails. Kneel on the bottom portion of the glideboard 330 facing away from the tower. Place both hands on the Press Bar. EXERCISE DESCRIPTION: With a neutral spine, push the glideboard 330 up the rails by extending the hips straight back. Maintain shoulders over wrists throughout entire movement. Lower the glideboard 330 by flexing the hips back to the starting position. TEACHING TIPS: Move the glideboard 330 slowly, using strict control of movement. Contract the abdominal muscles to stabilize the torso. Maintain shoulders directly over hands during movement. Maintain neutral spine. SAFETY ASPECTS: Do not let back or shoulders sag. Keep back straight, in line with the angle of glideboard 330 to minimize pressure placed on the lower back. Avoid hyper-extending the cervical spine. Keep the head in line with spine throughout the exercise. Avoid excessive shoulder protraction and retraction during the movement. ACCESSORIES: Press Bar.

Single Leg Prone Jack Knife—Abdominals, Tensor Fascia Latae, Gluteal Group, Iliopsoas STARTING POSITION: Disconnect the pulley from the glideboard 330. Remove the telescoping squat stand. Install the Press Bar on the bottom of the rails. Kneel on the bottom portion of the glideboard 330 facing away from the tower. Place both hands on the Press Bar. EXERCISE DESCRIPTION: Extend one leg straight back, off the glideboard 330. With a neutral spine, push the glideboard 330 up the rails by extending the active hip straight back. Maintain shoulders over wrists throughout entire movement. Lower the glideboard 330 by flexing the hip back to the starting position and repeat. Alternate legs after complete set. PULLEY PIN PLACEMENT: None. TEACHING TIPS: Move the glideboard 330 slowly, using strict control of movement. Contract the abdominal muscles to stabilize the torso. Maintain shoulders directly over hands during movement. Maintain neutral spine. SAFETY ASPECTS: Do not let back or shoulders sag. Keep back straight, in line with the angle of glideboard 330 to minimize pressure placed on the lower back. Avoid hyper-extending the cervical spine. Keep the head in line with spine throughout the exercise. Avoid excessive shoulder protraction and retraction during the movement. ACCESSORIES: Press Bar.

Bent Leg Incline Crunch—Hamstrings, Abdominals, Obliques

STARTING POSITION: Disconnect the pulley from the glideboard 330. Push the glideboard 330 halfway up the rails. Straddle the rails and sit on the top edge of the glideboard 330 facing the tower. Secure both feet into the adjustable foot holder. Lie back on the glideboard 330 with legs extended, ensuring the head is fully supported. EXERCISE DESCRIPTION: Using heels, pull the glideboard 330 up the rails by flexing the knee to a 90° angle. Place hands behind head or across chest. Maintaining bent leg position, raise head and shoulder blades off the glideboard 330 by contracting the abdominal muscles. Lower the glideboard 330 back to the starting position while lowering head and shoulders. PULLEY PIN PLACEMENT: None. TEACHING TIPS: Keep tension on the abdominals throughout the entire movement. Maintain neutral cervical spine. If the movement is too difficult, place arms across the chest, or reach arms to outer thighs. SAFETY ASPECTS: Do not pull excessively on the head with hands. This places stress on the cervical spine. ACCESSORIES: Adjustable Foot Holder. VARIATIONS: Torso Rotation—From the same starting position, place one hand behind the head and the other on the abdominals. Maintaining bent leg position, perform an oblique crunch by bringing the head and one shoulder off the glideboard 330 toward the opposite knee.

Seated Torso Rotation—Abdominals, Obliques, Psoas Major

STARTING POSITION: Stand to the side of exercise device 100 with back facing the rails. Grasp the handle on the opposite side of the exercise device 100 and pull the glideboard 330 halfway up. Sit toward the top edge of the glideboard 330 facing sideways with both legs extended straight out. Feet should not touch the ground. Grasp the handle with both hands, arms extended directly in front of the chest. Slightly bend elbows and rotate the torso toward the pulleys. EXERCISE DESCRIPTION: Using a twisting motion from the waist, bring the handle across the front of the chest until torso is rotated to the opposite side. Slowly lower the glideboard 330 down the rails by bringing the handle back across the body to the original starting position. PULLEY PIN PLACEMENT: Adjust to ensure correct force angle. Recommended—2, 3. TEACHING TIPS Concentrate on using the oblique and abdominal muscles to rotate, rather than using the arms. If the exercise is too difficult, bring the elbows in toward the rib cage during entire movement pattern. To increase resistance, grasp both handles. Maintain an upright posture throughout the movement. Keep head in line with the shoulders by watching hands during the exercise. SAFETY ASPECTS: Do not swing the torso back and forth. This brings momentum into the exercise and takes the resistance off of the abdominals, increasing the risk for low back injury. Avoid excessive shoulder protraction and elevation during movement.

Incline Seated Torso Rotation—Abdominals, Obliques, Psoas Major

STARTING POSITION: Stand to the side of exercise device 100 with back facing the rails. Grasp the handle on the opposite side of the exercise device 100 and pull the glideboard 330 halfway up. Sit toward the top edge of the glideboard 330 facing sideways with both legs extended straight out. Feet should not touch the ground. Grasp the handle with both hands, arms extended directly in front of the chest. Slightly bend elbows and rotate the torso toward the pulleys. EXERCISE DESCRIPTION: Using a twisting motion from the waist, bring the handle across the front of the chest in an upward motion until the torso is rotated to the opposite side with hands at eye level. Slowly lower the glideboard 330 down the rails by bringing the handle back down and across the body to the original starting position. PULLEY PIN PLACEMENT: Adjust to ensure correct force angle. Recommended—1, 6. TEACHING TIPS: Concentrate on using the oblique and abdominal muscles to rotate, rather than using the arms. If the exercise is too difficult, bring the elbows in toward the rib cage during entire movement pattern. To increase resistance, grasp both handles. Maintain an upright posture throughout the movement. Keep head in line with the shoulders by watching hands during the exercise. SAFETY ASPECTS: Do not swing the torso back and forth. This brings momentum into the exercise and takes the resistance off of the abdominals, increasing the risk for low back injury. Avoid excessive shoulder protraction and elevation during movement.

Decline Seated Torso Rotation—Abdominals, Obliques, Psoas Major

STARTING POSITION: Stand to the side of exercise device 100 with back facing the rails. Grasp the handle that is on the opposite side of the exercise device 100 and pull the glideboard 330 halfway up. Sit toward the top edge of the glideboard 330 facing sideways with both legs extended straight out. Feet should not touch the ground. Grasp the handle with both hands, arms extended directly in front of the chest. Slightly bend elbows and rotate the torso toward the pulleys. EXERCISE DESCRIPTION: Using a twisting motion from the waist, bring the handle across the front of the chest in a downward motion until the torso is rotated to the opposite side with hands at abdominal level. Slowly lower the glideboard 330 down the rails by bringing the handle back up and across the body to the original starting position. PULLEY PIN PLACEMENT: Adjust to ensure correct force angle. Recommended—3, 4. TEACHING TIPS: Concentrate on using the oblique and abdominal muscles to rotate, rather than using the arms. If the exercise is too difficult, bring the elbows in toward rib cage during entire movement pattern. To increase resistance, grasp both handles. Maintain an upright posture throughout the movement. Keep head in line with the shoulders by watching hands during the exercise. SAFETY ASPECTS: Do not swing the torso back and forth. This brings momentum into the exercise and takes the resistance off of the abdominals, increasing the risk for low back injury. Avoid excessive shoulder protraction and elevation during movement.

Kneeling Torso Rotation—Abdominals, Obliques, Psoas Major

STARTING POSITION: Stand to the side of the rails and grasp the handle on the same side of the exercise device 100. Pull the glideboard 330 halfway up the rails. Place hands, knuckles down, on the glideboard 330 to stabilize movement. Kneel on the top portion of the glideboard 330 facing sideways. Use caution when kneeling on exercise device 100. Grasp the handle with both hands, arms extended directly in front of the chest. Slightly bend elbows and rotate the torso toward the pulleys. EXERCISE DESCRIPTION: Using a twisting motion from the waist, bring the handle across the front of the chest until torso is rotated to the opposite side. Slowly lower the glideboard 330 down the rails by bringing the handle back across the body to the original starting position. PULLEY PIN PLACEMENT: Adjust to ensure correct force angle. Recommended—3, 4. TEACHING TIPS: Beginners should widen the base of support by increasing the space between the knees. Concentrate on using the oblique and abdominal muscles to rotate, rather than using the arms. If the exercise is too difficult, bring the elbows in toward the rib cage during entire movement pattern. To increase resistance, grasp both handles. Maintain an upright posture throughout the movement. Keep head in line with the shoulders by watching hands during the exercise. SAFETY ASPECTS: Do not swing the torso back and forth. This brings momentum into the exercise and takes the resistance off of the abdominals, increasing the risk for low back injury. Avoid excessive shoulder protraction and elevation during movement.

Incline Kneeling Torso Rotation—Abdominals, Obliques Psoas Major

STARTING POSITION: Stand to the side of the rails and grasp the handle on the same side of the exercise device 100. Pull the glideboard 330 halfway up the rails. Place hands, knuckles down, on the glideboard 330 to stabilize movement. Kneel on the top portion of the glideboard 330 facing sideways. Use caution when kneeling on exercise device 100. Grasp the handle with both hands, arms extended directly in front of the chest. Slightly bend elbows and rotate the torso toward the pulleys. EXERCISE DESCRIPTION: Using a twisting motion from the waist, bring the handle across the front of the chest in an upward motion until the torso is rotated to the opposite side with hands at eye level. Slowly lower the glideboard 330 down the rails by bringing the handle back down and across the body to the original starting position. PULLEY PIN PLACEMENT: Adjust to ensure correct force angle. Recommended—3. TEACHING TIPS: Beginners should widen the base of support by increasing the space between the knees. Concentrate on using the oblique and abdominal muscles to rotate, rather than using the arms. If the exercise is too difficult, bring the elbows in toward the rib cage during entire movement pattern. To increase resistance, grasp both handles. Maintain an upright posture throughout the movement. Keep head in line with the shoulders by watching hands during the exercise. SAFETY ASPECTS: Do not swing the torso back and forth. This brings momentum into the exercise and takes the resistance off of the abdominals, increasing the risk for low back injury. Avoid excessive shoulder protraction and elevation during movement.

Decline Kneeling Torso Rotation—Abdominals, Obliques, Psoas Major

STARTING POSITION: Stand to the side of the rails and grasp the handle on the same side of the exercise device 100. Pull the glideboard 330 halfway up the rails. Place hands, knuckles down, on the glideboard 330 to stabilize movement. Kneel on the top portion of the glideboard 330 facing sideways. Use caution when kneeling on exercise device 100. Grasp the handle with both hands, arms extended directly in front of the chest. Slightly bend elbows and rotate the torso toward the pulleys. EXERCISE DESCRIPTION: Using a twisting motion from the waist, bring the handle across the front of the chest in a downward motion until the torso is rotated to the opposite side with hands at abdominal level. Slowly lower the glideboard 330 down the rails by bringing the handle back up and across the body to the original starting position and repeat. PULLEY PIN PLACEMENT: Adjust to ensure correct force angle. Recommended—3. TEACHING TIPS: Beginners should widen the base of support by increasing the space between the knees. Concentrate on using the oblique and abdominal muscles to rotate, rather than using the arms. If the exercise is too difficult, bring the elbows in toward the rib cage during entire movement pattern. To increase resistance, grasp both handles. Maintain an upright posture throughout the movement. Keep head in line with the shoulders by watching hands during the exercise. SAFETY ASPECTS: Do not swing the torso back and forth. This brings momentum into the exercise and takes the resistance off of the abdominals, increasing the risk for low back injury. Avoid excessive shoulder protraction and elevation during movement.

Overhead Press—Deltoids Triceps Pectoralis Major

STARTING POSITION: Disconnect the pulley from the glideboard 330. Remove the telescoping squat stand. Install the Press Bar on the bottom of the rails. Kneel near the center of the glideboard 330 facing away from the tower. Place both hands on the Press Bar. Lower body down by extending hips until torso is fully supported by the glideboard 330. Bend elbows until chin is over the Press Bar. EXERCISE DESCRIPTION: Press the glideboard 330 up the rails until arms are fully extended overhead. Slowly lower the glideboard 330 back to the starting position and repeat. PULLEY PIN PLACEMENT: None. TEACHING TIPS: Keep upper torso on the glideboard 330 during the entire exercise. Maintain neutral spine throughout movement. SAFETY ASPECTS: Do not allow the glideboard 330 to "bottom out" during lower half of the movement. Do not raise your chest off the glideboard 330 at any time. Avoid excessive shoulder protraction and elevation during the movement. Do not bounce at the bottom range of the exercise. Move the arms in a slow and controlled motion. ACCESSORIES: Press Bar. VARIATIONS: Unilateral—Perform the exercise with one hand on the Press Bar and the other on the hip.

Horizontal Shoulder Abduction—Deltoids, Trapezius, Rhomboids, Teres Minor, Infraspinatus STARTING POSITION: Stand to the side of the exercise device 100 with back facing the rails. With the hand closest to the bottom of the rails, grasp the handle on the opposite side and pull the glideboard 330 halfway up the rails. Sit toward the top edge of the glideboard 330 facing sideways with both legs extended straight out. Feet should not touch the ground. Extend active arm toward the pulley at shoulder level. EXERCISE DESCRIPTION: Pull the glideboard 330 up the rails by bringing the active arm straight across the torso until fully extended away from the tower. Lower the glideboard 330 back down the rails by bringing the handle back across the torso to the original starting position. PULLEY PIN PLACEMENT: Adjust to ensure correct force angle. Recommended—2, 3. TEACHING TIPS: Place inactive hand on hip or on the side of the glideboard 330 to stabilize. Keep a slight bend in the elbow during exercise. Use the abdominal muscles to keep back straight and body stable on the glideboard 330. Focus on contracting the shoulder stabilizers throughout the exercise. Maintain neutral wrist. SAFETY ASPECTS: Do not bend elbow or wrist joint to facilitate the movement. Avoid excessive shoulder protraction and elevation during exercise. VARIATIONS: Alter angle of pull with incline or decline shoulder abduction.

Lateral Shoulder Raise Deltoids

STARTING POSITION: Grasp handles and pull the glideboard 330 halfway up the rails. Straddle the glideboard 330 and sit at the top edge. Lie back, ensuring head is fully supported. Place both feet on the top edge of the glideboard 330 with arms parallel to the glideboard 330, palms facing thighs. EXERCISE DESCRIPTION: With a slight bend in the elbow, pull the glideboard 330 up the rails by bringing the arms away from the hips, up to shoulder height. Slowly lower the glideboard 330 down the rails by bringing the arms back down to the hips. PULLEY PIN PLACEMENT: Adjust to ensure correct force angle. Recommended—2, 5. TEACHING TIPS: Keep arms straight with a slight bend at the elbow throughout the entire movement. If discomfort is felt in the shoulders, stop just short of shoulder height or within a pain free range of motion. If the glideboard 330 contacts the top or bottom of the rails, adjust body position. Maintain neutral wrists. SAFETY ASPECTS: Do not raise the handles above shoulder level. Ensure head is fully supported by the glideboard 330. Avoid excessive shoulder depression and elevation during the movement. Discontinue exercise or prop the torso up if inverted position causes nausea, dizziness or lightheadedness. VARIATIONS: Vary the angle of work to challenge all parts of the deltoids. For taller users, raise knees over hips and sit at the top edge of the glideboard 330. This will allow for additional range of motion and support for the head.

Single Arm Shoulder Abduction—Deltoids

STARTING POSITION: Stand to the side of the exercise device 100 facing away from the rails. Grasp handle with hand closest to tower. Sit toward the top edge of the glideboard 330 facing sideways. Lie sideways on the glideboard 330 with knees bent, feet toward tower and elbow supported by the glideboard 330. Begin with the arm parallel to the body with hand next to hip, palm facing down. EXERCISE DESCRIPTION: With a slight bend in the elbow, pull the glideboard 330 up the rails by bringing the arm away from the hip, up to shoulder height. Slowly lower the glideboard 330 down the rails by bringing the arm back down to the hip. PULLEY PIN PLACEMENT: Adjust to ensure correct force angle. Recommended—2, 3. TEACHING TIPS: Keep arms straight with a slight bend at the elbow throughout the entire movement. If discomfort is felt in the shoulders, stop just short of shoulder height or within a pain free range of motion. If the glideboard 330 contacts the top or bottom of the rails, adjust body position. Maintain neutral wrists. Support the cervical spine with the resting arm. SAFETY ASPECTS: Do not perform this movement too quickly. Raising and lowering the handle in a controlled manner will help reduce the risk of injury. Do not raise the handle above shoulder level. Avoid excessive shoulder depression and elevation during the movement. Avoid lateral flexion of the cervical spine. Keep the head in line with spine throughout the exercise. VARIATIONS: Vary the angle of work to challenge all parts of the deltoids.

Cross Cable Upright Row—Deltoids, Trapezius, Biceps, Brachialis, Brachioradialis, Infraspinatus STARTING POSITION: Grasp handles and pull the glideboard 330 halfway up the rails. Straddle the rails and sit toward the top edge of the glideboard 330, facing the tower. Switch handles so cables cross over in front of the torso. Extend arms in front with hands overlapping, palms facing down. EXERCISE DESCRIPTION: From an upright, seated position, pull the handles toward the shoulders, leading with the elbows. Lower the glideboard 330 back down the rails by lowering hands back to the starting position. PULLEY PIN PLACEMENT: Adjust to ensure correct force angle. Recommended—2, 4. TEACHING TIPS: Concentrate on leading with the elbows while pulling the handles up to the shoulders. Maintain upright posture (neutral spine). Maintain neutral wrists. Pause momentarily with elbows back. SAFETY ASPECTS: Avoid upper body movement in the sagittal plane. Avoid excessive shoulder protraction and retraction during the movement. Do not bounce at the bottom range of the exercise. Move the arms in a slow and controlled motion. VARIATIONS: Static Equilibrium—From the starting position, bring the glideboard 330 up the rails by pulling one handle toward the shoulder leading with the elbow. Without moving the glideboard 330, move both arms in opposite directions simultaneously. Unilateral with Torso Rotation—From the starting position, pull one handle toward the shoulder leading with the elbow. Rotate torso throughout movement. Lower the glideboard 330 back down the rails by lowering hand back to the starting position. Repeat with alternate arm.

Kneeling Upright Row—Deltoids, Trapezius, Biceps, Brachialis, Brachioradialis, Infraspinatus STARTING POSITION: Grasp handles and pull the glideboard 330 halfway up the rails. Place hands, knuckles down, on the glideboard 330 to stabilize movement. Kneel at the top edge of the glideboard 330 facing the tower. Extend arms toward pulleys with palms facing down. EXERCISE DESCRIPTION: From a kneeling position, pull the handles up toward the shoulders leading with the elbows. Lower the glideboard 330 back down the rails by lowering hands back to the starting position. PULLEY PIN PLACEMENT: Adjust to ensure correct force angle. Recommended—1, 2. TEACHING TIPS: Concentrate on leading with the elbows while pulling the handles up to the shoulders. Maintain upright posture (neutral spine). Maintain neutral wrists. Pause momentarily with elbows back. SAFETY ASPECTS: Avoid upper body movement in the sagittal plane. Avoid excessive shoulder protraction and elevation during the movement. Do not bounce at the bottom range of the exercise. Move the arms in a slow and controlled motion. VARIATIONS: Static Equilibrium—From the starting position, bring the glideboard 330 up the rails by pulling one handle toward the shoulder leading with the elbow. Without moving the glideboard 330, move both arms in opposite directions simultaneously. Stabilize the torso during the exercise. Unilateral—From the starting position, pull one handle toward the shoulder, leading with the elbow. Lower the glideboard 330 back down the rails by lowering hand back to the starting position. Repeat with alternate arm. Stabilize the torso during the exercise.

Seated External Shoulder Rotation—Teres Minor, Supraspinatus, Infraspinatus, Deltoids, Biceps, Brachialis, Trapezius STARTING POSITION: Grasp handles and pull the glideboard 330 halfway up the rails. Straddle the rails and sit on the top edge of the glideboard 330, facing the tower. Extend arms directly toward the pulleys with palms facing down. Lift feet off the floor. EXERCISE DESCRIPTION: With upright posture, flex elbows and externally rotate the shoulders back to bring the handles above the shoulders in an arc motion. Lower the glideboard 330 down the rails by rotating shoulders forward until the handles are back to starting position. PULLEY PIN PLACEMENT: Adjust to ensure correct force angle. Recommended—2, 3. TEACHING TIPS: Maintain upright posture (neutral spine). Concentrate on leading with the forearms while pulling the handles above the shoulders. Maintain neutral wrists. Keep elbows at shoulder level during entire movement. SAFETY ASPECTS: Avoid upper body movement in the sagittal plane. Do not allow elbows to sway during exercise. Do not exceed pain free range of motion. Avoid excessive shoulder elevation and protraction during the exercise. Avoid excessive torque at the shoulder during movement. VARIATIONS: Static Equilibrium—From the starting position, bring the glideboard 330 up the rails by pulling one handle only. Without moving the glideboard 330, move both arms in opposite directions simultaneously. Unilateral—From the starting position, bring the glideboard 330 up the rails by pulling one handle only. Lower the glideboard 330 back down the rails by lowering hand back to the starting position. Repeat with alternate arm. Kneeling—Perform the same exercise in a low kneeling position.

Standing External Shoulder Rotation—Teres Minor, Infraspinatus, Deltoids

STARTING POSITION: Stand to one side of the rails facing the glideboard 330. Grasp the closest handle with the arm that is toward the bottom of the rails. Step toward the bottom rails until tension is felt in the cable. Bend elbow to 90° and keep upper arm in tight to the torso with the hand across the abdomen. EXERCISE DESCRIPTION: Slowly raise the glideboard 330 up the rails by externally rotating the arm outward until a mild stretch is felt in the shoulder. Lower the glideboard 330 back down the rails by rotating the shoulder inward in an arc motion until hand touches the abdominals. PULLEY PIN PLACEMENT: Adjust to ensure correct force angle. Recommended—2, 3. TEACHING TIPS: Keep elbow in contact with the torso throughout the movement. Stand in a position that produces tension throughout the full range of motion. Maintain a slow tempo during the movement. Maintain upright posture (neutral spine). Maintain neutral wrist. Place rolled towel between elbow and torso for feedback to ensure elbow stability. SAFETY ASPECTS: The glideboard 330 should not rest at the bottom during the end of the movement. Do not exceed pain free range of motion. Do not lock knees while standing.

Seated Internal Shoulder Rotation—Pectoralis Major, Latissimus Dorsi, Subscapularis, Deltoids, Teres Major STARTING POSITION: Stand to the side of exercise device 100 with back facing the rails. Grasp the closest handle with the arm facing the tower. Pull the glideboard 330 halfway up, sitting toward the top edge of the glideboard 330 facing sideways with both legs extended straight out. Feet should not touch the ground. EXERCISE DESCRIPTION: Bend the elbow to 90°, keeping the upper arm in tight to the torso. Slowly lower the glideboard 330 down the rails by externally rotating the shoulder until a mild stretch is felt in the shoulder. Pull the glideboard 330 back up the rails by internally rotating the shoulder inward in an arc motion until the hand touches the abdominals. PULLEY PIN PLACEMENT: Adjust to ensure correct force angle. Recommended—1, 2, 3. TEACHING TIPS: Contract the abdominal muscles to keep back straight and body stable on the glideboard 330. Place inactive hand on hip or on the side of the glideboard 330 to stabilize. Keep elbow in contact with the torso throughout the movement. Maintain a slow tempo during the movement. Maintain neutral wrist. Maintain upright posture (neutral spine). Place rolled towel between elbow and torso for feedback to ensure elbow stability. SAFETY ASPECTS: Do not allow elbow to sway during exercise. Do not exceed pain free range of motion.

Seated Shoulder Extension—Deltoids (Posterior), Latissimus Dorsi, Teres Major, Pectoralis Major, Triceps (Long Head STARTING POSITION: Grasp handles and pull the glideboard 330 halfway up the rails. Straddle the rails and sit on the top edge of the glideboard 330 facing the tower. Extend arms directly toward the pulleys with palms facing down. Lift feet off the floor. EXERCISE DESCRIPTION: With upright posture, press the handles back and down past the hips in an arc motion. Lower the glideboard 330 down the rails and return to the starting position. PULLEY PIN PLACEMENT: Adjust to ensure correct force angle. Recommended—2, 3. TEACHING TIPS: Keep arms extended throughout the entire movement, with only a slight bend at the elbows. Contract abdominal muscles during entire movement to stabilize and maintain neutral spine. Maintain neutral wrists. SAFETY ASPECTS: Avoid upper body movement in the sagittal plane. Do not exceed pain free range of motion. Avoid excessive shoulder protraction and retraction during exercise. VARIATIONS: Static Equilibrium—From the starting position, bring the glideboard 330 up the rails by pulling one handle only. Without moving the glideboard 330, move both arms in opposite directions simultaneously. Unilateral—From the starting position, bring the glideboard 330 up the rails by pulling one handle only. Lower the glideboard 330 back down the rails by lowering hand back to the starting position. Repeat with alternate arm.

Kneeling Shoulder Extensions—Deltoids (Posterior), Latissimus Dorsi, Teres Major, Pectoralis Major, Triceps (Long Head)

STARTING POSITION: Grasp handles and pull the glideboard 330 halfway up the rails. Place hands, knuckles down, on the glideboard 330 to stabilize movement. Kneel at the top edge of the glideboard 330 facing the tower. Extend arms toward pulleys with palms facing down. EXERCISE DESCRIPTION: With upright posture, press the handles back and down past the hips in an arc motion. Lower the glideboard 330 down the rails and return to the starting position. PULLEY PIN PLACEMENT: Adjust to ensure correct force angle. Recommended—2, 3. TEACHING TIPS: Keep arms extended throughout the entire movement, with only a slight bend at the elbows. Contract abdominal muscles during entire movement to stabilize and maintain neutral spine. Maintain neutral wrists. Maintain upright posture (neutral spine). SAFETY ASPECTS: Avoid upper body movement in the sagittal plane. Do not exceed pain free range of motion. Avoid excessive shoulder protraction and retraction during exercise. VARIATIONS: Static Equilibrium—From the starting position, bring the glideboard 330 up the rails by pulling one handle only. Without moving the glideboard 330, move both arms in opposite directions simultaneously. Unilateral—From the starting position, bring the glideboard 330 up the rails by pulling one handle only. Lower the glideboard 330 back down the rails by lowering hand back to the starting position. Repeat with alternate arm.

Seated Shoulder Flexion—Deltoids, Pectoralis Major

STARTING POSITION: Grasp handles and pull the glideboard 330 halfway up the rails. Straddle the rails and sit toward the top edge of the glideboard 330, facing away from the tower. Place legs in a comfortable position. Position arms straight down to the side of the hips, palms facing back. EXERCISE DESCRIPTION: Slowly raise the handles forward and up to shoulder height without bending the elbows. Lower the glideboard 330 back down the rails by bringing the handles back to the starting position. PULLEY PIN PLACEMENT: Adjust to ensure correct force angle. Recommended—1, 6. TEACHING TIPS: Keep arms straight with a slight bend at the elbow throughout the entire movement. If discomfort is felt in the shoulders, stop just short of shoulder height or within a pain free range of motion. If the glideboard 330 contacts the top or bottom of the rails, adjust body position. Maintain neutral wrists. Maintain upright posture (neutral spine). SAFETY ASPECTS: Do not over-accelerate during the initial phase of the exercise. Avoid torso movement in the sagittal plane. Avoid excessive shoulder protraction and elevation during the exercise. VARIATIONS: Static Equilibrium—From the starting position, bring the glideboard 330 up the rails by pulling one handle only. Without moving the glideboard 330, move both arms in opposite directions simultaneously. Unilateral—From the starting position, bring the glideboard 330 up the rails by pulling one handle only. Lower the glideboard 330 back down the rails by lowering hand back to the starting position. Repeat with alternate arm.

Seated Cross Body Shoulder Extension—Deltoids, Trapezius, Rhomboids, Teres Minor, Infraspinatus, Supraspinatus STARTING POSITION: Grasp the right handle with the left hand. Straddle the rails and sit toward the top edge of the glideboard 330, facing the tower. Extend arm directly toward the pulley with palms facing down. Lift feet off the floor. EXERCISE DESCRIPTION: Pull the glideboard 330 up the rails by bringing the handle up and across the front of the torso in an arc motion until the handle is overhead and outside the shoulder. Lower the glideboard 330 back down the rails by returning arm back to the starting position. PULLEY PIN PLACEMENT: Adjust to ensure correct force angle. Recommended—1, 2. TEACHING TIPS: Maintain upright posture (neutral spine). Concentrate on leading with the forearms while pulling the handles above the shoulders. Maintain neutral wrists. Contract the abdominal muscles to keep back straight and body stable on the glideboard 330. Keep elbow slightly bent during exercise. Place inactive hand on hip or on the side of the glideboard 330 to stabilize. SAFETY ASPECTS: Do not swing arm back and forth or bend wrist during exercise. Do not over-accelerate during the initial phase of the exercise. Avoid excessive shoulder protraction and elevation during the exercise. VARIATIONS: Slight torso rotation throughout movement.

Supine Cross Body Shoulder Extension—Deltoids, Trapezius, Teres Minor, Infraspinatus, Supraspinatus STARTING POSITION: Grasp left handle with right arm and pull the glideboard 330 halfway up the rails. Straddle the rails and sit toward the top edge of the glideboard 330, facing the tower. Lie back on the glideboard 330, ensuring head is fully supported. Place both feet on the top edge of the glideboard 330. Extend active arm diagonally across the body so hand is resting above the opposite hip. EXERCISE DESCRIPTION: Pull the glideboard 330 up the rails by bringing the handle up and across the front of the torso in an arc motion until the handle is overhead and outside the shoulder. Lower the glideboard 330 back down the rails by returning arm back to the starting position. Repeat. PULLEY PIN PLACEMENT: Adjust to ensure correct force angle. Recommended—1, 2. TEACHING TIPS: Concentrate on leading with the forearms while pulling the handles above the shoulders. Maintain neutral wrists. Keep elbow slightly bent during exercise. Fully extend arm across the body and pause briefly at the top of the motion. Keep elbow slightly bent during exercise. Place inactive arm on hip or side of glideboard 330. SAFETY ASPECTS: Do not swing arm back and forth or bend wrist during exercise. Do not over-accelerate during the initial phase of the exercise. Avoid excessive shoulder protraction and elevation during the exercise.

Kneeling Cross Body Shoulder Raise with Trunk Extension—Erector Spinae, Deltoids, Supraspinatus, Trapezius, Rhomboids, Infraspinatus STARTING POSITION: Grasp left handle with right arm and pull the glideboard 330 halfway up the rails. Place hands, knuckles down, on the glideboard 330 to stabilize movement. Kneel near the center of the glideboard 330 facing the tower. Lower trunk over the knees and fully extend the active arm diagonally toward the pulley. EXERCISE DESCRIPTION: Pull the glideboard 330 up the rails by simultaneously extending the trunk and bringing the handle up and across the front of the body in an arcing motion until the handle is overhead and outside the shoulder. Lower the glideboard 330 back down the rails by bringing the arm back to the starting position and allowing trunk to stretch over the knees. PULLEY PIN PLACEMENT: Adjust to ensure correct force angle. Recommended—1, 2, 6. TEACHING TIPS: Keep arm extended throughout the entire motion, with only a slight bend at the elbow. Concentrate on leading with the forearms while pulling the handles above the shoulders. Place inactive hand on hip. Stretch forward during the beginning phase of the exercise. Maintain neutral wrists. SAFETY ASPECTS: Do not swing the arm back and forth during exercise. Do not over-accelerate during initial phase of the exercise. Avoid hyper-extending the cervical spine. Keep the head in line with spine throughout the exercise. Avoid excessive shoulder protraction and elevation during the exercise. VARIATIONS: Angle Variations—decrease or increase angle of pull.

Inverted Shoulder Shrug—Trapezius, Levator Scapulae, Rhomboids

STARTING POSITION: Grasp handles and pull the glideboard 330 halfway up the rails. Straddle the glideboard 330 and sit at the top edge. Lie back on the glideboard 330, ensuring head is fully supported. Place both feet on the top edge of the glideboard 330 with arms parallel to the torso, palms facing thighs. EXERCISE DESCRIPTION: Maintaining straight arms, pull the glideboard 330 up the rails by elevating the shoulders toward the ears. Slowly lower the glideboard 330 back down the rails by lowering the shoulders to the starting position. PULLEY PIN PLACEMENT: Adjust to ensure correct force angle. Recommended—1. TEACHING TIPS: Elevate shoulders in line with the glideboard 330. Ensure equal loading of muscle with a slow tempo. Maintain neutral wrists. SAFETY ASPECTS: Do not bend the elbows or raise head off the glideboard 330 during the movement. ACCESSORIES: Dip Bars (optional). VARIATIONS: Perform exercise with the Dip Bars.

Squat—Quadriceps, Gluteal Group, Hamstrings

STARTING POSITION: Disconnect the pulley from the glideboard 330. Push the glideboard 330 halfway up the rails, straddle the glideboard 330 and sit at the bottom edge. Lie back, ensuring head is fully supported. Place both feet on the squat stand shoulderwidth apart. Lower the glideboard 330 by bending both knees to 90°. EXERCISE DESCRIPTION: Push the glideboard 330 up the rails by pressing against the squat stand until legs are fully extended. Lower the glideboard 330 back down the rails by squatting with both legs to the starting position. PULLEY PIN PLACEMENT: None. TEACHING TIPS: Maintain a slow tempo during this exercise and pause briefly at the bottom of the movement. Body weight should be evenly distributed across the feet. Rest hands on the sides of the glideboard 330 or cross arms over torso. Ensure the knees track over the feet throughout the movement. SAFETY ASPECTS: Do not allow knee angle to exceed 90°at the bottom of the movement. Ensure the patella does not move anterior to the toes throughout the movement. Do not lock the knees at the top of the movement. Keep hands above the glideboard 330 at all times. Do not raise head during exercise. ACCESSORIES: Telescoping squat stand, Weight Bar (optional), Squat Handle Bar (optional). VARIATIONS: Add external weights to Weight Bar.

Unilateral Squat—Quadriceps, Gluteal Group, Hamstrings

STARTING POSITION: Disconnect the pulley from the glideboard 330. Push the glideboard 330 halfway up the rails, straddle the glideboard 330 and sit at the bottom edge. Lie back, ensuring head is fully supported. Place one foot near the center of the squat stand and the other on the lower edge of the glideboard 330. Lower the glideboard 330 by bending active knee to 90°. EXERCISE DESCRIPTION: Push the glideboard 330 up the rails by pressing against the squat stand until leg is fully extended. Lower the glideboard 330 back down the rails by squatting with one leg to the starting position. PULLEY PIN PLACEMENT: None. TEACHING TIPS: Maintain a slow tempo during this exercise and pause briefly at the bottom of the movement. Body weight should be evenly distributed across the feet. Rest hands on the sides the glideboard 330 or cross arms over torso. Ensure knees track over the foot throughout the movement. SAFETY ASPECTS: Do not allow knee angle to exceed 90° at the bottom of the movement. Ensure the patella does not move anterior to the toes throughout the movement. Do not lock knees at the top of the movement. Keep hands above glideboard 330 at all times. Do not raise head during exercise. ACCESSORIES: Telescoping squat stand, Weight Bar (optional), Squat Handle Bar (optional). VARIATIONS: Extend inactive leg straight out over the Telescoping squat stand during exercise. Add external weights to Weight Bar.

Toes Out Squat—Quadriceps, Hip Adductors, Gluteal Group, Hamstrings

STARTING POSITION: Disconnect the pulley from the glideboard 330. Push the glideboard 330 halfway up the rails, straddle the glideboard 330 and sit at the bottom edge. Lie back, ensuring head is fully supported. Place feet flat on the squat stand, shoulderwidth apart, with toes pointing outward 45°. Lower the glideboard 330 by bending both knees to 90°. EXERCISE DESCRIPTION: Push the glideboard 330 up the rails by pressing against the squat stand until legs are fully extended. Lower the glideboard 330 back down the rails by squatting with both legs to the starting position. PULLEY PIN PLACEMENT: None. TEACHING TIPS: Maintain a slow tempo during this exercise pausing briefly at the bottom of the movement. Body weight should be evenly distributed across the feet. Rest hands on the sides of the glideboard 330 or cross arms over torso. Ensure the knees track over the feet throughout the movement. SAFETY ASPECTS: Do not allow knee angle to exceed 90° at the bottom of the movement. Ensure the patella does not move anterior to the toes throughout the movement. Do not lock the knees at the top of the movement. ACCESSORIES: Telescoping squat stand, Weight Bar (optional), Squat Handle Bar (optional). VARIATIONS: Add external weights to Weight Bar.

Single Leg Lateral Squat—Quadriceps, Gluteal Group, Hamstrings

STARTING POSITION: Disconnect the pulley from the glideboard 330. Push the glideboard 330 halfway up the rails and lie sideways with buttocks toward the bottom edge. Place the top foot on the squat stand. Bend bottom leg to 90° so it rests on the glideboard 330. Lower the glideboard 330 by bending active knee to 90°. EXERCISE DESCRIPTION: Push the glideboard 330 up the rails by pressing against the squat stand with the active leg. Lower the glideboard 330 back down the rails to the starting position. PULLEY PIN PLACEMENT: None. TEACHING TIPS: Stationary leg should remain bent throughout the movement. Maintain a slow tempo during this exercise, pausing briefly at the bottom of the movement. Body weight should be evenly distributed across the foot. Maintain neutral spine by resting head on upper arm. Adjust foot placement of active leg to avoid unnecessary torque on the knee. SAFETY ASPECTS: Do not allow knee angle to exceed 90° at the bottom of the movement. Do not lock knee at the top of the movement. Ensure the patella does not move anterior to the toes throughout the movement. ACCESSORIES: Telescoping squat stand Bridge Squat—Quadriceps, Hip Adductors, Gluteal Group, Hamstrings STARTING POSITION: Disconnect the pulley from the glideboard 330. Push the glideboard 330 halfway up the rails, straddle the glideboard 330 and sit at the bottom edge. Lie back, ensuring head is fully supported. Place feet shoulder width apart with toes pointed outward on the top edge of the squat stand. With hands resting near sides, lift hips and buttocks above the glideboard 330 until parallel with torso. EXERCISE DESCRIPTION: Keeping the hips and buttocks elevated, lower the glideboard 330 down the rails by squatting with the legs until the knees bend to 90°. Press feet against the squat stand to return to the starting position. PULLEY PIN PLACEMENT: None. TEACHING TIPS: Contract abdominal and gluteal muscles throughout the entire movement to keep hips above the glideboard 330. Maintain a slow tempo during this exercise, pausing briefly at the bottom of the movement. Keep shoulder blades in contact with glideboard 330 at all times to avoid unnecessary pressure on the cervical spine. SAFETY ASPECTS: Do not allow knee angle to exceed 90° at the bottom of the movement. Ensure the patella does not move anterior to the toes throughout the movement. Keep hands above the glideboard 330 at all times. Do not raise head during exercise. Do not lock the knees at the top of the movement. ACCESSORIES: Telescoping squat stand.

Skiing—Gluteal Group, Quadriceps, Hamstrings

STARTING POSITION: Disconnect the pulley from the glideboard 330. Push the glideboard 330 halfway up the rails, straddle the glideboard 330 and sit at the bottom edge. Lie back, ensuring head is fully supported. Place heels together on the squat stand with both feet facing 45° to one side. Lower the glideboard 330 with hips and knees rotated toward toes by bending knees to 90°. EXERCISE DESCRIPTION: Push the glideboard 330 up the rails by pressing against the squat stand until legs are fully extended. At the top of the movement, pivot both feet and hips so knees and toes are facing 45° in the opposite direction. Repeat movement by alternating back and forth as if skiing. PULLEY PIN PLACEMENT: None. TEACHING TIPS: Pivot weight on heels when rotating hips. Keep knees together throughout exercise. Ensure the knees track over the feet throughout the movement. SAFETY ASPECTS: Do not allow knees to exceed 90° at the bottom of the movement. Ensure the patella does not move anterior to the toes throughout the movement. Keep hands above the glideboard 330 at all times. Do not raise head during exercise. ACCESSORIES: Telescoping squat stand, Weight Bar (optional), Squat Handle Bar (optional). VARIATIONS: Add external weights to Weight Bar.

Plyometric Squat—Quadriceps, Gluteal Group, Hamstrings, Gastrocnemius, Soleus

STARTING POSITION: Disconnect the pulley from the glideboard 330. Push the glideboard 330 halfway up the rails, straddle the glideboard 330 and sit at the bottom edge. Lie back, ensuring head is fully supported. Place both feet on the squat stand shoulderwidth apart. Lower the glideboard 330 down the rails by bending knees to 90°. EXERCISE DESCRIPTION: Push forcefully against the squat stand, sliding up the rails in a jumping manner. Land softly and explode back up the rails. PULLEY PIN PLACEMENT: None. TEACHING TIPS: Use caution during this exercise. Land softly as the feet hit the squat stand, and immediately push forcefully with legs to facilitate an explosive, bouncing motion. Beginners should start this exercise at a low incline. Rest hands on the sides of the glideboard 330 or cross arms over torso. Ensure the knees track over the feet throughout the movement. SAFETY ASPECTS: Do not allow the glideboard 330 to hit the tower at the top of the movement. Push only hard enough so the feet leave the squat stand. Do not allow knees to exceed 90°. Rest hands on the sides of glideboard 330 or cross arms over torso. Do not reach underneath the glideboard 330. ACCESSORIES: Telescoping squat stand, Squat Handle Bar (optional).

Plyometric Skiing—Quadriceps, Gluteal Group, Hamstrings, Gastrocnemius, Soleus, Abdominals (Obliques)

STARTING POSITION: Disconnect the pulley from the glideboard 330. Push the glideboard 330 halfway up the rails, straddle the glideboard 330 and sit at the bottom edge. Lie back, ensuring head is fully supported. Place heels together on the squat stand with both feet facing 45° to one side. Lower the glideboard 330 with hips and knees rotated toward toes by bending knees to 90°. EXERCISE DESCRIPTION: Push forcefully against the squat stand, sliding up the rails in a jumping manner. Pivot both feet and hips so knees and toes are facing 45° in the opposite direction before landing. Land softly and explode back up the rails. Alternate back and forth as if skiing. PULLEY PIN PLACEMENT: None. TEACHING TIPS: Establish a rhythm with smooth movement while still maintaining complete control of the glideboard 330. Use caution during exercise. Land softly as the feet hit the squat stand, and immediately push forcefully with legs to facilitate an explosive, bouncing motion. Beginners should start this exercise at a low incline. Ensure the knees track over the feet throughout the movement. SAFETY ASPECTS: Do not allow the glideboard 330 to hit the tower at the top of the movement. Push only hard enough so the feet leave the squat stand. Do not allow knees to exceed 90°. Rest hands on the sides of the glideboard 330 or cross arms over torso. Do not reach underneath the glideboard 330. ACCESSORIES: Telescoping squat stand Squat Handle Bar (optional)

Plyometric Split Squat—Quadriceps, Gluteal Group, Hamstrings, Gastrocnemius, Soleus STARTING POSITION: Disconnect the pulley from the glideboard 330. Push the glideboard 330 halfway up the rails, straddle the glideboard 330 and sit at the bottom edge. Lie back, ensuring head is fully supported. Place one foot near the center of the squat stand and the other extended over the squat stand. Lower the glideboard 330 by bending active knee to 90°. EXERCISE DESCRIPTION: Push forcefully against the squat stand, sliding up the rails in a jumping manner. Land softly on the opposite leg and explode back up the rails. Repeat with alternate legs throughout the set. PULLEY PIN PLACEMENT: None. TEACHING TIPS: Use caution during this exercise. Land softly as the feet hit the squat stand, and immediately push forcefully with legs to facilitate an explosive, bouncing motion. Beginners should start this exercise at a low incline. Ensure the knees track over the feet throughout the movement. Start exercise with light jumping to increase the user's confidence of alternating legs. SAFETY ASPECTS: Do not allow the glideboard 330 to hit the tower at the top of the movement. Push only hard enough so the feet leave the squat stand. Do not allow knee angle to exceed 90°. Rest hands on the sides of the glideboard 330 or cross arms over torso. Do not reach underneath the glideboard 330. ACCESSORIES: Telescoping squat stand, Squat Handle Bar (optional).

Plyometric Sprint Start—Quadriceps, Gluteal Group, Hamstrings, Gastrocnemius, Soleus STARTING POSITION: Disconnect the pulley from the glideboard 330 and remove the telescoping squat stand. With the glideboard 330 at bottom of rails, face the tower and kneel on one leg near bottom of board. Place the ball of the active foot on the outside of the lower base. Rest the upper body on the forearms near the top edge of the glideboard 330 and bend the active knee to 90°. EXERCISE DESCRIPTION: With one knee on the glideboard 330, push forcefully against the base, sliding up the rails in a jumping manner. Land softly on the cross bar and explode back up the rails. PULLEY PIN PLACEMENT: None. TEACHING TIPS: Use caution during this exercise. Keep the back in neutral alignment throughout the movement. Land softly and immediately push forcefully against the cross bar to facilitate an explosive, bouncing motion. Start exercise with light jumping to increase the user's confidence of landing on the cross bar. Ball of the active foot should land on the cross bar throughout the exercise. SAFETY ASPECTS: Do not allow lower back to sag during exercise. Avoid hyperextending the cervical spine. Keep the head in line with spine throughout the exercise. Do not allow the glideboard 330 to hit impact at the top of the movement. Push only hard enough so the feet leave the telescoping squat stand. Do not allow knee angle to exceed 90°. Do not reach underneath the glideboard 330. VARIATIONS: Place hands on outside of glideboard 330 with arms extended.

Heel Raise—Gastrocnemius

STARTING POSITION: Disconnect the pulley from the glideboard 330. Push the glideboard 330 halfway up the rails, straddle the glideboard 330 and sit at the bottom edge.

Lie back, ensuring head is fully supported. Place the balls of both feet shoulder-width apart on the bottom edge of the squat stand. Lower heels below the squat stand until a mild stretch is felt in the lower leg muscles. EXERCISE DESCRIPTION: Press the balls of the feet into the squat stand, raising heels as high as possible. Lower heels back down to the starting position. PULLEY PIN PLACEMENT: None. TEACHING TIPS: Maintain a slow tempo during this exercise and pause briefly at the top of the movement while contracting the calf muscles. Body weight should be evenly distributed across the balls of the feet. Rest hands on the sides of the glideboard 330 or cross arms over torso. Point toes inward to place emphasis on lateral head of the gastrocnemius. Point toes outward to place emphasis on medial head of the gastrocnemius. SAFETY ASPECTS: Do not bounce during exercise. Do not lock knees during exercise. Do not raise head during exercise. ACCESSORIES: Telescoping squat stand, Weight Bar (optional). VARIATIONS: Unilateral—From the starting position, lift one leg over the squat stand and perform the exercise with one leg at a time.

Bent Knee Heel Raise—Soleus

STARTING POSITION: Disconnect the pulley from the glideboard 330. Push the glideboard 330 halfway up the rails, straddle the glideboard 330 and sit at the bottom edge. Lie back, ensuring head is fully supported. Place the balls of both feet shoulder-width apart on the bottom edge of the squat stand with legs bent approximately 30° at the knee. Lower heels below the squat stand until a mild stretch is felt in the lower leg muscles. EXERCISE DESCRIPTION: While maintaining knee angle at 30°, press the balls of the feet into the squat stand, raising heels as high as possible. Lower heels back down to the starting position. PULLEY PIN PLACEMENT: None: TEACHING TIPS: Maintain a slow tempo during this exercise and pause briefly at the top of the movement while contracting the calf muscles. Body weight should be evenly distributed across the balls of the feet. Rest hands on the sides of the glideboard 330 or cross arms over torso. Point toes inward to place emphasis on the lateral head of the soleus. SAFETY ASPECTS: Do not bounce during exercise. Do not lock knees during exercise. Do not raise head during exercise. ACCESSORIES: Telescoping squat stand. Weight Bar (optional). VARIATIONS: Unilateral—From the starting position, lift one leg over the squat stand and perform the exercise with one leg at a time.

Hamstring Curl—Hamstrings, Gastrocnemius

STARTING POSITION: Disconnect the pulley from the glideboard 330 and raise the adjustable foot holder to the "up" position. Sit on the glideboard 330 facing the tower. Once body weight is fully supported by the glideboard 330, secure both feet into the adjustable foot holder. Lie back on the glideboard 330 with legs extended and head fully supported. Point toes toward the tower. EXERCISE DESCRIPTION: Using the heels, pull the glideboard 330 up the rails to at least a 90° angle at the knee. Slowly lower the glideboard 330 back down the rails. PULLEY PIN PLACEMENT: None. TEACHING TIPS: Maintain a neutral spine throughout the movement. Maintain a slow tempo during the movement. Lower the glideboard 330 in a controlled manner, keeping tension on the hamstring muscles. Ensure head is fully supported by the glideboard 330. Place pillow or towel behind head if neck is hyper-extended. Rest hands on the sides of the glideboard 330 or cross arms over torso. SAFETY ASPECTS: Do not let the glideboard 330 fall down the rails after the curl. Discontinue exercise or prop the torso up if inverted position causes nausea, dizziness or lightheadedness. ACCESSORIES: Adjustable Foot Holder. VARIATIONS: Unilateral—Bend the inactive leg, placing the foot near the top of the glideboard 330.

Incline Lunge—Quadriceps, Gluteal Group, Hamstrings

STARTING POSITION: Disconnect the pulley from the glideboard 330 and remove the telescoping squat stand. Stand behind the bottom of the rails facing the tower. Place the foot closest to the exercise device 100 squarely in the middle of the glideboard 330. EXERCISE DESCRIPTION: Push the glideboard 330 up the rails by lunging forward until the leg on the glideboard 330 forms a 90° angle at the knee. Push off the foot that is on the glideboard 330 while returning to the starting position. PULLEY PIN PLACEMENT: None. TEACHING TIPS: To increase the difficulty of this exercise, lower the incline of the rails. Place hands on hips during exercise. Maintain neutral spine during exercise. Maintain a slow tempo during the movement. Raise and lower the glideboard 330 in a controlled manner. When lunging forward, apply body weight to the leading leg. Allow the back knee to bend and the back heel to raise off the ground. SAFETY ASPECTS: Do not allow knee of active leg to extend beyond the toes throughout the exercise. Use caution during this exercise. Beginners may need a chair or spotting when first performing movement. VARIATIONS: Holding external weights in hands.

Lateral Lunge—Quadriceps, Gluteal Group, Hamstrings

STARTING POSITION: Disconnect the pulley from the glideboard 330 and remove the telescoping squat stand. Stand at the bottom end of the rails, facing sideways. Place the foot that is closest to the base on the bottom edge of the glideboard 330. EXERCISE DESCRIPTION: Push the glideboard 330 up the rails while performing a single leg squat with the stationary leg. Extend the resting leg out until a mild stretch is felt in the inner thigh. Bring the glideboard 330 back down the rails while coming up out of the squat with active leg. Repeat. PULLEY PIN PLACEMENT: None. TEACHING TIPS: To increase the difficulty of this exercise, lower the incline of the rails. Weight should shift directly down over the stationary leg. Pause briefly at the end of the movement to stretch the inner thigh area. Maintain neutral spine during exercise. Maintain a slow tempo during the movement. Raise and lower the glideboard 330 in a controlled manner. SAFETY ASPECTS: Do not bounce at the bottom of the exercise. Do not allow knee of active leg to extend beyond the toes throughout the exercise. Use caution during this exercise. Beginners may need a chair or spotting when first performing movement.

Reverse Lunge—Quadriceps, Gluteal Group, Hamstrings Starting Position:

STARTING POSITION: Disconnect the pulley from the glideboard 330 and remove the telescoping squat stand. Stand at the bottom end of the exercise device 100, facing away from the tower. Place the ball of one foot on the bottom edge of the glideboard 330 with the heel of the active leg near the bottom base. EXERCISE DESCRIPTION: Push the glideboard 330 up the rails while performing a single leg squat with the active leg. Push off the stationary foot to come out of the lunge while lowering the glideboard 330 back to the starting position. PULLEY PIN PLACEMENT: None. TEACHING TIPS: Extend arms in front of the chest during the squat to help maintain balance and alignment. Weight should shift directly down over the stationary leg. Maintain neutral spine throughout movement. Maintain a slow tempo during the movement. Raise and lower the glideboard 330 in a controlled manner. SAFETY ASPECTS: Do not bounce at the bottom of the lunge. Do not allow knee of active leg to extend beyond the toes throughout the exercise. Use caution during this exercise. Beginners may need a chair or spotting when first performing movement. VARIATIONS: Holding external weights in hands.

Hip Extension—Hamstrings, Gluteal Group

STARTING POSITION: Attach the Leg Pulley/Ankle Harness to the glideboard 330. Pull the glideboard 330 halfway up the rails. Straddle the glideboard 330 and sit at the bottom edge. Place inactive leg on the squat stand and press up; Attach the Ankle Harness to the active leg. Lie back, ensuring head is fully supported. Straighten the active leg and flex the hip until a mild stretch is felt in the hamstrings. Keep tension on the cable and bring the resting leg onto the bottom of the glideboard 330 EXERCISE DESCRIPTION: In an arc motion, extend the active hip by pressing heel down toward the glideboard 330. Slowly return to the starting position until a mild stretch is felt in the hamstring muscles. PULLEY PIN PLACEMENT: None. TEACHING TIPS: Maintain a straight leg with a slight bend at the knee throughout the entire movement. Keep hips on the glideboard 330 at all times. Practice controlled movement during each phase of the exercise. Taller users may require a cable extension to obtain full range of motion. SAFETY ASPECTS: Do not allow the glideboard 330 to drop from the top of the rails. The glideboard 330 should not hit the top or bottom of the frame. Adjust body positioning if range is compromised. ACCESSORIES: Leg Pulley/Ankle Cuff.

Prone Leg Extension—Quadriceps

STARTING POSITION: Attach the Leg Pulley/Ankle Harness to the glideboard 330. Secure the Ankle Harness around the active leg with the cable attached at the back of the heel. Push glideboard 330 halfway up rails and lie face down with head toward the tower. Rest hands on the top end of the glideboard 330. EXERCISE DESCRIPTION: With the upper legs lying flat on the glideboard 330, bend the knee of the active leg to form a 90° angle. Using the quadriceps muscles, extend the active leg until it is straight. The glideboard 330 should move up the rails slightly. Lower the glideboard 330 back down the rails by returning the leg back to a 90° angle. PULLEY PIN PLACEMENT: None. TEACHING TIPS: Keep both upper legs flat on the glideboard 330 during the entire movement. Practice controlled movement during each phase of the exercise. SAFETY ASPECTS: Do not allow knee angle to go beyond a 90° when lowering the glideboard 330 down the rails. Taller users may require a cable extension to obtain full range of motion. ACCESSORIES: Leg Pulley/Ankle Cuff.

Leg Thrust—Gluteal Group, Quadriceps, Hamstrings

STARTING POSITION: Attach the Leg Pulley/Ankle Harness to the glideboard 330. Pull the glideboard 330 halfway up the rails. Straddle the glideboard 330 and sit at the bottom edge. Place inactive leg on the squat stand and press up. Attach the Ankle Harness to the active leg. Lie back, ensuring head is fully supported. Bend the active hip and knee toward the tower, so knee is at a 90° angle. Keep tension on the cable while placing inactive foot onto the glideboard 330. EXERCISE DESCRIPTION: Pull the glideboard 330 up the rails by pushing the active leg down in a straight line with the rails until completely straight. Slowly return to the starting position until a mild stretch is felt in the hamstring muscles. PULLEY PIN PLACEMENT: None. TEACHING TIPS: Lead with the heel through the entire movement as if taking a giant step. Keep hips on the glideboard 330 at all times. Practice controlled movement during each phase of the exercise. SAFETY ASPECTS: Do not bounce at the bottom of the thrust. The glideboard 330 should not hit the top or bottom of the frame. Adjust body positioning if range is compromised. ACCESSORIES Leg Pulley/Ankle Cuff.

Hip Adduction—Hip Adductors: Adductor Magnus, Gracilias, Adductor Longus

STARTING POSITION: Attach the Leg Pulley/Ankle Harness to the glideboard 330. Pull the glideboard 330 halfway up the rails. Straddle the glideboard 330 and sit at the bottom edge. Place inactive leg on the squat stand and press up. Attach the Ankle Harness to the active leg. Keep tension on the cable while turning to lie on side with the active leg on top of the inactive leg. Bend the inactive leg underneath, so it rests on the glideboard 330. Rest head on the upper arm and straighten the active leg toward the squat stand. EXERCISE DESCRIPTION: In an arc motion, allow the active leg to abduct until a mild stretch is felt along the inner thigh. Slowly return back to the starting position. PULLEY PIN PLACEMENT: None. TEACHING TIPS: Maintain a straight leg with a slight bend at the knee throughout the entire movement. Practice controlled movement during each phase of the exercise. Taller users may require a cable extension to obtain frill range of motion. SAFETY ASPECTS: Do not allow the glideboard 330 to drop from the top of the rails. The glideboard 330 should not hit the top or bottom of the frame. Adjust body positioning if range is compromised. ACCESSORIES: Leg/Pulley Ankle Cuff. VARIATIONS: Externally rotate active hip throughout the movement.

Seated Hip Abduction—Gluteus Medius, Gluteus Maximus

STARTING POSITION: Grasp handles and pull the glideboard 330 halfway up the rails. Straddle the rails and sit on the top edge of the glideboard 330 facing the tower. Extend legs directly toward the tower with the cables resting gently against the outside of each foot. Keep the handles adjacent to the knees. EXERCISE DESCRIPTION: Pull the glideboard 330 up the rails by pressing feet outward against the inside of the cables, while keeping arms relaxed. Pause briefly. Lower the glideboard 330 back down the rails by slowly allowing feet to move back in toward the rails until returned to the starting position. PULLEY PIN PLACEMENT: Adjust to ensure correct force angle. Recommended—1, 6. TEACHING TIPS: Remain upright throughout the exercise. The movement should come directly from the outer thighs. Maintain a straight leg with a slight bend at the knee throughout the entire movement. Practice controlled movement during each phase of the exercise. SAFETY ASPECTS: Do not allow slack to build in the cables by pressing too hard during the beginning of the movement. Do not pull handles in toward the body. Arms should be fully extended toward knees throughout exercise.

Arm Pullover—Latissimus Dorsi, Pectoral Group, Serratus, Teres Major, Triceps (Long Head)

STARTING POSITION: Grasp handles and pull the glideboard 330 halfway up the rails. Straddle the glideboard 330 and sit at the bottom edge facing away from the tower. Lie back, ensuring head is fully supported. Place both feet on the bottom edge of the glideboard 330 extending arms overhead toward the pulleys. EXERCISE DESCRIPTION: In an arc motion, bring the handles over the chest until hands reach outer thighs. Slowly bring the handles back to the starting position. PULLEY PIN PLACEMENT: Adjust to ensure correct force angle. Recommended—2, 4. TEACHING TIPS: Keep arms extended throughout the entire motion, with only a slight bend at the elbows. If discomfort is felt in the shoulders, slightly bend elbows while overhead. If the glideboard 330 touches the bottom with arms extended overhead, adjust body position. SAFETY ASPECTS: Do not allow arms to do the work during this exercise. Movement should emanate from the back and shoulder muscles. Avoid arching the back during the movement. Contract abdominals throughout exercise to maintain neutral spine. Avoid excessive shoulder elevation during exercise. VARIATIONS: Static Equilibrium—From the starting position, bring the glideboard 330 up the rails by bringing one handle over the chest until hand reaches outer thigh. Without moving the glideboard 330, move both arms in opposite directions simultaneously. Unilateral—From the starting position, bring the glideboard 330 up the rails by bringing one handle over the chest until hand reaches outer thigh. Return with control to the starting position. Repeat with alternating arms.

Supine Shoulder Adduction (Iron Cross) Latissimus Dorsi, Triceps (Long Head), Serratus, Teres Major Start Variation (Elevated Legs)

STARTING POSITION: Grasp handles and pull the glideboard 330 halfway up the rails. Straddle the glideboard 330 and sit at the bottom edge facing away from the tower. Lie back, ensuring head is fully supported. Place both feet on the bottom edge of the glideboard 330. Slowly raise arms out to shoulder height, palms facing down. EXERCISE DESCRIPTION: Move the glideboard 330 up the rails by pulling the handles down to the side of the hips in an arching motion. Lower the glideboard 330 down the rails by abducting arms laterally to starting position. PULLEY PIN PLACEMENT: Adjust to ensure correct force angle. Recommended—1, 2, 3, 4. TEACHING TIPS: Keep arms extended throughout the range of motion, with a slight bend at the elbow. If the glideboard 330 touches the bottom during the movement, adjust body position. The movement is similar to a gymnast's "Iron Cross" exercise. Contract shoulder muscles throughout exercise. SAFETY ASPECTS: If discomfort is felt in the shoulders during the exercise, shorten the range of motion. Avoid arching the back during the movement. Contract abdominals throughout exercise to maintain neutral spine. Avoid excessive shoulder elevation during exercise. Do not allow arms to come up too quickly from the bottom of the movement. Return hands back to start position in a controlled manner. Do not allow arms to do the work during this exercise. Movement should emanate from the back and chest muscles. VARIATIONS: Elevate legs throughout movement.

Lat Pull Down—Latissimus Dorsi, Rhomboids, Biceps, Brachioradialis, Brachialis, Trapezius, Teres Major STARTING POSITION: Grasp handles and pull the glideboard 330 halfway up the rails. Straddle the glideboard 330 and sit at the bottom edge facing away from the tower. Lie back, ensuring head is fully supported. Place both feet on the bottom edge of the glideboard 330 extending arms overhead toward the pulleys, palms facing up. EXERCISE DESCRIPTION: Bring the glideboard 330 up the rails by pulling the elbows down to the sides of the torso until hands are directly outside the shoulders. Lower the glideboard 330 down the rails by extending arms overhead to the starting position. PULLEY PIN PLACEMENT: Adjust to ensure correct force angle. Recommended—2, 5. TEACHING TIPS: Lead with elbows while pulling the glideboard 330 up the rails. Concentrate on using the back muscles to facilitate the movement. If the glideboard 330 touches the bottom with arms extended overhead, adjust body position. SAFETY ASPECTS: Do not bend wrists during any portion of the exercise. Forearms should be parallel to the torso throughout movement. Avoid arching the back during the movement. Contract abdominals throughout exercise to maintain neutral spine. Avoid excessive shoulder elevation during exercise. VARIATIONS: Reverse Grip—Perform exercise with palms facing down, leading with elbows over head. Parallel Grip—Perform exercise with palms facing in, leading with elbows over head.

Lumbar Extension Erector—Spinae, Quadratus Lumborum, Trapezius (Lower)

STARTING POSITION: Grasp handles and pull the glideboard 330 halfway up the rails. Place hands, knuckles down, on the glideboard 330 to stabilize movement. Kneel at the top edge of the glideboard 330 facing the tower and sit back on heels. Lower the torso over the knees while holding the handles close to the chest. EXERCISE DESCRIPTION: Keeping the handles in toward the chest, pull the glideboard 330 up the rails by using the lower back musculature to extend the torso into an upright position. Slowly bring the glideboard 330 down the rails by lowering the torso down over the knees returning to the starting position. PULLEY PIN PLACEMENT: Adjust to ensure correct force angle. Recommended—1, 2. TEACHING TIPS: Keep lower back muscles contracted throughout the entire movement. Maintain neutral spine throughout exercise. Lead movement with head and shoulders, contracting the torso muscles to stabilize. SAFETY ASPECTS: Do not rock back and forth on the knees. Keep the movement slow and controlled, concentrating on the lower back. Avoid pulling glideboard 330 up rails with hip flexors and abdominal muscles.

Seated Row—Latissimus Dorsi, Trapezius, Teres Major, Deltoids, Rhomboids, Biceps, Brachioradialis STARTING POSITION: Grasp handles and pull the glideboard 330 halfway up the rails. Straddle the rails and sit toward the top edge of the glideboard 330, facing the tower. Extend arms directly toward the pulleys with palms facing down. Lift feet off the floor. EXERCISE DESCRIPTION: From an upright seated position, pull the glideboard 330 up the rails by pulling the handles back, rib high, until hands reach the sides of the torso. Lower the glideboard 330 back down the rails by extending arms back to the starting position. PULLEY PIN PLACEMENT: Adjust to ensure correct force angle. Recommended—2, 3. TEACHING TIPS: Lead the movement with the elbows. Squeeze the shoulder blades together when the elbows are back to contract the rhomboids and trapezium. Maintain an upright posture during the entire movement. Maintain neutral wrists. SAFETY ASPECTS: Avoid upper body movement in the sagittal plane. Avoid excessive shoulder elevation during exercise. Do not bounce at the bottom range of the exercise. Move the arms in a slow and controlled motion. VARIATIONS: Static Equilibrium—From the starting position, bring the glideboard 330 up the rails by pulling one handle back, rib high, until hand reaches the side of the torso. Without moving the glideboard 330, move both arms in opposite directions simultaneously. Unilateral—From the starting position, pull one handle back, rib high, until hand reaches the side of the torso. Lower the glideboard 330 back down to the starting position. Repeat with alternate arm. Parallel Grip≠Perform same movement with palms facing inward.

Seated Row with Lumbar Extension—Erector Spinae, Latissimus Dorsi, Deltoids, Teres Major, Rhomboids, Trapezius, Biceps, Brachioradialis STARTING POSITION: Grasp handles and pull the glideboard 330 halfway up the rails. Straddle the rails and sit toward the bottom edge of the glideboard 330 facing the tower with legs extended up the glideboard 330. Extend arms toward pulleys and lower torso over legs with palms facing down. EXERCISE DESCRIPTION: From the starting position, pull the glideboard 330 up the rails by simultaneously pulling the handles back and extending torso upright until hands reach the sides of the rib cage, palms in. Lower the glideboard 330 back down the rails by extending the arms forward and lowering the torso back to the starting position. PULLEY PIN PLACEMENT: Adjust to ensure correct force angle. Recommended—1, 2. TEACHING TIPS: Lead the movement with the elbows and shoulders. Squeeze the shoulder blades together when the elbows are back to contract the rhomboids and trapezium. Lean forward until a mild stretch is felt in the hamstrings and back musculature. Maintain neutral wrists. SAFETY ASPECTS: Do not bounce at the bottom range of the exercise. Move in a slow and controlled motion. Avoid excessive shoulder protraction and elevation during exercise.

Pull Up—Latissimus Dorsi, Teres Major, Rhomboids, Biceps, Brachialis, Brachioradialis STARTING POSITION: Disconnect the pulley from the glideboard 330 and lower the LAT bars into the pull up position. Push the glideboard 330 halfway up the rails. Lie prone with chest near the top edge of the glideboard 330. Grasp the LAT bars, palms facing down. Bend the knees to ensure glideboard 330 is not sitting on the bottom of the rails. EXERCISE DESCRIPTION: Pull the glideboard 330 up the rails until hands are level with shoulders. Lower the glideboard 330 back down the rails until arms are fully extended. PULLEY PIN PLACEMENT: None. TEACHING TIPS: Lead movement with the elbows. Exercise in a pain free range of motion. Contract abdominal muscles during the exercise. SAFETY ASPECTS: Avoid hyper-extending the cervical spine. Keep the head in line with spine throughout the exercise. Do not lift chest off the glideboard 330. Avoid bouncing at the bottom range of motion. Avoid excessive shoulder elevation during the exercise.

Chin Up—Latissimus Dorsi, Teres Major, Biceps, Brachialis

STARTING POSITION: Disconnect the pulley from the glideboard 330 and lower the LAT bars into the pull up position. Push the glideboard 330 halfway up the rails. Lie prone with chest near the top edge of the glideboard 330. Grasp the LAT bars, palms facing up. Bend the knees to ensure glideboard 330 is not sitting on the bottom of the rails. EXERCISE DESCRIPTION: Pull the glideboard 330 up the rails, elbows out, until hands are level with shoulders. Lower the glideboard 330 back down the rails until arms are fully extended. PULLEY PIN PLACEMENT: None. TEACHING TIPS: Lead movement with the elbows. Maintain head in neutral alignment with the spine. Exercise in a pain free range of motion. SAFETY ASPECTS: Do not lift chest off the glideboard 330. Avoid bouncing at the bottom range of motion. ACCESSORIES. LAT bars.

Swimmer—Latissimus Dorsi, Teres Major, Triceps (Long Head)

STARTING POSITION: Grasp handles and pull the glideboard 330 halfway up the rails. Straddle the rails and lie prone on the glideboard 330. Position the body with chest near the top edge of the glideboard 330. Bend the knees up to 90°, extending arms overhead toward the pulleys, palms facing down. EXERCISE DESCRIPTION: In a downward arc motion, pull the handles down and back to the side of the hips. Slowly bring the arms back to the starting position. Repeat. PULLEY PIN PLACEMENT: Adjust to ensure correct force angle. Recommended—1, 2, 6. TEACHING TIPS: Keep arms extended throughout the entire motion, with only a slight bend at the elbows. Avoid hyper-extending the cervical spine. Keep the head in line with spine throughout the exercise. If the glideboard 330 touches the bottom with arms extended overhead, adjust body position. Contract the shoulder muscles throughout movement. Bring the hands back to starting position in a slow, controlled manner. This exercise is similar to a swimmer's "free style" stroke. SAFETY ASPECTS: Do not allow arms to do the work during this exercise. Movement should emanate from the back and shoulder muscles. Do not allow the arms to come up too quickly from the bottom of the movement. Avoid excessive shoulder elevation and protraction during exercise. VARIATIONS: Unilateral—From the starting position, bring the glideboard 330 up the rails by pulling one handle in a downward arc motion down and back to the side of the hip. Slowly bring the arm back to the starting position. Return with control to the starting position. Repeat with alternating arm. Static—From the starting position, bring the glideboard 330 up the rails by pulling one handle in a downward arc motion down and back to the side of the hip. Without moving the glideboard 330, move both arms in opposite directions simultaneously.

Reverse Fly—Deltoids, Trapezius, Rhomboids, Infraspinatus

STARTING POSITION: Grasp handles and pull the glideboard 330 halfway up the rails. Straddle the rails and sit on the top edge of the glideboard 330, facing the tower. Extend arms directly toward the pulleys with palms facing in. Lift feet off the floor. EXERCISE DESCRIPTION: From an upright seated position, bring the glideboard 330 up the rails by pulling the arms back in an outward arc until hands are directly out to the side of the torso. Lower the glideboard 330 down the rails by returning the arms to the starting position. PULLEY PIN PLACEMENT: Adjust to ensure correct force angle. Recommended—2, 3. TEACHING TIPS: Keep arms extended with a slight bend at the elbow throughout the entire movement. Lead the movement with the hands. Squeeze the shoulder blades together when the elbows are back to contract the rhomboids and trapezium. Maintain an upright posture during the entire movement. Maintain neutral wrists. SAFETY ASPECTS: Beginners should start this exercise at a low level. Avoid torso movement in the saggital plane. Avoid excessive shoulder protraction during this exercise. VARIATIONS: Cross cable.

Kneeling Reverse Fly Deltoids, Trapezius, Rhomboids, Infraspinatus

STARTING POSITION: Grasp handles and pull the glideboard 330 halfway up the rails. Place hands, knuckles down, on the glideboard 330 to stabilize movement. Kneel at the top edge of the glideboard 330 facing the tower. Extend arms toward pulleys with palms facing in. EXERCISE DESCRIPTION: From an upright kneeling position, bring the glideboard 330 up the rails by pulling the arms back in an outward arc until hands are directly out to the side of the torso. Lower the glideboard 330 down the rails by bringing your arms back to the starting position. PULLEY PIN PLACEMENT: Adjust to ensure correct force angle. Recommended—2, 3. TEACHING TIPS: Keep arms extended with a slight bend at the elbow throughout the entire movement. Lead the movement with the hands. Squeeze the shoulder blades together when the elbows are back to contract the rhomboids and trapezium. Maintain an upright posture during the entire movement. Maintain neutral wrists. To advance exercise, extend torso and knees into a high kneeling position. SAFETY ASPECTS: Beginners should start this exercise at a low level. Avoid torso movement in the sagittal plane. Avoid excessive shoulder protraction during this exercise. Do not over-accelerate during initial phase of the exercise. VARIATIONS: Unilateral with Torso Rotation.

Prone Reverse Fly—Erector Spinae, Levator Scapula, Deltoids, Trapezius, Rhomboids, Infraspinatus STARTING POSITION: Grasp handles and pull the glideboard 330 halfway up the rails. Straddle the rails and lie prone on the glideboard 330. Position the body with chest near the top edge of the glideboard 330. Bend the knees up to 90°, extending arms overhead toward the pulleys, palms facing out. EXERCISE DESCRIPTION: In an outward arc motion, press the handles out and back, parallel to the sides of the torso. Slightly raise head and upper chest off the glideboard 330 as hands press back. Slowly bring head and arms back to the starting position. PULLEY PIN PLACEMENT: Adjust to ensure correct force angle. Recommended—1, 2. TEACHING TIPS: Keep arms extended with a slight bend at the elbow throughout the entire movement. Lead the movement with the hands. Squeeze the shoulder blades together when the elbows are back to contract the rhomboids and trapezium. Maintain neutral wrists. SAFETY ASPECTS: Beginners should start this exercise at a low level. Do not bounce at the bottom range of the exercise. Move the arms in a slow and controlled motion. Discontinue exercise if pain occurs in the lower back. Avoid excessive shoulder elevation during this exercise. VARIATIONS: With legs extended, abduct and externally rotate hips to reduce any tension felt in the lumbar spine during this exercise.

Seated Biceps Curl—Biceps, Brachialis, Brachioradialis

STARTING POSITION: Grasp handles and pull the glideboard 330 halfway up the rails. Straddle the rails and sit toward the top edge of the glideboard 330, facing the tower. Extend arms directly toward the pulleys with palms facing up. Lift feet off the floor. EXERCISE DESCRIPTION: From an upright seated position, pull the glideboard 330 up the rails by curling the handles up toward the shoulders, keeping elbows stationary. Lower the glideboard 330 back down the rails by bringing the handles back to the starting position. PULLEY PIN PLACEMENT: Adjust to ensure correct force angle. Recommended—1, 3. TEACHING TIPS: Pause briefly at the top of the curl, keeping elbows up and stationary during the movement. Maintain upright posture (neutral spine). Maintain neutral wrists. SAFETY ASPECTS: Do not fully extend the arm at the bottom of the curl. Keep a slight bend in the elbow to protect the joint and maintain the load on the biceps muscles. Avoid torso movement in the saggital plane. Avoid excessive shoulder protraction and depression during exercise. ACCESSORIES Curl Bench (optional) VARIATIONS: Static Equilibrium—From the starting position, bring the glideboard 330 up the rails by curling one handle up toward the shoulder, keeping elbow stationary. Without moving the glideboard 330, move both arms in opposite directions simultaneously. Unilateral—From the starting position, bring the glideboard 330 up the rails by curling one handle up toward the shoulder, keeping elbow stationary. Lower the glideboard 330 back down to the starting position. Repeat with alternate arm. Reverse Grip—Palms face down throughout movement.

Kneeling Biceps Curl—Biceps, Brachialis, Brachioradialis

STARTING POSITION: Grasp handles and pull the glideboard 330 halfway up the rails. Place hands, knuckles down, on the glideboard 330 to stabilize movement. Kneel at the top edge of the glideboard 330 facing the tower. Extend arms toward pulleys with palms facing up. EXERCISE DESCRIPTION: From an upright kneeling position, pull the glideboard 330 up the rails by curling the handles up toward the shoulders, keeping elbows stationary. Lower the glideboard 330 back down the rails by bringing the handles back to the starting position. PULLEY PIN PLACEMENT: Adjust to ensure correct force angle. Recommended—2, 3. TEACHING TIPS: Pause briefly at the top of the curl, keeping elbows up and stationary during the movement. Maintain upright posture (neutral spine). Maintain neutral wrists. To advance exercise, extend torso and knees into a high kneeling position. SAFETY ASPECTS: Do not fully extend the arms at the bottom of the curl. Keep a slight bend in the elbows to protect the joint and maintain the load on the biceps muscles. Avoid torso movement in the sagittal plane. Avoid excessive shoulder protraction and depression during exercise. Beginners should start this exercise at a low level. VARIATIONS: Static Equilibrium—From the starting position, bring the glideboard 330 up the rails by curling one handle up toward the shoulder, keeping elbow stationary. Without moving the glideboard 330, move both arms in opposite directions simultaneously. Unilateral—From the starting position, bring the glideboard 330 up the rails by curling one handle up toward the shoulder, keeping elbow stationary. Lower the glideboard 330 back down to the starting position. Repeat with alternate arm. High Kneeling—Perform same exercise with shoulders, hips and knees in line and perpendicular to the glideboard 330. VARIATION (High Kneeling) VARIATION (Unilateral)

Seated Lateral Biceps Curl—Biceps, Brachialis, Brachioradialis

STARTING POSITION: Stand to the side of the exercise device 100 with back facing the rails. Grasp the closest handle and pull the glideboard 330 halfway up. Sit toward the top edge of the glideboard 330 facing sideways with both legs extended straight out. Feet should not touch the ground. Extend active arm toward the pulley at shoulder level. Place the inactive hand on hip or the glideboard 330. EXERCISE DESCRIPTION: With a slight bend in the elbow, slowly pull the glideboard 330 up the rails by curling the handle up toward the shoulder, keeping elbow stationary. Lower the glideboard 330 back down the rails by bringing the handle back to the starting position. PULLEY PIN PLACEMENT: Adjust to ensure correct force angle. Recommended—1 to 6. TEACHING TIPS: Pause briefly at the top of the curl, keeping elbow up and stationary during the movement. Maintain upright posture (neutral spine). Maintain neutral wrists. Use the abdominal muscles to keep back straight and body stable on the glideboard 330. Focus on contracting the medial portion of the biceps (short head). SAFETY ASPECTS: Do not fully extend the arm at the bottom of the curl. Keep a slight bend in the elbow to protect the joint and maintain the load on the biceps muscles. Avoid torso movement in the frontal plane. Stabilize the torso throughout the exercise.

Kneeling Lateral Biceps Curl—Biceps, Brachialis

STARTING POSITION: Stand to the side of the rails and grasp the handle on the same side of the exercise device 100. Pull the glideboard 330 halfway up the rails. Place hands, knuckles down, on the glideboard 330 to stabilize movement. Kneel on the top portion of the glideboard 330 facing sideways. Extend active arm toward the pulley, palm facing up. Place the inactive hand on hip. EXERCISE DESCRIPTION: Pull the glideboard 330 up the rails by curling the handle up toward the shoulder, keeping elbow stationary. Lower the glideboard 330 back down the rails by bringing the handle back to the starting position. PULLEY PIN PLACEMENT: Adjust to ensure correct force angle. Recommended—1 to 6. TEACHING TIPS: Beginners should widen the base of support by increasing the space between the knees. Pause briefly at the top of the curl and keep elbow up during the movement. Maintain upright posture and neutral wrists. Use the abdominal muscles to keep back straight and body stable on the glideboard 330. Focus on contracting the medial portion of the biceps (short head). SAFETY ASPECTS: Do not fully extend the arm at the bottom of the curl. Keep a slight bend in the elbow to protect the joint and maintain the load on the biceps muscles. Avoid torso movement in the frontal plane. Stabilize the torso throughout the exercise.

Supine Biceps Curl—Biceps, Brachialis

STARTING POSITION: Grasp handles and pull the glideboard 330 halfway up the rails. Straddle the glideboard 330 and sit at the top edge. Lie back, ensuring head is fully supported. Place both feet on the top edge of the glideboard 330 with arms parallel to the torso, palms facing up. EXERCISE DESCRIPTION: Using the biceps muscles, pull the glideboard 330 up the rails by curling the handles up toward the shoulders. Lower the glideboard 330 back down the rails by bringing the handles back to the starting position. PULLEY PIN PLACEMENT: Adjust to ensure correct force angle. Recommended—1 to 6. TEACHING TIPS: Pause briefly at the top of the curl, focusing on the biceps muscles. Maintain neutral wrists. If the glideboard 330 contacts the top or bottom of the rails, adjust body position. SAFETY ASPECTS: Discontinue exercise or prop the torso up if inverted position causes nausea, dizziness or lightheadedness. Do not fully extend the arms at the bottom of the curl. Keep a slight bend in the elbows to protect the joint and maintain the load on the biceps muscles. Ensure head is full supported by the glideboard 330, placing pillow or towel behind head if neck is hyper-extended. VARIATIONS: Static Equilibrium—From the starting position, bring the glideboard 330 up the rails by curling one handle up toward the shoulder, keeping elbow stationary. Without moving the glideboard 330, move both arms in opposite directions simultaneously. Unilateral—From the starting position, bring the glideboard 330 up the rails by curling one handle up toward the shoulder, keeping elbow stationary. Lower the glideboard 330 back down to the starting position. Repeat with alternate arm.

Prone Biceps Curl—Biceps, Brachialis

STARTING POSITION: Grasp handles and pull the glideboard 330 halfway up the rails. Straddle the rails and lie prone on the glideboard 330. Position the body with the elbows resting near the top edge of the glideboard 330. Bend knees and extend the arms directly toward the pulleys. EXERCISE DESCRIPTION: With elbows resting on the glideboard 330, curl the handles up toward the shoulders. Lower the glideboard 330 back down the rails by bringing the handles back to the starting position. PULLEY PIN PLACEMENT: Adjust to ensure correct force angle. Recommended—1, 2. TEACHING TIPS: Focus on maintaining the elbow positions on the glideboard 330. Maintain neutral wrists. Pause briefly at the top of the curl focusing on the biceps muscles. If the glideboard 330 contacts the top or bottom of the rails, adjust body position. SAFETY ASPECTS: Do not fully extend the arms at the bottom of the curl. Keep a slight bend in the elbows to protect the joint and maintain the load on the biceps muscles. Avoid bouncing at the bottom range of motion. Avoid hyper-extending the cervical spine. Keep the head in line with the spine throughout the exercise. VARIATIONS: Static Equilibrium—From the starting position, bring the glideboard 330 up the rails by curling one handle up toward the shoulder. Without moving the glideboard 330, move both arms in opposite directions simultaneously. Unilateral—From the starting position, bring the glideboard 330 up the rails by curling one handle up toward the shoulder. Lower the glideboard 330 back down to the starting position. Repeat with alternate arm.

Preacher Curl—Biceps, Brachialis

STARTING POSITION: Attach the curl bench and pulley to the glideboard 330. Grasp handles and pull glideboard 330 halfway up the rails. Straddle the rails and sit toward the top edge of the glideboard 330, facing the tower. With cables in hand, extend arms over the curl bench, shoulder-width apart. Elbows should be fully supported by the curl bench. EXERCISE DESCRIPTION: From an upright seated position, pull the glideboard 330 up the rails by curling the handles up toward the shoulders. Lower the glideboard 330 back down the rails by bringing the handles back to the starting position. PULLEY PIN PLACEMENT: Adjust to ensure correct force angle. Recommended—1, 2. TEACHING TIPS: Focus on maintaining the elbow positions on the curl bench. Maintain neutral wrists. Pause briefly at the top of the curl, focusing on the biceps muscles. Maintain upright posture (neutral spine). SAFETY ASPECTS: The angle of the curl bench creates significant torque when elbows are fully extended. Warm up biceps muscles prior to this exercise and start at a low level. Do not fully extend arms at the bottom of the curl. Keep a slight bend in your elbow to protect the joint and maintain the load on the biceps muscles. Avoid rounding the back to get into position. Knees should be over the top of the glideboard 330. ACCESSORIES Curl Bench VARIATIONS: Reverse Grip Static Equilibrium (not pictured)—From the starting position, bring the glideboard 330 up the rails by curling one handle up toward the shoulder. Without moving the glideboard 330, move both arms in opposite directions simultaneously. Unilateral—From the starting position, bring the glideboard 330 up the rails by curling one handle up toward the shoulder. Lower the glideboard 330 back down to the starting position. Repeat with alternate arm.

Triceps Press Down Triceps

STARTING POSITION: Grasp handles and pull the glideboard 330 halfway up the rails. Straddle the glideboard 330 and sit at the bottom edge facing away from the tower. Lie back, ensuring head is fully supported. Place both feet on the bottom edge of the glideboard 330. Position the upper arms in tight by the rib cage, palms facing up with elbows flexed. EXERCISE DESCRIPTION: Keeping elbows stationary, press down on the handles until arms are fully extended next to the thighs. Lower the glideboard 330 back down the rails by bringing the handles back to the starting position. PULLEY PIN PLACEMENT: Adjust to ensure correct force angle. Recommended—2, 3. TEACHING TIPS: Keep the handles a few inches apart during the pressing movement. Maintain the elbows close to the rib cage throughout the exercise. Straighten elbows to just short of a full extension and isometrically contract the triceps for one to two seconds. Maintain neutral wrists. SAFETY ASPECTS: Avoid arching the back during the movement. Contract abdominals throughout exercise to maintain neutral spine. Do not lock the elbows out at the bottom of the press. Do not raise head during movement. Avoid movement at the shoulder throughout the exercise. VARIATIONS: Static Equilibrium—From the starting position, bring the glideboard 330 up the rails by pressing one handle down until arm is fully extended next to the thigh. Without moving the glideboard 330, move both arms in opposite directions simultaneously. Unilateral—From the starting position, bring the glideboard 330 up the rails by pressing one handle down until arm is fully extended next to the thigh. Return with control to the starting position. Repeat with alternating hands. Reverse Grip Elevated Elbows—Elevate elbows to eye level to change the emphasis to the long head of the triceps.

Kneeling Triceps Kickback—Triceps

STARTING POSITION: Grasp handles and pull the glideboard 330 halfway up the rails. Place hands, knuckles down, on the glideboard 330 to stabilize movement. Kneel at the top edge of the glideboard 330 facing the tower. Keeping the elbows in tight to the rib cage, lower torso over the knees. Bend elbows with palms facing down. EXERCISE DESCRIPTION: Keeping elbows stationary, press down on the handles until arms are fully extended next to the thighs. Lower the glideboard 330 back down the rails by bringing the handles back to the starting position. PULLEY PIN PLACEMENT: Adjust to ensure correct force angle. Recommended—1, 2. TEACHING TIPS: Maintain the elbows close to the rib cage throughout the exercise. Straighten elbows to just short of a full extension and isometrically contract the triceps for one to two seconds. Maintain neutral wrists. SAFETY ASPECTS: Avoid hyperextending the cervical spine, keeping the head in line with the spine throughout the exercise. Do not swing the handles back and forth during the movement. Do not allow elbows to drop during movement. Avoid movement at the shoulder throughout the exercise. VARIATIONS: Static Equilibrium—From the starting position, bring the glideboard 330 up the rails by pressing one handle down until arm is fully extended next to the thigh. Without moving the glideboard 330, move both arms in opposite directions simultaneously. Unilateral—From the starting position, bring the glideboard 330 up the rails by pressing one handle down until arm is fully extended next to the thigh. Return with control to the starting position. Repeat with alternating hands. Reverse Grip Bent Over Kick Back—From a high kneeling position, bend torso to 90° while stabilizing glideboard 330 with inactive hand. Extend active arm with stationary elbow, keeping upper arm stationary.

Lateral Triceps Extension—Triceps

STARTING POSITION: Stand to the side of exercise device 100 with back facing the rails. With the hand closest to the bottom of the rails, grasp the handle on the opposite side and pull the glideboard 330 halfway up the rails. Sit toward the top edge of the glideboard 330 facing sideways with both legs extended straight out. Feet should not touch the ground. Bring the handle directly in front of the chest, palm facing in. Raise the active elbow up and out to the side to shoulder height. EXERCISE DESCRIPTION: Slowly extend the arm out to the side to full extension. Lower the glideboard 330 back down the rails by bringing the arm back to the starting position. PULLEY PIN PLACEMENT: Adjust to ensure correct force angle. Recommended—2, 3. TEACHING TIPS: Keep elbow in a fixed position to ensure the resistance is placed on the triceps muscles. Use the abdominal muscles to keep back straight and body stable on the glideboard 330. Maintain a neutral wrist. Place inactive hand on hip or on the side of the glideboard 330 to stabilize. SAFETY ASPECTS: Do not allow elbow to drop down during movement. Avoid torso movement in the frontal plane. Avoid excessive shoulder protraction and elevation during exercise.

Overhead Triceps Extensiontriceps (Long Head)

STARTING POSITION: Grasp handles and pull the glideboard 330 halfway up the rails. Straddle the rails and sit toward the top edge of the glideboard 330, facing the away from the tower. Place legs in a comfortable position. Raise elbows to eye level with palms facing up. EXERCISE DESCRIPTION: Keeping elbows in a stationary position, press handles up above the head until arms are fully extended. Return to the starting position. PULLEY PIN PLACEMENT: Adjust to ensure correct force angle. Recommended—2, 3. TEACHING TIPS: Keep the upper arms stationary so the elbow points up diagonally throughout the exercise. Straighten elbows to just short of a full extension and isometrically contract the triceps for one to two seconds. Maintain neutral wrist and spine. Keep the handles a few inches apart during the pressing movement. Use the abdominal muscles to keep back straight and body stable on the glideboard 330. Taller users may require the cable extension. SAFETY ASPECTS: Avoid torso movement in the sagittal plane. Do not allow elbows to sway outward. Elbows remain same distance apart throughout exercise. Avoid excessive shoulder protraction and elevation during exercise. VARIATIONS: Static Equilibrium—From the starting position, bring the glideboard 330 up the rails by pressing one handle up until arm is fully extended. Without moving the glideboard 330, move both arms in opposite directions simultaneously. Unilateral—From the starting position, bring the glideboard 330 up the rails by pressing one handle up until arm is fully extended. Return with control to the starting position. Repeat with alternating hands. Reverse Grip.

Triceps Dip—Triceps, Pectoralis Major

STARTING POSITION: Disconnect the pulley from the glideboard 330 and attach the Dip Bars to the exercise device 100. Push the glideboard 330 halfway up the rails, straddle the glideboard 330 and sit at the bottom edge. Lie back, ensuring head is fully supported. Grasp the Dip Bars with extended arms and place both feet on the bottom edge of the glideboard 330. EXERCISE DESCRIPTION: Slowly lower the glideboard 330 by bending arms at the elbows until a mild stretch is felt in the shoulder. Press down using the triceps muscles until arms are extended. PULLEY PIN PLACEMENT: None. TEACHING TIPS: Straighten elbows to just short of a full extension and isometrically contract the triceps for one to two seconds. Focus on stabilizing the shoulders throughout movement. Keep elbows close to body during the exercise. Maintain neutral wrists. SAFETY ASPECTS: Do not bounce at the bottom of the movement. Keep movement slow and controlled throughout the exercise. Avoid excessive shoulder elevation during exercise. ACCESSORIES Dip Bars VARIATIONS: Elevated Legs—Elevate legs during entire exercise set.

Forearm Curl—Wrist Flexors

STARTING POSITION: Grasp handles and pull the glideboard 330 halfway up the rails. Straddle the rails and sit toward the bottom edge of the glideboard 330 facing the tower. Bend knees and place feet near the end of the glideboard 330. Rest forearms on the upper leg so wrists drape over the knees with palms facing up. EXERCISE DESCRIPTION: From an upright seated position, curl wrists in toward the body by contracting the forearm muscles. Extend wrists back to the starting position. PULLEY PIN PLACEMENT: Adjust to ensure correct force angle. Recommended—1, 2. TEACHING TIPS: Maintain upright posture (neutral spine). Avoid torso movement in the sagittal plane. Pause briefly at the top of the curl and squeeze the forearm muscles. SAFETY ASPECTS: Do not use the biceps to perform this movement. Keep the forearms in contact with the upper legs at all times. Do not bounce at the bottom range of the exercise. Move wrists in a slow and controlled motion. VARIATIONS: Reverse Grip—The reverse grip changes the emphasis to the wrist extensors.

Cardio Pull—Quadriceps, Gluteal Group, Latissimus Dorsi, Teres Major, Biceps, Brachioradialis STARTING POSITION: Grasp handles and pull the glideboard 330 halfway up the rails. Straddle the glideboard 330 and sit at the bottom edge. Lie back on the glideboard 330, ensuring head is fully supported. Place both feet on the squat stand shoulder-width apart. Lower the glideboard 330 by bending both knees to 90° and extending arms overhead. EXERCISE DESCRIPTION: Bring the glideboard 330 up the rails by simultaneously using legs to push off the squat stand and pulling the handles down to chest level until legs are fully extended. Lower the glideboard 330 down to the starting position by squatting with the legs and bringing the handles back overhead. PULLEY PIN PLACEMENT: Adjust to ensure correct force angle. Recommended—2, 3. TEACHING TIPS: Lead with elbows while pulling the glideboard 330 up the rails. This exercise can also be performed using one leg at a time to add difficulty. Maintain neutral wrists throughout exercise. Adjust body on glideboard 330 for full range of motion. Ensure the knees track over the feet throughout the movement. SAFETY ASPECTS: Do not allow slack to build up in cables. The board movement should result from the arm pull as well as the leg press. Avoid arching the back during the movement. Contract abdominals throughout exercise to maintain neutral spine. Do not allow knee angle to exceed 90° at the bottom of the movement. Ensure the patella does not move anterior to the toes throughout the movement. Do not lock the knees at the top of the movement. Do not raise head during exercise. Avoid excessive shoulder elevation during exercise. ACCESSORIES Telescoping squat stand. VARIATIONS: Create variations (unilateral arm, unilateral leg, etc.).

Rowing—Hamstrings, Latissimus Dorsi, Trapezius, Rhomboids, Teres Major, Biceps, Brachialis, Brachioradialis STARTING POSITION: Grasp handles and pull the glideboard 330 halfway up the rails. Sit on the glideboard 330 facing the tower. Secure feet in the adjustable foot holder. Sit upright on the glideboard 330 with arms and legs extended toward the tower. EXERCISE DESCRIPTION: From an upright seated position, pull the glideboard 330 up the rails simultaneously with the legs and the arms. Pull the handles in toward the chest until hands are in front of the shoulders. Lower the glideboard 330 down the rails by extending arms and legs back to the starting position. PULLEY PIN PLACEMENT: Adjust to ensure correct force angle. Recommended—2, 3. TEACHING TIPS: Maintain control of the glideboard 330 during the down phase of the movement and sit with an upright neutral posture. Pull heels toward the glideboard 330 to ensure hamstring recruitment. Maintain neutral wrists. Adjust body position on glideboard 330 to ensure full range of motion. Taller users may require a cable extension. SAFETY ASPECTS: Avoid upper body movement in the sagittal plane. Avoid excessive shoulder elevation during exercise. ACCESSORIES: Adjustable foot holder.

Surfer Lat Pull—Erector Spinae, Deltoids, Latissimus Dorsi, Teres Major, Pectoralis Major, Triceps (Long Head)

STARTING POSITION: Grasp handles and pull the glideboard 330 halfway up the rails. Place hands, knuckles down, on the glideboard 330 to stabilize movement. Kneel at the top edge of the glideboard 330 facing the tower while sitting back on the heels. Lower the torso over knees, extending the arms toward the pulleys. EXERCISE DESCRIPTION: From the starting position, pull the glideboard 330 up the rails by simultaneously pulling the handles in a downward arc motion and extending torso upright. Lower the glideboard 330 down the rails by extending the arms forward and lowering the torso to the starting position. PULLEY PIN PLACEMENT: Adjust to ensure correct force angle. Recommended—1, 2. TEACHING TIPS: Keep lower back muscles contracted throughout the entire movement. Maintain neutral spine throughout exercise. Lead movement with hands and shoulders, contracting the torso muscles to stabilize. Keep arms extended throughout the entire motion, with a slight bend at the elbows. Avoid hyper-extending the cervical spine. Keep the head in line with spine throughout the exercise. If the glideboard 330 touches the bottom with arms extended overhead, adjust body position. This exercise is similar to a surfer's paddling technique. SAFETY ASPECTS: Avoid excessive shoulder elevation and protraction during exercise. Avoid pulling glideboard 330 up rails with hip flexors and abdominal muscles.

Hamstring Curl with Abdominal Crunch—Hamstrings, Gastrocnemius, Abdominals, Obliques STARTING POSITION: Disconnect the pulley from the glideboard 330 and raise the adjustable foot holder to the "up" position. Sit on the glideboard 330 facing the tower. Once body weight is fully supported by the glideboard 330, secure both feet into the adjustable foot holder. Lie back on the glideboard 330 with legs extended and head fully supported. Place arms across torso or behind head. EXERCISE DESCRIPTION: Lift head and shoulders off the glideboard 330 by contracting the abdominal muscles. Simultaneously pull the glideboard 330 up the rails by flexing the hamstrings. Lower the glideboard 330 back to the starting position while lowering head and shoulders. PULLEY PIN PLACEMENT: None. TEACHING TIPS: Maintain a slow tempo during this exercise. Lower the glideboard 330 in a controlled manner, keeping tension on the hamstrings and abdominal muscles. To increase the intensity of the abdominal crunch, place arms behind neck. Lift only head and shoulder blades off the glideboard 330 during abdominal crunch. SAFETY ASPECTS: Do not pull excessively on the head with hands. This places stress on the cervical spine. Do not let the glideboard 330 fall down the rails after the curl. Discontinue exercise if inverted position causes nausea, dizziness or lightheadedness. ACCESSORIES Adjustable foot holder VARIATIONS: Torso Rotation—Curl one shoulder up toward opposite knee during abdominal crunch.

Incline Abdominal Crunch/Squat—Abdominals, Quadriceps, Gluteal Group, Hamstrings STARTING POSITION: Disconnect the pulley from the glideboard 330. Push the glideboard 330 halfway up the rails, straddle the glideboard 330 and sit at the bottom edge. Lie back, ensuring head is fully supported. Place both feet on the squat stand shoulderwidth apart. EXERCISE DESCRIP- TION: Place hands across the chest or behind the head. Simultaneously, lower down into a squat position while raising the head and shoulder blades off the glideboard 330. Lower shoulders back down to the glideboard 330 as you press up with the legs. PULLEY PIN PLACEMENT: None. TEACHING TIPS: Keep tension on the abdominals throughout the entire movement. Keep head in neutral alignment with spine. SAFETY ASPECTS: Do not allow knee angle to exceed 90° at the bottom of the movement. Ensure the patella does not move anterior to the toes throughout the movement. Do not lock knees at the top of the movement. Do not pull excessively on the head with hands. This places stress on the cervical spine. ACCESSORIES Telescoping squat stand VARIATIONS: Torso Rotation—During the lower portion of the exercise with knees bent, crunch up and twist to one side using the abdominal and oblique muscles.

Group

Individuals join health clubs and gyms for three main reasons: to lose weight, to increase strength and to look better. Obtaining those results, however, can be daunting, even overwhelming for the average gym member. Although it is well-known that resistance or strength training must be a part of any balanced workout program, many people find it difficult to incorporate into their schedule. Equipment (or "machines") and free weights are intimidating. In addition, members may not have the time, the experience or the patience to learn the proper technique that ensures results. Since the early 1980s, when aerobic group classes were introduced, strength training equipment for group fitness has come and gone. It was unable to satisfy the underlying principles of true strength training. A single piece of equipment that could provide a full-body workout without compromising correct technique has been elusive. The exercise device 100 has finally provided the opportunity for group strength training offering the same benefits one receives from spending hours in the weight room. While there have been countless "body-sculpt" classes and formats created to meet the needs of all members, these efforts still fall short of the ability to truly customize a workout for each individual in a group setting. Fortunately, with the exercise device equipment and group program format, customized group programming can be achieved with proven results. It is time-efficient, effective and scientifically sound. In a fun and comfortable setting, members will see and feel the results they desire. GROUP is a series of high intensity muscular endurance exercises that are designed to provide time-efficient, effective, full body workouts. The 30-minute classes focus on muscle isolation and integration, challenging muscular strength and endurance while including unique core and stretching exercises. The wide variety of exercises and the freedom of a dynamic pulley system allow for enhanced muscle development, improved tone, and increased joint range of motion. The use of body weight as the resistive factor against gravity produces an individualized workout environment that one can progressively increase in intensity as strength and performance improve.

The Benefits of Resistance Training: The numerous health and wellness advantages of resistance training have typically been difficult to incorporate into a group exercise environment. These benefits have significantly limited the general gym going population, since many often minimize the amount of resistance training in their regular exercise program. Benefits of resistance training include: INCREASE MUSCLE MASS AND RESTING METABOLIC RATE: Resistance training increases the immediate number of calories burned from exercise. By increasing muscle mass, an individual will also increase his/her overall resting metabolic rate. DECREASE BODY FAT: An increase of overall muscle mass and resting metabolic rate will result in a change in daily caloric output. Such a significant change will greatly assist in decreasing an individual's percentage of body fat. INCREASE BONE MINERAL DENSITY: Resistance training helps to build and maintain bone mass. By progressively increasing resistance, individuals can gain and maintain muscle strength, increase bone density and thereby minimize the risk of osteoporosis. IMPROVE POSTURE AND AVOID BACK PAIN: Strengthening the muscles of the vertebral column including the spinae and transversospinal group will improve an individual's ability to maintain correct posture. Exercises that strengthen and increase mobility of muscles surrounding the trunk (core) can reduce the threat of recurring back pain and increase one's mobility for an active lifestyle. REDUCE RESTING BLOOD PRESSURE: Resistance training has been shown to reduce resting blood pressure with results similar to those achieved by endurance exercises. With a well-developed program, an individual can safely perform strength exercises and obtain many physiological benefits. IMPROVE GLUCOSE METABOLISM: Poor glucose metabolism is linked to the ever increasing onset of adult diabetes. Resistance training has been shown to increase glucose intake and improve the overall metabolism. FUNCTIONAL STABILITY: Functional movements mimic an individual's daily activities and can help prevent injuries. Resistance training can lead to increased body awareness, stability and can help an individual be more active in all aspects of life. INJURY PREVENTION: Resistance training can help increase an individual's overall stability. Enhancing neuromuscular sensitivity and reflexes improves muscular control, which is essential for injury prevention.

Resistance Training Guidelines: One to three set programming of six to fifteen repetitions (intensity ranging from 60-70% 1 RM) is effective for improvements in strength, endurance and power. THE IMPORTANCE OF "INTENSITY" IN RESISTANCE TRAINING: The health and fitness industry has long studied the principles of intensity, frequency and duration to build an effective resistance training program. Recent research has shown that minimal significant differences in strength gain are found between groups that follow single or multiple set programming. One hard set of exercises produces similar strength improvements as three hard sets. Exercise intensity rather than duration is most important for stimulating strength development. The GROUP Strength Series with its single high intensity exercise programming supports these results and provides an individual with an effective resistance training program.

The Design of Group Strength Series: The GROUP philosophy is to provide a series of high intensity muscular endurance workouts that are scientifically sound, time-efficient and effective. The 30-minute full body workouts include unique core and stretching exercises, with a specific focus on challenging muscular strength and endurance. By offering a variety of exercises and the freedom of a dynamic pulley system, the classes allow for enhanced muscle development, faster toning, increased joint range of motion and improved stability. Consider the following: MAXIMIZING BODY POSITIONING: In each of the selected body positions on the glideboard 330, multiple exercises can be executed, focused on various muscle groups to maximize overall efficiency. MINIMIZING TRANSITIONS: The selection and sequencing of exercises allows for maximum time on exercise device 100 and minimum time spent modifying body position and incline height (resistance). Individuals are encouraged to change incline height to best suit their physical capabilities at any time during the program. PULLEY PIN PLACEMENT: The pulley system allows for a variety of force angles that can be modified by changing the pulley pin placement. Optimal pin placement can be selected for each exercise to ensure an efficient workout. MUSCLE SEQUENCING: Due to the high intensity anaerobic nature of the GROUP—Strength workouts, careful consideration was given to the selection and sequencing of the muscles to maximize performance for efficiency and recovery. EXERCISE VARIATIONS BI-LATERAL—Moving both limbs simultaneously. UNI-LATERAL—Moving a single limb. STATIC EQUILIBRIUM—Both arms move simultaneously in opposite directions while maintaining cable resistance without movement of the glideboard 330. STATIC HOLDS—Maintain an isometric contraction at a specific point in the movement. PULSES—Repeated, small, one-count movements. LINE OF PULL—Represents the direction in which a resistive force is being applied.

Group CLASS FORMAT: Be aware that at times during the workout, you will not be visible by all participants due to their positioning on exercise device 100. To maximize visibility of the instructor, you may wish to move between the front and back of the room. Here are some positioning recommendations: Exercises requiring the instructor to face the base should be done at the front of the room, i.e., supine incline and seated incline. Exercises requiring the instructor to face the tower should be done in the back of the room, i.e., wide rear fly, rows, biceps curls and abdominal training. Exercises requiring the instructor to be positioned laterally on the exercise device 100 should be demonstrated prior to participation or the instructor should stand and be mobile, i.e., torso twist, etc.

Instructional Guidelines (Cueing): The group exercise environment has always required skillful cueing for its success. These cueing techniques are designed to ensure class participation and motivation. The cueing required for the GROUP strength class is unique. Below are some tips on how to maximize class participation with effective cueing: VERBAL CUEING Carefully choose words that are easy to understand and establish a mental picture of the movement. Cueing to describe a movement should focus on words that indicate what, how, where and, when appropriate, why. For example, when you are describing the Chest fly, say "Bring hands forward and together, chest high, as if you are hugging a tree." Choose positive, uplifting words and phrases. Avoid using negative terms or the same phrase over and over, like "good job," "great," etc. Ask questions such as "Could you do eight more?" or "Would your training benefit by lowering the incline?" Instructors may benefit from testing themselves—they may try recording a class and critiquing their communication skills. Communicate proper technique with descriptive phrases that emphasize the essence of the exercise. Include only the most important cues. Cueing ahead, such as announcing the number of repetitions or what exercise is coming up next, will allow the participant to focus on the task at hand and be ready for the next movement. Be prepared to explain a specific movement pattern several ways to ensure understanding. Each exercise device exercise will provide cueing tips. Be aware of voice projections. Variation in voice tone and volume will produce more attention and maintain motivation. Be aware that sound travels in a straight line. If no public address system is in use, face participants when cueing. NON-VERBAL CUEING (DEMONSTRATION): Precise demonstration of each exercise can ensure proper and safe execution. For example, imagine the participants cannot hear the instructor. Be prepared to demonstrate each exercise several times prior to and throughout the exercise. Ensure good visibility throughout the class setting. Feel free to move around the class and demonstrate from a standing position. Perform the first demonstration of a movement slowly with clear, precise motion.

Group COACHING: Moving into the role of "coach" will be a natural progression after participants attend class on a regular basis and become educated and experienced with exercise device 100. For optimum results, try to encourage "regulars" to help role model in class. Try to place them in areas easily viewed by newer participants. This will also allow the instructor to move around the room and correct or compliment various techniques. SOME IMPORTANT TIPS WHEN COACHING GROUP: Be comfortable demonstrating exercise technique without always performing the exercise on the exercise device 100. Keep control of the whole group while addressing their needs in a supportive way. Recognize the variety of levels in class and pick your battles intelligently. HANDS-ON CORRECTIONAL TECHNIQUE: The following guidelines must be followed before hands-on correction can be utilized: First, ask for permission to use hands-on. Only use finger tips (never the whole hand). Be sensitive to body language (what a participant may be trying to say without verbalizing) When in doubt, do not touch. Re-explain or demonstrate again. Know and follow your individual health club rules and regulations. MUSIC: Music in GROUP: Strength classes provides motivation and speed of movement (tempo). It is important to remember that the tempo beats per minute (BPM) is only a guide. Participants should move at a comfortable pace, never sacrificing form or technique for speed of movement. Choose music that will motivate your students, selecting from a wide variety of styles and eras. Music from 125-128 BPM is ideal. In the exercise templates you will see the following tempo descriptions: Full Time—Use 8 beats per direction of movement Half Time—Use 4 beats per direction of movement Single Time—Use 2 beats per direction of movement Double Time/Pulses—Use 1 beat per direction of movement Beats in, Beats out—Use various beats per direction of movement Tempo: Feel free to start at the top of the musical phrase so that class can begin together. First set of a new movement pattern should be performed at a slow tempo to ensure easy learning of the movement pattern. Select tempo that ensures each movement can be performed through a full active range of motion and executed with control. The recommended tempo is 125-128 BPM.

Strength Class INTRODUCTION: Introduce yourself. Ask if there is anyone new to the class Ask if there are any medical issues of which you need to be aware Assure participants that they can change incline levels at any time throughout the workout to meet individual intensity demands Remind participants that the class is not a competition and that listening to one's own body is essential to training intelligently Describe the main components of the exercise device 100 and their function. ADJUSTING EXERCISE DEVICE 100: INCLINE LEVEL (TOWER): First, demonstrate how to change the incline levels on exercise device 100. Then allow each participant to do so. Have them adjust to level 6-8 in preparation for class. PULLEY PIN PLACEMENT: For all new participants, demonstrate how to adjust the pin placement on the LAT bars. Have them adjust to level 2 in preparation for class. TELESCOPING SQUAT STAND: Gauge squat stand height by ensuring patella does not cross anterior to the toes when in a 90° squat position. ADJUSTABLE FOOT HOLDER: Demonstrate how the foot holder swivels up into position and down while not in use. To simplify getting into and out of the foot holder, press the snap pin to remove the top section. LAT BARS: Demonstrate how the LAT bars are not only used as part of the adjustable pulley system, but can be lowered for pull-ups. EXERCISE DEVICE Set Up: Prior to beginning class, set up exercise device 100 for ease of transitions Incline level 6 to 8 Pulley pin placement on position 2 Squat stand set at level according to height of the individual (femur length) Pulley system detached from glideboard 330 LAT bars at full upright position Adjustable foot holder in down position.

GROUP SAFETY ASPECTS: CORRECT RESISTANCE LEVEL: Give participants permission to modify incline level (intensity) to maintain correct movement, form and tempo. If intensity is too high, encourage participant to lower incline or use feet to assist in movement. Incline guidelines given are based on an individual's ability to execute the exercise with control and correct form. The occurrence of muscle substitution and/or loss of exercise technique indicates that the intensity/incline level should be lowered. APPROPRIATE DRESS: Ensure that no loose clothing or hair can be caught in moving parts. Appropriate footwear and workout attire should be worn. MAINTAIN CONTROL OF THE GLIDEBOARD 330: During the GROUP Strength workout maintain control of the handles unless instructed otherwise. Perform all movements in control during both concentric and eccentric contractions. Ensure correct positioning on the glideboard 330. This promotes accurate exercise techniques, reduces injury risk and increases the quality of desired outcomes. PLACEMENT OF FEET: Avoid placing feet inside rails, due to risk of uncomfortable contact with glideboard 330. Always place feet outside the rails. RANGE OF MOTION (ROM): Stay within the normal pain-free range of joint and muscular movement during each exercise. Be aware of and sensitive to previous injuries that may limit ROM. BODY ALIGNMENT: Neutral joint positioning: During class, be aware of the positioning of all joints including normal curvature of the spine and neutral positions of the wrist, elbow, hip, knee and ankle. Engage core control: During resistance training it is important that the muscles of the thoracic are activated throughout the exercises. To ensure correct posture (neutral spine) and exercise technique, tone of the core muscles must be maintained. When the Hydraulic Amplifier Mechanism is activated by contraction of the transverse abdominous and internal/external obliques, trunk stabilization dramatically increases. Visually check to make sure crossbar is securely seated in tower level hook before beginning each exercise.

Group (Strength Fundamental)

An exemplary STRENGTH FUNDAMENTAL order of exercises is provided below: Introduction; 1. Squat bilateral; 2. Squat unilateral; 3. Toes out squat; Transition 1; 4. Lat pull down; 5. Arm pullover; 6. Pullover crunch; 7. Triceps press; Transition 2; 8. Chest press; Transition 3; 9. Seated row; 10. Single-arm row; 11. Seated biceps curl; Transition 4; 12. Seated torso rotation (L); Transition 5; 13. Seated torso rotation (R); Transition 6; 14. Bent leg incline crunch; 15. Hamstring curl; Transition 7; 16. Pull up; Transition 8; 17. Cool down routine. Each of these exercises or steps will be described in turn below.

Strength Fundamental Introduction

This introduction may take 5 minutes and may include an introduction to the make components that will be used in the exercise device 100, which include the tower, the glideboard 330, the rails, the pulley system and pin placement, the LAT bars, the telescoping squat stand, and the adjustable foot holder. Instruct participants how to adjust the telescoping squat stand, adjustable foot holder, LAT bars and pulley system. Have participant set up exercise device 100 ready for the first exercise. Briefly review the basic positioning on the glideboard 330. SAFETY ASPECTS: Select the correct resistance level. Check workout attire/hair. Maintain control of glideboard 330. Move in pain free range of motion. Ensure correct body alignment. SET UP: Incline levels 6-8. Pulley pin placement on 2. Squat stand set at level according to height of the individual (femur length). Glideboard 330 disengaged. LAT bars at full upright position. Adjustable foot holder in down position. INSTRUCTOR CUES: Adjust incline level to an appropriate resistance. Height of squat stand should be determined by femur length of participant. Disengage pulley system and place center pulley on top of tower for easy access. Ensure adjustable foot holder is in the down position. Straddle the glideboard 330 and sit at the bottom edge. Lie back on the glideboard 330, making sure head is fully supported. Place both feet on the squat stand shoulder width apart. TEMPO: 128 beats per minute (BPM).

Squat Bilateral—Quadriceps, Gluteus Maximus, Hamstrings

STARTING POSITION: Squatting—Push the glideboard 330 halfway up the rails, straddle it, and sit at the bottom edge. Lie back on the glideboard 330, making sure head is fully supported. Place both feet on the squat stand shoulder-width apart with heels towards the top. EXERCISE DESCRIPTION: Start with legs extended but NOT locked (slight bend at the knee), bend up to 90° of knee flexion and then extend up to the starting position. INCLINE GUIDELINES: Incline level 6-8 PROGRESSIONS/VARIATIONS: None. PULLEY PIN PLACEMENT: None. TEACHING TIPS: Maintain neutral spine throughout the entire exercise. Control movement in both directions. Drive heels into base during knee extension. In the case of joint pain, decrease the range of motion. Ensure that knees remain aligned with feet. SAFETY ASPECTS: Avoid flexion past 90°. Ensure knees track over ankles. Watch for the lumbar vertebrae arching away from glideboard 330. Do not lock knees at full knee extension. REPETITIONS: 8 Half time; 8 Single time; 4-3 Beat down, 1 beat up; 4-1 Beat down, 3 beats up; 16 Double time at the bottom; 8 Single time; 15 Beats of static at the bottom, 1 beat up. Total Time: 2 mins. TEMPO: Half time; Single time; Double time (shorter ROM); Static.

Squat—Unilateral Quadriceps, Gluteus Maximus, Hamstrings

STARTING POSITION: Squatting—Push the glideboard 330 halfway up the rails, straddle it and sit at the bottom edge. Lie back on the glideboard 330, making sure head is fully supported. Position one foot on the squat stand; the opposite leg is extended with the foot above the squat stand. EXERCISE DESCRIPTION: Start with legs extended but NOT locked (slight bend at the knee), bend up to 90°of knee flexion and then extend up to the starting position. INCLINE GUIDELINES: Incline level 6-8 PROGRESSIONS/VARIATIONS: None. PULLEY PIN PLACEMENT: None. TEACHING TIPS: Maintain neutral spine throughout the entire exercise. Position squatting leg at the line of gravity for balance. Drive heels into the base during extension. If joint pain is present, decrease the range of motion. Ensure that knee remains aligned with foot. SAFETY ASPECTS: Avoid flexion past 90°. Ensure knees track over ankles. Be aware of extended ribs and lumbar vertebrae arching away from the glideboard 330. Do not lock knees at full knee extension. TEMPO: Full time; Half time; Single time; Double time (shorter ROM).

REPETITIONS: 2 Half time; 8 Single time; 4-3 Beats down, 1 beat up; 8 Double time at the bottom; 7 Beats of static at the bottom, 1 beat up; 8 Single time. Total Time: 3 mins. (1 min. per side).

Toes Out Squat—Adductors, Gluteal Group, Quadriceps Group

STARTING POSITION: Squatting—Push the glideboard 330 halfway up the rails, straddle it and sit at the bottom edge. Lie back on the glideboard 330, making sure head is fully supported. Place both feet at the top corners of the squat stand, slightly everted with legs extended. With hands resting by hips on top of the glideboard 330, lift hips off of the glideboard 330 with shoulders providing the base of support. EXERCISE DESCRIPTION: Keeping hips elevated, lower the glideboard 330 down the rails by squatting with the legs until knees bend to 90°. With knees tracking over the ankles at all times, press feet against the squat stand to push the glideboard 330 back up the rails to the starting position. INCLINE GUIDELINES: Incline level 6-8 PROGRESSIONS/VARIATIONS: Bridge PULLEY PIN PLACEMENT: None. TEACHING TIPS: Keep abdominals engaged throughout movement to maintain hip elevation. Ensure that the knees track in the same plane as the ankle. Push through heels during knee extension. Head remains on glideboard 330. SAFETY ASPECTS: Avoid arching (extension) of the spine. Knees should track over ankles at all times. Keep the shoulder blades (scapula) in contact with the glideboard 330. Do not put pressure on the cervical vertebrae. TEMPO: Half Time; Single Time; Double Time. REPETITIONS: 8 Half Time; 16 Single Time; 8 Beats of static; 16 Beats of pulses; 8 Halftime. Total Time: 1 min.

Transition One

POSITION: Upright Supine. UPRIGHT SUPINE: Pulley system attached. Seated near bottom of glideboard 330. Heels placed on the bottom of glideboard 330 (heels below the gluteal muscles). Head resting on the top of glideboard 330. SET UP: Incline level 2-5. Pulley pin placement on 2. Glideboard 330 attached. LAT bars at full upright position. Adjustable foot holder in down position. INSTRUCTOR CUES: Lower incline level to an appropriate resistance. Remove pulley from the top of tower and attach it to glideboard 330. Ensure pulley pin placement is on 2. Holding handles, straddle glideboard 330 while facing the squat stand. With one handle in each hand, and with hands separated, sit at the bottom edge of glideboard 330. Lie back on glideboard 330, making sure head is fully supported with knees bent and feet resting on the bottom edge of glideboard 330.

Lat Pull Down—Latissimus Dorsi

STARTING POSITION: Upright Supine—Grasp handles and pull the glideboard 330 halfway up the rails, straddle it and sit at the bottom edge. Lie back on the glideboard 330, making sure head is fully supported with knees bent and feet resting on the bottom edge. Extend both arms over head. EXERCISE DESCRIPTION: With palms facing each other, pull the glideboard 330 up the rails by pulling the handles down until elbows are next to rib cage. Lower the glideboard 330 back down the rails by extending arms overhead until you return to the starting position. Repeat: INCLINE GUIDELINES: Incline level 2-5 PROGRESSIONS/VARIATIONS: None. PULLEY PIN PLACEMENT: 2. TEACHING TIPS: Lead with elbows while pulling glideboard 330 up the rails. If tension or pain is present during extension, decrease range of motion. Concentrate on using "lats" to facilitate the movement. SAFETY ASPECTS: Maintain neutral spine through range of motion. Do not bend wrists during any portion of the exercise (maintain neutral wrist position). Arms and hands should be parallel to body throughout movement. REPETITIONS: 16 Half time. Total Time: 30 secs. TEMPO: Half time.

Arm Pullover, Latissimus Dorsi

STARTING POSITION: Upright Supine—Lie back on the glideboard 330, making sure head is fully supported, with knees bent and feet resting on the bottom edge. Extend both arms over head. EXERCISE DESCRIPTION: In an arc motion, bring handles over the chest until they touch outer thighs, and slowly return to the starting position. INCLINE GUIDELINES: Incline level 2-5 PROGRESSIONS/VARIATIONS: None. PULLEY PIN PLACEMENT: 2. TEACHING TIPS: If tension or pain is present during the extension, decrease range of motion. Maintain cable tension throughout movement. Maintain a slight bend in the elbow throughout movement. SAFETY ASPECTS: Maintain neutral spine through range of motion. Be aware of shoulder impingements (pain). TEMPO: Half time; Full time. REPETITIONS: 16 Half time; 8 Full time. Total Time: 1 min.

Pullover Crunch—Legs Down Latissimus Dorsi, Abdominals

STARTING POSITION: Upright Supine—Lie back on the glideboard 330, making sure head is fully supported with knees bent and feet resting on the bottom edge. Extend both arms over head. EXERCISE DESCRIPTION: In an arc motion, bring the handles over chest until they touch outer thighs. Use abdominal muscles to raise head and shoulders 5 to 6 inches off of the glideboard 330, pushing the handles past thighs. Lie back on glideboard 330 while controlling handles back to the starting position. Repeat. INCLINE GUIDELINES: Incline levels 2-5 PROGRESSIONS/VARIATIONS: Lift feet off the glideboard 330, extending the legs away from the midline while maintaining neutral spinal position. PULLEY PIN PLACEMENT: 2. TEACHING TIPS: Curl up throughout pullover, feeling each vertebrae come up and down. Curl from abdomen, not the arms. Exhale on the way up. SAFETY ASPECTS: Maintain correct cervical spine position. Avoid using momentum. Maintain control. Be aware of excessive lordotic curve. REPETITIONS: 8 Half time; 32 Double time; 16 Beats peak contractions static. Total Time: 1 min. TEMPO: Half time; Double time; Static holds; Quickly (with control).

Triceps Press—Triceps

STARTING POSITION: Upright Supine—Lie back on the glideboard 330, making sure head is fully supported with knees bent and feet resting on the bottom edge. Keep elbows by side and bent at 90°, with hands in front and palms facing up. Position one: Elbows directly over the shoulders Position two: Elbows by the rib cage. EXERCISE DESCRIPTION: Keep elbows stationary and press down on the handles until arms are fully extended. Lower the glideboard 330 back down the rails by bringing the handles back to the starting position. INCLINE GUIDELINES: Incline level 2-5 PROGRESSION/VARIATIONS: Unilateral, static equilibrium PULLEY PIN PLACEMENT: 2. TEACHING TIPS: Maintain static elbows throughout movement. Maintain straight strong wrists (neutral). SAFETY ASPECTS: Avoid excessive movement of the upper arm. Avoid excessive wrist flexion. Do not lock elbows. TEMPO: Full time; Half time;

Static (single time on static reps only). REPETITIONS: 8 Half time, bilateral; 16 Single time, unilateral; 4 Half time static equilibrium; 8 Single time static equilibrium; 8 Double time static equilibrium. Total Time: 1 min. 30 secs.

Transition Two

POSITION: Seated Forward. SEATED FORWARD: Pulley system attached. Seated at top of glideboard 330 facing squat stand. Legs placed on glideboard 330 or dangling over the sides. SET UP: Incline level 2-5. Pulley pin placement on 2. Glideboard 330 attached. LAT bars at full upright position. Adjustable foot holder in down position. INSTRUCTOR CUES: Continue to hold handles, placing feet back on the ground. Straddle the glideboard 330 while facing the squat stand. Allow glideboard 330 to slide slowly down the rails by allowing the handles to move back toward tower. Sit toward the top edge of glideboard 330, facing squat stand. Place legs in front of body on glideboard 330.

Chest Press—Pectoral Group, Triceps

STARTING POSITION: Seated Forward—Grasp handles and pull the glideboard 330 halfway up the rails. Straddle the rails and sit toward the top edge of the glideboard 330, facing the squat stand. Place legs in front of you on the glideboard 330. Bring hands to the side of torso, just beneath underarms. EXERCISE DESCRIPTION: From an upright seated position, bring the glideboard 330 up the rails by extending the arms and pushing the handles straight out in front of chest. Return to starting position. INCLINE GUIDELINES: Incline levels 2-5 PROGRESSIONS/VARIATIONS: Unilateral (alternate arms) Static equilibrium (alternate arms) PULLEY PIN PLACEMENT: 2. TEACHING TIPS: Bring the handles together at the top of the movement to maximize contraction of the pectoral muscles. Pause momentarily at full extension. Maintain correct upright posture throughout movement. SAFETY ASPECTS: Maintain neutral wrist position. Maintain scapula retraction throughout movement. Control the eccentric movement to avoid abnormal shoulder extension. Ensure upright neutral spine throughout movement. REPETITIONS: 8 Halftime; 8 Halftime, Unilateral; 8 Halftime. Total Time: 1 min. TEMPO: Half time.

Transition Three

POSITION: Seated Backwards. Pulley system engaged. Seated at top of glideboard 330 facing tower. Legs dangle over the sides. SET UP: Incline level 2-5. Pulley pin placement on 1. Glideboard 330 attached. LAT bars at full upright position. Adjustable foot holder in down position. INSTRUCTOR CUES: Continue to hold handles, place feet back on the ground and straddle the glideboard 330. Step to the side of the glideboard 330 and turn around, transferring handles and facing tower. Straddle glideboard 330 and sit toward the top edge of the glideboard 330, allowing legs to hang over the sides.

Seated Row—Latissimus Dorsi, Posterior Deltoids

STARTING POSITION: Seated Backward—Facing the tower, grasp handles and pull glideboard 330 halfway up the rails. Straddle the rails and sit toward the top edge of the glideboard 330. Grasp handles with palms facing in and arms fully extended straight out in front. EXERCISE DESCRIPTION: From an upright-seated position, pull glideboard 330 up the rails by pulling the handles back, rib high, until hands reach the side of rib cage. Lower the glideboard 330 back down the rails by extending arms until returned to starting position. INCLINE GUIDELINES: Incline levels 2-5. PROGRESSIONS/VARIATIONS: None. PULLEY PIN PLACEMENT: 2. TEACHING TIPS: Maintain scapula retraction throughout movement. Flex elbows and pull the arms back next to the rib cage. Maintain neutral wrist position. Initiate the movement in the back by squeezing the shoulder blades together—scapular adduction and retraction. SAFETY ASPECTS: Ensure correct upright posture throughout movement. Avoid excessive contraction (extension) of the arms and lower back. At the end ROM, avoid excessive lordotic curve. Make sure that the exercise is performed without rocking the upper body. TEMPO: Half time; Single time. REPETITIONS: 4 Half time; 16 Single time, 3 beats in, 1 beat out; 4 Sets slow in, 4 sets slow out; 16 Single time, 1 beat in, 3 beats out. Total Time: 2 mins.

Single Arm Row—Both Handles Latissimus Dorsi, Posterior Deltoid

STARTING POSITION: Seated Backward—Facing the tower, grasp handles and pull glideboard 330 halfway up the rails. Straddle the rails and sit toward the top edge of the glideboard 330. Grasp both handles in one hand with palm facing in and arm fully extended straight out in front. EXERCISE DESCRIPTION: From an upright-seated position, pull the glideboard 330 up the rails by pulling the handles back, rib high, until hand reaches the side of rib cage of the active arm. Lower the glideboard 330 back down the rails by extending arm until you return to the starting position. INCLINE GUIDELINES: Incline levels 2-5. PROGRESSIONS/VARIATIONS: Tempo changes. PULLEY PIN PLACEMENT: 2. TEACHING TIPS: Maintain scapular retraction throughout movement. Lead with the elbow. Return with control. SAFETY ASPECTS: Ensure correct upright posture throughout movement. Avoid excessive contraction (extension) of the arms and lower back. At the end ROM, avoid excessive lordotic curve. Make sure that the exercise is performed without rocking the upper body. REPETITIONS: 4 Half time; 16 Single time, in and hold for 6, out 7-8; 4 Holds; 8 Single time; Total Time: 1 min. TEMPO: Half time; Single time.

Seated Biceps Curl—Biceps

STARTING POSITION: Seated Backward—Grasp handles and pull the glideboard 330 halfway up the rails. Straddle the rails and sit toward the top edge of the glideboard 330. Extend arms out in front with palms facing up. Do not allow feet to touch the floor. EXERCISE DESCRIPTION: With both arms extended toward the tower, pull the glideboard 330 up the rails by curling the handles up toward shoulders. Lower the glideboard 330 back down the rails by bringing the handles back down to the starting position. INCLINE GUIDELINES: Incline levels 2-5. PROGRESSION/VARIATIONS: Unilateral, static equilibrium. PULLEY PIN PLACEMENT: 2. TEACHING TIPS: Sit up as tall as possible, maintaining neutral spine throughout exercise. Begin with slight flexion at the elbow joint and curl to full flexion. Avoid excessive elbow movement. Return to the starting position with control. Focus on torso stabilizers to prevent additional lower body movement. SAFETY ASPECTS: Maintain cervical spinal curve, looking forward throughout movement. Avoid shoulder elevation. Maintain slight scapular retraction through this exercise. REPETITIONS: 8 Half time; 8 Alternating single time; 8 Half time; 8 Singles; Slow static equilibrium, to fast static equilibrium. Total Time: 1 min. 30 secs. VARIATION (Unilateral, Static Equilibrium): 4-3 Beats in, 1 beat out; 4-1 Beat in, 3 beats out. TEMPO: Half time; Single time.

Transition Four

POSITION: Seated Lateral. Pulley system engaged. Seated laterally at the top of glideboard 330. Legs straight and crossed. SET UP: Incline level 2-5. Pulley pin placement on 2. Glideboard 330 attached. LAT bars at full upright position. Adjustable foot holder in down position. INSTRUCTOR CUES: Continue to hold handles, placing feet back on the ground and straddle the glideboard 330. Step with both feet to the side of glideboard 330 allowing it to lower. Stand with back facing the glideboard 330. Sit toward the top edge of glideboard 330 facing sideways with legs extended in front of the body, feet crossed.

Seated Torso Rotation (Left)—Obliques, Isometric Contraction of Shoulders and Upper Back STARTING POSITION: Seated Lateral—Stand to the side of exercise device 100 with back facing the glideboard 330. Grasping both handles, pull the glideboard 330 halfway up the rails. Sit toward the top edge of the glideboard 330, facing perpendicular to the glideboard 330 with legs extended in front of body, feet crossed. Your feet should not touch the ground. EXERCISE DESCRIPTION: Grasp both handles with hands clasped, waist high on the side of the body closest to the tower. Using a twisting motion from the waist, bring the handle across the front of body until torso is rotated to the opposite side and handles are across the body at chest level. Slowly lower the glideboard 330 down the rails by bringing the handles back down across the body to the original starting position. INCLINE GUIDELINES: Incline levels 2-5. PROGRESSIONS/VARIATIONS: Low to high. PULLEY PIN PLACEMENT: 2. TEACHING TIPS: Concentrate on using the oblique and abdominal muscles to twist, rather than the arms. Hips stay fixed and square to glideboard 330 and shoulders are directly over hips. If the right shoulder is closest to the tower, place the right hand into the handles first, and vice versa. Keep hands at midline and eyes on hands with fixed cervical spine motion. Imagine that there is a large beach ball inside of arms so that you do not change the amount of elbow flexion through out the exercise. Sit up tall, maintaining a neutral spine. SAFETY ASPECTS: Avoid lower back injury by maintaining control of movement. Correct, neutral spine should be maintained throughout movements. Repeat: sit up tall. REPETITIONS: 8 Half time; 8 Small single time pulse. Total Time: 45 seconds. TEMPO: Half time; Single time. VARIATION: Low To High movement with handles.

Transition Five

POSITION: Seated Lateral. Pulley system engaged. Seated laterally at the top of glideboard 330. Legs straight and crossed. SET UP: Incline level 2-5. Pulley pin placement on 2. Glideboard 330 attached. LAT bars at full upright position. Adjustable foot holder in down position. INSTRUCTOR CUES: Continue to hold handles, placing feet back on the ground and stand up. Step with both feet to opposite side of glideboard 330. Stand with back facing glideboard 330, grasping both handles and pulling glideboard 330 halfway up the rails. Sit toward the top edge of glideboard 330 facing sideways with legs extended in front of the body, feet crossed.

Seated Torso Rotation (Right)—Obliques, Isometric Contraction of Shoulders and Upper Back STARTING POSITION: Seated Lateral—Stand to the side of exercise device 100 with back facing the glideboard 330. Grasp both handles and pull the glideboard 330 halfway up the rails. Sit toward the top edge of the glideboard 330 facing perpendicular to the glideboard 330 with both legs extended in front of the body, feet crossed. Feet should not touch the ground. EXERCISE DESCRIPTION: Grasp both handles with hands clasped, waist high on the side of the body closest to the tower. Using a twisting motion from the waist, bring the handle across the front of body until torso is rotated to the opposite side and handles are across the body at chest level. Slowly lower the glideboard 330 down the rails by bringing the handles back down across the body to the original starting position. INCLINE GUIDELINES: Incline levels 2-5. PROGRESSIONS/VARIATIONS: Low to high. PULLEY PIN PLACEMENT: 2. TEACHING TIPS: Concentrate on using the oblique and abdominal muscles to twist, rather than the arms. Hips stay fixed and square to glideboard 330 and shoulders are directly over hips. If the right shoulder is closest to tower, place the right hand into the handles first, and vice versa. Keep hands at midline and eyes on hands with fixed cervical spine motion. Imagine that there is a large beach ball inside of arms so that the amount of elbow flexion does not change through out the exercise. Sit up tall (maintain neutral spine). SAFETY ASPECTS: Avoid lower back injury by maintaining control of movement. Correct neutral spine should be maintained throughout movement. REPETITIONS: 8 Half time; 16 Double time. Total Time: 45 secs. TEMPO: Half time; Single time. VARIATION: Low To High movement with handles.

Transition Six

POSITION: Inverted Supine. Pulley system detached. Adjustable foot holder attached. Seated at top of glideboard 330 facing tower. Ankles secured in adjustable foot holder. Head resting on glideboard 330. SET UP: Incline level 2-5. Pulley system attached. Glideboard 330 attached. LAT bars at full upright position. Adjustable foot holder in attached, up position. INSTRUCTOR CUES: Stand up and release handles. Remove the pulley system from glideboard 330 and place it on the top of the tower. Push in the pin, allowing the adjustable foot holder to engage in the up position. Face the tower and straddle the rails. Sit on the top edge of glideboard 330. Raise top section of the adjustable foot holder (push pin) and place ankles on top of lower pads. Replace the top section so feet are secured between the upper and lower pads. Ensure the pin has locked into position. Lie back on glideboard 330 with legs extended straight and head fully supported.

Bent Leg Incline Crunch—Hamstring Group, Abdominals

STARTING POSITION: Inverted Supine—Face the tower and sit on the glideboard 330. Raise top section of the adjustable foot holder (push pin) and place ankles on top of lower pads. Replace the top section so feet are secured between the upper and lower pads. Ensure the pin has locked into position. Lie back on the glideboard 330 with legs extended straight and head fully supported. Point toes towards the tower. EXERCISE DESCRIPTION: Using heels, pull the glideboard 330 up the rails by flexing at the knee to at least a 90° angle. While maintaining knee flexion, place hands over chest or by sides. Raise head and shoulders off of the glideboard 330 by contracting the abdominal muscles. Lower shoulders back down to the glideboard 330 and repeat the abdominal crunch. INCLINE GUIDELINES: Incline levels 2-5. PROGRESSIONS/VARIATIONS: Oblique twists, trunk flexion with rotation. PULLEY PIN PLACEMENT: None. TEACHING TIPS: Begin with knees slightly flexed. Concentrate on curling up, using the abdominal muscles. Do not pull with the feet. Curl up as far as possible without disengaging the abdomen. Make sure that the exercise is performed without rocking the upper body. Maintain a neutral spine (avoid excessive cervical flexion). Place hands across chest, by side, or behind head. Slight hip external rotation can help reduce the hip flexor involvement. SAFETY ASPECTS: Maintain tone of hamstring to avoid losing neutral spine. Avoid excessive cervical flexion. Avoid full knee extension by maintaining slight knee bend at all times. TEMPO: Half time; Single time; Double time pulses; Static. REPETITIONS: 8 Half time; 16 Single time; 8 Halftime; 16 Double time; 16 Static hold at top; Total Time: 2 mins. VARIATION: Add Oblique Twist.

Hamstring Curl—Hamstring Group

STARTING POSITION: Inverted Supine—Face the tower and sit on the glideboard 330. Raise top section of the adjustable foot holder (push pin) and place ankles on top of lower pads. Replace the top section so feet are secured between the upper and lower pads. Ensure the pin has locked into position. Lie back on the glideboard 330 with legs extended straight and head fully supported. Point toes towards the tower. EXERCISE DESCRIPTION: Using heels, pull the glideboard 330 up the rails by flexing at the knee to at least a 90° angle. Lower the glideboard 330 back down the rails by extending the legs. Allow for slight bend at the knee to ensure good lumbar curvature. INCLINE GUIDELINES: Incline levels 2-5. PROGRESSIONS/VARIATIONS: None. PULLEY PIN PLACEMENT: None. TEACHING TIPS: Start and finish this exercise with slight knee flexion. Concentrate on curling through the heels. Maintain a neutral spine (avoid excessive lumbar curvature). Place hands across chest, or hips on top of glideboard 330. SAFETY ASPECTS: Maintain tone of hamstring to avoid losing neutral spine. Avoid rotation of knees by keeping knees aligned with ankles. REPETITIONS: 8 Half time; 8-3 Beats down, 1 beat up; 8-1 Beat down, 3 beats up; 2 Full time; 8 Half time. Total Time: 1 min: 30 secs. TEMPO: Half time; Full time.

Transition Seven

POSITION: Upright Prone. Pulley system disengaged. LAT bars lowered to pull-up position. Facing the tower, lie face down with chest across the top edge of glideboard 330. Hands grasp pull-up bar. Knees bent. SET UP: Incline level 5-8. Pulley system detached. Glideboard 330 disengaged. LAT bars at lowered to pull-up position. Adjustable foot holder in down position. INSTRUCTOR CUES: Sit up and raise top section of the adjustable foot holder by pushing in pin. Carefully remove ankles from the lower pad and lower adjustable foot holder. Stand up and move to the LAT bars, lowering them to the pull up position. Raise incline to preferred resistance. Push the glideboard 330 halfway up the rails. Lie on the glideboard 330 with head toward the tower and chest at the top edge of the glideboard 330. Grasp the LAT bars with palms facing down.

Pull Up—Latissimus Dorsi, Rhomboids, Teres Major

STARTING POSITION: Upright Prone—Push the glideboard 330 halfway up the rails. Lie on the glideboard 330 with head toward the tower and chest at the top edge of the glideboard 330. Grasp the LAT bars with palms facing down. Bend knees so lower legs are perpendicular to the glideboard 330. EXERCISE DESCRIPTION: Begin with arms fully extended and pull the glideboard 330 up the rails until full adduction of the shoulder and upper arm is complete. Lower the glideboard 330 back down the rails until arms are fully extended. INCLINE GUIDELINES: Incline levels 5-8. PROGRESSIONS/VARIATIONS: None. PULLEY PIN PLACEMENT: None. TEACHING TIPS: Concentrate on leading with the elbows (pulling elbows down toward ribs). Maintain a neutral spine (avoid excessive thoracic curvature). Do not lift chest off the glideboard 330 and maintain a neutral cervical spine by continuing to look down throughout movement. Maintain scapular retraction and depression. SAFETY ASPECTS: Maintain neutral wrist throughout this exercise. Be aware of shoulder impingements (pain). START FINISH REPETITIONS: 16 Halftime; 16-3 Beats up 1 down; 7 up 1 down, 1 up 3 down, 1 up 7 down; 4-3 Beats up, 1 beat down; Hold up for 7 beats, come down slowly 8 Half time. Total Time: 1 min. TEMPO: Full Time; Half Time; Static at various ROM, pulsing at top position.

Transition Eight

POSITION: Seated Forward (using squat stand). Pulley system disengaged. Seated at bottom of glideboard 330 facing squat stand. Legs placed on squat stand. SET UP: Incline level 5-8. Squat stand set a level according to individual's femur length. Glideboard 330 disengaged. LAT bars lowered to pull-up position. Adjustable foot holder in down position. INSTRUCTOR CUES: Release LAT bars, allowing the glideboard 330 to lower. Straddle glideboard 330 and stand up. Turn around to face squat stand. Sit at the bottom edge of the glideboard 330. Place both feet on the squat stand, shoulder-width apart.

Cool Down Routine

STARTING POSITION: Seated upright at the bottom of the glideboard 330 with legs placed on the squat stand, shoulder-width apart. INCLINE GUIDELINES: Incline levels 5-8. PULLEY PIN PLACEMENT: None. INSTRUCTOR CUES: Slow and controlled. Passive and active range of motion achieved. Breath through stretches. TEMPO: Slow and controlled. REPETITIONS: One each side.

STRETCHING SERIES (In order): 1. PIRIFORMIS STRETCH: Cross the ankle of one leg over the knee of the opposite leg. Think of the stretch as making the shape of a "4" with the legs. Slowly allow the glideboard 330 to slide down the rails until there is a stretch along the outside of the gluteal muscles. If there is any gluteal pain, slowly back out of the stretch until only a mild stretch along the hip and gluteal section is felt. 2. HAMSTRING STRETCH: Lie back on the glideboard 330. Keep one leg supporting weight with slight knee flexion. Bring the opposite leg with knee bent toward the body, hold this position and then straighten the knee actively. 3. SIDE-LYING QUADRICEPS STRETCH: Assume a side-lying position. Pull the top leg back by holding just below the ankle. Repeat for both legs. 4. LOWER BACK STRETCH: Sit up with both feet on the squat stand and flex forward at the hips and lower back. Reach forward with arms extended. 5. SEATED DELTOIDS STRETCH: Cross one arm over and in front of the chest. With shoulders pulled down away from the ears, pull the arm in front of the chest toward the torso using the other arm. 6. SEATED TRICEPS STRETCH: Bring the arms overhead, extending through the fingertips. Allow one arm to drop behind the head and down the back, with flexion at the elbow. Additional stretch can be achieved by pushing down on elbow. 7. GLUTEAL STRETCH: Lie back on the glideboard 330 with one foot supported on the squat stand. Pull the opposite knee toward the chest while the lumbar spine maintains contact with the glideboard 330. 8. UPPER BACK STRETCH: Reach forward with arms, allowing the scapulae to abduct and rotate. 9. CALF STRETCH: Place toes at the bottom of the squat stand, allowing heels to be free of support. Allow glideboard 330 to lower as you move feet into a dorsi-flexed position. 10. HANGING STRETCH: Lie back on glideboard 330. Reach and grab LAT bars. Remove legs from squat stand. Hang freely.

Group (Strength Plus)

An exemplary STRENGTH PLUS order of exercises is provided below: Introduction; 1. Squat bilateral; 2. Squat unilateral; 3. Squat plyometric; 4. Single leg lateral squat; 5. Toes out squat; Transition 1; 6. Lat pull down; 7. Arm pullover; 8. Pullover crunch; 9. Triceps press; Transition 2; 10. Chest press; Transition 3; 11. Seated torso rotation (L); 12. Single arm chest fly (L); 13. Single arm biceps curl; Transition 4; 14. Seated torso rotation (R); 15. Single arm chest fly (R); 16 Single arm biceps curl (R); Transition 5; 17. Seated row; 18. Single-arm row; 19. Seated row—high elbow; Transition 6; 20. Seated biceps curl; 21. Hip abduction; Transition 7; 22. Bent leg incline crunch; 23. Hamstring curl; Transition 8; 24. Pull up; Transition 9; 25. Cool down routine. Each of these exercises or steps will be described in turn below.

STRENGTH PLUS INTRODUCTION (SEE STRENGTH FUNDAMENTAL INTRODUCTION ABOVE)

SQUAT BILATERAL (SEE SQUAT BILATERAL ABOVE)

SQUAT UNILATERAL (SEE SQUAT UNILATERAL ABOVE)

SQUAT PLYOMETRICS (BILATERAL)—QUADRICEPS, GLUTEUS MAXIMUS HAMSTRINGS

STARTING POSITION: Squatting—Push the glideboard 330 halfway up the rails, straddle it and sit at the bottom edge. Lie back on the glideboard 330, making sure head is fully supported. Place both feet shoulder-width apart on the squat stand. Bend knees to a squatting position. EXERCISE DESCRIPTION: Accelerate with power and propel away from the squat stand, landing with both feet on the squat stand. Control the deceleration. INCLINE GUIDELINES: Incline level 6-8. PROGRESSIONS/VARIATIONS: Feet move between 10 and 2 o'clock positions. (Parallel skiing action). PULLEY PIN PLACEMENT: None. TEACHING TIPS: Push or propel with force away from squat stand, landing with control. When feet hit the squat stand, land softly and immediately push forcefully against the squat stand to facilitate an explosive, bouncing motion. Decrease range of motion if there is any knee discomfort. SAFETY ASPECTS: Individuals with knee problems should continue with controlled bilateral squatting. Extend legs on the acceleration without locking the knees. Do not allow glideboard 330 to bottom out. Control the push off the squat stand to avoid glideboard 330 hitting stoppers. REPETITIONS: 32 Half time. Total Time: 30 secs. TEMPO: Halftime.

Squat Plyometrics (Unilateral)—Quadriceps, Gluteus Maximus, Hamstrings

STARTING POSITION: Squatting—Push the glideboard 330 halfway up the rails, straddle it and sit at the bottom edge. Lie back on the glideboard 330, making sure head is fully supported. Place one foot flat on the squat stand and extend opposite leg with foot above the stand. Bend the knee of the active leg until you are in a single leg squatting position. EXERCISE DESCRIPTION: Accelerate with power and propel away from the squat stand, landing with the opposite foot on the stand and control the deceleration. Repeat with alternating legs. INCLINE GUIDELINES: Incline level 6-8. PROGRESSIONS/VARIATIONS: None. PULLEY PIN PLACEMENT: None. TEACHING TIPS: Push or propel with force away from squat stand, landing with control. When foot hits the squat stand, land softly and immediately push forcefully against the squat stand to facilitate an explosive, bouncing motion. SAFETY ASPECTS: Individuals with knee problems should continue with unilateral or bilateral squatting. Extend legs on the acceleration without locking knees. Do not allow glideboard 330 to bottom out. TEMPO: Half time. REPETITIONS: 32 Half time. Total Time: 1 min. (30 secs per side).

Single Leg Lateral Squat Quadriceps Group, Hip Extensors

STARTING POSITION: Squatting—Lie on one side with shoulders and hips stacked so that the top leg is placed at the top forward corner of the squat stand and the bottom leg is curled behind the body. EXERCISE DESCRIPTION: Start with legs extended but NOT locked (slight bend at the knee), bend up to 90° of knee flexion and then extend up to the starting position. INCLINE GUIDELINES: Incline level 6-8. PULLEY PIN PLACEMENT: None. TEACHING TIPS: Ensure shoulders and hips are stacked above each other. Maintain neutral spine throughout range of motion. Drive heels into the base as you come up. Ensure knees track over ankles. SAFETY ASPECTS: Avoid flexion past 90°. Knees track over ankles. Be aware of extended ribs and lumbar vertebrae arching away from the glideboard 330. Do not lock knees. REPETITIONS: 2 Half time; 8 Single time; 4-3 Beat down, 1 beat up; 4-1 Beat down, 3 beat up; 8 Double time; 7 Beats of static at bottom, 1 beat to come up; 8 Single time. Total Time: 2 mins. (1 min. per side). TEMPO: Half time; Single time; Double time (shorter ROM).

TOES OUT SQUAT ADDUCTORS (SEE TOES OUT SQUAT ADDUCTORS ABOVE)

TRANSITION ONE (SEE TRANSITION ONE ABOVE)

LAT PULL DOWN (SEE LAT PULL DOWN ABOVE)

ARM PULLOVER (SEE ARM PULLOVER ABOVE)

PULLOVER CRUNCH (SEE PULLOVER CRUNCH ABOVE)

TRICEPS PRESS (SEE TRICEPS PRESS ABOVE)

TRANSITION TWO (SEE TRANSITION TWO ABOVE)

CHEST PRESS (SEE CHEST PRESS ABOVE, VARIATIONS INCLUDE INCLINE PRESS, DECLINE PRESS, UNILATERAL, STATIC)

TRANSITION THREE

POSITION: Seated Lateral. Pulley system engaged. Seated laterally at the top of glideboard 330. Legs straight and crossed. SET UP: Incline levels 2-5. Pulley pin placement on 2. Glideboard 330 attached. LAT bars at full upright position. Adjustable foot holder in down position. INSTRUCTOR CUES: Continue to hold handles, place feet back on the ground and straddle the glideboard 330. Step with both feet to the side of the glideboard 330 allowing it to lower. Stand with back facing the glideboard 330. Sit toward the top edge of the glideboard 330 facing sideways with legs extended in front of the body, feet crossed.

Seated Torso Rotation—Left (See Seated Torso Rotation—Left Above) Single Arm Chest Fly (Left)—Left Pectoralis, Anterior Deltoid STARTING POSITION: Seated Lateral—Sit toward the top edge of the glideboard 330 facing perpendicular to the glideboard 330 with both legs extended in front of the body, feet crossed. Your feet should not touch the ground. Grasping handles, the hand closest to the tower is fully extended and the opposite hand is held close to the torso/hip with a bent elbow. EXERCISE DESCRIPTION: Example: with left arm extended toward the ladder, pull the arm in an arc motion to the front mid-line of the body. Slowly lower the glideboard 330 down the rails by bringing the handle back across body to the original starting position. Right hand remains fixed close to torso/hip throughout the movement. INCLINE GUIDELINES: Incline levels 2-5 PROGRESSIONS/VARIATIONS: Angle variation—low to high. PULLEY PIN PLACEMENT: 2. TEACHING TIPS: Sit up as tall as possible, maintaining neutral spine throughout exercise. Begin with slight flexion at the elbow joint and maintain elbow flexion throughout the exercise. Return to the starting position with control. Focus on torso stabilizers to prevent additional lower body movement. SAFETY ASPECTS: Maintain scapular retraction throughout movement. Control the eccentric movement to avoid abnormal shoulder extension. Ensure upright neutral spine throughout movement. REPETITIONS: 2 Full time, 12 Half time. Total Time: 1 min. TEMPO: Full time, Half time.

Single Arm Biceps Curl (Left)—Left Biceps

STARTING POSITION: Seated Lateral—Sit toward the top edge of the glideboard 330 facing perpendicular to the glideboard 330 with both legs extended in front of the body, feet crossed. Your feet should not touch the ground. Grasping handles, the hand closest to the tower is fully extended and the opposite hand is held close to the torso/hip with a bent elbow. EXERCISE DESCRIPTION: Example: with left arm extended toward the ladder, pull the glideboard 330 up the rails by curling the handle in toward left shoulder. Lower the glideboard 330 back down the rails by bringing the handle back down to the starting position. Right hand remains fixed close to torso/hip throughout the movement. INCLINE GUIDELINES: Incline levels 2-5. PROGRESSIONS/VARIATIONS: None. PULLEY PIN PLACEMENT: 2. TEACHING TIPS: Sit up as tall as possible, maintaining neutral spine throughout exercise. Begin with slight flexion at the elbow joint and curl to full flexion. Maintain a static elbow position throughout movement. Focus on torso stabilizers to prevent additional lower body movement. SAFETY ASPECTS: Maintain neutral spine, looking forward throughout movement. Avoid shoulder elevation and maintain slight scapular retraction. Avoid muscle substitution. FINISH TEMPO: Half time, Single time. REPETITIONS: 8 Half time; 16 Single time; 8-3 Beats in, 1 beat out; 8-1 Beat in, 3 beat out; Total Time: 1 min.

TRANSITION FOUR (SEE TRANSITION FOUR ABOVE)

SEATED TORSO ROTATION—RIGHT (SEE SEATED TORSO ROTATION—RIGHT ABOVE)

SINGLE ARM CHEST FLY (RIGHT)—RIGHT PECTORALIS, ANTERIOR DELTOID

STARTING POSITION: Seated Lateral—Sit toward the top edge of the glideboard 330 facing perpendicular to the glideboard 330 with both legs extended in front of the body, feet crossed. Feet should not touch the ground. Grasping handles, the hand closest to the tower is fully extended and the opposite hand is held close to the torso/hip with a bent elbow. EXERCISE DESCRIPTION: Example: with left arm extended toward the ladder, pull the arm in an arc motion to the front mid-line of the body. Slowly lower the glideboard 330 down the rails by bringing the handle back across body to the original starting position. Left hand remains fixed close to torso/hip throughout the movement. INCLINE GUIDELINES: Incline level 2-5. PROGRESSIONS/VARIATIONS: Tempo variation, and varying angle of pull PULLEY PIN PLACEMENT: 2. TEACHING TIPS: Sit up as tall as possible, maintaining neutral spine throughout exercise. Begin with slight flexion at the elbow joint and maintain elbow flexion throughout the exercise. Return to the starting position with control. Focus on torso stabilizers to prevent additional lower body movement. SAFETY ASPECTS: Maintain scapula retraction throughout movement. Control the eccentric movement to avoid abnormal shoulder extension. Ensure upright neutral spine throughout movement. REPETITIONS: 2 Full time; 12 Half time. Total Time: 1 min. TEMPO: Full time; Half time.

Single Arm Biceps Curl (Right)—Right Biceps

STARTING POSITION: Seated Lateral—Sit toward the top edge of the glideboard 330 facing perpendicular to the glideboard 330 with both legs extended in front of the body, feet crossed. Feet should not touch the ground. Grasping handles, the hand closest to the tower is fully extended and the opposite hand is held close to the torso/hip with a bent elbow. EXERCISE DESCRIPTION: Example: with right arm extended toward the ladder, pull the glideboard 330 up the rails by curling the handle in towards left shoulder. Lower the glideboard 330 back down the rails by bringing the handle back down to the starting position. Left hand remains fixed, close to torso/hip throughout the movement. INCLINE GUIDELINES: Incline levels 2-5. PROGRESSIONS/VARIATIONS: Tempo, static holds PULLEY PIN PLACEMENT: 2. TEACHING TIPS: Sit up as tall as possible, maintaining neutral spine throughout exercise. Begin with slight flexion at the elbow joint and curl to full flexion. Maintain a static elbow position throughout movement. Focus on torso stabilizers to prevent additional lower body movement. SAFETY ASPECTS: Maintain neutral spine, looking forward throughout movement. Avoid shoulder elevation and maintain slight scapular retraction. Avoid muscle substitution. TEMPO: Single time. REPETITIONS: 8 Single time; 8-3 Beats in, 1 beat out; 8-1 Beats in, 3 beats out; Total Time: 1 min.

TRANSITION FIVE

POSITION: Seated backwards. Pulley system attached. Seated at top of glideboard 330 facing tower. Legs hang over the sides. SET UP: Incline level 2-5. Pulley pin placement on 2. Glideboard 330 attached. LAT bars at full upright position. Adjustable foot holder in down position. INSTRUCTOR CUES: Continue to hold handles. Place feet back on the ground and stand up. Facing the tower, straddle glideboard 330 and sit toward the top edge. Allow legs to hang over the sides of glideboard 330.

SEATED ROW (SEE SEATED ROW ABOVE)

SINGLE ARM ROW (SEE SINGLE ARM ROW ABOVE)

SEATED ROW (HIGH ELBOW)—POSTERIOR DELTOIDS, RHOMBOIDS

STARTING POSITION: Seated Backward—Facing the tower, grasp handles and pull glideboard 330 halfway up the rails. Straddle the rails and sit toward the top edge of the glideboard 330. Grasp handles with palms facing down and arms fully extended straight out in front. EXERCISE DESCRIPTION: From an upright-seated position, pull the handles toward shoulders, leading with elbows. Pull elbows just past midline of the body and below shoulder height. Lower the glideboard 330 back down the rails by extending arms until you return to the starting position. INCLINE GUIDELINES: Incline levels 2-5. PROGRESSION/VARIATIONS: Static hold at end of range of motion. PULLEY PIN PLACEMENT: 2 TEACHING TIPS: Maintain scapula retraction throughout movement. Lead with the elbows, but allow them to move no higher than the shoulders. Do not let allow elbow flexion to be less than 90°. Pull elbows just past midline of the torso. Return with control. SAFETY ASPECTS: Avoid shoulder impingement by keeping elbow below shoulder height. Ensure correct upright posture (no arching) throughout movement. REPETITIONS: 16 Halftime. Total Time: 30 secs. TEMPO: Half time.

TRANSITION SIX

POSITION: Seated Backwards. Pulley system engaged. Seated at top of glideboard 330 facing tower. Legs dangle over the sides. SET UP: Incline level 2-5. Pulley pin placement on 1. Glideboard 330 attached. LAT bars at full upright position. Adjustable foot holder in down position. INSTRUCTOR CUES: Continue to hold handles, place feet back on the ground and straddle the glideboard 330. Step with both feet to the side of the glideboard 330 allowing the glideboard 330 to lower. Release both handles and step to the back of the LAT bars. Change the pin placement to 1. Grasping both handles, once again straddle the glideboard 330 facing the tower. Sit toward the top edge of the glideboard 330 allowing legs to hang over the sides.

Seated Biceps Curl—Biceps

STARTING POSITION: Seated Backward—Grasp handles and pull the glideboard 330 halfway up the rails. Straddle the rails and sit toward the top edge of the glideboard 330. Extend arms out in front with palms facing up. Do not allow feet to touch the floor. EXERCISE DESCRIPTION: With both arms extended toward the tower, pull the glideboard 330 up the rails by curling the handles up toward shoulders. Lower the glideboard 330 back down the rails by bringing the handles back down to the starting position. INCLINE GUIDELINES: Incline levels 2-5. PROGRESSION/VARIATIONS Unilateral, static equilibrium. PULLEY PIN PLACEMENT: 1. TEACHING TIPS: Sit up as tall as possible, maintaining neutral spine throughout exercise. Begin with slight flexion at the elbow joint and curl to full flexion. Avoid excessive elbow movement. Return to the starting position with control. Focus on torso stabilizers to prevent additional lower body movement. SAFETY ASPECTS: Maintain cervical spinal curve, looking forward throughout movement. Avoid shoulder elevation. Maintain slight scapular retraction through this exercise. REPETITIONS: 8 Half time 8 Alternating single time 8 Half time 8 Singles Slow static equilibrium, to fast static equilibrium. Total Time: 1 min. 30 secs. VARIATION: 4-3 Beats in, 1 beat out; 4-1 Beat in, 3 beats out; TEMPO: Half time; Single time. Variation (Unilateral, Static Equilibrium).

Hip Abduction—Gluteus Medius and Minimus, Piriformis

STARTING POSITION: Seated Backward—Grasp handles and pull the glideboard 330 halfway up the rails. Straddle the rails and sit toward the top edge of the glideboard 330, facing the tower. Extend feet directly in front, with the cables resting gently against the outside of feet. Keep the handles just outside knees. EXERCISE DESCRIPTION: Pull the glideboard 330 up the rails by pressing feet outward against the inside of the cables, keeping arms stationary and slightly extended. Lower the glideboard 330 back down the rails by allowing feet to move back in toward the rails to return to the starting position. INCLINE GUIDELINES: Incline levels 2-5. PROGRESSIONS/VARIATIONS: None. PULLEY PIN PLACEMENT: 1. TEACHING TIPS: Remain upright throughout the exercise—sit up tall. Slight eversion of the feet with toes pointed out. Maintain tension on the cables at all times. Abduct the legs as far as form and control can be maintained. Start with a slight amount of hip internal rotation and maintain the hip position throughout this exercise. SAFETY ASPECTS: Ensure correct upright posture throughout movement. Avoid any ballistic movement. TEMPO: Single time; Double time; Static count. REPETITIONS: 8 Single time; 4-3 Beat out, 1 beat in; 8 Double time; 16 Static beats out, 1 beat 1; Total Time: 1 min.

TRANSITION SEVEN (SEE TRANSITION SIX OF STRENGTH FUNDAMENTAL)

BENT LEG INCLINE CRUNCH (SEE BENT LEG INCLINE CRUNCH ABOVE)

HAMSTRING CURL (SEE HAMSTRING CURL ABOVE, except Total Time of 1 min. 30 secs.)

TRANSITION EIGHT (SEE TRANSITION SEVEN OF STRENGTH FUNDAMENTAL)

PULL UP (SEE PULL UP STRENGTH FUNDAMENTAL)

TRANSITION NINE (SEE TRANSITION EIGHT OF STRENGTH FUNDAMENTAL)

COOL DOWN (SEE COOL DOWN OF STRENGTH FUNDAMENTAL)

ADVANCED GROUP: BLAST SERIES™

BICEPS AND TRICEPS BLAST

Biceps and Triceps Blast Introduction: The Biceps & Triceps Blast Series™ was designed to introduce clients to the exercise device 100 with a concentrated, high intensity workout focusing on the upper arm musculature. The exercises are performed in a circuit type fashion with minimal rest periods. Participants should warm up for 6-8 minutes with light, multi-joint exercises to prepare the body for heavy work. The estimated time allotment for the workout is 15 minutes.

INTRODUCTION TO EXERCISE DEVICE 100: Tower—how to adjust intensity. Glideboard 330 & pulley system—how to attach pulley. Pulley pin placement—how to adjust. Dip Bars—how to adjust to stored position (parallel to glideboard 330). ACCESSORIES Dip Bars. SAFETY ASPECTS Select appropriate resistance level. Check workout attire/hair. Pain free range of motion. Neutral joint positions. PRIMARY MUSCULATURE Triceps Brachii; Biceps Brachii; Brachialis; Brachioradialis; Pectoral Group; Deltoids; Coracobrachialis; Anconeus; Wrist Extensors/Flexors. The following is an exemplary order of exercises and steps for the Biceps and Triceps Blast workout. Each of the exercises and steps are described in turn.

Biceps and Triceps Blast Set-Up

POSITION: Upright Supine with Dip Bars. EXERCISE: Triceps Dip. SET UP: Pulley pin placement—n/a. Level—4-8. Dip Bars—installed. Glideboard 330—no pulley. LAT bars—upright. Adjustable foot holder—down. INSTRUCTOR CUES: Adjust incline to a challenging level. Install Dip Bars to upright position. Push the glideboard 330 halfway up the rails. Straddle the glideboard 330 and sit at the lower portion facing the squat stand. Lie back, ensuring the head is fully supported. Grasp Dip Bars with arms fully extended and feet on the bottom portion of the glideboard 330.

TRICEPS DIP (SEE TRICEPS DIP, PERSONAL TRAINING)

TRANSITION ONE

POSITION: Seated backward. EXERCISE: Seated Biceps Curl. SET UP: Dip Bars—parallel to glideboard 330

(stored). Pulley pin placement—2. Level—3-5. Glideboard 330—pulley attached. LAT bars—upright. Adjustable foot holder—down. INSTRUCTOR CUES: Straddle the glideboard 330 and stand up. Remove dip bars and place in stored position. Attach the pulley to the glideboard 330. Ensure pulley pin placement is on 2. Holding handles, straddle the glideboard 330 facing the tower and sit on the top edge of glideboard 330. Extends arms directly toward the pulleys with palms facing up.

SEATED BICEPS CURL (SEE SEATED BICEPS CURL, PERSONAL TRAINING)

STATIC SEATED BICEPS CURL (SEE SEATED BICEPS CURL, PERSONAL TRAINING)

SEATED SHOULDER EXTENSION (SEE SEATED SHOULDER EXTENSION, PERSONAL TRAINING)

TRANSITION TWO

POSITION: Kneeling backward. EXERCISE: Kneeling Triceps Kickback. SET UP: Dip Bars—parallel to glideboard 330 (stored). Pulley pin placement—2. Level—3-5. Glideboard 330—pulley attached. LAT bars—upright. Adjustable foot holder—down. INSTRUCTOR CUES: Straddle the glideboard 330 and stand up. Place hands/knuckles down on top of glideboard 330 to stabilize. Kneel at the top edge of the glideboard 330 facing the tower. Keeping the elbows close to the rib cage, lower torso over knees.

KNEELING TRICEPS KICKBACK (SEE KNEELING TRICEPS KICKBACK, PERSONAL TRAINING)

REVERSE GRIP STATIC KICKBACK

STARTING POSITION: Grasp handles and pull the glideboard 330 halfway up the rails. Place hands, knuckles down, on the glideboard 330 to stabilize movement. Kneel at the top edge of the glideboard 330 facing the tower. Keeping the elbows in tight to the rib cage, lower torso over the knees. Bend elbows with palms facing up. EXERCISE DESCRIPTION: Keeping elbows stationary, press down on the handles until arms are fully extended next to the thighs. Lower the glideboard 330 back down the rails by bringing the handles back to the starting position. PULLEY PIN PLACEMENT: 2. TEACHING TIPS: Maintain the elbows close to the rib cage throughout the exercise. Straighten elbows to just short of a full extension and isometrically contract the triceps for one to two seconds. Maintain neutral wrists. SAFETY ASPECTS: Avoid hyper-extending the cervical spine, keeping the head in line with the spine throughout the exercise. Do not swing the handles back and forth during the movement. Do not allow elbows to drop during movement. Avoid movement at the shoulder throughout the exercise. TEMPO: Double time. REPETITIONS: 16 Double time. Total Time: 16 secs.

TRANSITION THREE

POSITION: Inverted supine. EXERCISE: Supine Biceps Curl. SET UP: Dip Bars—parallel to glideboard 330 (stored). Pulley pin placement—2. Level—3-5. Glideboard 330—pulley attached. LAT bars—upright. Adjustable foot holder—down. INSTRUCTOR CUES: Place hands, knuckles back down on top of the glideboard 330. Straddle the glideboard 330 and stand up. Sit at the top portion of the glideboard 330. Lie back, ensuring the head is supported. Place feet on top of glideboard 330 with arms extended toward the pulleys.

SUPINE BICEPS CURL (SEE SUPINE BICEPS CURL, PERSONAL TRAINING)

STATIC SUPINE BICEPS CURL (SEE SUPINE BICEPS CURL, PERSONAL TRAINING)

TRANSITION FOUR

POSITION: Upright supine. EXERCISE: Triceps Press Down. SET UP: Dip Bars—parallel to glideboard 330 (stored). Pulley pin placement—2. Level—3-5. Glideboard 330—pulley attached. LAT bars—upright. Adjustable foot holder—down. INSTRUCTOR CUES: Continue to hold handles, carefully move to seated position. Straddle the glideboard 330 and stand up. Step with both feet to the side of the glideboard 330. Straddle glideboard 330, facing away from the tower. Sit at the bottom portion of the glideboard 330. Lie back ensuring head is fully supported. Place feet on bottom edge of the glideboard 330 with upper arms in tight by ribcage with elbows bent at least 90°.

TRICEPS PRESS DOWN (SEE TRICEPS PRESS DOWN, PERSONAL TRAINING)

STATIC TRICEPS PRESS DOWN (SEE TRICEPS PRESS DOWN, PERSONAL TRAINING)

TRANSITION FIVE

POSITION: Seated lateral. EXERCISE: Lateral Biceps Curl. SET UP: Dip Bars—parallel to glideboard 330 (stored). Pulley pin placement—2. Level—3-5. Glideboard 330—pulley attached. LAT bars—upright. Adjustable foot holder—down. INSTRUCTOR CUES: Place feet on floor and straddle the glideboard 330. Step with both feet to the right side of the glideboard 330. Stand with back facing the glideboard 330. Sit toward the center of the glideboard 330 facing sideways with legs extended in front of the body, feet crossed. Grasp one handle with hand closest to the tower. Extend the active arm toward the pulley at shoulder level with resting hand on the hip. Switch body position to opposite side after one complete set to train the other arm.

Lateral Biceps Curl (Right)—Biceps, Brachialis, Brachioradialis)

STARTING POSITION: Stand to the side of the exercise device 100 with back facing the rails. Grasp the closest handle and pull the glideboard 330 halfway up. Sit toward the top edge of the glideboard 330 facing sideways with both legs extended straight out. Feet should not touch the ground. Extend active arm toward the pulley at shoulder level. Place the inactive hand on hip or the glideboard 330. EXERCISE DESCRIPTION: With a slight bend in the elbow, slowly pull the glideboard 330 up the rails by curling the handle up toward the shoulder, keeping elbow stationary. Lower the glideboard 330 back down the rails by bringing the handle back to the starting position. PULLEY PIN PLACEMENT: 2. TEACHING TIPS: Pause briefly at the top of the curl, keeping elbow up and stationary during the movement. Maintain upright posture (neutral spine). Maintain neutral wrists. Use the abdominal muscles to keep back straight and body stable on the glideboard 330. Focus on contracting the medial portion of the biceps (short head). SAFETY ASPECTS: Do not fully extend the arm at the bottom of the curl. Keep a slight bend in the elbow to protect the joint and maintain the load on the biceps muscles. Avoid torso movement in the frontal plane. Stabilize the torso throughout the exercise. TEMPO: Half time. REPETITIONS: 12 Halftime. Total Time: 48 Secs.

Lateral Biceps Curl (Left)—Biceps, Brachialis, Brachioradialis

STARTING POSITION: Stand to the side of the exercise device 100 with back facing the rails. Grasp the closest handle and pull the glideboard 330 halfway up. Sit toward the top edge of the glideboard 330 facing sideways with both legs extended straight out. Feet should not touch the ground. Extend active arm toward the pulley at shoulder level. Place the inactive hand on hip or the glideboard 330. EXERCISE DESCRIPTION: With a slight bend in the elbow, slowly pull the glideboard 330 up the rails by curling the handle up toward the shoulder, keeping elbow stationary. Lower the glideboard 330 back down the rails by bringing the handle back to the starting position. PULLEY PIN PLACEMENT: 2. TEACHING TIPS: Pause briefly at the top of the curl, keeping elbow up and stationary during the movement. Maintain upright posture (neutral spine). Maintain neutral wrists. Use the abdominal muscles to keep back straight and body stable on the glideboard 330. Focus on contracting the medial portion of the biceps (short head). SAFETY ASPECTS: Do not fully extend the arm at the bottom of the curl. Keep a slight bend in the elbow to protect the joint and maintain the load on the biceps muscles. Avoid torso movement in the frontal plane. Stabilize the torso throughout the exercise. TEMPO: Half time. REPETITIONS: 12 Half time. Total Time: 48 secs.

TRANSITION SIX

POSITION: Upright Supine with Dip bars. EXERCISE: Triceps Dip. SET UP: Pulley pin placement—n/a. Level—4-8. Dip Bars—installed (upright). Glideboard 330—no pulley. LAT bars—upright. Adjustable foot holder—down. INSTRUCTOR CUES. Stand up and disconnect the pulley from the glideboard 330. Adjust incline to a challenging level. Adjust Dip Bars to upright position. Push the glideboard 330 halfway up the rails. Straddle the glideboard 330 and sit at the lower portion facing the squat stand. Lie back, ensuring the head is fully supported. Grasp Dip Bars with arms fully extended and feet on the bottom portion of the glideboard 330.

TRICEPS DIP (SEE TRICEPS DIP ABOVE)

BACK AND CHEST BLAST

Back and Chest Blast Introduction: The estimated time allotment for the workout is 15 minutes. INTRODUCTION TO EXERCISE DEVICE 100: Tower—how to adjust intensity. Glideboard 330 & pulley system—how to attach pulley. Pulley pin placement—how to adjust. Deluxe Pull-up Bar—how to install. ACCESSORIES: None. SAFETY ASPECTS: Select appropriate resistance level. Check workout attire/hair. Pain free range of motion. Neutral joint positions. PRIMARY MUSCULATURE: Latissimus Dorsi; Erector Spinae; Pectoral Group; Deltoids; Trapezius; Teres Major; Rotator Cuff Group; Rhomboids; Triceps brachii; Biceps brachii.

The Back & Chest Blast Series™ was designed to introduce clients to the exercise device 100 with a concentrated, high intensity workout focusing on the muscles of the back and chest. The exercises are performed in a circuit type fashion with minimal rest periods. Participants should warm up for 6-8 minutes with light, multi joint exercises to prepare the body for heavy work. The following is an exemplary order of exercises and steps for the Back & Chest Blast workout. Each of the exercises and steps are described in turn.

Back and Chest Blast Set-Up

POSITION: Prone Push Up. EXERCISE: Incline Push Up. SET UP: Pulley pin placement—n/a. Level—4-6. Glideboard 330—no pulley. LAT bars—upright. Adjustable foot holder—down. Folding squat platform—removed. INSTRUCTOR CUES: Disconnect the pulley from the glideboard 330 and remove the folding squat platform. Stand at the base of the rails facing the tower. Bend forward, placing both hands halfway up the glideboard 330 toward the sides. Push the glideboard 330 up the rails until body is straight and arms are perpendicular to the rails.

TRICEPS DIP (SEE TRICEPS DIP, PERSONAL TRAINING)

INCLINE PUSH-UP (SEE INCLINE PUSH-UP, PERSONAL TRAINING)

TRANSITION ONE

POSITION: Prone Pull Up. EXERCISE: Pull Up. SET UP: Pulley pin placement—n/a. Level—6-8: Glideboard 330—no pulley. LAT bars—Pull-up position. Adjustable foot holder—down. Folding squat platform—removed. INSTRUCTOR CUES: Adjust incline to a challenging level. Push the glideboard 330 halfway up the rails. Lie prone, with chest near the top of the glideboard 330. Grasp LAT Bars with palms facing down. Slightly bend knees for full range of motion. Glideboard 330 should not make contact with tower or lower base. Adjust body position if glideboard 330 is not free moving.

PULL-UP (SEE PULL-UP, PERSONAL TRAINING)

TRANSITION TWO

POSITION: Inverted Prone Push Up. EXERCISE: Decline Push Up. SET UP: Pulley pin placement—n/a. Level—6. Glideboard 330—no pulley. LAT bars—Pull-up position. Adjustable foot holder—down. Folding squat platform—removed. INSTRUCTOR CUES: Straddle rails with feet on floor to dismount. Stand at the bottom of the rails, facing away from the tower. Bend knees and place both hands on floor near the outside portion of the lower base. Position both feet in the center of the glideboard 330. Push glideboard 330 up the rails until legs are straight and shoulders are directly above hands.

DECLINE PUSH-UP (SEE DECLINE PUSH-UP, PERSONAL TRAINING)

TRANSITION THREE

POSITION: Prone Pull Up. EXERCISE: Parallel Grip Pull Up. SET UP: Pulley pin placement—n/a. Level—6-8. Glideboard 330—no pulley. LAT bars—Pull-up position. Adjustable foot holder—down. Folding squat platform—removed. INSTRUCTOR CUES: Push the glideboard 330 halfway up the rails. Lie prone with chest near the top edge of the glideboard 330. Grasp LAT Bars with palms facing down. Slightly bend knees for full range of motion. Glideboard 330 should not make contact with tower or lower base. Adjust body position if glideboard 330 is not moving freely.

PULL-UP (SEE PULL-UP, PERSONAL TRAINING)

TRANSITION FOUR

POSITION: Seated Forward. EXERCISE: Chest Press. SET UP: Pulley pin Placement—2. Level—3-6. Glideboard 330—pulley attached. LAT bars—upright. Adjustable foot holder—down. INSTRUCTOR CUES: Attach pulley to glideboard 330. Grasp handles and pull the glideboard 330 halfway up the rails. Straddle the rails and sit toward the top edge of the glideboard 330 facing away from the tower.

Place legs in a comfortable position on the glideboard 330. Bring handles to the side of the torso, at chest level. Cables should be inside forearms.

CHEST PRESS (SEE CHEST PRESS, PERSONAL TRAINING)

STATIC CHEST PRESS (SEE STATIC CHEST PRESS, PERSONAL TRAINING)

TRANSITION FIVE

POSITION: Seated Backward. EXERCISE: Seated Row. SET UP: Pulley pin placement—2. Level—3-6. Glideboard 330—pulley attached. LAT bars—upright. Adjustable foot holder—down. INSTRUCTOR CUES: Place feet on the floor. Stand up, turn around and sit toward the top edge of the glideboard 330, facing the tower. Extend arms directly toward the pulleys with palms facing down. Feet should not touch the floor.

SEATED ROW (SEE SEATED ROW, PERSONAL TRAINING)

SINGLE ARM ROW—BOTH HANDLES

SINGLE ARM ROW—BOTH HANDLES (LATISSIMUS DORSI, POSTERIOR DELTOID)

STARTING POSITION: Seated Backward—Facing the tower, grasp handles and pull glideboard 330 halfway up the rails. Straddle the rails and sit toward the top edge of the glideboard 330. Grasp both handles in one hand with palm facing in and arm fully extended straight out in front. EXERCISE DESCRIPTION: From an upright-seated position, pull the glideboard 330 up the rails by pulling the handles back, rib high, until hand reaches the side of rib cage of the active arm. Lower the glideboard 330 back down the rails by extending arm until you return to the starting position. INCLINE GUIDELINES: Incline levels—2-5. PROGRESSIONS/VARIATIONS. Tempo changes. PULLEY PIN: PLACEMENT: 2. TEACHING TIPS: Maintain scapular retraction throughout movement. Lead with the elbow. Return with control. SAFETY ASPECTS: Ensure correct upright posture throughout movement. Avoid excessive contraction (extension) of the arms and lower back. At the end ROM, avoid excessive lordotic curve. Make sure that the exercise is performed without rocking the upper body. REPETITIONS: 4 Halftime; 16 Single time, in and hold for 6, out 7-8; 4 Holds; 8 Single time. Total Time: 1 min. TEMPO: Half time; Single time.

Seated Cross—Cable Row Latissimus Dorsi, Trapezius, Teres Major, Deltoids, Rhomboids, Biceps, Brachioradialis STARTING POSITION: Grasp handles and pull the glideboard 330 halfway up the rails: Straddle the rails and sit toward the top edge of the glideboard 330, facing the tower. Extend arms directly toward the pulleys with palms facing down. Lift feet off the floor. Switch handles so that cables cross over in front of torso. EXERCISE DESCRIPTION: From an upright seated position, pull the glideboard 330 up the rails by pulling the handles back, rib high, until hands reach the sides of the torso. Lower the glideboard 330 back down the rails by extending arms back to the starting position. PULLEY PIN PLACEMENT: 2. TEACHING TIPS: Lead the movement with the elbows. Squeeze the shoulder blades together when the elbows are back to contract the rhomboids and trapezium. Maintain an upright posture during the entire movement. Maintain neutral wrists. SAFETY ASPECTS: Avoid upper body movement in the sagittal plane. Avoid excessive shoulder elevation during exercise. Do not bounce at the bottom range of the exercise. Move the arms in a slow and controlled motion. TEMPO: Half time. REPETITIONS: 8 Half time. Total Time: 32 secs.

TRANSITION SEVEN

POSITION: Seated Forward. EXERCISE: Decline Chest Fly. SET UP: Pulley pin placements. Level—3-6. Glideboard 330—pulley attached. LAT bars—upright. Adjustable foot holder—down. INSTRUCTOR CUES: Place feet on the floor. Adjust pulley pin placement to position 4. Stand up, turn around and sit toward the top edge of the glideboard 330, facing away from the tower. Place legs in a comfortable position on the glideboard 330. Stretch arms out to the sides of the torso, with palms facing forward and a slight bend at the elbows. Cables should be outside the forearms.

DECLINE CHEST FLY (SEE DECLINE CHEST FLY, PERSONAL TRAINING)

TRANSITION EIGHT

POSITION: Seated Lateral. EXERCISE: Single Arm Chest Fly. SET UP: Pulley pin placement—3. Level—3-6. Glideboard 330—pulley attached. LAT bars—upright. Adjustable foot holder—down. INSTRUCTOR CUES: Place feet on the floor. Stand up with back facing the rails. Grasp the closest handle and pull the glideboard 330 halfway up the rails. Sit toward the top edge of the glideboard 330 facing sideways with both legs extended straight out. Feet should not touch the floor. Extend active arm toward the pulley at shoulder level. Place inactive hand on hip or on the side of the glideboard 330 to stabilize. Switch body position to opposite side after one complete set to train the other arm. Adjust pulley pin placement to position 3.

SINGLE ARM CHEST FLY—LEFT AND RIGHT (SEE SINGLE ARM CHEST FLY, PERSONAL TRAINING)

TRANSITION NINE

POSITION. Seated Backward. EXERCISE: Incline Chest Press. SET UP. Pulley pin placement—2. Level—3-6. Glideboard 330—pulley attached. LAT bars—upright. Adjustable foot holder—down. INSTRUCTOR CUES: Place feet on the floor. Stand up and adjust the pulley pin placement to 2. Grasp handles and sit near the top edge of the glideboard 330, facing away from the tower. Bring handles to side of the torso at chest level. Cables should be inside forearm. Adjust pulley pin placement to position 2.

INCLINE CHEST PRESS (SEE INCLINE CHEST PRESS, PERSONAL TRAINING)

TRANSITION TEN

POSITION: Seated Backward. EXERCISE: Reverse Fly. SET UP: Pulley pin placement—2. Level—3-6. Glideboard 330—pulley attached. LAT bars—upright. Adjustable foot holder—down. INSTRUCTOR CUES: Place feet on the floor. Stand up, turn around and sit toward the top edge of the glideboard 330, facing the tower. Extend arms directly toward the pulleys with palms facing down. Feet should not touch the floor.

REVERSE FLY (SEE REVERSE FLY, PERSONAL TRAINING)

BUNS AND LEGS BLAST

Buns and Legs Blast Introduction: ESTIMATED TIME ALLOTMENT: 15 MINUTES. INTRODUCTION TO EXERCISE DEVICE: Tower—how to adjust intensity. Folding squat platform—how to install. Telescoping squat stand—how to adjust. Adjustable foot holder—how to adjust. Glideboard 330 & pulley system—how to attach pulley. Pulley pin placement—how to adjust. ACCESSO- RIES: Squat Handle Bar; Telescopic Squat Stand. SAFETY ASPECTS: Select appropriate resistance level. Check workout attire/hair. Pain free range of motion. Neutral joint positions. Ensure Telescopic Squat Stand is locked in position when in use. PRIMARY MUSCULATURE: Gluteal Group; Hamstring Group; Hip Abductors; Hip Adductors; Quadriceps; Gastrocnemius; Soleus. The Buns & Legs Blast Series™ was designed to introduce clients to the exercise device 100 with a concentrated, high intensity workout focusing on the lower extremities. The exercises are performed in a circuit type fashion with minimal rest periods. Participants should warm up for 6-8 minutes with light, multi-joint exercises to prepare the body for heavy work. The following is an exemplary order of exercises and steps for the Buns & Legs Blast workout. Each of the exercises and steps are described in turn.

Buns and Legs Blast Set-Up

POSITION: Lying Supine. EXERCISE: Squat. SET UP: Pulley pin placement—n/a. Level—6-8. Glideboard 330—no pulley. LAT bars—upright. Adjustable foot holder—down. Folding squat platform—installed. INSTRUCTOR CUES: Raise the tower to a challenging level. Push the glideboard 330 halfway up the rails. Straddle the glideboard 330 and sit on the bottom edge. Lie back, ensuring head is fully supported. Place both feet on the squat stand shoulder-width apart. Lower the glideboard 330 by bending both knees to 90°.

SQUAT (SEE SQUAT, PERSONAL TRAINING)

SKIING (SEE SKIING, PERSONAL TRAINING)

BRIDGE SQUAT (SEE BRIDGE SQUAT, PERSONAL TRAINING)

HEEL RAISE (SEE HEEL RAISE, PERSONAL TRAINING)

PLYOMETRIC SQUAT (SEE PLYOMETRIC SQUAT, PERSONAL TRAINING)

PLYOMETRIC SKIING (SEE PLYOMETRIC SKIING, PERSONAL TRAINING)

PLYOMETRIC SPLIT SQUAT (SEE PLYOMETRIC SPLIT SQUAT, PERSONAL TRAINING)

TRANSITION ONE

POSITION: Inverted Supine. EXERCISE: Hamstring Curl. SET UP: Pulley pin placement—n/a. Level—3-5. Glideboard 330—no pulley: LAT bars—upright. Adjustable foot holder—up. INSTRUCTOR CUES: Raise the adjustable foot holder to the "up" position. Sit on the glideboard 330 facing the tower. Secure both feet into the adjustable foot holder. Lie back on the glideboard 330 with legs extended and head fully supported. Point toes toward tower.

HAMSTRING CURL (SEE HAMSTRING CURL, PERSONAL TRAINING)

TRANSITION TWO

POSITION: Seated backward. EXERCISE: Hip Abduction. SET UP: Pulley pin placement—1. Level—2-5. Glideboard 330—pulley attached. LAT bars—upright. Adjustable foot holder—down. INSTRUCTOR CUES: Sit up to remove feet from the adjustable foot holder. Attach the pulley to the glideboard 330. Grasp the handles and pull the glideboard 330 halfway up the rails. Straddle the rails and sit at the top edge of the glideboard 330 facing the tower. Extend legs directly toward the tower with the cables resting gently against the outside of each foot. Keep handles adjacent to knees.

SEATED HIP ABDUCTION (SEE SEATED HIP ABDUCTION, PERSONAL TRAINING)

TRANSITION THREE

POSITION: Standing Forward. EXERCISE: Reverse Lunge. SET UP: Pulley pin Placement—n/a. Level—1-3. Glideboard 330—no pulley. LAT bars—upright. Adjustable foot holder—down. Folding squat platform—removed. INSTRUCTOR CUES: Disconnect the pulley from the glideboard 330. Remove the folding squat platform. Stand at the base of the rails facing away from the tower. Place the ball of one foot on the bottom edge of the glideboard 330. Alternate legs after completing one full set.

REVERSE LUNGE—RIGHT AND LEFT (SEE REVERSE LUNGE, PERSONAL TRAINING)

SHOULDER BLAST SERIES™

Shoulder Blast Introduction: ESTIMATED TIME ALLOTMENT: 15 MINUTES; INTRODUCTION TO EXERCISE DEVICE 100: Tower—how to adjust intensity. Glideboard 330 & pulley system—how to attach pulley. Pulley pin placement—how to adjust. Press Bar—installed throughout. ACCESSORIES: Press Bar. SAFETY ASPECTS: Select appropriate resistance level. Check workout attire/hair. Pain free range of motion. Neutral joint positions. PRIMARY MUSCULATURE: Deltoids; Latissimus Dorsi; Teres Major; Trapezius; Triceps Brachii; Rotator Cuff Group; Pectoral Group; Rhomboids; Levator Scapulae; The Shoulder Blast Series™ was designed to introduce clients to the exercise device 100 with a concentrated, high intensity workout focusing on the shoulder musculature. The exercises are performed in a circuit type fashion with minimal rest periods. Participants should warm up for 6-8 minutes with light, multi-joint exercises to prepare the body for heavy work. The following is an exemplary order of exercises and steps for the Shoulder Blast workout. Each of the exercises and steps are described in turn.

Shoulder Blast Set-Up

POSITION: Kneeling Backward. EXERCISE: Surfer Lat Pull. SET UP: Pulley pin placement—2. Level—2-4. Glideboard 330—pulley attached. LAT bars—upright. Adjustable foot holder—down. Folding squat platform. INSTRUCTOR CUES: Adjust incline to an appropriate level. Grasp handles and pull the glideboard 330 halfway up the rails. Place hands, knuckles down, on the glideboard 330 to stabilize movement. Kneel at the top edge of the glideboard 330 facing the tower. Sit back onto heels. Lower the torso over the knees, extending arms toward pulleys.

STANDING EXTERNAL SHOULDER ROTATION (LEFT & RIGHT) (SEE STANDING EXTERNAL SHOULDER ROTATION, PERSONAL TRAINING)

TRANSITION ONE

POSITION: Kneeling Backward. EXERCISE: Surfer Lat Pull. SET UP: Pulley pin placement—2. Level—2-4. Glideboard 330—pulley attached. LAT bars—upright. Adjustable foot holder—down. Folding squat platform. INSTRUCTOR CUES: Adjust incline to an appropriate level. Grasp handles and pull the glideboard 330 halfway up the rails. Place hands, knuckles down, on the glideboard 330 to stabilize movement. Kneel at the top edge of the glideboard 330 facing the tower. Sit back onto heels. Lower the torso over the knees, extending arms toward pulleys.

SURFER LAT PULL (SEE SURFER LAT PULL, PERSONAL TRAINING)

KNEELING UPRIGHT ROW (SEE KNEELING UPRIGHT ROW, PERSONAL TRAINING)

TRANSITION TWO

POSITION: Seated Backward. EXERCISE: Seated Shoulder Extension. SET UP: Pulley pin placement—2. Level—3-6. Glideboard 330—pulley attached. LAT bars—upright. Adjustable foot holder—down. INSTRUCTOR CUES: Place knuckles on the glideboard 330 to stabilize movement. Straddle rails with feet on floor to dismount. Sit on the top edge of the glideboard 330, facing the tower. Extend arms directly toward the pulleys with palms facing down. Lift feet off the floor.

CROSS-CABLE UPRIGHT ROW (SEE CROSS-CABLE UPRIGHT ROW, PERSONAL TRAINING)

SEATED SHOULDER EXTENSION (SEE SEATED SHOULDER EXTENSION, PERSONAL TRAINING)

TRANSITION THREE

POSITION: Lying Inverted Supine. EXERCISE: Lateral Shoulder Raise. SET UP: Pulley pin placement—2. Level—2-6. Glideboard 330—pulley attached. LAT bars—upright. Adjustable foot holder—down. INSTRUCTOR CUES: Place both feet on the floor. Lie back, ensuring head is fully supported by the glideboard 330. Place both feet on the top edge of the glideboard 330 with arms parallel to the torso, palms facing thighs. Taller users can raise knees directly over hips for additional range of motion.

LATERAL SHOULDER RAISE (SEE LATERAL SHOULDER RAISE, PERSONAL TRAINING)

INVERTED SHOULDER SHRUG (SEE INVERTED SHOULDER SHRUG, PERSONAL TRAINING)

TRANSITION FOUR

POSITION: Seated Forward. EXERCISE: Seated Shoulder Flexion. SET UP: Pulley pin placement—1. Level—2-6. Glideboard 330—pulley attached. LAT bars—upright. Adjustable foot holder—down. INSTRUCTOR CUES: Bring knees to chest allowing the glideboard to rest at the bottom. Place feet on floor to sit up and dismount the exercise device 100. The Press Bar remains in place (not depicted in photo). Attach the pulley to the glideboard 330. Lower the incline to the appropriate level. Grasp handles and pull the glideboard 330 halfway up the rails. Straddle the rails and sit toward the top edge of the glideboard 330, facing away from the tower. Place legs in a comfortable position on the glideboard 330. Position arms straight down to the side of the hips with palms facing back.

SEATED SHOULDER FLEXION (SEE SEATED SHOULDER FLEXION, PERSONAL TRAINING)

TRANSITION FIVE

POSITION: Seated Lateral. Pulley system engaged. Seated laterally at the top of glideboard 330. Legs straight and crossed. SET UP: Incline levels 2-5. Pulley pin placement on 1. Glideboard 330 attached. LAT bars at full upright position. Adjustable foot holder in down position. INSTRUCTOR CUES: Continue to hold handles, place feet back on the ground and straddle the glideboard 330. Step with both feet to the side of the glideboard 330 allowing it to lower. Stand with back facing the glideboard 330. Carefully release the handle on the opposite side. Sit toward the top edge of the glideboard 330 facing sideways with legs extended in front of the body, feet crossed.

HORIZONTAL SHOULDER ABDUCTION (LEFT AND RIGHT) (SEE HORIZONTAL SHOULDER ABDUCTION, PERSONAL TRAINING)

TRANSITION SIX

POSITION: Inverted Prone. EXERCISE: Shoulder Press. SET UP: Press Bar—installed. Pulley pin placement—n/a. Level—3-6. Glideboard 330—no pulley. LAT bars—upright. Adjustable foot holder—down. Folding squat platform—removed. INSTRUCTOR CUES. Place feet on floor to sit up and dismount the exercise device 100. Disengage the pulley from the glideboard 330. Raise the tower to the appropriate level. Install the Press Bar to the bottom of the rails. Kneel near the center of the glideboard 330 facing away from the tower. Place both hands on the Press Bar. Lower body down by extending hips until torso is fully supported by the glideboard 330. Bend elbows until chin is over the Press Bar. Keep chest and head down during entire exercise set.

OVERHEAD PRESS (SEE OVERHEAD PRESS, PERSONAL TRAINING)

AB BLAST

Ab Blast Introduction: The Ab Blast Series™ was designed to introduce clients to the exercise device 100 with a concentrated, high intensity workout focusing on the abdominal musculature. The exercises are performed in a circuit type fashion with minimal rest periods. Participants should warm up for 6-8 minutes with light, multi-joint exercises to prepare the body for heavy work. ESTIMATED TIME ALLOTMENT: 15 MINUTES INTRODUCTION TO EXERCISE DEVICE 100: Tower—how to adjust intensity. Glideboard 330 & pulley system—how to attach pulley. Pulley pin placement how to adjust. Press Bar—installed throughout series. LAT bars—how to adjust ACCESSORIES. Press Bar. SAFETY ASPECTS: Select appropriate resistance level. Check workout attire/hair. Pain free range of motion. Neutral joint positions. Anchor glideboard 330 to enter kneeling position. PRIMARY MUSCULATURE: Rectus Abdominis; Internal Oblique; Extenal Oblique; Transverse Abdominus; Quadratus Lumborum; Erector Spinae; Transversospinalis; Iliopsoas Group. The following is an exemplary order of exercises and steps for the Ab Blast workout. Each of the exercises and steps are described in turn.

Ab Blast Set-Up

POSITION: Kneeling Forward. EXERCISE: Surfer Lat Pull. SET UP: Pulley pin Placement—2. Level—2-4. Glideboard 330—pulley attached. LAT bars—upright. Adjustable foot holder—down. Folding squat platform. INSTRUCTOR CUES: Adjust incline to level 2-4. Grasp handles and pull the glideboard 330 halfway up the rails. Place hands, knuckles down, on the glideboard 330 to stabilize movement. Kneel at the top edge of the glideboard 330 facing the tower. Sit back on to heels. Lower the torso over the knees, extending arms toward pulleys.

SURFER LAT PULL (SEE SURFER LAT PULL, PERSONAL TRAINING)

TRANSITION ONE

POSITION: Lying Supine. EXERCISE: Pullover Crunch. SET UP: Pulley pin placement—2. Level—2-5. Glideboard 330—pulley attached. LAT bars—upright. Adjustable foot holder—down. INSTRUCTOR CUES: Continue to hold handles. Place feet on ground, stand up and straddle the glideboard 330 facing the squat stand. Sit toward the bottom edge of the glideboard 330, lie back, extend arms overhead.

Ensuring head is fully supported by the glideboard 330, bring feet onto the bottom of the glideboard 330.

PULLOVER CRUNCH (SEE PULLOVER CRUNCH, PERSONAL TRAINING)

CROSS-BODY PULLOVER CRUNCH (SEE PULLOVER CRUNCH, PERSONAL TRAINING)

TRANSITION TWO

POSITION: Seated Lateral. EXERCISE: Seated Torso Rotation. SET UP: Pulley pin placement—2. Level—2-4. Glideboard 330—attached. LAT bars—upright. Adjustable foot holder—down. INSTRUCTOR CUES: Continue to hold handles, place knuckles on glideboard 330 to stabilize. Place feet on ground and straddle glideboard 330. Sit toward the top edge of the glideboard 330 facing sideways with both feet extended straight out above the floor. Rotate torso toward the tower with arms extended straight out, hands together. Switch body position to opposite side after one complete set to train other side.

SEATED TORSO ROTATION (RIGHT AND LEFT) (SEE SEATED TORSO ROTATION, PERSONAL TRAINING)

TRANSITION THREE

POSITION: Kneeling Lateral. EXERCISE: Kneeling Torso Rotation. SET UP: Pulley pin placement—3. Level—2-4. Glideboard 330—attached. LAT bars—upright. Adjustable foot holder—down. INSTRUCTOR CUES: Sit upright and dismount the exercise device 100. Adjust pulley pin placement to position 3. Stand next to the rails facing the glideboard 330, holding one handle. Place hands, knuckles down, on the glideboard 330 to stabilize movement. Kneel on the top portion of the glideboard 330 facing sideway. Start in a low kneeing position, sitting back on heels. Rotate torso toward the tower with arms extended straight out, hands together. Switch body position to opposite side after one complete set to train other side.

KNEELING TORSO ROTATION (RIGHT AND LEFT) (SEE KNEELING TORSO ROTATION, PERSONAL TRAINING)

TRANSITION FOUR

POSITION: Inverted Supine. EXERCISE: Bent Leg Incline Crunch. SET UP: Pulley pin placement—n/a. Adjustable foot holder—up. Level—2-5. Glideboard 330—no pulley LAT bars—upright. INSTRUCTOR CUES: Place knuckles on the glideboard 330 to stabilize movement. Place feet on the ground to dismount exercise device 100. Disengage the pulley from the glideboard 330. Place the adjustable foot holder in the upright position. Sit at the top of the glideboard 330 facing the tower. Secure both feet into the adjustable foot holder. Lie back on the glideboard 330 ensuring head is fully supported.

BENT LEG INCLINE CRUNCH (SEE BENT LEG INCLINE CRUNCH, PERSONAL TRAINING)

BENT LEG OBLIQUE CRUNCH (HAMSTRINGS, ABDOMINALS, OBLIQUES)

STARTING POSITION: Disconnect the pulley from the glideboard 330. Push the glideboard 330 halfway up the rails. Straddle the rails and sit on the top edge of the glideboard 330 facing the tower. Secure both feet into the adjustable foot holder. Lie back on the glideboard 330 with legs extended, ensuring the head is fully supported. EXERCISE DESCRIPTION: From the same starting position, place one hand behind the head and the other on the abdominals. Maintaining bent leg position, perform an oblique crunch by bringing the head and one shoulder off the glideboard 330 toward the opposite knee. PULLEY PIN: PLACEMENT: None. TEACHING TIPS: Keep tension on the abdominals throughout the entire movement. Maintain neutral cervical spine. If the movement is too difficult, place arms across the chest. SAFETY ASPECTS: Do not pull excessively on the head with hands. This places stress on the cervical spine. ACCESSORIES: Adjustable foot holder. TEMPO: Half time. REPETITIONS: 8 each side. Total Time: 64 secs.

TRANSITION FIVE

POSITION: Lying Supine. EXERCISE: Lying Leg Lift. SET UP: Pulley pin placement—n/a. Level—2-5. Glideboard 330—no pulley. LAT bars—down (pull-up position). Adjustable foot holder—down. INSTRUCTOR CUES: Sit upright and remove feet from adjustable foot holder. Place feet on ground, stand up and turn facing away from the tower. Sit toward the bottom edge of the glideboard 330, lie back, extend arms overhead and grasp the LAT bars. Ensuring head is fully supported, flex both the hip and knees to approximately 90°.

LYING LEG LIFT (SEE LYING LEG LIFT, PERSONAL TRAINING)

TRANSITION SIX

POSITION: Kneeling Prone with Press Bar. EXERCISE: Prone Jack Knife. SET UP: Press Bar—attached. Pulley pin placement—n/a. Level—2-4. Glideboard 330—no pulley. LAT bars—upright. Adjustable foot holder—down. Folding squat stand—removed. INSTRUCTOR CUES: Place feet on the floor and sit upright. Dismount the exercise device 100 and raise the LAT bars to the upright position. Adjust incline if necessary. Kneel on the bottom of the glideboard 330 facing away from the tower. Grasp the Press Bar with both hands. Ensure shoulders are directly over the hands and press the glideboard 330 up the rails so hip and knees are both at a 90° angle.

PRONE JACK KNIFE (SEE PRONE JACK KNIFE, PERSONAL TRAINING)

PILATES

INTRODUCTION TO PILATES USING EXERCISE DEVICE 100: PILATES is a blend of traditional Pilates reformer and mat exercises with a revolutionary evolved repertoire designed to fit all levels of participant fitness. PILATES using the exercise device 100 was developed from a desire to calibrate the appropriate resistance load based on the participant's level of fitness, as well as the need to alleviate common compensation patterns due to limitations in strength and flexibility. The exercise device 100 works with eight calibrated inclines, personalizing PILATES to fit the participant's strength, flexibility and height. The inclines also address the challenges of cervical tension and hamstring inflexibility, allowing participants to correctly perform the exercises and feel more successful. The workouts are broadened by the use of the pulley system and the free motion glideboard 330 during open and closed chain exercises, creating a repertoire that significantly challenges core strength, dynamic stability and coordination.

THE FUNDAMENTALS OF PILATES AND THE EXERCISE DEVICE 100: The fundamentals reflect the philosophy underlying the development of the exercises. The fundamentals focus on increasing the participant's awareness of postural alignment while enhancing core and dynamic stability. These in turn lead to improved function, equilibrium and gracefulness, which translate to a more efficient individual who is less likely to be injured. These are the 8 adapted PILATES fundamentals: 1) Concentration—needed to execute the movement with proper muscular sequencing and joint alignment. 2) Core Strength/Centering—needed for dynamic stability and distal mobility. 3) Breathing—needed to oxygenate and invigorate the body, mind and spirit. 4) Isolation—needed to recognize and strengthen the weaker muscle groups so that precision can be attained. 5) Control—needed to isolate single muscle groups, as well as synchronize a group of muscles to perform a coordinated movement. 6) Precision—needed to master a movement with proper technique at the subconscious level. 7) Flowing movement—needed for efficient movement during exercise and everyday activities. 8) Routine—needed for improved quality of movement and quality of life.

PRINCIPLES OF THE EXERCISES FOR PILATES AND THE EXERCISE DEVICE 100:M Influenced by the fundamentals, the principles (A,B,C below) govern the proper execution of the exercise. The principles are: A. Alignment, B. Breath, and C. Core Control, each of which is described in turn below: A. ALIGNMENT: Introduction—Alignment of the body refers to how the line of gravity falls in relation to each joint. Alignment also refers to how each joint orients itself to the joint above and below. In Pilates, the goal is to optimally align each joint so that proper muscle-length tension is maintained. Alignment is assessed statically and dynamically: Static Alignment—The observation of each joint with relation to the joint above and below, as well as this joint's relationship to gravity when the body is still. Static alignment is used as an assessment tool for evaluating postural asymmetries and/or faults. Dynamic Alignment—The observation of each joint with relationship to the joints above and below, as well as the joint's relationship to gravity when the body is active. In Pilates, the instructor assesses dynamic alignment by observing the participant's, ability to isolate the extremities without subsequent movement of the torso or to isolate spinal movement without subsequent extremity movement. This ability to isolate is commonly termed dissociation. The areas of focus include 1) Pelvic positioning, 2) Thoracic positioning, 3) Shoulder Girdle positioning, 4) Cervical positioning 5) Knee/Patellar positioning and 6) Ankle, Elbow and Wrist positioning.

1) PELVIC POSITIONING: Q. WHAT ARE NEUTRAL PELVIC PLACEMENT AND NEUTRAL LUMBAR SPINE? A. Neutral spine falls under different definitions according to different people. For instance, one may state that neutral spine is the place where the participant is pain-free. Others may state that neutral is the midpoint between anterior pelvic tilt and posterior pelvic tilt. In a Pilates setting, neutral pelvis is when both the ASIS (Anterior Superior Iliac Spine) and the pubic bone fall in the same sagittal plane. In this position, the lumbar spine will possess its "natural" lordotic curve and sacral spine will maintain its "natural" kyphotic curve. Q. WHY ARE NEUTRAL PELVIS AND LUMBAR SPINE IMPORTANT? A. Neutral spine allows the spine to maintain its natural curves. This in turn allows for: Resiliency against compressive and shear forces. Greater flexibility than that of a straight column. Optimal posture which allows for: Gravitational forces to be balanced by countertourques generated by passive ligamentous tension and minimal muscle activity. Compressive forces to be distributed optimally over the weight-bearing surfaces of joints with no excessive tension exerted on the ligaments and muscles. Q. WHAT IS THE GOAL IN TEACHING NEUTRAL PELVIS AND LUMBAR SPINE? A. Teach the participant to perceive and achieve his/her neutral spine, and teach the participant how to maintain and move through neutral during the exercises. Teach the participant how to maintain an abdominal contraction with a neutral pelvic positioning. If the participant is unable to achieve and/or maintain a neutral pelvis, an imprinted pelvis may be encouraged. (An imprinted pelvis is a slight posterior pelvic tilt with slight flexion of the lumbar spine.) An imprinted pelvis is commonly mistaken for a pelvic tilt. A pelvic tilt can encourage overuse of the hip extensors or spinal flexors and can overstretch the lumbar extensors. To envision an imprint, the participant can be taught to move between pelvic tilt and neutral pelvis. The middle region is the imprint zone. Q. WHAT ARE THE CONSIDERATIONS? A. Every individual may not be able to achieve a neutral spine. Some participants may have well-developed gluteal muscles, which makes it difficult to achieve a neutral spine while supine. Likewise, the participant with well-developed quadriceps may have difficulty maintaining a neutral pelvis in prone. Some participants may demonstrate exaggerated lordotic curves and increased anterior pelvic tilting. In this case, cue to work in an imprinted versus neutral spine to reduce shear forces onto the lower lumbar spine. A comprehensive understanding of posture and how postural faults affect biomechanics is important for the instructor to have when constructing an individualized program.

2) THORACIC POSITIONING Q. WHAT IS NEUTRAL THORACIC SPINE? A. Neutral thoracic spine is the maintenance of the natural kyphotic curve. The thoracic spine consists of the thoracic vertebrae, the rib cage, the diaphragm and the abdomen. Q. WHY IS NEUTRAL THORACIC POSITIONING IMPORTANT? A. Promotes full ventilation of the lungs through contraction of the abdomen prior to inspiration. Increasing abdominal muscle tension just before inspiring could therefore result in a stronger contraction of the diaphragm and greater potential for higher transdiaphragmatic pressure differences during inspiration. Promotes optimal abdominal facilitation and contraction. The rectus abdominis, internal and external obliques and intercostals have attachments in the thorax. Proper alignment of the thorax can maximize length/tension relationship of these muscles. Enhance proper biomechanics of the shoulder girdle. The shoulder girdle has multiple attachments on the thorax. The position of the thorax will influence not only the range of motion, but also the strength of the shoulder girdle. Q. WHAT IS THE GOAL OF NEUTRAL THORACIC POSITIONING IN PILATES? A. Teach the participant to engage the abdominals during thoracic flexion and extension. Teach the participant to maintain a lengthened thoracic spine without over-extending the lower thoracic spine. In Pilates, "popping the lower ribs" is commonly used to describe this action and can result in loss of abdominal activation. Cue to knit or connect the lower ribs together and slightly down toward the pelvis. This action is termed "imprinting the ribs" and can discourage "popping." Q. WHAT ARE THE CONSIDERATIONS? A. Lack of abdominal activation can lead to popping or loss of thoracic imprint, as well as increased stress on the mid to lower thoracic vertebrae. Encourage activation of the abdominals. Poor flexibility of the shoulder girdle musculature can hinder ideal neutral thoracic placement. The latissimus dorsi, for instance, can encourage popping and/or extension of the thorax. In order to promote neutral thoracic positioning, decrease the shoulder girdle movement. Tension in the cervical spine, such as the upper trapezius, can promote elevation of the thorax. Focus on teaching how to relax and how to stretch the musculature. Upper chest breathing can lead to elevation of the thorax. Encourage thoracic breathing.

3) SHOULDER GIRDLE POSITIONING: Q. WHAT IS NEUTRAL FOR THE SHOULDER JOINT? A. For the purposes of this text, neutral glenohumeral position is achieved when the humerus is in line with the glenoid. Ideally, there will be equal contraction between the flexors, adductors and the shoulder extensors. Neutral scapular position is achieved when the scapula is flush against the thorax between the second and seventh vertebrae and approximately 4 inches from the vertebrae. It should be noted that the sternoclavicular joint and the acromioclavicular joint are also considered integral components of the shoulder girdle. However, the intricacies of these joints and their role in shoulder movement are outside the scope of this text. Q. WHY IS SHOULDER GIRDLE POSITIONING IMPORTANT? A. Promotes less stress to the cervical spine. Encourages proper rib cage placement and, in turn, better abdominal engagement. Promotes full range of motion, which is a necessary activity for daily life. Q. WHAT IS THE GOAL OF SHOULDER GIRDLE POSITIONING IN PILATES? A. Promote full range of motion in the glenohumeral and scapulothoracic joints. Promote increased strength and flexibility to optimize postural alignment in order to lessen the stress on the cervical spine. Improve participant's awareness of scapula positioning during movement. Q. WHAT ARE THE CONSIDERATIONS? A. Tightness along the anterior aspect of the shoulder, as seen with rounded shoulder posture, may lead to difficulty achieving optimal glenohumeral positioning. Cue to widen through the collarbones and drop the shoulders back and down. If a participant is unable to relax the shoulder girdle or unable to maintain an imprint when the shoulder is optimally positioned, then a pillow or wedge can be used to bring the participant into better alignment. Poor scapular alignment, such as increased scapular elevation, can contribute to cervical strain. Cue to slide the scapula down the back and slightly together. However, one does not want over-adduction of the scapula. If present, cue the participant to imagine the scapula sitting flush against the thorax. Some participants have poor kinesthetic awareness of their scapula. Tactile cues to promote scapular mobility may benefit a hypomobile scapula.

4) CERVICAL POSITIONING Q. WHAT IS NEUTRAL IN THE CERVICAL SPINE? A. Maintenance of the natural lordotic curve. Neutral can be thought of as the midpoint between flexion extension, rotation and lateral flexion. In Pilates, neutral will be slight flexion of the first two vertebrae, while maintaining extension of the lower cervical spine. Q. WHY IS NEUTRAL CERVICAL SPINE IMPORTANT? A. Neutral allows for the least amount of stress to the cervical spine while promoting the greatest amount of mobility. Optimal neutral spine promotes better biomechanics for everyday activities such as swallowing, chewing and talking. See pelvic placement section regarding the importance of neutral spine. Q. WHAT IS THE GOAL OF NEUTRAL CERVICAL SPINE IN PILATES? A. Promote optimal alignment in order to decrease cervical stress or strain. Increase muscular strength and flexibility in order to enhance everyday activities such as breathing, swallowing, chewing and speaking. Q. WHAT ARE THE CONSIDERATIONS? A. Participants with forward head, which is hyperextension at C1 and flexion of the lower cervical spine, can have difficulty achieving neutral spine in the supine position. Place a small pad or the Support Wedge Pillow under the participant's head and shoulder girdle to limit excessive hyperextension. Any participant with predisposing neck pathology should support the cervical spine by placing the head on the glideboard 330 or by placing the hands behind the head for support. Furthermore, at no time should a participant feel stress or strain to the cervical spine. If a participant's tendency is to hyperflex by pressing the chin into the chest, cue to keep the gaze toward the knees during supine activities. Cue to keep crown of the head reaching forward or the gaze diagonally to the front during prone activities. If the participant continues to show strain or over-flexion of the cervical spine, the instructor should look at the shoulder girdle to ensure there is no hyperextension of the arms or elevation of the shoulders. If present, cue correct shoulder girdle or elbow positioning to alleviate strain.

5) KNEE/PATELLAR POSITIONING Q. WHAT IS PROPER KNEE ALIGNMENT? A. Ideal knee alignment is achieved when the knee is able to be fully extended but does not enter into hyperextension. The patella sits superior and slightly laterally to the midline of the joint. As the knee moves from flexion into extension, the patella moves medially. Q. WHY IS PROPER KNEE ALIGNMENT IMPORTANT? A. Proper alignment places the muscle in better biomechanical alignment to generate strength. Proper alignment encourages proper loading of the joint surface. Proper patella tracking is critical for maximizing quadriceps' force production. Furthermore, improper tracking leads to degenerative changes to the patellar surface and increases the likelihood of pathologies, such as chrondromalacia. Due to the closed-chain nature of the knee joint, proper alignment is necessary for achievement of optimal hip and ankle alignment. Q. WHAT IS THE GOAL OF KNEE ALIGNMENT IN PILATES? A. Promote proper patellar tracking. Encourage balance of the muscular system surrounding the knee joint. Increase participant's postural awareness, by noting postural or movement faults. For example, hyperextension during knee extension. Q. WHAT ARE THE CONSIDERATIONS? A. If the patella is tracking laterally, tightness along the iliotibial band and poor strength of the VMO (Vastus Medialis Obliqus) may be contributing factors. Addressing these two issues should be included in participant programming by: Placing a ball between the knees to encourage greater activation of the VMO. Stretching of the iliotibial band as well as the surrounding hip musculature. Tactile cueing, such as tapping, to the VMO to enhance kinesthetic awareness helps activate the VMO. Excessive internal or external femoral rotation can lead to unequal weightbearing through the knee. Cue to turn the inner thigh toward the ceiling or toward the floor.

6) ANKLE, ELBOW AND WRIST POSITIONING In Pilates, the ankle moves through dorsiflexon, plantar flexion, inversion and eversion. It is important to discourage excessive plantar flexion when pointing the toes/foot. It is also important to encourage that the foot be in the midrange between inversion and eversion. "Rolling out" or "flattening the arch" are two common faults present during Pilates-based movements. Cue to bring the foot into midline to promote balance and prevent undo strain to the surrounding ligaments. In Pilates, the elbow positioning is slight flexion. The intention is to prevent hyperextension of the elbow. Hyperextension can promote shoulder elevation and over-activation of the pectorals, as well as increase cervical strain. The instructor may need to cue the softening of the elbow in extension, especially with weight-bearing activities. The wrists should be held in slight extension and in line with the elbow. During weight bearing activities, "breaking" at the wrist joint hyperextension needs to be prevented. If breaking is occurs, the shoulder girdle strength may be limited and activity and modifications should be given.

Breath

In order to better comprehend the breath used in Pilates, one needs to be able to understand general patterns of breathing and what responses are facilitated. PATTERNS OF BREATH: 1. DIAPHRAGMATIC Breath is directed into the diaphragm. This pattern is encouraged in order to facilitate relaxation and greater tidal volume. 2. UPPER CHEST Breath is directed into the upper chest and shoulder girdle. This pattern is used as an attempt to increase ventilation. Problems of limited ventilation are commonly seen in participants who have upper trapezius tightness, increased stress/tension, chronic pain and/or respiratory pathologies, i.e. COPD, (Chronic Obstructive Pulmonary Disease). The inhalation is facilitated by accessory muscles, such as the levator scapulae, scalenes and the upper trapezium. In turn, the participant has increased cervical tension and difficulty engaging and maintaining the abdominals. 3. POSTERIOR LATERAL THORACIC This is the breathing pattern encouraged in Pilates. The focus is to draw the breath into the lateral and posterior aspects of the thorax while maintaining an abdominal contraction. The goal is to aerate the entire lung versus only the superior aspect, as seen with upper chest breathers. The engagement of the diaphragm is still important, but the emphasis is to draw the breath downward and outward into the thorax, and not into the belly. Regardless of the participant's mode of breathing, he or she needs to learn how to maintain the abdominal contraction, especially the transverse abdominis. WHY IS BREATH IMPORTANT IN PILATES? Encourages full oxyngenation of the lungs. Promotes delivery of nutrients throughout the body. Promotes the elimination of waste products from the body. Oxygenates and invigorates the mind, body and spirit. Sets the tempo of an exercise. Intensifies or eases an exercise. Increases or decreases coordination of an exercise. WHAT ARE THE BREATHING CONSIDERATIONS? Concentration on an exercise or an excessive number of verbal cues can promote breath-holding. Straining due to the below factors can cause a participant to hold the breath. Excessive load Extreme range of motion Fatigue due to the previous exercise CORE CONTROL: THE THREE REGIONS OF THE CORE: 1) SHOULDER GIRDLE COMPLEX: Composed of the glenohumeral joint, scapulathoracic joint, acromioclavicular joint, coracoclavicular joint and its surrounding soft tissue. It serves as a site for muscular attachments of scapula, humerus and thorax. It is a base for controlled upper extremity and cervical movement. 2) THORAX: Composed of the sternum, ribcage, thoracic spine, the abdominal cavity and its surrounding soft tissue. It is a site for ventilatory and abdominal muscular attachments. It houses the abdominal viscera and cardiorespiratory system. It serves as a bridge between shoulder girdle and lumbo-pelvic complex. 3) LUMBO-PELVIC COMPLEX: Composed of the pelvis, lumbar spine and its surrounding musculature. It serves as a site for over twenty-nine muscular attachments. It serves as a base for lower extremity movement and the transference of force to/from the torso. The above regions are connected through the hydraulic amplifier mechanism. The force of the latissimus dorsi muscle, a noted shoulder girdle and spinal stabilizer, creates tension along the thoracolumbar dorsi fascia. This pull creates a corset affect about the spine. Similarly, the force of the abdominals, in particular the transverse abdominis, presses against the thoracolumbar dorsi fascia, also creating a corset affect. Due to the muscular attachments and origins of the shoulder girdle and lumbo-pelvic region, each region influences the core's strength and stability.

WHAT IS CORE CONTROL? CORE STRENGTH: The ability to recruit the appropriate amount of muscular force to stabilize or move the core. SEGMENTAL STABILITY: The ability to isolate the inner segment, the inner segment being the smaller or weakened muscle group. For example, the ability to isolate the transverse abdominis. GROSS STABILITY: The ability to keep the inner segments active while performing a gross movement pattern. For example, maintaining the transverse abdominis active while flexing the spine. WHY IS CORE CONTROL IMPORTANT IN PILATES? Allows for proximal stability and distal mobility. In other words, the strength and control of the core allow for a solid foundation in which the upper and lower extremities move with precision and ease. Needed for proper distribution of force throughout the upper and lower body. Prevents compensation patterns leading to overuse and injuries. WHAT ARE THE CORE CONTROL CONSIDERATIONS? Lack of core control leads to stress and strain to the spine. Lack of core control leads to compensation patterns. Lack of core control leads to inability to control acceleration and deceleration of the body.

THE DESIGN OF PILATES: The philosophy for PILATES using the exercise device 100 is to provide a series of traditional Pilates and evolved Pilates exercises in a comfortable group setting while challenging each individual participant both physically and mentally. The classes are designed to incorporate the traditional principles of Pilates-alignment, breath and core control—while providing a variety of fun and effective exercise programming. The exercise device 100 offers a variety of new and challenging Pilates evolved exercises with the freedom of a moving glideboard 330 and adjustable pulley system. The use of body weight as the resistance factor against gravity produces an individualized workout routine that one can progressively increase in intensity as strength, flexibility and overall performance improve. To execute an effective PILATES class, the following considerations have been taken: A. Maximizing body positioning: In each of the selected body positions on the glideboard 330, multiple exercises are executed to maximize overall workout time and efficiency. B. Minimizing Transitions: The selection and sequencing of exercises allows for maximum time spent on exercise device 100 with little need to modify body position and/or incline height (resistance). However, at any time during the program a participant is encouraged to change resistance (incline height) to best suit his or her physical capabilities. C. Muscle sequencing: Due to the nature of Pilates exercises, careful consideration was given to the selection and sequencing of the exercises. They are presented in sequence to maximize muscle performance for both time efficiency and recovery. D. Participant's level of fitness/flexibility: the incline level is chosen to assist or resist a movement or to accommodate for lack of flexibility. CLASS OPPORTUNITIES: PILATES using the exercise device 100 provides its instructors with a series of classes that can be integrated easily into the regular group schedule based on the experience of the members. To avoid members attending classes that may not be suitable, please consider the following: FOUNDATION CLASS: A 30-minute class that reviews the essentials of Pilates and the specifications of the exercise device. Focus on the positions used in Pilates. Perform the exercises in each of those positions which assist in the participant gaining understanding and achieving a neutral position. CLASS STAGES: Schedule set classes that focus on the various ability levels of the members. The Stage 1 class will be slower paced, less demanding on coordination and will focus on the principles of Pilates: alignment, breath and control. Stage 2 progresses with more difficult exercise techniques and transitions, while Stage 3 classes will require a strong understanding of Pilates. Past participation in Stage 1 and Stage 2 PILATES using the exercise device 100 is recommended prior to beginning Stage 3. COMBO CLASSES: Combine PILATES classes with other scheduled group classes such as cardio classes or the 30-minute GROUP strength classes. Another option is to provide a specialty class which runs for 6 weeks, such as a series that includes Get Fit, Get Strong, and Get Length classes (30 minutes cardio, 30 minutes GROUP and 30 minutes PILATES).

PREPARING FOR PILATES: CLASS FORMAT: Be aware that at times during the workout you will not be visible by all participants due to their position on the exercise devices 100. Therefore, you may wish to travel from the front to the back of the room so that the participants can see you at all times. Here are some positioning recommendations: Exercises requiring the instructor to face the base should be done at the front of the room, i.e., roll up, spine twist forward, hip hinge. Exercises requiring the instructor to face the tower should be done in the back of the room, i.e., push up. Exercises requiring the instructor to be positioned laterally on the exercise device 100 should be demonstrated prior to participation or the instructor should stand and be mobile. MUSIC: To use or not to use is an individual instructor's preference. Beware that music can either assist or distract a class depending upon volume and pitch. Select tempo that will suit the nature and objectives of the class.

INTRODUCTION TO PILATES CLASS: A. INTRODUCTION: Introduce yourself. Ask if there is anyone new to the class. Ask if there are any medical issues of which you need to be aware. Assure participants that they can change incline levels at any time throughout the workout to meet their individual intensity demands. Advise participants that the class is not a competition and that listening to their own body is essential to training intelligently. B. ORIENTATION TO THE EXERCISE DEVICE 100: INTRODUCTION TO THE EXERCISE DEVICE 100: Name and describe the main components of the exercise device 100 and their functions. ADJUSTING THE EXERCISE DEVICE 100: Glideboard 330 incline—For new participants, demonstrate how to change the incline levels on the exercise device 100 and then allow each participant to do so. Pulley pin placement—Demonstrate how to adjust the pin placement on the LAT bars. Telescoping squat stand—Depending upon femur length, the squat stand may be adjusted so that in a 90° squat position, the knee does not extend anterior to the toes. Adjustable foot holder—Demonstrate how the adjustable foot holder swivels up into position and away while not in use. Press the snap button to raise the top portion to demonstrate ease of utilizing the device for hamstring glide. LAT bars—Demonstrate how the LAT bars are not only used as part of the adjustable pulley system, but can be lowered for pull-ups. C. EXERCISE DEVICE SET UP: The brief exercise device orientation at the beginning of each class provides the instructor with an opportunity for participants to set up exercise devices 100 in preparation for the first exercise. D. SAFETY ASPECTS: BODY ALIGNMENT: Neutral joint positioning: During class, be aware of the neutral position of joints that are not active. For an example: check curves of lumbar and cervical spine for normal curvature. Engage core control: It is important during resistance training that the muscles of the core are activated throughout the exercises. Muscle tone must be maintained to ensure correct posture and exercise technique. The Hydraulic Amplifier Mechanism, when activated by contraction of the transverse abdominis, internal obliques and latissimus dorsi, dramatically increases trunk stabilization. Research has even shown that there is spinal decompression between L3-L4 when abdominal pressure is held. E. RANGE OF MOTION: Stay within the normal range of joint and muscular movement during each exercise. Be aware of Active vs. Passive range of motion. Passive range of motion is the range of motion in which a joint should move under load. Passive range is determined by flexibility, strength of the agonist muscle groups, and whether there has been any type of injury that limits an individual's ROM. An easy way to establish passive ROM is to have a participant move through the active ROM unloaded. See where there is tightness or muscle substitution, and limit the ROM based on the individual's ability to work through a smooth movement without pain or compensation. Use caution, however. Individuals have a much larger passive ROM then active. It is better to start off with a smaller passive ROM, and slowly increase the depth of movement, since some issues may not be apparent until an individual has additional load. Maintain control of glideboard 330 and cables at all times to avoid ballistic movement. F. BODY POSITIONING ON GLIDEBOARD 330: Ensuring correct positioning on the glideboard 330 promotes the use of accurate exercise techniques, reduces risk of injury and increases positive outcomes. G. EXERCISE INTENSITY: If exercise intensity is too high, encourage participants to modify incline or use the feet to assist in movement. Incline guidelines given are based on an individual's ability to execute the exercise with control and correct form. The occurrence of muscle substitution and/or loss of exercise technique indicates that intensity/incline level should be lowered.

PROGRESSION OF A CLASS: GENERAL PRINCIPLES OF LEARNING: THE STAGES OF LEARNING: The first stage: A participant is unaware of the exercise and unaware of the proper technique. The second stage: The participant learns the choreography but is uncertain whether he or she is performing it correctly. The third stage: The participant knows the choreography but has to concentrate on the execution to perform the movement correctly. The fourth stage: The participant knows the choreography but needs intermittent cueing on the proper technique. The fifth stage: Unconsciously the participant knows how to execute the movement with proper technique. As the participant moves through the stages, it is the responsibility of the instructor to cue accordingly. As the participant learns the movement patterns, the cues may become less frequent. Furthermore, the cues should not always be geared to what the participant is doing "wrong," but rather should focus on what the participant is performing correctly. B. CUEING: The "group" exercise environment has always required skillful cueing for proper technique. These cueing techniques are designed to ensure class participation and motivation. The cueing required for the PILATES class can be unique. Below are some tips on how to maximize class participation with effective cueing: 1. VERBAL CUEING: Choose words that are easy to understand in order to establish a mental picture of the movement. Cueing to describe a movement should focus on words that indicate what, how, where, and why, if appropriate. For an example: "Inhale—draw your navel in toward your spine and up toward the crown of your head." Choose positive uplifting words and phrases. Avoid using negative terms or the same phrase over and over. Ask questions to continually engage participants' involvement (e.g. "Would your training benefit by lowering the glideboard 330?"). Test yourself by filming yourself and critique your communication skills. Communicate proper technique with descriptive phrases that emphasize the essence of the exercise. Include only the most important cues. Cue ahead by stating the number of repetitions or what exercise is coming up next. This will allow the participant to focus on the task at hand and be ready for the next movement. Explain a specific movement pattern several ways to ensure understanding. Each PILATES exercise will provide cueing tips. Be aware of voice projections. Vary tone of voice and volume to elicit more attention and maintain motivation. Be aware that sound travels in a straight line. If a PA system is unavailable, face your participants when you are cueing. 2. NON-VERBAL CUEING/OR DEMONSTRATION: Precise demonstration of each exercise will ensure proper and safe execution. For an example, imagine the participants cannot hear the instructor. Be prepared in the essentials classes to "demo" each exercise several times and perhaps in several ways. Ensure visibility of demonstration throughout the class setting. Feel free to move around class and demonstrate from a standing position. Perform the first demonstration of a movement slowly with clear, precise motion. 3. TACTILE CUEING: The following guidelines must be followed before hands-on correction can be utilized: First, ask for permission to use hands-on. Only use finger tips (never the whole hand). Be sensitive to body language (what a participant may be trying to say without verbalizing). When in doubt, do not touch. Re-explain or demonstrate again. Know and follow your individual health club rules and regulations. 4. COACHING: Moving into the role of "coach" will be a natural progression after participants attend class on a regular basis and become educated and experienced with exercise device 100. For optimum results, try to encourage "regulars" to help role model in class and/or try to place them in areas easily viewed by newer participants. This will also allow the instructor to move around the room and correct/compliment various techniques. A few of the qualities that make a great coach are: Good role model; Friendly, approachable and personable; Authentic; Knowledgeable; Motivating; Great communicator; Is well prepared and ready; A leader in a genuine and humble way; Full of energy, entertaining, and has a good sense of humor; Show variety in communication skills (pitch, volume, interest); Avoid merely barking orders or relying only on simple phrases. Vary your style. Use simple phrases, ask questions, paint pictures, and give an excellent breakdown of what is expected to your participants.

PACE: Pace is dependent upon the level of experience in your class. Slow the pace to help participants integrate the techniques and the cueing. Be careful not to go so slowly that you lose your class' focus and interest. Avoid going so fast that the essence of Pilates exercises is lost.

ADVANCEMENT OF THE CLASS: It is important to identify when your class should progress in exercise difficulty and/or be challenged with a new sequence of exercises. PILATES using the exercise device 100 provides you with the opportunity to change to a new series of exercises when some of the following criteria are being met: An understanding of the exercises fundamentals and principles has been met. Improvement in overall class strength and flexibility. Improvement in overall class coordination. Competency in the use of various accessories for the exercise device 100.

TEACHING PRINCIPLES FOR PILATES

TEACHING NEUTRAL PELVIS: LONG SIT POSITION: Neutral pelvis is when the participant sits directly on top of the sit bones (ischial tuberosities), bringing the anterior superior iliac spine (ASIS) and the pubic bone into the same plane. 1. PELVIC ROCKING IN LONG SITTING OBJECTIVE: Enhance awareness of neutral pelvis in long sitting. Increase pelvic mobility and dissociation. Control movement in and out of neutral. STARTING POSITION: Once the incline level is determined, have the participant find where his or her sit bones (ischial tuberosities) are located. Placing the hands under the buttocks to feel the ischial tuberosities may be beneficial. Sit in neutral (on top of the ischial tuberosities) with the legs extended and hands on the pelvis for feedback. EXERCISE DESCRIPTION: Inhale—To rock forward off the sit bones, performing an anterior tilt. Exhale—To return to neutral. Inhale—To rock back off the sit bones, performing a posterior tilt. Exhale—To return to neutral. Have the participant find the midpoint position of sitting directly on top of the sit bones. Additional considerations: The participant should not compensate by moving the thorax. Cue the participant to keep the shoulders steady. SUPINE: Ideally, the ASIS (anterior superior iliac spine) and the pubic bone are aligned in the same plane. The sacrum will feel heavy on the glideboard 330 and a natural lumbar lordotic curve will be present. 1. PELVIC ROCKING IN SUPINE: OBJECTIVE: Enhance awareness of neutral pelvis in supine. Increase pelvic mobility and dissociation. Control movement in and out of neutral. STARTING POSITION: Place the heel of the hands on each of the ASIS with the index fingers pointing toward the pubic bone forming a triangle. EXERCISE DESCRIPTION: Imagine a cup of water in the middle of the triangle. Inhale—To rock the pelvis forward, creating an arch in the low back. Note how the cup of water would spill between the legs. Exhale—To rock the pelvis back flattening the lumbar lordotic curve. Note how the cup of water would spill on you. Repeat 3-5 times, then have the participant find the midpoint where the cup of water would remain full. 2. LUMBAR IMPRINTING: OBJECTIVE: Teach the difference between imprinting versus pelvic tilting. STARTING POSITION: Place the heel of the hands on the ASIS with the index fingers toward the pubic bone, forming a triangle. EXERCISE DESCRIPTION: Inhale—To flatten the lumbar spine. Exhale—To release the tilt just before the lumbar spine comes off the mat. Repeat 3-5 times, having the participant distinguish between a pelvic tilt and an imprint. Focus on maintaining abdominal activation throughout the exercise. PRONE: The ideal neutral pelvic positioning in prone is with the ASIS and pubic bone flush against the glideboard 330. 1. GLUTEAL SQUEEZE IN PRONE: OBJECTIVES: Teach neutral pelvis in prone. Teach abdominal versus hip extensor activation to achieve neutral. STARTING POSITION: Lie prone on glideboard 330 with hands by the sides or folded, resting on the forehead. EXERCISE DESCRIPTION: Lying prone on the glideboard 330: Inhale—To prepare. Exhale—To squeeze the buttocks (Note how the pelvis and lumbar spine change position). Inhale—To relax. Exhale—To pull the navel up and in (Note the spinal position). Continue to repeat this 3-5 times, having the participant distinguish between engaging the abdominals without tightening the buttocks to promote neutral pelvic positioning. SIDE-LYING: The ideal neutral position is with the hips aligned with the shoulders. The visual cue is a straight line passing directly through the hips.

TEACHING NEUTRAL THORACIC PLACEMENT: LONG SIT POSITION: The ideal thoracic placement is with the rib cage slightly imprinted, but not flexed. The correct imprint position has the sensation of knitting the bottom ribs together and down toward the pelvis. Note that the torso shape (breast or chest size) may affect the participant's ability to achieve ideal thoracic placement. 1. THORACIC IMPRINTING IN LONG SITTING: OBJECTIVES: Teach thoracic imprint with use of the breath. Encourage lateral thoracic breathing. STARTING POSITION: The participant places his or her hands on the rib cage with fingertips lying along the lower portion of the ribs. EXERCISE DESCRIPTION: Inhale—Through the nose and focus on expanding the rib cage. Exhale—Voluntarily, as if blowing through a straw, focusing on the ribs knitting together. Repeat 3-5 times, having the participant focus on slight thoracic flexion. Notice how the fingertips glide toward one another and down toward the pelvis during exhalation. Focus on maintaining the thoracic imprint while continuing breath pattern. Focus on maintaining abdominal activation throughout the exercise The participant may compensate by flexing the trunk. Correct by cueing that the motion is subtle. Once the participant finds the imprint of the lower ribs, cue to lengthen the spine and lift the collarbone while maintaining the imprint. SUPINE: The ideal placement is to have the bottom rib resting on the glideboard 330. This is known as "imprinting" in the supine position. To teach this placement, have the participant place his or her hands on the lower ribs and repeat the above exercises. Be sure to note that during the repertoire, when the legs are brought in the air, the abdominals must remain engaged in order to maintain the thoracic imprint, as well as counteract the weight of the legs. Be sure to also note during the repertoire, when the arms are brought overhead, the abdominals must remain engaged to maintain the imprint. PRONE: The ideal placement has the sensation of imprinting the ribs. For some participants this may feel like the lower ribs are drawing away from the glideboard 330. SIDE-LYING: Neutral thoracic placement is having the natural kyphotic curve maintained. 1. TUG OF WAR IN SIDE-LYING: OBJECTIVE: Teach trunk placement during side-lying. Teach scapular and torso stabilization. STARTING POSITION: Side-lying with the bottom arm long overhead and the top arm holding onto glideboard 330. EXERCISE DESCRIPTION: Inhale—To prepare. Exhale—To draw the bottom arm toward the side of the body. Keep the elbow straight as if pulling a rope down from overhead. The movement pattern will result in the bottom torso lifting off the glideboard 330.

TEACHING NEUTRAL THORACIC PLACEMENT: LONG SIT POSITION: The ideal position is to have the shoulder aligned with the hip and ear. The humerus is midrange between internal and external rotation and protraction and retraction. Ideally the humerus will align with the glenoid fossa. The scapula sits in a "neutral" or optimal position by placing the scapula in the midpoint between elevation and depression and protraction and retraction. Ideally, the scapula should sit flush against the thorax. 1. SHOULDER INTERNAL AND EXTERNAL ROTATION IN LONG SITTING: OBJECTIVES: Teach proper humeral positioning in long sitting. Enhance humeral awareness and mobility. STARTING POSITION: Long sitting with arms reaching to the side with the fingers reaching long toward the floor. Palms will face the glideboard 330. EXERCISE DESCRIPTION: Inhale—To turn the palms to face forward, externally rotating the humerus. Exhale—To return to the start position. Inhale—To turn the palms to face backward, internally rotating the humerus. Repeat 3-5 times, then have the participant find the midpoint between the internal and external rotation. 2. SHOULDER ELEVATION AND DEPRESSION: OBJECTIVES: Teach proper scapular positioning in long sitting. Enhance scapular awareness and mobility. STARTING POSITION: Long sitting with humerus in neutral. EXERCISE DESCRIPTION: Inhale—To draw the shoulders up to the ears. Exhale—To draw the shoulders away from the ears. Repeat the above 3-5 times, then have the participant find the midpoint in the range of motion. 3. SHOULDER PROTRACTION/RETRACTION IN LONG SITTING: OBJECTIVES: Teach proper scapular and shoulder position in long sitting. Enhance shoulder and scapular awareness and mobility. STARTING POSITION: Long sitting with humerus in neutral and fingertips reaching for the floor. EXERCISE DESCRIPTION: Inhale—To roll the shoulders forward. Exhale—To roll the shoulders back to the start position. Inhale—To roll the shoulders backward. Exhale—To roll the shoulders forward to the start position. Repeat 3-5 times, then have the participant find the midpoint in the range of motion. 4. SCAPULAR PROTRACTION/RETRACTION IN LONG SITTING: OBJECTIVES: Teach proper scapular positioning in long sitting. Enhance scapular awareness and mobility. STARTING POSITION: Long sitting with arms flexed to 90° with the palms facing one another. EXERCISE DESCRIPTION: Inhale—To reach the fingertips to the front wall allowing the scapulae to separate. Exhale—Keep the arms extended and slide the scapula toward one another. Repeat 5-8 times, then have the participant find the midpoint where the scapulae lie flush against the thorax. Watch for shoulder elevation. Cue to focus on isolating just the scapula. SUPINE: The ideal alignment is with the humerus sitting aligned with the glenoid fossa and the scapula sitting flush against the back. Perform the above exercises in supine. Use the glideboard 330 for verbal and tactile cueing. PRONE: Maintain the humerus sitting aligned with the glenoid fossa and the scapula sitting flush against the thorax. 1. PRONE SCAPULAR AND SHOULDER RETRACTION AND PROTRACTION: OBJECTIVES: Teach proper scapular and humeral positioning in prone. Enhance scapular awareness and mobility. STARTING POSITION: Prone with chest at the top of the glideboard 330 and legs together or shoulder width apart. The head can be supported or suspended. Flex the arms to 90° with palms facing each other. EXERCISE DESCRIPTION: Inhale—To reach the fingertips toward the floor allowing the scapulae to separate. Exhale—To keep the arms extended and slide the scapulae toward one another. Do not allow the elbows to flex. Repeat the above 5-8 times, then have the participant find the midpoint where the scapula will lie flush against the thorax. 2. PRONE SCAPULAR AND SHOULDER ELEVATION AND DEPRESSION: OBJECTIVES: Teach proper scapular and humeral positioning. Enhance awareness of scapular mobility. STARTING POSITION: Prone with chest at the top of the glideboard 330 and legs together or shoulder width apart. Arms extended by side of body with fingertips reaching toward the feet. Head is supported or suspended. EXERCISE DESCRIPTION: Inhale—To draw the shoulders up to the ears. Exhale—To draw the shoulders away from the ears. Repeat the above 3-5 times, then have the participant find the midpoint in the range of motion. 3. ARMS OVERHEAD WHILE PRONE, WITH PALMS FACING ONE ANOTHER: OBJECTIVES: Teach proper scapular and humeral positioning. Enhance awareness of scapular mobility. STARTING POSITION: Lie prone with chest at the top of the glideboard 330 and legs together or shoulder width apart. Arms are extended overhead with palms facing one another. Head is supported or suspended. EXERCISE DESCRIPTION: Inhale—To reach the fingers toward the tower. Exhale—To draw the scapulae down the back. Repeat 3-5 times, then have the participant find the midpoint in the range of motion. SIDE-LYING: Maintain the humerus sitting aligned with the glenoid fossa and the scapula sitting flush against the thorax. When in this position, reach the bottom arm overhead in line with the body, or bend the bottom elbow to support the head. 1. TUG OF WAR: OBJECTIVES: Teach neutral humeral and scapular position in sidelying. Enhance awareness of scapular mobility. STARTING POSITION: Bottom arm is long overhead and top arm is supported on glideboard 330 for essentials and resting along the top of the thigh for more intermediate participants. EXERCISE DESCRIPTION: Inhale—To prepare. Exhale—To draw the scapulae down the back, allowing the bottom of the torso to lift off the board. Repeat 3-5 times, then have the participant find the midpoint in the range of motion.

TEACHING CERVICAL POSITIONING: LONG SIT POSITION: The proper alignment is achieved when the ear, shoulders and hips are aligned over one another. The head is neither projected forward nor pulled backward; rather, it is in the midpoint of the range of motion. It is also important to note that the head is neither hyperextended (tilted up) nor hyperflexed (tilted down). Rather, it is in the midpoint in the range of motion. 1. CERVICAL NODDING IN LONG SITTING: OBJECTIVES: Teach neutral cervical positioning in long sitting. Improve awareness of cervical alignment and mobility. STARTING POSITION: Seated upright with neutral pelvis, lumbar and thoracic spine. Abdominals engaged. EXERCISE DESCRIPTION: Inhale—To flex the neck, dropping the chin toward the chest. Exhale—To return to the start position. Inhale—To extend the neck, looking up toward the ceiling. Exhale—To return to the start position. Repeat 3-5 times, then have the participant find the midpoint in the range of motion. A feeling of lengthening in the back of the neck will be present. 2. CERVICAL RETRACTION AND PROTRACTION IN LONG SITTING: OBJECTIVES: Teach neutral cervical positioning in long sitting. Improve awareness of cervical alignment and mobility. STARTING POSITION: Seated upright with neutral pelvis, lumbar and thoracic spine. Abdominals engaged. EXERCISE DESCRIPTION: Inhale—To project the head slightly forward, like a turtle peeking out of its shell. Exhale—To return to the start position. Inhale—To retract the head slightly back, like a turtle returning to its shell. Exhale—To return to the start position. Repeat 3-5 times, then have the participant find the midpoint of the range of motion. Be careful not to press the chin too far backward. SUPINE: The proper alignment is the same as above. The participant may have the sensation of increased pressure on the back of the skull. Cue to perform a slight nod to lengthen the neck. If needed, cue to look diagonally upward. Exercises are the same as above, but note that the execution of the movement may be different because the head is now supported. When bringing the head off the glideboard 330 from this position, cue the participant's gaze toward the knees or thighs, not up to the ceiling. This may help to promote the lengthening in the cervical spine and allow less tension in the cervical flexors. If cervical discomfort is detected, maintain cervical support on the glideboard 330. Make sure the shoulder girdle is stabilized, and that there is not excessive cervical flexion or extension contributing to the discomfort. Participants with tightness in the cervical flexors or extensors may have difficulty lying supine. In order to position them in a better alignment, place a small pad or the Support Wedge Pillow underneath the head and/or shoulder girdle. PRONE: The proper position is the same as the above, but the likelihood of entering into hyperextension is greater. Ideally, the tip of the nose should point toward the glideboard 330, allowing a lengthening to occur in the cervical spine. 1. CERVICAL RETRACTION IN PRONE: OBJECTIVE: Teach neutral cervical positioning in prone position. STARTING POSITION: Prone with hands to the outside of the shoulder or placed underneath the forehead. EXERCISE DESCRIPTION: Inhale—To draw the nose away from the board. Exhale—To lower down. Repeat this movement pattern 3-5 times then have the participant gently place the forehead on the glideboard 330/hands. SIDE-LYING: The proper alignment in side-lying is for the head to stay aligned with the spine without deviating into sidebending/lateral flexion.

TEACHING KNEE ALIGNMENT: LONG SIT POSITION: The proper alignment has the knees aligned with the ankles and hips. The knees are extended without hyperextending. The femurs are in the midpoint between internal and external rotation. The patellas are facing up to the ceiling. 1. QUAD SETS IN LONG SITTING: OBJECTIVES: Teach activation of the knee extensors to straighten the knee versus passive ligamentous tension (which is simply letting gravity push the knee into hyperextension). Promote proper patella tracking. STARTING POSITION: Long sitting with the legs extended, hands by the side of the body, fingertips reaching toward the floor. EXERCISE DESCRIPTION: Inhale—To prepare. Exhale—To contract the quadriceps. Cue to tighten the front of the thigh, pulling the kneecaps up toward you. Resist the urge to hyperextend or lock the knee. 2. EXTERNAL AND INTERNAL ROTATION: OBJECTIVE: To promote proper femoral alignment. STARTING POSITION: Sit with the legs extended, hands by the side of the body, fingertips reaching toward the floor. EXERCISE DESCRIPTION: Inhale—To roll the inner thighs toward the floor. Exhale—To roll the inner thighs to face the ceiling. Repeat 3-5 times, then have the participant find the midpoint in the range of motion. SUPINE: The same exercises apply when in the supine position. When executing movement, be sure to keep the patellas facing the ceiling, not facing off to one side. The instructor may have to tactilely provide feedback on maintaining alignment during movement. Ask for permission before touching the participant. PRONE: The proper alignment is the same for the prone position. The cueing can be to have the soles of the feet straight up toward the ceiling or the tops of the feet flush against the floor. When cueing a person out of internal or external rotation and into neutral, provide a visual cue of lengthening or reaching the tops of the toes to the back wall. When executing the movement, keep the patellas facing the floor and not to the sides. The instructor may have to tactilely provide feedback on maintaining alignment during movement. SIDE-LYING: Ideally, the knees face forward, neither up to the ceiling nor down to the floor. If this is difficult for the participant to achieve, then cue to turn the toes up to the ceiling and down to the floor. Find the midpoint.

TEACHING THE BREATH: The mode of breathing in Pilates is lateral thoracic breathing. As described earlier, the objective is to promote the breath into the sides (lateral aspect) and the back (posterior aspect) of the thorax. The inhalation is through the nose and the exhalation is voluntary through the mouth. Throughout either phase of the breathing, the goal is to maintain abdominal activation. OBJECTIVES: Teach posterior-lateral thoracic breathing with abdominal activation. Enhance awareness of using the breath to imprint the thorax. STARTING POSITION: Long sitting, supine, prone or sitting with the knees bent and the upper body resting over the knees. The hands can be positioned so that the fingertips wrap around the lower ribs. Ensure that the shoulders stay relaxed. EXERCISE DESCRIPTION: Inhale—Through the nose. Exhale—Through the mouth as if you are blowing through a straw or pursing the lips. Repeat cueing to exhale and draw the navel in toward the spine and up toward the crown of the head. Cue to hold in the navel and inhale. This will direct the breath more deeply into the posterior-lateral aspect as opposed to the belly. Additionally, draw awareness to the movement of the hands as the rib cage expands during inhalation and knits together during exhalation. The above breath pattern can be taught in any position; however, the easiest position to teach a participant this pattern may be with the knees bent and the upper body resting on the thighs or in long sitting. The rest position or child's pose is sitting on the back of the heels and flexed forward at the hips. It can allow for greater expansion and facilitation of the breath into the posterior aspect of the thorax. Incorporating awareness to the breath at various points in the workout will assist the participant in learning lateral-thoracic breathing.

The following is an exemplary order of exercises and steps for a FOUNDATION CLASS for PILATES using the exercise device 100: Incline Level 5 with telescoping squat stand. 1. Pelvic Rocking; 2. Thoracic Imprinting with Focus on the Breath; 3. Shoulder Internal and External Rotation; 4. Shoulder Protraction/Retraction; 5. Cervical Nodding; 6. Cervical Protraction and Retraction; 7. Quad Sets; 8. Femoral Internal and External Rotation; Roll Back into Supine; Prepare for Pelvic Rocking in Supine; 9. Pelvic Rocking; 10. Shoulder Flexion-Extension; 11. Scapular Protraction and Retraction; 12. Cervical Nodding; 13. Cervical Protraction and Retraction; Transition to the Right Side-lying; Prepare for Tug O'War; 14. Tug O'War; 15. Prone Scapular and Shoulder Retraction and Protraction; 16. Prone Scapular and Shoulder Elevation and Depression; 17. Prone Arms Overhead with Palms Facing One Another; 18. Tug O'War Transition to Supine Prepare for Roll Up; 19. Roll Up; 20. Hip Hinge Forward; 21. Spine Stretch Forward; 22. Spine Twist; 23. Saw; 24. Scooping; 25. Side Twist; 26. Scooping Back; 27. Side Twist; 28. Hundred; 29. Heels Squeeze and Lengthen. Each of these exercises is described in more detail below in the following sections.

Reformat Evolved Series™

The following is an exemplary order of exercises and steps for a REFORMAT EVOLVED™ CLASS for PILATES using the exercise device 100: Incline Level 4 or below without telescoping squat stand. 1. Roll Up; 2. Hip Hinge Forward; 3. Spine Stretch Forward; 4. Tree; 5. Spine Twist; 6. Roll Back with Twist; 7. Saw; 8. Push Up; 9. Sidebend; 10. Leg Pull; 11. Chest Stretch; 12. Sidebend; 13. Leg Pull Front with Hamstring Stretch; 14. Scooping; 15. Hug a Tree; 16. Soccer Toss; 17. Side Twist; 18. Bicep Curl with Spinal Stretch; 19. Side Twist; 20. Hamstring Glide; 21. Inverted Roll Back with Hamstring Stretch; 22. Swan Dive Prep 1; 23. Crouching Tiger #1; 24. Essential Side-lying Leg Lifts; 25. Back Extension; 26. Back Extension with Twist; 27. Essential Side-lying Leg Lifts; 28. Hundred; 29. Bend and Stretch; 30. Swimming; 31. Neck Pull; 32. One Leg Circle; 33. Essential Hip Rolls. Each of these exercises is described in more detail below.

The following is an exemplary order of exercises and steps for a REFORMAT EVOLVED™ STAGE 1 CLASS for PILATES using the exercise device 100: Incline Level 5 with telescoping squat stand. 1. Roll Up 4; 2. Hip Hinge Forward; 3. Spine Stretch Forward; 4. Tree; 5. Spine Twist; 6. Roll Back with Twist; 7. Saw; 8. Scooping; 9. Hug a Tree; 10. Side Twist; 11. Bicep Curl and Spinal Stretch; 12. Side Twist; 13. Hamstring Glide; 14. Essential Side-lying Leg Lifts; 15. Swimming; 16. Essential Side-lying Leg Lifts; 17. Hundred; 18. Essential Hip Rolls. Each of these exercises is described in more detail below.

The following is an exemplary order of exercises and steps for a REFORMAT EVOLVED™ STAGE 2 CLASS for PILATES using the exercise device 100: Incline Level 5 or below without telescoping squat stand. 1. Roll Up 4; 2. Hip Hinge Forward; 3. Spine Stretch Forward; 4. Tree; 5. Spine Twist; 6. Roll Back with Twist; 7. Saw; 8. Push Up; 9. Sidebend; 10. Leg Pull; 11. Chest Stretch; 12. Sidebend; 13. Leg Pull Front with Hamstring Stretch; 14. Scooping; 15. Hug a Tree; 16. Soccer Toss; 17. Side Twist; 18. Bicep Curl with Spinal Stretch; 19. Side Twist; 20. Hamstring Glide; 21. Essential Side-lying Leg Lifts; 22. Back Extension; 23. Essential Side-lying Leg Lifts; 24. Hundred; 25. Bend and Stretch; 26. Swimming; 27. One Leg Circle; 28. Essential Hip Rolls. Each of these exercises is described in more detail below.

The following is an exemplary order of exercises and steps for a REFORMAT EVOLVED™ STAGE 3 CLASS for PILATES using the exercise device 100: Incline Level 4 or below without telescoping squat stand. 1. Roll Up 4; 2. Hip Hinge Forward; 3. Spine Stretch Forward; 4. Tree; 5. Spine Twist; 6. Roll Back with Twist; 7. Saw; 8. Push Up; 9. Sidebend; 10. Leg Pull; 11. Chest Stretch; 12. Sidebend; 13. Leg Pull Front with Hamstring Stretch; 14. Scooping; 15. Hug a Tree; 16. Soccer Toss; 17. Side Twist; 18. Bicep Curl with Spinal Stretch; 19. Side Twist; 20. Hamstring Glide; 21. Inverted Roll Back with Hamstring Stretch; 22. Swan Dive Prep 1; 23. Crouching Tiger #1; 24. Essential Side-lying Leg Lift; 25. Back Extension; 26. Back Extension with Twist; 27. Essential Side-lying Leg Lifts; 28. Hundred; 29. Bend and Stretch; 30. Swimming; 31. Neck Pull; 32. One Leg Circle; 33. Essential Hip Roll. Each of these exercises is described in more detail below.

The following is an exemplary order of exercises and steps for a REFORMAT EVOLVED™ STAGE 4 CLASS for PILATES using the exercise device 100: Incline Level 2 without telescoping squat stand. 1. Roll Up; 2. Toe Tapping; 3. Bridging; 4. Hundred; 5. Spine Stretch Forward; 6. Scooping Back; 7. Gliding; 8. Side Twist; 9. Offering; 10. Side Twist; 11. Hamstring Glide with Hamstring Stretch; 12. Essential Side Kick; 13. Heel Squeeze and Lengthen; 14. Rest Position; 15. Crouching Tiger #2; 16. Essential Side Kick; 17. Single Leg Kick; 18. Hip Hinge Forward; 19. Saw; 20. Gluteal Stretch. Each of these exercises is described in more detail below.

The following is an exemplary order of exercises and steps for a REFORMAT EVOLVED™ STAGE 5 CLASS for PILATES using the exercise device 100: Incline Level 2 without telescoping squat stand. 1. Roll Up; 2. Toe Tapping; 3. Bridging; 4. Hundred; 5. Essential Shoulder Bridge with Straight Leg Raise; 6. Spine Stretch Forward; 7. Scooping Back; 8. Gliding; 9. Half Roll Back With Sweep; 10. Spine Extensor Stretch; 11. Side Twist; 12. Offering; 13. Side Twist; 14. Hamstring Glide with Hamstring Stretch; 15. Inverted Double Leg Circles; 16. Essential Side Kick; 17. Heel Squeeze and Lengthen; 18. Rest Position; 19. Crouching Tiger #2; 20. Essential Side Kick; 21. Single Leg Kick; 22. Sidebend; 23. Double Leg Kick; 24. Sidebend; 25. Hip Hinge Forward; 26. Tree; 27. Saw; 28. Gluteal Stretch. Each of these exercises is described in more detail below.

The following is an exemplary order of exercises and steps for a REFORMAT EVOLVED™ STAGE 6 CLASS for PILATES using the exercise device 100: Incline Level 2 without telescoping squat stand. 1. Roll Up; 2. Toe Tapping; 3. Bridging; 4. Hundred; 5. Essential Shoulder Bridge with Straight Leg Raise; 6. Spine Stretch Forward; 7. Scooping Back; 8. Gliding; 9. Half Roll Back With Sweep; 10. Bicep Coordination; 11. Spine Extensor Stretch; 12. Side Twist;

13. Offering; 14. Side Twist; 15. One Leg Stretch With Arm Pulley; 16. Teaser Prep 1 With Arm Pulley; 17. Hamstring Glide with Hamstring Stretch; 18. Inverted Double Leg Circles; 19. Inverted Rollover; 20. Essential Side Kick; 21. Heel Squeeze and Lengthen; 22. Rest Position; 23. Crouching Tiger #2; 24. Essential Side Kick; 25. Single Leg Kick; 26. Sidebend; 27. Double Leg Kick; 28. Sidebend; 29. Bend And Stretch; 30. Hip Hinge Forward; 31. Tree; 32. Saw; 33. Gluteal Stretch. Each of these exercises is described in more detail below.

Roll Up

ACCESSORY: Telescoping squat stand; Optional Weight Bar; Optional Dowel. OBJECTIVES: Improve or maintain spinal articulation. Challenge core stability. Work the spinal and hip flexors. Improve pelvic and lower extremity dissociation. PRIME MOVERS: During the Roll Up: Concentric spinal and hip flexors. Concentric shoulder extensors to initiate the shoulder extension, followed by eccentric shoulder flexors to maintain the arms shoulder level. During the Roll Back: Eccentric spinal and hip flexors. Concentric shoulder flexors to return the arms overhead followed by eccentric shoulder extensors. PRIME STABILIZERS: Hip extensors to assist in performing a posterior pelvic tilt. Knee extensors to limit knee flexion. Scapular stabilizers to limit shoulder elevation and cervical tension. Deep lumbo-pelvic musculature to support the spinal column and to facilitate the hydraulic amplifier mechanism. INCLINE GUIDELINE: 8 to 1—Decrease incline for torso focus. 1 to 8—Increase incline to accommodate lack of hamstring flexibility. STARTING POSITION: Disconnect arm pulley from the glideboard 330. Push the glideboard 330 halfway up the rails, straddle the glideboard 330 and sit at the bottom edge. Place the feet shoulder width apart on the rails of the telescoping squat stand or place the feet together on the telescoping squat stand platform. Extend the legs. With the pelvis near the bottom of the glideboard 330, lie back, ensuring head is fully supported. Extend the arms overhead. EXERCISE DESCRIPTION: Inhale—To lengthen the back of the neck and float the arms toward the ceiling. Exhale—To roll up by flexing the cervical, thoracic, and lumbar spine followed by the pelvis. The trunk will flex up and over the legs creating "C" curve in the spine. Inhale—To roll back by posteriorly rotating the pelvis onto the glideboard 330. Emphasize articulating the spine one vertebra at a time onto the glideboard 330 beginning with the lumbar spine. The arms remain shoulder level. Exhale—To continue rolling the thoracic and cervical spine onto the glideboard 330. The arms will stay shoulder level until the head is on the glideboard 330 and then they flex overhead. REPETITIONS: 5-10 times TEACHING TIPS: Watch for cervical hyperflexion. Gaze up and over the knees. Hold an imaginary ball between the chin and the chest. Watch for cervical strain. Initiate the movement with the sensation of sliding the ribs toward the pelvis prior to movement. Watch for loss of thoracic imprint, "popping of the ribs." Slide the ribs together and down without compensating by flexing the trunk. "Knit" the ribs together. Watch for shoulder protraction (rounding of the shoulders) or collapsing through the collarbone. Lift the collarbone up while maintaining an imprinted ribcage. Think wide through the collarbone. Slide the scapulae toward one another. Watch for proper spinal articulation. "Peel" the spine, not lift, off the glideboard 330. Watch for lack of dissociation between the pelvis and lower extremities. Maintain the lower extremities and torso steady as the pelvis posteriorly rotates to initiate the roll down. Watch for proper femoral alignment. If the leg is internally rotating, turn the inner thigh up toward the ceiling. If the leg is externally rotating, turn the inner thigh down toward the floor. Watch for loss of abdominal activation. Draw the navel in toward the spine and up toward the crown of the head. PROGRESSIONS/VARIATIONS: Have a participant hold a dowel/pole or a ball between the hands to assist in maintenance of shoulder flexion and width through the clavicles (collar bones). To intensify, keep the arms overhead with the head in between the arms as the participant rolls up and down. To intensify, the participant can hold a medicine ball. To strengthen lateral trunk stabilizers, place one hand behind the head while the other arm reaches to the front or stays by the side of the body. SAFETY ASPECTS: Spinal and sacroiliac vulnerabilities which are exacerbated by flexion. Cervical strain or vulnerability. Hip vulnerability, especially for those with hip precautions limiting flexion, adductor or external rotation.

Hip Hinge Forward

ACCESSORY: Telescoping squat stand. OBJECTIVES: Stretch the hamstrings. Teach correct lumbar and pelvic dissociation. Strengthen the spinal extensors eccentrically and concentrically. Teach neutral spine during hip flexion. PRIME MOVERS: Hinging forward: Spinal extensors eccentrically and hip flexors concentrically. Returning to neutral: Spinal extensors concentrically and hip extensors. PRIME STABILIZERS: Quadriceps to limit knee flexion. Shoulder girdle stabilizers to avert shoulder elevation and decrease cervical tension. Trunk flexors to assist with initiating and maintaining thoracic imprint. Deep lumbo-pelvic musculature to support the spinal column and to facilitate the hydraulic amplifier mechanism. Cervical extensors to limit excessive cervical hyper flexion. INCLINE GUIDELINE: 8 to 1—Adjust incline higher to accommodate lack of hamstring flexibility. 8 to 1—Decrease incline for torso focus. STARTING POSITION: Disconnect arm pulley from the glideboard 330. Push the glideboard 330 halfway up the rails, straddle the glideboard 330 and sit at the bottom edge. Place the feet shoulder width apart on the rails of the telescoping squat stand or place the feet together on the telescoping squat stand platform. Extend the legs. The pelvis is in neutral with the arms by the sides of the body. EXERCISE DESCRIPTION: Inhale—To prepare. Exhale—To flex the hips maintaining neutral spine and pelvic position. Allow the glideboard 330 to glide up the incline. Inhale—To maintain the position. Exhale—To maintain the position. Inhale—To maintain the position. Exhale—To return to the start position. REPETITIONS: 3-5 times. TEACHING TIPS: Watch for shoulder protraction (rounding of the shoulders) or collapsing through the collarbone. Lift the collarbone up while maintaining an imprinted ribcage. Think wide through the collarbone. Slide the scapulae toward one another. Watch for loss of thoracic imprint, "popping of the ribs." Slide the ribs together and down without compensating by flexing the trunk. "Knit" the ribs together. Watch for loss of abdominal activation. Draw the navel in toward the spine and up toward the crown of the head. Watch for proper femoral alignment. If the leg is internally rotating, turn the inner thigh up toward the ceiling. If the leg is externally rotating, turn the inner thigh down toward the floor. Watch for hyperextension of the knees. Maintain a soft bend in the knee while maintaining the front of the thigh "tight." Imagine forming a "V" or a "pike" position in the body. Press the glideboard 330 up the incline, or lengthen the tailbone away from the crown of the head while reaching the crown of the head to the front wall. PROGRESSIONS/VARIATIONS: To increase flexibility of the hamstrings, maintain the forward hinge position for a longer duration. To increase muscular work of the spinal extensors, decrease duration in the forward hinge position. To intensify the work of the scapular stabilizers and the trunk flexors, place the arms overhead. To challenge the lateral spinal stabilizers of the torso, bring one arm overhead while keeping the other arm by the side, on the forehead, or reaching out in front at shoulder level. SAFETY ASPECTS: Spinal and sacroiliac vulnerabilities which are exacerbated by flexion. Hip vulnerabilities, especially for those with hip precautions limiting flexion, adductor or external rotation.

Spine Stretch Forward

ACCESSORY: Telescoping squat stand. OBJECTIVES: Stretch and work the spinal erectors and rotator muscles. Teach spinal extensor muscular control during spinal flexion. Facilitate greater exhalation during spinal flexion increase lung capacity. PRIME MOVERS: To flex forward: Concentric hip flexors and eccentric trunk extensors. To roll up: Concentric trunk extensors. PRIME STABILIZERS: Hip extensors to assist performing a posterior pelvic tilt. Knee extensors to maintain knee extension. Deep lumbo-pelvic musculature to support the spinal column and to facilitate the hydraulic amplifier mechanism. INCLINE GUIDELINE: 8 to 1—Adjust incline higher to accommodate lack of hamstring flexibility. STARTING POSITION: Disconnect arm pulley from the glideboard 330. Push the glideboard 330 halfway up the rails, straddle the glideboard 330 and sit at the bottom edge. Place the feet shoulder width apart on the rails of the telescoping squat stand or place the feet together on the telescoping squat stand platform. Extend the legs. The pelvis is in neutral with the hands gently resting on the top of the thighs. EXERCISE DESCRIPTION: Inhale—To lengthen through the back of the neck. Exhale—To sequentially start flexing the spine down and slightly forward leading from the top of the spine. Slide the hands forward along the tops of the thighs and legs. Do not let the pelvis change its position, i.e. it should not move. Inhale—Maintain position. Exhale—Slowly start extending the spine back to the starting position. Lead from the bottom of the spine while simultaneously allowing scapular depression. REPETITIONS: 3-5 times. TEACHING TIPS: Watch for cervical hyperflexion. Gaze up and over the knees. Hold an imaginary ball between the chin and the chest. Watch for excessive shoulder elevation. Lengthen the shoulders away from the ears. Slide, don't press, the shoulder blades (scapulae) down the back. Watch for loss of abdominal activation. Draw the navel in toward the spine and up toward the crown of the head. Watch for proper femoral alignment. If the leg is internally rotating, turn the inner thigh up toward the ceiling. If the leg is externally rotating, turn the inner thigh down toward the floor. Watch for proper spinal articulation. "Peel" the spine away from an imaginary pole. Roll up and over an imaginary ball. Watch for awareness of breathing. In the forward flexed position, maintain the ribs knitted together. PROGRESSIONS/VARIATIONS: To assist with limiting shoulder protraction, interlace the fingers with palms facing out and rest hands on forehead. To focus on shoulder stabilization or to limit shoulder protraction, flex arms to shoulder level. To facilitate relaxation of the lower body, have the glideboard 330 closed while the participant is seated at the top of the board. SAFETY ASPECTS: Spinal and sacroiliac vulnerabilities which are exacerbated by flexion. Postural faults exacerbated by spinal flexion. Hip vulnerability, especially for those with hip precautions limiting flexion, adductor or external rotation.

Tree

ACCESSORY: Telescoping squat stand. OBJECTIVES: Stretch and work the spinal flexors. Challenge the lateral stability of the pelvis. Stretch the hip extensors and flexors. PRIME MOVERS: To flex and extend the knee: Knee extensors to eccentrically to control knee flexion and concentrically to extend the leg. To flex and extend the hip: Hip flexors concentrically to flex the hip and eccentrically to lower the leg. To roll back: Spinal flexors, hip extensors and hamstrings eccentrically to assist in posterior pelvic tilt. To roll forward: Concentric hip and trunk flexion. PRIME STABILIZERS: Trunk lateral flexors to prevent shifting of the pelvis. Hip extensors to assist with posterior pelvic tilt and to limit excessive hip flexion. Deep lumbo-pelvic musculature to support the spinal column and to facilitate the hydraulic amplifier mechanism. Knee extensor, especially on the side of the supporting leg, to maintain knee extension. INCLINE GUIDELINE: 8 to 1—Adjust incline higher to accommodate lack of hamstring flexibility. STARTING POSITION: Disconnect arm pulley from the glideboard 330. Push the glideboard 330 halfway up the rails, straddle the glideboard 330 and sit at the bottom edge. Place the feet shoulder width apart on the rails of the telescoping squat stand or place the feet together on the telescoping squat stand platform. Extend the legs. Bend the right knee toward the chest, bringing hip and knee to a flexed position of 90° (tabletop position). The left hand reaches along the inside of the right leg for the ankle while the right hand is resting underneath the right knee. EXERCISE DESCRIPTION: Inhale—To lengthen the spine. Exhale—To lengthen right leg without losing neutral spine or pelvis. Inhale—To flex the right knee to tabletop. Exhale—To lengthen the right leg without losing neutral spine. Inhale—To flex the right knee to tabletop. Exhale—To lengthen the free leg without losing neutral spine. Inhale—To keep the right leg extended and walk the hands up the leg toward the ankle. Exhale—To perform a posterior pelvic tilt allowing the spine to flex into a "C" curve position. Simultaneously, walk the hands down the leg. The right leg can remain extended or enter into flexion to alleviate hamstring tightness. Inhale—To stay and keep the abdominals engaged. Exhale—To roll up into the start position with the hands walking up toward the ankle. To flex the spine beginning with the cervical, followed by thoracic, then lumbar spine. Inhale—To bend the knee and return the hands to the original start position Exhale—To straighten the leg and place it back onto the glideboard 330. Switch legs. REPETITIONS: 1-3 times for each leg. TEACHING TIPS: Watch for cervical hyperflexion. Gaze up and over the knees. Hold an imaginary ball between the chin and the chest. Watch for cervical strain. Initiate the movement with the sensation of sliding the ribs toward the pelvis prior to movement. Watch for excessive shoulder elevation. Lengthen the shoulders away from the ears. Slide, don't press, the shoulder blades (scapulae) down the back. Watch for loss of thoracic imprint, "popping of the ribs." Slide the ribs together and down without compensating by flexing the trunk. "Knit" the ribs together. Watch for loss of abdominal activation. Draw the navel in toward the spine and up toward the crown of the head. Watch for equal weight bearing through the pelvis. Bear weight evenly through both sides of the pelvis. Greater weight bearing tends to occur on the unsupported side. Place greater weight on the supported side. Watch for proper femoral alignment. If the leg is internally rotating, turn the inner thigh up toward the ceiling. If the leg is externally rotating, turn the inner thigh down toward the floor. Watch for proper spinal articulation. "Peel" the spine, don't lift, off the glideboard 330. PROGRES- SIONS/VARIATIONS: Limit the amount of hip flexion and knee extension for the beginner. To challenge, when the participant rolls all the way back, let the body rest on the mat and bring the arms over the head to stretch the abdominals and shoulder extensors. For the more intermediate participant, have the glideboard 330 closed and the buttocks toward the upper half of the board. When the participant rolls all the way back, he or she may further extend the thoracic and cervical spine, allowing the head to lower below the glideboard 330. SAFETY ASPECTS: Spinal and sacroiliac vulnerabilities which are exacerbated by flexion. Postural faults exacerbated by spinal flexion. Hip vulnerability, especially for those with hip precautions limiting flexion, adductor or external rotation. Participants with previous hamstring strain or pull. Spinal vulnerability, especially when spinal lateral trunk flexor and rotator weakness are present.

Spine Twist

ACCESSORY: Telescoping squat stand; Optional Dowel; Optional Weight Bar. OBJECTIVES: Increase or maintain range of motion for thoracic rotation. Improve kinesthetic awareness of posture, especially during thoracic rotation. Increase awareness and strength in the torso rotators. Teach dissociation between the trunk and pelvis/lower extremities. PRIME MOVERS: To abduct and adduct the arms: Shoulder abductors concentrically to raise the arms and eccentrically to lower the arms. To rotate the torso: Concentric and eccentric trunk rotators. PRIME STABILIZERS: Spinal erectors to limit thoracic extension. Trunk flexors to assist with maintaining thoracic imprint. Shoulder girdle stabilizers to prevent dropping of the arms or elevation. Deep lumbo-pelvic musculature to support the spinal column and to facilitate the hydraulic amplifier mechanism. INCLINE GUIDELINE: 8 to 1—Adjust incline higher to accommodate lack of hamstring flexibility. STARTING POSITION: Disconnect arm pulley from the glideboard 330. Push the glideboard 330 halfway up the rails, straddle the glideboard 330 and sit at the bottom edge. Place the feet shoulder width apart on the rails of the telescoping squat stand or place the feet together on the telescoping squat stand platform. Extend the legs. EXERCISE DESCRIPTION: Inhale—To lengthen the spine. Exhale—To abduct the arms to shoulder height, i.e. parallel with the floor. Inhale—To rotate torso one way without moving the pelvis or lumbar spine. Exhale—To return to center. Inhale—To lower the arms to sides. Repeat to other side. REPETITIONS: 5 rotations each way. TEACHING TIPS: Watch for dropping of the arms as the torso rotates. Keep the arms level, pressing down on an imaginary countertop. Maintain energy in the upper body. Watch for shoulder protraction (rounding of the shoulders) or collapsing through the collarbone. Lift the collarbone up while maintaining an imprinted ribcage. Think wide through the collarbone. Slide the scapulae toward one another. Watch for loss of thoracic imprint, "popping of the ribs." Slide the ribs together and down without compensating by flexing the trunk. "Knit" the ribs together. Watch for loss of abdominal activation. Draw the navel in toward the spine and up toward the crown of the head. Watch for shifting of the pelvis. Maintain the legs extended. If using the Telescoping Toe Bar or telescoping squat stand, maintain the feet flush up against the platform. PROGRESSIONS/VARIATIONS: On the first exhale, raise the arms to high fifth position (overhead) and lower them to horizontal on the torso rotation, then raise arms high as the torso on return to center. If the participant continues to engage the trapezius, then have the participant exhale with rotation and inhale to de-rotate. To encourage greater stretch, use 3 short breaths, exhaling or inhaling. Pause with each breath and cue to lengthen the spine. To facilitate a greater thoracic extension and midback muscular activation, bend the back elbow during rotating. Let the arm straighten when de-rotating to the center. SAFETY ASPECTS/CONTRAINDICATIONS: Spinal and sacroiliac vulnerabilities which are exacerbated by flexion and rotation. Cervical strain or vulnerability. Shoulder vulnerability, especially for those with impingement, tendonitis or instability.

Roll Back with Twist

ACCESSORY: Telescoping squat stand; Optional Dowel; Optional Weight Bar. OBJECTIVES: Increase or maintain lumbar and thoracic flexion and rotation. Improve or maintain articulation of the pelvis and lumbar spine. Teach dissociation between the pelvis and lower extremities and between the pelvis and trunk during rotation. Increase awareness and strength of the spinal rotators. PRIME MOVERS: To roll back: Trunk and hip flexors eccentrically and hip extensors concentrically to facilitate posterior pelvic tilting. To rotate: Concentric and eccentric trunk rotators. To flex and extend the arms: Concentric and eccentric shoulder flexors. To roll up: concentric spinal extensors. PRIME STABILIZERS: Spinal extensors to assist with posterior tilting and to limit excessive trunk flexion. Shoulder girdle stabilizers to limit shoulder elevation. Deep lumbo-pelvic musculature to support the spinal column and to facilitate the hydraulic amplifier mechanism. INCLINE GUIDELINE: 1 to 8—Adjust incline higher to accommodate lack of hamstring flexibility. 8 to 1—Adjust incline lower to increase spinal flexor work. STARTING POSITION: Disconnect arm pulley from the glideboard 330. Push the glideboard 330 halfway up the rails, straddle the glideboard 330 and sit at the bottom edge. Place the feet shoulder width apart on the rails of the telescoping squat stand or place the feet together on the telescoping squat stand platform. Extend the legs. Flex the arms to shoulder level with the hands clasped together (first position). Pelvis is in neutral. EXERCISE DESCRIPTION: Inhale—To slide the shoulders away from the ears. Exhale—To roll the pelvis away from the femur and flex the lumbar and then lower thoracic spine onto the glideboard 330, forming a "C" shape position in the spine, maintaining the arms at shoulder level. Inhale—To rotate the torso to the right while maintaining the pelvis square to the front. Exhale—To de-rotate back to center. Inhale—To rotate to the opposite direction. Exhale—To de-rotate back to center. Inhale—To roll forward flexing the upper body from the cranium to sacrum and deepening the "C" curve. The arms remain overhead. Exhale—To continue rolling forward bringing the torso over the hips and reaching the hands toward the feet. Inhale—To stay. Exhale—To articulate the spine into a neutral position while allowing the arms to stay at shoulder level. Inhale—To float the arms back overhead. REPETITIONS: 3-5 rotations each way. TEACHING TIPS: Watch for excessive shoulder elevation. Lengthen the shoulders away from the ears. Slide, don't press, the shoulder blades (scapulae) down the back. Watch for dropping of the arms as the torso rotates. Keep the arms level, pressing down on an imaginary countertop. Maintain energy in the upper body. Watch for loss of abdominal activation. Draw the navel in toward the spine and up toward the crown of the head. Watch for excessive lateral flexion versus rotation. Stay lengthened in the torso. Maintain equal distance between the lower rib and the pelvis. Imagine toothpicks lifting the ribcage up and away from the pelvis. Watch for loss of the "C" curve during rotation. Maintain the navel pulling in and up while reaching the sternum forward. Watch for shifting of the pelvis. Maintain the legs extended. If using the Telescoping Toe Bar or squat stand. Maintain the feet flush up against the platform. Watch for initiation of the movement with a hip hinge. Roll backward, not hinge. Tuck the pelvis under as if putting on a tight pair of pants. PROGRESSIONS/VARIATIONS: Place a pad or ball between the knees to increase inner thigh contraction. To disengage the upper trapezius, place the hands across the chest. To assist with maintaining width in the clavicular region, hold a pole between the hands. SAFETY ASPECTS/CONTRAINDICATIONS: Spinal and sacroiliac vulnerabilities which are exacerbated by flexion and rotation. Hip vulnerability, especially for those with hip precautions limiting flexion, adductor or external rotation. Shoulder vulnerability, especially for those with impingement, tendonitis or instability.

Saw

ACCESSORY: Telescoping squat stand. OBJECTIVES: Develop and maintain spinal mobility, especially with rotation. Improve coordination. Promote stretching of the spinal rotators and extensors. PRIME MOVERS: To rotate the spine: Concentric and eccentric spinal rotators. To flex spine: Eccentric spinal extensors. To roll up: Concentric spinal extensors. To abduct, adduct, and rotate arms: Concentric and eccentric shoulder abductors and internal and external rotators. To de-rotate the spine: Concentric and eccentric spinal rotators. PRIME STABILIZERS: Shoulder girdle, especially the shoulder abductors, to deter dropping the arms. Hip extensors to assist with posterior pelvic tilting. Knee extensors to limit knee flexion. INCLINE GUIDELINE: Level 8 to 1—Adjust incline higher to accommodate lack of hamstring flexibility. STARTING POSITION: Disconnect arm pulley from the glideboard 330. Push the glideboard 330 halfway up the rails, straddle the glideboard 330 and sit at the bottom edge. Place the feet shoulder width apart on the rails of the telescoping squat stand or place the feet together on the telescoping squat stand platform. Extend the legs. With the palms facing forward, abduct the arms to shoulder level. EXERCISE DESCRIPTION: Inhale—To lengthen through the trunk, and turn the torso to right as far as possible while keeping pelvis stable and facing front. The arms remain straight, reaching toward either corner. Exhale—To flex the torso over the hips (keeping the glideboard 330 static) until left hand crosses and rests diagonally and centrally on the outside of the right thigh, knee, or shin. The right arm internally rotates as it reaches backwards. Inhale—To roll up through the spine, initiating from the sacrum up to the cranium. Allow the back arm to derotate to have the palm face forward. Exhale—To return to center. Repeat to left side. REPETITIONS: 3-5 rotations each way. TEACHING TIPS: Watch for collapsing in the ribcage during the forward flexion. Visualize flexing up and over a ball. Watch for loss of abdominal activation. Draw the navel in toward the spine and up toward the crown of the head. Watch for compensatory lumbar and pelvic rotation. Rotate just the ribcage while maintaining the pelvis parallel to the front wall. Place one hand on the small of the back and don't let the back pull away from the hand. PROGRESSIONS/VARIATIONS: While stretching the body forward, one can perform three sliding/reaching saw like movements, avoiding ballistic motion. To prevent collapsing in the upper thoracic spine or to prevent the shoulders from rolling forward, place a pole along the upper back. To accommodate for hamstring inflexibility or to increase base of support, lower incline level to 4 or below and sit with buttocks at the top of the glideboard 330. (Shown below). SAFETY ASPECTS/CONTRAINDICATIONS: Spinal and sacroiliac vulnerabilities which are exacerbated by flexion and rotation. Shoulder vulnerability, especially for those with impingement, tendonitis or instability. Hip vulnerability, especially for those with hip precautions limiting flexion, adductor or external rotation.

Push Up

ACCESSORY: Optional Weight Bar. OBJECTIVES: Strengthen the shoulder girdle stabilizers in a closed chain activity. Strengthen the elbow extensors and shoulder flexors. Teach dissociation between the upper extremities and torso. Stretch the hip and spinal extensors at the beginning and end of the exercise. PRIME MOVERS: Entering in plank position: Concentric spinal erectors and eccentric hip extensors to control spinal flexion. Concentric spinal and hip extensors, and shoulder flexors. During push up: Eccentric followed by concentric elbow extensions. To exit plank position: Concentric shoulder extensors and hip spinal extensors. PRIME STABILIZERS: Shoulder girdle stabilizers to limit excessive shoulder elevation and scapular winging. Cervical extensors to maintain neutral spine. Trunk flexors and deep lumbo-pelvic musculature to support the spinal column and to facilitate the hydraulic amplifier mechanism. INCLINE GUIDELINE: 8 to 1—Adjust incline lower to increase torso and upper extremity focus. STARTING POSITION: Disconnect the arm pulley and remove the telescoping squat stand. With the glideboard 330 at the bottom of the rails (closed position), face the tower and stand approximately one foot from the base of the exercise device 100. The spine is neutral with the legs together and the hands down by the sides of the body. EXERCISE DESCRIPTION: Inhale—To lengthen through the spine. Exhale—To flex the spine and hips until hands are by ankles (standing forward fold posture). For those with less hamstring flexibility, allow the hands to rest at the base of the glideboard 330. Inhale—To maintain standing forward fold posture. Exhale—To walk forward and up the glideboard 330 until body comes into a push up/plank position. The heels will naturally come off the ground. The hands will ideally be placed under the shoulders with fingers facing forward. Inhale—To bend the elbows and lower the body parallel to the glideboard 330. The elbows remain close to the side of the body. The head remains aligned with the spine. Exhale—To extend the elbows to press the body up. Inhale—To walk the hands back down the glideboard 330 into the forward fold posture. Exhale—To roll the spine up to the starting position, leading from the pelvis. REPETITIONS: 5-8 times TEACHING TIPS: Watch for loss of connection in the hip flexors as noted by an increased lumbar lordosis and a dropping of the pelvis closer to the glideboard 330. Tighten the buttocks or tuck the pelvis under. Have the sensation of someone lifting up from the back of the pants. Push the buttocks up toward the ceiling. Watch for loss of stabilization in the scapular depressors. Push in and down with the heel of the hands. Watch for scapular winging. Wrap the scapulae around the back. Watch for excessive hip and shoulder flexion as noted by a shifting of the pelvis posteriorly or piking the pelvis up toward the ceiling. Reach crown of the head to the front of the room. Activate the buttocks and lower the pelvis toward the glideboard 330. PROGRESSIONS/VARIATIONS: To strengthen elbow extensors, add push ups to every repetition. To increase shoulder girdle and spinal stabilization, have the glideboard 330 open. To decrease shoulder girdle stabilization, begin exercise on forearms. To decrease torso stabilization, increase the base of support through the lower extremities by widening foot stance. To alleviate wrist discomfort, have the participant wrap the hands around the edges of the glideboard 330. SAFETY ASPECTS/CONTRAINDICATIONS: Shoulder vulnerability, especially for those with impingement, tendonitis or instability. Wrist vulnerability, especially those with carpal tunnel. Precautions limiting weightbearing through the upper extremity. Spinal and sacroiliac vulnerabilities which are exacerbated by flexion. Spinal and sacroiliac vulnerabilities which are exacerbated by extension.

Sidebend

ACCESSORY: None. OBJECTIVES: Challenge balance and control. Challenge torso and shoulder girdle stabilization. Strengthen and stretch the spinal lateral flexors. PRIME MOVERS: To sidebend, bring the left side away from the glideboard 330: Concentric left lateral trunk flexors. To return to start position: Eccentric left trunk lateral spinal flexors. To abduct the right arm: Right shoulder abductor concentrically to bring the arm overhead and eccentrically to the lower the arm. PRIME STABILIZERS: Hip abductors and adductors to stabilize the hip during lateral trunk flexion. Shoulder girdle stabilizers to limit excessive scapular elevation and winging. Trunk flexor and deep lumbo-pelvic musculature to support the spinal column and to facilitate the hydraulic amplifier mechanism. Knee extensors to limit knee flexion. INCLINE GUIDELINE: 8 to 1—Adjust incline lower to increase extremity and torso focus. STARTING POSITION: Disconnect the arm pulley and remove the telescoping squat stand. With the glideboard 330 at the bottom of the rails (closed position), lie on one side with the bottom arm bent to bring the elbow in line with the shoulder. The top arm rests on the glideboard 330 or along the side of the body, palm facing up. The legs are crossed with the top leg forward and the bottom leg back. Pelvis and spine are in neutral. Press the hips up toward the ceiling, bringing the body into a side plank position. EXERCISE DESCRIPTION: Inhale—To prepare and slide the scapulae down the back. Exhale—To press the pelvis up toward the ceiling, thus laterally flexing the trunk away from glideboard 330 (i.e. the bottom hip will move away from the glideboard 330). Reach the top arm overhead toward the tower. Inhale—To lower the torso returning to the start position. REPETITIONS: 3-5 each side. TEACHING TIPS: Watch for sinking into the shoulder girdle. Press up and out through the elbow. Lift the torso up and over the stabilizing forearm, particularly the elbow. Ensure that stabilization in the thoracic region is present. Watch for loss of abdominal activation. Draw the navel in toward the spine and up toward the crown of the head. Watch for loss of stabilization of the lateral trunk flexors. Lengthen the torso up and away as if making an arch or rainbow shape with the body. Lengthen the spine. Ensure the lumbo-pelvic region is stabilized. Watch for loss of pelvic alignment. The tendency is for the pelvis to rotate backward toward the ceiling. Stack the hips directly over one another. Gently press the top hip forward. Increase activation of the spinal flexors and hip extensors. Guide the pelvis up and down during the movement. Decrease the range of motion. PROGRESSIONS/VARIATIONS: To challenge spinal stabilization, place legs and feet together in side plank position. To decrease shoulder girdle stabilization, increase incline. To decrease coordination, focus on maintaining stability in a side plank position. To initiate the movement, look toward the hand on the top hip. As the hips raise off the glideboard 330 and the arm raises, look at the stabilizing hand/elbow on the glideboard 330. SAFETY ASPECTS/CONTRAINDICATIONS: Shoulder vulnerability, especially for those with impingement, tendonitis or instability. Wrist vulnerability, especially for those with carpal tunnel. Precautions limiting weightbearing through the upper extremity. Knee vulnerability, especially for those with medial and lateral instability. Spinal vulnerability, especially when spinal lateral trunk flexor and rotator weakness are present.

Leg Pull

ACCESSORY: None. OBJECTIVES: Focus on total body stability. Challenge lateral stability of the pelvis. Balance out the Leg Pull—Front. Strengthen the hip flexors of the free leg and isometrically work the hip extensors of the supporting leg. PRIME MOVERS: To enter into a reverse plank position: Concentric scapular depressors and hip extensors. To flex the leg: Concentric hip flexors. To lower the leg: Eccentric hip flexors. To lower the body: Gravity and eccentric scapular depressors and hip extensors. PRIME STABILIZERS: Hip extensors, especially on the supporting leg, to keep pelvis lifted off glideboard 330. Spinal erectors to maintain neutral spine and limit trunk flexion. Shoulder girdle stabilizers, especially the scapular depressors, to prevent shoulder elevation and "sinking" into the supporting shoulder. Trunk rotators to prevent shifting or lateral tilting of the pelvis. Deep lumbo-pelvic musculature to support the spinal column and to facilitate the hydraulic amplifier mechanism. INCLINE GUIDELINE: 8 to 1—decrease incline for torso and extremity focus. STARTING POSITION: Disconnect the arm pulley and remove the telescoping squat stand. With the glideboard 330 closed, sit with the buttocks near the middle to bottom of the glideboard 330. Adduct and extend the legs while plantar-flexing the feet. Arms are extended behind the body with the hands wrapped around the sides of the glideboard 330 or resting on the glideboard 330 with the fingertips facing away from the tower. EXERCISE DESCRIPTION: Inhale—To slide the scapulae down the back. Exhale—To press through the heels and the hands to lift the buttocks off the glideboard 330, entering into a reverse plank position. Inhale—To stay. Then: Exhale—To flex one hip lifting the leg toward the ceiling. Inhale—To lower leg, lightly tapping the floor. Repeat 2 more times. To finish: Exhale—To lower heel onto the floor and maintain reverse plank position. Inhale—To return the buttocks to the glideboard 330. Switch sides. REPETITIONS: 1 set of 3-5 lower and lifts per leg. TEACHING TIPS: Watch for knee or hip flexion as a means to compensate for tight hamstrings. Extend the hip, i.e. tighten the lift of the buttocks. To facilitate greater hamstring activation, keep weight into the heel of the supporting leg. Watch for shifting or tilting of the pelvis and torso as the hip is flexed. Limit the range of motion for hip flexion. Activate the spinal rotators. Watch for lateral flexion of the trunk or hip hiking, especially as the hip is flexed. Lengthen out of the hip as if to reach the leg toward the front wall prior to flexing the hip. Watch for loss of stabilization in the scapular depressors. Push in and down with the heel of the hands. Perform this motion on the forearms. Change the incline level. Watch for excessive lateral flexion versus rotation. Stay lengthened in the torso. Maintain equal distance between the lower rib and the pelvis. Imagine toothpicks lifting the ribcage up and away from the pelvis. Watch for hyperextension of the knees. Maintain a soft bend in the knee while maintaining the front of the thigh "tight." PROGRESSIONS/VARIATIONS: To challenge lateral pelvic stability, place the feet wider apart. If participant is unable to keep pelvis stable when the torso is lifted into a plank position, or is unable to isolate the hip flexor, have the participant assume a long-sitting position with the feet on the floor and from there perform unilateral hip flexion. Hands can be supported behind the participant, or in front of participant with the hands together in line with breastbone (first position). To focus on increasing strength through the upper extremity, simply practice lifting into a reverse plank position and holding the plank for three to five seconds. For added challenge, keep one leg lifted as the movement is performed. To decrease shoulder or wrist discomfort, increase the incline. If this does not alleviate discomfort, then have the participant support him/herself on the forearms by flexing the elbows. To decrease the coordination, lift the leg only 1 to 2 inches off the ground, then switch legs. SAFETY ASPECTS/CONTRAINDICATIONS: Spinal and sacroiliac vulnerabilities which are exacerbated by extension. Spinal and sacroiliac vulnerabilities which are exacerbated by flexion and rotation. Wrist vulnerability, especially for those with carpal tunnel. Precautions limiting weightbearing through the upper extremity. Participants with previous hamstring strain or pull.

Chest Stretch

ACCESSORY: None. OBJECTIVES: Stretch the muscles of the chest. PRIME MOVERS: To retract the elbows and extend the arm: Concentric scapular retractors and shoulder extensors. PRIME STABILIZERS: Spinal extensors to remain extended. Shoulder girdle stabilizers to prevent shoulder protraction or elevation. INCLINE GUIDELINE: 8 to 1—Use the same incline as the previous exercise. STARTING POSITION: Disconnect the arm pulley and remove the telescoping squat stand. With the glideboard 330 closed, sit with the buttocks near the middle to bottom of the glideboard 330. Bend the knees and extend the arms behind the body and wrap the hands around the edge of the glideboard 330. EXERCISE DESCRIPTION: Inhale—To adduct the elbows. Exhale—To maintain position. Inhale—To maintain position. Exhale—To maintain position. Inhale—To maintain position. Exhale—To release elbows. REPETITIONS: 1-3 times. TEACHING TIPS: Relax and drop the rib cage for a deeper stretch. PROGRESSIONS/VARIATIONS: Take arms higher up glideboard 330 for a deeper stretch. Perform one arm at a time rotating the torso away for a deeper stretch. SAFETY ASPECTS/CONTRAINDICATIONS: Shoulder vulnerability, especially for those with impingement, tendonitis or instability. Participants with elbow vulnerability.

Leg Pull Front with Hamstring Stretch

ACCESSORY: Optional Weight Bar. OBJECTIVES: Strengthen shoulder girdle stabilization. Challenge lateral stability of pelvis. Strengthen hip and spinal extensors. PRIME MOVERS: Entering in plank position: Spinal and hip extensors eccentrically to control spinal flexion. Concentric hip extensors and shoulder flexors to enter into a plank position. To lift the leg: Concentric hip extensors and plantar flexors. To lower the leg: Eccentric hip extensors and concentric dorsiflexors. To press back into a hamstring stretch: Eccentric plantar flexors and concentric hip flexors. Concentric shoulder extensors to walk the hands down on the glideboard 330. To roll the spine up: Concentric spinal and hip extensors. PRIME STABILIZERS: Knee extensors to limit knee flexion. Hip flexors and extensors to stabilize the pelvis. Trunk flexors and deep lumbo-pelvic musculature to support the spinal column and to facilitate the hydraulic amplifier mechanism. Shoulder girdle stabilizers to prevent elevation and scapular winging. INCLINE GUIDELINE: 8 to 1—Decrease incline for greater torso and extremity focus. STARTING POSITION: Disconnect the arm pulley and remove the telescoping squat stand. With the glideboard 330 at the bottom of the rails (closed position), face the tower and stand approximately one foot from the base of the exercise device 100. Roll down and walk the hands toward the top of the glideboard 330, entering into a plank position. Hands, elbows and shoulders are in line, with the legs parallel and adducted, heels lifted off the ground. EXERCISE DESCRIPTION: Inhale—To prepare. Exhale—To extend one leg up toward the ceiling while platar flexing the foot, without moving any other part of the body. Inhale—To lower the leg to the start position while dorsiflexing the foot. Repeat with same leg two more times. To finish, change legs. Exhale—To flex the hips and lower heels onto the floor for a hamstring stretch. If necessary, walk the hands back to the middle of the glideboard 330 while lowering the heels. Inhale and exhale for 5 breaths, maintaining the position and focusing on deepening the stretch. Exhale—To slightly flex knees and roll the spine up from the sacrum to the cranium, as a segue to a standing upright position. REPETITIONS: 1 set of 3-5 repetitions per leg. TEACHING TIPS: Watch for loss of hip extension as noted by the buttocks dropping toward the glideboard 330. Tighten and lift the buttocks. Place a pole under the pelvis and try not touch the pole. Watch for shifting of the pelvis. The tendency is for the pelvis to drop on the side of the free leg. If this occurs, then push this side of the pelvis up. Watch for excessive hip and/or shoulder flexion as noted by shifting the torso backward and/or piking the buttocks up toward the ceiling. Reach the crown of the head toward top of the glideboard 330 or activate the hip extensors by tightening the buttocks. Watch for scapular winging. Wrap the scapulae round the back. Watch for loss of stabilization in the scapular depressors. Push in and down with the heel of the hands. Watch for loss of hip flexor connection as noted by excessive lumbar lordosis and a dropping of the pelvis closer to the glideboard 330. Tighten the buttocks or tuck the pelvis under the body. Think of pressing the buttocks up toward the ceiling. PROGRESSIONS/VARIATIONS: To challenge lateral pelvic stability, place feet wider. To further challenge stability and cross coordination, flex the opposite arm overhead during hip extension. To challenge core stabilization, perform the motion with the glideboard 330 open. To decrease core stabilization, lower the body onto the glideboard 330 while keeping the hands underneath shoulders or under the forehead. Maintain a neutral cervical spine and perform hip extension. At the end, either press back up into a push up or press back onto the knees then enter into a standing forward fold posture. To decrease shoulder girdle stabilization, increase the incline, or perform the movement from the forearms. To decrease coordination, keep the foot dorsiflexed during hip extension. SAFETY ASPECTS/CONTRAINDICATIONS: Spinal and sacroiliac vulnerabilities which are exacerbated by flexion. Spinal and sacroiliac vulnerabilities which are exacerbated by extension. Hip vulnerability, especially for those with hip precautions limiting flexion, adductor or external rotation. Wrist vulnerability, especially for those with carpal tunnel. Shoulder vulnerability, especially for those with impingement, tendonitis or instability. Precautions limiting weightbearing through the upper extremity.

Scooping

ACCESSORY: Arm Pulley. OBJECTIVES: Increase or maintain shoulder range of motion. Strengthen shoulder flexors. Stretch shoulder extensors. PRIME MOVERS: To scoop the arms forward: Concentric shoulder flexors. To lower the arms: Eccentric shoulder flexors. PRIME STABILIZERS: Shoulder girdle stabilizers to limit excessive elevation and protraction. Spinal flexors and extensors to maintain neutral spine. Hip extensors to limit compensatory hip flexion. INCLINE GUIDELINE: 1 to 8—Adjust incline higher for greater extremity focus. 8 to 1—Adjust incline lower to decrease lower extremity focus or decrease cervical tension. PIN PLACEMENT: Inner Middle. STARTING POSITION: Attach arm pulley to the glideboard 330. Grasp the handles and pull the glideboard 330 half way up the rails. Straddle the rails and sit toward the top edge of the glideboard 330, facing away from the tower. The legs will be extended, crossed, or straddling the glideboard 330. Bring the arms to the sides of the body with the hands slightly behind shoulder line, elbows slightly bent. Shoulder and hips are aligned with the pelvis and the spine is in neutral. EXERCISE DESCRIPTION: Inhale—To lengthen through the spine. Exhale—To scoop the arms forward to shoulder level. Inhale—To draw the arms back to the start position. REPETITIONS: 5-10 times. TEACHING TIPS: Watch for excessive shoulder elevation. Lengthen the shoulders away from the ears. Slide, don't press, the shoulder blades (scapulae) down the back. Watch for the use of momentum. Visualize scooping through mud. Reach the fingers down toward the floor, then up toward the ceiling. Count to four on each phase of the movement. Watch for hyperextension of the elbows. Maintain a soft bend in the elbows while reaching the fingertips long. Watch for shoulder protraction (rounding of the shoulders) or collapsing through the collarbone. Lift the collarbone up while maintaining an imprinted ribcage. Think wide through the collarbone. Slide the scapulae toward one another. Watch for loss of abdominal activation. Draw the navel in toward the spine and up toward the crown of the head. Watch for leaning the torso posteriorly as the arms come forward. Reach the sternum forward without "popping" the ribs. Decrease the range of motion. Straddle the glideboard 330 and allow the legs to assist. PROGRESSIONS/VARIATIONS: To challenge lateral stability or decrease intensity, perform one side at a time. To increase core stabilization, perform in a low kneeling position. Use a pillow between the calves and buttocks if knee range of motion is limited. To increase emphasis on the shoulder flexors, flex the arms with palms facing down toward the floor. SAFETY ASPECTS/CONTRAINDICATIONS: To accommodate lack of flexibility or strength, sit with knees flexed on the glideboard 330, straddling the glideboard 330, or cross-legged. Shoulder vulnerability, especially for those with impingement, tendonitis or instability. Cervical strain or vulnerability.

Hug a Tree

ACCESSORY: Arm Pulley. OBJECTIVES: Challenge torso stability during upper extremity movement. Increase dissociation of the upper extremities and torso. Strengthen the shoulder horizontal adductors. Build postural endurance with dynamic upper extremity movement. PRIME MOVERS: To open the arms: Eccentric shoulder horizontal adductors. To close the arms: Concentric shoulder horizontal adductors. PRIME STABILIZERS: Shoulder flexors to maintain shoulder flexion, to limit shoulder elevation, and to promote scapular control. Spinal flexors and extensors to maintain neutral spine. Hip extensors to avert compensatory hip flexion. Deep lumbo-pelvic musculature to support the spinal column and to facilitate the hydraulic amplifier mechanism. INCLINE GUIDELINE: 1 to 8—Adjust incline higher for greater extremity focus. 8 to 1—Adjust incline lower to decrease extremity focus, decrease cervical tension and promote better postural alignment. PIN PLACEMENT: Outer or inner middle. Dependent on chest width. STARTING POSITION: Attach arm pulley to the glideboard 330. Grasp the handles and pull the glideboard 330 half way up the rails. Straddle the rails and sit toward the top edge of the glideboard 330, facing away from the tower. The legs will be extended, crossed, or straddling the glideboard 330. Bring the arms out to the sides of the body with the palms up toward the ceiling and slightly in front of the shoulder. Elbows are slightly bent. Shoulders and hips are aligned with the pelvis and the spine is in neutral. EXERCISE DESCRIPTION: Inhale—To drop the shoulders away from the ears. Exhale—To pull handles around toward one another in a circular motion, ending in line with the center of the chest. Inhale—To return to the start position. Careful not to let the hands go behind the shoulders. REPETITIONS: 5-10 times. TEACHING TIPS: Watch for loss of shoulder girdle stabilization leading to excessive cervical strain or stress. Drop the shoulders away from the ears. Think wide through the collarbone. Maintain a slight bend in the elbow. Watch for hyperextension of the elbows. Maintain a soft bend in the elbows while reaching the fingertips long. Watch for shoulder protraction (rounding of the shoulders) or collapsing through the collarbone. Lift the collarbone up while maintaining an imprinted ribcage. Think wide through the collarbone. Slide the scapulae toward one another. Watch for loss of thoracic imprint, "popping of the ribs." Slide the ribs together and down without compensating by flexing the trunk. "Knit" the ribs together. Watch for loss of abdominal activation. Draw the navel in toward the spine and up toward the crown of the head. PROGRESSIONS/VARIATIONS: To challenge lateral stability, perform one side at a time. To increase focus more on shoulder horizontal adductors, turn the palms to face one another. To decrease spinal stabilization or assist with maintaining neutral spine, perform the movement cross-legged or straddling the glideboard 330. SAFETY ASPECTS/CONTRAINDICATIONS: Shoulder vulnerability, especially for those with impingement, tendonitis or instability. Cervical strain or vulnerability.

Soccer Toss

ACCESSORY: Arm Pulley. OBJECTIVES: Challenge torso stability. Strengthen elbow extensors. Build postural endurance with dynamic overhead upper extremity movement. PRIME MOVERS: To extend the elbows: Concentric elbow extensors. To bend the elbows: Eccentric elbow extensors. PRIME STABILIZERS: Shoulder flexors to maintain shoulder and arms still in space. Shoulder girdle stabilizers to control shoulder elevation and promote proper scapular positioning. Spinal flexors and extensors to maintain neutral spine. Hip extensors to limit excessive hip flexion. Deep lumbo-pelvic musculature to support the spinal column and to facilitate the hydraulic amplifier mechanism. INCLINE GUIDELINE: 1 to 8—Adjust incline higher for extremity focus. 8 to 1—Adjust incline lower to decrease extremity focus and promote better postural alignment. PIN PLACEMENT: Inner Middle. STARTING POSITION: Attach arm pulley to the glideboard 330. Grasp the handles and pull the glideboard 330 half way up the rails. Straddle the rails and sit toward the top edge of the glideboard 330, facing away from the tower. The legs will be extended, crossed, or straddling the glideboard 330. Flex the hips slightly while maintaining the spine in extension. Bring the hands overhead and flex the elbows. Palms face up to the ceiling. EXERCISE DESCRIPTION: Inhale—To drop the shoulders away from the ears. Exhale—To extend (straighten) the arms while keeping the elbows and arms still in space. Inhale—To flex the elbows. REPETITIONS: 5-10 times. TEACHING TIPS: Watch for excessive shoulder elevation. Lengthen the shoulders away from the ears. Slide, don't press, the shoulder blades (scapulae) down the back. Watch for inability to maintain the elbows in position. Visualize holding a ball between the elbows. Watch for loss of thoracic imprint, "popping of the ribs." Slide the ribs together and down without compensating by flexing the trunk. "Knit" the ribs together. Watch for loss of abdominal activation. Draw the navel in toward the spine and up toward the crown of the head. PROGRESSIONS/VARIATIONS: To challenge lateral stability or decrease intensity, perform one side at a time. To challenge timing, coordination and stability, maintain the glideboard 330 in a static position while alternating elbow extension. To decrease difficulty, flex the shoulders to 90°and perform the same movement pattern without letting the arms drop below shoulder level. To accommodate for lack of flexibility, perform the same movement with the arms in front of the body and the hands placed on the forehead with palms facing forward. To decrease spinal stabilization or assist with maintaining neutral spine, perform the movement cross-legged or straddling the glideboard 330. SAFETY ASPECTS/CONTRAINDICATIONS: Shoulder vulnerability, especially for those with impingement, tendonitis or instability. Cervical strain or vulnerability. Participants with elbow vulnerability.

Side Twist

ACCESSORY: Arm Pulley. OBJECTIVES: Challenge torso lateral rotators. Teach dissociation of the pelvis and trunk. Increase torso rotation. PRIME MOVERS: To rotate and de-rotate the torso: Concentric and eccentric torso lateral rotators, especially the internal and external obliques. PRIME STABILIZERS: Shoulder flexors to maintain shoulder flexion. Shoulder girdle stabilizers, especially the scapular depressors and retractors, to limit shoulder elevation and overuse of the upper extremity. Spinal flexors and extensors to maintain neutral spine. Hip extensors to limit compensatory hip flexion. Deep lumbo-pelvic musculature to support the spinal column and to facilitate the hydraulic amplifier mechanism. INCLINE GUIDELINE: 1 to 8—Adjust incline higher to increase lateral torso focus. 8 to 1—Adjust incline lower to decrease cervical strain or upper extremity compensation. PIN PLACEMENT: Inner Middle. STARTING POSITION: Stand to the side of the exercise device 100 with back facing the rails. Grasp the handles and pull the glideboard 330 up halfway up the rails. Sit toward the top of the glideboard 330 facing sideways with both legs extended or crossed. The feet should not touch the ground. Rotate the torso toward the tower. Raise the arms to bring the hands in line with the middle of the sternum. Elbows are slightly bent, and pelvis is in neutral. EXERCISE DESCRIPTION: Inhale—To drop the shoulders away from the ears and lengthen through the spine. Exhale—To rotate the torso away from the tower. Initiate the movement from the torso and not with the arms. Inhale—To stay, lengthening the spine. Exhale—To return the start position. REPETITIONS: 5-10 times. Variation not shown: Advanced/high kneeling position. TEACHING TIPS: Watch for loss of shoulder girdle stabilization leading to excessive cervical strain or stress. Drop the shoulders away from the ears. Think wide through the collarbone. Maintain a slight bend in the elbow. Watch for compensatory shoulder horizontal adduction and abduction. Visualize holding an imaginary ball, and don't let the ball change shape during rotation. Rotate from the torso and not only the arms. Keep the arms aligned with the sternum. Create a stirring motion (out and around). Watch for loss of thoracic extension. Keep the chest or sternum lifted and to reach forward. Watch for loss of abdominal activation. Draw the navel in toward the spine and up toward the crown of the head. Watch for loss of stabilization in the pelvis. Maintain connection in the inner thighs. Glue the inner thighs together. Watch for compensatory lumbar and pelvic rotation. Rotate just the ribcage while maintaining the pelvis parallel to the front wall. Place one hand on the small of the back and don't let the back pull away from the hand. PROGRESSIONS/VARIATIONS: To intensify, perform small pulses at the end or beginning of the motion. To decrease resistance, perform with one handle. To maintain pelvic balance, cross legs in the opposite direction. SAFETY ASPECTS/CONTRAINDICATIONS: Pathologies exacerbated by kneeling, or increased knee flexion. Spinal vulnerability, especially when spinal lateral trunk flexor and rotator weakness are present.

Biceps Curl with Spinal Stretch

ACCESSORY: Arm Pulley. OBJECTIVES: Improve postural control during dynamic upper extremity movement. Strengthen elbow flexors. Stretch spinal extensors. PRIME MOVERS: To pull the hands to the shoulder: Elbow flexors. To straighten the arms: Eccentric elbow flexors. To lower arms: Shoulder extensors. To flex the spine: Eccentric spinal flexors. To roll the spine up: Concentric spinal extensors. PRIME STABILIZERS: Shoulder girdle stabilizers to limit shoulder elevation and protraction. Shoulder extensors and flexors work in conjunction to maintain optimal humeral positioning. Deep lumbo-pelvic musculature to support the spinal column and to facilitate the hydraulic amplifier mechanism. Hip extensors to limit excessive thoracic flexion and to assist eccentrically in rolling forward. INCLINE GUIDELINE: 1 to 8—Adjust incline higher to increase upper extremity focus. PIN PLACEMENT: Inner Middle. STARTING POSITION: Grasp handles and pull the glideboard 330 half way up the rails. Place the hands, knuckles down, on the glideboard 330 to stabilize the glideboard 330. Straddle the glideboard 330 facing the tower. Sit near the middle to bottom of the glideboard 330. While holding onto the handles, extend the arms with the palms facing up. Extend the legs along the glideboard 330. Spine and pelvis are in a neutral position. EXERCISE DESCRIPTION: Inhale—To prepare. Exhale—To flex the elbows, pulling the hands in toward the shoulders while performing a biceps curl. Inhale—To extend the elbows Exhale—To flex the elbows. Repeat 5-10 times On the last rep: Inhale—To extend the elbows. Exhale—Roll forward, rotating palms downward, reaching the hands toward the feet. Inhale—To stay. Exhale—To roll the spine up into neutral. Allow the arms to remain extended in line with the shoulders while rotating the palms upward. REPETITIONS: 5-10 biceps curls. TEACHING TIPS: Watch for hinging backwards during biceps curl. Reach the breastbone forward or lean forward from the hips. Watch for loss of shoulder girdle stabilization leading to excessive cervical strain or stress. Drop the shoulders away from the ears. Think wide through the collarbone. Maintain a slight bend in the elbow. Watch for shoulder protraction (rounding of the shoulders) or collapsing through the collarbone. Lift the collarbone up while maintaining an imprinted ribcage. Think wide through the collarbone. Slide the scapulae toward one another. PROGRESSIONS/VARIATIONS: To challenge lateral stability, perform one side at a time. This will require increased lateral stability. To challenge timing, coordination and stability, alternate biceps curls while keeping the glideboard 330 still. To facilitate a greater spinal and hamstring stretch, stay in spinal flexion for a longer duration. To accommodate for lack of flexibility or to decrease core stabilization, sit cross-legged or straddling the glideboard 330. SAFETY ASPECTS/CONTRAINDICATIONS: Shoulder vulnerability, especially for those with impingement, tendonitis or instability. Cervical strain or vulnerability. Spinal and sacroiliac vulnerabilities which are exacerbated by flexion. Postural faults exacerbated by spinal flexion.

Hamstring Glide

ACCESSORY: Adjustable foot holder; Optional Support Wedge Pillow; OBJECTIVES: Strengthen inner knee and hip flexors. Challenge pelvic stability. Stretch the spinal extensors. Teach lower extremity and pelvic dissociation. PRIME MOVERS: To bend the knees: Concentric knee and hip flexors. To straighten the knee: Eccentric knee and hip flexors. PRIME STABILIZERS: Hip extensors to avoid or prevent excessive lumbar lordosis. Spinal flexors to maintain thoracic imprint and neutral pelvis. Deep lumbo-pelvic musculature to support the spinal column and to facilitate the hydraulic amplifier mechanism. INCLINE GUIDELINES: 1 to 5—Adjust the incline higher to increase lower extremity focus. STARTING POSITION: Disconnect the arm pulley from the glideboard 330 and raise the adjustable foot holder to the "up" position. Sit on the glideboard 330 facing the tower. Once the body weight is fully supported on the glideboard 330, secure both feet into the adjustable foot holder. Lie back on the glideboard 330 with the legs extended, spine in neutral, and the head fully supported. Relax the feet, softly pointing the toes. EXERCISE DESCRIPTION: Inhale—To prepare. Exhale—To pull heels toward the buttocks, moving up the glideboard 330 incline as far as possible while maintaining torso stability. Inhale—To slowly return to start position. REPETITIONS: 5-10 times. TEACHING TIPS: Watch for cervical stress or strain. Nod, don't press, the chin toward the chest. Place the tongue on the roof of the mouth. Use the Support Wedge Pillow. Watch for loss of thoracic imprint, "popping of the ribs." Slide the ribs together and down without compensating by flexing the trunk. "Knit" the ribs together. Use the Support Wedge Pillow. Perform an abdominal curl. Watch for loss of abdominal activation. Draw the navel in toward the spine and up toward the crown of the head. Watch for excessive dorsiflexion. Relax the front of the foot. Maintain a soft point in the foot. Watch for hyperextension of the knees. Maintain a soft bend in the knees. Use the Slide Distance Regulator to control the range of motion. PROGRESSIONS/VARIATIONS: To challenge coordination, add single or double arm movements, flexing at the shoulder. To strengthen shoulder flexors and extensors, add shoulder flexion and extension while the participant holds a medicine ball. To strengthen spinal flexors, add an abdominal curl, or roll up as the knees flex. To intensify, add small pulses in the midrange of the movement. SAFETY ASPECTS/CONTRAINDICATIONS: Participants with high blood pressure, aneurysms, or any related pathology should avoid an inverted position that brings greater blood flow to the head. Participants with vestibular disorders. Participants with previous hamstring strain or pull. Pathologies exacerbated by kneeling or increased knee flexion. Knee vulnerability, especially those who hyperextend. Hip vulnerability, especially for those with hip precautions limiting flexion, adductor or external rotation. Spinal and sacroiliac vulnerabilities which are exacerbated by extension.

Inverted Roll Back with Hamstring Stretch

ACCESSORY: Adjustable foot holder. OBJECTIVES: Teach dissociation of the pelvis and the lower extremities. Strengthen the spinal flexors and rotators. Stretch the hip extensors and spinal extensors. PRIME MOVERS: To roll back: Eccentric spinal flexors. To float the arms up: Concentric shoulder flexors and abductors. To roll forward: Concentric spinal and hip flexors followed by eccentric spinal and hip extensors. To roll into the start position: Spinal extensors and shoulder flexors and abductors to raise the arms to first position. PRIME STABILIZERS: Shoulder girdle to control shoulder elevation and protraction. Shoulder extensors and flexors work in conjunction with one another to maintain optimal humeral positioning. Hip extensors to facilitate posterior pelvic tilt and spinal extension. Knee extensors to limit knee flexion. Deep lumbo-pelvic musculature to support the spinal column and to facilitate the hydraulic amplifier mechanism. INCLINE GUIDELINE: 1 to 8—Adjust incline higher to intensify abdominal work. STARTING POSITION: Disconnect the arm pulley from the glideboard 330 and raise the adjustable foot holder to the "up" position. Sit on the glideboard 330 facing the tower. Once the body weight is fully supported on the glideboard 330, secure both feet into the adjustable foot holder. Maintain sitting upright and extend the legs. With the elbows slightly flexed, raise the arms to shoulder level. Hands are clasped and aligned with the middle of the sternum (first position). Spine and pelvis are in a neutral position. EXERCISE DESCRIPTION: Inhale—To draw the shoulders away from the ears and lengthen through the spine. Exhale—To roll back, initiating with a posterior pelvic tilt, followed by lumbar flexion. Only roll onto the lumbar spine. The thoracic spine will flex simultaneously forming a "C" shape. Inhale—To float the arms up toward the ceiling. Exhale—To roll all the way forward while reaching the hands toward the feet. Inhale—To stay and stretch the spinal and hip extensors. Exhale—To roll up one vertebra at a time to the start position. REPETITIONS: 5-8 times. TEACHING TIPS: Watch for cervical hyperflexion. Gaze above the knees. Hold an imaginary ball between the chin and the chest. Watch for excessive shoulder elevation. Drop the shoulders away from the ears. Slide, don't press, the shoulder blades (scapulae) down the back. Watch for shoulder protraction (rounding of the shoulders) or collapsing through the collarbone. Lift the collarbone up while maintaining an imprinted ribcage. Think Wide through the collarbone. Slide the scapulae toward one another. Watch for loss of thoracic imprint, "popping of the ribs." Slide the ribs together and down without compensating by flexing the trunk. "Knit" the ribs together. Watch for loss of the "C" curve during rotation. Draw the navel pulling inward and up to the sternum while reaching the sternum forward. PROGRESSIONS/VARIATIONS: To challenge coordination, add single or double arm movements. To strengthen the shoulder girdle, add shoulder flexion and extension with a medicine ball. To focus on articulation through a particular area, perform small abdominal pulses. Add small abdominal pulses in the midrange of the movement. SAFETY ASPECTS/CONTRAINDICATIONS: Knee vulnerability, especially for those who hyperextend. Spinal and sacroiliac vulnerabilities which are exacerbated by flexion. Postural faults exacerbated by spinal flexion. Shoulder vulnerability, especially for those with impingement, tendonitis or instability.

Swan Dive Prep 1

ACCESSORY: None. OBJECTIVES: Develop cervical and thoracic flexibility into extension. Strengthen spinal and hip extensors. Facilitate greater abdominal contraction during spinal extension. Promote weight bearing through the upper extremity. Enhance shoulder girdle stabilization during a closed chain exercise. PRIME MOVERS: To extend: Concentric spinal extensors. To lower the spine: Eccentric spinal extensors. PRIME STABILIZERS: Spinal flexors and hip extensors to limit excessive lumbar lordosis. Knee extensors to maintain active knee extension. Shoulder girdle stabilizers, especially the scapular depressors, to promote scapular control and limit shoulder elevation. INCLINE GUIDELINE: 1 to 3—Adjust incline higher to add greater upper extremity weight bearing and to increase resistance into thoracic extension. 3 to 1—Adjust the incline lower to lessen upper extremity weight bearing and to decrease resistance into thoracic extension. STARTING POSITION: Disconnect the arm pulley from the glideboard 330. Remove the telescoping squat stand. Straddle the glideboard 330, facing away from the tower. Kneel on the glideboard 330 then transition into a prone position, extending the legs and bringing the chest toward the bottom edge of the glideboard 330. Laterally rotate and abduct hips to shoulder width apart. Depending on flexibility, bend the elbows and place the hands to the sides, in front of the exercise device base, or directly on the exercise device base. Maintain the pelvis in neutral with the abdominals drawn inward and upward off the glideboard 330. EXERCISE DESCRIPTION: Inhale—To slide the scapulae down the back. Exhale—To extend the cervical, thoracic, and lumbar spine. The hands will remain on the pegs or floor. Focus on extending using the spinal extensors versus pressing through the hands. Inhale—To stay. Exhale—To lengthen through the spine while lowering the torso onto the glideboard 330. REPETITIONS: 5-10 times. TEACHING TIPS: Watch for loss of stabilization in the scapular depressors. Push in and down with the heel of the hands. Watch for loss of thoracic imprint, "popping of the ribs." Slide the ribs together and down without compensating by flexing the trunk. "Knit" the ribs together. Watch for loss of neutral pelvis and increased lumbar lordosis. Gently tuck the pelvis while pulling the navel away from the glideboard 330. Watch for proper spinal sequencing during extension. Lengthen the cervical, then the thoracic, then the lumbar spine away from the glideboard 330. Press the spine toward the ceiling one-vertebra at a time, versus pressing through the hands. Press the collarbone and sternum up and away. PROGRESSIONS/VARIATIONS: To decrease the intensity, turn the body 180° and perform prone facing the tower. To decrease spinal muscular endurance, perform only cervical and thoracic extension until strength is gained. As strength improves, incorporate greater lumbar extension. SAFETY ASPECTS/CONTRAINDICATIONS: Shoulder vulnerability, especially for those with impingement, tendonitis or instability. Precautions limiting weightbearing through the upper extremity. Postural faults exacerbated by spinal extension. Spinal and sacroiliac vulnerabilities which are exacerbated by extension.

Crouching Tiger #1

ACCESSORY: None. OBJECTIVES: Work shoulder girdle stabilizers in a closed chain environment. Challenge balance and control. Enhance torso stability and strength. PRIME MOVERS: Entering in plank position: Concentric hip and knee extensors. To enter back into quadruped: Concentric hip flexors. PRIME STABILIZERS: Shoulder girdle stabilizers to inhibit shoulder elevation, flexion or scapular winging. Hip flexors to control "sagging" or excessive hip extension in a plank position. Knee extensors to control knee flexion, especially during transition from plank to quadruped. Cervical extensors to maintain neutral spine. Spinal flexors and deep lumbo-pelvic musculature to support the spinal column and to facilitate the hydraulic amplifier mechanism. INCLINE GUIDELINE: 8 to 1—Adjust incline lower for greater torso control and less upper body resistance. STARTING POSITION: Disconnect the pulley from the glideboard 330. Remove the telescoping squat stand. Straddle the glideboard 330, facing away from the tower. Kneel on the glideboard 330 with the knees near the bottom edge and the hands on the floor in front of the exercise device base. Dorsi-flexed the ankles to shift the body weight forward. Spine and pelvis are in a neutral position. EXERCISE DESCRIPTION: Inhale—To prepare. Exhale—To press the glideboard 330 up the incline entering into a plank position. Inhale—To stay. Exhale—To return the glideboard 330. REPETITIONS: 5-10 times. TEACHING TIPS: Watch for loss of stabilization in the scapular depressors. Push in and down with the heel of the hands. Perform this motion on the forearms. Change the incline level. Watch for hyperextension of the elbows. Maintain a soft bend in the elbows while reaching the fingertips long. Watch for compensatory shoulder movement. Maintain the arms as still as possible. Visualize bringing the torso forward over the hands while pressing through the back legs. Watch for scapular winging. Flatten the scapulae across the back. Watch for excessive hip and shoulder flexion as noted by a shifting of the pelvis posteriorly or piking the pelvis up toward the ceiling. Reach the crown of the head toward the front of the room. Activate the buttocks and lower the pelvis toward the glideboard 330. PROGRESSIONS/VARIATIONS: To decrease wrist stress or strain, perform the motion on the forearms. To strengthen scapular protractions and help to strengthen the serratus anterior, perform serratus "punches" in quadruped. To decrease stabilization, adjust the plank position. Have the participant press the glideboard 330 out as far possible without letting the legs come off the glideboard 330. To strengthen the elbow extensors, perform a push-up in the plank position. SAFETY ASPECTS/CONTRAINDICATIONS: Spinal and sacroiliac vulnerabilities which are exacerbated by extension. Knee vulnerability, especially for those with medial and lateral instability. Knee vulnerability, especially those who hyperextend. Shoulder vulnerability, especially for those with impingement, tendonitis or instability. Precautions limiting weightbearing through the upper extremity. Pathologies exacerbated by kneeling or increased knee flexion. Postural faults exacerbated by spinal extension.

Essential Side-Lying Leg Lifts

ACCESSORY: None. OBJECTIVES: Develop core control and lateral trunk stability during lower extremity movement. Strengthen hip abductors. Develop shoulder girdle stabilizers in a closed chain activity. PRIME MOVERS: Hip Abduction: To abduct the leg: Concentric hip abductors. To lower the leg: Eccentric hip abductors. Hip Adduction: To adduct the leg: Concentric hip adductors. To lower the leg: Eccentric hip adductors. Lateral Flexion: To lift both legs: Concentric lateral spinal flexors. To lower both legs: Eccentric lateral spinal flexors. PRIME STABILIZERS: Throughout all movements: Scapular stabilizers prevent shoulder elevation or protraction. Trunk lateral flexors on the supported side prevent sinking of the torso. Hip lateral and medial rotators maintain parallel alignment. Deep lumbo-pelvic musculature supports the spinal column and facilitates the hydraulic amplifier mechanism. During hip adduction: The top leg's hip abductors work to maintain the leg in space. During lateral flexion: hip abductors and adductors assist in lifting the legs and maintaining the legs together. INCLINE GUIDELINE: 1 to 3—Adjust incline higher for less extremity focus. If increasing the angle, it may be necessary to use the telescoping squat stand. 3 to 1—Adjust incline lower to increase lateral flexor resistance. STARTING POSITION: Stand to the side of the exercise device 100, facing away from the rails. Sit toward the middle to bottom of the glideboard 330 facing sideways. Still facing sideways, lie on the glideboard 330 with the head toward the tower. While maintaining the legs in parallel alignment and extended, bring them slightly in front of the body. Extend the bottom arm, reaching for the tower, and rest the top arm on the glideboard 330 in front of the torso. Maintain neutral spine and pelvic alignment. To assist with neutral pelvis, it may be necessary to maintain the bottom leg slightly adducted or bent. Watch for loss of neutral pelvis and increased lumbar lordosis. Gently tuck the pelvis while pulling the navel away from the glideboard 330. Watch for loss of thoracic stabilization. Feel a lifted sensation in the torso. The bottom aspect of the torso should not rest on the glideboard 330, rather the torso should be pulling gently away from the glideboard 330. Watch for excessive lateral flexion as the leg abducts or adducts. Lengthen the leg away from the hip and visualize maintaining a toothpick between the bottom rib and pelvis. Watch for proper femoral alignment. If the leg is internally rotating, turn the inner thigh up toward the ceiling. If the leg is externally rotating, turn the inner thigh down toward the floor. PROGRESSIONS/VARIATIONS: To further challenge shoulder girdle stabilization, have the upper body propped and stabilized on the bottom forearm. To further challenge the shoulder girdle and torso stability, have the top arm flexed at the elbow with the hand resting on the forehead. SAFETY ASPECTS/CONTRAINDICATIONS: Spinal vulnerability, especially when spinal lateral trunk flexor and rotator weakness are present. Knee vulnerability, especially for those with medial and lateral instability. Hip vulnerability, especially for those with bursitis. Hip vulnerability, especially for those with hip precautions limiting flexion, adductor or external rotation. Postural faults exacerbated by spinal lateral flexion. EXERCISE DESCRIPTION: ABDUCTION: Inhale—To lengthen out of the hip. Exhale—To lift the top leg. Only lift as high as one can without losing pelvic stability or rotating the leg. Inhale—To lower the leg. Repeat 8-10 times. ADDUCTION: Inhale—To lift or maintain the top leg in abduction. Exhale—To bring the bottom leg up to meet the top leg. Keep the legs parallel. Inhale—To lower the bottom leg. Repeat lifting and lowering of the bottom leg On the last rep: Exhale—To bring the bottom leg up to meet the top leg. Inhale—To lower both legs together. Repeat 8-10 times. LATERAL FLEXION: Inhale—To strongly adduct the inner thighs. Exhale—To raise both legs together without losing stability in the pelvis. Inhale—To lower both legs together. Repeat 8-10 times. REPETITIONS: 5-10 each side. TEACHING TIPS: Watch for excessive shoulder elevation. Lengthen the shoulders away from the ears. Slide, don't press, the shoulder blades (scapulae) down the back. Watch for loss of thoracic imprint, "popping of the ribs." Slide the ribs together and down without compensating by flexing the trunk. "Knit" the ribs together.

Back Extension

ACCESSORY: None. OBJECTIVES: Strengthen spinal extensors. Strengthen scapular stabilizers. Maintain abdominal contraction during back extension. PRIME MOVERS: To lower the arms: Eccentric shoulder flexors. To lower the spine: Eccentric spinal extensors. PRIME STABILIZERS: Shoulder girdle stabilizers, especially the scapular depressors, to avoid shoulder elevation. Trunk flexors and deep lumbo-pelvic musculature to support the spinal column and to facilitate the hydraulic amplifier mechanism. INCLINE GUIDELINE: 8 to 1—Decrease incline for torso and extremity focus. STARTING POSITION: Disconnect the arm pulley from the glideboard 330. Kneel on the glideboard 330 facing the tower and then extend the legs to lower the body into a prone position. Adduct the legs and maintain them in parallel. The head may be supported on the glideboard 330 or suspended in neutral. Flex the elbows and place the hands on the forehead with the palms facing the floor. Maintain an abdominal contraction and a neutral spine and scapula position. EXERCISE DESCRIPTION: Inhale—To draw the shoulders away from the ears. Exhale—To flex the shoulders, bringing the arms overhead. Simultaneously extend the cervical and thoracic spine. Inhale—To lower the arms and torso onto the glideboard 330. REPETITIONS: 5-10 times. TEACHING TIPS: Watch for cervical hyperextension. Reach the crown of the head toward the tower. Watch for excessive shoulder elevation. Lengthen the shoulders away from the ears. Slide, don't press, the shoulder blades (scapulae) down the back. Watch for loss of thoracic imprint, "popping of the ribs." Slide the ribs together and down without compensating by flexing the trunk. "Knit" the ribs together. Watch for proper spinal sequencing during extension. Lengthen the cervical spine, then the thoracic spine, away from the glideboard 330. Press the spine toward the ceiling one vertebra at a time, versus pressing through the hands. Press the collarbone and sternum up and away. PROGRESSIONS/VARIATIONS: To facilitate coordination and control of the breath with spinal extension and activation of the abdominals, break the movement into four breaths, whereby one inhales to hold the extension. A four-breath pattern can also be used as a teaching tool to break the movement into various steps. To challenge, raise the arms overhead throughout the exercise. For participants with increased lumbar lordosis, place a pad or pillow under the hips. SAFETY ASPECTS/CONTRAINDICATIONS: Shoulder vulnerability, especially for those with impingement, tendonitis or instability. Spinal and sacroiliac vulnerabilities which are exacerbated by extension. Postural faults exacerbated by spinal extension.

Back Extension with Twist

ACCESSORY: None. OBJECTIVES: Strengthen spinal extensors and rotators. Strengthen the scapular stabilizers. Teach maintaining abdominal contraction during spinal extension with rotation. PRIME MOVERS: To extend the spine: Concentric spinal extensors. To rotate the spine: Concentric spinal rotators. To lift the arms: Concentric shoulder flexors and scapular retractors. To de-rotate the spine: Eccentric spinal rotators. To lower the arms: Eccentric shoulder flexors and scapular depressors. To lower the spine: Eccentric spinal extensors. PRIME STABILIZERS: Spinal flexors to assist in controlling excessive flexion. Shoulder girdle stabilizers, especially the scapular depressors, to limit shoulder elevation and over activation of the upper trapezium. Hip extensors to limit excessive lordosis. Deep lumbo-pelvic musculature to support the spinal column and to facilitate the hydraulic amplifier mechanism. INCLINE GUIDELINE: 8 to 1—Adjust incline lower for greater torso and extremity focus. STARTING POSITION: Disconnect the arm pulley from the glideboard 330. Kneel on the glideboard 330 facing the tower and then extend the legs to lower the body into a prone position. Adduct the legs and maintain them in parallel. The head may be supported on the glideboard 330 or suspended in neutral. Flex the elbows and place the hands on the forehead with the palms facing the floor. Maintain an abdominal contraction and a neutral spine and scapula position. EXERCISE DESCRIPTION: Inhale—To draw the scapulae down. Exhale—To extend the cervical, thoracic and upper lumbar spine. Inhale—To stay in extension. Exhale—To rotate the torso while keeping the pelvis parallel to the glideboard 330. The cervical spine will follow torso rotation. Inhale—To de-rotate to the center. Exhale—To lower the torso. Repeat rotating to the opposite side REPETITIONS: 5-10 times per side. TEACHING TIPS: Watch for cervical hyperextension. Reach the crown of the head toward the tower. Watch for excessive shoulder elevation. Lengthen the shoulders away from the ears. Slide, don't press, the shoulder blades (scapulae) down the back. Watch for loss of thoracic imprint, "popping of the ribs." Slide the ribs together and down without compensating by flexing the trunk. "Knit" the ribs together. Watch for proper spinal sequencing during extension. Lengthen the cervical spine, then the thoracic spine, away from the glideboard 330. Press the spine toward the ceiling one vertebra at a time, versus pressing through the hands. Press the collarbone and sternum up and away. Watch for cervical hyperflexion. Gaze up and over the knees. Hold an imaginary ball between the chin and the chest. Watch for equal weight bearing through the pelvis during rotation. Maintain equal weight through the pelvis. Reach the side that is lifting toward the glideboard 330. PROGRESSIONS/VARIATIONS: To challenge, reach the arms overhead. To challenge coordinating and controlling the breath, use a two-breath pattern. Extend and rotate the spine and inhale to de-rotate and lower the spine back onto glideboard 330. This breath pattern also requires greater abdominal control. Participants with increased lumbar lordosis may need a pad or pillow under the hips. To enhance muscular endurance of the spinal extensors, rotate to both sides before lowering the torso onto the glideboard 330. SAFETY ASPECTS/CONTRAINDICATIONS: Spinal and sacroiliac vulnerabilities which are exacerbated by extension. Postural faults exacerbated by spinal extension. Shoulder vulnerability, especially for those with impingement, tendonitis or instability.

Hundred

ACCESSORY: Optional telescoping squat stand; Optional Support Wedge Pillow. OBJECTIVES: Build pelvic and lumbar stability. Build coordination of breath and movement. Increase endurance of the scapular stabilizers. PRIME MOVERS: To initiate and end the movement: Cervical, trunk, and shoulder spinal flexors. During movement: Concentric and eccentric shoulder flexors. PRIME STABILIZERS: Spinal flexors and hip extensors to deter excessive lordosis. Shoulder girdle stabilizers to control scapular movement. Knee extensors maintain knee extension. INCLINE GUIDELINE: 8 to 1—Adjust incline lower to increase abdominal intensity. 1 to 8—Adjust incline higher to decrease cervical tension. Note that higher incline levels will require the telescoping squat stand and the legs will be supported. STARTING POSITION: Disconnect the pulley from the glideboard 330. With the glideboard 330 closed, sit toward the bottom edge, feet on the floor in front of the base of the exercise device 100. Lie back, ensuring the head is fully supported. The legs remain flexed and adducted with the feet on the floor. Bring the hands to the sides of the body. Maintain neutral spine and pelvic alignment. EXERCISE DESCRIPTION: Inhale—To lengthen through the back of neck. Exhale—To flex the upper body, sliding the rib cage toward the pelvis and reaching the arms down so they are parallel with the floor. Only flex upper torso, still maintaining the scapulae in contact with the glideboard 330. Inhale—Remain in flexion and simultaneously pulse the arms up and down a few inches 5 times. Exhale—Simultaneously pulse the arms up and down a few inches 5 times. Repeat for 9 more sets of inhale and exhale, making a total of 100 pulses with the arms. Inhale—To stop pumping the arms and stay in flexion. Exhale—To return arms and head to starting position while flexing the legs to tabletop. REPETITIONS: 1 set of 100 pulses. TEACHING TIPS: Watch for cervical stress or strain. Nod, don't press, the chin toward the chest. Place the tongue on the roof of the mouth. Use the Support Wedge Pillow. Watch for cervical strain. Initiate the movement with the sensation of sliding the ribs toward the pelvis prior to movement. Watch for loss of shoulder girdle stabilization leading to excessive cervical strain or stress. Drop the shoulders away from the ears. Think wide through the collarbone. Maintain a slight bend in the elbow. Watch for excessive thoracic flexion. Maintain the tip of the scapulae on the glideboard 330. PROGRESSIONS/VARIATIONS: To decrease difficulty for inhaling for five counts, try only three counts on the inhale and five counts on the exhale. For added challenge, hold one leg in tabletop. As strength improves, allow for both legs to be in tabletop. To challenge torso strength and stability, slow down the count and raise the arms up to the ceiling for a count of five, then lower down for a count of five. For the beginner, raise the incline and place the telescoping squat stand on exercise device 100. Have the participant lie supine with the pelvis near the bottom of the glideboard 330. The legs are adducted and extended with the feet at the bottom of the platform. Perform the motion described above with the legs extended throughout. SAFETY ASPECTS/CONTRAINDICATIONS: Cervical strain or vulnerability. Spinal and sacroiliac vulnerabilities which are exacerbated by flexion. Hip vulnerability, especially for those with hip precautions limiting flexion, adductor or external rotation. Postural faults exacerbated by spinal flexion.

Bend and Stretch

ACCESSORY: Optional Support Wedge Pillow. OBJECTIVES: Strengthen spinal flexors. Develop core control. Enhance scapular stabilizers. PRIME MOVERS: To flex the spine: Concentric spinal flexors. To reach the arms overhead: Concentric shoulder flexors followed by eccentric shoulder extensors. To straighten the legs: Concentric hip and knee extensors. To reach the arms toward the knees: Concentric shoulder extensors followed by eccentric shoulder flexors. To bend the knee to tabletop: Eccentric knee and hip extensors. To return spine onto sideboard 330: Eccentric spinal flexors. PRIME STABILIZERS: Spinal flexors and deep lumbo-pelvic musculature to support the spinal column and to facilitate the hydraulic amplifier mechanism. Hip extensors to limit excessive lordosis and hip flexion. Neck flexors to maintain cervical flexion. INCLINE GUIDELINE: 1 to 3—Adjust incline higher to decrease cervical tension. 3 to 1—Adjust incline lower to increase work of the abdominals. STARTING POSITION: Disconnect the pulley from the glideboard 330. With the glideboard 330 closed, sit toward the bottom edge, feet on the floor in front of the base of the exercise device 100. Lie back, ensuring the head is fully supported. Bring the thoracic and lumbar spine into an imprinted position while lengthening the cervical spine. Flex the knees toward the chest, bringing the hips and knees to a 90° (tabletop) position. Reach the hands to the outside of the knees. EXERCISE DESCRIPTION: Inhale—To prepare. Exhale—To flex the upper body, sliding the rib cage toward the pelvis and reaching the hands toward the ankles. Inhale—To maintain the position. Exhale—To keep the spine imprinted on glideboard 330 and extend the hips and knees. Simultaneously flex the arms overhead. Do not let the torso move. Inhale—To flex both the knees and hips and circle the arms around to the start position. Repeat 3-5 more times Exhale—To lengthen the spine back onto the glideboard 330. REPETITIONS: 3-5 times. TEACHING TIPS: Watch for cervical stress or strain. Nod, don't press, the chin toward the chest. Place the tongue on the roof of the mouth. Use the Support Wedge Pillow. Watch for loss of shoulder girdle stabilization leading to excessive cervical strain or stress. Drop the shoulders away from the ears. Think wide through the collarbone. Maintain a slight bend in the elbow. Watch for loss of thoracic imprint, "popping of the ribs." Slide the ribs together and down without compensating by flexing the trunk. "Knit" the ribs together. Use the Support Wedge Pillow. Perform an abdominal curl. Participants with longer limbs will require greater torso stabilization earlier in the range of motion. PROGRESSIONS/VARIATIONS: To challenge abdominal control, reverse the breathing. To decrease the amount of abdominal endurance required, perform each repetition separately versus remaining flexed for 3-5 reps. To decrease coordination or torso focus, bring the arms overhead while keeping the legs in tabletop. Or, extend the knees and hips with the arms reaching by the sides of the body or placed behind the head. To further increase coordination, turn the legs out (keep the heels together, feet in a V) as the hips and knees extend, and return to parallel as the hips and knees flex in toward the body, To decrease spinal flexor muscular endurance, place the Support Wedge Pillow under the head and shoulder girdle, and perform only the extremity movement. SAFETY ASPECTS/CONTRAINDICATIONS: Spinal and sacroiliac vulnerabilities which are exacerbated by flexion. Hip vulnerability, especially for those with hip precautions limiting flexion, adductor or external rotation. Shoulder vulnerability, especially for those with impingement, tendonitis or instability. Cervical strain or vulnerability.

Swimming

ACCESSORY: None. OBJECTIVES: Develop core control and cross coordination of the extremities during spinal extension. Work the spinal and hips extensors. Facilitate greater abdominal contraction during spinal extension. PRIME MOVERS: To extend the spine: Concentric spinal extensors. To lift the arms: Concentric shoulder flexors and scapular depressors. To lift the legs: Concentric hip extensors. To lower the arms: Eccentric shoulder flexors and scapular depressors. To lower the legs: Eccentric hip extensors. PRIME STABILIZERS: Spinal extensors to maintain extension during extremity movement. Spinal flexors and hip flexors to prevent or avoid excessive lumbar lordosis. Knee extensors to maintain active knee extension. Cervical extensors to maintain the cervical spine in extension. INCLINE GUIDELINE: 1 to 3—Adjust incline higher to decrease extensor work. STARTING POSITION: Disconnect the arm pulley from the glideboard 330. Kneel on the glideboard 330 facing the tower and then extend the legs to lower the body into a prone position. Adduct the legs and maintain them in parallel with a soft point in the feet. The head may be supported on the glideboard 330 or suspended in neutral. Reach the arms overhead while maintaining them slightly wider than shoulder-width apart. Palms face the floor. Maintain abdominal contraction and neutral spine and scapula position. EXERCISE DESCRIPTION: Inhale—To draw the scapulae down the back. Exhale—Extend spine in conjunction with extending the legs and flexing the shoulders. Do not hyperextend the lumbar or cervical spine. Inhale and exhale normally while performing the exercise, simultaneously alternating left leg and right arm lift and then right leg and left arm lift. 20-50 times To end: Inhale—To stay and lengthen through the spine, arms, and legs. Exhale—To lower the torso onto the glideboard 330. REPETITIONS: 20-50 times. TEACHING TIPS: Watch for cervical hyperextension. Reach the crown of the head toward the tower. Watch for loss of shoulder girdle stabilization leading to excessive cervical strain or stress. Drop the shoulders away from the ears. Think wide through the collarbone. Maintain a slight bend in the elbow. Watch for loss of abdominal activation. Draw the navel in toward the spine and up toward the crown of the head. Watch for excessive lumbar lordosis in the prone position. Slightly tuck the pelvis under. Place a small pad under the pelvis. PROGRESSIONS/VARIATIONS: To challenge greater thoracic extension, turn body 180° and perform exercise in an inverted prone position. To focus on muscular control and endurance, slow the count down. To decrease spinal endurance, lower the torso onto the glideboard 330 and only perform extremity movements. Decrease coordination and focus on muscle isolation by performing only either the arm or lower extremity motion. SAFETY ASPECTS/CONTRAINDICATIONS: Spinal and sacroiliac vulnerabilities which are exacerbated by extension and rotation. Spinal vulnerability, especially when spinal lateral trunk flexor and rotator weakness are present. Shoulder vulnerability, especially for those with impingement, tendonitis or instability. Postural faults exacerbated by spinal extension.

Neck Pull

ACCESSORY: Optional Dowel; Optional weight bar. OBJECTIVES: Improve or maintain spinal articulation. Challenge core stability. Strengthen the trunk and hip flexors. Teach dissociation of the torso and pelvis from the lower extremities. PRIME MOVERS: To roll up: Concentric spinal and hip flexors. To roll up into a sitting position: Concentric spinal and hip extensors. To hinge back: Eccentric hip and spinal flexors. To roll back: Eccentric hip and spinal flexors. PRIME STABILIZERS: Knee extensors to limit knee flexion. Hip extensors to assist with posterior pelvic tilting and to limit excessive thoracic flexion. Shoulder girdle stabilizers to avert elevation and protraction. Spinal flexors and deep lumbo-pelvic musculature to support the spinal column and to facilitate the hydraulic amplifier mechanism. INCLINE GUIDELINE: 8 to I—Adjust incline lower for greater torso focus. 1 to 8—Adjust incline higher to decrease cervical strain. STARTING POSITION: Disconnect the pulley from the glideboard 330. With the glideboard 330 closed, sit toward the bottom edge, feet on the floor in front of the base of the exercise device 100. Lie back, ensuring the head is fully supported. Extend the legs while maintaining them hip distance apart and in parallel alignment. Dorsi-flex the feet. Bend the elbows to place hands on the forehead, palms facing out. Maintain neutral spine and pelvic alignment. EXERCISE DESCRIPTION: Inhale—To lengthen through back of neck. Exhale—To flex the upper body, sliding rib cage toward the pelvis, and roll the spine completely up and over the legs. Inhale—To articulate the spine from the pelvis to the cervical spine into an upright seated position. Exhale—To hinge the spine away from the hips. Keep the spine extended. When the participant cannot go further while maintaining the hinge position, then have him or her perform a pelvic tilt and roll the spine onto the glideboard 330. When rolling onto glideboard 330, lead with the posterior pelvic tilt followed by lumbar, thoracic, and cervical flexion. Focus on articulating the spine. Throughout the movement, the hands remain on the forehead. REPETI- TIONS: 5-8 times. TEACHING TIPS: Watch for hyperextension of the cervical spine. Nod, don't press, the chin toward the chest. Watch for shoulder protraction (rounding of the shoulders) or collapsing through the collarbone. Lift the collarbone up while maintaining an imprinted ribcage. Think wide through the collarbone. Slide the scapulae toward one another. Watch for lack of dissociation between the pelvis and lower extremities. Maintain the lower extremities and pelvis steady while initiating the movement from the hip. Watch for loss of neutral lumbar spine when hinging backward. Maintain greater activation of the abdominals and gently tuck the pelvis under as if putting on a tight pair of pants. Decrease the range of motion. Watch for proper spinal articulation. "Peel" the spine away from an imaginary pole. Roll up and over an imaginary ball. PROGRESSIONS/VARIATIONS: To assist with shoulder stabilization, hold a ball or dowel/pole. To challenge lateral spinal stability, reach one arm overhead while the other hand remains on the forehead. Or flex one hip to lift one leg during the exercise. Alternate sides or perform three to five reps on one side, then three to five on the other side. SAFETY ASPECTS/CONTRAINDICATIONS: Spinal and sacroiliac vulnerabilities which are exacerbated by flexion. Shoulder vulnerability, especially for those with impingement, tendonitis or instability. Postural faults exacerbated by spinal flexion. Cervical strain or vulnerability. Hip vulnerability, especially for those with hip precautions limiting flexion, adductor or external rotation.

One Leg Circle

ACCESSORY: Optional Support Wedge Pillow. OBJECTIVES: Challenge the lateral stabilizers of the torso and pelvis. Enhance articulation of the hip. Teach dissociation of the hip (lower extremity) and pelvis. PRIME MOVERS: To bring the leg into position: Concentric hip flexors and knee extensors. To perform the circles: Concentric and eccentric hip flexors, extensors, abductors, and adductors. PRIME STABILIZERS: Spinal trunk rotators to stabilize the pelvis as the leg circles. Hip flexors and rotators to maintain the leg parallel and flexed at the hip. Spinal flexors and deep lumbo-pelvic musculature to support the spinal column and to facilitate the hydraulic amplifier mechanism. INCLINE GUIDELINE: 8 to 1—Adjust incline lower for greater torso focus. 1 to 8—Adjust incline higher to decrease cervical strain. Note that higher incline levels will require the telescoping squat stand. STARTING POSITION: Disconnect the pulley from the glideboard 330. With the glideboard 330 closed, sit toward the bottom edge, feet on the floor in front of the base of the exercise device 100. Lie back, ensuring the head is fully supported. Hips and knees are flexed with the feet resting on the floor in line with the sit bones. Place the hands to the sides of the body with the elbows slightly bent. EXERCISE DESCRIPTION: Inhale—To prepare. Exhale—To flex one knee in toward the chest into a tabletop position (90° of hip flexion, 90° of knee flexion). Inhale—To extend the knee. Exhale—To hold. Inhale—To circle the leg toward the midline of the body, if able, cross the midline of the body, and down. All performed without moving the pelvis. Exhale—To circle the leg out to the side and around to the start position. Repeat 5 times one direction, then reverse directions 5 times. Upon completion of the last repetition: Inhale—To stay and lengthen through the leg. Exhale—To flex the knee and return the foot to the floor. REPETITIONS: 1 set of 5 circles clockwise and 5 counterclockwise. TEACHING TIPS: Watch for cervical hyperextension. Reach the crown of the head toward the tower. Watch for loss of thoracic imprint, "popping of the ribs." Slide the ribs together and down without compensating by flexing the trunk. "Knit" the ribs together. Use the Support Wedge Pillow. Perform an abdominal curl. Watch for equal weight bearing through the pelvis. Bear weight evenly through both sides of the pelvis. Greater weight bearing tends to occur on the unsupported side. Place greater weight on the supported side. Watch for lateral tilting or shifting in the pelvis. Decrease the lever by bending the knee. Tighten the abdominals, especially the obliques. Limit the hip range of motion. Watch for flexion of the knees. Maintain active in the front of the thighs. Lengthen the leg or reach the leg long. Imagine making an "O" on the ceiling. Start with a small range of motion and as strength and stability improve, increase the range of motion. PROGRESSIONS/VARIATIONS: To change range of motion, make a "D" shape versus an "O" shape on the ceiling. To challenge core stability, reach the arms up toward the ceiling. To increase abdominal activation, maintain an abdominal curl throughout the exercise. Another option is to perform the same motion inverted while performing an abdominal curl. For greater feedback regarding pelvic positioning, place the hands on the pelvis. SAFETY ASPECTS/CONTRAINDICATIONS: Spinal vulnerability, especially when spinal lateral trunk flexor and rotator weakness are present. Hip vulnerability, especially for those with hip precautions limiting flexion, adductor or external rotation.

Essential Hip Rolls

ACCESSORY: None. OBJECTIVES: Strengthen the hip extensors. Increase articulation of the spine. Challenge core stability. PRIME MOVERS: To lift the buttocks: Concentric hip extensors and spinal flexors. To lower buttocks: Eccentric hip extensors and lumbar flexors. PRIME STABILIZERS: Shoulder girdle to limit shoulder elevation and prevent increased weight bearing up cervical spine. Knee flexors to maintain the hook-lying position. Deep lumbo-pelvic musculature to support the spinal column and to facilitate the hydraulic amplifier mechanism. INCLINE GUIDELINE: 4 to 1—Adjust incline lower for less extremity focus. STARTING POSITION: Disconnect the pulley from the glideboard 330. With the glideboard 330 closed, sit toward the bottom edge, feet on the floor in front of the base of the exercise device 100. Lie back, ensuring the head is fully supported. Hips and knees are flexed with the feet resting on the floor in line with the sit bones. Place the hands to the sides of the body with the elbows slightly bent. EXERCISE DESCRIPTION: Inhale—To prepare. Exhale—To roll the pelvis off the glideboard 330 beginning with posteriorly rotating the pelvis. Inhale—To the maintain position. Exhale—To roll down one vertebra at a time beginning with the thoracic spine. REPETITIONS: 5-10 times. TEACHING TIPS: Watch for excessive weight bearing onto the cervical spine. Lengthen the chest away from the chin. Reach the knees over the toes. Watch for loss of thoracic imprint, "popping of the ribs." Slide the ribs together and down without compensating by flexing the trunk. "Knit" the ribs together. Watch for proper spinal articulation. "Peel" the spine, don't lift, off the glideboard 330. Watch for dropping versus rolling the spine onto the glideboard 330. Place each vertebra on the glideboard 330 one at a time. Visualize the spine as a string of pearls lowering one bead at a time onto the glideboard 330. PROGRESSIONS/VARIATIONS: To challenge pelvic control and work the hip flexors and knee extensors, press the glideboard 330 up the incline while maintaining a bridge position. To challenge unilateral stability, lift one leg off the floor with the knee remaining bent or straight depending on the pelvic stability, then alternately raise and lower the buttocks. To challenge coordination and control on the hip extension, reach the arms up toward the ceiling. SAFETY ASPECTS/CONTRAINDICATIONS: Spinal and sacroiliac vulnerabilities which are exacerbated by extension. Knee vulnerability, especially for those with medial and lateral instability. Postural faults exacerbated by spinal extension.

PILATES

REFORMAT MATWORK SERIES

The following is an exemplary order of exercises and steps for a REFORMAT MATWORK™ CLASS for PILATES using the exercise device 100: Incline Level 3 or below without telescoping squat stand. Begin with LAT bars in position. 1. Roll Up; 2. Half Roll Back; 3. Slow Hundred; 4. Hip Hinge Reaching; 5. Spine Stretch Forward; 6. Hip Hinge Reach; 7. Saw; 8. Scarecrow; 9. Thoracic Lift with Pull Up; 10. Thoracic Twist with Pull Up; 11. Inverted One Leg Circle; 12. Inverted Bend and Stretch; 13. Inverted Cross with One Leg Stretch; 14. Inverted One Leg Stretch with Reach; 15. Inverted Scissors with Reach; 16. Inverted Rollover; 17. Inverted Corkscrew; 18. Swan Dive Prep 1; 19. Swan Dive Prep 2; 20. Rest Position; 21. Crouching Tiger #1; 22. Reverse Leg Pull Front; 23. Hundred; 24. Essential Shoulder Bridge with Straight Leg Raise; 25. Rolling Like a Ball; 26. Intermediate Sidelying Leg Lift Series; 27. Cat and Camel; 28. Intermediate Sidelying Leg Lift Series; 29. Open and Close; 30. Intermediate Shoulder Bridge with Straight Leg Raise; 31. Teaser Prep 1 with Arm Pulley; 32. Teaser Prep 2 with Arm Pulley; 33. Double Leg Pulley: Windmills; 34. Double Leg Pulley: Footwork: Parallel; 35. Double Leg Pulley: Footwork: V; 36. Double Leg Pulley: Footwork: Hip Distance; 37. Double Leg Pulley: Footwork: Flexed. Each of these exercises is described in more detail below.

The following is an exemplary order of exercises and steps for a REFORMAT MATWORK™ STAGE 1 CLASS for PILATES using the exercise device 100: STAGE 1 Incline Level 3 or below without telescoping squat stand. Begin with LAT bars in position. 1. Roll Up; 2. Half Roll Back; 3. Slow Hundred; 4. Hip Hinge Reaching; 5. Spine Stretch Forward; 6. Hip Hinge Reach; 7. Saw; 8. Scarecrow; 9. Thoracic Lift with Pull Up; 10. Inverted One Leg Circle; 11. Inverted Bend and Stretch; 12. Inverted Cross with One Leg Stretch; 13. Swan Dive Prep 1; 14. Rest Position; 15. Crouching Tiger #1; 16. Hundred; 17. Essential Shoulder Bridge with Straight Leg Raise; 18. Rolling Like a Ball; 19. Intermediate Side-lying Leg Lift Series; 20. Cat and Camel; 21. Intermediate Side-lying Leg Lift Series; 22. Open and Close; 23. Intermediate Shoulder Bridge with Straight Leg Raise; 24. Teaser Prep 1 with Arm Pulley; 25. Double Leg Pulley: Windmills; 26. Double Leg Pulley: Footwork: Parallel; 27. Double Leg Pulley: Footwork V; 28. Double Leg Pulley: Footwork: Hip Distance; 29. Double Leg Pulley: Footwork: Flexed. Each of these exercises is described in more detail below.

The following is an exemplary order of exercises and steps for a REFORMAT MATWORK™ STAGE 2 CLASS for PILATES using the exercise device 100: Incline Level 3 or below without telescoping squat stand. Begin with LAT bars in position. 1. Roll Up; 2. Half Roll Back; 3. Slow Hundred; 4. Hip Hinge Reaching; 5. Spine Stretch Forward; 6. Hip Hinge Reach; 7. Saw; 8. Scarecrow; 9. Thoracic Lift with. Pull Up; 10. Thoracic Twist with Pull Up; 11. Inverted One Leg Circle; 12. Inverted Bend and Stretch; 13. Inverted Rollover; 14. Swan Dive Prep 1; 15. Swan Dive Prep 2; 16. Rest Position; 17. Crouching Tiger #1; 18. Hundred; 19. Essential Shoulder Bridge with Straight Leg Raise; 20. Rolling Like a Ball; 21. Intermediate Side-lying Leg Lift Series; 22. Cat and Camel; 23. Intermediate Side-lying Leg Lift Series; 24. Open and Close; 25. Intermediate Shoulder Bridge with Straight Leg Raise; 26. Teaser Prep 1 with Arm Pulley; 27. Teaser Prep 2 with Arm Pulley; 28. Double Leg Pulley: Windmills; 29. Double Leg Pulley: Footwork: Parallel; 30. Double Leg Pulley: Footwork: V; 31. Double Leg Pulley: Footwork: Hip Distance; 32. Double Leg Pulley: Footwork: Flexed. Each of these exercises is described in more detail below.

The following is an exemplary order of exercises and steps for a REFORMAT MATWORK™ STAGE 3 CLASS for PILATES using the exercise device 100: Incline Level 3 or below without telescoping squat stand. Begin with LAT bars in position. 1. Roll Up; 2. Half Roll Back; 3. Slow Hundred; 4. Hip Hinge Reaching; 5. Spine Stretch Forward; 6. Hip Hinge Reach; 7. Saw; 8. Scarecrow; 9. Thoracic Lift with Pull Up; 10. Thoracic Twist with Pull Up; 11. Inverted One Leg Circle; 12. Inverted Bend and Stretch; 13. Inverted Cross with One Leg Stretch; 14. Inverted One leg stretch with Reach; 15. Inverted Scissors with Reach; 16. Inverted Rollover; 17. Inverted Corkscrew; 18. Swan Dive Prep 1; 19. Swan Dive Prep 2; 20. Rest Position; 21. Crouching Tiger #1; 22. Reverse Leg Pull Front; 23. Hundred; 24. Essential Shoulder Bridge with Straight Leg Raise; 25. Rolling Like a Ball; 26. Intermediate Sidelying Leg Lift Series; 27. Cat and Camel; 28. Intermediate Sidelying Leg Lift Series; 29. Open and Close; 30. Intermediate Shoulder Bridge with Straight Leg Raise; 31. Teaser Prep 1 with Arm Pulley; 32. Teaser Prep 2 with Arm Pulley; 33. Double Leg Pulley: Windmills; 34. Double Leg Pulley:Footwork:Parallel; 35. Double Leg Pulley: Footwork: V; 36. Double Leg Pulley: Footwork: Hip Distance; 37. Double Leg Pulley: Footwork: Flexed. Each of these exercises is described in more detail below.

The following is an exemplary order of exercises and steps for a REFORMAT MATWORK™ STAGE 4 CLASS for PILATES using the exercise device 100: Incline Level 3 or below without telescoping squat stand. Begin with LAT bars in position. 1. Roll Up; 2. Footwork: V; 3. Footwork: Hip Distance; 4. Footwork: Flexed; 5. Bridging; 6. Hundred; 7. Superman; 8. Flight; 9. Rest Position; 10. Breaststroke; 11. Side-Lying Bicycle; 12. One Leg Stretch; 13. Side-Lying Bicycle; 14. Bridge and Press; 15. Side-Lying Hot Potato; 16. Swimming; 17. Side-Lying Hot Potato; 18. Prone Ruby Slippers; 19. Side-Lying Ruby Slippers; 20. Mermaid; 21. Spinal Balance; 22. Side-Lying Ruby Slippers; 23. Mermaid; 24. Cat And Camel; 25. Seal. Each of these exercises is described in more detail below.

The following is an exemplary order of exercises and steps for a REFORMAT MATWORK™ STAGE 5 CLASS for PILATES using the exercise device 100: Incline Level 3 or below without telescoping squat stand. Begin with LAT bars in position. 1. Roll Up; 2. Footwork: V; 3. Footwork: Hip Distance; 4. Footwork: Flexed; 5. Bridging; 6. Hundred; 7. Superman; 8. Flight; 9. Rest Position; 10. Breaststroke; 11. Side-Lying Bicycle; 12. One Leg Stretch; 13. Cross with One Leg stretch; 14. Side-Lying Bicycle; 15. Bridge and Press; 16. Bend And Stretch; 17. Side-Lying Hot Potato; 18. Swimming Frog; 19. Side-Lying Hot Potato; 20. Swimming; 21. Side-Lying Ruby Slippers; 22. Prone Ruby Slippers; 23. Side-Lying Ruby Slippers; 24. Tree With Leg Circle; 25. Mermaid; 26. Spinal Balance; 27. Cat And Camel; 28. Mermaid; 29. Seal. Each of these exercises is described in more detail below.

The following is an exemplary order of exercises and steps for a REFORMAT MATWORK™ STAGE 6 CLASS for PILATES using the exercise device 100: Incline Level 3 or below without telescoping squat stand. Begin with LAT bars in position. 1. Roll Up; 2. Footwork: V; 3. Footwork: Hip Distance; 4. Footwork: Flexed; 5. Bridging; 6. Hundred; 7. Superman; 8. Flight; 9. Rest Position; 10. Breaststroke; 11. Side-Lying Bicycle; 12. One Leg Stretch; 13. Cross with one Leg stretch; 14. Side-Lying Bicycle; 15. Bridge and Press; 16. Bend And Stretch; 17. Side-Lying Hot Potato; 18. Swimming Frog; 19. Side-Lying Hot Potato; 20. Swimming; 21. Side-Lying Ruby Slippers; 22. Prone Ruby Slippers; 23. Side-Lying Ruby Slippers; 24. Tree With Leg Circle; 25. Bicycle In The Air; 26. Scissors In The Air; 27. Inverted Saw; 28. Inverted Hip Twist; 29. Jack Knife; 30. Swan Dive With Grasshopper; 31. Kneeling Side Kicks; 32. Mermaid; 33. Spinal Balance; 34. Cat And Camel; 35. Kneeling Side Kicks; 36. Mermaid; 37. Seal. Each of these exercises is described in more detail below.

Roll Up

ACCESSORY: Optional Telescoping squat stand. Optional Weight Bar. Optional Dowel. OBJECTIVES: Improve or maintain spinal articulation. Challenge core stability. Improve pelvic and lower extremity dissociation. PRIME MOVERS: During the Roll Up: Concentric spinal and hip flexors. During the Roll Back: Eccentric spinal and hip flexors. PRIME STABILIZERS: Hip extensors to assist in performing a posterior pelvic tilt. Shoulder girdle stabilizers, especially shoulder flexors and extensors, to maintain the arms reaching forward. Knee extensors to limit knee flexion. Scapular stabilizers to limit shoulder elevation and cervical tension. Deep lumbo-pelvic musculature to support the spinal column and to facilitate the hydraulic amplifier mechanism. INCLINE GUIDELINE: 3 to 1—Adjust the incline lower for increased torso focus. 1 to 3—Adjust higher incline to alleviate hamstring tightness. STARTING POSITION: Disconnect the pulley from the glideboard 330. With the glideboard 330 closed, sit facing away from the tower with the buttocks toward the bottom edge of the glideboard 330, feet on the floor in front of the base of the exercise device 100. Lie back, ensuring the head is fully supported. Adduct and extend the legs. Dorsi-flex the feet. Reach the arms overhead for the tower without losing neutral spine and pelvis. EXERCISE DESCRIPTION: Inhale—To prepare. Exhale—To roll up flexing the cervical, thoracic, and lumbar followed by the pelvis. Maintain the head in between the arms. The trunk will flex up and over the legs creating "C" curve in the spine. Maintain the arms overhead. Inhale—To roll back initiating with a posterior pelvic tilt. Emphasize articulating the spine one vertebra at a time onto the glideboard 330 beginning with the lumbar spine. The arms remain overhead and the spine in "C" curve. Exhale—To continue rolling the thoracic and cervical spine onto the glideboard 330. Returning to the start position. REPETITIONS: 5-10 times TEACHING TIPS: Watch for popping of the ribs, especially when rolling the back. "Knit" the front ribs together. Watch for cervical hyperflexion or strain. Initiate the movement with the sensation of sliding the ribs toward the pelvis prior to movement. Watch for cervical hyperflexion. Gaze up and over the knees. Hold an imaginary ball between the chin and the chest. Watch for excessive shoulder elevation. Lengthen the shoulders away from the ears. Slide, don't press, the shoulder blades (scapulae) down the back. Watch for proper spinal articulation. "Peel", don't the spine, not lift, off the glideboard 330. Watch for lack of dissociation between the pelvis and lower extremities. Maintain the lower extremities and torso steady as the pelvis posteriorly rotates to initiate the movement. Watch for proper femoral alignment. If the leg is internally rotating, turn the inner thigh up toward the ceiling. If the leg is externally rotating, turn the inner thigh down toward the floor. Watch for loss of abdominal activation. Draw the navel in toward the spine and up toward the crown of the head. Watch for hyperextension or flexion of the knees. If hyperextended, maintain a soft bend in the knee. If flexing, raise the incline and/or engage the quadriceps to maintain the knees in extension. PROGRESSIONS/VARIATIONS: To assist in maintaining shoulder flexion and maintaining width through the clavicles (collar bones), hold a dowel/pole or a ball between the hands. To strengthen the lateral trunk stabilizers, maintain one arm overhead while the other arm reaches to the front or side of the body. SAFETY ASPECTS/CONTRAINDICATIONS: Spinal and sacroiliac vulnerabilities which are exacerbated by flexion. Cervical strain or vulnerability. Shoulder vulnerability, especially for those with impingement, tendonitis or instability. Postural faults exacerbated by spinal flexion Hip vulnerability, especially for those with hip precautions limiting flexion, adductor or external rotation.

Half Roll Back

ACCESSORY: Optional telescoping squat stand. OBJECTIVES: Improve or teach pelvic to lumbar articulation. Improve dissociation of the pelvis and lower extremities. Increase trunk flexor strength. PRIME MOVERS: To roll back: Eccentric trunk and hip flexors. To roll forward: Concentric hip and trunk flexors. PRIME STABILIZERS: Hip extensors to assist with posterior pelvic tilting. Shoulder girdle stabilizers to limit shoulder elevation and protraction. Shoulder flexors to keep the arms shoulder level. Deep lumbo-pelvic musculature to support the spinal column and to facilitate the hydraulic amplifier mechanism INCLINE GUIDELINE: 1 to 5—Adjust incline higher to accommodate limited hamstring flexibility and decrease torso focus. 5 to 1—Adjust incline lower for increased torso focus. STARTING POSITION: Disconnect the pulley from the glideboard 330. With the glideboard 330 closed, sit facing away from the tower with the buttocks toward the bottom edge of the glideboard 330, feet on the floor in front of base of the exercise device 100. Adduct the legs while maintaining the knees and hips flexed. Flex the spine to form a "C" curve. Reach the arms forward over the knees. EXERCISE DESCRIPTION: Inhale—To prepare. Exhale—To slide the shoulders away from the ears and roll back off the sit bones onto the lumbar spine. Maintain the "C" shape with the spine and the arms shoulder level. Inhale—To roll forward. Initiate with increasing thoracic flexion. Continue rolling forward, bringing the torso over the hips and reaching the hands toward the feet. REPETITIONS: 5-8 times. TEACHING TIPS: Watch for initiating the roll back with hip hinging versus rolling. Roll the pelvis to initiate the movement. Focus on rolling the pelvis away from the femur. Watch for excessive shoulder elevation. Lengthen the shoulders away from the ears. Slide, don't press, the shoulder blades (scapulae) down the back. Watch for shoulder protraction (rounding of the shoulders) or collapsing through the collarbone. Lift the collarbone up while maintaining an imprinted ribcage. Think wide through the collarbone. Slide the scapulae toward one another. Watch for loss of abdominal activation. Draw the navel in toward the spine and up toward the crown of the head. Watch for loss of the "C" curve during rotation. Maintain the navel pulling inward and up to the sternum while reaching the sternum forward. Watch for hyperextension of the cervical spine. Nod, don't press, the chin toward the chest. PROGRESSIONS/VARIATIONS: To increase adduction contraction, place a pad or ball between the knees. To decrease torso focus, perform on a higher incline with the Telescoping Squat Stand. To challenge control, lift the heels and balance on the balls of the feet. SAFETY ASPECTS/CONTRAINDICATIONS: Spinal and sacroiliac vulnerabilities which are exacerbated by flexion. Hip vulnerability, especially for those with hip precautions limiting flexion, adductor or external rotation.

Slow Hundred

ACCESSORY: Optional telescoping squat stand. OBJECTIVES: Build pelvic and lumbar stability. Build co-ordination of breath and movement. Increase muscular endurance of the scapular stabilizers. PRIME MOVERS: To flex the spine: Concentric cervical and thoracic spinal flexors. To bring the arms to the side: Concentric shoulder extensors followed by eccentric shoulder flexors. To lift the arms: Concentric shoulder flexors. To lower the arms: Eccentric shoulder flexors. To roll back: Eccentric cervical and thoracic spinal flexors. Concentric shoulder flexors. To raise the arms toward the ceiling: and eccentric shoulder extensors to lower the arms overhead. PRIME STABILIZERS: Trunk flexors and hip extensors to limit excessive lordosis during shoulder flexion and extension. Shoulder girdle stabilizers to limit shoulder protraction and elevation and promote proper scapular movement. Knee extensors maintain knee extension. INCLINE GUIDELINE: 8 to 1—Adjust the incline lower for increased torso focus. If incline is greater than level 3, Telescoping squat stand may be needed or legs will need to be flexed with feet resting on the floor. STARTING POSITION: Disconnect the pulley from the glideboard 330. With the glideboard 330 closed, sit facing away from the tower with the buttocks toward the bottom edge of the glideboard 330, feet on the floor in front of the base of the exercise device 100. Lie back, ensuring the head is fully supported. Flex and adduct the legs bringing the feet into the air (table top position). Maintain the arms by the sides of the body with the spine and pelvis in neutral. EXERCISE DESCRIPTION: Inhale—To lengthen through the back of neck. Exhale—To reach the arms toward the feet while flexing the upper body. Arms will be parallel to the glideboard 330 and the tips of the scapulae will remain in contact with the glideboard 330. Remain in flexion. Then: Inhale—To raise the arms up toward the knees for a count of 5. Exhale—To lower the arms down toward the glideboard 330 for a count of 5. Repeat up to 10 times To finish . . . Inhale—To reach the hands toward the feet, increasing the spinal flexion. Exhale—To lower onto the glideboard 330 and float the arms overhead. REPETITIONS: 1 set of 100 pulses. TEACHING TIPS: Watch for inability to coordinate the breath and movement. Decrease the breath to 3 counts on the inhale and 3 counts on the exhale. Watch for cervical tension. Place one hand behind the head while the other arm pumps, then switch arms half-way through. Lower the head onto the glideboard 330. Raise the incline level. Watch for cervical hyperflexion or strain. Initiate the movement with the sensation of sliding the ribs toward the pelvis prior to movement. Watch for excessive thoracic flexion. Maintain the tips of the scapulae on the glideboard 330. Watch for shoulder protraction (rounding of the shoulders) or collapsing through the collarbone. Lift the collarbone up while maintaining an imprinted ribcage. Think wide through the collarbone. Slide the scapulae toward one another. Watch for hyperextension of the elbows. Maintain a soft bend in the elbows while reaching the fingertips long. PROGRESSIONS/VARIATIONS: To challenge, extend legs to a diagonal. To challenge shoulder girdle and torso strength, use small weights in the hands. To decrease torso focus, flex the legs, resting the feet on the floor. SAFETY ASPECTS/CONTRAINDICATIONS: Cervical strain or vulnerability. Spinal and sacroiliac vulnerabilities which are exacerbated by flexion. Shoulder vulnerability, especially for those with impingement, tendonitis or instability.

Hip Hinge Reaching

ACCESSORY: Optional telescoping squat stand. OBJECTIVES: Stretch hip extensors. Teach correct pelvic and lower extremity dissociation. Strengthen spinal extensors. Teach neutral spine during hip flexion and hip extension. Strengthen the spinal flexors. PRIME MOVERS: Hinging forward: Eccentric spinal extensors and concentric hip flexors to initiate. Hinging from the forward flexed position to neutral: Concentric spinal and hip extensors. Hinging backward: Eccentric hip and trunk flexors. Hinging from the hip extended position to neutral: Concentric hip and trunk flexors. PRIME STABILIZERS: Trunk flexors to assist with maintaining thoracic imprint. Knee extensors to limit knee flexion. Shoulder girdle stabilizers to limit shoulder elevation and cervical tension. Hip extensors to prevent excessive lumbar lordosis during hinging backward and to prevent excessive hip flexion during hinging forward. Cervical extensors to maintain neutral spine. Deep lumbo-pelvic musculature to support the spinal column and to facilitate the hydraulic amplifier mechanism. INCLINE GUIDELINES: 8 to 1—Adjust incline higher to accommodate short hamstrings. Higher inclines may require telescoping squat stand. STARTING POSITION: Disconnect the pulley from the glideboard 330. With the glideboard 330 closed, sit facing away from the tower with the buttocks toward the bottom edge of the glideboard 330, feet on the floor in front of the base of the exercise device 100. If the incline is less than three, then extend and adduct the legs while dorsiflexing the feet. If the incline is greater than three, maintain the legs adducted and flexed with the feet on the floor. With the spine and pelvis in neutral, bend the elbows and place the hands on the forehead with the palms facing out. EXERCISE DESCRIPTION: Inhale—To hinge forward while maintaining neutral spine. Exhale—To return to the start position. Inhale—To hinge backward while maintaining neutral spine. Exhale—To return to the start position. REPETITIONS: 3-5 times. TEACHING TIPS: Watch for "gripping" or over-activation of the hip flexors. Increase the incline, use the Deluxe Slide Distance Regulator to hold the board in position, or raise the incline to 4 or 5 and sit at the top with the legs supported on the glideboard 330. Watch for cervical stress or strain. Nod, don't press, the chin toward the chest. Place the tongue on the roof of the mouth. Watch for loss of thoracic imprint, "popping of the ribs." Slide the ribs together and down without compensating by flexing the trunk. "Knit" the ribs together. Watch for loss of thoracic extension. Keep the chest or sternum lifted and reaching forward. Watch for loss of abdominal activation. Draw the navel in toward the spine and up toward the crown of the head. Watch for proper femoral alignment. If the leg is internally rotating, turn the inner thigh up toward the ceiling. If the leg is externally rotating, turn the inner thigh down toward the floor. PROGRESSIONS/VARIATIONS: To hinder shoulder protraction, fold the hands and place them on the small of the back with palms facing out. To decrease spinal extensor work and shoulder girdle stabilization, flex arms to shoulder level with palms facing the floor. SAFETY ASPECTS/CONTRAINDICATIONS: Spinal and sacroiliac vulnerabilities which are exacerbated by flexion. Postural faults exacerbated by spinal flexion. Hip vulnerability, especially for those with hip precautions limiting flexion, adductor or external rotation.

Spine Stretch Forward

ACCESSORY: Optional telescoping squat stand. OBJECTIVES: Stretch and work the spinal extensors and rotator muscles. Teach spinal extensor muscular control during spinal flexion. Facilitate greater exhalation during spinal flexion, increasing lung capacity. PRIME MOVERS: To flex forward: Concentric hip flexors and eccentric trunk extensors. To roll up: Concentric trunk and hip extensors. PRIME STABILIZERS: Hip extensors to assist performing a posterior pelvic tilt. Knee extensors to maintain knee extension. Deep lumbo-pelvic musculature to support the spinal column and to facilitate the hydraulic amplifier mechanism. INCLINE GUIDELINE: 8 to 1—Adjust incline higher to accommodate lack of hamstring flexibility. Lower inclines may be done without telescoping squat stand. STARTING POSITION: Disconnect the pulley from the glideboard 330. With the glideboard 330 closed, sit facing away from the tower with the buttocks toward the bottom edge of the glideboard 330, feet on the floor in front of the base of the exercise device 100. If the incline is less than three, then extend and adduct the legs while dorsiflexing the feet. If the incline is greater than three, maintain the legs adducted and flexed with the feet on the floor. With the spine and pelvis in neutral, gently rest the hands on the tops of the thighs. EXERCISE DESCRIPTION: Inhale—To lengthen through the back of the neck. Exhale—To sequentially start flexing the spine down and slightly forward, leading from the top of the spine. Slide the hands forward along the tops of the thighs and legs. Do not let the pelvis change its position, i.e. it should not move. Inhale—To maintain position. Exhale—To slowly start extending the spine back to the starting position, leading from the bottom of the spine, while simultaneously allowing scapular depression. REPETITIONS: 3-5 times. TEACHING TIPS: Watch for cervical hyperflexion. Gaze up and over the knees. Hold an imaginary ball between the chin and the chest. Watch for excessive shoulder elevation. Lengthen the shoulders away from the ears. Slide, don't press, the shoulder blades (scapulae) down the back. Watch for loss of abdominal activation. Draw the navel in toward the spine and up toward the crown of the head. Watch for proper femoral alignment. If the leg is internally rotating, turn the inner thigh up toward the ceiling. If the leg is externally rotating, turn the inner thigh down toward the floor. Watch for proper spinal articulation. "Peel" the spine away from an imaginary pole. Roll up and over an imaginary ball. In the forward flexed position, draw awareness to the breath with the ribs knitted together. PROGRESSIONS/VARIATIONS: To assist with limiting shoulder protraction, interlace the fingers with palm facing out and rest them on forehead. To focus on shoulder stabilization or to limit shoulder protraction, flex arms to shoulder level. To facilitate relaxation of the lower body, have the glideboard 330 closed while the participant is seated at the top of the board. SAFETY ASPECTS Spinal and sacroiliac vulnerabilities which are exacerbated by flexion. Postural faults exacerbated by spinal flexion. Hip vulnerability, especially those with hip precautions limiting flexion, adductor or external rotation.

Hip Hinge Reach

ACCESSORY: Optional telescoping squat stand. OBJECTIVES: Challenge lateral stability of the pelvis. Strengthen the lateral pelvic stability. Teach correct pelvic and lower extremity dissociation. Strengthen spinal flexors. PRIME MOVERS: Hinging forward: Eccentric spinal extensors and concentric hip flexors to initiate. Hinging from the forward flexed position to neutral: Concentric spinal and hip extensors. Hinging backward: Eccentric hip and trunk flexors. Hinging from the hip extended position to neutral: Concentric hip and trunk flexors. PRIME STABILIZERS: Trunk flexors to assist with maintaining thoracic imprint. Knee extensors to limit knee flexion. Shoulder girdle stabilizers to limit shoulder elevation and cervical tension. Hip extensors to prevent excessive lumbar lordosis during hinging backward and to prevent excessive hip flexion during hinging forward. Cervical extensors to maintain neutral spine. Deep lumbo-pelvic musculature to support the spinal column and to facilitate the hydraulic amplifier mechanism. INCLINE GUIDELINE: 8 to 1—Adjust incline higher to accommodate lack of hamstring flexibility. Higher levels may require the telescoping squat stand. STARTING POSITION: Disconnect the pulley from the glideboard 330. With the glideboard 330 closed, sit facing away from the tower with the buttocks toward the bottom edge of the glideboard 330, feet on the floor in front of the base of the exercise device 100. If the incline is less than three, then extend and adduct the legs while dorsiflexing the feet. If the incline is greater than three, maintain the legs adducted and flexed with the feet on the floor. With the spine and pelvis in neutral, bend one elbow and place the hand on the forehead with the palms facing out. Reach the other arm overhead. EXERCISE DESCRIPTION: Inhale—To hinge forward while maintaining neutral spine. Exhale—To return to the start position. Inhale—To hinge backward while maintaining neutral spine. Exhale—To return to the start position. REPETITIONS: 5-10 times. TEACHING TIPS: When hinging backwards, watch for initiating the movement with lumbar extension versus hip extension. Perform a slight pelvic tilt to limit excessive lumbar extension (lordosis). Roll or open the hips. Watch for shoulder protraction (rounding of the shoulders) or collapsing through the collarbone. Lift the collarbone up while maintaining an imprinted ribcage. Think wide through the collarbone. Slide the scapulae toward one another. Watch for loss of thoracic extension. Keep the chest or sternum lifted and reaching forward. Watch for loss of abdominal activation. Draw the navel in toward the spine and up toward the crown of the head. PROGRESSIONS/VARIATIONS: To increase flexibility of the spinal extensors, maintain the forward flexed position for a longer duration. SAFETY ASPECTS/CONTRAINDICATIONS: Spinal and sacroiliac vulnerabilities which are exacerbated by flexion. Postural faults exacerbated by spinal flexion. Hip vulnerability, especially for those with hip precautions limiting flexion, adductor or external rotation.

Saw

ACCESSORY: Optional telescoping squat stand. OBJECTIVES: Develop and maintain spinal mobility, especially with rotation. Improve coordination. Promote stretching of the spinal rotators. PRIME MOVERS: To rotate and derotate the spine: Concentric and eccentric trunk rotators. To flex spine: Eccentric trunk extensors. To roll up: Concentric trunk extensors. To abduct, adduct, and rotate arms: Concentric and eccentric shoulder abductors and internal and external rotators. PRIME STABILIZERS: Shoulder girdle, especially the lateral flexors, to maintain the arms to the side. Hip extensors to assist with posterior pelvic tilting. Knee extensors to limit the knee flexion. INCLINE GUIDELINE: Level 8 to 1—Adjust incline higher to accommodate lack of hamstring flexibility. Higher levels may require Telescoping Squat Stand. STARTING POSITION: Disconnect the pulley from the glideboard 330. With the glideboard 330 closed, sit facing away from the tower with the buttocks toward the top edge of the glideboard 330 with legs extended and abducted hip distance. Dorsi-flex the feet. With the spine and pelvis in neutral, abduct the arms to shoulder level and turn the palms to face forward. EXERCISE DESCRIPTION: Inhale—To lengthen through the trunk, rotate the torso to right as far as possible while keeping pelvis stable and facing front. The arms follow the trunk. Exhale—To flex the torso over the hips (keeping the glideboard 330 static) until left hand crosses and rests diagonally and centrally on outside of right thigh, knee, or shin. The right arm internally rotates as it reaches backwards. Inhale—To roll up through the spine initiating from the sacrum up to the cranium. Allow the back arm to derotate to have the palm face forward. Exhale—To return to center. Repeat to left side REPETITIONS: 3-5 times each way. TEACHING TIPS: Watch for lethargy of the upper body. Reach through each hand and out of the shoulders to provide a two-directional stretch, or open the shoulders and exaggerate this motion. Watch for collapsing in the ribcage. Visualize flexing up and over a ball. Watch for dropping of the arms as the torso rotates. Keep the arms level, pressing down on an imaginary countertop. Maintain energy in the upper body. Watch for loss of abdominal activation. Draw the navel in toward the spine and up toward the crown of the head. Watch for compensatory lumbar and pelvic rotation. Rotate only the ribcage while maintaining the pelvis parallel to the front wall. Place greater weight through the hip opposite the one being rotated toward. Watch for over-activation or "gripping" of the hip flexors. Move the incline level to 4 or below. Sit at the top of the glideboard 330 with the legs supported. Use the Deluxe Slide Distance Regulator to hold the glideboard 330 in place. PROGRESSIONS/VARIATIONS: To increase the stretch when flexed forward, perform three sliding/reaching saw-like movements, avoiding ballistic motion. To prevent collapsing in the upper thoracic or the shoulders rolling forward, have participant hold a pole across the shoulder blades. SAFETY ASPECTS/CONTRAINDICATIONS: Spinal and sacroiliac vulnerabilities which are exacerbated by flexion and rotation. Postural faults exacerbated by spinal flexion. Hip vulnerability, especially for those with hip precautions limiting flexion, adductor or external rotation.

Scarecrow

ACCESSORY: None. OBJECTIVES: Strengthen spinal extensors. Strengthen scapular stabilizers. Maintain abdominal contraction during back extension. PRIME MOVERS: To extend the spine: Concentric spinal extensors. To lift the arms: Concentric shoulder horizontal abductors and scapular retractors. To lower the arms: Eccentric shoulder horizontal abductors and scapular retractors. To lower the spine: Eccentric spinal extensors. PRIME STABILIZERS: Shoulder girdle stabilizers, especially the scapular depressors, to deter shoulder elevation. Elbow flexors to maintain elbow flexion. Spinal flexors and deep lumbo-pelvic musculature to support the spinal column and to facilitate the hydraulic amplifier mechanism. Hip extensors to facilitate posterior pelvic tilt and to limit excessive lumbar lordosis. INCLINE GUIDELINE: 8 to 1—Adjust incline lower for increased torso and extremity focus. STARTING POSITION: Disconnect the arm pulley from the glideboard 330. Kneel on the glideboard 330 facing the tower, and then extend the legs to lower the body into a prone position. Abduct the legs hip distance apart. The feet may rest up against the base of the machine or on the floor. The head may be supported on the glideboard 330 or suspended in neutral. Abduct the arms to shoulder level and flex the elbows so that the fingertips point toward the floor with the palm facing back (forming an "L" shape with a arms). Maintain an abdominal contraction and a neutral spine and scapula position. EXERCISE DESCRIPTION: Inhale—To draw the shoulders away from the ears and pull the navel in and up. Exhale—To lift the elbows toward the ceiling. Follow by lifting the head and upper chest off the glideboard 330. Elbows remain bent or extended. Inhale—To lower the arms and chest onto the glideboard 330. REPETITIONS: 5-10 times. TEACHING TIPS: Watch for shoulder protraction (rounding of the shoulders) or collapsing through the collarbone. Lift the collarbone up while maintaining an imprinted ribcage. Think wide through the collarbone. Slide the scapulae toward one another. Watch for cervical hyperextension. Reach the crown of the head toward the tower. Watch for excessive scapular retraction. Visualize the scapulae drawing together as the elbows lengthen away from the shoulders. Watch for loss of thoracic imprint, "popping of the ribs." Slide the ribs together and down without compensating by flexing the trunk. "Knit" the ribs together. Watch for proper spinal sequencing during extension. Lengthen the cervical, then the thoracic, away from the glideboard 330. Press the spine toward the ceiling one vertebra at a time, versus pressing through the hands. Press the collarbone and sternum up and away from the glideboard 330. Participants with increased lumbar lordosis may need a pad or pillow under the hips. PROGRESSIONS/VARIATIONS: To facilitate coordinating the breath with spinal extension and abdominal activation, break the movement into four breaths. Inhale to prepare. Exhale to extend. Inhale to hold the extension. Inhale to lower. To focus on scapular mobility and strength, focus on only lifting the arms without incorporating spinal extension. To decrease cervical extensor work, rest the head on the glideboard 330 to begin. To emphasize more scapular retractors versus shoulder horizontal abductors, extend the elbows. SAFETY ASPECTS/CONTRAINDICATIONS: Spinal and sacroiliac vulnerabilities which are exacerbated by extension. Shoulder vulnerability, especially for those with impingement, tendonitis or instability.

Thoracic Lift with Pull Up

ACCESSORY: LAT Bars. OBJECTIVES: Strengthen spinal extensors. Strengthen scapular stabilizers. Promote scapular mobility. Maintain abdominal contraction during back extension. PRIME MOVERS: To pull up: Concentric scapular depressors and shoulder extensors. Concentric elbow flexors. To extend the spine: Concentric spinal extensors. To straighten the arms: Eccentric scapular depressors and shoulder extensors. Eccentric elbow flexors. To lower the spine: Eccentric spinal extensors. PRIME STABILIZERS: Shoulder girdle stabilizers, especially the scapular depressors, to limit excessive shoulder elevation. Hip extensors to limit excessive lumbar lordosis. Spinal flexors and deep lumbo-pelvic musculature to support the spinal column and to facilitate the hydraulic amplifier mechanism. INCLINE GUIDELINE: 8 to 1—Adjust incline lower for decreased extremity focus. STARTING POSITION: Disconnect the arm pulley from the glideboard 330 and lower the LAT bars into the pull up position. Facing the tower, straddle then push the glideboard 330 halfway up the rails. Lie prone with the chest near the top edge of the glideboard 330. Grasp the LAT bars, palms facing down. Maintain the legs extended and abducted, shoulder width apart, with the feet softly pointed. The spine and pelvis are in a neutral position. EXERCISE DESCRIPTION: Inhale—To draw the scapulae down the back to a neutral position. Exhale—To pull oneself up by drawing the elbows into the sides of the body. Simultaneously extend the cervical and thoracic spine. Inhale—To extend the arms while lowering the torso onto the glideboard 330. REPETITIONS: 5-10 times. TEACHING TIPS: Watch for over activation of the biceps. Focus more on pulling from the back versus the arms. Watch for increased lumbar lordosis. Activate more hip extensors and spinal flexors. Watch for loss of thoracic imprint, "popping of the ribs." Slide the ribs together and down without compensating by flexing the trunk. "Knit" the ribs together. Watch for excessive shoulder elevation. Lengthen the shoulders away from the ears. Slide, don't press, the shoulder blades (scapulae) down the back. Watch for cervical hyperextension. Reach the crown of the head toward the tower. PROGRESSIONS/VARIATIONS: To facilitate coordinating and controlling the breath with spinal extension and activation of the abdominals, break the movement into four breaths. Inhale to prepare. Exhale to extend. Inhale to hold the extension. Inhale to lower. To focus on scapular mobility and strength; focus on scapular elevation and depression. To increase intensity and increase lateral stability, perform unilateral pull-ups. The resting arm can be on the forehead or on the small of the back. SAFETY ASPECTS/CONTRAINDICATIONS: Shoulder vulnerability, especially for those with impingement, tendonitis or instability. Spinal and sacroiliac vulnerabilities which are exacerbated by extension. Postural faults exacerbated by spinal extension.

Thoracic Twist with Pull Up

ACCESSORY: LAT bars. OBJECTIVES: Teach coordination core stabilization during extension. Increase thoracic extension and rotation. Enhance spinal articulation into extension. PRIME MOVERS: To extend spine: Concentric spinal extensors. To rotate the spine: Concentric spinal rotators. To flex the shoulders: Concentric and eccentric shoulder flexors. To lower the spine: Eccentric spinal extensors. PRIME STABILIZERS: Spinal extensors to maintain extension during extremity movement. Trunk flexors and hip flexors to limit excessive lumbar lordosis. Knee extensors to maintain active knee extension. Cervical extensors to maintain cervical extension. Shoulder flexors and scapular stabilizers to maintain shoulder flexion (the arms over the head). INCLINE GUIDELINE: 1 to 8—Adjust incline higher for increased extremity focus. STARTING POSITION: Disconnect the arm pulley from the glideboard 330 and lower the LAT bars into the pull up position. Facing the tower, straddle then push the glideboard 330 halfway up the rails. Lie prone with the chest near the top edge of the glideboard 330. Grasp the LAT bars with one hand, palm facing down. Bring the other arm to the side of the body, palms facing in. Maintain the legs extended and abducted, shoulder width apart, with the feet softly pointed. The spine and pelvis are in a neutral position. EXERCISE DESCRIPTION: Inhale—To draw the scapulae down the back. Exhale—To pull oneself up by drawing the right elbow into the side. Simultaneously, lift the left arm toward the ceiling while rotating the cervical and thoracic spine. Inhale—To return to the start position. REPETITIONS: 8-10 times. TEACHING TIPS: Watch for increase lumbar lordosis. Activate more hip extensors and spinal flexors. Limit range of motion. Watch for excessive shoulder elevation. Lengthen the shoulders away from the ears. Slide, don't press, the shoulder blades (scapulae) down the back. Watch for loss of neutral pelvis and increased lumbar lordosis. Gently tuck the pelvis while pulling the navel away from the glideboard 330. Watch for excessive lumbar lordosis in the prone position. Slightly tuck the pelvis under. Place a small pad under the pelvis. Watch for shoulder protraction (rounding of the shoulders) or collapsing through the collarbone. Lift the collarbone up while maintaining an imprinted ribcage. Think wide through the collarbone. Slide the scapulae toward one another. Watch for compensatory lumbar and pelvic rotation. Rotate just the ribcage while maintaining the pelvis parallel to the front wall. Place one hand on the small of the back and don't let the back pull away from the hand. PROGRESSIONS/VARIATIONS: To focus on timing and control, slow down the count. To decrease coordination and focus on muscle isolation, move the arm or lower extremity only. SAFETY ASPECTS/CONTRAINDICATIONS: Shoulder vulnerability, especially for those with impingement, tendonitis or instability. Spinal and sacroiliac vulnerabilities which are exacerbated by extension. Postural faults exacerbated by spinal extension.

Inverted One Leg Circle

ACCESSORY: Optional Support Wedge Pillow OBJECTIVES: Challenge the lateral stabilizers of the torso and pelvis. Articulation of the hip. Dissociation of the hip (lower extremity) and pelvis. PRIME MOVERS: To perform the circles: Concentric hip flexors, extensors, abductors, and adductors. To flex the spine: Concentric spinal flexors. To lower the spine: Eccentric spinal flexors. PRIME STABILIZERS: Trunk rotators to stabilize the pelvis as the leg circles. Hip flexors and rotators to maintain the leg in parallel and flexed at the hip. Spinal flexors and deep lumbo-pelvic musculature to support the spinal column and to facilitate the hydraulic amplifier mechanism. INCLINE GUIDELINE: 3 to 1—Adjust incline lower for increased extremity work. 1 to 3—Adjust incline higher for increased torso focus. STARTING POSITION: Disconnect the pulley from the glideboard 330. With the glideboard 330 closed, sit facing the tower toward the top edge of the glideboard 330. Bring the feet onto the rails and lie back, ensuring the head is fully supported. Bring the thoracic and lumbar spine into an imprinted position while lengthening the cervical spine. Align one leg with the ischial tuberosity, extend and reach it toward the tower. The other leg maintains an extended position, reaching for the ceiling. Place the hands to the sides of the body. EXERCISE DESCRIPTION: Inhale—To circle the leg toward the midline of the body. If able, cross the midline of the body, and down. All performed without moving the pelvis. Exhale—To circle the leg out to the side and around to the start position. All performed without moving the pelvis. Repeat 5 times clockwise, 5 times counterclockwise Inhale—To lengthen through the leg. REPETITIONS: 5 times clockwise and 5 times counterclockwise. TEACHING TIPS: Watch for equal weight bearing through the pelvis. Bear weight evenly through both sides of the pelvis. Greater weight bearing tends to occur on the unsupported side. Place greater weight on the supported side. Decrease the lever arm by bending the knee to tabletop position. Watch for compensatory knee movement versus hip movement. Decrease the range of motion and increase activation of the knee extensors. If the knee is flexed, visualize balancing a serving tray on the tibia (shin). Watch for gripping of the hip flexors. Decrease the lever by bending the supported or unsupported knee. Change the incline level. (Note that a higher incline requires greater hamstring flexibility). Reach the leg to the front wall versus the ceiling. Watch for loss of thoracic imprint, "popping of the ribs." Slide the ribs together and down without compensating by flexing the trunk. "Knit" the ribs together. Use the Support Wedge Pillow. Perform an abdominal curl. Imagine making an "O" on the ceiling. Start with a small range of motion and as strength and stability improve, increase the range of motion. Watch for loss of neutral pelvis and increased lumbar lordosis. Maintain a slight imprint in the spine. Increase activation of the abdominals. Reach the legs toward the ceiling or maintain the knees bent in tabletop position. PROGRESSIONS/VARIATIONS: To vary range of motion, make more of "D" shape versus an "0" shape on the ceiling. To challenge core stability, lift the arms up toward the ceiling. For greater feedback regarding pelvic positioning, place his/her hands on the pelvis. SAFETY ASPECTS/CONTRAINDICATIONS: Spinal and sacroiliac vulnerabilities which are exacerbated by flexion. Cervical strain or vulnerability. Hip vulnerability, especially for those with hip precautions limiting flexion, adductor or external rotation. Participants with high blood pressure, aneurysms, or any related pathology should avoid any position that brings greater blood flow to the head. Participants with vestibular disorders. Then reverse directions.

Inverted Bend and Stretch

ACCESSORY: Optional Support Wedge Pillow. OBJECTIVES: Enhance muscular endurance of spinal flexors. Teach dissociation of the extremities and torso. Increase coordination. PRIME MOVERS: To flex the trunk: Concentric cervical and trunk flexors. To flex the arms and extend the legs: Concentric shoulder flexors to initiate the movement and eccentric shoulder extensors to control the arm overhead. Concentric hip extensors to initiate hip extension then eccentric hip flexors to complete the motion. To flex the legs and circle the arms: Concentric hip flexors and eccentric knee extensors to flex the hips and knees. Concentric shoulder adductors to initiate the movement and eccentric shoulder adductors and flexors. To lower trunk onto glideboard 330: Eccentric spinal flexors. PRIME STABILIZERS: Shoulder girdle stabilizers to limit shoulder elevation and assist in scapular control. Spinal and cervical flexors to maintain spinal flexion during extremity movement. Spinal flexors and hip extensors to assist in maintaining an imprinted spine and pelvic positioning, especially as the legs and arms lengthen. Deep lumbo-pelvic musculature to support the spinal column and to facilitate the hydraulic amplifier mechanism. INCLINE GUIDELINE: 1 to 3—Adjust incline higher to increase torso focus. STARTING POSITION: Disconnect the pulley from the glideboard 330. With the glideboard 330 closed, sit facing the tower toward the top edge of the glideboard 330. Bring the feet onto the rails and lie back, ensuring the head is fully supported. Bring the thoracic and lumbar spine into an imprinted position while lengthening the cervical spine. Flex the knees toward the chest, bringing the hips and knees to a 90° (tabletop) position. Reach the hands to the outsides of the knees. EXERCISE DESCRIPTION: Inhale—To lengthen through the back of the neck. Exhale—To flex the upper body, sliding rib cage toward the pelvis. Do not let the tips of the scapulae come off the glideboard 330. Remain in flexion. Inhale—To reach the arms overhead while lengthening the legs to a diagonal. Exhale—To circle the arms around toward the knees while returning the legs into tabletop position. Repeat 3-5 more times To finish . . . Inhale—To stay. Exhale—To lengthen the spine onto the glideboard 330. REPETITIONS: 1 set of 3-5 times. TEACHING TIPS: Watch for stress or strain to the lumbar spine. Lengthen the legs toward the ceiling versus on a diagonal. Decrease the levers by extending only the legs or only the arms. Watch for loss of thoracic imprint, "popping of the ribs." Slide the ribs together and down without compensating by flexing the trunk. "Knit" the ribs together. Use the Support Wedge Pillow. Perform an abdominal curl. Watch for shoulder protraction (rounding of the shoulders) or collapsing through the collarbone. Lift the collarbone up while maintaining an imprinted ribcage. Think wide through the collarbone. Slide the scapulae toward one another. Watch for cervical stress or strain. Nod, don't press, the chin toward the chest. Place the tongue on the roof of the mouth. Use the Support Wedge Pillow. Participants with longer limbs will require greater torso stabilization due to the increase in lever lengths. PROGRESSIONS/VARIATIONS: To teach the choreography and the breath, change the breath pattern to a four count. Exhale as the extremities lengthen, inhale to stay, exhale to return to the start position, inhale to stay. To decrease the amount of spinal flexor muscular endurance, only perform one repetition of the extremities lengthening. As endurance improves, increase the repetitions accordingly. To further increase coordination, externally rotate the legs as they extend and rotate to parallel as they return to tabletop. To decrease coordination, focus on bringing the arms overhead while keeping the legs in tabletop. Or, extend the knees while keeping the arms reaching by the side of the body or supporting the head. SAFETY ASPECTS/CONTRAINDICATIONS: Spinal and sacroiliac vulnerabilities which are exacerbated by flexion. Cervical strain or vulnerability. Shoulder vulnerability, especially for those with impingement, tendonitis or instability. Participants with high blood pressure, aneurysms, or any related pathology should avoid any position that brings greater blood flow to the head. Participants with vestibular disorders.

Inverted Cross with One Leg Stretch

ACCESSORY: Optional Support Wedge Pillow. OBJECTIVES: Develop core control and lateral stability of the pelvis. To increase spinal flexor muscular endurance. Develop cross coordination. PRIME MOVERS: To flex the spine: Concentric trunk and cervical flexors. To lower the spine: Eccentric trunk and cervical flexors. To lower one leg toward the floor: Eccentric hip flexors and concentric knee extensors. To rotate the torso: Concentric and eccentric spinal rotators. To de-rotate the torso: Eccentric and concentric spinal rotators. To flex the knee to tabletop: Concentric hip flexors and knee flexors followed by eccentric knee extensions. PRIME STABILIZERS: Spinal flexors to maintain flexion and spinal imprint. Torso rotators to stabilize the pelvis during lower extremity movement. Shoulder girdle stabilizers to limit shoulder elevation and promote scapular control. Elbow flexors to maintain elbow flexion. Hip flexors to maintain leg in tabletop. INCLINE GUIDELINE: 3 to 1—Adjust incline lower for increased extremity work. 1 to 3—Adjust incline higher for increased torso focus. STARTING POSITION: Disconnect the pulley from the glideboard 330. With the glideboard 330 closed, sit facing the tower toward the top edge of the glideboard 330. Bring the feet onto the rails and lie back, ensuring the head is fully supported. Bring the thoracic and lumbar spine into an imprinted position while lengthening the cervical spine. Flex the knees toward the chest, bringing the hips and knees to a 90° (tabletop) position. Bend the elbows and place the hands behind the head. EXERCISE DESCRIPTION: Inhale—To lengthen through the back of the neck. Exhale—To lift the upper body off the glideboard 330, sliding rib cage towards the pelvis. Inhale—To stay. Exhale—Extend one knee and hip (left) until it is parallel to the floor while the other knee (right) maintains tabletop position. Simultaneously rotate the torso toward the bent knee. Focus on opposite rib to hip versus elbow to knee. Inhale—To derotate and bring the legs back to tabletop. Repeat 5 times To finish Exhale—To lower the upper body onto the glideboard 330. Repeat other side. REPETITIONS: Up to 10 times with each leg. TEACHING TIPS: Watch for increased lumbar lordosis or loss of abdominal activation. Extend the knee and hip to a higher angle versus parallel with the floor. Ensure that the lumbar spine is not compensating for loss of thoracic imprint. Watch for pulling the torso into rotation with the upper body versus using the spinal rotators. Limit the range of motion. Visualize drawing a diagonal line from the bottom rib to the opposite hip. Watch for cervical stress or strain. Nod, don't press, the chin toward the chest. Place the tongue on the roof of the mouth. Use the Support Wedge Pillow. Watch for cervical hyperflexion. Gaze up and over the knees. Hold an imaginary ball between the chin and the chest. Watch for proper femoral alignment. If the leg is internally rotating, turn the inner thigh up toward the ceiling. If the leg is externally rotating, turn the inner thigh down toward the floor. Watch for pelvic lateral tilting or shifting as the legs are flexing and extending. Increase activation of the spinal rotators, especially the obliques. If the right leg is extending, it is common for greater weight-bearing to occur through the right side of the pelvis. Keep more weight on the left side of the pelvis. Watch for increased lumbar lordosis or loss of abdominal activation. Extend the knee and hip to a higher angle versus parallel with the floor. Ensure that the lumbar spine is not compensating for loss of thoracic imprint. Watch for pulling the torso into rotation with upper body versus spinal rotators. Limit the range of motion. Visualize drawing a diagonal line from the bottom rib to the opposite hip. PROGRESSIONS/VARIATIONS: To focus more on the hip lateral rotators and adductors, laterally rotate the legs. To challenge torso stability, reach the left hand overhead when rotating to the left. Vice versa for left rotation. To decrease cervical strain, use the Support Wedge Pillow. SAFETY ASPECTS/CONTRAINDICATIONS: Spinal and sacroiliac vulnerabilities which are exacerbated by flexion. Cervical strain or vulnerability. Participants with high blood pressure, aneurysms, or any related pathology should avoid any position that brings greater blood flow to the head. Participants with vestibular disorders.

Inverted One Leg Stretch with Reach

ACCESSORY: Optional Support Wedge Pillow. OBJECTIVES: Develop core control and lateral stability of the pelvis. To increase abdominal muscular endurance. Develop cross coordination. PRIME MOVERS: To flex the spine: Concentric trunk and cervical flexors. To lower the spine: Eccentric trunk and cervical flexors. To reach the arm overhead: Concentric shoulder flexors. To lower the arms: Eccentric shoulder flexors. To lower one leg toward the floor: Eccentric hip flexors. To flex one leg toward the ceiling: Concentric hip flexors. PRIME STABILIZERS: Spinal flexors to maintain flexion and spinal imprint. Torso rotators to stabilize the pelvis during lower extremity movement. Shoulder girdle stabilizers to limit shoulder elevation and promote scapular control. INCLINE GUIDELINE: 3 to 1—Adjust incline lower for less extremity work. 1 to 3—Adjust incline higher for increased spinal flexor resistance. STARTING POSITION: Disconnect the pulley from the glideboard 330. With the glideboard 330 closed, sit facing the tower toward the top edge of the glideboard 330. Bring the feet onto the rails and lie back, ensuring the head is fully supported. Bring the thoracic and lumbar spine into an imprinted position while lengthening the cervical spine. Flex the knees toward the chest, bringing the hips and knees to a 90° (tabletop) position. Place the hands to the sides of the body. EXERCISE DESCRIPTION: Inhale—To lengthen through the back of the neck. Exhale—To lift the upper body off the glideboard 330, sliding rib cage towards pelvis. Inhale—To extend one knee and hip (left) until it is parallel to the floor, the other knee (right) maintains hip and knee flexion. The right hand will reach overhead while the other hand (left) extends toward the tower. Exhale—Return extended leg and change hands and leg position. Repeat 5 time each side To finish Inhale—To stay in flexion and return the legs to tabletop position. Exhale—To lower the upper body onto the glideboard 330. REPETITIONS: Up to 10 times with each leg. TEACHING TIPS: Watch for cervical stress or strain. Nod, don't press, the chin toward the chest. Place the tongue on the roof of the mouth. Use the Support Wedge Pillow. Watch for cervical hyperextension. Gaze toward the knees or navel. Watch for increased lumbar lordosis or loss of abdominal activation. Extend the knee and hip to a higher angle versus parallel with the floor. Ensure that the lumbar spine is not compensating for loss of thoracic imprint. Watch for proper femoral alignment. If the leg is internally rotating, turn the inner thigh up toward the ceiling. If the leg is externally rotating, turn the inner thigh down toward the floor. Watch for pelvic lateral tilting or shifting as the legs are flexing and extending. Increase activation of the spinal rotators, especially the obliques. If the right leg is extending, it is common for greater weight-bearing to occur through the right side of the pelvis. Keep more weight on the left side of the pelvis. Watch for shoulder protraction (rounding of the shoulders) or collapsing through the collarbone. Lift the collarbone up while maintaining an imprinted ribcage. Think wide through the collarbone. Slide the scapulae toward one another. Watch for excessive shoulder elevation. Lengthen the shoulders away from the ears. Slide, don't press, the shoulder blades (scapulae) down the back. PROGRESSIONS/VARIATIONS: To focus more on the hip lateral rotators and adduct, laterally rotate the legs. To support the cervical spine, place the hands behind the head. To increase abdominal work and decrease hip flexor work, perform the same movement in a supine inverted position. SAFETY ASPECTS/CONTRAINDICATIONS: Spinal and sacroiliac vulnerabilities which are exacerbated by flexion. Cervical strain or vulnerability. Participant's with high blood pressure, aneurysms, or any related pathology should avoid any position that brings greater blood flow to the head. Participants with vestibular disorders.

Inverted Scissors with Reach

ACCESSORY: Optional Support Wedge Pillow. OBJECTIVES: Develop core control and lateral stability of the pelvis. To increase spinal flexor muscular endurance. Develop cross coordination. PRIME MOVERS: To flex the spine: Concentric trunk and cervical flexors. To lower the spine: Eccentric trunk and cervical flexors. To reach the arm overhead: Concentric shoulder flexors. To lower the arms: Eccentric shoulder flexors. To lower one leg toward the floor: Eccentric hip flexors. To flex one leg toward the ceiling: Concentric hip flexors. PRIME STABILIZERS: Spinal flexors to maintain flexion and spinal imprint. Torso rotators to stabilize the pelvis during lower extremity movement. Shoulder girdle stabilizers to limit shoulder elevation and promote scapular control. Elbow extensors to maintain straight arms. INCLINE GUIDELINE: 3 to 1—Adjust incline lower for less extremity work. 1 to 3—Adjust incline higher for increased torso work. STARTING POSITION: Disconnect the pulley from the glideboard 330. With the glideboard 330 closed, sit facing the tower toward the top edge of the glideboard 330. Bring the feet onto the rails and lie back, ensuring the head is fully supported. Bring the thoracic and lumbar spine into an imprinted position while lengthening the cervical spine. Flex the knees toward the chest, bringing the hips and knees to a 90°(tabletop) position. Place the hands to the sides of the body. EXERCISE DESCRIPTION: Inhale—To lengthen through the back of the neck. Exhale—To lift the upper body off the glideboard 330, sliding the ribs toward the pelvis. Inhale—To lower one leg (left) toward the floor while the other leg (right) reaches for the ceiling. Simultaneously, raise the opposite arm overhead (right) while the other arm reaches for the tower. Exhale—To switch legs and arms. Repeat 5 times on each side To finish Inhale—To return the legs to tabletop and arms to the side. Exhale—To lower the upper body onto the glideboard 330. REPETITIONS: Up to 10 times with each leg. TEACHING TIPS: Watch for cervical stress or strain. Nod, don't press, the chin toward the chest. Place the tongue on the roof of the mouth. Use the Support Wedge Pillow. Watch for cervical hyperextension. Gaze toward the knees or navel. Watch for increased lumbar lordosis or loss of abdominal activation. Extend the knee and hip to a higher angle versus parallel with the floor. Ensure that the lumbar spine is not compensating for loss of thoracic imprint. Watch for proper femoral alignment. If the leg is internally rotating, turn the inner thigh up toward the ceiling. If the leg is externally rotating, turn the inner thigh down toward the floor. Watch for pelvic lateral tilting or shifting as the legs are flexing and extending. Increase activation of the spinal rotators, especially the obliques. If the right leg is extending, it is common for greater weight-bearing to occur through the right side of the pelvis. Keep more weight on the left side of the pelvis. Watch for shoulder protraction (rounding of the shoulders) or collapsing through the collarbone. Lift the collarbone up while maintaining an imprinted ribcage. Think wide through the collarbone. Slide the scapulae toward one another. Watch for excessive shoulder elevation. Lengthen the shoulders away from the ears. Slide, don't press, the shoulder blades (scapulae) down the back. PROGRESSIONS/VARIATIONS: To focus more on the hip lateral rotators and adductors, laterally rotate the legs. To support the cervical spine, place the hands behind the head. To decrease cervical strain, use the Support Wedge Pillow. SAFETY ASPECTS/CONTRAINDICATIONS: Spinal and sacroiliac vulnerabilities which are exacerbated by flexion. Cervical strain or vulnerability. Participants with high blood pressure, aneurysms, or any related pathology should avoid any position that brings greater blood flow to the head. Participants with vestibular disorders.

Inverted Rollover

ACCESSORY: None. OBJECTIVES: Increase spinal flexibility. Increase abdominal strength. Stretching the hip extensors and knee flexors dynamically. PRIME MOVERS: To initiate the rollover: Concentric hip and spinal flexors. To complete the rollover: Gravity and eccentric hip and spinal extensors. To open the legs: Concentric hip abductors. To close the legs: Concentric hip adductors. To roll down: Gravity and eccentric spinal flexors and hip extensors. To hinge legs away: Eccentric hip flexors. PRIME STABILIZERS: Spine extensors to limit excessive trunk flexion, especially with the roll down phase. Shoulder girdle stabilizers to limit shoulder elevation. Knee extensors to prevent knee flexion. Deep lumbo-pelvic musculature to support the spinal column and to facilitate the hydraulic amplifier mechanism. INCLINE GUIDELINE: 3 to 1—Adjust incline lower to decrease torso focus. STARTING POSITION: Disconnect the pulley from the glideboard 330. With the glideboard 330 closed, sit facing the tower toward the top edge of the glideboard 330. Bring the feet onto the rails and lie back, ensuring the head is fully supported. Bring the thoracic and lumbar spine into an imprinted position while lengthening the cervical spine. Flex the knees toward the chest, then extend the legs toward the ceiling. Place the arms to the sides of the body with the hands lightly grasping the top of the glideboard 330, or reach the arms overhead EXERCISE DESCRIPTION: Inhale—To hinge the legs toward the body. Exhale—To peel the pelvis and spine off the glideboard 330. Send the legs over the head and bring them are parallel to floor. The weight of the body rests across the shoulder girdle region and not on the cervical spine. Inhale—To flex the feet and open the legs shoulder distance. Exhale—To keep the legs abducted, roll the spine onto the glideboard 330 one vertebra at a time. When the pelvis is on the glideboard 330, hinge the legs away from the body. Inhale—To adduct the legs and hinge them toward the body. Repeat rolling over with legs adducted for 3 repetitions then reverse the legs for 3 repetitions. The reverse will be with the legs abducted to roll over and adducted to roll down. REPETITIONS: 1 set of 3 rollovers with legs adducted and 3 rollovers with legs abducted. TEACHING TIPS: Watch for hyperextension of the cervical spine. Nod, don't press, the chin toward the chest. Watch for excessive weight bearing onto the cervical spine. Maintain the weight of the body across the shoulder girdle. Lengthen the chin away from the chest. Watch for compensatory knee movement versus hip movement. Decrease the range of motion and cue greater activation of the knee extensors. If the knee is flexed, visualize balancing a serving tray on the tibia (shin). Watch for flexion of the knees. Maintain contraction in the quadriceps. Lengthen the leg or reach the leg long. Watch for the use of momentum. Count to three or four with each phase of the movement. Watch for the use of the upper extremity to propel oneself upward. Bring the arms overhead which makes the movement more difficult. Change the level of the incline. Watch for dropping versus rolling the spine onto the glideboard 330. Place each vertebra on the glideboard 330 one at a time. Visualize the spine as a string of pearls lowering one bead at a time onto the glideboard 330. Watch for rolling the pelvis off the glideboard 330. Lift the spine off the glideboard 330 as one unit. Participants with longer limbs will require greater torso stabilization earlier in the range of motion. PROGRESSIONS/VARIATIONS: To decrease coordination, maintain a soft point in the toe throughout the motion. To teach the choreography to the beginner, perform only the lower extremity movement with hinging the legs but not flexing the spine. To focus more on the lateral hip rotators, perform the movement with legs laterally rotated. During the rollover, have the participant maintain spinal flexion and flex the hips, not the spine, to tap the floor then extend the hips to bring the legs parallel to the glideboard 330. To intensify the motion, hover the hands about an inch above the glideboard 330. To further intensify the motion, have the participant perform the movement on level one with the head at the top of the glideboard 330. As strength and control improve, perform the movement with a neutral pelvis. SAFETY ASPECTS/CONTRAINDICATIONS: Postural faults exacerbated by spinal lateral flexion. Hip vulnerability, especially for those with hip precautions limiting flexion, adductor or external rotation. Participants with high blood pressure, aneurysms, or any related pathology should avoid any position that brings greater blood flow to the head. Participants with vestibular disorders.

Inverted Corkscrew

ACCESSORY: None. OBJECTIVES: Develop trunk control, especially of the spinal rotators. Develop trunk strength and endurance. Increase spinal flexibility. INCLINE GUIDELINES: 1 to 3—Adjust incline higher to assist rolling over. 3 to 1—Adjust incline lower to emphasize more torso control and strength. PRIME MOVERS: To initiate the rollover: Concentric and spinal flexors. To complete the rollover: Gravity, rotators, eccentric hip flexors and spinal extensors. To roll down: Eccentric spinal flexors and rotators. To hinge legs away: Eccentric hip flexors. PRIME STABILIZERS: Spine extensors to limit excessive trunk flexion. Trunk rotators to maintain the "twist" in the torso during the roll up and down. Hip adductors and knee extensors to maintain the legs together and extended. Shoulder girdle stabilizers to limit excessive cervical tension and shoulder elevation. INCLINE GUIDELINE: 3 to 1—Decrease incline to increase torso focus. 3 to 1—Decrease incline to alleviate hamstring shortness. STARTING POSITION: Disconnect the pulley from the glideboard 330. With the glideboard 330 closed, sit facing the tower toward the top edge of the glideboard 330. Bring the feet onto the rails and lie back, ensuring the head is fully supported. Bring the thoracic and lumbar spine into an imprinted position while lengthening the cervical spine. Flex the knees toward the chest, then extend the legs to a diagonal. Place the arms to the sides of the body with the hands lightly grasping the top of the glideboard 330, or reach the arms overhead. EXERCISE DESCRIPTION: Inhale—To prepare. Exhale—To take the legs to the right and roll up through the right side of the spine in a half circle shape to where the legs are parallel with the glideboard 330 and one is resting on the upper thoracic and shoulder girdle region. Inhale—As the legs are passing through the mid point over the face and are parallel to the floor Exhale—To roll down through the left side of the spine in a half circle shape. Inhale—As the legs are passing through the midpoint of the body and are at a 45° angle to the body. Repeat the motion for another 2-3 repetitions then roll up the spine on left side. REPETITIONS: 3 times each side. TEACHING TIPS: Watch for hyperextension of the cervical spine. Nod, don't press, the chin toward the chest. Watch for excessive weight bearing onto the cervical spine. Maintain the weight of the body across the shoulder girdle. Lengthen the chin away from the chest. Watch for loss of abdominal activation. Draw the navel in toward the spine and up toward the crown of the head. Watch for flexion of the knees. Maintain contraction in the quadriceps. Lengthen the leg or reach the leg long. Watch for dropping versus rolling the spine onto the glideboard 330. Place each vertebra on the glideboard 330 one at a time. Visualize the spine as a string of pearls lowering one bead at a time onto the glideboard 330. Watch for rolling the pelvis off the glideboard 330. Lift the spine off the glideboard 330 as one unit. Watch for twisting of the spine and pelvis. Make a small arc on the ceiling with the legs. Keep the patella facing forward versus to the side. PROGRESSIONS/VARIATIONS: To intensify the motion, hover the hands about an inch above the glideboard 330. To further intensify the motion, perform the movement on level one in the supine position. As strength and control improve, perform the movement with a neutral pelvis. SAFETY ASPECTS/CONTRAINDICATIONS: Spinal and sacroiliac vulnerabilities which are exacerbated by flexion. Hip vulnerability, especially for those with hip precautions limiting flexion, adductor or external rotation. Participants with high blood pressure, aneurysms, or any related pathology should avoid any position that brings greater blood flow to the head. Participants with vestibular disorders.

Swan Dive Prep 1

ACCESSORY: None. OBJECTIVES: Develop cervical and thoracic flexibility into extension. Strengthen the spinal and hip extensors. Facilitate greater abdominal contraction during spinal extension. Promote weight-bearing through the upper extremity. Enhance shoulder girdle stabilization during a closed chain exercise. PRIME MOVERS: To extend and lower the spine: Concentric and eccentric spinal extensors. PRIME STABILIZERS: Spinal flexors and hip extensors to limit excessive lumbar lordosis. Knee extensors to maintain active knee extension. Shoulder girdle stabilizers, especially the scapular depressor, to promote scapular control and limit shoulder elevation. INCLINE GUIDELINE: 1 to 3—Adjust incline higher for greater upper extremity weight bearing and increase resistance for thoracic extension. 3 to 1—Adjust the incline lower for less upper extremity weightbearing and decrease resistance for thoracic extension. STARTING POSITION: Disconnect the arm pulley from the glideboard 330. Remove the telescoping squat stand. Facing away from the tower, kneel on the glideboard 330. Lower into a prone inverted position with the chest toward the bottom edge of the glideboard 330 and the hands on the exercise device base or in front the exercise device base. Maintain the legs in extension while externally rotating and abducting them hip to shoulder distance apart. Softly point the feet. Ensure the pelvis and spine are neutral with the abdominals activated. EXERCISE DESCRIPTION: Inhale—To slide the scapulae down the back. Exhale—To extend the cervical, thoracic, and lumbar spine. The hands will remain on the floor. Focus on extending, using the spinal extensors versus pressing through the hands. Inhale—To stay. Exhale—To lower the spine onto the glideboard 330. REPETITIONS: 5-10 times. TEACHING TIPS: Watch for proper spinal sequencing during extension. Lengthen the cervical, then the thoracic, then the lumbar spine away from the glideboard 330. Press the spine toward the ceiling one vertebra at a time, versus pressing through the hands. Press the collarbone and sternum up and away. Watch for excessive lumbar lordosis in the prone position. Slightly tuck the pelvis under. Place a small pad under the pelvis. Watch for loss of stabilization in the scapular depressors. Push into and down with the heel of the hands. Watch for loss of abdominal activation. Draw the navel in toward the spine and up toward the crown of the head. Watch to ensure that the cervical spine is following the natural extension of the spine and is not hyper-extending or remaining flexed. PROGRESSIONS/VARIATIONS: To decrease the intensity, turn the body 180° and perform the exercise prone facing the tower. To decrease upper extremity strength demands, perform only cervical and thoracic extension until strength is gained. As strength improves, incorporate more lumbar extension. SAFETY ASPECTS/CONTRAINDICATIONS: Spinal and sacroiliac vulnerabilities which are exacerbated by extension. Shoulder vulnerability, especially for those with impingement, tendonitis or instability. Postural faults exacerbated by spinal extension. Participants with high blood pressure, aneurysms, or any related pathology should avoid any position that brings greater blood flow to the head. Precautions limiting weightbearing through the upper extremity.

Swan Dive Prep 2

ACCESSORY: None. OBJECTIVES: Increase spinal extension and articulation. Increase spinal and hip extensor muscular endurance. Facilitate greater abdominal contraction during spinal extension. Promote shoulder girdle stabilization during a closed chain exercise. To stretch the anterior chest wall. PRIME MOVERS: To extend the spine: Concentric hip, spinal, and elbow extensors and shoulder flexors. To lower the spine: Eccentric spinal, hip extensors, elbow extensors and shoulder flexors. To extend the legs: Concentric hip and spinal extensors. To the lower legs: Eccentric hip and spinal extensors. To extend the elbows: Concentric elbow extensors and shoulder flexors. To bend the elbows: Eccentric elbow extensors and shoulder flexors. PRIME STABILIZERS: Spinal flexors and hip extensors to limit excessive lumbar lordosis. Knee extensors to maintain active knee extension. Shoulder girdle stabilizers to promote proper scapularhumeral rhythm and to control shoulder flexion and extension during spinal extension. INCLINE GUIDELINE: 1 to 3—Adjust incline higher to increase upper extremity weightbearing and stabilization. STARTING POSITION: Disconnect the arm pulley from the glideboard 330. Remove the telescoping squat stand. Facing away from the tower, kneel on the glideboard 330. Lower into a prone inverted position with the chest toward the bottom edge of the glideboard 330 and the hands on the exercise device base or in front the exercise device base. Maintain the legs in extension while externally rotating and abducting them hip to shoulder distance apart. Softly point the feet. Ensure the pelvis and spine are neutral with the abdominals activated. EXERCISE DESCRIPTION: Inhale—To lengthen the spine. Exhale—To extend the cervical, thoracic, and lumbar spine while keeping the hands on the floor. Maintain the pubic bone in contact with the glideboard 330. Inhale—To stay. Exhale—To lower the body onto the glideboard 330 while simultaneously extending the hips. When the upper body is one the glideboard 330, the legs will extend and lift and the arms will extend pressing the glideboard 330 up the incline. Inhale—To lower the legs and return the glideboard 330. Repeat the above 5-8 times To finish . . . Exhale—To lower the legs onto the floor. REPETITIONS: 5-10 times. TEACHING TIPS: Watch for proper spinal sequencing during extension. Lengthen the cervical, then the thoracic, then the lumbar spine away from the glideboard 330. Press the spine toward the ceiling one vertebra at a time, versus pressing through the hands. Press the collarbone and sternum up and away from the glideboard 330. Watch for excessive lumbar lordosis in the prone position. Slightly tuck the pelvis under. Place a small pad under the pelvis. Watch for loss of stabilization in the scapular depressors. Push into and down with the heel of the hands. Watch for loss of abdominal activation. Draw the navel in toward the spine and up toward the crown of the head. Watch to ensure that the cervical spine is following the natural extension of the spine and is not hyper-extending or remaining flexed. PROGRESSIONS/VARIATIONS: To decrease coordination, perform cervical and thoracic extension or hip extension. To challenge the hip adductors and lateral rotators, place a ball between the legs. Make sure the ball is large enough to maintain the legs shoulder-width apart. SAFETY ASPECTS/CONTRAINDICATIONS: Spinal and sacroiliac vulnerabilities which are exacerbated by extension. Shoulder vulnerability, especially for those with impingement, tendonitis or instability. Postural faults exacerbated by spinal extension. Participants with high blood pressure, aneurysms, or any related pathology should avoid any position that brings greater blood flow to the head. Precautions limiting weightbearing through the upper extremity.

Rest Position

ACCESSORY: None. OBJECTIVES: Stretch the spine. Facilitate lateral thoracic breathing. PRIME MOVERS: To roll down into position: Eccentric spinal extensors. To roll up: Concentric spinal extensors. PRIME STABILIZERS: Shoulder stabilizers to limit shoulder elevation. INCLINE GUIDELINE: 1 to 3—Adjust incline according to the incline used in previous exercise. STARTING POSITION: Disconnect the arm pulley from the glideboard 330. Remove the telescoping squat stand. Facing away from the tower, kneel on the glideboard 330. Flex the spine and sit the buttocks toward the heels. Reach the arms overhead toward the bottom of the glideboard 330. EXERCISE DESCRIPTION: Inhale—To stay. Exhale—To stay. Stay in the stretch for 3-5 breath cycles. Exhale—To roll up one vertebra at a time. REPETITIONS: 1-3 times. TEACHING TIPS: To facilitate a greater stretch, drop the tailbone and crown of the head toward the glideboard 330. PROGRESSIONS/VARIATIONS: To stretch the lateral aspect of the spine and the rotators, walk the hands over to one side and shift the weight in the pelvis to the opposite side. If unable to perform the movement seated on the heels, then place the Support Wedge Pillow under the knees. SAFETY ASPECTS/CONTRAINDICATIONS: Spinal and sacroiliac vulnerabilities which are exacerbated by flexion. Hip vulnerability, especially for those with hip precautions limiting flexion, adductor or external rotation. Postural faults exacerbated by spinal flexion.

Crouching Tiger #1

ACCESSORY: None. OBJECTIVES: Work shoulder girdle stabilizers in a closed chain environment. Challenge balance and control. Enhance torso stability and strength: PRIME MOVERS: Entering in plank position: Concentric hip and knee extensors. Enter back into quadruped: Concentric hip flexors. PRIME STABILIZERS: Shoulder girdle stabilizers to inhibit shoulder elevation, flexion or scapular winging. Hip flexors to control "sagging" or excessive hip extension in a plank position. Knee extensors to control knee flexion, especially during transition from plank to quadruped. Cervical extensors to maintain neutral spine. Spinal flexors and deep lumbo-pelvic musculature to support the spinal column and to facilitate the hydraulic amplifier mechanism. INCLINE GUIDELINE: 8 to 1—Adjust incline lower for greater torso control and less upper body resistance. STARTING POSITION: Disconnect the arm pulley from the glideboard 330. Remove the telescoping squat stand. Facing away from the tower, kneel toward the bottom edge of the glideboard 330, hands on the floor in front of the exercise device base and aligned with the shoulders. Dorsiflex the feet, bringing the weight onto the balls of the feet. Ensure the pelvis and spine are neutral with the abdominals activated. EXERCISE DESCRIPTION: Inhale—To prepare. Exhale—To press the glideboard 330 up the incline entering into a plank position. Inhale—To stay. Exhale—To return the glideboard 330. REPETITIONS: 5-10 times. TEACHING TIPS: Watch for loss of stabilization in the scapular depressors. Push into and down with the heel of the hands. Perform this motion on the forearms. Change the incline level. Watch for hyperextension of the elbows. Maintain a soft bend in the elbows while reaching the fingertips long. Watch for compensatory shoulder movement. Keep the arms as still as possible. Visualize bringing the torso forward over the hands while pressing through the back legs. Watch for scapular winging. Wrap the scapulae around the back. Watch for excessive hip and shoulder flexion as noted by shifting of the pelvis posteriorly or piking the pelvis up toward the ceiling. Reach to crown of the head to the front of the room. Activate the buttocks and lower the pelvis toward the glideboard 330. PROGRESSIONS/VARIATIONS: to decrease wrist stress or strain, perform the motion on the forearms. To strengthen scapular protractions, performance of serratus "punches" in quadruped can help to strengthen the serratus anterior. To decrease stabilization, adjust the plank position. Have the participant press the glideboard 330 out as far as he or she can without letting the legs come off the glideboard 330. To strengthen the elbow extensors, perform a push-up in the plank position. SAFETY ASPECTS/CONTRAINDICATIONS: Spinal and sacroiliac vulnerabilities which are exacerbated by extension. Knee vulnerability, especially for those with medial and lateral instability. Knee vulnerability, especially for those who hyperextend. Shoulder vulnerability, especially for those with impingement, tendonitis or instability. Precautions limiting weightbearing through the upper extremity. Pathologies exacerbated by kneeling or increased knee flexion. Postural faults exacerbated by spinal extension.

Reverse Leg Pull Front

ACCESSORY: None. OBJECTIVES: Strengthen shoulder girdle stabilizers in a closed chain activity. Strengthen hip extensors. Teach dissociation between the lower extremities and torso. PRIME MOVERS: Entering into a plank position: Concentric spinal, hip, and knee extensors. To lift the leg: Concentric hip extensors. To lower leg: Eccentric hip extensors. To exit plank position: Eccentric knee extensors. PRIME STABILIZERS: Shoulder girdle stabilizers to limit shoulder elevation and maintain neutral scapular position. Spinal extensors to maintain spinal extension and counteract gravity. Trunk and hip flexors to limit excessive lumbar lordosis. Spinal rotators to limit pelvis shifting and tilting during hip extension. Deep lumbo-pelvic musculature to support the spinal column and to facilitate the hydraulic amplifier mechanism. INCLINE GUIDELINE: 1 to 5—Adjust incline higher for increased upper extremity weight bearing. STARTING POSITION: Disconnect the arm pulley from the glideboard 330. Remove the telescoping squat stand. Facing away from the tower, kneel toward the bottom edge of the glideboard 330, hands on the floor in front of the exercise device base and aligned with the shoulder. Dorsi-flex the feet bringing the weight onto the balls of the feet. Extend the legs to press the glideboard 330 up the rails, entering into a plank position. Ensure the pelvis and spine are neutral with the abdominals activated. EXERCISE DESCRIPTION: Inhale—To stay in the plank position. Exhale—To extend the right hip, keeping a soft point in the foot. Inhale—To flex the foot and lower the leg toward the glideboard 330. Repeat 3-5 times Repeat on the left side REPETITIONS: 1 set of 3-5 times per side. TEACHING TIPS: Watch for loss of activation in the hip extensors as noted by increased lumbar lordosis or dropping of the pelvis closer to the glideboard 330. Tighten the buttocks or tuck the pelvis under as if putting on a tight pair of pants. Push the buttocks up toward the ceiling. Watch for excessive hip and shoulder flexion as noted by shifting the torso backwards and piking the buttocks up toward the ceiling. Reach the crown of the head over the hands and lower the pelvis toward the glideboard 330. Watch for loss of abdominal connection, especially as the leg is extending. Keep the hips/pelvis parallel to the glideboard 330. On the side that is extending, press the hip toward the glideboard 330. Watch for hyperextension of the cervical spine. Nod, don't press, the chin toward the chest. Watch for loss of stabilization in the scapular depressors. Push into and down with the heel of the hands. Watch for scapular winging. Wrap the scapulae around the back. Watch for loss of thoracic imprint, "popping of the ribs." Slide the ribs together and down without compensating by flexing the trunk. Watch for loss of abdominal activation. Draw the navel in toward the spine and up toward the crown of the head. Watch for loss of neutral pelvis and increased lumbar lordosis. Gently tuck the pelvis while pulling the navel away from the glideboard 330. Watch for hyperextension of the knees. Maintain a soft bend in the knee while maintaining the front of the thigh "tight." Watch for hyperextension of the elbows. Maintain a soft bend in the elbows while reaching the fingertips long. PROGRESSIONS/VARIATIONS: To increase coordination, plantarflex both ankles as the hip extends and dorsiflex the ankles as the leg lowers. To decrease muscular endurance of the upper extremity in a closed chain activity, perform one hip extension then return the glideboard 330. As strength increases, the number of repetitions can be increased. To decrease shoulder stabilization, perform the movement on the forearms. SAFETY ASPECTS/CONTRAINDICATIONS: Shoulder vulnerability, especially for those with impingement, tendonitis or instability. Precautions limiting weightbearing through the upper extremity. Spinal and sacroiliac vulnerabilities which are exacerbated by extension. Wrist vulnerability, especially for those with carpal tunnel.

Hundred

ACCESSORY: Optional telescoping squat stand OBJECTIVES: Build pelvic and lumbar stability. Build coordination of breath and movement. Increase endurance of the scapular stabilizers. Increase muscular endurance of the spinal flexors. PRIME MOVERS: To initiate spinal flexion: Concentric spinal and shoulder flexors. To extend the legs diagonally: Concentric knee extensors and eccentric hip flexors. To lower the legs toward the floor: Eccentric hip flexors. To raise the legs to a diagonal position: Concentric hip flexors. To pump the arms up and down: Concentric and eccentric shoulder flexors. To lower the spine onto the glideboard 330: Eccentric spinal flexors. To bring the legs into tabletop from the diagonal position: Concentric hip flexors and eccentric knee extensors. PRIME STABILIZERS: Spinal flexors and hip extensors to limit excessive lordosis. Shoulder girdle stabilizers to control scapular movement. Knee extensors maintain knee extension. Hip adductors to hold the legs together. INCLINE GUIDELINE: 3 to 1—Adjust incline lower to increase abdominal intensity. 1 to 3—Adjust incline higher to decrease abdominal intensity or decrease cervical tension. Note that the Hundred can be performed at a higher incline with legs extended and supported on the Telescoping Squat Stand. STARTING POSITION: Disconnect the pulley from the glideboard 330. With the glideboard 330 closed, sit facing away from the tower with the buttocks toward the bottom edge of the glideboard 330, feet on the floor in front of the base of the exercise device 100. Lie back, ensuring the head is fully supported. Flex and adduct the legs, bringing the feet into the air (table top position). Maintain the arms by the sides of the body with the spine and pelvis in neutral. EXERCISE DESCRIPTION: Inhale—To lengthen through the back of neck. Exhale—To flex the upper body, sliding rib cage toward the pelvis. Simultaneously extend the legs diagonally and lift the arms about an inch off the glideboard 330. Inhale—Remain in flexion and lower the legs toward the floor without losing the spinal imprint. Simultaneously pulse the arms up and down a few inches, and repeating five times. Exhale—Continue to remain in flexion and lift the legs back to the diagonal position without losing spinal imprint.

Simultaneously pulse the arms up and down a few inches, repeating five times. Repeat for 9 more sets of inhale and exhale, making a total of 100 beats with the arms. Inhale—To stop pumping the arms and stay in flexion. Keep the legs in diagonal position. Exhale—To lower the spine onto the glideboard 330 while bending the knees and hips into tabletop position. REPETITIONS: 1 set of 100 pulses. TEACHING TIPS: Watch for loss of abdominal activation as the legs lower. Decrease the range of motion or eliminate lowering and lifting until strength improves. Watch for cervical stress or strain. Nod, don't press, the chin toward the chest. Place the tongue on the roof of the mouth. Use the Support Wedge Pillow. Initiate the movement with the sensation of sliding the ribs toward the pelvis prior to movement. Watch for loss of shoulder girdle stabilization leading to excessive cervical strain or stress. Drop the shoulders away from the ears, think wide through the collarbone, and maintain a slight bend in the elbow. Watch for excessive thoracic flexion. Maintain the tips of the scapulae on the glideboard 330. Watch for loss of adduction. Keep the inner thighs together and gluteal group tight. PROGRESSIONS/VARIATIONS: To decrease the coordination of breath and movement, inhale for three counts and exhale for five counts. To decrease the work of the spinal flexors, first maintain the legs in tabletop. To challenge torso strength and stability, slow down the count and have the participant slowly raise the arms up toward the ceiling for a count of five then lower down for a count of five. To further challenge the torso and increase hip adductor activation, place a small ball between the knees or ankles. SAFETY ASPECTS/CONTRAINDICATIONS: Spinal and sacroiliac vulnerabilities which are exacerbated by flexion. Cervical strain or vulnerability.

Essential Shoulder Bridge with Straight Leg Raise

ACCESSORY: None. OBJECTIVES: Challenge lateral pelvic stability. Teach dissociation of the pelvis and lower extremity. Lower extremity cross-coordination and dissociation. PRIME MOVERS: To lift the buttocks: Concentric hip and spinal flexors. To lift leg: Concentric hip flexors. To lower leg: Eccentric hip flexors. To lower buttocks: Eccentric hip extensors and lumbar flexors. PRIME STABILIZERS: Shoulder girdle stabilizers to limit shoulder elevation and prevent weight bearing on the cervical spine. Knee flexors and hip extensors, especially on the supporting limb, to maintain the bridge position. Knee extensors on the free limb to extend the knee. Deep lumbo-pelvic musculature to support the spinal column and to facilitate the hydraulic amplifier mechanism. INCLINE GUIDELINE: 4 to 1—Adjust incline lower to increase spinal and hip range of motion and increase resistance. STARTING POSITION: Disconnect the pulley from the glideboard 330. With the glideboard 330 closed, sit toward the bottom edge of the glideboard 330 with the feet on the floor in front of the base of the exercise device 100. Lie back, ensuring your head is fully supported. The legs remain flexed and hip distance apart, feet on the floor. Bring the hands to the sides of the body. Maintain neutral spine and pelvic alignment. EXERCISE DESCRIPTION: Inhale—To lengthen through the back of the neck. Exhale—To roll the pelvis and spine off the glideboard 330 initiating with a posterior pelvic tilt. Focus on articulating one vertebra at a time. Inhale—To flex the right hip into a tabletop position. Exhale—To point the right foot and extend the right leg to the ceiling. Inhale—To lower the right leg down toward the floor, even with the left knee. Exhale—To lift the right leg to the ceiling. Repeat lowering and lifting 3-5 times. Inhale—To stay, lengthening the leg toward the ceiling. Exhale—To flex the knee, lowering foot to the floor. Inhale—To stay in the bridge position. Exhale—To roll the spine onto the glideboard 330 beginning with the thoracic spine. Repeat on left side. REPETITIONS: 1 set of 3-5 straight leg raises per side. TEACHING TIPS: Watch for lateral tilting or shifting of the pelvis, especially during flexion and extension of the unsupported limb. The unsupported side will have a tendency to drop toward the floor. Keep the hips in the same plane or decrease the range of motion of the unsupported limb. Watch for excessive weight bearing onto the cervical spine. Maintain the weight of the body across the shoulder girdle. Lengthen the chin away from the chest. Watch for loss of thoracic imprint, "popping of the ribs." Slide the ribs together and down. "Knit" the ribs together. Watch for lateral tilting or shifting in the pelvis. Decrease the lever by bending the knee. Tighten the abdominals, especially the obliques. Limit the hip range of motion. Watch for flexion of the knees. Maintain contraction in the quadriceps. Lengthen the leg or reach the leg long. Watch for dropping versus rolling the spine onto the glideboard 330. Place each vertebra on the glideboard 330 one at a time. Visualize the spine as a string of pearls lowering one bead at a time onto the glideboard 330. PROGRESSIONS/VARIATIONS: To challenge stability with greater dynamic movement, press the glideboard 330 up the incline when lifting/lowering the unsupported leg. To decrease coordination and lateral stabilization, keep the unsupported knee aligned with the supporting knee and lift and lower the buttocks. To further challenge stability, reach arms toward the ceiling. To challenge coordination, flex the foot as the leg lowers and point the foot as the leg lifts. To add coordination, raise the arms overhead as the unsupported leg lowers, and extend the arms toward the ceiling as the leg lifts. To decrease coordination and lateral stabilization, but to strengthen the hip flexors, perform hip flexion (straight leg raise) without bridging. SAFETY ASPECTS/CONTRAINDICATIONS: Spinal and sacroiliac vulnerabilities, especially those which are exacerbated with extension. Hip vulnerability, especially with hip flexion.

Rolling Like a Ball

ACCESSORY: None. OBJECTIVES: Improve or maintain spinal articulation. Challenge core stability. PRIME MOVERS: To roll back: Gravity. To roll up: Concentric spinal flexors. PRIME STABILIZERS: Shoulder girdle to limit shoulder elevation and protraction. Hip and knee flexors to maintain the legs in flexion. Spinal flexors to maintain the "C" curve position and to limit rolling onto cervical spine. Deep lumbo-pelvic musculature to support the spinal column and to facilitate the hydraulic amplifier mechanism. Spinal extensors to control the end range when rolling forward. INCLINE GUIDELINE: 3 to 1—Decrease incline for torso focus. STARTING POSITION: Disconnect the pulley from the glideboard 330. With the glideboard 330 closed, sit toward the bottom edge of the glideboard 330 with the feet on the floor in front of the base of the exercise device 100. Posteriorly tilt the pelvis and slightly flex the spine forming a "C" shape. Balancing on the ischial tuberosities, adduct the legs and plantar flex the feet to lift the toes off the ground. EXERCISE DESCRIPTION: Inhale—To roll back off the sit bones onto the glideboard 330 while maintaining the body in "C" curve. Only roll back to the shoulder blades and not onto the cervical spine. Exhale—To roll up into the start position. REPETITIONS: 5-10 times. TEACHING TIPS: Watch for popping of the ribs or extending the thoracic spine when rolling up or down. Remain in a "C" curve. Watch for proper articulation of the spine.

Touch each vertebra to the glideboard 330 (except for the cervical spine) when rolling up or down. Watch for extension of the knee. Keep the flexion in the knee constant. Watch for increased distance between the ankles and ischial tuberosity. Keep the distance between the ankles and ischial tuberosity constant. Watch for excessive shoulder elevation. Lengthen the shoulders away from the ears. Slide, don't press, the shoulder blades (scapulae) down the back. Watch for excessive weight bearing onto the cervical spine. Maintain the weight of the body across the shoulder girdle. Watch for cervical hyperflexion. Gaze up and over the knees. Hold an imaginary ball between the chin and the chest. PROGRESSIONS/VARIATIONS: To intensify, hold on to the ankles. To decrease intensity, have the feet further away from the buttocks. To assist with keeping the knees together or close to the buttocks, balance a small ball between the ankles or between the buttocks and heels. SAFETY ASPECTS/CONTRAINDICATIONS: Spinal and sacroiliac vulnerabilities which are exacerbated by flexion. Cervical strain or vulnerability. Hip vulnerability, especially for those with hip precautions limiting flexion, adductor or external rotation. Postural faults exacerbated by spinal flexion.

Intermediate Side-Lying Leg Lifts Series

ACCESSORY: None. OBJECTIVES: Develop core control and lateral trunk stability during lower extremity movement. Strengthen hip abductors. Develop shoulder girdle stabilizers in a closed chain activity. PRIME MOVERS: Hip Abduction: To abduct the leg: Concentric hip abductors. To lower the leg: Eccentric hip abductors. Hip Adduction: To adduct the leg: Concentric hip adductors. To lower the leg: Eccentric hip adductors. Lateral Flexion: To lift both legs: Concentric lateral spinal flexors. To lower both legs: Eccentric lateral spinal flexors. PRIME STABILIZERS: Throughout all movements. Scapular stabilizers prevent shoulder elevation or protraction. Trunk lateral flexors (on the supported side) prevent sinking of the torso. Hip lateral and medial rotators to maintain parallel alignment. During hip adduction, the top leg's hip abductors work to maintain the leg in space. During lateral flexion, the hip abductors and adductors, to assist in lifting legs and maintaining legs together. Deep lumbo-pelvic musculature to support the spinal column and to facilitate the hydraulic amplifier mechanism. INCLINE GUIDELINE: 1 to 3—Adjust incline higher to decrease lateral flexor resistance. STARTING POSITION: Stand to the side of the exercise device 100 facing away from the rails. Sit toward the middle to bottom of the glideboard 330 facing sideways. Lie sideways on the glideboard 330 with the head toward the tower. Maintaining the legs in parallel alignment and extended, bring the legs slightly in front of the body. Bend the bottom elbow to prop the body up. The top arm rests on the glideboard 330 in front of the torso. Maintain neutral spine and pelvic alignment. To assist with neutral pelvis, it may be necessary to maintain the bottom leg slightly adducted or bent. ABDUCTION EXERCISE DESCRIPTION: Inhale—To lengthen out of the hip. Exhale—To lift the top leg. Only go as high as one can without losing pelvic stability or rotating the leg. Inhale—To lower the leg. Repeat 8-10 times. Inhale—To cross the top leg in front with the knee bent and the foot resting on the floor. Hip Abduction: Exhale—To lift the bottom leg up, keep the legs parallel. Inhale—To lower the bottom leg. Repeat lifting and lowering of the bottom leg On the last repetition . . . Exhale—To uncross the top leg and bring it parallel to the floor. Inhale—To lower the top leg. Repeat 8-10 times. LATERAL FLEXION EXERCISE DESCRIPTION: Inhale—To strongly adduct the inner thighs. Exhale—To lift both legs up together without losing stability in the pelvis. Inhale—To lower both legs together. Repeat 8-10 times. Change sides REPETITIONS: 5-10 times per side. TEACHING TIPS: Watch for scapular stabilization. Slide the scapulae down the back, lifting the torso off the glideboard 330. Watch for sinking into the shoulder girdle. Press up and out through the elbow. Lift the torso up and over the stabilizing forearm, particularly the elbow. Ensure that stabilization in the thoracic region is present. Watch for loss of thoracic stabilization. Feel a lifted sensation in the torso. The bottom aspect of the torso should not rest on the glideboard 330, rather the torso should be pulling gently away from the glideboard 330. Watch for excessive lateral flexion as the leg abducts or adducts. Lengthen the leg away from the hip and to visualize maintaining a toothpick between the bottom rib and pelvis. Watch for loss of pelvic alignment. The tendency is for the pelvis to rotate backward toward the ceiling. Stack the hips directly over one another, and gently press the top hip forward. Increase activation of the spinal flexors and hip extensors. Place one hand on the pelvis for feedback. PROGRESSIONS/VARIATIONS: To decrease core stabilization, place the top hand on the glideboard 330 for support. To increase coordination, have the top arm mimic the top leg. The top arm will be resting along the thigh, and as the top leg lifts, the top arms lifts toward the ceiling. SAFETY ASPECTS/CONTRAINDICATIONS: Spinal vulnerability, especially when spinal lateral trunk flexor and rotator weakness is present. Knee vulnerability, especially for those with medial and lateral instability. Hip vulnerability, especially for those with bursitis. Hip vulnerability, especially for those with hip precautions limiting flexion, adductor or external rotation. Shoulder vulnerability, especially for those with impingement, tendonitis or instability.

Cat and Camel

ACCESSORY: None. OBJECTIVES: Stretch the spinal extensors. Facilitate spinal articulation. Facilitate lateral thoracic breathing. Enhance kinesthetic awareness of spinal mobility. PRIME MOVERS: To flex the spine: Concentric spinal and hip flexors. To extend the spine: Eccentric spinal and hip flexors and gravity. INCLINE GUIDELINE: 1 to 3. STARTING POSITION: Disconnect the arm pulley from the glideboard 330. Remove the telescoping squat stand. Facing the tower, kneel on the glideboard 330. Align the hips with the knees and the hands with the shoulders. Maintain the spine and pelvis in a neutral position. EXERCISE DESCRIPTION: Inhale—To prepare. Exhale—To flex the lumbar, thoracic, and cervical spine. Inhale—To stay. Exhale—To extend the lumbar, thoracic and cervical spine. Perform 1-3 repetitions initiating with the lumbar spine, then perform 1-3 repetitions initiating with the cervical spine. REPETITIONS: 3-6 times. TEACHING TIPS: Watch for shifting of the weight posteriorly. Maintain equal weight bearing through the hands. Watch for premature cervical flexion and extension when initiating flexion and extension with the lumbar spine. Watch for premature lumbar flexion and extension when initiating flexion and extension with the cervical spine. PROGRESSIONS/VARIATIONS: To stretch the lateral aspect of the spine and the rotators, reach one hand across the chest and rotate the spine accordingly. To facilitate greater spinal flexion and extension, flex knee into the chest during spinal flexion and extend the leg during spinal extension. To facilitate a greater stretch, cue to drop tailbone and crown of head. To facilitate posterior lateral breathing, cue to breathe through posterior lateral aspect of the rib cage. SAFETY ASPECTS/CONTRAINDICA- TIONS: Spinal and sacroiliac vulnerabilities which are exacerbated by flexion. Spinal and sacroiliac vulnerabilities which are exacerbated by extension. Wrist vulnerability, especially for those with carpel tunnel. Precaustions limiting weightbearing through the upper extremity. Pathologies exacerbated by kneeling or increased knee flexion.

Open and Close

ACCESSORY: None. OBJECTIVES: Build pelvic and lumbar stability during lower extremity movement. To stretch and strengthen hip adductors. Increase muscular endurance of the spinal flexors. PRIME MOVERS: To open the legs: Eccentric hip adductors. To extend the knee: Concentric knee extension. To close the legs: Concentric hip adductors. To bend the knees: Eccentric knee extensors. PRIME STABILIZERS: Hip flexors to maintain the legs in tabletop position. Spinal flexors and hip extensors to limit excessive lumbar lordosis. Knee extensors to maintain the knees at 90° of knee flexion. Hip internal rotators to promote parallel alignment and limit external rotation. Deep lumbo-pelvic musculature to support the spinal column and to facilitate the hydraulic amplifier mechanism. INCLINE GUIDELINE: 4 to 1—Adjust incline lower for greater extremity and torso focus. STARTING POSITION: Disconnect the pulley from the glideboard 330. With the glideboard 330 closed, sit facing away from the tower with the buttocks toward the bottom edge of the glideboard 330, feet on the floor in front of the base of the exercise device 100. Lie back, ensuring the head is fully supported. Flex and adduct the legs, bringing the feet into the air (table top position). Maintain the arms by the sides of the body with the spine and pelvis in neutral. EXERCISE DESCRIPTION: Inhale—To open the legs to the side (hip abduction) while keeping the knees bent. Exhale—To extend the legs. Inhale—To close the legs. Exhale—To bend the knees, returning the legs to tabletop. REPETITIONS: 5-10 times. TEACHING TIPS: Watch for increased lumbar lordosis. Imprint the spine onto the glideboard 330. Use the Support Wedge Pillow under the head and shoulder girdle. Place the hands behind the head and perform an abdominal curl. Watch for loss of abdominal activation. Draw the navel in toward the spine and up toward the crown of the head. Watch for cervical stress or strain. Nod, don't press, the chin toward the chest. Place the tongue on the roof of the mouth. Use the Support Wedge Pillow. Watch for loss of thoracic imprint, "popping of the ribs." Slide the ribs together and down without compensating by flexing the trunk. "Knit" the ribs together. Use the Support Wedge Pillow. Perform an abdominal curl. Watch for proper femoral alignment. If the leg is internally rotating, turn the inner thigh up toward the ceiling. If the leg is externally rotating, turn the inner thigh down toward the floor. PROGRESSIONS/VARIATIONS: To further challenge stability, reach the hands for the ceiling. Open arms to the side, mirror imaging the legs. Use weights to increase shoulder horizontal adductors. To further increase abdominal strength and endurance, maintain an abdominal curl. To decrease spinal flexor muscular endurance, use the Double Leg Pulley. SAFETY ASPECTS/CONTRAINDICATIONS: Spinal and sacroiliac vulnerabilities which are exacerbated by flexion. Hip vulnerability, especially for those with hip precautions limiting flexion, adductor or external rotation.

Intermediate Shoulder Bridge with Straight Leg Raise

ACCESSORY: None. OBJECTIVES: Challenge lateral pelvic stability. Teach dissociation of the pelvis and lower extremity. Lower extremity cross coordination and dissociation. PRIME MOVERS: To lift the buttocks: Concentric hip extensors and spinal flexors. To lift leg: Concentric hip flexors. To push the glideboard 330 up the incline: Concentric hip and knee extensors. To return the glideboard 330: Eccentric hip and knee extensors. To lower leg: Eccentric hip flexors. To lower buttocks: Eccentric hip extensors and lumbar flexors. PRIME STABILIZERS: Shoulder girdle stabilizers to limit shoulder elevation and prevent riding up cervical spine. Knee flexors and hip extensors, especially on the supporting limb, to maintain the bridge position. Knee extensors on the supporting limb to extend the knee. Deep lumbo-pelvic musculature to support the spinal column and to facilitate the hydraulic amplifier mechanism. INCLINE GUIDELINE: 4 to 1—Adjust incline lower to increase spinal and hip range of motion and increase resistance. STARTING POSITION: Disconnect the pulley from the glideboard 330. With the glideboard 330 closed, sit toward the bottom edge of the glideboard 330, feet on the floor in front of the base of the exercise device 100. Lie back, ensuring your head is fully supported. The legs remain flexed and hip distance apart with the feet on the floor. Bring the hands to the sides of the body. Maintain neutral spine and pelvic alignment. EXERCISE DESCRIPTION: Inhale—To lengthen through the back of the neck. Exhale—To roll the pelvis and spine off the glideboard 330 initiating with a posterior pelvic tilt. Focus on articulating one vertebra at a time. Inhale—To stay. Exhale—To flex the right hip and extend the leg to the front wall. Inhale—To maintain the leg reaching for the front wall while pushing the glideboard 330 up the incline. Exhale—To return the glideboard 330 maintaining the leg reaching for the front wall. Repeat pressing the glideboard 330 up the incline 3-5 times. Inhale—To flex the knee, lowering foot to the floor. Exhale—To roll the spine onto the glideboard 330 beginning with the thoracic spine. Repeat on left side. REPETITIONS: 1 set of 3-5 straight leg raises per side TEACHING TIPS: Watch for excessive weight bearing onto the cervical spine. Maintain the weight of the body across the shoulder girdle. Lengthen the chin away from the chest. Watch for loss of thoracic imprint, "popping of the ribs." Slide the ribs together and down without compensating by flexing the trunk. "Knit" the ribs together. Watch for lateral tilting or shifting in the pelvis. Decrease the lever by bending the knee. Tighten the abdominals, especially the obliques. Limit the hip range of motion. Watch for flexion of the knees. Maintain contraction in the quadriceps. Lengthen the leg or reach the leg long. Watch for dropping versus rolling the spine onto the glideboard 330. Place each vertebra on the glideboard 330 one at a time. Visualize the spine as a string of pearls lowering one bead at a time onto the glideboard 330. Watch for hyperextension of the knees. Maintain a soft bend in the knees. Use the Deluxe Slide Distance Regulator to control the range of motion. PROGRESSIONS/VARIATIONS: To decrease coordination and lateral stabilization, keep the unsupported knee in line with the supporting knee and press the glideboard 330 up and down. To further challenge stability, reach the arms toward the ceiling. To challenge coordination, flex the foot as the leg lowers and point the foot as the leg extends. To add coordination, raise the arms overhead as the unsupported leg lowers/extends and extend the arms toward the ceiling as the leg flexes. To increase hip adductor strength, maintain the leg in external rotation. SAFETY ASPECTS/CONTRAINDICATIONS: Spinal and sacroiliac vulnerabilities which are exacerbated by flexion and rotation. Spinal and sacroiliac vulnerabilities which are exacerbated by extension and rotation. Knee vulnerability, especially for those with medial and lateral instability. Hip vulnerability, especially for those with hip precautions limiting flexion, adductor or external rotation.

Teaser Prep 1 with Arm Pulley

ACCESSORY: Arm Pulleys; Optional Support Wedge Pillow; Optional Slide Distance Regulator. OBJECTIVES: Strengthen spinal and hip flexors. Increase spinal articulation. Develop shoulder girdle stabilization. Prepare for full teaser. PRIME MOVERS: To flex the spine: Concentric spinal and hip flexors. To circle the arms forward: Initially concentric shoulder adductors and extensors, followed by concentric shoulder flexors. To lower the arms: Initially eccentric shoulder flexors, followed by eccentric shoulder adductors and extensors. To roll back: Eccentric spinal and hip flexors. PRIME STABILIZERS: Hip extensors to assist in posteriorly rotating the pelvis. Shoulder girdle to limit shoulder elevation and promote scapular control. Deep lumbo-pelvic musculature to support the spinal column and to facilitate the hydraulic amplifier mechanism. INCLINE GUIDELINE: 1 to 5—Adjust incline higher to intensify torso focus. PIN PLACEMENT: Inner Middle. STARTING POSITION: Attach the arm pulley. Grasp the handles and pull the glideboard 330 halfway up the rails. Straddle the glideboard 330 and sit at the bottom edge, facing away from the tower. Lie back, ensuring the head is fully supported. Place both feet on the bottom edge of the glideboard 330. Reach the arms overhead toward the tower, ensuring the spine and pelvis remain in neutral. EXERCISE DESCRIPTION: Inhale—To circle the arms out to the side and around in an arc, while rolling the cervical and upper thoracic spine off the glideboard 330. Exhale—To continue scooping the arms around to the side while simultaneously flexing the spine. End in a seated position with the pelvis posteriorly rotated and the lumbar spine flexed. The thoracic and cervical spine remain extended. Inhale—To initiate rolling back, leading with the pelvis then lumbar spine. The arms gradually circle out and around. Exhale—To continue rolling the spine onto the glideboard 330 while bringing the arms overhead to the start position. REPETITIONS: 5-8 times. TEACHING TIPS: Watch for overuse of the hip flexors as noted by the knees pulling into the chest. Limit spinal flexion until greater strength is achieved or allow for slight hip and knee extension as the spine flexes. Limit the range of motion until greater strength is achieved. Watch for cervical hyperflexion. Gaze up and over the knees. Hold an imaginary ball between the chin and chest. Watch for loss of shoulder girdle stabilization leading to excessive cervical strain or stress. Drop the shoulders away from the ears, think wide through the collarbone, and maintain a slight bend in the elbow. Watch for loss of hip adduction. Place a ball or towel between the knees. Maintain energy between the inner thighs. Watch for lifting the pelvis off the glideboard 330. "Peel" the spine off the glideboard 330 one vertebra at a time. Watch to ensure the participants remain posterior to the ischial tuberosities and slightly flexed in the lumbar spine. Maintain a slight "C" shape with the torso. PROGRESSIONS/VARIATIONS: To target more lateral stabilization, extend one leg while the other stays supported on the glideboard 330 or bent in tabletop position. To challenge abdominal muscular endurance and upper extremity strength, stay in the seated position and scoop the arms forward and back. SAFETY/CONTRAINDICATIONS: Cervical strain or vulnerability. Spinal and sacroiliac vulnerabilities which exacerbated by flexion. Postural faults exacerbated by spinal flexion. Hip vulnerability, especially for those with hip precautions limiting flexion, adductor or external rotation.

Teaser Prep 2 with Arm Pulley

ACCESSORY: Arm Pulleys; Optional Support Wedge Pillow; Optional Slide Distance Regulator. OBJECTIVES: Improve or maintain spinal articulation. Challenge core stability and strength. Improve shoulder girdle stabilization. Prepare for full teaser. PRIME MOVERS: To flex the spine: Concentric spinal and hip flexors. To scoop the arms: Concentric shoulder extensors and adductors. To extend the legs: Concentric knee extensors. To roll back: Eccentric spinal and hip flexors. To circle the arms overhead: Eccentric shoulder extensors and adductors. To return the legs to tabletop: Eccentric knee extensors. PRIME STABILIZERS: Hip extensors to assist in posterior pelvic tilt and limit excessive hip flexion. Scapular stabilizers to limit shoulder elevation, protraction and cervical tension. Knee extensors to maintain knee extension as the spine rolls back. Deep lumbo-pelvic musculature to support the spinal column and to facilitate the hydraulic amplifier mechanism. INCLINE GUIDELINE: 5 to 1—Decrease incline for less extremity focus. STARTING POSITION: Attach the arm pulley. Grasp the handles and pull the glideboard 330 halfway up the rails. Straddle the glideboard 330 and sit at the bottom edge, facing away from the tower. Lie back, ensuring the head is fully supported. Place both feet on the glideboard 330 then into a table top position (hips and knees bent 90°). Reach the arms overhead toward the tower, ensuring the spine and pelvis remain in neutral. EXERCISE DESCRIPTION: Inhale—To prepare. Exhale—To circle the arms out to the side and around while rolling the spine off the glideboard 330. In the end position, the upper thoracic and cervical spine are extended and the lower thoracic and lumbar spine are flexed. The pelvis will be posteriorly rotated. The legs remain in the tabletop position. Inhale—To begin rolling the pelvis and spine onto the glideboard 330 while keeping the legs in tabletop position. Exhale—To continue rolling the spine onto the glideboard 330 while circling the arms out to the side and overhead and flexing the hips and knees to tabletop position. REPETITIONS: 5-8 times. TEACHING TIPS: Watch for hyperextension of the cervical spine. Nod, don't press, the chin toward the chest. Watch for cervical hyperflexion or strain. Initiate the movement with the sensation of sliding the ribs toward the pelvis prior to movement. Watch for excessive shoulder elevation. Lengthen the shoulders away from the ears. Slide, don't press, the shoulder blades (scapulae) down the back. Watch for loss of thoracic imprint, "popping of the ribs." Slide the ribs together and down. "Knit" the ribs together. Watch for loss of abdominal activation. Draw the navel in toward the spine and up toward the crown of the head. Watch for overuse of the hip flexors during the roll up as noted by the knees pulling in toward the chest. Limit the range of motion until greater strength is achieved. Watch for loss of hip adduction. Place a ball or towel between the knees. Maintain energy between the inner thighs. Press into the first and second toe. Watch for the use of momentum. Count to three or four with each phase of the movement. Watch to ensure the participants remain posterior to the ischial tuberosities and slightly flexed in the lumbar spine. Maintain a slight "C" shape with the torso. PROGRESSIONS/VARIATIONS: To intensify, balance a ball between the knees and ankles. To decrease abdominal emphasis during the roll back, place the legs onto the glideboard 330. SAFETY ASPECTS/CONTRAINDICATIONS: Spinal and sacroiliac vulnerabilities which are exacerbated by flexion. Cervical strain or vulnerability. Hip vulnerability, especially for those with hip precautions limiting flexion, adductor or external rotation.

Double Leg Pulley: Windmills

ACCESSORY: Double leg pulley with foot harnesses; Optional Slide Distance Regulator; Optional Cable Extensions. OBJECTIVES: Increase spinal flexor muscular endurance. Teach dissociation of the extremities and torso. Increase coordination. PRIME MOVERS: To flex the trunk: Concentric cervical and trunk flexors. To lower the leg toward the floor: Concentric hip extensor. To open and circle the leg out to the side: Concentric lateral rotators and hip abductors followed by eccentric hip adductors. To complete the circle returning the leg to the start position: Concentric hip internal rotators and adductors. To lower trunk onto glideboard 330: Eccentric spinal flexors. PRIME STABILIZERS: Shoulder girdle stabilizers to limit shoulder elevation and assist in scapular control. Spinal flexors to maintain spinal flexion during extremity movement. Spinal flexors and hip extensors to assist in maintaining an imprinted spine and pelvic positioning. Hip extensors to limit excessive hip flexion of the stationary leg. Deep lumbo-pelvic musculature to support the spinal column and to facilitate the hydraulic amplifier mechanism; INCLINE GUIDELINE: 1 to 2—Adjust incline higher to increase extremity focus. STARTING POSITION: Disconnect the arm pulley. The telescoping squat stand may be on or off. Holding the foot loops in one hand straddle the glideboard 330 facing away from the tower. Sit with the buttocks near the bottom edge of the glideboard 330. Place the feet on floor in front of the body. Lie back, ensuring the head is fully supported. Separate the foot loops into each hand. Press the glideboard 330 halfway up the rails and bring one knee into the chest to place the foot into the loop. Extend this leg toward the ceiling while bringing the other knee into the chest to place the foot in the loop. Extend and adduct the legs toward the ceiling. Maintain the feet softly pointed. The legs are parallel to begin. Bend the elbows and place the hands to behind the head. Ensure the pelvis and spine are neutral. EXERCISE DESCRIPTION: Inhale—To lengthen through the back of the neck. Exhale—To flex the upper body, sliding the rib cage toward the pelvis. Do not let the tips of the scapulae come off the glideboard 330. Inhale—Lower one leg toward the floor. Exhale—To circle the leg out to the side and then around, bringing the legs together. Switch sides. Repeat 5-8 times per side. To End . . . Inhale—To stay with the legs remaining together. Exhale—To lengthen the spine onto the glideboard 330. REPETITIONS: 1 set of 5-8 extremity movements TEACHING TIPS: Watch for stress or strain to the lumbar spine. Decrease the range of motion. Watch for shifting or tilting of the pelvis, especially as the legs separate. Limit the range of motion and encourage greater activation of the torso rotators. Watch for lateral trunk flexion as the legs separate. Maintain length between the rib and hip. On the side that is opening, cue to bring the pelvis toward the ribcage. Watch for cervical stress or strain. Nod, don't press, the chin toward the chest. Place the tongue on the roof of the mouth. Use the Support Wedge Pillow. Watch for loss of thoracic imprint, "popping of the ribs." Slide the ribs together and down without compensating by flexing the trunk. "Knit" the ribs together. Use the Support Wedge Pillow. Participants with longer limbs will require greater torso stabilization due to the increased lever lengths. PROGRESSIONS/VARIATIONS: To decrease spinal flexor muscular endurance, perform the same movement with the spine resting on the glideboard 330. To challenge spinal flexor muscular endurance, perform the same movement without foot loops. To increase range of motion, add cable extension. SAFETY ASPECTS/CONTRAINDICATIONS: Spinal and sacroiliac vulnerabilities which are exacerbated by flexion and rotation. Knee vulnerability, especially those with medial and lateral instability. Knee vulnerability, especially those who hyperextend. Hip vulnerability, especially for those with hip precautions limiting flexion, adductor or external rotation.

Double Leg Pulley: Footwork: Parallel

ACCESSORY: Double leg pulley with foot harnesses; Optional Slide Distance Regulator; Optional Cable Extensions. OBJECTIVES: Increase spinal flexor muscular endurance. Teach dissociation of the extremities and torso. Increase coordination. PRIME MOVERS: To flex the trunk: Concentric cervical and trunk flexors. To extend the legs to a diagonal: Concentric knee and hip extensors. To flex the legs to tabletop: Concentric hip flexors and eccentric knee extensors. To lower trunk onto glideboard 330: Eccentric spinal flexors. PRIME STABILIZERS: Shoulder girdle stabilizers to limit shoulder elevation and assist in scapular control. Spinal flexors to maintain spinal flexion during extremity movement. Spinal flexors and hip extensors to assist in maintaining an imprinted spine and pelvic positioning. Hip extensors to limit excessive hip flexion. Deep lumbo-pelvic musculature to support the spinal column and to facilitate the hydraulic amplifier mechanism. INCLINE GUIDELINE: 1 to 2—Adjust incline higher to increase extremity focus. STARTING POSITION: Disconnect the arm pulley. The telescoping squat stand may be on or off. Holding the foot loops in one hand straddle the glideboard 330 facing away from the tower. Sit with the buttocks near the bottom edge of the glideboard 330. Place the feet on floor in front of the body. Lie back, ensuring the head is fully supported. Separate the foot loops into each hand. Press the glideboard 330 halfway up the rails and bring one knee into the chest to place the foot into the loop. Extend this leg toward the ceiling while bringing the other knee into the chest to place the foot in the loop. Extend and adduct the legs toward the ceiling while maintaining parallel alignment. Bend both knees to 90° (table top position). Maintain the feet softly pointed. Bend the elbows and place the hands to behind the head. Ensure the pelvis and spine are neutral. EXERCISE DESCRIPTION: Inhale—To lengthen through the back of the neck. Exhale—To flex the upper body, sliding rib cage toward the pelvis. Do not let the tips of the scapulae come off the glideboard 330. Stay in flexion. Inhale—To extend the legs to a diagonal. Exhale—To bend the legs into tabletop position; Repeat 5-10 times per side. To Finish . . . Inhale—To maintain the legs in tabletop. Exhale—To lengthen the spine onto the glideboard 330. REPETITIONS: 1 set of 5-8 extremity movements. TEACHING TIPS: Watch for stress or strain to the lumbar spine. Decrease the range of motion. Watch for shifting or tilting of the pelvis. Limit the range of motion and encourage greater activation of the torso rotators. Watch for loss of thoracic imprint, "popping of the ribs." Slide the ribs together and down without compensating by flexing the trunk. "Knit" the ribs together. Use the Support Wedge Pillow. Participants with longer limbs will require greater torso stabilization due to the increased lever lengths. PROGRESSIONS/VARIATIONS: To decrease spinal flexor muscular endurance, perform the same movement with the spine resting on the glideboard 330. To challenge spinal flexor muscular endurance, perform the same movement without Double Leg Pulley. To increase range of motion, add cable extension. SAFETY ASPECTS/CONTRAINDICATIONS: Spinal and sacroiliac vulnerabilities which are exacerbated by flexion and rotation. Knee vulnerability, especially for those with medial and lateral instability. Knee vulnerability, especially for those who hyperextend. Hip vulnerability, especially for those with hip precautions limiting flexion, adductor or external rotation.

Double Leg Pulley: Footwork: V

ACCESSORY: Double leg pulley with foot harnesses; Optional Slide Distance Regulator; Optional Cable Extensions. OBJECTIVES: Increase spinal flexor muscular endurance. Teach dissociation of the extremities and torso. Increase coordination and core control. PRIME MOVERS: To flex the trunk: Concentric cervical and trunk flexors. To extend the legs to a diagonal: Concentric knee extensors and eccentric hip extensors. To flex the legs to tabletop: Concentric hip flexors and eccentric knee extensors followed by eccentric hip extensors and knee flexors. To lower trunk onto glideboard 330: Eccentric spinal flexors. PRIME STABILIZERS: Shoulder girdle stabilizers to limit shoulder elevation and assist in scapular control. Spinal flexors to maintain spinal flexion during extremity movement. Spinal flexors and hip extensors to assist in maintaining an imprinted spine and pelvic positioning. Hip extensors to limit excessive hip flexion. Deep lumbo-pelvic musculature to support the spinal column and to facilitate the hydraulic amplifier mechanism. INCLINE GUIDELINE: 1 to 2—Adjust incline higher to increase extremity focus. STARTING POSITION: Disconnect the arm pulley. The telescoping squat stand may be on or off. Holding the foot loops in one hand straddle the glideboard 330 facing away from the tower. Sit with the buttocks near the bottom edge of the glideboard 330. Place the feet on floor in front of the body. Lie back, ensuring the head is fully supported. Separate the foot loops into each hand. Press the glideboard 330 halfway up the rails and bring one knee into the chest to place the foot into the loop. Extend this leg toward the ceiling while bringing the other knee into the chest to place the foot in the loop. Extend and adduct the legs toward the ceiling. Externally rotate the legs, maintaining the heels together. Bend both knees to 90° while maintaining the heels together and the feet softly pointed. Bend the elbows and place the hands to behind the head. Ensure the pelvis and spine are neutral. EXERCISE DESCRIPTION: Inhale—To lengthen through the back of the neck. Exhale—To flex the upper body, sliding rib cage toward the pelvis. Do not let the tips of the scapulae come off the glideboard 330. Stay in flexion. Inhale—To extend the legs to a diagonal, allowing the inner thighs to connect. Keep the heels together and the legs externally rotated. Exhale—To bend the knees and hips while keeping the heels together and allowing the knees to separate. Repeat 5-10 times per side. To finish . . . Inhale—To maintain the legs flexed and in turn out. Exhale—To lengthen the spine onto the glideboard 330. REPETITIONS: 1 set of 5-8 extremity movements. TEACHING TIPS: Watch for stress or strain to the lumbar spine. Decrease the range of motion. Watch for shifting or tilting of the pelvis. Limit the range of motion and encourage greater activation of the spinal rotators. Watch for lateral deviation of the legs to one side. Deviation may be occurring because of unequal weight bearing in the pelvis lateral trunk flexion. Maintain equal weight in the pelvis and equal length from the rib to pelvis. Lengthen the side in which the torso is shortening. Watch for increased abduction of the legs. Keep the knee in line with the second and third toe. Keep active in the inner thighs, resisting the tendency to let the legs drop open. Watch for loss of thoracic imprint, "popping of the ribs." Slide the ribs together and down without compensating by flexing the trunk. "Knit" the ribs together. Use the Support Wedge Pillow. Watch for lateral deviation of the legs to one side. Keep the legs in the midline of the body. Maintain equal weight through both sides of the pelvis. Ensure that compensatory trunk lateral flexion is not occurring. Watch for hyperextension of the knees. Maintain a soft bend in the knee while maintaining the front of the thigh "tight." PROGRESSIONS/VARIATIONS: To decrease spinal flexor muscular endurance, perform the same movement without spinal flexion and the arms by the side or on the pelvis for feedback. To challenge spinal flexor muscular endurance, perform the same movement in spinal flexion with the arms to the side and hovering the glideboard 330. To challenge spinal flexor muscular endurance, perform the same movement without Double Leg Pulley. To increase range of motion, add cable extension. SAFETY ASPECTS/CONTRAINDICATIONS: Spinal and sacroiliac vulnerabilities which are exacerbated by flexion and rotation. Knee vulnerability, especially for those with medial and lateral instability. Knee vulnerability, especially for those who hyperextend. Hip vulnerability, especially for those with hip precautions limiting flexion, adductor or external rotation.

Double Leg Pulley: Footwork: Hip Distance

ACCESSORY: Double leg pulley with foot harnesses Optional Slide Distance Regulator Optional Cable Extensions OBJECTIVES: Increase spinal flexor muscular endurance. Teach dissociation of the extremities and torso. Increase coordination and core control. PRIME MOVERS: To flex the trunk: Concentric cervical and trunk flexors. To extend the legs to a diagonal: Concentric knee extensors and hip extensors. To flex the legs to tabletop: Concentric hip flexors and eccentric knee extensors followed by eccentric extensors and knee flexors. To lower trunk onto glideboard 330: Eccentric spinal flexors. PRIME STABILIZERS: Shoulder girdle stabilizers to limit shoulder elevation and assist in scapular control. Spinal flexors to maintain spinal flexion during extremity movement. Spinal flexors and hip extensors to assist in maintaining an imprinted spine and pelvic positioning. Hip extensors to limit excessive hip flexion. Ankle dorsiflexors to maintain the feet flexed. Deep lumbo-pelvic musculature to support the spinal column and to facilitate the hydraulic amplifier mechanism. INCLINE GUIDELINE: 1 to 2—Adjust incline higher to increase extremity focus. STARTING POSITION: Disconnect the arm pulley. The telescoping squat stand may be on or off. Holding the foot loops in one hand straddle the glideboard 330 facing away from the tower. Sit with the buttocks near the bottom edge of the glideboard 330. Place the feet on floor in front of the body. Lie back, ensuring the head is fully supported. Separate the foot loops into each hand. Press the glideboard 330 halfway up the rails and bring one knee into the chest to place the foot into the loop. Extend this leg toward the ceiling while bringing the other knee into the chest to place the foot in the loop. Extend and abduct the legs hip distance apart toward the ceiling while maintaining parallel alignment. Bend both knees to 90° (table top position). Maintain the feet softly pointed. Bend the elbows and place the hands to behind the head. Ensure the pelvis and spine are neutral. EXERCISE DESCRIPTION: Inhale—To lengthen through the back of the neck. Exhale—To flex the upper body, sliding rib cage toward the pelvis. Do not let the tips of the scapulae come off the glideboard 330. Stay in flexion. Inhale—To extend the legs to a diagonal, keeping the legs hip distance and the feet flexed. Exhale—To return the legs to tabletop. Repeat 5-10 times per side. To finish . . . Inhale—To maintain the legs in tabletop. Exhale—To lengthen the spine onto the glideboard 330. REPETITIONS: 1 set of 5-8 extremity movements. TEACHING TIPS: Watch for stress or strain to the lumbar spine. Decrease the range of motion. Watch for shifting or tilting of the pelvis. Limit the range of motion and encourage greater activation of the spinal rotators. Watch for loss of thoracic imprint, "popping of the ribs." Slide the ribs together and down without compensating by flexing the trunk. "Knit" the ribs together. Use the Support Wedge Pillow. Watch for hyperextension of the knees. Maintain a soft bend in the knee while maintaining the front of the thigh "tight." Watch for greater deviation of the leg to one side. Maintain equal weight through both sides of the pelvis. Decrease the range of motion. Ensure that compensatory trunk lateral flexion is not occurring. Watch for proper femoral alignment. If the leg is internally rotating, turn the inner thigh up toward the ceiling. If the leg is externally rotating, turn the inner thigh down toward the floor. PROGRESSIONS/VARIATIONS: To decrease spinal flexor muscular endurance, perform the same movement without spinal flexion and the arms by the side or on the pelvis for feedback. To challenge spinal flexor muscular endurance, perform the same movement in spinal flexion with the arms to the side hovering the glideboard 330. To challenge spinal flexor muscular endurance, perform the same movement without Double Leg Pulley. To increase adductor activation, place a small ball between the ankles. To increase range of motion, add cable extension. SAFETY ASPECTS/CONTRAINDICATIONS: Spinal and sacroiliac vulnerabilities which are exacerbated by flexion and rotation. Knee vulnerability, especially for those with medial and lateral instability. Knee vulnerability, especially for those who hyperextend. Hip vulnerability, especially for those with hip precautions limiting flexion, adductor or external rotation.

Double Leg Pulley: Footwork: Flexed

ACCESSORY: Double leg pulley with foot harnesses; Optional Slide Distance Regulator; Optional Cable Extensions. OBJECTIVES: Increase spinal flexor muscular endurance. Teach dissociation of the extremities and torso. Increase coordination and core control. PRIME MOVERS: To flex the trunk: Concentric cervical and trunk flexors. To extend the legs to a diagonal: Concentric knee extensors and hip flexors. To flex the legs to tabletop: Concentric hip flexors and eccentric knee extensors followed by eccentric hip extensors and knee flexors. To lower trunk onto glideboard 330: Eccentric spinal flexors. PRIME STABILIZERS: Shoulder girdle stabilizers to limit shoulder elevation and assist in scapular control. Spinal flexors to maintain spinal flexion during extremity movement. Spinal flexors and hip extensors to assist in maintaining an imprinted spine and pelvic positioning. Hip extensors to limit excessive hip flexion. Ankle dorsiflexors to maintain ankle flexion. Deep lumbo-pelvic musculature to support the spinal column and to facilitate the hydraulic amplifier mechanism. INCLINE GUIDELINE: Level 1 to 2—Adjust incline higher to increase extremity-focus. STARTING POSITION: Disconnect the arm pulley. The telescoping squat stand may be on or off. Holding the foot loops in one hand straddle the glideboard 330 facing away from the tower. Sit with the buttocks near the bottom edge of the glideboard 330. Place the feet on floor in front of the body. Lie back, ensuring the head is fully supported. Separate the foot loops into each hand. Press the glideboard 330 halfway up the rails and bring one knee into the chest to place the foot into the loop. Extend this leg toward the ceiling while bringing the other knee into the chest to place the foot in the loop. Extend and abduct the legs hip distance apart toward the ceiling while maintaining parallel alignment. Bend both knees to 90° (table top position). Maintain the feet softly pointed. Bend the elbows and place the hands to behind the head. Ensure the pelvis and spine are neutral. EXERCISE DESCRIPTION: Inhale—To lengthen through the back of the neck. Exhale—To flex the upper body, sliding rib cage toward the pelvis. Do not let the tips of the scapulae come off the glideboard 330. Stay in flexion. Inhale—To extend the legs to a diagonal, keeping the legs adducted. Exhale—To return the legs to tabletop. Repeat 5-10 times. To finish . . . Inhale—To maintain the legs in tabletop. Exhale—To lengthen the spine onto the glideboard 330. REPETITIONS: 1 set of 5-8 extremity movements. TEACHING TIPS: Watch for stress or strain to the lumbar spine. Decrease the range of motion. Watch for shifting or tilting of the pelvis. Limit the range of motion and encourage greater activation of the spinal rotators. Watch for increased abduction of the legs. Keep the knee in line with the second and third toe. Keep active in the inner thighs and to resist the tendency to let the legs open. Watch for loss of thoracic imprint, "popping of the ribs." Slide the ribs together and down without compensating by flexing the trunk. "Knit" the ribs together. Use the Support Wedge Pillow. Perform an abdominal curl. Watch for hyperextension of the knees. Maintain a soft bend in the knee while maintaining the front of the thigh "tight." Watch for greater deviation of the leg to one side. Maintain equal weight through both sides of the pelvis. Decrease the range of motion. Ensure that compensatory trunk lateral flexion is not occurring. Watch for proper femoral alignment. If the leg is internally rotating, turn the inner thigh up toward the ceiling. If the leg is externally rotating, turn the inner thigh down toward the floor. PROGRESSIONS/VARIATIONS: To decrease spinal flexor muscular endurance, perform the same movement without spinal flexion and the arms by the side or on the pelvis for feedback. To challenge spinal flexor muscular endurance, perform the same movement in spinal flexion with the arms to the side and hovering the glideboard 330. To challenge spinal flexor muscular endurance, perform the same movement without Double Leg Pulley. To increase range of motion, add cable extension. SAFETY ASPECTS/CONTRAINDICATIONS: Spinal and sacroiliac vulnerabilities which are exacerbated by flexion and rotation. Knee vulnerability, especially for those with medial and lateral instability. Knee vulnerability, especially for those who hyperextend. Hip vulnerability, especially for those with hip precautions limiting flexion, adductor or external rotation.

PILATES

REFORMAT COREWORK SERIES

The following is an exemplary order of exercises and steps for a REFORMAT COREWORK™ CLASS for PILATES using the exercise device 100: Incline Level 4 or below with Telescoping Toe Bar. 1. Footwork: Feet In V; 2. Footwork: Toes Wrapped On Bar; 3. Footwork: Point And Flex; 4. Footwork: Relevé; 5. Hip Rolls; 6. Single Leg: Table Top; 7. Single Leg: Bicycle; 8. Single Leg: Battément; 9. Single Leg: Single Heel; 10. Pullover; 11. Hundred with Arm Pulley; 12. Snow Angel; 13. Tricep Press; 14. Side Twist Kneeling; 15. Roll Back With Bicep Curl; 16. Side Twist Kneeling; 17. Prone Snow Angel; 18. Kneeling Breaststroke; 19. Semicircle; 20. Stomach Massage: Round Back; 21. Stomach Massage: Flat Back; 22. Long Stretch; 23. Down Stretch; 24. Mermaid; 25. Long Back Stretch; 26. Side Splits Abduction; 27. Side Splits Plié In; 28. Side Splits Plié Out; 29. Side Splits Abduction; 30. Side Splits Plié In; 31. Side Splits Plié Out; 32. Double Leg Pulley: Short Spine; 33. Double Leg Pulley: Long Spine. Each of these exercises is described in more detail below.

The following is an exemplary order of exercises and steps for a REFORMAT COREWORK™ STAGE 1 CLASS for PILATES using the exercise device 100: Incline Level 4 or below with Telescoping Toe Bar. 1. Footwork: Feet In V; 2. Footwork: Toes Wrapped On Bar; 3. Footwork: Point And Flex; 4. Footwork: Relevé; 5. Hip Rolls; 6. Single Leg: Tabletop; 7. Single Leg: Bicycle; 8. Single Leg: Battéament; 9. Single Leg: Single Heel; 10. Pullover; 11. Hundred with Arm Pulley; 12. Snow Angel; 13. Triceps Press; 14. Side Twist Kneeling; 15. Roll Back With Bicep Curl; 16. Side Twist Kneeling; 17. Prone Snow Angel; 18. Stomach Massage: Round Back; 19. Stomach Massage: Flat Back; 20. Long Stretch (knees on glideboard 330); 21. Mermaid. Each of these exercises is described in more detail below.

The following is an exemplary order of exercises and steps for a REFORMAT COREWORK™ STAGE 2 CLASS for PILATES using the exercise device 100: Incline Level 4 or below with Telescoping Toe Bar. 1. Footwork: Feet In V; 2. Footwork: Toes Wrapped On Bar; 3. Footwork: Point And Flex; 4. Footwork: Relevé; 5. Hip Rolls; 6. Single Leg: Tabletop; 7. Single Leg: Bicycle; 8. Single Leg: Battéament; 9. Single Leg: Single Heel; 10. Pullover; 11. Hundred with Arm Pulley; 12. Snow Angel; 13. Triceps Press; 14. Side Twist Kneeling; 15. Roll Back With Bicep Curl; 16. Side Twist Kneeling; 17. Prone Snow Angel; 18. Kneeling Breaststroke; 19. Stomach Massage: Round Back; 20. Stomach Massage: Flat Back; 21. Long Stretch; 22. Mermaid; 23. Double Leg Pulley: Short Spine; 24. Double Leg Pulley: Long Spine. Each of these exercises is described in more detail below.

The following is an exemplary order of exercises and steps for a REFORMAT COREWORK™ STAGE 3 CLASS for PILATES using the exercise device 100: Incline Level 4 or below with Telescoping Toe Bar. 1. Footwork: Feet In V; 2. Footwork: Toes Wrapped On Bar; 3. Footwork: Point And Flex; 4. Footwork: Relevé; 5. Hip Rolls; 6. Single Leg: Tabletop; 7. Single Leg: Bicycle; 8. Single Leg: Battéament; 9. Single Leg: Single Heel; 10. Pullover; 11. Hundred with Arm Pulley; 12. Snow Angel; 13. Triceps Press; 14. Side Twist Kneeling; 15. Roll Back With Bicep Curl; 16. Side Twist Kneeling; 17. Prone Snow Angel; 18. Kneeling Breaststroke; 19. Semicircle; 20. Stomach Massage: Round Back; 21. Stomach Massage: Flat Back; 22. Long Stretch; 23. Down Stretch; 24. Mermaid; 25. Long Back Stretch; 26. Side Splits Abduction; 27. Side Splits Plié In; 28. Side Splits PliéOut; 29. Side Splits Abduction; 30. Side Splits Plié In; 31. Side Splits Plié Out; 32. Double Leg Pulley: Short Spine; 33. Double Leg Pulley: Long Spine. Each of these exercises is described in more detail below.

The following is an exemplary order of exercises and steps for a REFORMAT COREWORK™ STAGE 4 CLASS for PILATES using the exercise device 100: Incline Level 4 or below with Telescoping Toe Bar. 1. Footwork: Feet In V; 2. Footwork: Toes Wrapped On Bar; 3. Footwork: Point And Flex; 4. Footwork: Relevé; 5. Bridging On Heels; 6. Single Leg: Table Top; 7. Single Leg: Bicycle; 8. Single Leg: Battéament; 9. Single Leg: Single Heel; 10. Stomach Massage: Round Back; 11. Stomach Massage: Flat Back; 12. Elephant: Round Back; 13. Elephant: Flat Back; 14. Essential Knee Stretches: Round Back; 15. Essential Knee Stretches: Flat Back; 16. Essential Single Thigh Stretch; 17. Hundred with Arm Pulley; 18. Arm Circles; 19. Prone Scooping Back With Thoracic Lift; 20. Prone Tricep Extensions; 21. Surfer; 22. Hamstring Glide; 23. Double Leg Pulley: Double Leg Circles; 24. Double Leg Pulley: Hamstring Stretch; 25. Double Leg Pulley: Adductor Stretch. Each of these exercises is described in more detail below.

The following is an exemplary order of exercises and steps for a REFORMAT COREWORK™ STAGE 5 CLASS for PILATES using the exercise device 100: Incline Level 4 or below with Telescoping Toe Bar. 1. Footwork: Feet In V; 2. Footwork: Toes Wrapped On Bar; 3. Footwork: Point And Flex; 4. Footwork: Relevé; 5. Bridging On Heels; 6. Single Leg: Table Top; 7. Single Leg: Bicycle; 8. Single Leg: Battéament; 9. Single Leg: Single Heel; 10. Stomach Massage: Round Back; 11. Stomach Massage: Flat Back; 12. Elephant: Round Back; 13. Elephant: Flat Back; 14. Essential Knee Stretches: Round Back; 15. Essential Knee Stretches: Flat Back; 16. Essential Single Thigh Stretch; 17. Hundred with Arm Pulley; 18. Teaser Prep 1 with Arm Pulley; 19. Prone Scooping Back With Thoracic Lift; 20. Prone Tricep Extensions; 21. Surfer; 22. Hamstring Glide; 23. Roll Back With Hamstring Stretch; 24. Double Leg Pulley: Double Leg Circles; 25. Double Leg Pulley: Hamstring Stretch; 26. Double Leg Pulley: Adductor Stretch. Each of these exercises is described in more detail below.

The following is an exemplary order of exercises and steps for a REFORMAT COREWORK™ STAGE 6 CLASS for PILATES using the exercise device 100: Incline Level 4 or below with Telescoping Toe Bar. 1. Footwork: Feet In V; 2. Footwork: Toes Wrapped On Bar; 3. Footwork: Point And Flex; 4. Footwork: Relevé; 5. Bridging On Heels; 6. Single Leg: Table Top; 7. Single Leg: Bicycle; 8. Single Leg: Battéament; 9. Single Leg: Single Heel; 10. Stomach Massage: Round Back; 11. Stomach Massage: Flat Back; 12. Elephant: Round Back; 13. Elephant: Flat Back; 14. Essential Knee Stretches: Round Back; 15. Essential Knee Stretches: Flat Back; 16. Essential Single Thigh Stretch; 17. Hundred with Arm Pulley; 18. Teaser Prep 1 with Arm Pulley; 19. Teaser Prep 2 with Arm Pulley; 20. Arm Circles; 21. Bicep Coordination; 22. Prone Scooping Back With Thoracic Lift; 23. Prone Tricep Extensions; 24. Surfer; 25. Hamstring Glide; 26. Roll Back With Hamstring Stretch; 27. Hip Hinge with Hamstring Stretch; 28. Front Splits; 29. Back Splits; 30. Double Leg Pulley: Double Leg Circles; 31. Double Leg Pulley: Hamstring Stretch; 32. Double Leg Pulley: Adductor Stretch. Each of these exercises is described in more detail below.

Footwork: Feet in V

ACCESSORY: Telescoping Toe Bar; Optional Support Wedge Pillow; Optional Slide Distance Regulator. OBJECTIVES: Strengthen lower extremities. Integrate Pilates teaching principles. Improve pelvic and lower extremity dissociation. Prepare the body for the workout. PRIME MOVERS: To extend the legs: Concentric hip and knee extensors. To flex the legs: Eccentric hip and knee extensors. PRIME STABILIZERS: Hip flexors to limit excessive lordosis and assist in maintaining neutral spine. Hip internal rotators to limit excessive external rotation, and hip external rotators to maintain the legs in turn out. Scapular stabilizers to limit shoulder elevation and cervical tension. Foot intrinsics to maintain placement of foot on toebar. Deep lumbopelvic musculature to support the spinal column and to facilitate the hydraulic amplifier mechanism. INCLINE GUIDELINE: 8 to 1—Adjust the incline lower for torso focus. 1 to 8—Adjust incline higher for extremity focus. STARTING POSITION: Disconnect the pulley from the glideboard 330. Push the glideboard 330 halfway up the rails, straddle the glideboard 330 and sit at the bottom edge. Place the balls of the feet in a V position on the Telescoping Toe Bar. With the legs laterally rotated, extend and adduct them. Bring the feet into a soft point in the foot and ankle. The knees will be aligned with the second and third toe. Lie back with the pelvis near the bottom of the glideboard 330, ensuring head is fully supported. Rest the arms to the sides of the body or place the hands on the pelvis for feedback. EXERCISE DESCRIPTION: Inhale—To prepare. Exhale—To extend the legs, pressing the glideboard 330 up the incline. The heels will remain together in turn out as the legs adduct. Inhale—To return the glideboard 330 to the start position. The heels remain together as the legs separate. REPETITIONS: 8 to 10 times. TEACHING TIPS: Watch for pelvic shifting and tilting or loss of neutral spine. Visualize balancing a cup of water on the pelvis. Place the hands on the pelvis for feedback. Watch the legs entering into parallel or excessive internal rotation during extension. Turn the inner thighs toward the ceiling. The heels remain together throughout the motion. Watch for hyperextension of the knees. Maintain a soft bend in the knees or decrease the range of motion. Watch for patellar alignment. If patellae are rolling inward toward one another, turn the adductors toward the ceiling, facilitating the external rotators to rotate the femurs. If the patellae are facing laterally, turn the inner thighs to face the floor, facilitating the internal rotators to rotate the femurs. Watch for excessive end range knee flexion. Adjust the Telescoping Toe Bar accordingly. Use the Slide Distance Regulator to control range of motion. Watch for loss of thoracic imprint, "popping of the ribs." Slide the ribs together and down without compensating by flexing the trunk. "Knit" the ribs together. Watch for collapsing in the ribcage. Visualize flexing up and over a ball. Watch for loss of abdominal activation. Draw the navel in toward the spine and up toward the crown of the head. PROGRESSIONS/VARIATIONS: To assist in maintaining lateral rotation, place a pad between the heels. To intensify, perform small controlled pulses at the end and/or the beginning of the range of motion. To challenge coordination, reach the arms overhead during extension and lower them to the sides during flexion. To enhance body awareness, perform an abdominal curl with the hands by the side or behind the head. And cue to observe neutral pelvis. SAFETY ASPECTS/CONTRAINDICATIONS: Lower back injuries i.e. disc pathologies. Knee pathologies that limit range of motion.

Footwork: Toes Wrapped on Bar

ACCESSORY: Telescoping Toe Bar; Optional Support Wedge Pillow; Optional Slide Distance Regulator. OBJECTIVES: Strengthen lower extremities. Integrate Pilates teaching principles. Improve pelvic and lower extremity dissociation. Prepare the body for the workout. PRIME MOVERS: To extend the legs: Concentric hip and knee extensors. To flex the legs: Eccentric hip and knee extensors. PRIME STABILIZERS: Hip flexors to limit excessive lordosis and assist in maintaining neutral spine. Hip internal rotators to maintain parallel alignment. Foot intrinsics to hold onto the Telescoping Toe Bar. Scapular stabilizers to limit shoulder elevation and cervical tension. Deep lumbo-pelvic musculature to support the spinal column and to facilitate the hydraulic amplifier mechanism. INCLINE GUIDELINE: 8 to 1—Adjust the incline lower for torso focus. 1 to 8—Adjust incline higher for extremity focus. STARTING POSITION: Disconnect the pulley from the glideboard 330. Push the glideboard 330 halfway up the rails, straddle the glideboard 330 and sit at the bottom edge. Place the balls of the feet on the Telescoping Toe Bar. With the legs parallel, extend and adduct them. Lower the heels under the bar bringing the foot into a neutral position. Lie back with the pelvis near the bottom of the glideboard 330, ensuring head is fully supported. Rest the arms to the sides of the body or place the hands on the pelvis for feedback. EXERCISE DESCRIPTION: Inhale—To prepare. Exhale—To extend the knees and hips, pressing the glideboard 330 up the incline. Maintain adduction of the legs. Inhale—To return the glideboard 330 to the start position. REPETITIONS: 8 to 10 times. TEACHING TIPS: Watch for pelvic shifting and tilting or loss of neutral spine. Visualize balancing a cup of water on the pelvis. Place the hands on the pelvis for feedback. Maintain legs in parallel during extension. Maintain heels together throughout the motion. Watch for hyperextension of the knees. Maintain a soft bend in the knees or decrease the range of motion. Watch for patellar alignment. If patellae are rolling inward toward one another, turn the adductors toward the ceiling, facilitating the external rotators to rotate the femurs. If the patellae are facing laterally, turn the inner thighs to face the floor, facilitating the internal rotators to rotate the femurs. Watch for excessive end range knee flexion. Bend the knees' to only 90°. Use the Slide Distance Regulator to control range of motion. Ensure that the Telescoping Toe Bar is appropriately adjusted. Watch for excessive supination or pronation of the foot. Visualize pressing the foot up against an imaginary wall. If supinating, press the big toe toward the front of the room. If pronating, draw the arch of the foot up. Watch for loss of thoracic imprint, "popping of the ribs." Slide the ribs together and down without compensating by flexing the trunk. "Knit" the ribs together. Watch for collapsing in the ribcage. Visualize flexing up and over a ball. Watch for loss of abdominal activation. Draw the navel in toward the spine and up toward the crown of the head. PROGRESSIONS/VARIATIONS: To assist in maintaining adduction, place a pad/ball between the knees or heels. To intensify, perform small controlled pulses at the end and/or the beginning of the range of motion. To challenge coordination, reach the arms overhead during extension and lower them to the sides during flexion. To enhance body awareness, perform an abdominal curl with the hands by the side or behind the head and cue to observe neutral pelvis. SAFETY ASPECTS/CONTRAINDICATIONS: Lower back injuries i.e. disc pathologies. Knee pathologies that limit range of motion.

Footwork: Point and Flex

ACCESSORY: Telescoping Toe Bar; Optional Support Wedge Pillow; Optional Slide Distance Regulator. OBJECTIVES: Strengthen lower extremities. Integrate Pilates teaching principles. Improve pelvic and lower extremity dissociation. Prepare the body for the workout. PRIME MOVERS: To extend the legs: Concentric hip and knee extensors. To point the foot: Concentric plantarflexors. To flex the foot: Concentric ankleflexors. To bend the legs: Eccentric hip and knee extensors. PRIME STABILIZERS: Hip flexors to limit excessive lordosis and assist in maintaining neutral spine. Hip internal rotators to limit excessive external rotation, and hip external rotators to maintain the legs in turn out. Scapular stabilizers to limit shoulder elevation and cervical tension. Deep lumbo-pelvic musculature to support the spinal column and to facilitate the hydraulic amplifier mechanism. INCLINE GUIDELINE: 8 to 1—Adjust the incline lower for torso focus. 1 to 8—Adjust incline higher for extremity focus. STARTING POSITION: Disconnect the pulley from the glideboard 330. Push the glideboard 330 halfway up the rails, straddle the glideboard 330 and sit at the bottom edge. Place the heels on the Telescoping Toe Bar. With the legs parallel, extend and adduct them. Dorsiflex the ankles, bringing them into a neutral position. Lie back with the pelvis near the bottom of the glideboard 330, ensuring head is fully supported. Rest the arms to the sides of the body or place the hands on the pelvis for feedback. EXERCISE DESCRIPTION: Inhale—To bend the knees. Exhale—To extend the knees and hips, pressing the glideboard 330 up the incline. Inhale—To point and flex the feet, maintaining knees extended Exhale—To flex the feet, maintaining knees extended. Inhale—To bend the knees. REPETITIONS: 8 to 10 times. TEACHING TIPS: Watch for pelvic shifting and tilting or loss of neutral spine. Visualize balancing a cup of water on the pelvis. Place the hands on the pelvis for feedback. Watch for initiation of the movement with the lumbar spine. Contract the front of thighs first, then press the glideboard 330 up and contract the quadriceps throughout the movement. Watch for hyperextension of the knees. Maintain a soft bend in the knees or decrease the range of motion. Watch for the patellar alignment. If patellae are rolling inward toward one another, turn the adductors toward the ceiling, facilitating the external rotators to rotate the femurs. If the patellae are facing laterally, turn the inner thighs to face the floor, facilitating the internal rotators to rotate the femurs. Maintain legs in parallel during extension. Maintain heels together throughout the motion. Watch for loss of thoracic imprint, "popping of the ribs." Slide the ribs together and down without compensating by flexing the trunk. "Knit" the ribs together. Watch for excessive end range knee flexion. Adjust the Telescoping Toe Bar accordingly. Use the Slide Distance Regulator to control range of motion. Watch for excessive supination or pronation of the foot. Visualize pressing the foot up against an imaginary wall. If supinating, press the big toe toward the front of the room: If pronating, draw the arch of the foot up. Watch for loss of abdominal activation. Draw the navel in toward the spine and up toward the crown of the head. Watch for loss of transverse abdominal activation as noted by the navel no longer being pulled in and up toward the spine. Pull the navel in toward the spine. Activating the inner thighs can also assist abdominal activation. PROGRESSIONS/VARIATIONS: To assist in maintaining adduction, place a pad/ball between the knees or heels. To intensify, perform small controlled pulses at the end and/or the beginning of the range of motion. To challenge coordination, reach the arms overhead during extension and lower them to the sides during flexion. To enhance body awareness, perform an abdominal curl with the hands by the side or behind the head and cue to observe neutral pelvis. SAFETY ASPECTS/CONTRAINDICATIONS: Lower back injuries i.e. disc pathologies. Knee pathologies that limit range of motion.

Footwork: Relevé

ACCESSORY: Telescoping Toe Bar; Optional Support Wedge Pillow; Optional Slide Distance Regulator. OBJECTIVES: Strengthen lower extremities. Integrate Pilates teaching principles. Improve pelvic and lower extremity dissociation. Prepare the body for the workout. PRIME MOVERS: To extend the legs: Concentric hip and knee extensors. To bend the legs: Eccentric hip and knee extensors. PRIME STABILIZERS: Hip flexors to limit excessive lordosis and assist in maintaining neutral spine. Hip internal rotators to limit excessive external rotation, and hip external rotators to maintain the legs in turn out. Ankle plantarflexors to maintain ankle plantarflexion throughout the exercise. Scapular stabilizers to limit shoulder elevation and cervical tension. Deep lumbo-pelvic musculature to support the spinal column and to facilitate the hydraulic amplifier mechanism. INCLINE GUIDELINE: 8 to 1—Adjust the incline lower for torso focus. 1 to 8—Adjust incline higher for extremity focus. STARTING POSITION: Disconnect the pulley from the glideboard 330. Push the glideboard 330 halfway up the rails, straddle the glideboard 330 and sit at the bottom edge. Place the balls of the feet on the Telescoping Toe Bar. With the legs parallel, extend and adduct them. Lift the heels, bringing the ankles into a plantar flexed position. Lie back with the pelvis near the bottom of the glideboard 330, ensuring head is fully supported. Rest the arms to the sides of the body or place the hands on the pelvis for feedback. EXERCISE DESCRIPTION: Inhale—To prepare. Exhale—To extend the knees and hips, pressing the glideboard 330 up the incline. Inhale—To return the glideboard 330 to the start position. The heels remain together as the legs separate. REPETITIONS: 8 to 10 times. TEACHING TIPS: Watch the heels dropping in space. Maintain the heels lifted. Watch for pelvic shifting and tilting or loss of neutral spine. Visualize balancing a cup of water on the pelvis. Place the hands on the pelvis for feedback. Watch for initiation of the movement with the lumbar spine. Contract the front of thigh first, then press the glideboard 330 up and contract the quadriceps throughout the movement. Watch for the legs entering into greater external rotation. Maintain activation of the inner thighs and track the knee over the second and third toe. Watch for the legs entering into parallel during extension. Turn the inner thighs toward the ceiling. Make sure that heels remain together throughout the motion. Watch for hyperextension or the knees. Maintain a soft bend in the knees or decrease the range of motion. Watch for excessive end range knee flexion. Adjust the Telescoping Toe Bar accordingly. Use the Slide Distance Regulator to control range of motion. Watch for excessive supination or pronation of the foot. Visualize pressing the foot up against an imaginary wall. If supinating, press the big toe toward the front of the room. If pronating, draw the arch of the foot up. Watch for loss of thoracic imprint, "popping of the ribs." Slide the ribs together and down without compensating by flexing the trunk. "Knit" the ribs together. Watch for proper femoral alignment. If the leg is internally rotating, turn the inner thigh up toward the ceiling. If the leg is externally rotating, turn the inner thigh down toward the floor. Watch for loss of abdominal activation. Draw the navel in toward the spine and up toward the crown of the head. PROGRESSIONS/VARIATIONS: To assist in maintaining lateral rotation, place a pad between the heels. To intensify, perform small controlled pulses at the end and/or the beginning of the range of motion. To challenge coordination, reach the arms overhead during extension and lower them to the side during flexion. To enhance body awareness, perform an abdominal curl with the hands by the side or behind the head and cue to observe neutral pelvis. SAFETY ASPECTS/CONTRAINDICATIONS: Lower back injuries i.e. disc pathologies. Knee pathologies that limit range of motion.

Hip Rolls

ACCESSORY: Telescoping Toe Bar. OBJECTIVES: Strengthen lower extremity and spinal extensors. Challenge stabilization of the pelvis and torso. Enhance spinal articulation. PRIME MOVERS: To roll the pelvis and spine into a bridge position: Concentric hip and spinal extensors. To press glideboard 330 up the incline: Concentric hip and knee extensors. To the spine and pelvis onto the glideboard 330: Eccentric hip and spinal extensors. To roll the spine and pelvis onto the glideboard 330: Eccentric knee extensors and hip extensors. PRIME STABILIZERS: Hip internal and external rotators, as well as hip abductors and adductors, to maintain parallel alignment. Spinal flexors to assist in maintaining thoracic imprint and posterior pelvic tilt. Knee flexors to limit excessive knee extension. Hip and spinal extensors to maintain the pelvis in the bridge position.

Spinal flexors and rotators to maintain neutral pelvis and limit pelvic shifting and tilting. Scapular stabilizers to limit shoulder elevation and cervical tension. Deep lumbo-pelvic musculature to support the spinal column and to facilitate the hydraulic amplifier mechanism. INCLINE GUIDELINE: 8 to 1—Adjust the incline lower for torso focus. 1 to 8—Adjust incline higher for extremity focus. STARTING POSITION: Disconnect the pulley from the glideboard 330. Push the glideboard 330 halfway up the rails, straddle the glideboard 330 and sit at the bottom edge. Place the heels on the Telescoping Toe Bar. With the legs parallel and hip distance apart, extend the knees. Dorsiflex the ankles, bringing them into a neutral position. Lie back with the pelvis near the bottom of the glideboard 330, ensuring head is fully supported. Ensure the spine and pelvis are in a neutral position. Rest the arms to the sides of the body or place the hands on the pelvis for feedback. Lower the glideboard 330 by bending both the knees to 90°. EXERCISE DESCRIPTION: Inhale—To roll the pelvis, lumbar and lower thoracic spine off the glideboard 330. Exhale—To press the glideboard 330 up the incline maintaining the pelvis and spine in the same position. Inhale—To roll the spine and pelvis onto the glideboard 330 beginning with the lower thoracic. Exhale—To return the glideboard 330. Repeat 5 to 8 times in one direction then Inhale—To prepare. Exhale—To press the glideboard 330 up the incline. Inhale—To roll pelvis, lumbar and lower thoracic off the glideboard 330. Exhale—To return the glideboard 330, maintaining the pelvis and spine in the same position. Inhale—To roll the spine and pelvis onto the glideboard 330 beginning with the lower thoracic. REPETITIONS: 5 to 8 times in each direction TEACHING TIPS: Watch the loss of hip adduction. Maintain energy between the inner thighs. Watch for proper spinal articulation. "Peel" the spine, don't lift, off the glideboard 330. Watch for excessive end range knee flexion. Adjust the Telescoping Toe Bar accordingly. Use the Slide Distance Regulator to control range of motion. Watch for pelvis shifting or hiking during the bridge. Eliminate pressing the glideboard 330 up the incline until greater control is achieved. Watch for increased supination or pronation of the foot. Press equally through the entire foot. If supinating, press the big toe toward the front of the room. If pronating, draw the arch of the foot up. Watch for loss of proper femoral alignment. If the femur is internally rotated, turn the inner thigh toward the ceiling. If the femur is externally rotated, turn the inner thighs toward the floor. Watch for loss of thoracic imprint, "popping" of the ribs. "Knit the ribs together." Watch for loss of transverse abdominal activation as noted by the navel no longer being pulled in and up toward the spine. Pull the navel in toward the spine. Activating the inner thighs can also assist abdominal activation. PROGRESSIONS/VARIATIONS: To enhance body awareness, place the hands on the pelvis for feedback. To decrease coordination, perform only the bridging motion without incorporating the glideboard 330 movement. To challenge coordination, add shoulder flexion and extension. SAFETY ASPECTS/CONTRAINDICATIONS: Spinal and sacroiliac vulnerabilities which are exacerbated by extension. Knee vulnerability, especially those who hyperextend. Pathologies exacerbated by kneeling or increased knee flexion. Hip vulnerability, especially for those with hip precautions limiting flexion, adductor or external rotation. Participants with elbow vulnerability.

Single Leg: Tabletop

ACCESSORY: Telescoping Toe Bar; Optional Support Wedge Pillow Optional Slide Distance; Regulator. OBJECTIVES: Enhance coordination. Challenge lateral stabilization of the pelvis and torso. Strengthen lower extremities. Improve pelvic and lower extremity dissociation. PRIME MOVERS: To extend the supporting leg: Concentric hip and knee extensors. To bend the supporting leg: Concentric hip flexors and knee extensors. PRIME STABILIZERS: Hip flexors and knee extensors to maintain the free leg in tabletop position. Hip internal and external rotators to maintain parallel alignment. Lateral spinal rotators and lateral flexors to maintain equal weightbearing and neutral position in the pelvis and spine. Scapular stabilizers to limit shoulder elevation and cervical tension. Deep lumbo-pelvic musculature to support the spinal column and to facilitate the hydraulic amplifier mechanism. INCLINE GUIDELINE: 8 to 1—Adjust the incline lower for torso focus. 1 to 8—Adjust incline higher for extremity focus. STARTING POSITION: Disconnect the pulley from the glideboard 330. Push the glideboard 330 halfway up the rails, straddle the glideboard 330 and sit at the bottom edge. Place the balls of the feet on the Telescoping Toe Bar. With the legs parallel, extend and adduct them. Lower the heels under the bar, bringing the foot into a neutral position. Lie back with the pelvis near the bottom of the glideboard 330, ensuring head is fully supported. Lower the glideboard 330 by bending both the knees to 90°. Bring one leg into a tabletop position with the foot dorsiflexed. Rest the arms to the sides of the body or place the hands on the pelvis for feedback. Ensure the spine and pelvis are in a neutral position. EXERCISE DESCRIPTION: Inhale—To prepare. Exhale—To extend the supporting leg by pressing the glideboard 330 up the incline. Maintain the unsupported leg in tabletop. Inhale—To return the glideboard 330 to the start position. REPETITIONS: 8 to 10 times. TEACHING TIPS: Watch for greater weightbearing through the pelvis on the unsupported side. Maintain equal weight on each sit bone (ischial tuberosity). Watch for abduction or adduction of the unsupported leg. Maintain the leg in line with the sit bone. Appropriately increase abduction or adduction. Watch for increased knee flexion and decreased hip flexion. Visualize balancing, then maintaining, a tray on the lower leg. Place the hand up against the thigh as it is held at 90°. Don't let the thigh pull away from the hand. Watch for "popping" of the ribs. "Knit" the front ribs together. Watch for excessive end-range knee flexion of the supporting leg. Bend the knees to only 90°. Use the Slide Distance Regulator to control range of motion. Ensure that the Telescoping Toe Bar is appropriately adjusted. Watch for increased supination or pronation of the supporting foot. Press equally through the entire foot. If supinating, press the big toe toward the front of the room. If pronating, draw the arch of the foot up. Watch for pelvic shifting and tilting or loss of neutral spine. Visualize balancing a cup of water on the pelvis. Place the hands on the pelvis for feedback. Watch for initiation of the movement with the lumbar spine. Contract the front of the thighs first, then press the glideboard 330 up. Watch for hyperextension of the knees. Maintain a soft bend in the knees or decrease the range of motion. Watch for proper femoral alignment. If femur is internally rotated, turn the inner thigh toward the ceiling. If the femur is externally rotated, turn the inner thigh toward the floor. Watch for proper patellar tracking. If laterally tracking, increase activation of the medial aspect of the knee extensors, especially the vastus medialis obliques (VMO). If tracking medially, activate lateral knee extensors. Watch for loss of transverse abdominal activation as noted by the navel no longer being pulled in and up toward the spine. Pull the navel in toward the spine. Activating the inner thighs can also assist abdominal activation. PROGRES- SIONS/VARIATIONS: To enhance body awareness, perform an abdominal curl with the hands by the side or behind the head. Cue to equal weightbearing through the hip. SAFETY ASPECTS/CONTRAINDICATIONS: Spinal and sacroiliac vulnerabilities which are exacerbated by flexion. Spinal vulnerability especially when spinal lateral trunk flexor and rotator weakness is present. Knee vulnerability, especially for those who hyperextend. Participants with elbow vulnerability.

Single Leg: Bicycle

ACCESSORY: Telescoping Toe Bar; Optional Support Wedge Pillow; Optional Slide Distance Regulator. OBJECTIVES: Enhance cross-coordination. Challenge lateral stabilization of the pelvis and torso. Strengthen lower extremities. Improve pelvic and lower extremity dissociation. PRIME MOVERS: To extend the supporting leg: Concentric hip and knee extensors, followed by eccentric hip flexors. To extend the unsupported leg: Eccentric hip flexors and concentric knee extensors. To bend the unsupported limb: Concentric hip flexors and eccentric knee extensors. To bend the supporting leg: Eccentric hip and knee extensors. PRIME STABILIZERS: Hip internal and external rotators to maintain parallel alignment. Lateral spinal rotators and lateral flexors to maintain equal weightbearing and neutral position in the pelvis and spine. Scapular stabilizers to limit shoulder elevation and cervical tension. Deep lumbo-pelvic musculature to support the spinal column and to facilitate the hydraulic amplifier mechanism. INCLINE GUIDELINE: 8 to 1—Adjust the incline lower for torso focus. 1 to 8—Adjust incline higher for extremity focus. STARTING POSITION: Disconnect the pulley from the glideboard 330. Push the glideboard 330 halfway up the rails, straddle the glideboard 330 and sit at the bottom edge. Place the balls of the feet on the Telescoping Toe Bar. With the legs parallel, extend and adduct them. Lower the heels under the bar, bringing the foot into a neutral position. Lie back with the pelvis near the bottom of the glideboard 330, ensuring head is fully supported. Lower the glideboard 330 by bending both the knees to 90°. Extend one leg over the Telescoping Toe Bar with the foot softly pointed. Rest the arms to the sides of the body or place the hands on the pelvis for feedback. Ensure the spine and pelvis are in a neutral position. EXERCISE DESCRIPTION: Inhale—To prepare. Exhale—To extend the leg, pressing the glideboard 330 up the incline, simultaneously bending the unsupported leg to tabletop position. Inhale—To return the glideboard 330 to the start position, simultaneously extending the unsupported leg over the Telescoping Toe Bar. REPETITIONS: 8 to 10 times. TEACHING TIPS: Watch for greater pelvic weight bearing on the side where the leg is unsupported. Maintain equal weight on each sit bone (ischial tuberosity). Watch for abduction or adduction of the unsupported leg as the leg extends. If the leg is abducting, bring the leg closer toward the midline of the body. If the leg is adducting, bring the leg out from the midline of the body. Watch for increased internal or external rotation of the unsupported leg, especially as the limb enters into tabletop. Maintain the leg in line with the sit bone. Watch for increased hip flexion as the unsupported leg flexes in toward the chest. Bend the knee to only 90° and focus on lengthening out the hip, rather than bringing the knee into the chest. Watch for lateral trunk flexion. Keep the pelvis very still and maintain equal length from the rib to the pelvis on both sides. Watch for excessive end-range knee flexion of the supporting leg. Bend the knees to only 90°. Use the Slide Distance Regulator to control range of motion. Ensure that the Telescoping Toe Bar is appropriately adjusted. Watch for increased supination or pronation of the supporting foot. Press equally through the entire foot. If supinating, press the big toe toward the front of the room. If pronating, draw the arch of the foot up. Watch for pelvic shifting and tilting or loss of neutral spine. Visualize balancing a cup of water on the pelvis. Place the hands on the pelvis for feedback. Watch for initiation of the movement with the lumbar spine. Tighten front of the thighs then press the glideboard 330 up. Watch for hyperextension of the knees. Maintain a soft bend in the knees or decrease the range of motion. Watch for proper femoral alignment. If the femur is internally rotated, turn the inner thighs toward the ceiling. If the femur is externally rotated, turn the inner thighs toward the floor. Watch for proper patellar tracking. If laterally tracking, increase activation of the medial aspect of the knee extensors, especially the vastus medialis obliques (VMO). If tracking medially, activate lateral knee extensors. Watch for loss of transverse abdominal activation as noted by the navel no longer being pulled in and up toward the spine. Pull the navel in toward the spine. Activating the inner thighs can also assist abdominal activation. PROGRESSIONS/VARIATIONS: To enhance body awareness, perform an abdominal curl with the hands by the sides or behind the head. Cue to observe neutral pelvis. SAFETY ASPECTS/CONTRAINDICATIONS: Spinal vulnerability especially when spinal lateral trunk flexor and rotator weakness is present. Knee vulnerability, especially for those who hyperextend. Pathologies exacerbated by kneeling or increased knee flexion. Hip vulnerability, especially for those with hip precautions limiting flexion, adductor or external rotation. Participants with elbow vulnerability.

Single Leg: Battément

ACCESSORY: Telescoping Toe Bar; Optional Support Wedge Pillow; Optional Slide Distance Regulator. OBJECTIVES: Enhance cross-coordination. Challenge lateral stabilization of the pelvis and torso. Strengthen lower extremities. Improve pelvic and lower extremity dissociation. PRIME MOVERS: To extend the supporting leg: Concentric hip and knee extensors. To lower the unsupported leg toward the floor: Eccentric hip flexors. To reach the unsupported limb toward the ceiling: Concentric hip flexors. To bend the supporting leg: Eccentric hip and knee extensors. PRIME STABILIZERS: Hip internal and external rotators to maintain parallel alignment. Knee extensors of the unsupported leg to maintain knee extension. Lateral spinal rotators and lateral flexors to maintain equal weightbearing and neutral position in the pelvis and spine. Scapular stabilizers to limit shoulder elevation and cervical tension. Deep lumbo-pelvic musculature to support the spinal column and to facilitate the hydraulic amplifier mechanism. INCLINE GUIDELINE: 8 to 1—Adjust the incline lower for torso focus. 1 to 8—Adjust incline higher for extremity focus. STARTING POSITION: Disconnect the pulley from the glideboard 330. Push the glideboard 330 halfway up the rails, straddle the glideboard 330 and sit at the bottom edge. Place the balls of the feet on the Telescoping Toe Bar. With the legs parallel, extend and adduct them. Lower the heels under the bar, bringing the foot into a neutral position. Lie back with the pelvis near the bottom of the glideboard 330, ensuring head is fully supported. Lower the glideboard 330 by bending both the knees to 90°. Extend one leg over the Telescoping Toe Bar with the foot softly pointed. Rest the arms to the sides of the body or place the hands on the pelvis for feedback. Ensure the spine and pelvis are in a neutral position. EXERCISE DESCRIPTION: Inhale—To prepare. Exhale—To extend the leg pressing the glideboard 330 up the incline while simultaneously lifting the unsupported leg toward the ceiling. Inhale—To return the glideboard 330 to the start position while simultaneously lowering the unsupported leg toward the Telescoping Toe Bar. REPETITIONS: 8 to 10 times. TEACHING TIPS: Watch for greater weightbearing through the pelvis on the side of the unsupported leg. Maintain equal weight on each sit bone (ischial tuberosity). Watch for abduction or adduction of the unsupported leg as it lifts and lowers. If the leg is abducting, bring the leg closer toward the midline of the body. If the leg is adducting, bring the leg out from the midline of the body. Watch for loss of neutral pelvis and spine as the leg reaches for the ceiling. Decrease the range of motion for hip flexion. Watch for increased hip flexion as the unsupported leg flexes in toward the chest. Bend the knee to only 90° and focus on lengthening out the hip, rather than bringing the knee into the chest. Watch for lateral trunk flexion. Keep the pelvis very still and maintain equal length from the rib to the pelvis on both sides. Watch for excessive end-range knee flexion of the supporting leg. Bend the knees to only 90°. Use the Slide Distance Regulator to control range of motion. Ensure that the Telescoping Toe Bar is appropriately adjusted. Watch for increased supination or pronation of the supporting foot. Press equally through the entire foot. If supinating, press the big toe toward the front of the room. If pronating, draw the arch of the foot up. Watch for pelvic loss of neutral spine. Visualize balancing a cup of water on the pelvis. Place the hands on the pelvis for feedback. Watch for initiation of the movement with the lumbar spine. Contract the front of the thigh first, then press the glideboard 330. Watch for hyperextension of the knees. Maintain a soft bend in the knees or decrease the range of motion. Watch for proper femoral alignment. If the femur is internally rotated, turn the inner thighs toward the ceiling. If the femur is externally rotated, turn the inner thighs toward the floor. Watch for proper patellar tracking. If laterally tracking, increase activation of the medial aspect of the knee extensors, especially the vastus medialis obliques (VMO). If tracking medially, activate lateral knee extensors. Watch for loss of transverse abdominal activation as noted by the navel no longer being pulled in and up toward the spine. Pull the navel in toward the spine. Activating the inner thighs can also assist abdominal activation. PROGRESSIONS/VARIATIONS: To enhance body awareness, perform an abdominal curl with the hands by the sides or behind the head. Cue to observe the neutral pelvis. SAFETY ASPECTS/CONTRAINDICATIONS: Spinal vulnerability, especially when spinal lateral trunk flexor and rotator weakness is present. Knee vulnerability, especially for those who hyperextend. Hip vulnerability, especially for those with hip precautions limiting flexion, adductor or external rotation. Participants with elbow vulnerability.

Single Leg: Single Heel

ACCESSORY: Telescoping Toe Bar; Optional Support Wedge Pillow; Optional Slide Distance Regulator. OBJECTIVES: Enhance cross-coordination. Challenge lateral stabilization of the pelvis and torso. Strengthen lower extremities. Improve pelvic and lower extremity dissociation. PRIME MOVERS: To extend the supporting leg: Concentric hip and knee extensors. To bend the supporting leg: Eccentric hip and knee extensors. PRIME STABILIZERS: Hip internal and external rotators to maintain parallel alignment. Hip flexors and knee extensors of the unsupported leg to maintain the leg reaching over the Telescoping Toe Bar. Lateral spinal rotators and lateral flexors to maintain equal weightbearing and neutral position in the pelvis and spine. Scapular stabilizers to limit shoulder elevation and cervical tension. Deep lumbo-pelvic musculature to support the spinal column and to facilitate the hydraulic amplifier mechanism. INCLINE GUIDELINE: 8 to 1—Adjust the incline lower for torso focus. 1 to 8—Adjust incline higher for extremity focus. STARTING POSITION: Disconnect the pulley from the glideboard 330. Push the glideboard 330 halfway up the rails, straddle the glideboard 330 and sit at the bottom edge. Place the heels on the Telescoping Toe Bar. With the legs parallel and hip distance apart, extend the knees. Dorsiflex the ankles, bringing them into a neutral position. Lie back with the pelvis near the bottom of the glideboard 330, ensuring head is fully supported. Ensure the spine and pelvis are in a neutral position. Rest the arms to the sides of the body or place the hands on the pelvis for feedback. Lower the glideboard 330 by bending both the knees to 90°. Extend one leg over the Telescoping Toe bar with the foot softly pointed. EXERCISE DESCRIPTION: Inhale—To prepare. Exhale—To extend the leg pressing the glideboard 330 up the incline. Maintain the unsupported leg in the same position. Inhale—To return the glideboard 330 to the start position. REPETITIONS: 8 to 10 times. TEACHING TIPS: Watch for greater weightbearing through the pelvis on the side of the unsupported leg. Maintain equal weight on each sit bone (ischial tuberosity). Watch for abduction or adduction of the unsupported leg. If the leg is abducting, bring the leg closer toward the midline of the body. If the leg is adducting, bring the leg out from the midline of the body. Watch for lateral trunk flexion. Keep the pelvis very still and maintain equal length from the rib to the pelvis on both sides. Watch for excessive end-range knee flexion of the supporting leg. Bend the knees to only 90°. Use the Slide Distance Regulator to control range of motion. Ensure that the Telescoping Toe Bar is appropriately adjusted. Watch for increased supination or pronation of the supporting foot. Press equally through the entire foot. If supinating, press the big toe toward the front of the room. If pronating, draw the arch of the foot up. Watch for pelvic shifting and tilting or loss of neutral spine. Visualize balancing a cup of water on the pelvis. Place the hands on the pelvis for feedback. Watch for initiation of the movement with the lumbar spine. Contract the front of the thigh first, then press the glideboard 330. Watch for hyperextension of the supporting knee. Maintain a soft bend in the knee or decrease the range of motion. Watch for proper femoral alignment. If the femur is internally rotated, turn the inner thighs toward the ceiling. If the femur is externally rotated, turn the inner thighs toward the floor. Watch for proper patellar tracking. If laterally tracking, increase activation of the medial aspect of the knee extensors, especially the vastus medialis obliques (VMO). If tracking medially, activate lateral knee extensors. Watch for loss of transverse abdominal activation as noted by the navel no longer being pulled in and up toward the spine. Pull the navel in toward the spine. Activating the inner thighs can also assist abdominal activation. PROGRESSIONS/VARIATIONS: To enhance body awareness, perform an abdominal curl with the hands by the sides or behind the head. Cue to observe neutral pelvis. SAFETY ASPECTS/CONTRAINDICATIONS: Spinal vulnerability, especially when spinal lateral trunk flexor and rotator weakness is present. Knee vulnerability, especially for those who hyperextend. Hip vulnerability, especially for those with hip precautions limiting flexion, adductor or external rotation. Participants with elbow vulnerability.

Pullover

ACCESSORY: Arm Pulley; Optional Support Wedge Pillow; Optional Slide Distance Regulator. OBJECTIVES: Strengthen shoulder extensors. Teach dissociation of the upper extremity and torso. Strengthen posterior spinal musculature in a supported position. PRIME MOVERS: To pull arms to the hips: Concentric shoulder extensors. To return the arms overhead: Eccentric shoulder extensors. PRIME STABILIZERS: Shoulder girdle stabilizers to limit shoulder elevation and cervical tension. Spinal flexors maintain proper thoracic positioning, i.e. limit thoracic extension. Knee and hip flexors to maintain hook-lying position. Spinal extensors and flexors to maintain neutral pelvic positioning. Deep lumbo-pelvic musculature to support the spinal column and to facilitate the hydraulic amplifier mechanism. INCLINE GUIDELINE: 1 to 8—Adjust incline higher to increase extremity focus. PIN PLACEMENT: Inner Middle for narrow frames. Outer Middle for broader frames. STARTING POSITION: Attach the Arm Pulley. Grasp the handles and pull the glideboard 330 halfway up the rails. Straddle the glideboard 330 and sit at the bottom edge facing away from the tower. Lie back, ensuring the head is fully supported. Place both feet on the glideboard 330, then move into a table top position (hips and knees bent to 90°). Reach the arms overhead toward the tower, palms facing up to the ceiling. Ensure spine and pelvis are in a neutral position. EXERCISE DESCRIPTION: Inhale—To draw the scapulae down the back. Exhale—To reach the arms straight down toward hips. Inhale—To reach the arms overhead. REPETITIONS: 5 to 10 times. TEACHING TIPS: Watch for shoulder elevation. Slide the scapulae down the back or to draw the shoulders away from the ears. Watch for hyperextension of the elbows. Maintain a soft bend in the elbows. Watch for shoulder protraction. Bring the arms further out to the side, allowing for a small space under the armpit. Think wide through the clavicles. Watch for the use of momentum. Slow down the movement. Count to four for each phase of the movement. Watch for hyperextension of the thorax. Slide the ribs together and down. Use the breath to facilitate the imprint. Watch for loss of neutral pelvis and abdominal activation. Visualize balancing a cup of water on the pelvis. Pull the navel in and up. Watch for cervical tension. Ensure that the shoulder girdle and thorax are stabilized. Lower the incline level, if needed. PROGRESSIONS/VARIATIONS: To challenge lateral stability and decrease the resistance, exercise one side at a time. To challenge spinal flexor strength and endurance, perform an abdominal curl with each pullover. To challenge lateral stabilization, extend one leg toward the ceiling. To decrease core stabilization, maintain both feet on glideboard 330. SAFETY ASPECTS/CONTRAINDICATIONS: Cervical strain or vulnerability. Shoulder vulnerability, especially for those with impingement, tendonitis or instability.

Hundred with Arm Pulley

ACCESSORY: Arm Pulley; Optional Support Wedge Pillow; Optional Slide Distance Regulator. OBJECTIVES: Building pelvic and lumbar stability. Building coordination of breath and movement. Increasing endurance of the scapular stabilizers. PRIME MOVERS: To flex the spine: Concentric spinal flexors and elbow extensors. To pump the arms up toward the ceiling: Eccentric shoulder extensors. To pump the arms down: Concentric shoulder extensors. To return the torso onto the glideboard 330: Eccentric spinal flexors. PRIME STABILIZERS: Spinal flexors to maintain spinal flexion throughout the extremity movements. Shoulder girdle stabilizers to limit shoulder elevation and protraction. Hip and knee extensors to maintain the legs in tabletop position. Hip adductors to maintain the legs together. Deep lumbo-pelvic musculature to support the spinal column and to facilitate the hydraulic amplifier mechanism. INCLINE GUIDELINE: 1 to 8—Adjust incline to increase scapular stabilization. PIN PLACEMENT: Inner Middle. STARTING POSITION: Attach the Arm Pulley. Grasp the handles and pull the glideboard 330 halfway up the rails. Straddle the glideboard 330 and sit at the bottom edge facing away from the tower. Lie back, ensuring the head is fully supported. Place both feet on the glideboard 330, then move into a table top position (hips and knees bent 90°). Bend the elbows to 90°. Palms face forward and fingertips reach toward the ceiling. Ensure spine and pelvis are neutral. EXERCISE DESCRIPTION: Inhale—To lengthen through the back of neck. Exhale—To flex the upper body, sliding the rib cage down toward pelvis. Extend the elbows, reaching the fingers to the front wall. Remain in flexion and . . . Inhale—To pulse the arms up and down 5 times without moving the glideboard 330. Exhale—To pulse the arms up and down 5 times without moving the glideboard 330. Repeat for 9 more sets of inhale and exhale, making a total of 100 pulses with the arms. Then . . . Inhale—To remain in flexion. Exhale—To return the torso onto the glideboard 330. REPETITIONS: 1 set of 100 pulses. TEACHING TIPS: Watch for inability to coordinate breath and movement. Inhale for three counts, exhale for 5 counts If experiencing any discomfort in the cervical region, support the cervical spine with one hand while the other arm pumps; then switch arms half way through. Watch for initiation of spinal flexion without stabilization in the torso. Initiate the sensation of sliding the ribs to the pelvis, then flex the torso. Watch for elbow hyperextension. Maintain a soft bend at the elbow. Watch for excessive thoracic flexion. Maintain the tip of the scapula on the glideboard 330. Watch for increased lumbar lordosis or stress to the lumbar spine. Lower the spine onto the glideboard 330 and perform only extremity movement. Lower the legs onto the glideboard 330. Pull the navel in and up and slightly flatten the low back to the glideboard 330. Watch for shoulder girdle elevation and protraction. Reach through the fingers, and pretend there is a rolled up newspaper under the armpit to keep the sensation of width through the clavicles. Watch for loss of abdominal activation. Pull the navel in and up. Watch for cervical stress or strain. Lower the head onto the glideboard 330. Lower the feet onto the glideboard 330. Ensure stabilization in the shoulder girdle and thoracic and lumbar spine. PROGRESSIONS/VARIATIONS: To challenge, extend one leg to a diagonal and as strength improves, allow for both legs to extend. Slow down the count and have the participants slowly raise the shoulder toward the ceiling for a count of five then lower down to a count of five. To decrease spinal flexor muscular endurance, lower the legs onto the glideboard 330. To challenge lateral stability with this exercise, extend one leg or scissor the legs for 5 counts then switch. Alternate or perform half the reps with one leg, then switch. SAFETY ASPECTS/CONTRAINDICATIONS: Spinal and sacroiliac vulnerabilities which are exacerbated by flexion. Cervical strain or vulnerability.

Snow Angel

ACCESSORY: Arm Pulley; Optional Support Wedge Pillow; Optional Slide Distance Regulator. OBJECTIVES: Strengthen shoulder adductors. Teach dissociation of the upper extremity and torso. Prepare for backstroke. PRIME MOVERS: To pull arms to the side: Concentric shoulder adductors. To return the arms to the side: Eccentric shoulder adductors. PRIME STABILIZERS: Shoulder girdle stabilizers to limit shoulder elevation and cervical tension. Spinal flexors to maintain proper thoracic positioning, i.e. limit excessive thoracic extension. Knee and hip flexors to maintain hook-lying position. Spinal extensors and flexors to maintain neutral pelvic positioning. Deep lumbo-pelvic musculature to support the spinal column and to facilitate the hydraulic amplifier mechanism. INCLINE GUIDELINE: 1 to 8—Adjust incline higher to increase extremity focus. PIN PLACEMENT: Inner Middle for narrow framed torsos. Outer Middle for broader framed torsos. STARTING POSITION: Attach the Arm Pulley. Grasp the handles and pull the glideboard 330 halfway up the rails. Straddle the glideboard 330 and sit at the bottom edge facing away from the tower. Lie back, ensuring the head is fully supported. Place both feet on the bottom edge of the glideboard 330. Abduct the arms to the sides, aligning the hands with the shoulders. Palms face forward. Ensure spine and pelvis are in a neutral position. EXERCISE DESCRIPTION: Inhale—To draw the scapulae down the back. Exhale—To reach the arms toward hips. Inhale—To return to the arms to the side. REPETITIONS: 5 to 10 times. TEACHING TIPS: Watch for the arms dropping below the shoulders toward the floor. Keep the arms lifted slightly in front of the shoulders. Reach the hands just above the hips. Watch for shoulder elevation. Slide the scapulae down the back or to draw the shoulders away from the ears. Watch for hyperextension of the elbows. Maintain a soft bend in the elbows. Watch for shoulder protraction. Bring the arms further out to the side allowing for a small space under the armpit. Think wide through the clavicles. Watch for the use of momentum. Slow down the movement. Count to four for each phase of the movement. Watch for hyperextension of the thorax. Slide the ribs together and down. Use the breath to facilitate the imprint. Watch for loss of neutral pelvis and abdominal activation. Visualize balancing a cup of water on the pelvis. Pull the navel in and up. Watch for cervical tension. Ensure that the shoulder girdle and thorax are stabilized. Lower the incline level, if needed. PROGRESSIONS/VARIATIONS: To challenge lateral stability and decrease the resistance, exercise one side at a time. To challenge spinal flexor muscular endurance, maintain and abdominal curl as the arms abducts and adduct. If unable to sustain spinal flexion, perform an abdominal curl with each repetition. To challenge lateral stabilization, extend one leg toward the ceiling. To challenge core stabilization, maintain both legs in tabletop position. Spine is imprinted to neutral. SAFETY ASPECTS/CONTRAINDICATIONS: Cervical strain or vulnerability. Shoulder vulnerability, especially for those with impingement, tendonitis or instability.

Triceps Press

ACCESSORY: Arm Pulley; Optional Support Wedge Pillow; Optional Slide Distance Regulator. OBJECTIVES: Strengthen elbow extensors. Increase scapular stabilization. Enhance spinal stabilization during upper extremity movement. PRIME MOVERS: To press the hands toward the glideboard 330: Concentric elbow extensors. To return the arms to the side: Eccentric elbow extensors. PRIME STABILIZERS: Shoulder girdle stabilizers to limit shoulder elevation and cervical tension. Spinal flexors to maintain proper thoracic positioning, i.e. limit thoracic extension. Knee and hip flexors to maintain hook-lying position. Spinal extensors and flexors to maintain neutral pelvic positioning. Deep lumbo-pelvic musculature to support the spinal column and to facilitate the hydraulic amplifier mechanism. INCLINE GUIDELINE: 1 to 8—Adjust incline higher to increase extremity focus. PIN PLACEMENT: Inner Middle for narrow framed torsos. Outer Middle for broader framed torsos. STARTING POSITION: Attach the Arm Pulley. Grasp the handles and pull the glideboard 330 halfway up the rails. Straddle the glideboard 330 and sit at the bottom edge facing away from the tower. Lie back, ensuring the head is fully supported. Place both feet on the bottom edge of the glideboard 330. While keeping the elbows close to the sides of the body, flex to approximately 90°. Palms face away from the tower, fingertips reach toward the ceiling. Ensure spine and pelvis are in a neutral position. EXERCISE DESCRIPTION: Inhale—To lengthen through the elbows. Exhale—To extend the elbows reaching the fingers toward the feet. Inhale—To bend the elbows reaching the fingers toward the ceiling. REPETITIONS: 5 to 10 times. TEACHING TIPS: Watch for shoulder elevation. Reach or lengthen the elbows away from the shoulders. Watch for hyperextension of the elbows. Maintain a soft bend in the elbows. Watch for shoulder protraction. Bring the arms further out to the side allowing for a small space under the armpit. Think wide through the clavicles. Watch for the use of momentum. Slow down the movement. Count to three for each phase of the movement. Watch for hyperextension of the thorax. Slide the ribs together and down. Use the breath to facilitate the imprint. Watch for loss of neutral pelvis and abdominal activation. Visualize balancing a cup of water on the pelvis. Pull the navel in and up. Watch for cervical tension. Ensure that the shoulder girdle and thorax are stabilized. Lower the incline level if needed. PROGRESSIONS/VARIATIONS: To challenge lateral stability and decrease the resistance, exercise one side at a time. To challenge spinal flexor muscular endurance, maintain and abdominal curl. If the participant is unable to sustain spinal flexion, perform an abdominal curl with each repetition. To, assist in isolating the triceps and limit the use of momentum, cue to tighten the triceps prior to the execution of the movement. To challenge lateral stabilization, extend one leg toward the ceiling. To challenge core stabilization, maintain both legs in tabletop position. Spine is imprinted to neutral. SAFETY ASPECTS/CONTRAINDICATIONS: Cervical strain or vulnerability.

Side Twist Kneeling

ACCESSORY: Arm Pulley; Optional Support Wedge Pillow; Optional Slide Distance Regulator. OBJECTIVES: Challenge spinal lateral rotators. Teach dissociation of the pelvis and torso. Increase spinal rotation. PRIME MOVERS: To rotate the torso: Concentric and eccentric spinal lateral rotators, especially the internal and external obliques. PRIME STABILIZERS: Shoulder flexors to maintain shoulder flexion. Shoulder girdle stabilizers, especially the scapular depressors and retractors to control shoulder elevation and deter overuse of the upper extremity. Spinal flexors and extensors to maintain neutral spine. Hip extensors to limit compensatory hip flexion. Deep lumbo-pelvic musculature to support the spinal column and to facilitate the hydraulic amplifier mechanism. INCLINE GUIDELINE: 1 to 8—Adjust incline higher to increase lateral torso strength. 8 to 1—Adjust incline lower to decrease cervical strain or for less upper extremity compensation. PIN PLACEMENT: Inner Middle. Note: Pin placement may vary depending on torso height. Note: Pin placement may vary to focus more on a specific muscle group. STARTING POSITION: Stand to one side of the rails and grasp the handles. Pull the glideboard 330 halfway up the rails. Place hands, knuckles down, in the glideboard 330 to stabilize movement. Kneel on the top portion of the glideboard 330 facing sideways. Use caution when kneeling on the exercise device 100. Rotate the torso toward the tower and lift the arms to shoulder level.

The hands will be together and aligned with the middle of the sternum. Ensure neutral pelvis. EXERCISE DESCRIPTION: Inhale—To drop the shoulders away from the ears and lengthen through the spine. Exhale—To rotate the torso away from the ladder. Initiate the movement from the obliques and not with the arms. Inhale—To stay and lengthen the spine. Exhale—To return the start position. REPETITIONS: 5 to 10 times. TEACHING TIPS: Watch for compensatory lumbar or pelvic rotation. Get feedback by placing one's hands on the low back and/or pelvis. Increase thoracic rotation. Watch for compensatory shoulder horizontal abduction and adduction. Hold an imaginary circle between the hands and only move the torso. Keep the hands in line with the breastbone and let the hands follow the breastbone not vice versa. Imagine a stirring motion with the arms. Watch for posterior pelvic rotation or leaning posteriorly with the torso. Lengthen the torso and keep the breastbone reaching forward. Make an arc with the arms. Tighten the buttocks. Watch for thoracic flexion or collapsing in the thorax. Reach through the fingertips during the movement. Keep wide through the clavicle. Keep the chest lifted with the ribs imprinted. Watch for increased weight bearing on the lateral aspect of the knees. Place weight through the medial aspect of the knees and increase activation of the inner thighs. Watch for excessive shoulder elevation and protraction. Drop the shoulder blades down the back and maintain a space between the arms and the torso. Watch for decreased cervical rotation. Keep the gaze on the hands during rotation or look to the side one is rotating toward. PROGRESSIONS/VARIATIONS: To intensify work of the spinal rotators, perform small pulses at the end or beginning of the motion. To decrease resistance, use one handle. To decrease core stabilization requirements, perform the motion sitting low kneeling or cross-legged. Cross legs the opposite direction to balance out the hip. To assist with traction between the glideboard 330 and the legs, use the Gravity Gripper. SAFETY ASPECTS/CONTRAINDICATIONS: Spinal vulnerability, especially when spinal lateral trunk flexor and rotator weakness are present. Pathologies exacerbated by kneeling or increased knee flexion.

Roll Back with Biceps Curl

ACCESSORY: Arm Pulley; Optional Support Wedge Pillow; Optional Slide Distance Regulator. OBJECTIVES: Teach dissociation of the pelvis and the lower extremities. Strengthen the spinal and elbow flexors. Enhance articulation of the spine into a "C" curve position. PRIME MOVERS: To roll back: Eccentric spinal and hip flexors. To bend the elbows: Concentric elbow flexors. To extend the elbows: Eccentric elbow flexors. To roll up: Concentric spinal and hip flexors. To roll into upright: Concentric spinal extensors. PRIME STABILIZERS: Shoulder girdle to control shoulder elevation and protraction. Shoulder flexors to maintain the arms shoulder level. Hip flexors extensors to facilitate posterior pelvic tilt. Knee flexors to maintain the knees in flexion and steady in space. Deep lumbo-pelvic musculature to support the spinal column and to facilitate the hydraulic amplifier mechanism. INCLINE GUIDELINE: 1 to 8—Adjust incline higher to intensify abdominal work. PIN PLACEMENT: Inner Middle. STARTING POSITION: Grasp handles and pull the glideboard 330 half way up the rails. Place the hands, knuckles down, on the glideboard 330 to stabilize the glideboard 330. Straddle the glideboard 330 facing the tower. Sit near the middle to bottom of the glideboard 330. Place the feet on the glideboard 330 with the knees slightly bent. Extend the arms with the palms facing up to the ceiling. Thoracic and cervical spine are in neutral. EXERCISE DESCRIPTION: Inhale—To draw the shoulders away from the ears and lengthen through the spine Exhale—To roll back initiating with increasing posterior pelvic rotation and lumbar flexion. The thoracic spine will simultaneously flex forming a "C" shape. Inhale—To stay. Exhale—To bend the elbows, drawing the fingertips toward the ears. Inhale—To extend the elbows. Exhale—To roll all the way forward, reaching the arms past the knees. Inhale—To extend the thoracic and cervical spine, returning to the start position. REPETITIONS: 5 to 10 times. TEACHING TIPS: Watch for hinging straight back versus rolling back. Tuck the pelvis under as if putting on a tight pair of pants. Watch for excessive shoulder elevation and protraction. Draw the scapulae together and down and have a small space between the arm and torso. Lift the collarbone or upper half of sternum without losing thoracic imprint and/or "C" curve. Watch for hyperflexion or overuse of the cervical flexors to initiate rolling up. Initiate rolling forward by imprinting the ribs or sliding the ribs toward the pelvis or deepening the abdominal activation. Watch for stress or strain in the cervical spine during the movement. Gaze up and over the knees. Watch for dropping the arms toward the floor. Keep the arms lifting toward the ceiling. PROGRESSIONS/VARIATIONS: To increase elbow flexor strength and endurance, stay in a "C" curve and continue to perform biceps curl. During inhalation and exhalation in the forward flexed position, draw awareness to breath into the lateral thoracic region of the thorax. To decrease coordination, eliminate bicep curl. SAFETY ASPECTS/CONTRAINDICATIONS: Spinal and sacroiliac vulnerabilities which are exacerbated by flexion. Hip vulnerability, especially for those with hip precautions limiting flexion, adductor or external rotation. Postural faults exacerbated by spinal flexion. Pathologies exacerbated by kneeling or increased knee flexion.

Prone Snow Angel

ACCESSORY: Arm Pulley. OBJECTIVES: Strengthen spinal and shoulders extensors. Strengthen scapular stabilizers. Maintain abdominal contraction during back extension. Increase spinal articulation into extension. PRIME MOVERS: To extend the shoulders: Concentric shoulder extensors. To flex the shoulders: Eccentric shoulder extensors. PRIME STABILIZERS: Shoulder girdle stabilizers, especially the scapular depressors, to limit excessive shoulder elevation. Spinal flexors and deep lumbo-pelvic musculature to support the spinal column and to facilitate the hydraulic amplifier mechanism. Hip flexors to assist in maintaining a neutral pelvis and limiting excessive lumbar lordosis. INCLINE GUIDELINE: 8 to 1—Adjust incline higher for upper extremity focus. PIN PLACEMENT: Inner Middle. STARTING POSITION: Grasp the handles and pull the glideboard 330 halfway up the rails. Straddle the rails and lie prone on the glideboard 330. Position the chest near the top of the edge of the glideboard 330. Laterally turn out the legs and softly point the feet. Reach the arms overhead with the palms facing the floor. Ensure spine is in a neutral position with the abdominals contracted. EXERCISE DESCRIPTION: Inhale—To draw the hands open toward the sides bringing the arm in line with the shoulder. Exhale—To extend the arm toward the hip. Simultaneously extend the cervical and thoracic spine. Inhale—To start to return the arms overhead while lowering the cervical and thoracic spine to neutral. Exhale—To completely return the arms overhead. REPETITIONS: 5 to 10 times. TEACHING TIPS: Watch for "popping" of the ribs or loss of abdominal connection. Keep the ribs knitted together and the navel pulled away from the glideboard 330. Watch for shoulder girdle elevation. Slide, don't press, the scapulae downward. If needed, alternate between scapular elevation and depression to find the mid point. Watch for over-activation of the upper trapezium. Maintain a slight bend in the elbows. Bring the arms further apart. Decrease the range of motion. Watch for extension beginning with the cervical then the thoracic spine. The tendency is to pivot primarily from the lumbar spine. To assist cervical and thoracic spinal extension, reach the clavicle or sternum up and away and provide tactile feedback between the scapulae. Watch for cervical hyperextension; Reach the crown of the head toward the tower. PROGRESSIONS/VARIATIONS: To focus primarily on strengthening shoulder extensors, eliminate cervical and thoracic extension. To challenge stability, perform the exercise unilaterally. Participants with increased lumbar lordosis may need a pad or pillow under the hips. To challenge breath and movement, perform the movement in 2 breaths. Inhale to extend, exhale to return to neutral. To challenge spinal extension, maintain the spinal extension and perform shoulder flexion and extension. SAFETY ASPECTS/CONTRAINDICATIONS: Spinal and sacroiliac vulnerabilities which are exacerbated by extension. Postural faults exacerbated by spinal extension. Shoulder vulnerability, especially for those with impingement, tendonitis or instability.

Kneeling Breast Stroke

ACCESSORY: Arm Pulley. OBJECTIVES: Improve spinal articulation. Challenge coordination. Strengthen shoulder, elbow, and spinal extensors. Enhance scapular control. PRIME MOVERS: To pull the arms toward the chest: Concentric elbow flexors. To lower and extend the arms: Concentric shoulder and elbow extensors and wrist pronators. To flex the spine: Eccentric spinal and hip extensors. Bring the arms overhead: Concentric shoulder lateral rotators. Eccentric shoulder extensors and adductors. To open the shoulder: Concentric shoulder lateral rotators, scapular retractors and wrist pronators. To roll the spine into neutral: Concentric spinal extensors. PRIME STABILIZERS: Shoulder girdle stabilizers to limit excessive elevation, protraction and excessive lateral rotation and to promote smooth scapular movement. Shoulder extensors and flexors work in conjunction to maintain optimal humeral positioning. Spinal flexors to limit excessive spinal extension and to maintain thoracic imprint. Knee flexors to maintain low kneeling position. Deep lumbo-pelvic musculature to support the spinal column and to facilitate the hydraulic amplifier mechanism. INCLINE GUIDELINE: 1 to 8—Adjust incline higher to increase extremity focus. PIN PLACEMENT: Inner middle. STARTING POSITION: Grasp the handles and pull the glideboard 330 halfway up the rails. Place the hands, knuckles down, on the glideboard 330 to stabilize the movement. Kneel toward the top of the glideboard 330, facing the tower. Reaching for the tower, extend the arms shoulder width apart with the palms facing each other. EXERCISE DESCRIPTION: Inhale—To prepare. Exhale—To bend the elbows, pulling the hands in toward the breastbone. Keep the elbows lifted to the sides. Inhale—To bring the elbows to the side of the body; simultaneously flex the cervical to lumbar spine. Exhale—To pronate the forearm then extend the elbows (tricep extension). Inhale—To laterally rotate humerus and abduct arms around toward the tower in a half moon shape. Exhale—To stay. Inhale—To laterally rotate the arm, opening the shoulder joint, and extend the spine one vertebra at a time into neutral. REPETITIONS: 8 to 10 times. TEACHING TIPS: Watch for hinging forward versus articulating into spinal flexion. Place a pole against the spine and peel the spine away from the pole. Watch for cervical hyperextension or hyperflexion when in the flexed position. Reach the crown of the head toward the tower. Watch for excessive spinal and hip flexion. Keep the chest and abdomen slightly lifted off the knees. PROGRESSIONS/VARIATIONS: To challenge lateral stabilization, perform one side at a time. To strengthen elbow extensors, add tricep extensions in the forward flexed position. To strengthen shoulder adductor, add shoulder adduction and abduction in the forward flexed position. To challenge core control and coordination, begin the exercise high kneeling and enter into low kneeling as the hands are pulled toward the chest. If knee discomfort is present, place a pillow underneath the feet or in between the heels and the buttocks. SAFETY ASPECTS/CONTRAINDICATIONS: Spinal and sacroiliac vulnerabilities which are exacerbated by flexion. Shoulder vulnerability, especially for those with impingement, tendonitis or instability. Postural faults exacerbated by spinal flexion. Hip vulnerability, especially for those with hip precautions limiting flexion, adductor or external rotation. Pathologies exacerbated by kneeling or increased knee flexion.

Semicircle

ACCESSORY: Telescoping Toe Bar; Optional Support Wedge Pillow; Optional Slide Distance Regulator. OBJECTIVES: Strengthen lower extremity and spinal extensors. Challenge stabilization of the pelvis and torso. Increase flexibility and articulation through the spine. Stretch the knee extensors and hip flexors. PRIME MOVERS: To lift the buttocks into a bridge position: Concentric spinal, hip, and knee extensors. To press the glideboard 330 up the incline: Concentric hip and knee extensors. To roll the spine into neutral and flexion: Eccentric then concentric spinal extensors and eccentric knee and hip extensors. To return the glideboard 330: Eccentric knee and hip extensors. PRIME STABILIZERS: Hip internal and external rotators, as well as hip abductors and adductors, to maintain proper femoral alignment. Spinal flexors to assist in maintaining thoracic imprint. Knee flexors to limit excessive knee extension. Spinal flexors and rotators to maintain neutral pelvis and limit pelvic shifting and tilting. Scapular stabilizers to limit shoulder elevation and cervical tension. Deep lumbo-pelvic musculature to support the spinal column and to facilitate the hydraulic amplifier mechanism. INCLINE GUIDELINE: 4 to 1—Adjust the incline lower for torso focus. 1 to 4—Adjust incline higher for extremity focus. PIN PLACEMENT: Inner Middle for narrow framed torso. Outer Middle for broader framed torso. STARTING POSITION: Disconnect the pulley from the glideboard 330. Push the glideboard 330 halfway up the rails, straddle the glideboard 330 and sit at the bottom edge. Place the balls of the feet on the Telescoping Toe Bar. Laterally rotate the legs, bringing the heels together. Extend and adduct the legs. Lie back with the pelvis near the bottom of the glideboard 330, ensuring head is fully supported. Bending the knees slightly, slide the torso down the glideboard 330 to bring the shoulder girdle to the bottom of glideboard 330. Bend the knees lowering the glideboard 330 and lift and squeeze the heels together. EXERCISE DESCRIPTION: Inhale—To press the glideboard 330 up the incline. Exhale—To lower the spine and pelvis toward the floor, focusing on articulating one vertebrae at a time. Allow the lumbar spine to extend. The hips and knees will enter into greater flexion. Inhale—To return the glideboard 330. Exhale—To articulate into a bridge position, allowing the hips and knees to increase extension. Repeat for a total of 3 times then reverse directions for 3 times REPETITIONS: 3 times each direction. TEACHING TIPS: Watch for excessive hip abduction. Maintain energy between the inner thighs. Watch for lifting versus rolling the spine into a bridge position. Watch for increased supination or pronation of the foot. Press equally through the entire foot. If supinating, press the big toe toward the front of the room. If pronating, draw the arch of the foot up. Watch for proper femoral alignment. If femur is internally rotated, turn the inner thigh toward the ceiling. If the femur is externally rotated, turn the inner thighs toward the floor. Watch for loss of thoracic imprint, "popping" of the ribs. "Knit" the ribs together. Watch for loss of transverse abdominal activation as noted by the navel no longer being pulled in and up toward the spine. Pull the navel in toward the spine. Activating the inner thighs can also assist abdominal activation. Watch for excessive weightbearing onto the cervical spine. Release the chest away from the chin. Weightbear on the shoulder girdle. PROGRESSIONS/VARIATIONS: To enhance body awareness, place the hands on the pelvis. To increase knee flexion, perform the same motion on the balls of the feet. To decrease the amount of knee and hip extension, decrease the height of the Telescoping Toe Bar. SAFETY ASPECTS/CONTRAINDICATIONS: Spinal and sacroiliac vulnerabilities which are exacerbated by flexion. Spinal and sacroiliac vulnerabilities which are exacerbated by extension. Cervical strain or vulnerability. Shoulder vulnerability, especially for those with impingement, tendonitis or instability. Knee vulnerability, especially for those with medial and lateral instability. Hip vulnerability, especially for those with hip precautions limiting flexion, adductor or external rotation. Pathologies exacerbated by kneeling or increased knee flexion. Participants with elbow vulnerability.

Stomach Massage: Round Back

ACCESSORY: Telescoping Toe Bar. OBJECTIVES: Strengthen muscular endurance in "C" curve position. Increase dissociation between the torso and lower extremities. Challenge coordination. PRIME MOVERS: To press the glideboard 330 out: Concentric hip extensors and knee extensors. To lower the heels: Eccentric ankle plantarflexors and gravity. To lift the heels: Concentric ankle plantarflexors. To return the glideboard 330: Eccentric hip extensors and knee extensors. PRIME STABILIZERS: Shoulder girdles stabilizers to limit excessive shoulder elevation and protraction. Spinal flexors to maintain the spine in a "C" curve. Hip extensors to assist in maintaining posterior pelvic tilt. Knee flexors to limit hyperextension. Spinal flexors and deep lumbo-pelvic musculature to support the spinal column and to facilitate the hydraulic amplifier mechanism. INCLINE GUIDELINE: 5 to 1—Adjust incline lower greater for torso control and extremity resistance. 1 to 5—Adjust incline to increase extremity resistance. STARTING POSITION: Disconnect the pulley from the glideboard 330. Push the glideboard 330 halfway up the rails, straddle the glideboard 330 and sit at the bottom edge. Place the balls of the feet on the Telescoping Toe Bar. Maintaining the knees flexed, laterally rotate the legs to bring the heels together. Posteriorly rotate the pelvis and flex the spine into a "C" curve position. Reach the arms under the outside of the thighs, holding onto the glideboard 330. EXERCISE DESCRIPTION: Inhale—To press the glideboard 330 up the incline by extending the hips and knees without changing the spinal position. Lower and lift the heels. Exhale—To return the glideboard 330 without changing spinal position. REPETITIONS: 8 to 10 times. TEACHING TIPS: Watch for loss of the "C" curve or excessive thoracic flexion. Imagine flexing up and over an imaginary ball. Watch for shoulder elevation. Drop the shoulders away from the ears. Change the width of the arms. Ensure the elbows are not hyperextended. Watch for loss of abdominal activation. Draw the navel in toward the spine and up toward the crown of the head. Watch for separation of the heels. Maintain the heels together throughout the movement. Hold a small pad between the heels to assist with activation. PROGRESSIONS/VARIATIONS: To decrease coordination, eliminate the lower the lift of the heels. SAFETY ASPECTS/CONTRAINDICATIONS: Knee pathology limiting knee flexion. Lumbar spine and sacroiliac vulnerabilities. To assist with learning the movement pattern, place the hands on the Telescoping Toe Bar. Practice pressing the glideboard 330 out and controlling it, all while maintaining the spine flexed.

Stomach Massage: Flat Back

ACCESSORY: Telescoping Toe Bar. OBJECTIVES: Strengthen spinal extensor muscular endurance. Increase dissociation between the torso and lower extremities. Challenge coordination. PRIME MOVERS: To press the glideboard 330 out: Concentric hip extensors and knee extensors. To lower the heels: Eccentric ankle plantarflexors and gravity. To lift the heels: Concentric ankle plantarflexors. To return the glideboard 330: Eccentric hip extensors and knee extensors. PRIME STABILIZERS: Shoulder girdle stabilizers to limit excessive shoulder elevation and protraction. Spinal extensors to maintain thoracic and cervical extension. Hip extensors and spinal flexors to assist in maintaining posterior pelvic tilt and lumbar flexion. Knee flexors to limit hyperextension. Spinal flexors and deep lumbo-pelvic musculature to support the spinal column and to facilitate the hydraulic amplifier mechanism. INCLINE GUIDELINE: 5 to 1—Adjust incline lower for greater torso control and extremity resistance. 1 to 5—Adjust incline to increase extremity resistance. STARTING POSITION: Disconnect the pulley from the glideboard 330. Push the glideboard 330 halfway up the rails, straddle the glideboard 330 and sit at the bottom edge. Place the balls of the feet on the Telescoping Toe Bar. Maintaining the knees flexed, laterally rotate the legs to bring the heels together. Posteriorly rotate the pelvis while extending the thoracic and cervical spine. Flex the arms to shoulder level, aligning the hands with the middle of the sternum. EXERCISE DESCRIPTION: Inhale—To press the glideboard 330 up the incline by extending the hips and knees without changing the spinal position. Lower and lift the heels. Exhale—To return the glideboard 330 without changing spinal position. REPETITIONS: 8 to 10 times. TEACHING TIPS: Watch for loss of thoracic extension. Keep the chest lifted and the sternum reaching forward. Watch for shoulder elevation. Drop the shoulders away from the ears. Change the width of the arms. Ensure the elbows are not hyperextended. Watch for loss of abdominal activation. Draw the navel in toward the spine and up toward the crown of the head. Watch for separation of the heels. Maintain the heels together throughout the movement. Hold a small pad between the heels to assist with activation. PROGRESSIONS/VARIATIONS: To decrease coordination, eliminate the lower and lift of the heels. To challenge upper extremity strength, hold a large ball between the hands. To challenge coordination, reach the arms to shoulder level as the hips and knees extend and lower the arms to the side as the hips and knees flex. SAFETY ASPECTS/CONTRAINDICATIONS: Knee pathology limiting knee flexion. Lumbar spine and sacroiliac vulnerabilities.

Long Stretch

ACCESSORY: Telescoping Toe Bar. Optional Slide Distance Regulator OBJECTIVES: Strengthen spinal extensors in a plank position. Teach dissociation of the extremities and torso. Promote shoulder girdle stabilization in a closed chain environment. PRIME MOVERS: To press the glideboard 330 up the incline: Concentric shoulder flexors and scapular depressors. To return the glideboard 330: Eccentric shoulder flexors and scapular depressors. PRIME STABILIZERS: Spinal extensors to maintain spinal extension. Hip flexors and extensors to maintain neutral pelvic positioning. Knee extensors to maintain knee extension. Shoulder girdle stabilizers to limit excessive shoulder elevation and protraction, as well as scapular winging. Hip adductors to maintain the inner thighs connected. Spinal flexors to maintain thoracic imprint. Deep lumbo-pelvic musculature to support the spinal column and to facilitate the hydraulic amplifier mechanism. INCLINE GUIDELINE: 1 to 4—Adjust incline to increase extremity focus. STARTING POSITION: Straddle the glideboard 330 facing away from the tower. Place the hands on the Telescoping Toe Bar bringing the hands, elbows, and shoulders into alignment. The wrists are neutral. Enter into a plank position by placing the feet toward the top of the glideboard 330. Ensure the legs are extended and adducted with the spine in neutral. EXERCISE DESCRIPTION: Inhale—To press the glideboard 330 up the incline without changing the position of the spine and pelvis. Exhale—To slowly return the glideboard 330. REPETITIONS: 5 to 10 times. TEACHING TIPS: Watch for excessive posterior rotation of the pelvis and dropping of the pelvis closer to the glideboard 330. Lift the pelvis toward the ceiling. Watch for piking or increased hip flexion. Tighten the buttocks. Watch for increased knee flexion. Contract the front of the thighs. Watch for excessive shoulder elevation. Draw the scapulae down the back. Increase the width of the arms. Ensure that the elbows are not hyperextended. Press through the heel of the hand. Watch for excessive wrist extension. Keep the wrists in a straight line. Change hand position on the Telescoping Toe Bar if needed. Ensure that the shoulder girdle is stabilized. Watch for hyperextension of the elbows. Turn the elbow joints to face back. Maintain a soft bend in the elbow. Watch for loss of thoracic imprint. Keep the ribs knitted together. Watch for loss of abdominal activation. Pull the navel in and up. PROGRESSIONS/VARIATIONS: For the beginner, perform the same motion on the knees. The pelvis will be posteriorly rotated and the spine straight. Focus on shoulder extension and flexion. To regulate range of motion, use the Slide Distance Regulator. To decrease stabilization requirements, move the feet hip to shoulder distance apart. SAFETY ASPECTS/CONTRAINDICATIONS: Spinal and sacroiliac vulnerabilities which are exacerbated by extension. Cervical strain or vulnerability. Shoulder vulnerability, especially for those with impingement, tendonitis or instability. Wrist vulnerability, especially for those with carpal tunnel. Precautions limiting weightbearing through the upper extremity.

Down Stretch

ACCESSORY: Telescoping Toe Bar; Optional Slide Distance Regulator. OBJECTIVES: Strengthen and stretch spinal extensors. Teach dissociation of the extremities and torso. Promote shoulder girdle stabilization in a closed chain environment. PRIME MOVERS: To articulate into extension: Concentric spinal and hip extensors. To press the glideboard 330 up the incline: Concentric shoulder flexors and scapular depressors. To return the glideboard 330: Eccentric shoulder flexors and scapular depressors. To return to the start position: Concentric spinal and hip flexors then eccentric hip and spinal extensors. PRIME STABILIZERS: Spinal extensors to maintain spinal extension. Hip extensors to maintain hip extension. Knee extensors to maintain knee extension. Shoulder girdle stabilizers to limit excessive shoulder elevation and protraction, as well as scapular winging. Spinal flexors to maintain thoracic imprint. Deep lumbo-pelvic musculature to support the spinal column and to facilitate the hydraulic amplifier mechanism. INCLINE GUIDELINE: 1 to 4—Adjust incline to increase extremity focus. STARTING POSITION: Straddle the glideboard 330 facing away from the tower. Place the hands on the Telescoping Toe Bar. Kneel on the glideboard 330 by placing the feet toward the middle to top of the glideboard 330 while bending and resting the knees on the glideboard 330. Dorsiflex the ankles. Flex the spine and sit the buttocks toward the heels. Allow the arms to reach overhead while maintaining the elbows slightly bent. EXERCISE DESCRIPTION: Inhale—To prepare. Exhale—To press the glideboard 330 up the incline while articulating the spine into extension. Inhale—To continue pressing the glideboard 330 while entering into full spinal extension without arching. Then . . . Exhale—To maintain the spine in extension and slowly return the glideboard 330 by extending the shoulders to full range without losing scapular stabilization. Inhale—To press the glideboard 330 up the incline, maintaining the spine in extension. Repeat the above 2 more times. To finish. Exhale—To remain with the arms extended and the glideboard 330 up the incline and begin to flex the spine, hips and knees back to the start position. Initiate with the sacrum-flexion and ending with cervical flexion. Focus on articulating one vertebra at a time. Allow the glideboard 330 to slowly return. REPETITIONS: 1 set of 3 times. TEACHING TIPS: Watch for excessive lumbar lordosis. Lift the pelvis up using the abdominals and engage the buttocks to assist with hip extension. Watch for rolling onto the lateral aspect of the knee joint. Evenly distribute the weight across the knees by increasing the weight on the medial aspect of the knee. Watch for excessive shoulder elevation. Draw the scapulae down the back. Increase the width of the arms. Ensure that the elbows are not hyperextended. Press through the heel of the hand. Watch for excessive wrist extension. Keep the wrists in neutral position. Change hand position of the Telescoping Toe Bar if needed. Ensure that the shoulder girdle is stabilized. Watch for hyperextension of the elbows. Turn the elbow joints to face back. Maintain a soft bend in the elbow. Watch for loss of thoracic imprint. Keep the ribs knitted together. Watch for loss of abdominal activation. Pull the navel in and up. Watch for cervical hyperextension. Maintain the length in the back of the neck. Watch for decrease in spinal extension as the glideboard 330 tracks up the incline. Keep lifted in the breastbone (sternum) and look ahead versus toward the floor. PROGRESSIONS/VARIATIONS: To decrease the required flexibility, decrease the range of motion. Use the Slide Distance Regulator. To decrease spinal extensor muscular endurance, only perform one repetition, then return the glideboard 330 to the start position. SAFETY ASPECTS/CONTRAINDICATIONS: Spinal and sacroiliac vulnerabilities which are exacerbated by extension. Shoulder vulnerability, especially for those with impingement, tendonitis or instability. Hip vulnerability, especially for those with hip precautions limiting flexion, adductor or external rotation. Postural faults exacerbated by spinal extension. Precautions limiting weightbearing through the upper extremity. Pathologies exacerbated by kneeling or increased knee flexion.

Mermaid

ACCESSORY: Telescoping Toe Bar. OBJECTIVES: Stretch the spinal lateral flexors. Stretch the hip rotators. Enhance spinal and shoulder flexibility. Increase upper extremity weight bearing. PRIME MOVERS: To lift the arm: Concentric shoulder abductors. To press the carriage out: Concentric scapular depressors and eccentric shoulder adductors. To return the glideboard 330: Eccentric scapular depressors and shoulder adductors. To lower the arm to the concentric side: Eccentric shoulder abductors. To laterally flex the torso: Concentric then eccentric spinal lateral flexors. To return the torso to neutral: Concentric spinal lateral flexors. PRIME STABILIZERS: Shoulder girdle stabilizers to limit excessive shoulder elevation and protraction. Spinal flexors, extensors, and especially the lateral rotators, to maintain postural alignment and limit any compensatory movements. Deep lumbo-pelvic musculature to support the spinal column and to facilitate the hydraulic amplifier mechanism. INCLINE GUIDELINE: Level 2 to 1—Adjust incline lower to increase lateral flexion. STARTING POSITION: Stand to the side of the exercise device 100 with back to the rails. Grasp the handles and pull the glideboard 330 halfway up the rails. Sit toward the top of the glideboard 330 facing sideways. Bend the leg closest to the tower behind the body (internally rotated and flexed) and cross the leg closest to the Telescoping Toe Bar in front of the body (externally rotated and flexed). Place the hand closest to the Telescoping Toe Bar on top, and place the other hand on the leg closest to the tower, palm facing up. EXERCISE DESCRIPTION: Inhale—To lift the arm (left) toward the ceiling. Exhale—To laterally flex the spine toward the Telescoping Toe Bar while pressing the glideboard 330 up the incline. Inhale—To laterally flex the spine to neutral while adducting the arm right to return the glideboard 330. Exhale—To lower the arm left on the knee closest to the tower. Inhale—To lift the arm right from the Telescoping Toe Bar toward the ceiling. Exhale—To laterally flex the spine toward the tower. Inhale—To laterally flex the trunk to neutral. Exhale—To return the hand right to the Telescoping Toe Bar. Repeat 3-5 times then switch sides. REPETITIONS: 3 to 5 times per side. TEACHING TIPS: Watch for the pelvis lifting as the spine laterally flexes. Decrease the range of motion for lateral flexion. Press the hip toward the glideboard 330 during lateral flexion. Watch for shoulder elevation versus spinal lateral flexion. Open space between the lower rib and hip. Drop the shoulders away from the ears and lengthen from the torso versus the shoulder. Watch for spinal rotation during lateral flexion. Keep the collarbones parallel to the font. Imagine rotating the trunk to the ceiling when laterally flexing. Watch for loss of abdominal activation. Pull the navel in and up toward the crown of the head. PROGRESSIONS/VARIATIONS: To increase stretch of the lateral trunk rotators, maintain lateral flexion for a longer duration. If unable to sit in the position, sit crossed-legged or side-sitting. SAFETY ASPECTS/CONTRAINDICATIONS: Spinal and sacroiliac vulnerabilities which are exacerbated by flexion and rotation. Spinal vulnerability, especially when spinal lateral trunk flexor and rotator weakness is present. Hip vulnerability, especially for those with hip precautions limiting flexion, adductor or external rotation. Precautions limiting weightbearing through the upper extremity. Pathologies exacerbated by kneeling or increased knee flexion.

Long Back Stretch

ACCESSORY: Telescoping Toe Bar; Optional Slide Distance Regulator. OBJECTIVES: Strengthen elbow extensors. Enhance control for spinal articulation. Promote shoulder girdle stabilization in a closed chain environment. PRIME MOVERS: To bend the elbows: Eccentric elbow extensors. To press the glideboard 330 up the incline: Concentric spinal flexors and hip and shoulder extensors. To extend the elbows: Concentric elbow extensors. To return the glideboard 330: Eccentric spinal flexors and hip and shoulder extensors. PRIME STABILIZERS: Knee extensors to maintain knee extension. Shoulder girdle stabilizers to limit excessive shoulder elevation and protraction. Hip adductors to maintain the inner thighs connected. Ankle dorsiflexors to maintain the feet flexed. Spinal flexors to maintain thoracic imprint. Deep lumbo-pelvic musculature to support the spinal column and to facilitate the hydraulic amplifier mechanism. INCLINE GUIDELINE: 1 to 4—Adjust incline to increase extremity focus. STARTING POSITION: Straddle the glideboard 330 facing the tower. Place the hands on the Telescoping Toe Bar with the palms facing forward and sit on the Bar. Place the feet on the glideboard 330, dorsiflexed. Press down into the Telescoping Toe Bar and lift the buttocks off the Bar. Ensure spine and pelvis are in a neutral position. EXERCISE DESCRIPTION: Inhale—To prepare. Exhale—To bend the elbows lowering the torso. Press the glideboard 330 up the incline by posteriorly rotating the pelvis and flexing the lumbar spine. Allow the elbows to extend. Inhale—To return the glideboard 330 by anteriorly tilting the pelvis, return the pelvis and lumbar spine to neutral. Repeat 3 to 5 times then reverse directions. REPETITIONS: 3 to 5 times each way. TEACHING TIPS: Watch for loss of posterior pelvic tilt. Tighten and lift the buttocks. Watch for compensatory knee flexion. Tighten the front of the thighs. Watch for excessive shoulder elevation. Draw the scapulae down the back. Increase the width of the arms. Ensure that the elbows are not hyperextended. Press through the heel of the hand. Watch for excessive wrist extension. Keep wrists in a straight line. Change hand position on the Telescoping Toe Bar if needed. Ensure that the shoulder girdle is stabilized. Watch for loss of thoracic imprint. Keep the ribs knitted together. Watch for loss of abdominal activation. Pull the navel in and up. PROGRESSIONS/VARIATIONS: To focus on scapular depression, perform only shoulder elevation and depression by lifting and lowering the buttocks and torso off the Telescoping Toe Bar. To decrease coordination, eliminate elbow flexion and extension. Practice only scooping the pelvis to push the glideboard 330 up the incline and controlling the glideboard 330 down the incline. To regulate range of motion, use the Slide Distance Regulator. To decrease stabilization requirements, place the feet hip to shoulder distance apart. To focus on increasing elbow extensor strength, perform only elbow flexion and extension. SAFETY ASPECTS/CONTRAINDICATIONS: Spinal and sacroiliac vulnerabilities which are exacerbated by flexion. Shoulder vulnerability, especially for those with impingement, tendonitis or instability. Knee vulnerability, especially for those with medial and lateral instability. Knee vulnerability, especially for those who hyperextend. Precautions limiting weightbearing through the upper extremity.

Side Splits: Abduction

ACCESSORY: Standing Platform; Optional Slide Distance Regulator. OBJECTIVES: Challenge core stabilization. Strengthen and control hip adductors and abductors. Increase lower extremity stabilization and balance. PRIME MOVERS: To press the glideboard 330 up the incline: Concentric hip abductors of the leg on the glideboard 330 and eccentric hip adductors of the leg on the Standing Platform. To return the glideboard 330: Concentric hip adductors. PRIME STABILIZERS: Hip and spinal flexors and extensors to maintain pelvis in neutral. Knee flexors and extensors to maintain the knees in extension and limit hyperextension. Shoulder abductors to maintain the arms in abduction. Shoulder girdle stabilizers, especially the scapular depressors, to limit shoulder elevation. Spinal lateral flexors to limit hip hiking. Deep lumbo-pelvic musculature to support the spinal column and to facilitate the hydraulic amplifier mechanism. INCLINE GUIDELINE: 3 to 1—Adjust incline lower for torso and extremity focus. STARTING POSITION: Remove the Telescoping Toe Bar and attach the Standing Platform. Disconnect the arm pulley. Stand to the side of the exercise device 100 and place both feet on the Standing Platform, facing sideways. Place the foot closest to the tower on the glideboard 330, toward the middle to bottom edge. Abduct the arms to the sides, hands aligned with the shoulders and palms facing down. Ensure pelvis and spine are in a neutral position. EXERCISE DESCRIPTION: Inhale—To draw the shoulders away from the ears. Exhale—To press the glideboard 330 up the incline, keeping equal weight through the feet. Inhale—To return the glideboard 330. REPETITIONS: 5 to 10 times. TEACHING TIPS: Watch for unequal weightbearing through the feet. Keep the torso and hips in line and equal weight on each foot. Watch for increased lumbar lordosis or loss of neutral. Tighten the buttocks or tuck the pelvis under as if one were putting on a tight pair of pants. Watch for "popping" of the ribs or loss of abdominal connection. Keep the ribs knitted together and the navel pulled up toward the crown of the head. Watch for shoulder girdle elevation. Reach down toward the floor and back toward the hips. Ensure the elbows are not hyperextended. Maintain a slight space between the torso and the arms. Watch for the torso leaning forward. Maintain the hips and shoulders aligned. Watch for knee flexion or hyperextension. Keep active in the front of the thighs and pull the kneecaps upward. Watch for internal or external rotation of the lower extremities. Keep the kneecaps facing forward. Make sure there is not excessive pronation or supination of the feet. PROGRESSIONS/VARIATIONS: To control range of motion, use the Slide Distance Regulator. To increase coordination, add unilateral or bilateral arm movements or head turning (cervical rotation like in "chest expansion") SAFETY ASPECTS/CONTRAINDICATIONS: Spinal vulnerability, especially when spinal lateral trunk flexor and rotator weakness is present. Knee Vulnerability, especially for those with medial and lateral instability. Knee vulnerability, especially for those who hyperextend.

Side Splits: Plié In

ACCESSORY: Standing Platform; Optional Slide Distance Regulator. OBJECTIVES: Challenge core stabilization. Strengthen and control hip adductors and abductors. Increase lower extremity stabilization and balance. PRIME MOVERS: To press the glideboard 330 up the incline: Concentric hip abductors of the leg on the glideboard 330 and eccentric hip adductors of the leg on the Standing Platform. To bend the knees: Eccentric knee extension To extend the knees: Concentric knee extension. To return the glideboard 330: Concentric hip adductors. PRIME STABILIZERS: Hip and spinal flexors and extensors to maintain pelvis in neutral. Knee flexors and extensors to maintain the knees in extension and limit hyperextension. Shoulder abductors to maintain the arms in abduction. Shoulder girdle stabilizers, especially the scapular depressors, to limit shoulder elevation. Spinal lateral flexors to limit hip hiking. Deep lumbo-pelvic musculature to support the spinal column and to facilitate the hydraulic amplifier mechanism. INCLINE GUIDELINE: 3 to 1—Adjust incline lower for torso and extremity focus. STARTING POSITION: Remove the Telescoping Toe Bar and attach the Standing Platform. Disconnect the arm pulley. Stand to the side of the exercise device 100 and place both feet on the Standing Platform, facing sideways. Place the foot closest to the tower on the glideboard 330, toward the middle to bottom edge. Arms rest at the sides of the body. Ensure pelvis and spine are in a neutral position. EXERCISE DESCRIPTION: Inhale—To draw the shoulders away from the ears. Exhale—To press the glideboard 330 up the incline, keeping equal weight through the feet. Inhale—To bend the knees while keeping the spine upright. Exhale—To return the glideboard 330. Inhale—To extend the legs while keeping spine upright. REPETITIONS: 5 to 10 times. TEACHING TIPS: Watch for increased hip flexion as the knees bend. Tighten the buttocks and keep the chest lifted. Watch for unequal weightbearing through the feet. Keep the torso and hips in line and equal weight in the feet. Watch for increased lumbar lordosis or loss of neutral. Tighten the buttocks or tuck the pelvis under like putting on a tight pair of pants. Watch for "popping" of the ribs or loss of abdominal connection. Keep the ribs knitted together and the navel pulled away from the glideboard 330. Watch for shoulder girdle elevation. Reach the hands down toward the floor and back toward the hips. Ensure the elbows are not hyperextended. Maintain a slight space between the torso and the arms. Watch for the torso leaning forward. Maintain the hips and shoulders aligned. Lean the torso slightly backwards. Watch for internal or external rotation of the lower extremities. Keep the kneecaps facing forward. Make sure there is not excessive pronation or supination of the feet. PROGRESSIONS/VARIATIONS: To control range of motion, use the Slide Distance Regulator. To increase coordination, add unilateral or bilateral arm movements or head turning (cervical rotation like in "chest expansion") SAFETY ASPECTS/CONTRAINDICATIONS: Spinal vulnerability, especially when spinal lateral trunk flexor and rotator weakness is present. Knee vulnerability, especially for those with medial and lateral instability. Knee vulnerability, especially for those who hyperextend.

Side Splits: Plié Out

ACCESSORY: Standing Platform; Optional Slide Distance Regulator. OBJECTIVES: Challenge core stabilization. Strengthen and control hip adductors and abductors. Increase lower extremity stabilization and balance. PRIME MOVERS: To press the glideboard 330 up the incline: Concentric hip abductors of the leg on the glideboard 330 and eccentric hip adductor of the leg on the Standing Platform. To bend the knees: Eccentric knee extension. To extend the knees: Concentric knee extension. To return the glideboard 330: Eccentric hip abductors and concentric hip adductors. PRIME STABILIZERS: Hip and spinal flexors and extensors to maintain pelvis in neutral. Knee flexors and extensors to maintain the knees in extension and limit hyperextension. Shoulder abductors to maintain the arms in abduction. Shoulder girdle stabilizers, especially the scapular depressors, to limit shoulder elevation. Spinal lateral flexors to limit hip hiking. Deep lumbo-pelvic musculature to support the spinal column and to facilitate the hydraulic amplifier mechanism. INCLINE GUIDELINE: 3 to 1—Adjust incline lower for torso and extremity focus. STARTING POSITION: Remove the Telescoping Toe Bar and attach the Standing Platform. Disconnect the arm pulley. Stand to the side of the exercise device 100 and place both feet on the Standing Platform, facing sideways. Place the foot closest to the tower on the glideboard 330, toward the middle to bottom edge. Arms rest at the sides of the body. Ensure pelvis and spine are in a neutral position. EXERCISE DESCRIPTION: Inhale—To bend the knees and draw the shoulders away from the ears. Exhale—To press the glideboard 330 up the incline, keeping equal weight through the feet. Inhale—To extend the knees without changing the position of the spine. Exhale—To return the glideboard 330. REPETITIONS: 5 to 10 times. TEACHING TIPS: Watch for increased hip flexion as the knees bend. Tighten the buttocks and to keep the chest lifted. Watch for unequal weightbearing through the feet. Keep the torso and hips in line and equal weight in the feet Watch for increased lumbar lordosis or loss of neutral. Tighten the buttocks or tuck the pelvis under like putting on a tight pair of pants. Watch for "popping" of the ribs or loss of abdominal connection. Keep the ribs knitted together and the navel pulled away up to the crown of head. Watch for shoulder girdle elevation. Reach the hands down toward the floor and back toward the hips. Ensure the elbows are not hyperextended. Maintain a slight space between the torso and the arms. Watch for the torso leaning forward. Maintain the hips and shoulders aligned. Lean the torso backward. Watch for internal or external rotation of the lower extremities. Keep the kneecaps facing forward. Make sure there is not excessive pronation or supination of the feet. PROGRESSIONS/VARIATIONS: To control range of motion, use the Slide Distance Regulator. To increase coordination, add unilateral or bilateral arm movements or head turning (cervical rotation like in "chest expansion") Option: Perform in turn out. SAFETY ASPECTS/CONTRAINDICATIONS: Spinal vulnerability, especially when spinal lateral trunk flexor and rotator weakness is present. Knee vulnerability, especially for those with medial and lateral instability. Knee vulnerability, especially for those who hyperextend.

Double Leg Pulley: Short Spine

ACCESSORY: Double Leg Pulley System with Foot Loops; Optional Slide Distance Regulator; Optional Cable Extensions. OBJECTIVES: Stretch and strengthen spinal and hip extensors. Enhance spinal articulation. Challenge spinal stabilization and control. PRIME MOVERS: To hinge the legs toward the body: Eccentric hip extensors. To bring the legs overhead: Concentric spinal and hip flexors. To laterally rotate and bend the knees: Concentric hip and knee flexion to initiate, then eccentric hip and knee extensors to control. To roll the spine onto the glideboard 330: Gravity and eccentric spinal flexors and eccentric hip extensors and knee flexors. To extend the legs to a diagonal: Concentric hip internal rotator and extensors and knee extensors. PRIME STABILIZERS: Shoulder girdle stabilizers to limit shoulder elevation and excessive cervical strain. Hip extensors to limit excessive hip flexion as legs hinge toward the body and as the hip and knees flex toward the body. Spinal lateral flexors and rotators to limit shifting or lateral tilting. Deep lumbo-pelvic musculature to support the spinal column and to facilitate the hydraulic amplifier mechanism. INCLINE GUIDELINE: Level 1 to 2—Adjust incline higher to increase extremity focus and torso. STARTING POSITION: Disconnect the arm pulley. The Telescoping Toe Bar may be on or off. Holding the foot loops in one hand straddle the glideboard 330, facing away from the tower. Sit with the buttocks near the bottom edge of the glideboard 330. Place the feet on the floor in front of the body. Lie back, ensuring the head is fully supported. Separate the foot loops into each hand. Press the glideboard 330 halfway up the rails and bring one knee into the chest to place the foot into the loop. Hold this leg stationary while bringing the other knee into the chest to place the foot in the remaining loop. Extend and adduct the legs to a diagonal. The legs are parallel to begin. Place the hands to the sides of the body, palms facing down and fingertips reaching long. Ensure the pelvis and spine are in a neutral position. EXERCISE DESCRIPTION: Inhale—To hinge the legs toward the body. Exhale—To flex the hips and spine to reach the legs toward the ceiling then toward the tower. The weight of the body rests across the shoulder girdle region and not on the cervical spine. Inhale—To externally rotate the legs and bend the hips and knees toward the shoulders. Maintain the heels together and only flex the hips and knees to 90°. Exhale—To roll the spine onto the glideboard 330 one vertebra at a time while maintaining the heels still in space. Inhale—To pull the heels toward the buttocks and roll the rest of the spine and the pelvis onto glideboard 330. Exhale—To internally rotate the legs to parallel and extend the legs to a diagonal. REPETITIONS: 5 to 8 times. TEACHING TIPS: Watch for stress or strain in the cervical spine. Draw the chin away from the chest. Decrease the range of motion. Use the Slide Distance Regulator. Watch for lifting versus peeling the spine off the glideboard 330. Provide assistance to the feet/lower extremity to roll over. Watch for shifting or tilting of the pelvis. Limit the range of motion and encourage greater activation of the spinal flexors and transverse abdomonis. Watch for excessive abduction of the thighs as the knees and hips bend in space. Keep energy between the inner thighs. Maintain the knees in line with shoulders. Do not allow them to drop to the outside of the shoulders. Watch for heels dropping in space or excessive hip flexion as the spine rolls onto the glideboard 330. Keep a space between the thighs and the torso. Provide assistance by holding the heels in space. Watch for stress or strain to the lumbar spine or hip extensors as the lumbar spine and pelvis roll onto the glideboard 330. Allow for the heels to lower in space as the spine rolls onto the glideboard 330. Decrease range of motion for spinal flexion. Watch for loss of abdominal activation. Pull the navel in and up toward the crown of the head. Watch for cervical hyperextension and hyperflexion. To decrease cervical hyperflexion, allow the chest to pull away from chin or to soften the chest. To decrease cervical hyperextension, cue to drop, not press, the chin toward the chest. PROGRESSIONS/VARIATIONS: To decrease stress on the hip extensors, add a cable extension. Note this will increase the work of the spinal flexors. To decrease coordination, eliminate hip external rotation. Maintain the legs in parallel as the knees and hips bend in space. To intensify, hover the hands about an inch above the glideboard 330. As strength and control improve, perform the movement with a neutral pelvis. SAFETY ASPECTS/CONTRAINDICATIONS: Spinal and sacroiliac vulnerabilities which are exacerbated by flexion. Cervical strain or vulnerability. Hip vulnerability, especially for those with hip precautions limiting flexion, adductor or external rotation. Postural faults exacerbated by spinal flexion. Participants with previous hamstring strain or pull. Participants with high blood pressure, aneurysms, or any related pathology should avoid an inverted position that brings greater blood flow to the cerebral region.

Double Leg Pulley: Long Spine

ACCESSORY: Double Leg Pulley System with Foot Loops; Optional Slide Distance Regulator; Optional Cable Extensions. OBJECTIVES: Increase spinal flexibility. Increase spinal flexor strength and control. Stretch the hip extensors and knee flexors dynamically. PRIME MOVERS: To hinge the legs toward the body: Eccentric hip extensors. To roll the spine off the glideboard 330: Concentric spinal and hip flexors. To open the legs: Concentric hip abductors. To roll down: Gravity and eccentric spinal flexors and hip extensors. To hinge legs away: Concentric hip extensors. To close the legs: Concentric hip adductors. PRIME STABILIZERS: Spinal extensors to limit excessive trunk flexion, especially as the spine rolls onto the glideboard 330. Shoulder girdle stabilizers to limit shoulder elevation and cervical strain. Knee extensors and flexors to maintain knee extension without hyperextension. Hip internal and external rotators to maintain optimal femoral alignment with the legs in parallel. Deep lumbo-pelvic musculature to support the spinal column and to facilitate the hydraulic amplifier mechanism. INCLINE GUIDELINE: 2 to 1—Adjust incline lower to decrease torso focus. STARTING POSITION: Disconnect the arm pulley. The Telescoping Toe Bar may be on or off. Holding the foot loops in one hand straddle the glideboard 330, facing away from the tower. Sit with the buttocks near the bottom edge of the glideboard 330. Place the feet on the floor in front of the body. Lie back, ensuring the head is fully supported. Separate the foot loops into each hand. Press the glideboard 330 halfway up the rails and bring one knee into the chest to place the foot into the loop. Hold this leg stationary while bringing the other knee into the chest to place the foot in the remaining loop. Extend and adduct the legs to a diagonal. The legs are parallel to begin. Place the hands to the sides of the body, palms facing down and fingertips reaching long. Ensure the pelvis and spine are in a neutral position. EXERCISE DESCRIPTION: Inhale—Adduct and hinge the legs toward the body. Exhale—Peel the pelvis and spine off the glideboard 330, sending the legs toward the ceiling. The weight of the body rests across the shoulder girdle region and not on the cervical spine. Inhale—To open the legs shoulder distance. Exhale—Keeping the legs abducted, press into the straps and roll the spine onto the glideboard 330 one vertebra at a time. Inhale—To hinge the legs away from the body. Repeat rolling over with legs adducted for 3 Repetitions Then reverse direction for 3 repetitions. The reverse will be with the legs abducted to roll over and adducted to roll down. REPETITIONS: 1 set of 3 rollovers with legs adducted and 3 rollovers with legs abducted. TEACHING TIPS: Watch for knee flexion. Contract the front of the thighs and reach the legs long. Watch for transverse abdomonis activation, especially during spinal flexion and extension. Pull the navel in and up toward the crown of the head. Watch for cervical hyperextension and hyperflexion. To decrease cervical hyperflexion, allow the chest to pull away from chin or to soften the chest. To decrease cervical hyperextension, drop, don't press, the chin toward the chest. Watch for rolling onto the cervical region versus the shoulder girdle region. Keep the scapulae in contact with the glideboard 330. Limit the range of motion for spinal flexion until better core control is attained. Watch for use of the upper extremity to propel oneself over or control the rolling down. Have the hands hover over the glideboard 330 or bring them overhead. (This intensifies the movement.) Watch for articulation of the spine. "Peel" the spine off the board one vertebra at a time. Watch for excessive hip flexion as the spine rolls onto the glideboard 330. Keep the space between the thighs the same distance as the spine rolls onto the glideboard 330. Watch for dropping versus rolling the spine onto the glideboard 330. Decrease the range of motion until greater control is achieved. Provide assistance by holding the feet. PROGRESSIONS/VARIATIONS: To teach the choreography to the beginner, eliminate spinal flexion. To focus more on the lateral hip rotators, perform the movement with legs laterally rotated. To intensify, hover the hands about an inch above the glideboard 330. As strength and control improve, perform the movement with a neutral pelvis. To increase hip range of motion, add a cable extension. Note this will increase the work of the spinal flexors. SAFETY ASPECTS/CONTRAINDICATIONS: Spinal and sacroiliac vulnerabilities which are exacerbated by flexion. Knee vulnerability, especially for those with medial and lateral instability. Knee vulnerability, especially for those who hyperextend. Hip vulnerability, especially for those with hip precautions limiting flexion, adductor or external rotation. Postural faults exacerbated by spinal flexion. Cervical strain or vulnerability. Participants with high blood pressure, aneurysms, or any related pathology should avoid an inverted position that brings greater blood flow to the cerebral region.

Post-Rehab

Introduction: POST-REHAB is a safe and effective program designed to focus on movement dysfunction of the shoulder, lumbar spine and knee. The program provides a series of exercise progressions that allow for a sequential approach to post-rehabilitation in the health club environment. Importantly, the focus is on training of the muscles surrounding the joint rather than the treatment of a specific joint pathology. This approach to post-rehabilitation is possible if you consider that each joint complex, due to its skeletal and muscular system, is designed to move and function in a specific manner. Therefore, it is possible to progress through a series of specific exercises (in a pain-free environment) that will strengthen the stability and function of the joint complex. To minimize any damage to the muscular skeletal system, pain-free is the key consideration during the progressional exercise sequencing. However, it should be observed that significant limitations in range of motion and strength of a movement may be clear indications that the client should seek medical advice.

POST-REHAB is designed to fit within a personal fitness trainer's scope of practice by focusing on the training and conditioning of the function of the joint complex rather than treating a specific diagnosis, which should only be performed by a physical therapist or physician. Clear guidelines are given to assist the personal fitness trainer in determining when a client's joint aliment is beyond the scope of the program and the client should be asked to seek medical help. In addition to the individual conditioning of the involved joint complex, POST-REHAB includes a total body conditioning program to help realize the overall fitness objectives of the client.

The POST-REHAB program can be divided into three stages: awareness, pre-positioning and dynamic. The first stage of the program, 'awareness', involves the client focusing on improving proprioception and coordination of the joint complex and the surrounding local muscle system. This is followed by the 'pre-positioning' stage, which begins to improve the function of the joint complex by initiating specific, controlled movement patterns. Finally, the 'dynamic' stage progresses the client into loaded functional tasks designed to increase the strength and functionality of the joint complex and its relationship to multi-joint movements. All three stages work together progressively to achieve the POST-REHAB objective: to improve the movement dysfunction of a joint complex and incorporate it into functional movement patterns while ensuring conditioning of the total body.

POST-REHAB in the Health Club Industry: Following a physical injury or surgery, physical therapy is one of the first steps to returning to an active lifestyle. Unfortunately, the amount of sessions provided for by the healthcare system often prevents an individual from achieving his or her complete rehabilitation objectives. Many times patients are sent home prematurely, with limited knowledge of future do's and don'ts to complete their transition to an active lifestyle. Generally, that person will either do nothing and never achieve full potential for joint strength and movement, or return to activity prematurely and unsupervised, risking re-injury.

In observing the sequence of events that surrounds an injury, it becomes apparent that a cyclic sequence exists. Below is a representation of the possible stages that a moderately active individual may experience in the unfortunate occurrence of an injury.

Active lifestyle>injury>surgery/acute care>physical therapy>(premature) active lifestyle>injury (process repeats)

In this example, a premature return to an active lifestyle can produce a compound injury or reoccurrence of the original injury, leading back to the cyclic process of care and treatment. However, adding an opportunity for the training of an existing movement dysfunction in a joint complex in a controlled environment like a health club may be the missing piece for a long-term active lifestyle. With any activity there is a risk of re-injury, but when appropriate training of the injured joint complex occurs, the risk of re-injury is minimized.

Active lifestyle>injury>surgery/acute care>physical therapy>HEALTH CLUB active lifestyle>injury?

In recent years the health club industry has identified the business opportunity that exists through accessing a client demographic that requires some form of continued training of a movement dysfunction. And in doing so, clubs have looked for business opportunities to incorporate physical therapists into their health club facilities. Unfortunately, the variance among the respective business philosophies seems to make such a partnership difficult in most cases. Therefore, the next step is to educate the personal fitness trainers in the clubs to be able to assist with the continued training of the injured joint complex while promoting a professional relationship between the trainer and therapist. So far, the incorporation of post-rehab programs in the health club has been only mildly successful. This moderate success could be credited to a number of possibilities: 1) limited education of post-rehab guidelines for the personal fitness trainer; 2) a club's inability to market to the pertinent population; 3) inappropriate equipment and application in the facility. POST-REHAB provides the solution to these issues.

The present system includes the pairing of post-rehab guidelines and exercises approved and accredited by leading physical therapists with the exercise device 100, one of the most effective pieces of post-rehabilitative equipment in the industry. POST-REHAB provides the necessary information and training to apply a specific exercise sequence for the three most common joint complexes that experience movement dysfunctions: the lumbar spine, shoulder and knee.

It should be noted, POST-REHAB does not allow personal fitness trainers to diagnose or provide care outside of the scope of this course. Trainers should always refer clients to their general care provider or orthopedic specialist if persistent pain occurs.

Client Demographics: POST-REHAB provides the personal trainer an opportunity to provide professional help to a new client demographic who is currently training with a movement dysfunction or is seeking help following an injury. Among POST-REHAB clients, movement dysfunctions may be caused by a number of different reasons and will result in a variety of injury patterns. A comprehensive health and lifestyle history questionnaire (see Classifying Your Client below) will clarify the client's background and assist in future programming. Some of the types of clients a trainer can anticipate working with include: people with a chronic injury; overweight clients; the sporadic athlete (i.e., "weekend warrior"); people with specific lifestyle habits needing to be addressed, such as repeated heavy lifting, a sedentary job, etc.; referrals from physical therapists.

Although the clients will have a variety of backgrounds and causes for their movement dysfunction, the POST-REHAB program addresses the common experience of joint pain and/or movement dysfunction through the "training, not treatment" approach. The exercises will be consistent within the program outlined for each joint complex (shoulder, lumbar spine or knee), and each stage (awareness, pre-positioning or dynamic), so individual objectives will not be addressed. However, once the client has successfully completed the POST-REHAB program and is ready to return to full activity, his or her health history and personal objectives will play a role in determining the next programming goals.

The Post-rehab Network: In order to maximize the client's outcomes, it is ideal for the POST-REHAB trainer and the client's physical therapist to work together. While this may not always be possible, it is recommended that the trainer communicate with the therapist to report on the client's status and progress. This will help ensure that the POST-REHAB program avoids any contraindications for the client, based on the physical therapist's prior assessments and treatments. In the event that a contraindication occurs, the trainer will have an open line of communication to refer the client back to the therapist if needed.

For communication and/or a working relationship between the physical therapist and the trainer to be successful, it is imperative that the physical therapist clearly understands the "training not treatment" approach of the POST-REHAB program. It is the trainer's responsibility to explain this approach to the therapist and be able to describe how it fulfills a secondary stage of rehabilitation, following the primary stage delivered by the therapist. The physical therapist should feel confident that the trainer will in no way take on the therapist's role of diagnosing and treating a specific joint ailment, but rather will help progress the client toward returning to an active lifestyle by addressing a movement dysfunction.

Trainers should be aware that the physical therapy industry has numerous approaches to treatment and an individual therapist's philosophy will play an integral role in determining the type of relationship that is established. Regardless of the level of involvement from the physical therapist, the POST-REHAB program is designed to provide a sound and effective approach to assist the client in returning to an active, functional lifestyle.

In addition to maximizing the client's outcomes, a good working relationship with the physical therapist provides the opportunity for a two-way referral system between therapist and trainer. By referring clients in need of a physical therapist, the trainer further strengthens his or her professional relationship with the therapist, and the therapist can directly assist the trainer in building his or her business. In some cases a physical therapist may use a personal trainer to assist in other on-site conditioning programs, within the physical therapy clinic.

Principles of Post-Rehab

Position Statement: The POST-REHAB program is designed on training a joint complex that has a movement dysfunction, not on identifying a treatment strategy for a specific pathology. By doing so, the program not only assists in improving functionality of a joint complex, but also, importantly, falls within the scope of practice of a personal fitness trainer. Careful consideration is given to identifying any contraindications that will direct the personal fitness trainer to cease the program and ask the client to seek medical advice.

The POST-REHAB program approaches a muscular and skeletal ailment through an understanding that the human body is designed to move not in isolation but as a network of joint complexes. Each joint complex is made up of a series of structures including muscles, bones, ligaments, tendons, etc. Due to their skeletal and muscular systems, these joint complexes are designed to function in a precise manner and through specific movement patterns. However, each movement pattern is rarely isolated to a single joint complex and its surrounding tissues, but rather incorporates the involvement of other joints and their structures. When an injury occurs, a part of the joint complex's structure is affected, causing a movement dysfunction. A movement dysfunction can be defined as a pathological change of a joint complex's range of motion and strength, possibly with regions of pain. An acute injury is often diagnosed and treated by the medical community, including physical therapists, by utilizing a series of therapeutic exercises to gradually restore normal function of the affected area. Further treatment may be given by the physical therapist to restore normal function of the individual's local muscular system in order to reduce future problems and/or reduce pain (see Local and global stability below).

Following treatment with a physical therapist, continued care may be required to maximize the function of the joint complex and its utilization within the network of structures that are required for movement. POST-REHAB continues this care through identifying the movement dysfunction and utilizing a progressional sequence of exercises that are safe and performed pain-free. Importantly the focus is on training of the structures of the joint complex rather than the treatment of a specific joint pathology. Training of a movement dysfunction rather than pathology (specific injury) is effective when you consider that numerous pathologies will produce the same movement dysfunction. Therefore, it minimizes the need to know the specific pathology and allows the trainer to focus on restoring the normal loading capacity of the joint complex. (This principle is also used in acute rehabilitation with careful attention given to loading and the ability of the structure to cope with this loading. The initial step in all rehabilitation programs is to reduce the loading to achieve a level in which the structure can cope, and then progressively increase the load so that the structure can adapt without further injury. If pain occurs it is always important to reduce the loading or range of motion.)

POST-REHAB utilizes the above guidelines in its training program by ensuring that all exercises are performed pain-free, and a strict exercise sequence and loading guidelines are followed. At all times high quality and control of movement patterns are enforced through careful observation by the personal fitness trainer. With its sequential exercises, each program requires the joint complex to move through an array of movements without producing uncontrolled transfer movements to adjacent areas. The program utilizes training of the complete global muscular system by incorporating a series of total body conditioning exercises. These are performed in conjunction with the training exercises of the specific joint complex in order to maximize the program's outcomes through the mimicking of functional movements that occur in everyday life.

Classifying Your Client

Medical Clearance: Prior to beginning a new exercise program, it is important that a complete medical clearance has been given by the client's physician. For the POST-REHAB client who has been under the care of a physical therapist, it is recommended that the physical therapist also provides clearance. The trainer should have permission from the client to share program details as needed with the physical therapist and/or physician.

Health and Lifestyle History: As with any personal training client, a post-rehab client's health and lifestyle history should be evaluated to provide a comprehensive understanding of past and present activities, medical concerns, health issues and lifestyle habits. Such information is essential for effective programming and to help prevent future health problems.

Most health clubs and trainers already use some type of standardized health history form, such as the PAR-Q, however it may be necessary to create an additional form to collect any information not covered in their standardized form. To be comprehensive, a health and lifestyle history evaluation should include: General demographics: Age, sex and education; Social history: Cultural beliefs and behaviors, family and social activities; Medical/surgical history: Medications, disease diagnosis, surgeries, health issues, etc.; Social/health habits: Smoking, exercise, etc.; Current conditions: Concerns or needs of client, symptoms, limitations, etc.; Joint Assessment—Determining Movement Dysfunction.

Prior to beginning the POST-REHAB program, the joint complex's limitations must be observed in order to determine the degree of movement limitation and to find the pain-free range of motion. The client must be spared as much discomfort as possible and should feel confident that no harm will be imposed. This course will not outline a structured assessment for the trainer to perform; the personal trainer should determine limitations on range of motion and strength by understanding a specific joint complex's normal and acceptable range of motion and comparing it with the client's ability to move within that range. Often a comparative observation can be made to the range of motion and strength of the opposite joint when considering the knee and shoulder joint complexes.

In addition to visual observations to determine the pain-free range of motion, the trainer should include the following questions as part of the initial questionnaire: What is the problem? This open ended question can provide you with an immediate determination of any contraindications that may require the individual to seek medical treatment prior to this program. What movement is difficult? A visual analysis of the movement dysfunction and feedback on the degree of pain will assist in determining the proper amount of initial loading (incline). This pre-assessment can also be utilized to gauge levels of improvement throughout the course of the program. What is/are your objective(s)? Determine the short and long term objectives of the client. Ensure that the objectives are realistic and in the best interest of the client. What has been your course of rehabilitation? Determine the timeline of rehabilitation (if any) and the medical personnel who have been involved. Are you aware of any restrictions (as recommended by the physical therapist or physician)? It is essential that all movement/activity restrictions that have been provided following diagnosis and treatment be followed. Any contradiction of these within the POST-REHAB program should be avoided. Do you have any exercise guidelines given to you by your physical therapist or physician? Prescribed exercises should be incorporated into the program, assuming they are able to be performed pain-free and executed with control.

Initial Contraindications: Clients who meet any of the following criteria during initial assessment or during any part of the program must be referred to their physical therapist or physician for further evaluation: Acute or painful injury that greatly limits movement; Acute injury without diagnosis; Painful state that is not limited by movement; Loss of movement without pain.

Total Body Conditioning: In training today the word "functional" is used very often, and often without definition. For the purpose of clarity, this program will define "functional movement" as the occurrence of purposeful, controlled and safe use of the body to achieve activity goals. Functional movement has four conditions. First, the center of gravity must be controlled under a number of different postures and weight-bearing conditions. Second, we must have the physical capacity to accomplish our movement goal. This is the functional definition of strength. Third, we must have a selection of both the requisite movement "tools" and strategies. Fourth, we must be able to discriminate and interpret various sensory inputs from the visual, somatic, and vestibular systems. POST-REHAB helps to accomplish this by using exercise sequences that progress from proprioception and control to strength and endurance. Therefore the program targets not only the specific joint complex, but incorporates a total body approach.

Each joint complex is a vital member of a complete skeletal structure. Its function is affected by the surrounding muscles and their affiliation with other joints and/or origins. Therefore, in order to maximize the effectiveness and function of a single joint complex, it is important to consider that the body does not function in isolation but that most functional movements utilize an array of muscles and joints. Often, joint problems originate from an imbalance of strength and stability in other joint complexes. In such a case a compensation movement can occur causing the overuse or dysfunctional movements leading to injury to one or both joint complexes involved. Therefore, training the total body is essential in helping to strengthen and stabilize the other major joint complexes and prevent future compensation movement pattern from occurring. Within the POST-REHAB program, exercises focusing on the other major joint complexes are an essential part of the training philosophy to maximize client outcomes. These additional exercises also provide the important principle of a recovery period for the targeted joint complex throughout the training session. Each training session will incorporate three to four specific, targeted joint exercises intertwined with a complete set of total body conditioning exercises. The total body conditioning exercises minimize the involvement of the targeted joint while maximizing the benefits of resistance exercises on the exercise device 100.

Total body conditioning will also assist in preventing future injuries by increasing the body's overall metabolism and ensuring the body is balanced in muscle strength and joint range of motion. Following the program, the participant will have a greater awareness of his or her limitations and be able to appropriately modify movement behaviors to reduce the risk of injuries. The trainer will have the opportunity to promote the use of appropriate long-term functional movement behaviors, such as appropriate lifting and reaching techniques, to further assist the client's safe return to an active lifestyle.

Core Stability: Core stabilization has always been recognized as essential in functional movements. All skeletal muscles of the trunk and pelvic region are in some way responsible for the stabilization of the lower spine. To assist in understanding core stabilization and control, it is important to identify how spinal stability is possible.

Core Stability Defined: A simple definition of core stability is the ability to control the positioning of the spine while performing movement in the extremities (i.e. proximal stability with distal mobility). Controlling spine involves the ability to control the shoulder girdle and pelvis, due to their anatomical relationship with the spine. Core stability, through control of the spine, is the result of properly recruiting both the local and global muscle systems. The lumbar spine relies on the active support of its surrounding musculature. This 'active' support comes from four mechanisms: tension from the thoracolumbar fascia, the intra-abdominal pressure mechanism, the role of the paraspinal muscles and the role of deep lumbar extensors.

The thoracolumbar fascia (TLF) enhances posterior static and dynamic stability through its structural and muscular attachments. There are three layers of the fascia, each layer connecting muscles, and all layers feeding into the fascia of the spinal column. Increasing tension in the transversus abdominis (TVA), the internal obliques, and the rectus abdominis increases tension on the TLF. The increase in tension creates greater support for the spine and assists in equalizing pressures and forces on the spine. In addition, the increased tension of the TLF compresses the erector spinae and multifidus muscles, encouraging these to contract and resist spine flexion forces.

The lateral fibers of the TLF's middle layers blend with the fibers of the internal obliques and the TVA. Contraction of these muscles creates an increase in intra-abdominal pressures, which in turn increases the tension against the TLF. This mechanism is an important stabilizer during flexion and/or lifting activities.

The paraspinal muscles (interspinalas and intertransversarii) provide an individual stabilizing effect on their adjacent vertebrae, acting in a similar way to ligaments. The deep lumbar muscle, the multifidus, has been shown to be active throughout a full range of motion of the lumbar spine and during movements of the lower and upper limbs. The paraspinals and deep lumbar muscles appear to work together to create stabilization for the lumbar spine against rotational and extension forces.

From the information above, it is clear that active support of the spine comes from the deep muscles of the trunk and spine. However, core stabilization is not only a result of which muscles are recruited, but also the sequencing and timing of their recruitment.

The co-contraction of the TVA and multifidus muscles occurs prior to any movement of the limbs, and timing of coordination of these muscles is very significant. Of particular relevance to the POST-REHAB program, is that back injury patients are unable to recruit their TVA and multifidus muscles early enough to stabilize the spine prior to movement. The multifidus muscle shows poor recruitment in back injury patients. It will be critical in the POST-REHAB program to be aware of difficulties the back injury client may have related to core stabilization.

The Functional Result of Core Stability: Core stabilization allows an individual to perform a movement while maintaining good postural alignment, particularly in the lumbar-pelvic region by utilizing the local muscular system (see Local and global stability below). Without this core stability and the resulting neutral posture, the participant's movement technique may be compromised. Aside from an increased risk of injury, the movement will not be as effective or efficient as needed for the desired results. This is of particular concern in the POST-REHAB environment, where a participant's ability to improve his or her muscle function is directly related to performing the movements correctly.

Cycle of Injury as it Relates to Core Stability: Without stability at the body's core, other muscular imbalances can occur. If core stability is not addressed before attempting to rectify the additional muscular imbalances, they will persist, which often leads to an increased risk of repeated injury or overload. Addressing core stability in the POST-REHAB environment is essential for client outcomes and the prevention of future problems.

Neutral Pelvis and Lumbar Spine Positioning: The definition of "neutral position of spine" falls under different definitions, according to different people. For instance, one source may state that neutral spine is the midpoint between anterior pelvic tilt and posterior pelvic tilt. In this position the lumbar spine is considered to have a natural lordotic curvature and the sacral spine will maintain its natural kyphotic curvature (between flexion and extension). Others may state that neutral spine is the position in which the participant is pain-free. In POST-REHAB, the goal is to obtain and maintain a natural lordotic curve, however pain-free is the first objective and one should never move while experiencing pain.

Throughout all exercises it is important for the participant to be aware of and maintain a neutral and/or pain-free lumbar spine. To find the appropriate lumbar spine positioning, POST-REHAB provides exercises that focus on tilting of the pelvic girdle in a supine position. The personal trainer can assist in the participant's awareness of pelvic tilting by explaining that as the lumbar spine flattens out (flexion), the pelvis will tilt posteriorly, and alternatively, by increasing the lumbar curvature (extension), the pelvis will tilt anteriorly. Continuous cueing to maintain lumbar and pelvic position is important throughout all exercises.

Neutral positioning of the whole spinal complex is essential for successful core stability and exercise outcomes. The normal curvatures of the spine consist of anterior in the cervical section, posterior in the thoracic and anterior in the lumbar region. Again a neutral spine can be defined as the place where the participant is pain-free. Note that the convexity of the curves can vary slightly from individual to individual, so it is important to identify a genetically inherited curvature vs. poor posture and instability of the spine.

Local and Global Stability: The muscles and tendons that surround and maintain the structure and function of a joint are the key to its stability. Often when professionals speak of "stability" they will refer to the local and global stability of a joint. Therefore, in order to improve the stability of the joint, it is important to understand the local and global stabilizing muscle systems. Let's first look at defining the muscle systems.

The local muscle system provides support and control at a specific, individual joint. These muscles are primarily responsible for joint stabilization rather than joint movement and are usually deep and located close to the joint. Their anatomical positioning is often monoarticular (crossing one joint only) and is designed to increase joint stiffness and, hence, extrinsic mechanical stability. For example, biomechanically the transverse abdominis cannot contribute to extension, flexion or lateral flexion, but rather plays an important role in intersegmental stabilization by increasing stiffness of the spine. This is achieved by having a low contractile tone that is initiated prior to and maintained throughout the movement, regardless the direction of movement.

The global muscle system provides movement at a specific joint or region. These muscles are primarily responsible for movement of the joint and for balancing the external load that is being applied. They are generally multi-joint muscles (capable of moving and supporting several joints), and are designed for complex movement function. Their long, usual fusiform shape and often remote location to the joint provide for greater biomechanical opportunities to produce movement. Two examples are the rectus abdominis, which provides movement of the spinal complex, and the pectoralis major, which is a prime mover for the shoulder. The global muscle system is initiated regardless of the movement direction and is the foundation to all functional movements.

Understanding the characteristics of the local and global muscle systems allows us to more clearly define how stability is achieved from a local and global perspective.

Local stability is achieved by a local muscle system, providing support and control at a specific joint. For example, it maintains the position of each vertebra against each other and increases the "stiffness" of the spinal column. Stiffness between two skeletal structures is the key to its stability, and is produced by the low contractile tone provided by the local muscle system. This "tone" provides intersegmental stabilization, is essential for skeletal posture, and functions as the foundation to all movements. Fortunately, this stiffness or tone can occur with even a minimal amount of contraction. Only 25% of maximum voluntary contraction will result in 80% of possible total stiffness. This is important to appreciate that in everyday movements, a minimal activation of the local muscles will achieve a significant local stability.

Global stability is achieved by a global muscle system that provides movement at a specific joint or region. For example, it maintains the position of the trunk in relation to the pelvis through an individual's ability to know his or her skeletal positioning in space (proprioception). Global stability incorporates a person's ability to move while being aware of his or her center of gravity in relation to the base of support and the existence of all external forces. One's ability to counteract these external forces, including gravity, while moving with control, is the key to global stability.

When a normal, healthy individual performs a functional movement there will always be a contraction of the local muscle system prior the global ones. This sequence is important to ensure that the individual joint segments are stabilized first, therefore minimizing any additional joint movements beyond neutral. Each joint has a "neutral" range within which the joint can move without any structural consequences. A painful presentation may occur when this sequence of muscular contraction is reversed. For example, if at the initiation of a movement the global stabilizers contract prior to the local stabilizers, and this sequence occurs repeatedly over a period of time, it will produce excessive movement at the joint, which will result in greater friction and wear and tear at the joint site, producing pain. When this occurs the client requires therapeutic exercises, which focus on training the local muscle systems, in order to change the altered innervation pattern. Once this is achieved, focus can then be placed on training of the global muscle system, which occurs during a post-rehabilitation program. It is important to understand that by training the global muscle system, local stability will not be improved; the process to retrain the local muscle system should be achieved by a physical therapist.

The personal trainer can successfully improve global stability through functional exercises focusing on strength, endurance and balance training. However, as stated above, this type of training cannot assist in strengthening the local muscle system and re-establishing local stability. It is important for the personal trainer to be able to recognize symptoms that might be caused by a lack of local stability. Once a criterion has been identified, it is important that the client be referred to a physical therapist for possible treatment. The following list of criteria will assist in the identification of poor local muscle control. Exercise is pain-generating; Pain worsens with overload; Painful state occurs that is not limited by movement; There is no improvement over 10-12 sessions over 4 weeks; Symptoms increase (pain, reduced ROM, decrease in loading) over sessions; Feeling of poor joint control occurs; There is a sudden change of the correct movement pattern.

The 3 Stage Approach to Training a Movement Dysfunction: POST-REHAB is based on principles that are incorporated in rehabilitation within the physical therapy industry. These principles progress from formal motor skill training leading to gradual incorporation of skills into light functional tasks and progress to loaded functional tasks. Based on these principles, POST-REHAB approach the training of a movement dysfunction in 3 stages:

Awareness: To improve joint stability and restore full functional range of motion, it is essential that the client develops a correct perception of isolated muscle action and joint position. To do so, specific exercises are designed to enhance and develop a person's awareness of the position of the joint complex. The awareness stage focuses on improving proprioception and coordination of the joint and surrounding local muscle system. Be aware of fatigue due to intensity, focus is on proprioception and coordination (quality of movement) NOT strength or endurance.

Pre-positioning: Following the achievement of joint complex awareness the next step is progressively improve the function of the joint. To do so, specific exercises are designed to actively and passively position one section of a joint complex, preventing it from movement, while actively moving another. This occurs by isometrically contracting local muscle systems of a specific region while initiating functional movement with different levels of loading. The focus is on the quality and control of movement and the loading should be modified to achieve this.

Dynamic: The third stage is to allow the joint to progress into loaded functional tasks. These active movements of the joint complex through a pain-free range of motion focus on strength, endurance and appropriate range of motion. This final stage incorporates cognitive control of all stabilizing muscle systems as well as the application of long-term functional behaviors. During this stage a greater focus can be given to intensity however the quality and control of movement should never be compromised.

Principles of Training for Post-Rehab: The following list outlines basic training principles that should be followed in the POST-REHAB program: Warm up and cool down—Ensure the client has performed an adequate warm-up prior to beginning the exercises. Emphasis should be placed on raising the core temperature of the body and preparing the muscular-skeletal system for the work to be performed. Specific focus should be given to the targeted joint complex ensuring that an initial light load is used. Begin all warm-up exercises with a low intensity. At the end of the session include a cool-down to help the body recover and return to its pre-exercise levels. Emphasis should be placed on stretching the muscles worked during the session; Symptoms: Throughout each exercise, respect must be given to client symptoms; Pain: Regardless of the positions and actions described in the exercise templates, the client should always stay within a pain-free range of motion. In the event of pain, a decrease in the range of motion or a reduction in load should eliminate this symptom. If pain persists the exercise should be avoided and medical advice sought; Excessive heart rate and breathing: This typically indicates a load that is too high for the client and should be reduced. Clients who experience abnormal heart rate and breathing should cease exercising and seek medical advice; Neurological: Numbness and tingling in the extremities is often caused by poor blood supply or an impingement to the nerve system. A reassessment of positioning and movement pattern should occur, and if symptoms persist, cease the exercise; Breathing: The client should maintain normal breathing patterns while performing the exercises. Do not allow clients to hold their breath during any phase of the exercise; Quality of movement: The goal of POST-REHAB is to help clients regain functional range of motion and strength of a joint complex that has demonstrated a movement dysfunction. The movements required to perform the exercises listed are very specific and must be executed correctly in order to produce results. For quality control, the following should be considered: Speed: Slow to fast—Moving slowly allows more control both in the concentric and eccentric movement phases. As the client becomes more capable and proficient with a movement pattern, speed or tempo can increase; Range of motion: To ensure a pain-free environment progress from limited to full range of motion; Difficulty of movement: Be aware that the more difficult the exercise, the more quickly fatigue sets in, thus making it more challenging for the client to maintain quality of movement. In the case of fatigue allow for greater rest periods and/or reduce the load. Signs of fatigue are: Loss of coordination; Loss of quality of movement; Decreased range of motion. Lever: The length of the lever or distance between the resistance and the joint complex (axis) will often determine the amount of load at the joint. By reducing this distance, the torque at the joint will also be reduced, allowing for greater control and comfort. Intensity: The higher the intensity and/or load placed upon the joint complex, the more challenging it will be for the client to maintain quality of movement. Have the client work at a low intensity until quality of movement has been demonstrated, then progress with care. Magnitude: When determining programming for the client, consider the following: Load—Start with a low load while the client learns the movement pattern. Once adequate control and proper form have been established, increase the load by changing the incline level; Repetitions—All exercises should be performed for 12-15 repetitions. For unilateral exercises, perform the exercise for 12-15 repetitions on each side; Rest Period—To maximize the training effect, rest periods should vary depending upon the exercise intensity. With the POST-REHAB program, rest of targeted muscle groups is possible while performing the conditioning exercises. Sets—It is recommended the client perform 2-4 sets of each POST-REHAB exercise within a single training session. An exercise which proves to be difficult should be continued within a number of sessions until proficiency is achieved. Progression: Within POST-REHAB, progression is addressed in two ways: 1) within an individual exercise, the client may increase in load (incline) and 2) between exercises, having successfully completed an exercise the client will progress to the next exercise in sequence. This progression may be within a stage (i.e. pre-positioning) or it may involve incorporating the first exercise from the next stage (i.e. dynamic). Once the criteria of proficiency are met for an exercise, the trainer could then take the exercise out of the program and replace it with the next exercise in the sequence for the following session. The trainer will continue to repeat an exercise until proficiency is achieved, no matter the number of sessions it requires. The following are indications that the proficiency in an exercise has been achieved and it is safe to progress the client and include the next exercise in the sequence: Quality of movement has been demonstrated; The recommended number of repetitions is able to be performed with low exertion; Adequate muscular strength and endurance have been demonstrated; The client is able to properly execute the movement in a pain-free range of motion; In the event that the client completes an exercise with proficiency in a single session, he or she may progress to the next exercise in the sequence during the following session; Modifications: If the client is unable to perform the movement pattern described in the exercise, modify the lever, load or position on the glideboard 330 to ensure success; Training Contraindications: Clients who meet any of the following criteria during any part of the program must be referred to their physical therapist or physician for further evaluation: No improvement in 10-12 sessions over 4 weeks; Increase or changes in symptoms (pain, reduced ROM, decrease in loading) over sessions;

Homework: Become comfortable with the exercise device 100; Review position statement & program procedures; Learn all program contraindications; Practice exercises, cueing, positioning etc. (w/partner if possible); Rehearse program session prior to implementation.

Safety Considerations: When training on the exercise device 100, have clients consider the following: Always consult with a doctor before beginning any exercise program; Avoid baggy clothing on the exercise device 100 to prevent snagging or pulley jams; Tie back long hair when lying on the exercise device 100; Avoid dehydration by drinking adequate amounts of fluids before, during and after exercise; Use strict lifting techniques when adjusting levels on the exercise device 100; Ensure cross bar is secured in tower slot; Keep fingers above glideboard 330 at all times; Use the handles to maintain control of glideboard 330 at all times when using the cable pulley system; Body positioning on glideboard 330—minor adjustments may be required for different body types.

Sample Programming (lumbar spine): Each POST-REHAB session should address both the specific exercises for the joint complex as well as the total body conditioning exercises listed for that joint. The client should progress through the stages in order (Awareness, Pre-positioning and Dynamic), and the specific joint exercises are preferably performed in the order listed below. Conditioning exercises can be inserted throughout the session to build in rest periods for the joint.

Scenario: Client is new to a post-rehab training program targeting the lumbar spine. Below is an example of a session outline for the Awareness stage.

| Exercise | Reps | Sets | Level | Pin # |
|---|---|---|---|---|
| 1. Warm up (cardio) | | | | |
| 2. Pelvic rocking (Awareness #1) | 12-15 | 2 | 1 | N/A |
| 3. Conditioning #1 | 10-15 | 3 | | |
| 4. Single leg extension (Awareness #2) | 12-15 | 2 | 1 | N/A |
| 5. Conditioning #2 | 10-15 | 3 | | |
| 6. Single arm raise (Awareness #3) | 12-15 | 2 | 1 | N/A |
| 7. Conditioning #3 | 12-15 | 3 | | |
| 8. Conditioning #4 | 12-15 | 3 | | |
| 9. Squat (Awareness #4) | 10-15 | 2 | 4 | N/A |
| 10. Conditioning #5 | 12-15 | 3 | | |
| 11. Select Awareness Ex. which was most difficult | 10-15 | 2 | | |
| 12. Conditioning #6 | 12-15 | 3 | | |
| 13. Cool down (stretches) | | | | |

Scenario: Client has mastered Awareness exercises #1 and #2. Below is an example of a session outline demonstrating how to progress the client to the Pre-positioning stage.

| Exercise | Reps | Sets | Level | Pin # |
|---|---|---|---|---|
| 1. Warm up (cardio) | | | | |
| 2. Single arm raise (Awareness #3) | 12-15 | 2 | 1 | N/A |
| 3. Conditioning #1 | 10-15 | 3 | | |
| 4. Squat (Awareness #4) | 12-15 | 2 | 4 | N/A |
| 5. Conditioning #2 | 10-15 | 3 | | |
| 6. Hamstring curl (Pre-positioning #1) | 12-15 | 2 | 2 | N/A |
| 7. Conditioning #3 | 12-15 | 3 | | |
| 8. Conditioning #4 | 12-15 | 3 | | |
| 9. Abdominal pull-over (Pre-positioning #2) | 10-15 | 2 | 2 | 1 |
| 10. Conditioning #5 | 12-15 | 3 | | |
| 11. Select Awareness Ex. which was most difficult | 10-15 | 2 | | |
| 12. Conditioning #6 | 12-15 | 3 | | |
| 13. Cool down (stretches) | | | | |

POST-REHAB Exercises—LUMBAR SPINE

Joint Complex: Lumbar Spine.

Stage: Awareness.

Definition of Awareness:

To improve joint stability and, correspondingly, pain free functional movement, it is essential that the client develop a correct perception of isolated muscle action and joint position. To do so, specific exercises are designed to enhance and develop a person's awareness of the position of the joint. The awareness stage focuses on improving proprioception and coordination of the joint and surrounding local muscle system. Be aware of fatigue due to intensity; focus is on proprioception and coordination (quality of movement), NOT strength or endurance training.

Specific Objectives:

From performing the awareness exercises for the lumbar spine, the client should be able to find his or her neutral or pain free position, which is typically the mid-range between flexion and extension.

Initially, clients should be cued to use their hands to detect lumbar position. As lumbar position awareness increases, the client should be able to perform the exercises without using the hands for detection. The trainer may monitor the individual's lumbar stability by placing his or her hand under the spine.

Special Considerations:

If a client is unable to achieve and maintain a pain free, neutral lumbar position, instruct him or her to stay in a position as close to neutral as possible, without pain. The goal should be to progress the lumbar spine to a pain free and neutral position.

The following is an exemplary order of exercises and steps for AWARENESS for the LUMBAR SPINE using the exercise device 100: 1. Pelvic Rocking; 2. Single Leg Extension; 3. Single Arm Raise; 4. Squat. Each of these exercises is described in more detail below.

Exercise Name and Number: Pelvic Rocking—¼. Pulley Pin Placement: N/A. Incline Guideline: 1. Starting Position: Inverted Supine—Straddle the glideboard, facing the tower. Sit at the top edge of the glideboard 330 and lie back, making sure head is fully supported, with knees and hips slightly flexed and feet resting on the rails. Exercise Description: Begin by slightly rocking the pelvis forward and back. Client should focus on his or her awareness of whether the lumbar spine is in neutral, flexed or extended position. Teaching Tips: Maintain pain-free lumbar position throughout the exercise. Use hands placed palm up under the lumbar spine to detect pelvic tilting and lumbar position. Repetitions: 12-15 times. Sets: 2-4. Safety Aspects: Pelvic positioning is a client's awareness to determine the position of the lumbar spine by moving the pelvis. Therefore, the client is able to determine whether the lumbar spine is in neutral, flexed or extended position.

Exercise Name and Number: Single Leg Extension—2/4. Pulley Pin Placement: N/A. Incline Guideline: 1. Starting Position: Inverted Supine—Straddle the glideboard 330, facing the tower. Sit at the top edge of the glideboard 330 and lie back, making sure head is fully supported, with knees and hips slightly flexed and feet resting on the rails. Through pelvic rocking, obtain neutral or pain free lumbar position. Place the hands, palm up, under the lumbar spine. Exercise Description: While maintaining a neutral or pain-free lumbar position, extend one leg at a time, keeping contact between heel and rail. Slowly return to the Starting Position: Repeat for the desired number of repetitions: then change legs. Teaching Tips: Maintain neutral or pain-free lumbar position throughout the exercise. Use hands to detect lumbar position. Wear socks. Repetitions: 12-15 times on each leg. Sets: 2-4. Variation Knee Lift: Upon return, flex hip and lift knee towards the chest, maintaining neutral or pain free lumbar position.

Exercise Name and Number: Single Arm Raise—¾. Pulley Pin Placement: N/A. Incline Guideline: 1. Starting Position: Upright Supine—Push the glideboard 330 partway up the rails. Sit at the bottom edge of the glideboard 330, facing away from the tower. Lie back, ensuring head is fully supported, knees are flexed and feet placed against telescoping squat stand, shoulder-width apart. Through pelvic rocking, obtain neutral or pain free lumbar position. Place one hand under the lumbar spine palm up, the other arm is extended at the side, palm down. Exercise Description: While maintaining neutral or pain-free lumbar position, slowly raise extended arm overhead, then return to Starting Position: Repeat for the desired number of repetitions: then change arms. Teaching Tips: Maintain neutral or pain-free lumbar position throughout the exercise. Keep the knees slightly flexed. Use one hand to detect lumbar position. Repetitions: 12-15 times on each arm. Sets: 2-4.

Exercise Name and Number: Squat—4/4. Pulley Pin Placement: N/A. Incline Guideline: 4. Starting Position: Upright Supine—Push the glideboard 330 halfway up the rails. Straddle the glideboard 330 and sit at the bottom edge, facing away from the tower. Lie back with head resting on glideboard 330, legs extended but knees not locked, feet placed against telescoping squat stand, shoulder-width apart. Through pelvic rocking, obtain neutral or pain free lumbar position. Place both hands under the lumbar spine, palms up. Exercise Description: While maintaining neutral or pain-free lumbar positioning, lower the glideboard 330 to a squat position by flexing the knees. Slowly return to starting position. Teaching Tips: Use the hands to detect lumbar positioning. Be aware of degree of knee flexion, always maintaining a pain-free range of motion. Relax the head, neck and shoulders. Maintain neutral or pain free lumbar position throughout the exercise. Repetitions: 12-15 times. Sets: 2-4. Safety Aspects: Squat as deeply as possible without causing pain or loosing the position of the lumbar spine.

Stage: Pre-Positioning

Definition of Pre-Positioning:

Following the achievement of joint complex awareness the next step is to progressively improve the dynamic function of the joint. To do so, specific exercises are designed to actively and passively position one section of a joint complex, preventing it from movement, while actively moving another. This occurs by isometrically contracting all stabilizing muscle systems of a specific region while initiating functional movement with different levels of loading. The focus is on the quality and control of movement and the loading should be modified to achieve this.

Specific Objectives:

By performing an isometric contraction, the muscles of the lumbar region are strengthened.

The client will be introduced to functional movement, utilizing the extremities, while maintaining an appropriate lumbar position.

Special Considerations:

As in the Awareness stage, focus should be placed on maintaining the spine in a pain free position, regardless of the position stated in the exercise description. The goal would be to move toward the recommended lumbar position while remaining pain free.

The following is an exemplary order of exercises and steps for PRE-POSITIONING for the LUMBAR SPINE using the exercise device 100: 1. Hamstring Curl (Lumbar in Flexion); 2. Abdominal Pull-Over (Lumbar in Flexion); 3. Squat (Lumbar in Extension); 4. Rowing in Heel Sit (Lumbar in Neutral); 5. Kneeling Single Arm Row (Lumbar in Neutral); 6. Kneeling Single Arm Row with Shoulder Abduction; 7. Single Arm Pulley Press; 8. Rocking Baby. Each of these exercises is described in more detail below.

Exercise Name and Number: Hamstring Curl (Lumbar in flexion)-⅛. Pulley Pin Placement: N/A. Incline Guideline: 2. Starting Position: Inverted Supine—Sit at the top end of the glideboard 330 and place feet into the adjustable foot holders. Lie back with head resting on the glideboard 330 and legs extended, knees slightly flexed. Exercise Description: Press the lumbar spine against the glideboard 330 by tilting the pelvis. Maintain this position while flexing the knees and using the hamstrings to pull the glideboard 330 towards the feet. Slowly return to starting position. Teaching Tips: Maintain consistent contact and pressure between the lumbar spine and the glideboard 330 throughout the exercise. Move through full range of hamstring flexion while maintaining lumbar position. If needed, the client can use hands to detect lumbar and pelvic positioning. Repetitions: 12-15 times. Sets: 2-4.

Exercise Name and Number: Abdominal Pull-Over (Lumbar in flexion)-⅔. Pulley Pin Placement: 1. Incline Guideline: 2. Starting Position: Upright Supine—Grasp handles and pull the glideboard 330 halfway up the rails. Sit at the bottom edge facing away from the tower, head supported and feet resting on the bottom of the glideboard 330. Extend arms overhead. Exercise Description: Flex lumbar spine and achieve contact with glideboard 330. While maintaining this lumbar position, extend one leg and hold, then perform a pullover movement, sliding the glideboard 330 towards the tower. Perform the desired number of repetitions, then change legs and repeat the exercise. Teaching Tips: Tuck the chin under and maintain contact between the head and glideboard 330 throughout the exercise. Maintain consistent contact and pressure between the lumbar spine and the glideboard 330 throughout the exercise. Repetitions: 12-15 times on each leg. Sets: 2-4. Safety Aspects: Modify the pullover action as needed due to client's strength or pain-free range of motion limitations. Variation: Bilateral Knee Raise—From the starting position, lift the knees off the board by flexing the hips to no more than 90°. Hold this position while maintaining lumbar flexion and performing the pullover. Single Knee, Single Leg Extension—From the bilateral knee raise position, extend one leg. Hold this position while maintaining lumbar flexion and performing the pullover. Perform the desired number of repetitions on each leg. Bilateral Leg Extension—From the single knee, single leg extension position, extend the other leg. Hold this position while maintaining lumbar flexion and performing the pullover.

Exercise Name and Number: Squat (Lumbar in extension)-⅜. Pulley Pin Placement: N/A. Incline Guideline: 6-8. Starting Position: Upright Supine—Push the glideboard 330 halfway up the rails. Straddle the glideboard 330 and sit at the bottom edge, facing away from the tower. Lie back with head resting on glideboard 330, legs extended but knees not locked, feet placed against telescoping squat stand, in a plié position. Exercise Description: Place lumbar spine into extension by anteriorly tilting the pelvis. Squat with as much hip flexion as possible while still maintaining the position of lumbar extension. Slowly return to starting position. Maintain the position of lumbar extension throughout the exercise. Teaching Tips: Use the hands to detect lumbar extension. Be aware of degree of knee flexion, always maintaining a pain-free range of motion. Relax the head, neck and shoulders. Maintain lumbar extension throughout the exercise. Modify foot position as needed to allow greater hip flexion. Repetitions: 12-15 times. Sets: 2-4.

Exercise Name and Number: Rowing in Heel Sit (Lumbar in neutral)-⅘. Pulley Pin Placement: 2. Incline Guideline: 2-4. Starting Position: Kneeling Backwards—Grasp handles and pull glideboard 330 halfway up the rails. Place hands, knuckles down, on the glideboard 330 to stabilize movement. Kneel at the top edge of the glideboard 330 facing the tower, sit back on heels. Extend arms toward pulleys with palms facing each other. Exercise Description: While maintaining a neutral or pain-free lumbar position, pull the handles towards the rib cage, leading with the elbows. Return to starting position by slowly extending the arms. Teaching Tips: Throughout the row action, maintain scapula in retracted position and lumbar spine in a neutral or pain free position. Repetitions: 12-15 times. Sets: 2-4. Safety Aspects: If client is unable to kneel with full knee flexion, place a wedge between the calves and the buttocks. If client is unable to go into full plantar flexion, place a rolled up towel between the ankle and glideboard 330. Variation: Seated—Movement can be performed in a seated rather than kneeling position, however care should be given to maintaining neutral or pain-free lumbar position.

Exercise Name and Number: Kneeling Single Arm Row (Lumbar in neutral)-⅝. Pulley Pin Placement: 2. Incline Guideline: 2-4. Starting Position: Kneeling Backwards—Connect both cables to a single handle. Pull the glideboard 330 halfway up the rails. Place hands, knuckles down, on the glideboard 330 to stabilize movement. Kneel at the top edge of the glideboard 330 facing the tower. Grasp handle with both hands, extend arms toward pulleys. Move into a high-kneeling position by lifting the buttocks off the heels. Exercise Description: From the high kneeling position, maintain a neutral or pain free lumbar position and allow the body to lean forward. Hold this position while pulling the handle towards the sternum, leading with the elbows. The torso should not be allowed to move. Return to starting position by slowly extending the arms. Teaching Tips: Throughout the row action, maintain scapula in retracted position and spine in a neutral or pain free position. Maintain static core stability. Repetitions: 12-15 times. Sets: 2-4. Safety Aspects: Be aware of the client's stability, beginning with greater knee flexion and progressing to a high kneeling position.

Exercise Name and Number: Kneeling Single Arm Row with Shoulder Abduction—⅚. Pulley Pin Placement: 2. Incline Guideline: 3-5. Starting Position: Kneeling Backwards—Grasp one handle, pull the glideboard 330 partway up the rails. Place hands, knuckles down, on the glideboard 330 to stabilize movement. Kneel at the top edge of the glideboard 330 facing the tower. Extend one arm towards the pulleys, place the other hand palm up on the lumbar spine. Move into a high-kneeling position by lifting the buttocks off the heels. Exercise Description: From the high kneeling position, maintain a neutral or pain-free lumbar position and allow the body to lean forward. Hold this position while abducting the shoulder and performing a high elbow row. The torso should not be allowed to move. Return to starting position by slowly extending the arm. Repeat for the desired number of repetitions then change arms. Teaching Tips: Throughout the row action, maintain the spine in a neutral or pain free position. Maintain static core stability. Use one hand behind the back to detect neutral spine and help stabilize the opposite shoulder. Do not allow the torso to rotate during the row action. Repetitions: 12-15 times. Sets: 2-4. Safety Aspects: Be aware of the client's stability, beginning with greater knee flexion and progressing to a high kneeling position.

Exercise Name and Number: Single Arm Pulley Press—⅞. Pulley Pin Placement: 2. Incline Guideline: 2-5. Starting Position: Kneeling Forward—Grasp one handle, pull the glideboard 330 partway up the rails. Place hands, knuckles down, on the glideboard 330 to stabilize movement. Kneel at the top edge of the glideboard 330 facing away from the tower. Feet should be positioned to allow the toes to hang over the top edge of the glideboard 330. Pull the handle in front of the client with the cable running under the arm, next to the torso. Grasp the handle with both hands, keeping the cable aligned to one side, elbows flexed. Move into a high-kneeling position by lifting the buttocks off the heels. Exercise Description: From the high kneeling position, maintain a neutral or pain-free lumbar position and allow the body to lean forward, away from the tower. Hold this position while performing a front press, using both hands, extending the arms in alignment with the pulley. The torso should not be allowed to move. Return to starting position with control. Repeat for the desired number of repetitions then change arms. Teaching Tips: Throughout the press action, maintain the spine in a neutral or pain free position. Maintain static core stability. Do not allow the torso to rotate during the row action. Allow toes to lay over top edge of glideboard 330 for stability. Repetitions: 12-15 times. Sets: 2-4.

Exercise Name and Number: Rocking Baby—⅝. Pulley Pin Placement: 2. Incline Guideline: 3-5. Starting Position: Kneeling Lateral—Stand to the side of the rails and grasp the handle on the same side of the exercise device 100. Pull the glideboard 330 halfway up the rails. Place hands, knuckles down, on the glideboard 330 to stabilize movement. Kneel on the top portion of the glideboard 330 facing sideways. Flex the elbows, grasp the handle with both hands and hold it to the side of the body closer to the tower. Exercise Description: In a low kneeling position, maintain neutral or pain free lumbar positioning and a static trunk. With both hands, pull the handle across the body to the other side. Return with control. Repeat for the desired number of repetitions then change sides, facing the other direction. Teaching Tips: All rotation occurs at the shoulder, not the trunk. Maintain neutral or pain-free lumbar positioning throughout the exercise. Repetitions: 12-15 times. Sets: 2-4. Safety Aspects: Anchor in and out of lateral kneeling position. If client is unable to kneel with full knee flexion, place a wedge between the calves and the buttocks. Variation: Starting position is high kneeling lateral.

Stage: Dynamic

Definition of Dynamic:

The third stage is to allow the joint to progress into loaded functional tasks. These active movements of the joint complex through a pain free range of motion focus on strength, endurance and appropriate range of motion. This final stage incorporates cognitive control of all stabilizing muscle systems, as well as the application of long-term functional behaviors. During this stage, a greater focus can be given to intensity, however the quality and control of movement should never be jeopardized.

Specific Objectives:

Throughout the Dynamic stage, the client should be able to maintain awareness and muscle control while performing multi-joint movements.

Consideration is given to exercises that will help the client perform normal, everyday tasks pain free.

Special Considerations:

Care should be taken to maintain control of the lumbar spine and to remain in a pain free position throughout the exercises.

Due to the sensitive nature of the joint, all exercises should begin with low intensity, progressing as the client's strength improves and appropriate function is achieved.

The following is an exemplary order of exercises and steps for DYNAMIC for the LUMBAR SPINE using the exercise device 100: 1. Muslin; 2. Muslin with Arm Pulley; 3. Back Extension with Row in Abduction; 4. Back Extension with Rotation; 5. Assisted Abdominal Crunch; 6. Side Bending. Each of these exercises is described in more detail below.

Exercise Name and Number: Muslin—⅙. Pulley Pin Placement: N/A. Incline Guideline: 2-3. Starting Position: Kneeling Backwards—With glideboard 330 resting at the base, place hands, knuckles down, on top to stabilize movement. Kneel in the middle of the glideboard 330 facing the tower, sit back on the heels. Place hands, palms up, behind the back and resting on the lumbar spine. Lean forward, resting chest and trunk on thighs. Exercise Description: While maintaining the lumbar position, lift the ribcage off the thighs by extending the cervical and thoracic spine. Movement should begin with cervical spine and articulate into thoracic spine. Teaching Tips: Initiate the movement by slightly raising the head. Avoid hyperextension of all spinal sections. Keep lumbar movement to a minimum. End of the movement occurs when ribcage and trunk lose contact with the thighs. Repetitions: 12-15 times. Sets: 2-4.

Exercise Name and Number: Muslin with Arm Pulley—⅔. Pulley Pin Placement: 2. Incline Guideline: 2-3. Starting Position: Kneeling Backwards—Grasp handles and pull glideboard 330 halfway up the rails. Place hands, knuckles down, on the glideboard 330 to stabilize movement. Kneel at the top edge of the glideboard 330 facing the tower, sit back on heels. Lean forward, resting chest and trunk on thighs. Extend arms toward pulleys with palms facing each other. Exercise Description: While maintaining the lumbar position, lift the ribcage off the thighs by extending the cervical and thoracic spine. Simultaneously pull the handles toward the rib cage, leading with the elbows. Articulation of the spine should begin with cervical spine and move into thoracic spine. Return to starting position by slowly extending the arms and lowering the ribcage and trunk onto thighs. Teaching Tips: Initiate the movement by slightly raising the head. Avoid hyperextension of all spinal sections. Keep lumbar movement to a minimum. End of the movement occurs when ribcage and trunk lose contact with the thighs and hands reach the sides of the torso. Repetitions: 12-15 times. Sets: 2-4. Variation: Reverse Fly—While maintaining the lumbar position, lift the ribcage off the thighs by extending the cervical and thoracic spine. Simultaneously, pull the arms back in an outward arc until hands are directly out to the side from the torso. Articulation of the spine should begin with cervical spine and move into thoracic spine. Slowly return to starting position. Upright Row—While maintaining the lumbar position, lift the ribcage off the thighs by extending the cervical and thoracic spine. Simultaneously, pull the handles up toward the shoulders, leading with the elbows. Articulation of the spine should begin with cervical spine and move into thoracic spine. Slowly return to starting position.

Exercise Name and Number: Back Extension with Row in Adduction—⅜. Pulley Pin Placement: 2. Incline Guideline: 2-3. Starting Position: Kneeling Backwards—Grasp handles and pull glideboard 330 halfway up the rails. Place hands, knuckles down, on the glideboard 330 to stabilize movement. Kneel at the top edge of the glideboard 330 facing the tower, sit back on heels. Lean forward, resting chest and trunk on thighs. Extend arms toward pulleys with palms facing each other. Exercise Description: Lift the ribcage and trunk off the thighs by articulating the spine into extension, starting with the cervical and moving to the lumbar region. Simultaneously pull the handles toward the rib cage, leading with the elbows. Return to starting position by slowly extending the arms and lowering the ribcage and trunk onto thighs. Teaching Tips: Initiate the movement by slightly raising the head. Avoid hyperextension of all spinal sections. Keep the pelvic position static throughout the exercise. End of the movement occurs when hands reach the sides of the torso and the whole spine is in an upright and neutral position. If client has difficulty maintaining static pelvic position, lift the buttocks off the heels. Repetitions: 12-15 times. Sets: 2-4.

Exercise Name and Number: Back Extension with Rotation—4/6. Pulley Pin Placement: 2. Incline Guideline: 2-3. Starting Position: Kneeling Backwards—Grasp handles and pull glideboard 330 halfway up the rails. Place hands, knuckles down, on the glideboard 330 to stabilize movement. Kneel at the top edge of the glideboard 330 facing the tower, sit back on heels. Lean forward, resting chest and trunk on thighs. Extend arms toward pulleys with palms facing each other. Exercise Description: Lift the ribcage and trunk off the thighs by articulating the spine into extension, starting with the cervical and moving through to the lumbar region. Simultaneously pull one handle toward the rib cage, leading with the elbow, and rotating the torso in the same direction. Opposite hand maintains a static position with elbow slightly flexed. Slowly return to starting position then repeat for the desired number of repetitions before changing sides. Teaching Tips: Initiate the movement by slightly raising the head. Avoid hyperextension of all spinal sections. Keep the pelvic position static throughout the exercise. Allow the head to rotate in direction of torso rotation. End of the movement occurs when hand reaches the side of the torso, trunk is rotated and the whole spine is in an upright and neutral position. If client has difficulty maintaining static pelvic position, lift the buttocks off the heels. Repetitions: 12-15 times. Sets: 2-4.

Exercise Name and Number: Assisted Abdominal Crunch—5/6. Pulley Pin Placement: N/A. Incline Guideline: 2-6. Starting Position: Upright Supine—Push the glideboard 330 halfway up the rails. Straddle the glideboard 330 and sit at the bottom edge, facing away from the tower. Lie back with head resting on glideboard 330, legs extended but knees not locked, feet placed against telescoping squat stand, shoulder-width apart. Cross arms and rest hands on the chest. Flex knees to approximately 90° and hold. Exercise Description: While maintaining the squat position, flex the abdominals, raising the head and shoulders off the glideboard 330. Return to starting position with control. Teaching Tips: Maintain a neutral or pain free lumbar position throughout the exercise. Allow the thoracic spine to flex during the crunch movement. Movement of the upper body should be a result of shortening the abdominals, not flexion at the hip. Progress from high to low incline, based client's abdominal strength. Repetitions: 12-15 times. Sets: 2-4. Safety Aspects: Clients with poor quadriceps strength.

Exercise Name and Number: Side Bending—6/6. Pulley Pin Placement: N/A. Incline Guideline: 2-4. Starting Position: Side Lying—Lie on one side with hips at the bottom of the glideboard 330 and top foot braced against the base. Bottom leg is flexed with foot placed on knee of top leg. Rest hand of top arm on hip, lower arm rests on glideboard 330 while supporting and securing the head. Exercise Description: Use the muscles of the trunk to raise the shoulder and torso off the glideboard 330 along the frontal plane (side bend). Teaching Tips: Avoid pushing on the head with the bottom arm. Do not allow the torso to rotate during movement. Repetitions: 12-15 times. Sets: 2-4. Safety Aspects: Ensure that the client's hip and foot positioning is secure and properly aligned.

SHOULDER

AWARENESS

Definition of Awareness: To improve joint stability and, correspondingly, pain free functional movement, it is essential that the client develop a correct perception of isolated muscle action and joint position. To do so, specific exercises are designed to enhance and develop a person's awareness of the position of the joint. The awareness stage focuses on improving proprioception and coordination of the joint and surrounding local muscle system. Be aware of fatigue due to intensity; focus is on proprioception and coordination (quality of movement), NOT strength or endurance training.

Specific Objectives: The client should be able to determine scapula positioning in depression, elevation, retraction and protraction, without external feedback. Special Considerations: The client or trainer can assist in scapula awareness by the placement of hands to detect any movement. Although focus is not placed specifically on the spine, ensure a neutral or pain free position is maintained throughout the exercises.

The following is an exemplary order of exercises and steps for AWARENESS for the SHOULDER using the exercise device 100: 1. Depression of Scapula; 2. Elevation of Scapula; 3. Retraction of Scapula; 4. Protraction of Scapula. Each of these exercises is described in more detail below.

Joint Complex: Shoulder. Stage: Awareness. Exercise Name and Number: Depression of Scapula—1/4. Pulley Pin Placement: N/A. Incline Guideline 3-5. Starting Position: Upright Prone—Push the glideboard 330 halfway up the rails. Lie prone with chest near top edge of glideboard 330 with arms extended. Grasp the LAT bars, palm facing down. Bend the knees to keep the feet from hitting the base. Exercise Description: While keeping arms extended, depress the scapula. Glideboard 330 will move slightly up the rails. Return with control. Teaching Tips: Do not allow the elbows to flex. Focus on pressing the shoulders down, away from the ears. Repetitions: 12-15 times. Sets: 2-4.

Joint Complex: Shoulder. Stage: Awareness. Exercise Name and Number: Elevation of Scapula—2/4. Pulley Pin Placement: 1. Incline Guideline 2-4. Starting Position: Inverted Supine—Grasp handles and pull the glideboard 330 halfway up the rails. Straddle the glideboard 330 and sit at the top edge. Lie back on the glideboard 330, ensuring head is fully supported. Place both feet on top edge of glideboard 330 with knees flexed and arms parallel to the torso, palms facing thighs. Exercise Description: While keeping arms extended, elevate the scapula. Glideboard 330 will move slightly up the rails. Return with control. Teaching Tips: Do not allow the elbows to flex. Maintain contact between scapula and glideboard 330 throughout the exercise with a slight lordosis of the thoracic spine. Focus on elevating the shoulders toward the ears. Repetitions: 12-15 times. Sets: 2-4.

Joint Complex: Shoulder. Stage: Awareness. Exercise Name and Number: Retraction of Scapula—3/4. Pulley Pin Placement: 2. Incline Guideline 2-4. Starting Position: Kneeling Backwards—Grasp one handle and pull glideboard 330 halfway up the rails. Place hands, knuckles down, on the glideboard 330 to stabilize movement. Kneel at the top edge of the glideboard 330 facing the tower, sit back on heels. Hold the handle in one hand and extend the arm toward the pulleys with palm facing down. Use the opposite hand to press against the thorax on the side performing the exercise to keep the shoulder and torso from rotating. Exercise Description: While keeping the arm extended, retract the scapula on the same side. Glideboard 330 will move slightly up the rails. Return with control. Teaching Tips: Maintain the spine in a neutral or pain free position. Do not allow the elbow to flex. The spine should not flex, extend or rotate with the movement. Focus on pulling the scapula back and toward the midline of the body. Repetitions: 12-15 times on each side Sets: 2-4. Safety Aspects: If client is unable to kneel with full knee flexion, place a wedge between the calves and the buttocks. If client is unable to go into full plantar flexion, place a rolled up towel between the ankle and glideboard 330.

Joint Complex: Shoulder. Stage: Awareness. Exercise Name and Number: Protraction of Scapula—4/4. Pulley Pin Placement: 3. Incline Guideline 2-4. Starting Position: Seated Forward—Grasp one handle, pull the glideboard 330 partway up the rails. Sit at the top edge of the glideboard 330, facing away from the tower. Allow feet to rest on the floor. Pull the handle in front of the client with the cable running in alignment with the shoulder. Hold the handle with palm facing down, and arm extended, parallel to the shoulder. Use the free hand to press against the thorax on the opposite side performing the exercise to keep the shoulder and torso from rotating. Exercise Description: While keeping the arm extended, protract the scapula on the same side. Glideboard 330 will move slightly up the rails, Return with control. Teaching Tips: Maintain the spine in a neutral or pain free position. Do not allow the elbow to flex, The spine should not flex, extend or rotate with the movement. Focus on pushing the scapula forward and away from the midline of the body. Allow feet to assist in the movement if necessary. Repetitions: 12-15 times on each side Sets: 2-4. Safety Aspects: Adjust pin placement to ensure correct alignment with the shoulder.

Pre-Positioning

Definition of Pre-Positioning: Following the achievement of Joint Complex awareness the next step is to progressively improve the dynamic function of the joint. To do so, specific exercises are designed to actively and passively position one section of a Joint Complex, preventing it from movement, while actively moving another. This occurs by isometrically contracting all stabilizing muscle systems of a specific region while initiating functional movement with different levels of loading. The focus is on the quality and control of movement and the loading should be modified to achieve this.

Pre-Position: The pre-positioning of the scapula for all the exercises in this section is retraction and depression.

Specific Objectives: By minimizing scapula movement through performing an isometric contraction, the supporting muscles are strengthened. The client will be introduced to functional movement, utilizing the arms, while maintaining an appropriate scapula position. Special Considerations: Care should be taken to maintain control throughout the exercises; avoid hyperextending or hyperflexing the shoulder joint. During exercises utilizing handles, ensure neutral positioning of the wrist. The pin placements provided are recommendations. Trainers should adjust as necessary, depending on the stature of the client, in order to maintain appropriate lines of pull.

The following is an exemplary order of exercises and steps for PRE-POSITIONING for the SHOULDER using the exercise device 100: 1. Shoulder Extension; 2. Shoulder Flexion; 3. External Rotation; 4. Internal Rotation. Each of these exercises is described in more detail below.

Joint Complex: Shoulder. Stage: Pre-positioning. Exercise Name and Number: Shoulder Extension—1/4. Pulley Pin Placement: 2-3. Incline Guideline 2-4. Starting Position: Kneeling Backwards—Grasp handles and pull glideboard 330 halfway up the rails. Place hands, knuckles down, on the glideboard 330 to stabilize movement. Kneel at the top edge of the glideboard 330 facing the tower, sit back on heels. Slightly flex the elbows and hold the handles with palms facing in. Depress and retract the scapula. Exercise Description: While maintaining the scapula in retraction and depression and the spine in a neutral or pain free position, pull the handles toward the rib cage, leading with the elbows. The glideboard 330 will move slightly up the rails. Return to starting position by slowly extending the arms. Teaching Tips: Throughout the row action, maintain scapula in retraction and depression and the spine in a neutral or pain-free position. When returning to starting position, do not allow arms to fully extend. Maintain static spinal posture throughout the exercise. Repetitions: 12-15 times. Sets: 2-4. Safety Aspects: If client is unable to kneel with full knee flexion, place a wedge between the calves and the buttocks. If client is unable to go into full plantar flexion, place a rolled up towel between the ankle and glideboard 330.

Joint Complex: Shoulder. Stage: Pre-positioning. Exercise Name and Number: Shoulder Flexion—2/4. Pulley Pin Placement: 2-3. Incline Guideline 2-4. Starting Position: Kneeling Forward—Grasp both handles, pull the glideboard 330 partway up the rails. Place hands, knuckles down, on the glideboard 330 to stabilize movement. Kneel at the top edge of the glideboard 330 facing away from the tower and sit back on heels. Feet should be positioned to allow the toes to hang over the top edge of the glideboard 330. Pull the handles in front of the client with the cables running under the arms, next to the torso. Hold the handles with palms facing in and elbows flexed, close to the torso. Retract and depress the scapula. Exercise Description: While maintaining the scapula in retraction and depression and the spine in a neutral or pain free position, push the handles away from the rib cage. The glideboard 330 will move slightly up the rails. Stop the movement before full elbow extension occurs. Return to starting position with control. Teaching Tips: Throughout the press action, maintain scapula in retraction and depression and the spine in a neutral or pain free position. When performing press, do not allow arms to fully extend. Maintain static spinal posture throughout the exercise. Allow toes to lay over top edge of glideboard 330 for stability. Repetitions: 12-15 times. Sets: 2-4. Safety Aspects: For greater stability the client can perform the exercise in the seated position with feet resting on the ground for assistance, if necessary.

Joint Complex: Shoulder. Stage: Pre-positioning. Exercise Name and Number: External Rotation—3/4. Pulley Pin Placement: 2. Incline Guideline 2-4. Starting. Position: Seated Lateral—Stand to the side of the exercise device 100 with back facing the glideboard 330. Grasp the handle on the same side of the exercise device 100 and pull the glideboard 330 halfway up. Sit toward the top edge of the glideboard 330 facing sideways with feet resting on the ground. Hold the handle with the hand farthest from the tower, with elbow flexed at 90° and held close to the torso. Depress and retract the scapula on the same side. If possible, place the opposite hand behind the back to detect any movement of the scapula. Exercise Description: While maintaining the scapula in retraction and depression and flexed elbow close to the torso, pull the handle across the body in an arc motion to achieve external rotation. The glideboard 330 will move slightly up the rails. Return to starting position with control. Repeat for the desired number of repetitions then change arms. Teaching Tips: Maintain the scapula in retraction and depression and the spine in a neutral or pain free position throughout the exercise. Avoid any trunk rotation. Maintain the elbow position as close to the torso as possible throughout the exercise. Encourage a full range of motion. Repetitions: 12-15 times on each side Sets: 2-4. Safety Aspects: Be aware of appropriate intensity and ensure a pain-free movement. If needed, client can place a folded towel between elbow and torso to assist in maintaining elbow position. Variation: Kneeling Lateral—Perform the movement in a kneeling, heel sit position.

Joint Complex: Shoulder. Stage: Pre-positioning. Exercise Name and Number: Internal Rotation—4/4. Pulley Pin Placement: 2. Incline Guideline 2-4. Starting Position: Seated Lateral—Stand to the side of the exercise device 100 with back facing the glideboard 330. Grasp the handle on the same side of the exercise device 100 and pull the glideboard 330 halfway up. Sit toward the top edge of the glideboard 330 facing sideways with feet resting on the ground. Hold the handle with the hand closest to the tower, with elbow flexed at 90° and held close to the torso. Depress and retract the scapula on the same side. If possible, place the opposite hand behind the back to detect any movement of the scapula. Exercise Description: While maintaining the scapula in retraction and depression and flexed elbow close to the torso, pull the handle across the body in an arc motion to achieve internal rotation. The glideboard 330 will move slightly up the rails. Return to starting position with control. Repeat for the desired number of repetitions then change arms. Teaching Tips: Maintain the scapula in retraction and depression and the spine in a neutral or pain free position throughout the exercise. Avoid any trunk rotation. Maintain the elbow position as close to the torso as possible throughout the exercise. Encourage a full range of motion. Repetitions—12-15 times on each side Sets: 2-4. Safety Aspects: Be aware of appropriate intensity and ensure a pain-free movement. If needed, client can place a folded towel between elbow and torso to assist in maintaining elbow position. Variation: Opposite Pulley—To modify the force angle on the shoulder, use the opposite handle. Kneeling Lateral—Perform the movement in a kneeling, heel sit position.

Dynamic

Definition of Dynamic: The third stage is to allow the joint to progress into loaded functional tasks. These active movements of the Joint Complex through a pain free range of motion focus on strength, endurance and appropriate range of motion. This final stage incorporates cognitive control of all stabilizing muscle systems, as well as the application of long-term functional behaviors. During this stage, a greater focus can be given to intensity, however the quality and control of movement should never be jeopardized.

Specific Objectives: Throughout the Dynamic stage, the client should be able to maintain awareness and muscle control while performing multi-joint movements. Consideration is given to exercises that will help the client perform normal, everyday tasks pain free. Focus is placed on moving the shoulder through its extensive range of movement patterns.

Special Considerations: Care should be taken to maintain control of the scapula and to remain pain free throughout the exercises. The pin placements provided are recommendations. Trainers should adjust as necessary, depending on the stature of the client, in order to maintain appropriate lines of pull. Although focus is not placed specifically on the spine, ensure a neutral or pain free position is maintained throughout the exercises.

The following is an exemplary order of exercises and steps for DYNAMIC for the SHOULDER using the exercise device 100: 1. Pull Up; 2. Pull Up with Pulleys; 3. Adduction in Supine; 4. Abduction in Supine; 5. Single Arm Shoulder Flexion; 6. Single Arm Shoulder Extension; 7. Single Arm Overhead Press; 8. Diagonal in Supine; 9. Kneeling Shoulder Flexion with Rotation. Each of these exercises is described in more detail below.

Joint Complex: Shoulder. Stage: Dynamic. Exercise Name and Number: Pull Up—1/9. Pulley Pin Placement: N/A. Incline Guideline 3-6. Starting Position: Upright Prone—With the LAT bars in the pull up position, push the glideboard 330 halfway up the rails. Lie prone with chest near the top edge of the glideboard 330, with neutral spinal curvature. Grasp the LAT bars, palms facing down and arms extended. If the squat stand is attached, bend the knees to ensure feet do not hit the squat stand.

Exercise Description: While maintaining the spine in a neutral or pain free position, pull the glideboard 330 up the rails until hands are level with shoulders. Allow shoulders to move through full range of motion, from elevation through to depression. Lower the glideboard 330 back down the rails until arms are fully extended. Teaching Tips: Initiate pull up with scapula depression, followed by arm movement. Ensure sternum maintains contact with the glideboard 330. Maintain neutral or pain-free spinal curvature throughout the exercise. Cue client to keep the shoulders away from the ears. Avoid hyperextension of the lumbar spine. Repetitions: 12-15 times. Sets: 2-4.

Joint Complex: Shoulder. Stage: Dynamic. Exercise Name and Number: Pull Up with Pulleys—2/9. Pulley Pin Placement: 6. Incline Guideline 3-6. Starting Position: Upright Prone—Grasp the handles and pull the glideboard 330 partway up the rails. Lie prone with chest near the top edge of the glideboard 330, with neutral spinal curvature. Hold handles with palms facing down and arms extended. Bend the knees to ensure feet do not hit the squat stand. Exercise Description: While maintaining the spine in a neutral or pain free position, pull the glideboard 330 up the rails until hands are level with shoulders. Allow shoulders to move through full range of motion, from elevation through to depression. Lower the glideboard 330 back down the rails until arms are fully extended. Teaching Tips: Initiate pull up with scapula depression, followed by arm movement. Ensure sternum maintains contact with the glideboard 330. Maintain neutral or pain free spinal curvature throughout the exercise. Cue client to keep the shoulders away from the ears. Avoid hyperextension of the lumbar spine. Repetitions: 12-15 times. Sets: 2-4. Safety Aspects: Using the pulleys ensures the client must maintain an external rotation of the shoulders. Avoid pressing downward with the handles.

Joint Complex: Shoulder. Stage: Dynamic. Exercise Name and Number: Adduction in Supine—3/9. Pulley Pin Placement: 6. Incline Guideline 2-4. Starting Position: Upright Supine—Grasp handles and pull the glideboard 330 halfway up the rails. Straddle the glideboard 330 and sit facing away from the tower. Lie back on the glideboard 330, ensuring head is fully supported. Knees are flexed and feet placed on glideboard 330, shoulder-width apart. Holding the handles, arms are extended by the sides of the torso. Exercise Description: Lower the glideboard 330 by abducting the arms to no greater than parallel with the shoulders. From this position, adduct the arms and bring the handles back down to the sides of the torso. Teaching Tips: Encourage flexion of the lumbar spine and extension of the thoracic spine. Maintain scapula in depression and retraction throughout the movement. Repetitions: 12-15 times. Sets: 2-4.

Joint Complex: Shoulder. Stage: Dynamic. Exercise Name and Number: Abduction in Supine—4/9. Pulley Pin Placement: 6. Incline Guideline 2-4. Starting Position: Inverted Supine—Grasp handles and pull the glideboard 330 halfway up the rails. Straddle the glideboard 330 and sit at the top edge, facing the tower. Lie back on the glideboard 330, ensuring head is fully supported. Flex hips and knees to 90°. Hold handles with arms extended by the sides of the torso. Exercise Description: Raise the glideboard 330 by abducting the arms to no greater than parallel with the shoulders. Return to starting position with control. Teaching Tips: Keep arms straight with a slight flexion of the elbow throughout the movement. Maintain position of the elbows above the glideboard 330. Maintain contact between the head and glideboard 330, with chin tucked under. Encourage flexion of the lumbar spine and extension of the thoracic spine. Maintain scapula in depression and retraction throughout the movement. Repetitions: 12-15 times. Sets: 2-4. Safety Aspects: Always move within a pain free range of motion.

Joint Complex: Shoulder. Stage: Dynamic. Exercise Name and Number: Single Arm Shoulder Flexion—5/. Pulley Pin Placement: 6. Incline Guideline 2-4. Starting Position: Inverted Supine—Grasp handles and pull the glideboard 330 halfway up the rails. Straddle the glideboard 330 and sit at the top edge, facing the tower. Lie back on the glideboard 330, ensuring head is fully supported. Flex hips and knees to 90°. Hold handles with arms extended by the sides of the torso. Exercise Description: Raise the glideboard 330 by moving one arm in an arc motion to an overhead position. Return to starting position with control. Maintain an extended arm throughout the movement. Repeat for the desired number of repetitions then change arms. Teaching Tips: Maintain contact between the head and glideboard 330, with chin tucked under. Encourage flexion of the lumbar spine and extension of the thoracic spine. Maintain scapula in depression and retraction throughout the movement. Repetitions: 12-15 times. Sets: 2-4. Safety Aspects: Always move within a pain free range of motion.

Joint Complex: Shoulder. Stage: Dynamic. Exercise Name and Number: Single Arm Shoulder Extension—6/. Pulley Pin Placement: 1. Incline Guideline 2-4. Starting Position: Upright Supine—Grasp one handle and pull the glideboard 330 halfway up the rails. Straddle the glideboard 330 and sit facing away from the tower. Lie back, ensuring head is fully supported. Knees are flexed and feet placed on glideboard 330, shoulder-width apart. Hold the handle with the arm extended overhead. The opposite arm is extended by the side of the torso. Exercise Description: Raise the glideboard 330 by moving one arm in a downward arc motion. Return to starting position with control. Maintain an extended arm throughout the movement. Repeat for the desired number of repetitions then change arms. Teaching Tips: Maintain contact between the head and glideboard 330, with chin tucked under. Encourage flexion of the lumbar spine and extension of the thoracic spine. Maintain scapula in depression and retraction throughout the movement. Repetitions: 12-15 times. Sets: 2-4. Safety Aspects: Always move within a pain free range of motion.

Joint Complex: Shoulder. Stage: Dynamic. Exercise Name and Number: Single Arm Overhead Press—7/. Pulley Pin Placement: 1. Incline Guideline 2-4. Starting Position: Inverted Supine—Grasp handles and pull the glideboard 330 halfway up the rails. Straddle the glideboard 330 and sit at the top edge, facing the tower. Lie back on the glideboard 330, ensuring head is fully supported. Flex hips and knees and rest feet on glideboard 330. Hold handles with arms extended by the sides of the torso. Exercise Description: Using one arm, raise the glideboard 330 by the following sequence: Pull the handle up the torso moving into internal rotation, then external rotation, followed by overhead arm extension. Return to starting position with control, reversing the sequence. Repeat for the desired number of repetitions then change arms. Teaching Tips: Maintain contact between the head and glideboard 330, with chin tucked under. Encourage flexion of the lumbar spine and extension of the thoracic spine. Repetitions: 12-15 times. Sets: 2-4. Safety Aspects: Ensure a pain free movement, being aware of the torque placed on the shoulder.

Joint Complex: Shoulder. Stage: Dynamic. Exercise Name and Number: Diagonal in Supine—8/. Pulley Pin Placement: 5. Incline Guideline 2-4. Starting Position: Upright Supine—Grasp one handle and pull the glideboard 330 halfway up the rails. Straddle the glideboard 330 and sit facing away from the tower. Lie back, ensuring head is fully supported. Knees are flexed and feet placed on glideboard 330, shoulder-width apart. Hold the handle with both hands and the arms extended diagonally overhead toward the pulley. Exercise Description: Raise the glideboard 330 by pulling the handle across the body to the outside of the opposite knee. Maintain extended arms and allow for trunk rotation throughout the movement. Return to starting position with control. Repeat for the desired number of repetitions then change sides. Teaching Tips: Allow the shoulders and the head to raise off the glideboard 330 during the diagonal pulling action. Follow hands with the eyes, allowing head to follow movement. Minimize hip movement. Repetitions: 12-15 times. Sets: 2-4.

Joint Complex: Shoulder. Stage: Dynamic. Exercise Name and Number: Kneeling Shoulder Flexion with Rotation—9/. Pulley Pin Placement: 3. Incline Guideline 2-4. Starting Position: Kneeling Backwards —Grasp one handle with the opposite hand. Pull the glideboard 330 halfway up the rails. Straddle the glideboard 330 facing the tower. Place hands, knuckles down, on the glideboard 330 to stabilize movement. Kneel at the top edge of the glideboard 330 facing the tower, sit back on heels. Extend the arm holding the handle and place the other hand behind the back. Allow the torso to flex and rotate toward the pulley. Exercise Description: Pull the glideboard 330 up the rails by bringing the handle up and across the front of the torso in an arc motion until the handle is overhead and outside the shoulder. Allow the trunk to rotate throughout the movement. Return to starting position with control. Repeat for the desired number of repetitions then change sides. Teaching Tips: Lead with the elbow throughout the arc motion. Follow hand with the eyes, allowing head to follow movement. Repetitions: 12-15 times. Sets: 2-4.

KNEE

AWARENESS

Definition of Awareness: To improve joint stability and, correspondingly, pain free functional movement, it is essential that the client develop a correct perception of isolated muscle action and joint position. To do so, specific exercises are designed to enhance and develop a person's awareness of the position of the joint. The awareness stage focuses on improving proprioception and coordination of the joint and surrounding local muscle system. Be aware of fatigue due to intensity; focus is on proprioception and coordination (quality of movement), NOT strength or endurance training.

Specific. Objectives: The client should become aware of maintaining a linear relationship between the hip, knee and ankle, for the purpose of maintaining correct alignment during active knee flexion. Clients should also become aware of the degree of flexion that is occurring at the knee during specific exercises. As clients improve in their awareness of knee flexion, they should be able to correctly perform the exercises without external cues from the trainer.

Special Considerations: During the unilateral squat exercise, specific focus is given to maintaining a normal arch of the foot. This assists in controlling proper alignment throughout the exercise by reducing medial and lateral knee movement. To increase awareness of the arch position, have the client remove his or her shoes (in the awareness stage only). Although focus is not placed specifically on the spine, ensure a neutral or pain free position is maintained throughout the exercises. To assist the client in obtaining awareness during knee flexion exercises, trainer can provide verbal or visual cues, indicating an endpoint of flexion. To determine a client's competency in achieving correct alignment and degree of flexion, have the client close his or her eyes and perform the exercise.

The following is an exemplary order of exercises and steps for AWARENESS for the KNEE using the exercise device 100: 1. Unilateral Squat; 2. Unilateral Hamstring Curl. Each of these exercises is described in more detail below.

Joint Complex: Knee. Stage: Awareness. Exercise Name and Number: Unilateral Squat—½. Pulley Pin Placement: N/A. Incline Guideline 1-2. Starting Position: Upright Supine—Push the glideboard 330 halfway up the rails, straddle the glideboard 330 and sit at the bottom edge. Lie back, ensuring head is fully supported. Place one foot near the center of the squat stand and the other on the lower edge of the glideboard 330. Exercise Description: Lower the glideboard 330 down the rails by flexing the active knee and squatting with one leg. Return to starting position with control. Repeat for the desired number of repetitions then change legs. Teaching Tips: Ensure that middle of patella aligns with middle of foot throughout the motion. Maintain the arch in the foot; do not allow foot to pronate. Be aware of knee flexion: maintain alignment and flex through pain-free range of motion. Maintain a slow tempo throughout the exercise. Repetitions: 12-15 times. Sets: 2-4. Safety Aspects: Do not lock knee at top of the movement.

Joint Complex: Knee. Stage: Awareness. Exercise Name and Number: Unilateral Hamstring Curl—⅔. Pulley Pin Placement: N/A. Incline Guideline 1-2. Starting Position: Inverted Supine—Straddle the rails and sit at the top edge of the glideboard 330, facing the tower. Once body weight is fully supported by the glideboard 330, secure one foot into the adjustable foot holder. Lie back on the glideboard 330 with secured leg extended and foot aligned directly above the hip joint. Rest the head on the glideboard 330 with the chin tucked under, and hold the opposite knee to the chest. Exercise Description: Using the heel, pull the glideboard 330 up the rails, allowing the knee to flex through a pain-free range of motion. Return to starting position with control. Repeat for the desired number of repetitions then change legs. Teaching Tips: Ensure that middle of patella aligns with middle of the foot throughout the motion. Be aware of knee flexion: maintain alignment and flex through pain-free range of motion. Maintain a slow tempo during the movement. Repetitions: 12-15 times. Sets: 2-4. Safety Aspects: Be aware of appropriate intensity, as hamstrings may experience early fatigue.

KNEE

DYNAMIC

Definition of Dynamic: The third stage is to allow the joint to progress into loaded functional tasks. These active movements of the Joint Complex through a pain free range of motion focus on strength, endurance and appropriate range of motion. This final stage incorporates cognitive control of all stabilizing muscle systems, as well as the application of long-term functional behaviors. During this stage, a greater focus can be given to intensity, however the quality and control of movement should never be jeopardized.

Specific Objectives: Throughout the Dynamic stage, the client should be able to maintain proper alignment and muscle control while performing complex movement patterns. The client should be able place the knee into flexion with control by the eccentric and concentric contractions of the surrounding muscles. These movements reflect high impact actions such as running and jumping. Consideration is given to exercises that will help the client perform normal, everyday tasks pain free. Special Considerations: Although focus is not placed specifically on the spine, ensure a neutral or pain free position is maintained throughout the exercises. Low impact movements can be performed without shoes. This increases internal feedback for the client and allows the trainer to visually spot the foot. Due to the nature of the high impact movements included in this stage, the trainer should be aware of how the client is absorbing the impact through the hips, knees and ankles.

The following is an exemplary order of exercises and steps for DYNAMIC for the KNEE using the exercise device 100: 1. Bilateral Squat; 2. Unilateral Squat; 3. Bilateral Squat with External Rotation of Hips; 4. Unilateral Squat with External Rotation of Hip; 5. Unilateral. Plyometric Squat; 6. Bilateral Plyometric Squat; 7. Unilateral Plyometric Skiing; 8. Bilateral Plyometric Skiing; 9. Sidelying Single Leg Squat; 10. Quadraped; 11. Triped; 12. Seated Hamstring Curl; 13. Reverse Lunge; 14. Lateral Lunge. Each of these exercises is described in more detail below.

Joint Complex: Knee. Stage: Dynamic. Exercise Name and Number: Bilateral Squat—1/14. Pulley Pin Placement: N/A. Incline Guideline 3-6. Starting Position: Upright Supine—Push the glideboard 330 halfway up the rails. Straddle the glideboard 330 and sit at the bottom edge, facing away from the tower. Lie back with head resting on glideboard 330, legs extended but knees not locked, feet placed against telescoping squat stand in alignment directly under hip joint. Exercise Description: While maintaining the spine in a neutral or pain-free position, lower the glideboard 330 by flexing the knees. Slowly return to starting position. Teaching Tips: Be aware of degree of knee flexion, always maintaining a pain-free range of motion. Ensure that middle of patellae align with middle of the feet throughout the motion. Relax the head, neck and shoulders. Maintain the spine in a neutral or pain-free position throughout the exercise. Repetitions: 12-15 times. Sets: 2-4. Safety Aspects: Do not lock knees at the top of the movement.

Joint Complex: Knee. Stage: Dynamic. Exercise Name and Number: Unilateral Squat—2/14. Pulley Pin Placement: N/A. Incline Guideline 3-6. Starting Position: Upright Supine—Push the glideboard 330 halfway up the rails, straddle the glideboard 330 and sit at the bottom edge. Lie back, ensuring head is fully supported. Place one foot near the center of the squat stand and the other on the lower edge of the glideboard 330. Exercise Description: Lower the glideboard 330 down the rails by flexing the active knee and squatting with one leg. Return to starting position with control. Repeat for the desired number of repetitions then change legs. Teaching Tips: Ensure that middle of patella aligns with middle of the foot throughout the motion. Maintain the arch in the foot; do not allow foot to pronate. Be aware of degree of knee flexion, always maintaining a pain-free range of motion. Maintain the spine in a neutral or pain free position throughout the exercise. Repetitions: 12-15 times. Sets: 2-4. Safety Aspects: Do not lock knee at top of the movement.

Joint Complex: Knee. Stage: Dynamic. Exercise Name and Number: Bilateral Squat with External Rotation of the Hips—3/14. Pulley Pin Placement: N/A. Incline Guideline 3-6. Starting Position: Upright Supine—Push the glideboard 330 halfway up the rails. Straddle the glideboard 330 and sit at the bottom edge, facing away from the tower. Lie back, ensuring head is fully supported. Place feet on squat stand, shoulder-width apart, with toes pointing outward 45°. Legs are extended but knees not locked. Exercise Description: While maintaining external hip rotation, lower the glideboard 330 by flexing the knees. Slowly return to starting position. Teaching Tips: Be aware of degree of knee flexion, always maintaining a pain-free range of motion. Maintain external rotation of the hip and ensure the knees track over the feet throughout the movement. Focus on the ball of the foot remaining in contact with the squat stand. Relax the head, neck and shoulders. Maintain the spine in a neutral or pain free position throughout the exercise. By externally rotating the hip, focus is placed on the vastus medialis. Repetitions: 12-15 times. Sets: 2-4. Safety Aspects: Do not lock knees at the top of the movement.

Joint Complex: Knee. Stage: Dynamic. Exercise Name and Number: Unilateral Squat with External Rotation of the Hip—4/14. Pulley Pin Placement: N/A. Incline Guideline 3-6. Starting Position: Upright Supine—Push the glideboard 330 halfway up the rails. Straddle the glideboard 330 and sit at the bottom edge, facing away from the tower. Lie back, ensuring head is fully supported. Place one foot on the center of the squat stand, with toes pointing outward 45°. Leg is extended but knee not locked. Place the opposite foot on the lower edge of the glideboard 330. Exercise Description: While maintaining external hip rotation, lower the glideboard 330 by squatting by flexing the knee. Slowly return to starting position. Repeat for the desired number of repetitions then change legs. Teaching Tips: Be aware of degree of knee flexion, always maintaining a pain-free range of motion. Maintain external rotation of the hip and ensure the knee tracks over the feet throughout the movement. Focus on the ball of the foot remaining in contact With the squat stand. Relax the head, neck and shoulders. Maintain the spine in a neutral or pain free position throughout the exercise. By externally rotating the hip, focus is placed on the vastus medialis. Repetitions: 12-15 times. Sets: 2-4. Safety Aspects: Do not lock knees at the top of the movement.

Joint Complex: Knee. Stage: Dynamic. Exercise Name and Number: Unilateral Plyometric—5/14. Pulley Pin Placement: N/A. Incline Guideline 3-6. Starting Position: Upright Supine—Push the glideboard 330 halfway up the rails. Straddle the glideboard 330 and sit at the bottom edge, facing away from the tower. Lie back, ensuring head is fully supported. Place one foot on the center of the squat stand. Leg is extended but knee not locked. Place the opposite hip in maximum flexion by holding the knee to the chest. Exercise Description: Lower the glideboard 330 by flexing the active knee. Push off forcefully against the squat stand, causing the glideboard 330 to move up the rails and the foot to clear the squat stand. Land softly with knee slightly flexed and explode back up the rails. Repeat for the desired number of repetitions then change legs. Teaching Tips: Be aware of degree of knee flexion, always maintaining a pain-free range of motion. Ensure the knee tracks over the foot throughout the movement. Keep inactive knee held towards chest to stabilize the hip and allow the lumbar spine to maintain flexion. Relax the head, neck and shoulders. Use caution during this exercise: progress from a lesser to greater degree of clearance. Repetitions: 12-15 times. Sets: 2-4. Safety Aspects: Do not allow the glideboard 330 to hit the tower at the top of the movement. Push only hard enough so the foot leaves the squat stand. For self-assessment and security purposes have client watch alignment and foot placement on the squat stand.

Joint Complex: Knee. Stage: Dynamic. Exercise Name and Number: Bilateral Plyometric Squat—6/14. Pulley Pin Placement: N/A. Incline Guideline 3-6. Starting Position: Upright Supine—Push the glideboard 330 halfway up the rails. Straddle the glideboard 330 and sit at the bottom edge, facing away from the tower. Lie back, ensuring head is fully supported. Place feet on the squat stand, in direct alignment with the hip joints. Legs are extended but knees not locked. Exercise Description: Lower the glideboard 330 by flexing the knees. Push off forcefully against the squat stand, causing the glideboard 330 to move up the rails and the feet to clear the squat stand. Land softly with knees slightly flexed and explode back up the rails. Teaching Tips: Be aware of degree of knee flexion, always maintaining a pain-free range of motion. Ensure the knees track over the feet throughout the movement. Maintain the lumbar spine in flexion throughout the movement. Relax the head, neck and shoulders. Use caution during this exercise: progress from a lesser to greater degree of clearance. Repetitions: 12-15 times. Sets: 2-4. Safety Aspects: Do not allow the glideboard 330 to hit the tower at the top of the movement. Push only hard enough so the feet leave the squat stand. Rest hands on the sides of the glideboard 330 or cross arms over torso. Do not reach underneath the glideboard 330. For self-assessment and security purposes have client watch alignment and foot placement on the squat stand.

Joint Complex: Knee. Stage: Dynamic. Exercise Name and Number: Unilateral Plyometric Skiing—7/14. Pulley Pin Placement: N/A. Incline Guideline 3-6. Starting Position: Upright Supine—Push the glideboard 330 halfway up the rails. Straddle the glideboard 330 and sit at the bottom edge, facing away from the tower. Lie back, ensuring head is fully supported. Place one foot on the center of the squat stand. Leg is extended but knee not locked. Place the opposite hip in flexion and bring the knee toward the chest. Exercise Description: Lower the glideboard 330 by flexing the active knee. Push off forcefully against the squat stand, causing the glideboard 330 to move up the rails and the foot to clear the squat stand. Internally rotate the hip to 45° and land softly with knee slightly flexed. Explode back up the rails, externally rotate the hip to 45° and land softly with knee slightly flexed. Repeat the sequence of alternating internal and external rotation for the desired number of repetitions then change legs. Teaching Tips: Be aware of degree of knee flexion, always maintaining a pain-free range of motion. Ensure alignment between the hip, knee and foot throughout the movement. Keep inactive knee held towards chest to stabilize the hip and allow the lumbar spine to maintain flexion. Relax the head, neck and shoulders. Use caution during this exercise: progress from a lesser to greater degree of clearance. Repetitions: 12-15 times. Sets: 2-4. Safety Aspects: Do not allow the glideboard 330 to hit the tower at the top of the movement. Push only hard enough so the foot leaves the squat stand. For self-assessment and security purposes have client watch alignment and foot placement on the squat stand.

Joint Complex: Knee. Stage: Dynamic. Exercise Name and Number: Bilateral Plyometric Skiing—8/14. Pulley Pin Placement: N/A. Incline Guideline 3-6. Starting Position:

Upright Supine—Push the glideboard 330 halfway up the rails. Straddle the glideboard 330 and sit at the bottom edge, facing away from the tower. Lie back, ensuring head is fully supported. Place feet on the squat stand, with knees and feet together. Legs are extended but knees not locked. Exercise Description: Lower the glideboard 330 by flexing the knees. Push off forcefully against the squat stand, causing the glideboard 330 to move up the rails and the feet to clear the squat stand. Rotate the hips to 45° and land softly with knees slightly flexed. Explode back up the rails, rotate the hips 450 to the other side and land softly with knees slightly flexed. Repeat the sequence of alternating sides, as in a skiing motion, for the desired number of repetitions. Teaching Tips: Be aware of degree of knee flexion, always maintaining a pain-free range of motion. Ensure alignment of the hips, knees and feet throughout the movement. Maintain the lumbar spine in flexion throughout the movement. Note: Bilateral plyometric skiing requires a greater degree of core stability to maintain this position. Relax the head, neck and shoulders. Use caution during this exercise: progress from a lesser to greater degree of clearance. Repetitions: 12-15 times. Sets: 2-4. Safety Aspects: Do not allow the glideboard 330 to hit the tower at the top of the movement. Push only hard enough so the feet leave the squat stand. Rest hands on the sides of the glideboard 330 or cross arms over torso. Do not reach underneath the glideboard 330. For self-assessment and security purposes have client watch alignment and foot placement on the squat stand.

Joint Complex: Knee Stage: Dynamic. Exercise Name and Number: Side-lying Single Leg Squat—9/14. Pulley Pin Placement: N/A. Incline Guideline 3-6. Starting Position: Side lying—Push the glideboard 330 halfway up the rails and lie sideways with buttocks toward the bottom edge. Place the foot of the top leg on the squat stand, forward of the torso. Bend bottom leg to 90° and allow it to rest on the glideboard 330, under the extended leg. The head is supported and secured by the bottom arm. Exercise Description: Lower the glideboard 330 by flexing the knee. Return to starting position with control. Repeat for the desired number of repetitions then change sides. Teaching Tips: Be aware of degree of knee flexion, always maintaining a pain free range of motion. Ensure alignment of the hips, knees and feet throughout the movement. Allow the hip to flex and extend naturally. Relax the head, neck and shoulders. Repetitions: 12-15 times. Sets: 2-4. Safety Aspects: Stabilize trunk throughout the movement.

Joint Complex: Knee. Stage: Dynamic. Exercise Name and Number: Quadraped—10/14. Pulley Pin Placement: N/A. Incline Guideline 2-6. Starting Position: Push the glideboard 330 halfway up the rails. From a straddle position facing the tower, rest the elbows and forearms toward the top edge of the glideboard 330. Place one foot toward the top of the squat stand with leg extended. While maintaining glideboard 330 position, place opposite knee on the glideboard 330, directly beneath the hip. Exercise Description: While maintaining the spine in a neutral or pain-free position, lower the glideboard 330 by flexing the knee of the extended leg. Return to starting position with control. Repeat for desired number of repetitions then change legs. Teaching Tips: Avoid rotation of the lumbar spine. Keep elbows directly below the shoulders. Avoid any movement of inactive hip and knee. Maintain the spine in a neutral or pain free position. Repetitions: 12-15 times. Sets: 2-4. Safety Aspects: Be aware of placement of foot on squat stand to ensure correct alignment.

Joint Complex: Knee. Stage: Dynamic. Exercise Name and Number: Triped—11/14. Pulley Pin Placement: N/A. Incline Guideline 2-6. Starting Position: Push the glideboard 330 halfway up the rails. From a straddle position facing the tower, rest the elbows and forearms toward the top edge of the glideboard 330. Place one foot toward the top of the squat stand with leg extended. While maintaining glideboard 330 position, place opposite knee on the glideboard 330, directly beneath the hip. Exercise Description: While maintaining the spine in a neutral or pain-free position, lift the inactive knee off the glideboard 330 and hold. Lower the glideboard 330 by flexing the knee of the extended leg. Return to starting position with control. Repeat for desired number of repetitions then change legs. Teaching Tips: Avoid rotation of the lumbar spine. Keep elbows directly below the shoulders. Avoid any movement of inactive hip and knee. Maintain the spine in a neutral or pain free position. Repetitions: 12-15 times. Sets: 2-4. Safety Aspects: This exercise is very difficult. Be aware of intensity placed on shoulders and active knee. Be aware of placement of foot on squat stand to ensure correct alignment.

Joint Complex: Knee. Stage: Dynamic. Exercise Name and Number: Seated Hamstring Curl—12/14. Pulley Pin Placement: N/A. Incline Guideline 1-4. Starting Position: Backwards Seated—Straddle the rails and sit at the top edge of the glideboard 330, facing the tower. Once body weight is fully supported by the glideboard 330, secure feet into the adjustable foot holder and extend legs, keeping knees slightly flexed. Exercise Description: While maintaining the spine in a neutral or pain-free position, use the heels to pull the glideboard 330 up the rails, allowing the knees to flex through a pain-free range of motion. Return to starting position with control. Teaching Tips: Ensure that middle of patellae align with middle of the feet throughout the motion. Be aware of knee flexion: maintain alignment and flex through pain-free range of motion. Repetitions: 12-15 times. Sets: 2-4. Variation: On Elbows—Straddle the rails and sit at the top edge of the glideboard 330, facing the tower. Once body weight is fully supported by the glideboard 330, secure feet into the adjustable foot holder and extend legs with knees slightly flexed. Lie back on the glideboard 330 and rest upper body on the elbows, with shoulders in extended position. (If one cannot rest on elbows, place hands back with elbows bent and back is mostly on glideboard 330) Inverted—Straddle the rails and sit at the top edge of the glideboard 330, facing the tower. Once body weight is fully supported by the glideboard 330, secure feet into the adjustable foot holder and extend legs with knees slightly flexed. Lie back on the glideboard 330 with head fully supported and chin tucked under. Maintain lumbar spine in flexion throughout the exercise.

Joint Complex: Knee. Stage: Dynamic. Exercise Name and Number: Reverse Lunge—13/14. Pulley Pin Placement: N/A. Incline Guideline 1-2. Starting Position: With the folding squat stand removed, stand at the bottom end of the exercise device 100, facing away from the tower. Place the ball of one foot on the bottom edge of the glideboard 330 with the heel of the active leg near the base, toes pointed forward. Exercise Description: Push the glideboard 330 up the rails while performing a single leg, reverse lunge with the active leg. Return to the starting position with control. Repeat for the desired number of repetitions then change legs. Teaching Tips: Avoid rotation of the pelvis. Maintain spine in a neutral or pain-free position. Be aware of degree of knee flexion, always maintaining a pain-free range of motion. Ensure alignment of the hip, knee and foot throughout the movement. If necessary, have client use extended arms for balance assistance. Repetitions: 12-15 times. Sets: 2-4. Safety Aspects: Avoid hyper-extension of the rear hip.

Joint Complex: Knee. Stage: Dynamic. Exercise Name and Number: Lateral Lunge—14/14. Pulley Pin Placement: N/A. Incline Guideline 1-2. Starting Position: With the folding squat stand removed, stand at the bottom end of the exercise device 100, facing sideways. Place the foot that is closest to the base on the bottom edge of the glideboard 330. Externally rotate the opposite leg to 45° from the base. Exercise Description: Push the glideboard 330 up the rails while performing a single leg, lateral lunge with the active leg. Return to starting position with control. Repeat for the desired number of repetitions then change legs. Teaching Tips: Avoid rotation of the pelvis. Maintain spine in a neutral or pain-free position. Be aware of degree of knee flexion, always maintaining a pain-free range of motion. Ensure alignment of the hip, knee and foot throughout the movement. If necessary, have client use extended arms for balance assistance. Repetitions: 12-15 times. Sets: 2-4. Safety Aspects: Avoid over-stretching the inner thigh.

CONDITIONING

SPINE

The following is an exemplary order of exercises and steps for CONDITIONING for the SPINE using the exercise device 100: 1; Squat; 2. Pull Up; 3. Pullover Triceps Extension; 4. Inverted Biceps Curl; 5. Bi-lateral Shoulder Abduction; 6. Supine Fly. Each of these exercises is described in more detail below.

Joint Complex: Spine. Stage: Conditioning. Exercise Name and Number: Squat—1/6. Pulley Pin Placement: N/A. Incline Guideline 3-6. Starting Position: Upright Supine—Push the glideboard 330 halfway up the rails. Straddle the glideboard 330 and sit at the bottom edge, facing away from the tower. Lie back with head resting on glideboard 330, legs extended but knees not locked, feet placed against telescoping squat stand in alignment directly under hip joints. Exercise Description: While maintaining the spine in a neutral or pain free position, lower the glideboard 330 by flexing the knees. Return to the starting position with control. Teaching Tips: Be aware of degree of knee flexion, always maintaining a pain-free range of motion. Ensure that middle of patellae align with middle of the feet throughout the motion. Relax the head, neck and shoulders. Maintain the spine in a neutral or pain-free position throughout the exercise. Repetitions: 12-15 times. Sets: 2-4. Safety Aspects: Do not lock knees at the top of the movement.

Joint Complex: Spine. Stage: Conditioning. Exercise Name and Number: Pull Up—2/6. Pulley Pin Placement: N/A. Incline Guideline 3-6. Starting Position: With the LAT bars in the pull up position, push the glideboard 330 halfway up the rails. Lie prone with chest near the top edge of the glideboard 330, with neutral spinal curvature. Grasp the LAT bars, palms facing down and arms extended. Bend the knees to ensure feet do not hit the squat stand. Exercise Description: While maintaining the spine in a neutral or pain free position, pull the glideboard 330 up the rails until hands are level with shoulders. Allow shoulders to move through full range of motion, from elevation through to depression. Lower the glideboard 330 back down the rails until arms are fully extended. Teaching Tips: Initiate pull up with scapula depression, followed by arm movement. Ensure sternum maintains contact with the glideboard 330. Maintain neutral or pain-free spinal curvature throughout the exercise. Cue client to keep the shoulders away from the ears. Avoid hyperextension of the lumbar spine. Repetitions: 12-15 times. Sets: 2-4. Safety Aspects: Avoid hyperextension of the cervical spine.

Joint Complex: Spine. Stage: Conditioning. Exercise Name and Number: Pullover Triceps Extensions—3/6. Pulley Pin Placement: 2. Incline Guideline 2-4. Starting Position: Upright Supine—Grasp handles and pull the glideboard 330 halfway up the rails. Straddle the glideboard 330 and sit at the bottom edge facing away from the tower. Lie back, ensuring head is fully supported and chin tucked under. Place both feet on the bottom edge of the glideboard 330, with arms extended overhead toward the pulley. Exercise Description: Move the glideboard 330 up the rails by flexing the elbows and pulling the handles toward the torso. Position the upper arms close to the rib cage, palms facing up with elbows flexed. Keeping elbows stationary, press down on the handles until arms are fully extended, next to the thighs. Return to starting position with control. Teaching Tips: Maintain lumbar spine in a flexed position. Maintain neutral wrists. Repetitions: 12-15 times. Sets: 2-4. Safety Aspects: Do not lock the elbows out at the bottom of the press. Do not raise the head during movement.

Joint Complex: Spine. Stage: Conditioning. Exercise Name and Number: Inverted Biceps Curl—4/6. Pulley Pin Placement: 1 or 6. Incline Guideline 2-4. Starting Position: Inverted Supine—Grasp handles and pull the glideboard 330 halfway up the rails. Straddle the glideboard 330 and sit at the top edge. Lie back, ensuring head is fully supported. Place both feet on the top edge of the glideboard 330. Arms are extended, parallel to the torso, palms facing up. Exercise Description: Pull the glideboard 330 up the rails by curling the handles up toward the shoulders. Return to starting position with control. Teaching Tips: Maintain the spine in a neutral or pain free position. Pause briefly at the top of the curl, focusing on the biceps muscles. Maintain neutral wrists. If the glideboard 330 contacts the top or bottom of the rails, adjust body position. Repetitions: 12-15 times. Sets: 2-4. Safety Aspects: Ensure head is fully supported by the glideboard 330, placing pillow or towel behind head if neck is hyper-extended.

Joint Complex: Spine. Stage: Conditioning. Exercise Name and Number: Bi-lateral Shoulder Abduction—5/6. Pulley Pin Placement: 2 or 5 Incline Guideline 2-4. Starting Position: Inverted Supine—Grasp handles and pull the glideboard 330 halfway up the rails. Straddle the glideboard 330 and sit at the top edge. Lie back, ensuring head is fully supported. Place both feet on the top edge of the glideboard 330 with arms extended along the torso, palms facing in. Exercise Description: Pull the glideboard 330 up the rails by bringing the arms away from the hips, up to shoulder height. Return to starting position with control. Teaching Tips: Keep arms straight with a slight flexion of the elbow throughout the movement. If discomfort is felt in the shoulders, stop just short of shoulder height or within a pain free range of motion. Maintain position of the elbows above the glideboard 330. If the glideboard 330 contacts the top or bottom of the rails, adjust body position. Maintain neutral wrists. Maintain the spine in neutral or pain free position. Repetitions: 12-15 times. Sets: 2-4. Safety Aspects: Do not raise the handles above shoulder level. Ensure head is fully supported by the glideboard 330. Avoid excessive shoulder depression and elevation during the movement.

Joint Complex: Spine. Stage: Conditioning. Exercise Name and Number: Supine Fly—6/6. Pulley Pin Placement: 5. Incline Guideline 2-4. Starting Position: Upright Supine—Grasp handles and pull the glideboard 330 halfway up the rails. Straddle the glideboard 330 and sit at the bottom edge facing away from the tower. Lie back, ensuring head is fully supported and chin tucked under. Place both feet on the bottom edge of the glideboard 330, with arms extended above the torso, near the knees. Palms face in. Exercise Description: Move the glideboard 330 down the rails by performing abduction of the shoulders and allowing arms to stretch out and up, handles' moving toward the tower in a wide arc movement. Elbows stay slightly flexed throughout the exercise and do not move past shoulder height. Return to starting position with control. Teaching Tips: Maintain lumbar spine in a flexed position. Maintain neutral wrists. Repetitions: 12-15 times. Sets: 2-4. Safety Aspects: Do not raise the head during movement. Move slowly and with control throughout the exercise.

CONDITIONING

SHOULDER

The following is an exemplary order of exercises and steps for CONDITIONING for the SHOULDER using the exercise device 100: 1. Squat; 2. Leg Curl; 3. Inverted Abdominal Crunch; 4. Muslin; 5. Biceps Curl; 6. Triceps Press. Each of these exercises is described in more detail below.

Joint Complex: Shoulder. Stage: Conditioning. Exercise Name and Number: Squat—1/6. Pulley Pin Placement: N/A. Incline Guideline 3-6. Starting Position: Upright Supine—Push the glideboard 330 halfway up the rails. Straddle the glideboard 330 and sit at the bottom edge, facing away from the tower. Lie back with head resting on glideboard 330, legs extended but knees not locked, feet placed against telescoping squat stand in alignment directly under hip joints. Exercise Description: While maintaining the spine in a neutral or pain-free position, lower the glideboard 330 by flexing the knees. Return to the starting position with control. Teaching Tips: Be aware of degree of knee flexion, always maintaining a pain-free range of motion. Ensure that middle of patellae align with middle of the feet throughout the motion. Relax the head, neck and shoulders. Maintain the spine in a neutral or pain-free position throughout the exercise. Repetitions: 12-15 times. Sets: 2-4. Safety Aspects: Do not lock knees at the top of the movement.

Joint Complex: Shoulder. Stage: Conditioning. Exercise Name and Number: Leg Curl—2/6. Pulley Pin Placement: N/A. Incline Guideline 2-4. Starting Position: Inverted—Straddle the rails and sit at the top edge of the glideboard 330, facing the tower. Once body weight is fully supported by the glideboard 330, secure feet into the adjustable foot holder and extend legs with knees slightly flexed. Lie back on the glideboard 330 with head fully supported and chin tucked under. Maintain lumbar spine in flexion throughout the exercise. Exercise Description: While maintaining the spine in a neutral or pain-free position, use the heels to pull the glideboard 330 up the rails, allowing the knees to flex through a pain-free range of motion. Return to starting position with control. Teaching Tips: Ensure that middle of patellae align with middle of the feet throughout the motion. Be aware of knee flexion: maintain alignment and flex through pain-free range of motion. Repetitions: 12-15 times. Sets: 2-4.

Joint Complex: Shoulder. Stage: Conditioning. Exercise Name and Number: Inverted Abdominal Crunch—3/6. Pulley Pin Placement: N/A. Incline Guideline 1-4. Starting Position: Inverted Supine—Push the glideboard 330 halfway up the rails. Straddle the rails and sit at the top edge of the glideboard 330, facing the tower. Once body weight is fully supported by the glideboard 330, secure feet into the adjustable foot holder and extend legs. Lie back on the glideboard 330 with head fully supported and chin tucked under. Place hands behind the head or crossed over the chest. Using heels, pull the glideboard 330 up the rails by flexing the knees to a 90° angle. Exercise Description: While maintaining bent leg position, raise head and shoulder blades off the glideboard 330 by contracting the abdominal muscles. Return to starting position with control. Teaching Tips: Keep tension on the abdominals throughout the entire movement. Maintain the spine in a neutral or pain free position. If the movement is too difficult, place arms across the chest or reach arms to outer thighs. Repetitions: 12-15 times. Sets: 2-4. Safety Aspects: If hand placement is behind the head, do not allow client to pull excessively on the head.

Joint Complex: Shoulder. Stage: Conditioning. Exercise Name and Number: Muslin—4/6. Pulley Pin Placement: N/A. Incline Guideline 2-3. Starting Position: Kneeling Backwards—With glideboard 330 resting at the base, place hands, knuckles down, on top to stabilize movement. Kneel in the middle of the glideboard 330 facing the tower, sit back on the heels. Place hands, palms up, behind the back and resting on the lumbar spine. Lean forward, resting chest and trunk on thighs. Exercise Description: While maintaining the lumbar position, lift the ribcage off the thighs by extending the cervical and thoracic spine. Movement should begin with cervical spine and articulate into the thoracic spine. Teaching Tips: Initiate the movement by slightly raising the head. Avoid hyperextension of all spinal sections. Keep lumbar movement to a minimum. End of the movement occurs when ribcage and trunk lose contact with the thighs. Repetitions: 12-15 times. Sets: 2-4.

Joint Complex: Shoulder. Stage: Conditioning. Exercise Name and Number: Biceps Curl—5/6. Pulley Pin Placement: 1. Incline Guideline 3-6. Starting Position: Backwards Seated—Grasp handles and pull the glideboard 330 halfway up the rails. Straddle the rails and sit toward the top edge of the glideboard 330, facing the tower. Position the upper arms in tight by the torso, palms facing up. Extend arms directly toward the pulleys with minimal shoulder flexion. Lift feet off the floor. Exercise Description: Pull the glideboard 330 up the rails by curling the handles up toward the shoulders, keeping elbows stationary. Return to the starting position with control. Teaching Tips: Keep upper arms close to the torso and stationary. Maintain upright, neutral or pain-free posture. Maintain neutral wrists. Repetitions: 12-15 times. Sets: 2-4. Safety Aspects: Avoid movement at the shoulder throughout the exercise. Avoid torso movement in the saggital plane.

Joint Complex: Shoulder. Stage: Conditioning. Exercise Name and Number: Triceps Press—6/6. Pulley Pin Placement: 3. Incline Guideline 2-4. Starting Position: Upright Supine—Grasp handles and pull the glideboard 330 halfway up the rails. Straddle the glideboard 330 and sit at the bottom edge facing away from the tower. Lie back, ensuring head is fully supported. Place both feet on the bottom edge of the glideboard 330. Position the upper arms in tight by the torso, palms facing up with elbows flexed. Exercise Description: Keeping elbows stationary, press down on the handles until arms are fully extended next to the thighs. Lower the glideboard 330 back down the rails by bringing the handles back to the starting position. Teaching Tips: Maintain the upper arms stationary and close to the torso throughout the exercise. Maintain neutral wrists. Repetitions: 12-15 times. Sets: 2-4. Safety Aspects: Avoid movement at the shoulder throughout the exercise. Contract the abdominals throughout exercise to maintain the spine in a neutral or pain free position. Do not lock the elbows at the bottom of the press. Do not raise head during movement.

CONDITIONING

KNEE

The following is an exemplary order of exercises and steps for CONDITIONING for the KNEE using the exercise device 100: 1. Pull Up; 2. Row with Trunk Flexion and Extension; 3. Chest Press; 4. Pullover Crunch; 5. Triceps Press; 6. Biceps Curl. Each of these exercises is described in more detail below.

Joint Complex: Knee. Stage: Conditioning. Exercise Name and Number: Pull Up—1/6. Pulley Pin Placement: N/A. Incline Guideline 3-6. Starting Position: With the LAT bars in the pull up position, push the glideboard 330 halfway up the rails. Lie prone with chest near the top edge of the glideboard 330, with neutral spinal curvature. Grasp the LAT bars, palms facing down and arms extended. Bend the knees to ensure feet do not hit the squat stand. Exercise Description: While maintaining the spine in a neutral or pain-free position, pull the glideboard 330 up the rails until hands are level with shoulders. Allow shoulders to move through full range of motion, from elevation through to depression. Lower the glideboard 330 back down the rails until arms are fully extended. Teaching Tips: Initiate pull up with scapula depression, followed by arm movement. Ensure sternum maintains contact with the glideboard 330. Maintain neutral or pain-free spinal curvature throughout the exercise. Cue client to keep the shoulders away from the ears. Avoid hyperextension of the lumbar spine. Repetitions: 12-15 times. Sets: 2-4. Safety Aspects: Avoid hyperextension of the cervical spine.

Joint Complex: Knee. Stage: Conditioning. Exercise Name and Number: Row with Trunk Flexion and Extension—2/6. Pulley Pin Placement: 2. Incline Guideline 2-4. Starting Position: Grasp the handles and pull the glideboard 330 halfway up the rails. Straddle the glideboard 330 facing the tower and sit at the bottom edge of the glideboard 330. Place feet on the glideboard 330 with knees flexed. Hold the handles with arms extended toward the pulleys and palms facing in. Lean forward and rest abdominals and chest against the thighs. Exercise Description: Move the glideboard 330 up the rails by flexing and leading with the elbows, pulling the handles toward the chest. While maintaining the abdominals in contact with the thighs (lumbar extension), move into extension of the thoracic spine. Allow chest to lose contact with the thighs. Return to starting position with control. Teaching Tips: Maintain lumbar extension throughout the exercise. Avoid any movement of the hip. Maintain a flexed position throughout the exercise. Repetitions: 12-15 times. Sets: 2-4.

Joint Complex: Knee. Stage: Conditioning. Exercise Name and Number: Chest Press—3/6. Pulley Pin Placement: 2 or 3. Incline Guideline 3-6. Starting Position: Forward Seated—Grasp handles and pull the glideboard 330 halfway up the rails. Straddle the rails and sit toward the top edge of the glideboard 330, facing away from the tower. Place legs in a comfortable position. Bring hands to the side of the torso, at chest level. Cables should be inside forearm. Exercise Description: Slide the glideboard 330 up the rails by pressing the handles straight out to chest level until arms are fully extended. Return to starting position with control. Teaching Tips: Bring the handles together at the top of the movement to maximize contraction of the pectoral muscles. Maintain the spine in an upright, neutral or pain free position. Repetitions: 12-15 times. Sets: 2-4. Safety Aspects: Avoid flexion or extension of the torso. Avoid hyperextension during horizontal abduction of the shoulder. Avoid excessive shoulder protraction and retraction during the movement.

Joint Complex: Knee. Stage: Conditioning. Exercise Name and Number: Pullover Crunch—4/6. Pulley Pin Placement: 2. Incline Guideline 2-4. Starting Position: Grasp handles and pull the glideboard 330 halfway up the rails. Straddle the glideboard 330 and sit at the bottom edge. Lie back, ensuring the head is fully supported. Bend knees and rest the feet on the bottom edge of the glideboard 330. Arms are extended overhead toward the tower, with palms facing up. Exercise Description: In an arc motion, bring the handles over the chest toward the outer thighs. Simultaneously raise the head and shoulders off the glideboard 330 by contracting the abdominal muscles. Pause at the top of the movement before returning to the starting position with control. Teaching Tips: Minimize cervical flexion. Keep palms facing forward throughout the exercise. Maintain neutral wrists. Keep elbows slightly bent throughout the exercise. Repetitions: 12-15 times. Sets: 2-4.

Joint Complex: Knee. Stage: Conditioning. Exercise Name and Number: Triceps Press—5/6. Pulley Pin Placement: 2. Incline Guideline 2-4. Starting Position: Upright Supine—Grasp handles and pull the glideboard 330 halfway up the rails. Straddle the glideboard 330 and sit at the bottom edge facing away from the tower. Lie back, ensuring head is fully supported. Place both feet on the bottom edge of the glideboard 330. Position the upper arms in tight by the torso, palms facing up with elbows flexed. Exercise Description: Keeping elbows stationary, press down on the handles until arms are fully extended next to the thighs. Return to the starting position with control. Teaching Tips: Maintain the upper arms stationary and close to the torso throughout the exercise. Maintain neutral wrists. Maintain the spine in a neutral or pain free position. Repetitions: 12-15 times. Sets: 2-4. Safety Aspects: Avoid movement at the shoulder throughout the exercise. Do not lock the elbows at the bottom of the press. Do not raise head during movement.

Joint Complex: Knee. Stage: Conditioning. Exercise Name and Number: Biceps Curl—6/6. Pulley Pin Placement: 1. Incline Guideline 3-6. Starting Position: Backwards Seated—Grasp handles and pull the glideboard 330 halfway up the rails. Straddle the rails and sit toward the top edge of the glideboard 330, facing the tower. Extend arms directly toward the pulleys with palms facing up. Lift feet off the floor. Exercise Description: Pull the glideboard 330 up the rails by curling the handles up toward the shoulders, keeping elbows stationary. Return to the starting position with control. Teaching Tips: Maintain upright, neutral or pain free posture. Maintain neutral wrists. Repetitions: 12-15 times. Sets: 2-4. Safety Aspects: Avoid torso movement in the saggital plane. Avoid excessive shoulder protraction and depression during the exercise.

It will be apparent to those skilled in the art that various modifications and variations can be made in the collapsible exercise device 100 described above, features of the collapsible exercise device 100, the methods of using the exercise device 100, the methods of instruction using the exercise device, and other methods described herein without departing from the spirit or scope of the invention. Thus, it is intended that the present invention cover modifications and variations of this invention provided they come within the scope of the appended claims and their equivalents.

What is claimed is:

1. A method of using a collapsible exercise device, comprising:

providing a collapsible exercise device including a vertical support member, an adjustable incline having a first end and a second end, the first end of the adjustable incline pivotally coupled to, adjustably supported by, and vertically movable with respect to, the vertical support member for adjusting the incline of the adjustable incline, a user support platform movably attached to the adjustable incline, first and second combination pulley-support and pull-up bars each pivotally connected to the first end of the adjustable incline for movement between at least a substantially vertical position and a substantially non-vertical position, first and second pulleys movably connected to the first and second combination pulley-support and pull-up bars for movement of the pulleys to a desired location, and one or more cables extendable through first and second pulleys and connected to the user support platform for movement of the support platform along the adjustable incline through cable movement, wherein the exercise device is foldable such that the vertical support member and the adjustable incline are substantially parallel to each other when collapsed;

positioning the first end of the adjustable incline at a desired height with respect to the vertical support member so that the adjustable incline is at a desired inclination;

moving the first and second combination pulley-support and pull-up bars to a desired position;

moving the first and second pulleys connected to the first and second combination pulley-support and pull-up bars to a desired location;

moving the support platform along the adjustable incline through cable movement through the first and second pulleys on the combination pulley-support and pull-up bars.

2. The method of claim 1, wherein the first and second combination pulley-support and pull-up bars each have a trapezoidal configuration.

3. The method of claim 1, wherein the first and second pulleys each include a collar slidably attached to the combination pulley-support and pull-up bar and a pull pin carried by the collar for locking the pulley in position on the combination pulley-support and pull-up bar.

4. The method of claim 1, further comprising a folding squat platform pivotally and removably connected to the second end of the adjustable incline.

5. The method of claim 4, further including a squat stand telescopingly and removably engaged with the folding squat platform.

6. The method of claim 1, further comprising a push-up bar removably connected to the second end of the adjustable incline.

7. The method of claim 1, further comprising a padded foot support removably connected to the second end of the adjustable incline.

8. The method of claim 1, further comprising a dip bar assembly connected to the adjustable incline, and the dip bar assembly including a pair of dip bars movable between at least a retracted, out-of-the way position, and a non-retracted, ready-for-use position.

9. The method of claim 1, further comprising a foot support assembly pivotally connected to the adjustable incline, and the foot support assembly pivotable between at least a retracted, out-of-the way position, and a non-retracted, ready-for-use position.

10. The method of claim 1, wherein said one or more cables include a single cable with opposite ends, and handles each connected to the opposite ends of the single cable.

11. The method of claim 1, wherein the vertical support member includes a vertical support tower including a tower level track therein, the tower level tracks including multiple vertically spaced hooks, the first end of the adjustable incline being pivotally connected to, and adjustably supported by the hooks of the tower level track.

12. The method of claim 1, wherein the vertical support member includes an automatic lift mechanism including a driving mechanism, upper and lower pulley assemblies, at least one of which driven by the driving mechanism, and opposite vertical chains carried by the pulley, the adjustable incline coupled to the opposite vertical chains, and positioning the first end of the adjustable incline at a desired height includes moving the first end of the adjustable incline up and down with the automatic lift mechanism.

13. The method of claim 1, wherein the collapsible exercise device is used for personal training.

14. The method of claim 1, wherein the collapsible exercise device is used for group training.

15. The method of claim 1, wherein the collapsible exercise device is used for Pilates training.

16. The method of claim 1, wherein the collapsible exercise device is used for rehabilitation.

17. The method of claim 1, wherein positioning the first end of the adjustable incline at a desired height includes positioning the first end of the adjustable incline at a desired height level in accordance with a resistance chart indicating the effective weight for various height levels and body-weights.

* * * * *